US010556161B2

(12) United States Patent
Jertson et al.

(10) Patent No.: US 10,556,161 B2
(45) Date of Patent: Feb. 11, 2020

(54) ADJUSTABLE WEIGHT CLUB HEAD

(71) Applicant: KARSTEN MANUFACTURING CORPORATION, Phoenix, AZ (US)

(72) Inventors: Martin R. Jertson, Cave Creek, AZ (US); Ryan M. Stokke, Anthem, AZ (US); Xiaojian Chen, Phoenix, AZ (US); Cory S. Bacon, Scottsdale, AZ (US); Jeremy Pope, Phoenix, AZ (US); Daniel K. Lee, Chandler, AZ (US); David A. Higdon, Phoenix, AZ (US); Eric J. Morales, Laveen, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/185,923

(22) Filed: Nov. 9, 2018

(65) Prior Publication Data

US 2019/0083862 A1 Mar. 21, 2019

Related U.S. Application Data

(63) Continuation-in-part of application No. PCT/US2018/000181, filed on Aug. 15, 2018, and a continuation-in-part of application No. PCT/US2017/034586, filed on May 25, 2017.

(60) Provisional application No. 62/628,803, filed on Feb. 9, 2018, provisional application No. 62/545,770, filed on Aug. 15, 2017, provisional application No. 62/484,256, filed on Apr. 11, 2017, provisional application No. 62/472,742, filed on Mar. 17, 2017, provisional application No. 62/456,724, filed on Feb. 9, 2017, provisional application No. 62/448,864, filed on Jan. 20, 2017, provisional application No. 62/425,553, filed on Nov. 22, 2016, provisional application No. 62/377,465, filed on Aug. 19, 2016, provisional application No. 62/357,907, filed on Jul. 1, 2016, provisional application No. 62/348,645, filed on Jun. 10, 2016, provisional application No.

(Continued)

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0412* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 3,419,275 A 12/1968 Winkleman
5,971,867 A 10/1999 Galy
6,015,354 A 1/2000 Ahn et al.

(Continued)

FOREIGN PATENT DOCUMENTS

JP 06238022 A * 8/1994

*Primary Examiner* — Alvin A Hunter

(57) ABSTRACT

Embodiments of golf club heads having adjustable weighting systems with a plurality of discrete attachment locations capable of receiving one or more weights are described herein. The golf club heads described herein provide user adjustability of club head center of gravity to adjust ball flight while maintaining a high moment of inertia and low and back center of gravity position.

15 Claims, 93 Drawing Sheets

Related U.S. Application Data

62/346,701, filed on Jun. 7, 2016, provisional application No. 62/341,542, filed on May 25, 2016.

(56) References Cited

U.S. PATENT DOCUMENTS 6,056,649 A 5/2000 Imai
6,146,287 A 11/2000 Rugge et al.
6,592,468 B2 7/2003 Vincent et al.
6,638,183 B2 10/2003 Takeda
6,860,818 B2 3/2005 Mahaffey et al.
6,988,960 B2 1/2006 Mahaffey et al.
7,004,852 B2 2/2006 Billings
7,070,514 B1 7/2006 Borunda
7,101,290 B2 9/2006 Tucker, Sr.
7,147,573 B2 * 12/2006 DiMarco ..... A63B 53/0466 473/324
7,153,220 B2 12/2006 Lo
7,166,041 B2 1/2007 Evans et al.
7,344,450 B2 3/2008 Billings
7,404,722 B2 7/2008 Ikeya et al.
7,404,772 B2 7/2008 Koide et al.
7,448,959 B2 11/2008 Blankenship et al.
7,452,286 B2 11/2008 Lin et al.
7,530,903 B2 5/2009 Imamoto et al.
7,549,935 B2 6/2009 Foster et al.
7,611,424 B2 11/2009 Nagai et al.
7,824,280 B2 11/2010 Yokota
7,871,334 B2 * 1/2011 Young ..... A63B 53/04 473/231
7,871,335 B2 * 1/2011 Young ..... A63B 53/04 473/231
7,938,741 B2 5/2011 Evans
7,967,699 B2 6/2011 Soracco
8,016,694 B2 9/2011 Llewellyn et al.
8,197,358 B1 6/2012 Watson et al.
8,206,243 B2 6/2012 Stites
8,262,506 B2 9/2012 Watson et al.
8,292,757 B2 10/2012 Soracco
8,298,096 B2 10/2012 Stites et al.
8,308,583 B2 * 11/2012 Morris ..... A63B 53/0487 473/335
8,376,878 B2 2/2013 Bennett et al.
8,409,031 B2 4/2013 Stites et al.
8,414,422 B2 4/2013 Peralta et al.
8,668,596 B2 3/2014 Cackett et al.
8,684,863 B2 4/2014 Bezilla et al.
8,696,491 B1 4/2014 Myers
8,702,533 B2 4/2014 Evans
8,708,838 B2 4/2014 Ferguson et al.
8,715,106 B1 5/2014 Seluga et al.
8,734,271 B2 5/2014 Beach et al.
8,747,253 B2 6/2014 Stites
8,753,225 B1 6/2014 Abbott et al.
8,753,226 B2 6/2014 Rice et al.
8,784,234 B2 7/2014 Lacey et al.
8,858,362 B1 10/2014 Leposky et al.
8,870,679 B2 10/2014 Oldknow
8,926,450 B2 1/2015 Takahashi et al.
9,033,813 B2 5/2015 Oldknow et al.
9,072,949 B2 7/2015 Stites et al.
9,095,753 B2 8/2015 Bezilla et al.
9,101,808 B2 8/2015 Stites et al.
9,108,090 B2 8/2015 Stites et al.
9,111,672 B2 8/2015 Fullerton et al.
9,168,438 B2 10/2015 Boyd
9,199,145 B1 12/2015 Myers
9,205,311 B2 12/2015 Stokke
9,205,312 B2 12/2015 Zimmerman et al.
9,211,453 B1 12/2015 Foster et al.
9,216,333 B2 12/2015 Bezilla et al.
9,238,162 B2 1/2016 Breier et al.
9,272,194 B2 3/2016 Oldknow
9,289,660 B1 3/2016 Myers
9,308,423 B1 4/2016 Tang et al.
9,333,404 B2 5/2016 Abbott et al.
9,375,618 B2 6/2016 Myers et al.
9,381,410 B2 7/2016 Golden et al.
9,387,377 B2 7/2016 Liang et al.
9,399,158 B2 7/2016 Parsons et al.
9,433,836 B2 9/2016 Breier et al.
9,452,327 B2 9/2016 Willett et al.
9,463,361 B2 10/2016 Goudarzi et al.
9,480,890 B2 11/2016 Matsunaga et al.
9,550,096 B2 1/2017 Parsons et al.
9,561,413 B2 2/2017 Nielson et al.
9,623,294 B1 4/2017 Kingston et al.
9,630,069 B2 4/2017 Foster et al.
9,636,556 B2 5/2017 Beck et al.
9,694,256 B2 7/2017 Myers et al.
9,700,764 B2 * 7/2017 Carter ..... A63B 53/0466
9,764,210 B2 9/2017 Curtis et al.
9,795,846 B2 10/2017 Sargent et al.
9,821,198 B2 11/2017 Stokke
9,908,013 B2 3/2018 Hettinger et al.
10,046,212 B2 8/2018 Sargent et al.
10,183,203 B1 * 1/2019 Yi ..... A63B 53/0466
2006/0058112 A1 3/2006 Haralason et al.
2006/0166754 A1 7/2006 Kang
2006/0178228 A1 * 8/2006 DiMarco ..... A63B 53/0466 473/334
2008/0020861 A1 1/2008 Adams et al.
2010/0075773 A1 3/2010 Casati, Jr.
2010/0331103 A1 12/2010 Takahashi et al.
2011/0028238 A1 2/2011 Boyd et al.
2011/0081986 A1 4/2011 Stites
2012/0233838 A1 9/2012 Swist
2012/0289360 A1 11/2012 Breier et al.
2013/0244808 A1 9/2013 Bennett et al.
2013/0344988 A1 12/2013 Hettinger et al.
2015/0038258 A1 2/2015 Beach et al.
2015/0126303 A1 5/2015 Roach et al.
2016/0067570 A1 3/2016 Larson
2016/0074720 A1 3/2016 Kline et al.
2016/0101330 A1 4/2016 Harrington et al.
2016/0279490 A1 9/2016 Onuki

* cited by examiner

ADJUSTABLE WEIGHT CLUB HEAD

CROSS REFERENCE TO RELATED APPLICATIONS

This is a continuation in part of PCT Appl. No. PCT/US2018/000181, filed on Aug. 15, 2018, which claims the benefit of U.S. Provisional Patent Appl. No. 62/545,770, filed on Aug. 15, 2017, and U.S. Provisional Patent Appl. No. 62/628,803, filed on Feb. 9, 2018. This further is a continuation in part of PCT Appl. No PCT/US2017/034586, filed on May 25, 2017, which claims the benefit of U.S. Provisional Patent Appl. No. 62/484,256, filed on Apr. 11, 2017, U.S. Provisional Patent Appl. No. 62/472,742, filed on Mar. 17, 2017, U.S. Provisional Patent Appl. No. 62/456,724, filed on Feb. 9, 2017, U.S. Provisional Patent Appl. No. 62/448,864, filed on Jan. 20, 2017, U.S. Provisional Patent Appl. No. 62/425,553, filed on Nov. 22, 2016, U.S. Provisional Patent Appl. No. 62/377,465, filed on Aug. 19, 2016, U.S. Provisional Patent Appl. No. 62/357,907, filed on Jul. 1, 2016, U.S. Provisional Patent Appl. No. 62/348,645, filed on Jun. 10, 2016, U.S. Provisional Patent Appl. No. 62/346,701, filed on Jun. 7, 2016, and U.S. Provisional Patent Appl. No. 62/341,542, filed on May 25, 2016. The contents of all of the above described applications are incorporated herein by reference in their entirety.

FIELD OF THE INVENTION

The present disclosure relates to a golf club head, and more specifically to a golf club head having an adjustable weighting system.

BACKGROUND

Various characteristics of a golf club can affect the performance of the golf club. For example, the center of gravity and the moment of inertia of the golf club head are characteristics that can affect performance.

The center of gravity and moment of inertia of the golf club head are functions of the distribution of mass of the golf club head. In particular, distributing mass of the club head to be closer to a sole portion of the club head, closer to a strike face of the club head, and/or closer to a toe portion and heel portion of the club head can alter the center of gravity and/or the moment of inertia of the club head. Altering the moment of inertia of the club head can in turn alter the forgiveness of the golf club, flight direction of the golf ball, and/or flight angle of the golf ball.

Many weighting systems in current golf club heads require bulky and complex internal structures that reduce club head moment of inertia and move the club head center of gravity up (toward the crown) and forward (toward the face). There is a need in the art for a club head that provides user adjustability of club head weighting and center of gravity position to affect ball flight (trajectory and/or spin), without negatively impacting moment of inertia or center of gravity position.

DETAILED DESCRIPTION

Figure 1:
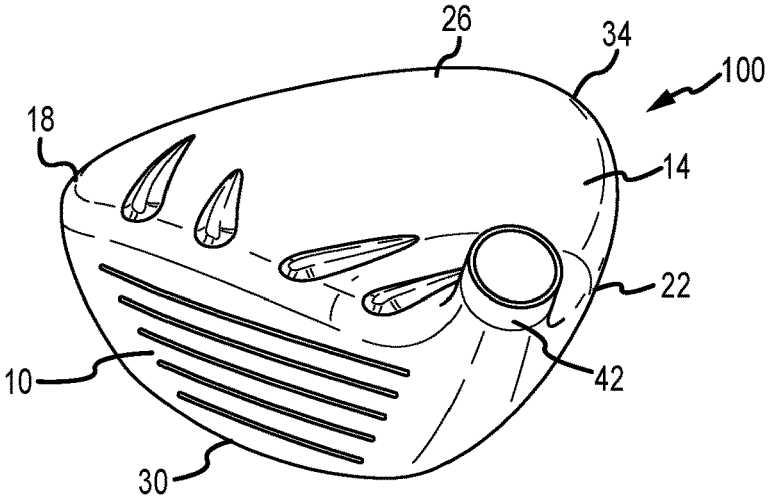
FIGS. 1-3 are perspective, front, and top views, respectively, of a golf club head having an x-axis, a y-axis, and a z-axis according to one embodiment.

Described herein are various embodiments of golf club heads having adjustable weighting systems. The adjustable weighting systems include a plurality of discrete attachment locations capable of receiving one or more weights. Each weight can be coupled to and shifted between any of the discrete attachment locations on the club head. Accordingly, the adjustable weighting system provides user adjustability of club head weighting and center of gravity position to change ball flight (i.e. ball spin or trajectory).

In many embodiments, the adjustable weighting systems described herein protrude from the external contour of the club head, or are minimally insert from the external contour of the club head. Further, in many embodiments the adjustable weighting systems described herein are positioned near the perimeter of the club head. The positioning of the adjustable weighting systems maximizes perimeter weighting and low and back weight positioning, thereby maximizing club head moment of inertia for forgiveness on off-center hits and positioning the club head center of gravity low and back to increase launch angle and reduce backspin. Accordingly, the golf club heads described herein provide user adjustability of club head center of gravity to adjust ball flight, while maintaining optimal design and performance characteristics (high moment of inertia and low and back center of gravity position).

Many embodiments described herein include adjustable weighting systems having one or more platforms, ledges, recesses or channels, without requiring significant internal structures that would adversely affect moment of inertia and head center of gravity position.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

For ease of discussion and understanding, and for purposes of description only, the following detailed description illustrates golf club heads 100, 110, 210, 310, 410, 510, 610, 710, 810, 910, 1010, 1110, 1210, 1310, 1410, 1510, 1610, 1710, 1810, 1910, 2010, 2110, 2210, 2310, 2410, 2510, 2610, 2710, 3010, 3210, 3310, 3410, 3510, 3610, 3710, 3810, 3910, 4010, 4110, 4210, 4310, 4410, 4510, 4610, 4710, 4810, 4910, 5010, 5110, 5210, 5310, 5410, 5510, 5610, 5710, 5810, 5910, 6010, 6110, 6210, 6310, 6410, 6510, 6610, 6710, 6810, 11010, 12010, and 13010 as woods. It should be appreciated that the woods are provided for purposes of illustration of one or more embodiments of the adjustable weighting systems as disclosed herein. However, the disclosed embodiments of the adjustable weighting systems can be used on any desired wood, iron, hybrid, or other golf club where adjustable weighting is desired. For example, the club head may include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter.

Figure 2:
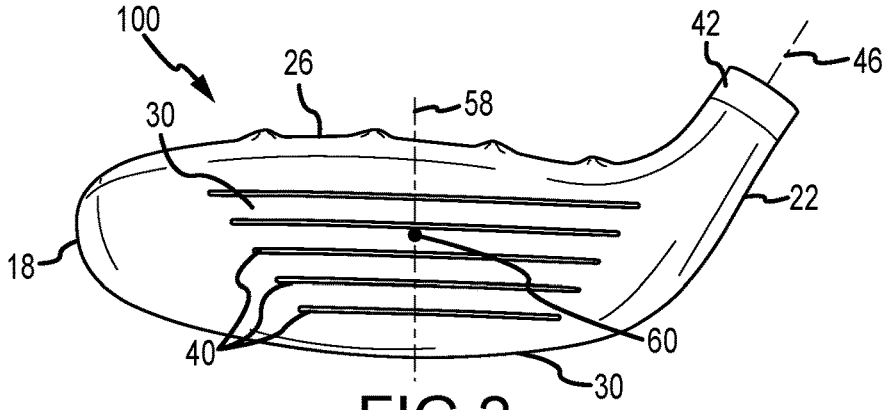
Figure 3:
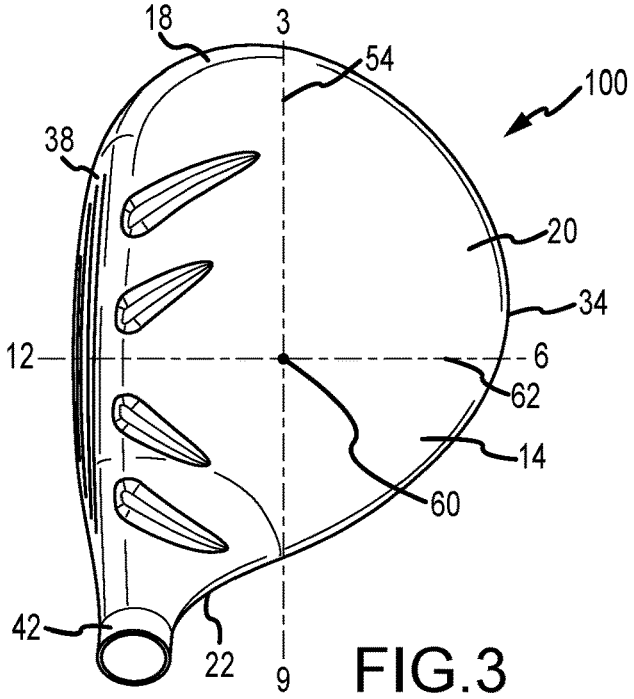

FIGS. 1-3 illustrate a golf club head 100. The golf club head 100 includes a body 14 having a toe or toe end 18 opposite a heel or heel end 22. The body 14 also includes a crown or top 26 opposite a sole or bottom 30 and a back or rear or back end 34 opposite a club face or face or strike face or strike plate 38. The club head further includes a perimeter or skirt or trailing edge 24 located at a junction or intersection between the crown 26 and the sole 30 extending from near the heel 22 to near the toe 18. The club head 100 further includes an adjustable weighting system. At least a portion of the adjustable weighting system can be positioned on the sole 30, the skirt 24, the heel 22, the toe 18, or any combination of the described locations.

The golf club head 100 also includes a hosel 42 having a hosel axis 46 (shown in FIG. 2) that extends through the center of the hosel 42. The hosel 42 is configured to receive a golf club shaft (not shown) that carries a grip (not shown). A golfer grasps the grip (not shown) while swinging the golf club.

In many embodiments, the golf club head 100 comprises a driver-type club head. In these embodiments, the loft angle of the club head 100 can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head 100 can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In some embodiments, the club head can comprise a fairway wood-type club head. In these embodiments, the loft angle of the club head 100 can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 100 can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. Further, in these embodiments, the volume of the club head 100 can be less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. For example, the volume of the club head can be approximately 300 cc-400 cc, approximately 325 cc-400 cc, approximately 350 cc-400 cc, approximately 250 cc-400 cc, approximately 250-350 cc, or approximately 275-375 cc.

In some embodiments, the club head can comprise a hybrid type club head. In these embodiments, the loft angle of the club head 100 can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head 100 can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees. Further, in these embodiments, the volume of the club head 100 can be less than approximately 200 cc, less than approximately 175 cc, less than approximately 150 cc, less than approximately 125 cc, less than approximately 100 cc, or less than approximately 75 cc. For example, the volume of the club head can be approximately 100 cc-150 cc, approximately 75 cc-150 cc, approximately 100 cc-125 cc, or approximately 75 cc-125 cc. In other embodiments, the golf club head 100 can comprise any type of golf club head.

A plurality of grooves or primary grooves 40 (shown in FIG. 2) are positioned on the club face 38. The strikeface 38 of the club head 100 defines a geometric center 140. In some embodiments, the geometric center 140 can be located at the geometric centerpoint of a strikeface perimeter, and at a midpoint of face height. In the same or other examples, the geometric center 140 also can be centered with respect to engineered impact zone, which can be defined by a region of grooves on the strikeface. As another approach, the geometric center of the strikeface can be located in accordance with the definition of a golf governing body such as the United States Golf Association (USGA). For example, the geometric center 140 of the strikeface 38 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipmen/testing/protocols/Procedure-For-Measuring-The-Flexibility-Of-A-Golf-Club-Head/) (the "Flexibility Procedure").

The club head 100 defines a loft plane 10102 tangent to the geometric center 140 of the strikeface 38. The club head 100 further defines a coordinate system having an origin located at the geometric center 140 of the strikeface 38. The coordinate system has an x' axis 10106, a y' axis 10104, and a z' axis 10108. The x' axis 10106 extends through the geometric center 140 of the strikeface 38 in a direction from the heel 22 to the toe 18 of the club head 100. The y' axis 10104 extends through the geometric center 140 of the strikeface 38 in a direction from the crown 26 to the sole 30 of the club head 100 and perpendicular to the x' axis 10106. The z' axis 10108 extends through the geometric center 140 of the strikeface 38 in a direction from the face 38 to the back end 34 of the club head 100 and is perpendicular to the x' axis 10106 and the y' axis 10104.

The coordinate system defines an x'y' plane 10124 extending through the x' axis 10106 and the y' axis 10104; an x'z' plane 10126 extending through the x' axis 10106 and the z' axis 10108; and a y'z' plane 10128 extending through the y' axis 10104 and the z' axis 10108, wherein the x'y' plane 10124, the x'z' plane 10126, and the y'z' plane 10128 are all perpendicular to one another and intersect at the origin of the coordinate system located at the geometric center 140 of the strikeface 38. The x'y' plane 10124 extends parallel to the hosel axis 46 and is positioned at an angle corresponding to the loft angle of the club head 100 from the loft plane 10102. Further, the x' axis 10106 is positioned at a 60 degree angle to the hosel axis 46 when viewed from a direction perpendicular to the x'y' plane 10124.

In these or other embodiments, the club head 100 can be viewed from a front view (FIG. 2) when the strikeface 38 is viewed from a direction perpendicular to the x'y' plane 10124. Further, in these or other embodiments, the club head 100 can be viewed from a side view or side cross-sectional view (FIG. 164) when the heel 22 is viewed from a direction perpendicular to the y'z' plane 10128.

Referring to FIGS. 2 and 3, the golf club head 100 further includes a center of gravity or CG 50 (shown in FIGS. 3, 164, and 165) that defines an origin of a coordinate system including an x-axis 54, a y-axis 58, and a z-axis 62. The y-axis 58 (shown in FIGS. 2 and 164) extends through the club head 100 center of gravity 50 from the crown or top 26 to the sole or bottom 30, is parallel to the hosel axis 46 when viewed from the side view, and is positioned at a 30 degree angle from the hosel axis 46 when viewed from a front view (FIG. 2). The x-axis 54 (shown in FIGS. 3 and 165) extends through the club head center of gravity 50 from the toe or toe end 18 to the heel or heel end 22, perpendicular to y-axis 58 when viewed from a front view and parallel to the x'y' plane 10124. The z-axis 62 (shown in FIGS. 3, 164, and 165) extends through the center of gravity 50 of the club head 100 from the club face 38 to the back end 34 and perpendicular to the x-axis 54 and the y-axis 58. The x-axis 54 extends through the head CG 50 from the toe or toe end 18 to the heel or heel end 22 and parallel to the x' axis 10106. The y-axis 58 extends through the head CG 50 from the crown or top 26 to the sole or bottom 30 parallel to the y' axis 10104. The z-axis 62 extends through the head CG 50 from the club face 38 to the back end 34 and parallel to the z' axis 10108.

Figure 164:
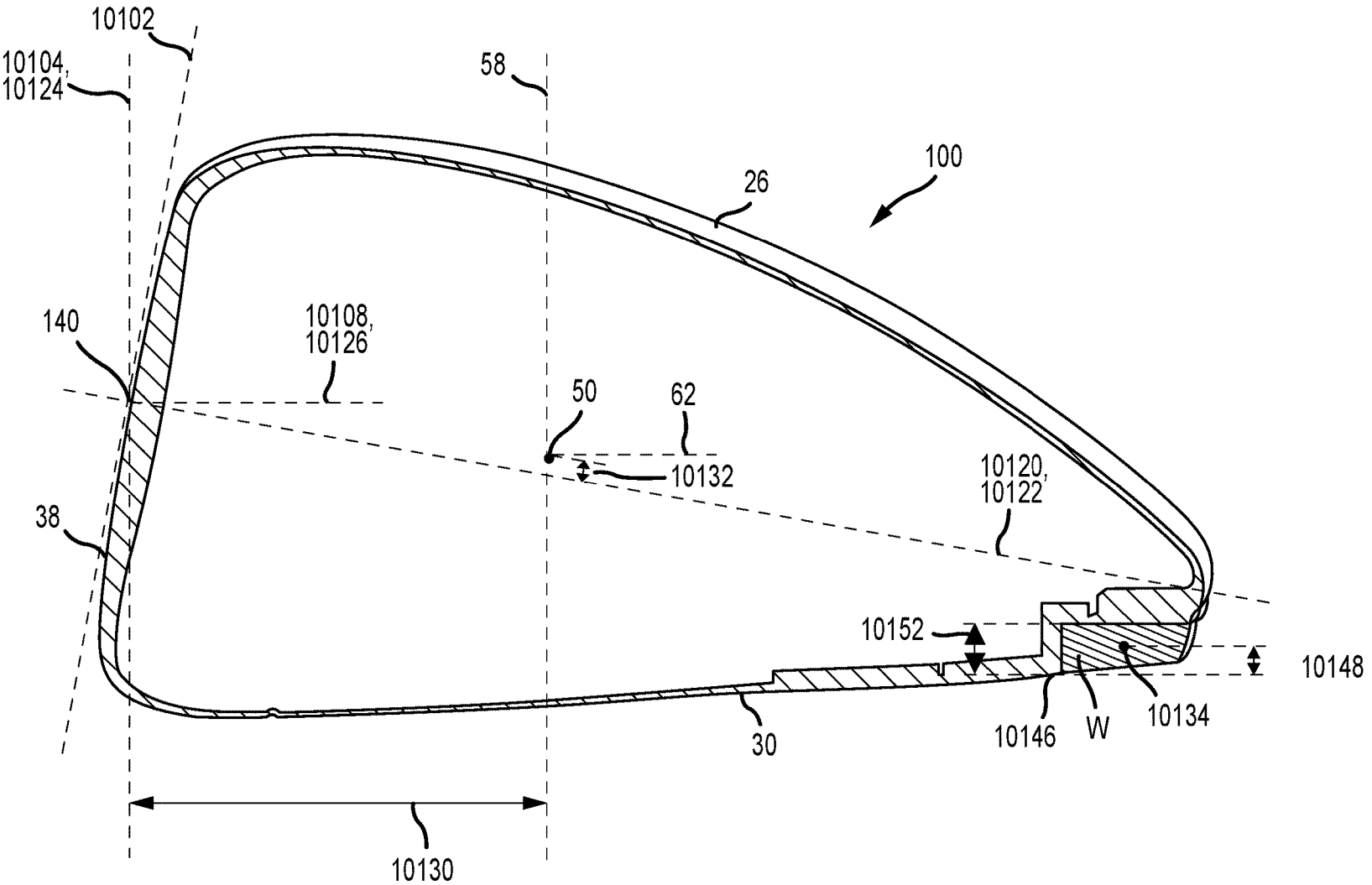
FIG. 164 is a side cross sectional view of the golf club head of FIGS. 1-3.
Figure 165:
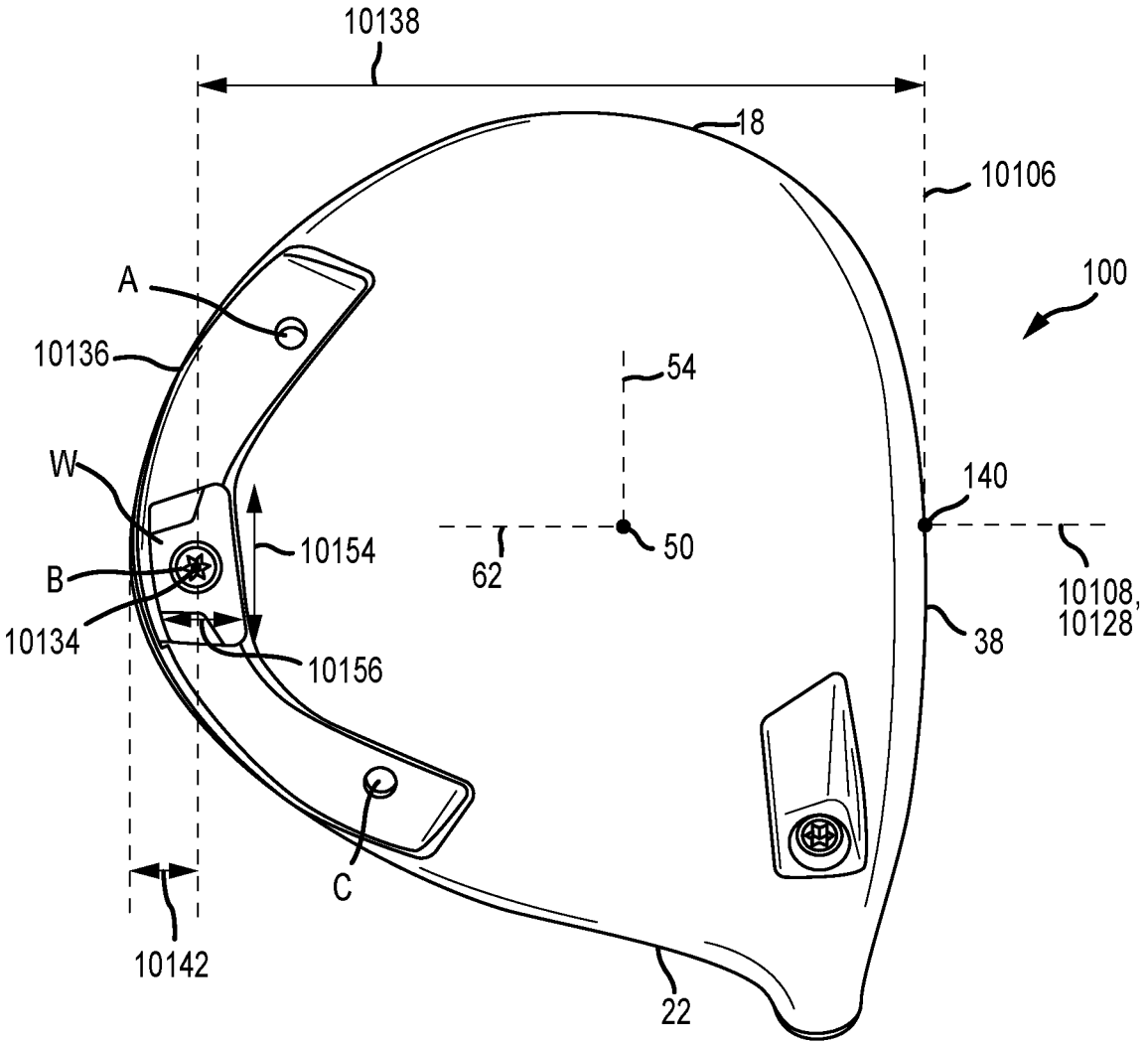
FIG. 165 is a bottom view of the golf club head of FIGS. 1-3.

As shown in FIG. 164, the club head 100 further comprises a head depth plane 10120 and a head depth axis 10122, wherein the head depth plane 10120 extends through the geometric center 140 of the strikeface 38, perpendicular to the loft plane 10102, in a direction from the heel 22 to the toe 18 of the club head 100, and the head depth axis 10122 extends through the geometric center 140 of the strikeface 38, perpendicular to the loft plane 10102. In many embodiments, the head CG 50 is located at a head CG depth 10130 from the x'y' plane 10124, measured in a direction perpendicular to the x'y' plane 10124. In some embodiments, the head CG 50 can be located at a head CG depth 10130 from the loft plane 10102, measured in a direction perpendicular to the loft plane 10102. The head CG 50 is further located at a head CG height 10132 from the head depth plane 10120, measured in a direction perpendicular to the head depth plane 10120. Further, the head CG height 10132 is measured as the offset distance of the head CG 50 from the head depth plane 10120 in a direction perpendicular to the head depth plane 10120 toward the crown 26 or toward the sole 30.

For additional guidance in describing the innovation herein, the x-axis 54 and the z-axis 62 are arranged to coincide with numbers on an analog clock in FIG. 3. The z-axis 62 extends between 12 o'clock ("12" through the club face 38) and 6 o'clock ("6" through the back 34), and the x-axis 54 extends between 3 o'clock ("3" through the toe end 18) and 9 o'clock ("9" through the heel end 22).

Various golf club head parameters are important in achieving desired performance characteristics, such as club head moment of inertia, club head center of gravity position, and club head center of gravity adjustability. High club head moment of inertia results in increased club head forgiveness for off-center hits. A club head center of gravity positioned low and back (i.e. toward the sole and rear of the club head) beneficially increases moment of inertia, reduces backspin, and increases launch angle of a golf ball on impact. Club head center of gravity adjustability allows for desired trajectory tuning of a club head by an end user. Each of these parameters are important in golf club design to achieve desired or optimal performance characteristics. However, including all of these parameters on a golf club head presents a design challenge, as many current center of gravity adjustability mechanisms (1) lower club head moment of inertia and/or (2) shift the club head center of gravity up and toward the front of the club head due to internal and/or bulky weight structures, and/or non-optimal weight structure positioning.

The embodiments of the golf club heads described below include adjustable weighting systems while maintaining or preventing a significant reduction in club head moment of inertia, and low and back club head center of gravity positioning. For example, many embodiments below describe low profile adjustable weighting systems and/or optimally positioned adjustable weighting systems to maintain a high club head moment of inertia and low and back club head center of gravity position, similar to a club head devoid of an adjustable weighting system, while providing user adjustability of ball flight and/or trajectory. Maintaining a high club head moment of inertia about the club head CG results in increased forgiveness for off-center hits, and maintaining a high club head moment if inertia about the hosel axis results in increased rotational stability during a swing. Further, maintaining a low and back club head center of gravity beneficially increases club head moment of inertia about the head CG and reduces backspin.

The club head 100 comprises a moment of inertia about the x-axis $I_{xx}$ (i.e. crown-to-sole moment of inertia), a moment of inertia about the y-axis $I_{yy}$ (i.e. heel-to-toe moment of inertia), and a moment of inertia about the hosel axis 46 $I_{hh}$.

The club heads comprising the adjustable weighting systems described herein can have a moment of inertia about the x-axis $I_{xx}$ greater than 3100 g·cm$^2$, greater than 3200 g·cm$^2$, greater than 3300 g·cm$^2$, greater than 3400 g·cm$^2$, greater than 3500 g·cm$^2$, greater than 3600 g·cm$^2$, greater than 3700 g·cm$^2$, greater than 3800 g·cm$^2$, greater than 3900 g·cm$^2$, greater than 4000 g·cm$^2$, greater than 4100 g·cm$^2$, greater than 4200 g·cm$^2$, greater than 4300 g·cm$^2$, greater than 4400 g·cm$^2$, or greater than 4500 g·cm$^2$. In some embodiments, the club heads comprising the adjustable weighting systems described herein have a moment of inertia about the x-axis $I_{xx}$ between 3100 and 4000 g·cm$^2$, between 3100 and 3800 g·cm$^2$, between 3200 and 4000 g·cm$^2$, between 3200 and 4000 g·cm$^2$, between 3300 and 4000 g·cm$^2$, between 3400 and 4000 g·cm$^2$, or between 3500 and 4000 g·cm$^2$.

Further, the club heads comprising the adjustable weighting systems described herein can have a moment of inertia about the y-axis $I_{yy}$ greater than 4700 g·cm$^2$, greater than 4800 g·cm$^2$, greater than 4900 g·cm$^2$, greater than 5000 g·cm$^2$, greater than 5100 g·cm$^2$, greater than 5200 g·cm$^2$, greater than 5300 g·cm$^2$, greater than 5400 g·cm$^2$, greater than 5500 g·cm$^2$, greater than 5600 g·cm$^2$, greater than 5700 g·cm$^2$, greater than 5800 g·cm$^2$, greater than 5900 g·cm$^2$, or greater than 6000 g·cm$^2$. In some embodiments, the club heads comprising the adjustable weighting systems described herein have a moment of inertia about the y-axis $I_{yy}$ between 4800 and 6000 g·cm$^2$, between 4900 and 6000 g·cm$^2$, between 5000 and 6000 g·cm$^2$, between 5100 and 6000 g·cm$^2$, between 5200 and 6000 g·cm$^2$, between 5300 and 6000 g·cm$^2$, or between 5400 and 6000 g·cm$^2$.

Further still, the club heads comprising the adjustable weighting systems described herein can have a moment of inertia about the hosel-axis $I_{hh}$ greater than 7500 g·cm$^2$, greater than 8000 g·cm$^2$, greater than 8250 g·cm$^2$, greater than 8500 g·cm$^2$, greater than 8750 g·cm$^2$, greater than 9000 g·cm$^2$, greater than 9050 g·cm$^2$, or greater than 10000 g·cm$^2$. In some embodiments, the club heads comprising the adjustable weighting systems described herein have a moment of inertia about the hosel-axis $I_{hh}$ between 7500 and 10000 g·cm$^2$, between 8000 and 10000 g·cm$^2$, between 8500 and 10000 g·cm$^2$, or between 9000 and 10000 g·cm$^2$.

Referring to Relation 1 below, many embodiments of the club heads with adjustable weighting systems comprise a combined moment of inertia about the head CG ($MOI_{CG}$) defined as the sum of the moment of inertia about the x-axis and the moment of inertia about the y-axis.

$$MOI_{CG}=I_{xx}+I_{yy} \quad \text{Relation 1}$$

The combined moment of inertia about the head center of gravity $MOI_{CG}$ can be greater than 7600 g·in$^2$, greater than 7700 g·cm$^2$, greater than 7800 g·cm$^2$, greater than 7900 g·cm$^2$, greater than 8000 g·cm$^2$, greater than 8100 g·cm$^2$, greater than 8200 g·cm$^2$, greater than 8300 g·cm$^2$, greater than 8400 g·cm$^2$, greater than 8500 g·cm$^2$, greater than 8600 g·cm$^2$, greater than 8700 g·cm$^2$, greater than 8800 g·cm$^2$, greater than 8900 g·cm$^2$, greater than 9000 g·cm$^2$, greater than 9100 g·cm$^2$, greater than 9200 g·cm$^2$, or greater than 9300 g·cm$^2$. For example, the combined moment of inertia about the club head head center of gravity $MOI_{CG}$ can be between 7700 and 9500 g·cm$^2$, between 7800 and 9500 g·cm$^2$, between 7900 and 9500 g·cm$^2$, between 8000 and 9500 g·cm$^2$, between 8100 and 9500 g·cm$^2$, between 8200 and 9500 g·cm$^2$, or between 8300 and 9500 g·cm$^2$.

Referring to Relation 2 below, many embodiments of the club heads with adjustable weighting systems comprise a combined moment of inertia about the head CG and hosel ($MOI_{CG-H}$), defined as the sum of the moment of inertia about the x-axis, the moment of inertia about the y-axis, and the moment of inertia about the hosel axis.

$$MOI_{CG-H}=I_{xx}+I_{yy}+I_{hh} \quad \text{Relation 2}$$

The combined moment of inertia about the head CG and hosel $MOI_{CG-H}$ can be greater than 14800 g·cm$^2$, greater than 14900 g·cm$^2$, greater than 15000 g·cm$^2$, greater than 15100 g·cm$^2$, greater than 15200 g·cm$^2$, greater than 15300 g·cm$^2$, greater than 15400 g·cm$^2$, greater than 15500 g·cm$^2$, greater than 15600 g·cm$^2$, greater than 15700 g·cm$^2$, greater than 15800 g·cm$^2$, greater than 15900 g·cm$^2$, greater than 16000 g·cm$^2$, greater than 16200 g·cm$^2$, greater than 16400 g·cm$^2$, greater than 16600 g·cm$^2$, greater than 16800 g·cm$^2$, greater than 17000 g·cm$^2$, greater than 17200 g·cm$^2$, greater than 17400 g·cm$^2$, greater than 17600 g·cm$^2$, greater than 17800 g·cm$^2$, greater than 18000 g·cm$^2$, greater than 18400 g·cm$^2$, greater than 18800 g·cm$^2$, greater than 19000 g·cm$^2$, greater than 19200 g·cm$^2$, or greater than 19400 g·cm$^2$. For example, the combined moment of inertia about the head CG and hosel $MOI_{CG-H}$ can be between 15000 and 19500 g·cm$^2$, between 15000 and 19000 g·cm$^2$, between 15000 and 18000 g·cm$^2$, between 16000 and 19500 g·cm$^2$, between 16000 and 19000 g·cm$^2$, or between 16000 and 18000 g·cm$^2$. In these embodiments, the combined moment of inertia about the head CG and hosel $MOI_{CG-H}$ can be greater than 15000 g·cm$^2$ for club heads with adjustable weighting systems having a volume between 425 and 450 cubic centimeters (cc), and the combined moment of inertia about the head CG and hosel $MOI_{CG-H}$ can be greater than 17000 g·cm$^2$ for club heads with adjustable weighting systems having a volume between 450 and 500 cubic centimeters (cc).

The club heads comprising the adjustable weighting systems described herein can have a head CG depth 10130 greater than 1.6 inches, greater than 1.65 inches, greater than 1.7 inches, greater than 1.75 inches, greater than 1.8 inches, greater than 1.85 inches, greater than 1.9 inches, greater than 1.95 inches, or greater than 2.0 inches. For example, the club head having the adjustable weighting systems can have a head CG depth 10130 between 1.61 and 2.0 inches, between 1.65 and 2.0 inches, between 1.7 and 2.0 inches, between 1.8 and 2.0 inches, between 1.61 and 3.0 inches, between 1.65 and 3.0 inches, between 1.7 and 3.0 inches, between 1.8 and 3.0 inches, between 1.9 and 3.0 inches, or between 2.0 and 3.0 inches.

Further, the club heads comprising the adjustable weighting systems described herein can have a head CG height 10132 located below the head depth plane 10120 (i.e. located between the head depth plane 10120 and the sole 30 of the club head). Further, the club heads comprising the adjustable weighting systems described herein can have a head CG height 10132 located within 0.10 inch, within 0.09 inch, within 0.08 inch, within 0.07 inch, within 0.06 inch, within 0.05 inch, or within 0.04 inch of the head depth plane 10120 toward the crown 26 or toward the sole 30 of the club head.

In many embodiments, the adjustable weight system includes one or more weights that are repositionable to a plurality of discrete portions or attachment locations of the club head to adjust the head CG position. Adjusting the head CG position using the adjustable weight systems described herein can affect ball trajectory and/or spin characteristics of the club head at impact, while maintaining a high club head moment of inertia.

In many embodiments, the adjustable weighting system can comprise two or more discrete attachment locations for receiving the one or more weights. In many embodiments, the adjustable weight system includes two, three, four, or five discrete attachment locations. For example, in embodiments of the adjustable weighting system having two discrete attachment locations, the attachment locations can include a first attachment location positioned toward the back end 34 and the toe 18 and a second attachment location positioned toward the back end 24 and the heel 22 of the club head. In these embodiments, a distance between the first attachment location and the second attachment location can be greater than 0.8 inch, greater than 0.9 inch, greater than 1.0 inch, greater than 1.1 inches, greater than 1.2 inches, or greater than 1.3 inches. For example, the distance between the first attachment location and the second attachment location can be between 0.8-1.3 inches, between 0.9-1.3 inches, between 1.0-1.3 inches, or between 1.1-1.3 inches.

For further example, in embodiments of the adjustable weighting system having three discrete attachment locations (e.g. FIG. 165), the attachment locations can include a first attachment location A positioned toward the back end 34 and the toe 18, a second attachment location C positioned toward the back end 34 and the heel 22, and a third attachment location B. In these embodiments, the third attachment location B can be positioned centrally and toward the back end 34 of the club head, generally aligned with or adjacent to the head depth axis 10122, and/or between the first and second attachment locations A, C. In these embodiments, a distance between adjacent attachment locations (e.g. the distance between the first attachment A location and the third attachment location B, or the distance between the second attachment location C and the third attachment location B) can be greater than 0.5 inch, greater than 0.6 inch, greater than 0.7 inch, greater than 0.8 inch, greater than 0.9 inch, or greater than 1.0 inch. For example, the distance between adjacent attachment locations (e.g. the distance between the first attachment location A and the third attachment location B, or the distance between the second attachment location C and the third attachment location B) can be between 0.5-1.0 inch, between 0.6-1.0 inch, between 0.7-1.0 inch, or between 0.8-1.0 inch.

In other embodiments, the adjustable weighting system can include any number of discrete attachment locations greater than one, such as, two, three, four, five, six, seven, eight, or more discrete attachment locations. In embodiments where the adjustable weighting system includes four discrete attachment locations, a distance between adjacent attachment locations can be greater than 0.4 inch, greater than 0.5 inch, greater than 0.6 inch, greater than 0.7 inch, greater than 0.8 inch, or greater than 0.9 inch. For example, in embodiments including four discrete attachment locations, the distance between adjacent attachment locations can be between 0.4-0.9 inch, between 0.5-0.9 inch, between 0.6-0.9 inch, or between 0.7-0.9 inch. In embodiments where the adjustable weighting system includes five discrete attachment locations, a distance between adjacent attachment locations can be greater than 0.3 inch, greater than 0.4 inch, greater than 0.5 inch, greater than 0.6 inch, greater than 0.7 inch, or greater than 0.8 inch. For example, in embodiments including four discrete attachment locations, the distance between adjacent attachment locations can be between 0.3-0.8 inch, between 0.4-0.8 inch, between 0.5-0.8 inch, or between 0.6-0.8 inch.

The plurality of discrete attachment locations of the club heads having adjustable weighting systems described herein can comprise various features including protruding bodies, apertures or recesses or ports capable of receiving a fastener, notches or tabs or cutout regions, ribs or grooves, pegs, hooks, magnets, programmable magnets, or any other suitable attachment means. In many embodiments having apertures or recesses or ports capable of receiving a fastener, the fastener can comprise the same material as the body, or a material having a lighter density than the body, such that the fastener does not contribute to the adjustable weighting properties of the club head. Further, in some embodiments, the apertures or recesses or ports can be threaded to receive a threaded fastener. In many embodiments, the adjustable weighting system is devoid of multiple and/or deep ports or recesses that require significant internal structure required to secure one or more weights within the ports or recesses.

The adjustable weighting system further comprises one or more weights positionable at the plurality of discrete attachment locations. The one or more weights can have a height 10152 measured in a crown to sole direction, parallel to the y-axis 58, when the weight is coupled to one or more of the attachment locations, a width 10154 measured in a heel to toe direction, parallel to the x-axis 54, when the weight is coupled to one or more of the attachment locations, and a depth 10156 measured in a front to back direction, parallel to the z-axis 62, when the weight is coupled to one or more of the attachment locations. In many embodiments, the height 10152 can be less than 0.5 inch, less than 0.4 inch, less than 0.3 inch, less than 0.25 inch, less than 0.2 inch, less than 0.18 inch, less than 0.16 inch, less than 0.14 inch, less than 0.12 inch, or less than 0.10 inch. In many embodiments, the width 10154 can be less than 1.3 inches, less than 1.2 inches, less than 1.1 inches, less than 1.0 inch, less than 0.9 inch, less than 0.8 inch, less than 0.7 inch, less than 0.6 inch, less than 0.5 inch, or less than 0.4 inch. In many embodiments, the depth 10156 can be less than 1.0 inch, less than 0.9 inch, less than 0.8 inch, less than 0.7 inch, less than 0.6 inch, less than 0.5 inch, less than 0.4 inch, less than 0.3 inch, less than 0.2 inch, or less than 0.1 inch. In many embodiments, one or more of the weights can have a surface area in contact with the club head body when the weight is coupled to any of the attachment. In many embodiments, the surface area of the weight in contact with the club head can be less than 0.75 $inch^2$, less than 0.7 $inch^2$, less than 0.65 $inch^2$, less than 0.6 $inch^2$, less than 0.55 $inch^2$, less than 0.5 $inch^2$, less than 0.45 $inch^2$, less than 0.4 $inch^2$, less than 0.35 $inch^2$, less than 0.3 $inch^2$, or less than 0.25 $inch^2$.

In many embodiments, the adjustable weighting system includes a first weight W positionable in the plurality of discrete attachment locations on the club head. In some embodiments, the adjustable weight system can further comprise additional weights, such as a second weight, a third weight, a fourth weight, and a fifth weight positionable in the plurality of discrete attachment locations on the club head. In these embodiments, each weight of the plurality of weights can be positioned in a different discrete attachment location on the club head. Further, in these embodiments, each weight of the plurality of weights can be removed and replaced or repositioned in different discrete attachment locations on the club head. While the embodiments of the adjustable weight system described herein include up to five weights, other embodiments can include adjustable weighting systems having any number of weights.

In many embodiments, the first weight is heavier than the remaining weights (e.g. the second weight, the third weight, the fourth weight, and/or the fifth weight). The first weight can comprises a mass greater than 10 grams, greater than 12 grams, greater than 14 grams, greater than 16 grams, greater than 18 grams, greater than 20 grams, greater than 22 grams, greater than 24 grams, greater than 26 grams, greater than 28 grams, or greater than 30 grams. For example, first weight can comprises a mass between 6 and 50 grams, between 10 and 50 grams, between 15 and 50 grams, between 20 and 50 grams, between 15 and 40 grams, between 20 and 40 grams, between 25 and 35 grams, between 10 and 25 grams, between 15 and 25 grams, between 10 and 20 grams, or between 15 and 20 grams. The remaining weights (e.g. the second weight, the third weight, the fourth weight, and/or the fifth weight) can comprise a mass less than 20 grams, less than 18 grams, less than 16 grams, less than 14 grams, less than 12 grams, less than 10 grams, less than 8 grams, less than 6 grams, less than 4 grams, or less than 2 grams. For example, the remaining weights can comprise a mass between 0.10 and 15 grams, between 0.25 and 10 grams, between 0.5 and 7 grams, or between 1 and 10 grams.

The first weight can be positioned in any of the discrete attachment locations. In embodiments having an adjustable weighting system comprising two discrete attachment locations, the first weight can be positioned in the first attachment location positioned near the toe 18 or the second attachment location positioned near the heel 22. In these embodiments, shifting the first weight from the first attachment location to the second attachment location shifts the head CG toward the heel 22, and shifting the first weight from the second attachment location to the first attachment location shifts the head CG toward the toe 18. In these embodiments, the remaining attachment location can be devoid of a weight, or the remaining attachment location can comprise an additional weight (e.g. the second weight).

In embodiments having an adjustable weighting system comprising three discrete attachment locations, the first weight W can be positioned in the third attachment location B positioned centrally, thereby generating a neutral head CG position. The first weight can be shifted from the third attachment location B to the first attachment location A, positioned toward the toe 18, thereby shifting the head CG 50 toward the toe 18 by a distance. The first weight W can be shifted from the third attachment location B to the second attachment location C, positioned toward the heel 22, thereby shifting the head CG 50 toward the heel 22 by a distance. In these embodiments, the remaining locations can be devoid of weights, or the remaining locations can comprise additional weights (e.g. the second weight and/or the third weight).

Shifting the first weight W from an attachment location nearest the toe 18 to an attachment location nearest the heel 22 can shift the head CG 50 by a distance of at least 0.10 inch, at least 0.15 inch, at least 0.20 inch, at least 0.25 inch, or at least 0.30 inch, in a direction extending parallel to the x-axis 54. For example, in many embodiments, shifting the first weight W from an attachment location nearest the toe 18 to an attachment location nearest the heel 22 can shift the head CG 50 by a distance between 0.10 and 0.30 inch, between 0.15 and 0.30 inch, between 0.20 and 0.30 inch, between 0.15 and 0.25 inch, or between 0.20 and 0.25 inch.

In these or other embodiments, shifting the head CG 50 toward the toe 18 can generate a fade or correct for a hook. Conversely, shifting the head CG 50 toward the heel 22 can generate a draw or correct for a slice. In the embodiments of the adjustable weighting system described below, shifting head CG 50 in a direction extending parallel to the x-axis 54 between 0.10 and 0.30 inch can result in a change in shot bend of 4.6 to 13.9 yards.

Other embodiments can include one or more discrete attachment locations positioned toward the strike face 38 of the club head 100. In these embodiments, shifting one or more weights to an attachment location(s) near the back end 34 of the club head 100 from an attachment location near the strike face 38 can increase the club head moment of inertia about the head CG $MOI_{CG}$ and increase dynamic loft or launch angle of a golf ball. Conversely, shifting one or more weights to an attachment location(s) near the strike face 38 of the club head 100 from an attachment location near the back end 34 can reduce dynamic loft or launch angle of a golf ball.

The embodiments of the club heads having adjustable weighting systems described herein maximize head CG depth 10130 and club head moment of inertia (or minimize the reduction in head CG depth 10130 and club head moment of inertia typically associated with introducing adjustability compared to a non-adjustable club head). In many embodiments, the maximized head CG depth and club head moment of inertia are achieved with first adjustable weight having a relatively low mass, thereby increasing the efficiency of the design to maintain club head performance characteristics (e.g. forgiveness, low back spin, high launch), while enabling user adjustability of ball spin and/or trajectory.

Referring to Relation 3 below, the club heads having adjustable weighting systems comprise a depth to mass ratio of the head CG depth 10130 to the mass of the first weight $W_m$. In many embodiments, the depth to mass ratio of the club head can be greater than 0.060 inch/gram, greater than 0.070 inch/gram, greater than 0.080 inch/gram, greater than 0.090 inch/gram, greater than 0.100 inch/gram, greater than 0.110 inch/gram, greater than 0.120 inch/gram, or greater than 0.130 inch/gram. In some embodiments, the depth to mass ratio can be between 0.070 and 0.13 inch/gram, between 0.080 and 0.13 inch/gram, between 0.090 and 0.13 inch/gram, between 0.070 and 0.11 inch/gram, between 0.080 and 0.11 inch/gram, or between 0.090 and 0.11 inch/gram. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 10 and 20 grams, between 12 and 20 grams, between 14 and 20 grams, between 16 and 20 grams, between 10 and 18 grams, between 12 and 18 grams, or between 14 and 18 grams.

$$\text{Depth to Mass Ratio} = \text{Head CG Depth}/Wm \qquad \text{Relation 3}$$

Referring to Relation 4 below, the club heads having adjustable weighting systems can comprise a first inertia to mass ratio defined as the combined moment of inertia about the head CG $MOI_{CG}$ to the mass of the first weight $W_m$. In many embodiments, the first inertia to mass ratio can be greater than 400 $cm^2$, greater than 410 $cm^2$, greater than 420 $cm^2$, greater than 430 $cm^2$, greater than 440 $cm^2$, greater than 450 $cm^2$, greater than 460 $cm^2$, greater than 470 $cm^2$, greater than 480 $cm^2$, greater than 490 $cm^2$, greater than 500 $cm^2$, greater than 510 $cm^2$, greater than 520 $cm^2$, greater than 530 $cm^2$, greater than 540 $cm^2$, or greater than 550 $cm^2$. In some embodiments, the first inertia to mass ratio can be between 400 and 550 $cm^2$, between 410 and 550 $cm^2$, between 420 and 550 $cm^2$, between 430 and 550 $cm^2$, between 440 and 550 $cm^2$, between 450 and 550 $cm^2$, between 400 and 500 $cm^2$, between 410 and 500 $cm^2$, between 420 and 500 $cm^2$, between 430 and 500 $cm^2$, between 440 and 500 $cm^2$, or between 450 and 500 $cm^2$. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 10 and 20 grams, between 12 and 20 grams, between 14 and 20 grams, between 16 and 20 grams, between 10 and 18 grams, between 12 and 18 grams, or between 14 and 18 grams.

$$\text{First Inertia to Mass Ratio} = MOI_{CG}/W_m \qquad \text{Relation 4}$$

The embodiments of the club heads having adjustable weighting systems described herein maximize the total shift in head CG as achievable by adjusting the one or more weights to the plurality of discrete attachment locations. In many embodiments, the maximized total shift in head CG is achieved with first adjustable weight having a relatively low mass, thereby increasing the efficiency of the design to maintain club head performance characteristics (e.g. forgiveness, low back spin, high launch) while enabling user adjustability of ball spin and/or trajectory.

Referring to Relation 5 below, the club heads having adjustable weighting systems comprise a head CG to mass ratio defined as the total shift in head CG or maximum head CG shift to the mass of the first weight. In many embodiments, the head CG to mass ratio can be greater than 0.008 inch/gram, greater than 0.009 inch/gram, greater than 0.010 inch/gram, greater than 0.011 inch/gram, greater than 0.012 inch/gram, greater than 0.013 inch/gram, greater than 0.014 inch/gram, or greater than 0.015 inch/gram. In some embodiments, the head CG to mass ratio can be between 0.008 and 0.015 inch/gram, between 0.009 and 0.015 inch/gram, between 0.010 and 0.015 inch/gram, between 0.008 and 0.013 inch/gram, between 0.009 and 0.013 inch/gram, or between 0.010 and 0.013 inch/gram. In these embodiments, the mass of the first weight can be less than 25 grams, less than 24 grams, less than 23 grams, less than 22 grams, less than 20 grams, less than 19 grams, less than 18 grams, less than 17 grams, less than 16 grams, or less than 15 grams. In some embodiments, the mass of the first weight can be between 10 and 20 grams, between 12 and 20 grams, between 14 and 20 grams, between 16 and 20 grams, between 10 and 18 grams, between 12 and 18 grams, or between 14 and 18 grams.

$$\text{Head CG to Mass Ratio} = \text{Maximum Head CG Shift}/W_m \qquad \text{Relation 5}$$

The one or more weights of the adjustable weighting system comprise a weight CG 10134. In many embodiments, the weight CG is positioned near a rear perimeter or skirt 10136 of the club head when viewed from a top or bottom view (FIG. 165), and at a maximized distance 10138 from the geometric center 140 of the strike face 38. Positioning the weight CG 10134 near the rear perimeter 10136 of the club head 100 or away from the strike face 38 can increase perimeter weighting and club head moment of inertia, thereby resulting in increased club head forgiveness for off center hits, compared to adjustable weights positioned closer to the strike face. Further, positioning the weight CG 10134 near the rear perimeter 10136 or away from the strike face 38 can result in a head CG position that is lower and farther back, thereby increasing club head moment of inertia and reducing back spin, back compared to adjustable weights positioned closer to the strike face.

In these embodiments, the weight CG 10134 of one or more of the weights is positioned at a distance 10142 from the rear perimeter 10136 of the club head 100 when the weight is positioned at one or more of the plurality of discrete attachment locations on the club head 100. The distance 10142 can be measured as the projected distance from the weight CG to the perimeter 10136 when the club head is viewed from a bottom view, perpendicular to the x'z' plane 10126, when the weight is positioned at one or more of the plurality of discrete attachment locations on the club head 100. Further, the distance 10142 can be measured in a direction parallel to the x'z' plane 10126, when the weight is positioned at one or more of the plurality of discrete attachment locations on the club head 100. For example, the weight CG 10134 of one or more of the weights can be positioned within 0.7 inch, within 0.65 inch, within 0.6 inch, within 0.55 inch, within 0.5 inch, within 0.45 inch, within 0.4 inch, within 0.35 inch, within 0.3 inch, within 0.25 inch, or within 0.2 inch of the rear perimeter 10136 of the club head 100. For further example, the weight CG 10134 of one or more of the weights can be positioned between 0.10 and 0.50 inch, between 0.25 and 0.5 inch, between 0.10 and 0.25 inch, between 0.10 and 0.35 inch, or between 0.10 and 0.45 inch from the rear perimeter 10136 of the club head 100.

Further, in these embodiments, the weight CG 10134 of one or more of the weights is positioned at a distance 10138 from the geometric center 140 of the strike face 38 of the club head 100 when the weight is positioned at one or more of the plurality of discrete attachment locations on the club head 100. For example, the weight CG 10134 of one or more of the weights can be positioned at a distance 10138 greater than 2.0 inches, greater than 2.25 inches, greater than 2.5 inches, greater than 2.75 inches, greater than 3.0 inches, greater than 3.25 inches, greater than 3.5 inches, or greater than 3.75 inches from the geometric center of the strike face. For further example, the weight CG 10134 of one or more of the weights can be positioned at a distance 10138 between 2.0 and 3.5 inches, between 2.5 and 3.5 inches, between 2.0 and 3.0 inches, between 2.5 and 3.0 inches, between 2.5 and 4.0 inches, between 3.0 and 3.75 inches, between 3.0 and 4.0 inches, between 3.2 and 4.0 inches, or between 3.5 and 4.0 inches from the geometric center 140 of the strike face 38. Positioning the weight CG 10134 away from the geometric center 140 of the strike face 38 can increase perimeter weighting and club head moment of inertia, thereby resulting in increased club head forgiveness for off center hits, compared to adjustable weights positioned closer to the strike face. Further, positioning the weight CG 10134 away from the geometric center 140 of the strike face 38 can result in a head CG position that is lower and farther, thereby increasing club head moment of inertia and reducing back spin, back compared to adjustable weights positioned closer to the strike face.

In many embodiments, the weight CG 10134 protrudes from an external contour or outer surface 10146 of the sole 30, is positioned flush with the external contour 10146 of the sole 30, and/or is positioned minimally inset relative to the external contour 10146 of the sole 30. Positioning the weight CG 10134 minimally inset, flush with, or external relative to the external contour 10146 of the sole 30 requires less structural support material to receive the one or more weights, thereby maintaining a low profile adjustable weighting system. Accordingly, positioning the weight CG 10134 minimally inset, flush with, or external relative to the external contour 10146 of the sole 30 can increase perimeter weighting and club head moment of inertia, thereby resulting in increased club head forgiveness for off center hits, compared to internal adjustable weights or adjustable weights recessed into the club head. Further, positioning the weight CG 10134 minimally inset, flush with, or external relative to the external contour 10146 of the sole 30 can result in a head CG position that is lower and farther back, thereby increasing club head moment of inertia and reducing back spin, back compared to internal adjustable weights or adjustable weights recessed into the club head.

In these embodiments, the weight CG 10134 of one or more of the weights is positioned at a distance 10148 from the external contour 10146 of the sole 30 when the weight is positioned at one or more of the plurality of discrete attachment locations on the club head 100, wherein the distance 10148 is measured in a direction parallel to the y-axis 58. For example, the weight CG 10134 of one or more of the weights can protrude from the external contour 10146 of the sole by up to 0.10 inch, up to 0.15 inch, up to 0.20 inch, up to 0.25 inch, or up to 0.30 inch. In some embodiments, the weight CG 10134 of the one or more weights protrudes from the external contour 10146 of the sole 30 by 0.10 to 0.25 inch, by 0.15 to 0.25 inch, by 0.15 to 0.25 inch, or by 0.15 to 0.30 inch. For further example, the weight CG 10134 can be inset relative to the external contour 10146 of the sole 30 by a distance 10148 of less than 0.15 inch, less than 0.14 inch, less than 0.13 inch, less than 0.125 inch, less than 0.12 inch, less than 0.11 inch, less than 0.10 inch, less than 0.09 inch, less than 0.08 inch, or less than 0.07 inch. In some embodiments, the weight CG 10134 of the one or more weights is inset relative to the external contour 10148 of the sole 30 by a distance 10148 between 0.05 and 0.15 inch, between 0.05 and 0.125 inch, between 0.05 and 0.15 inch, between 0.10 and 0.15 inch, between 0.10 and 0.125 inch, or between 0.10 and 0.15 inch.

Figure 4:
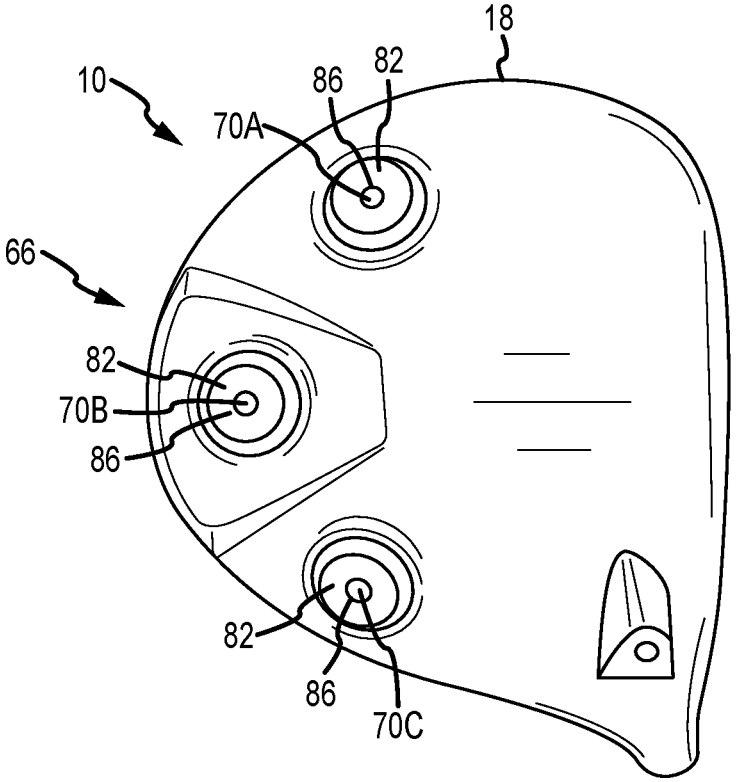
FIGS. 4 and 5 are bottom and partial perspective views, respectively, of the golf club head of FIG. 1.
Figure 5:
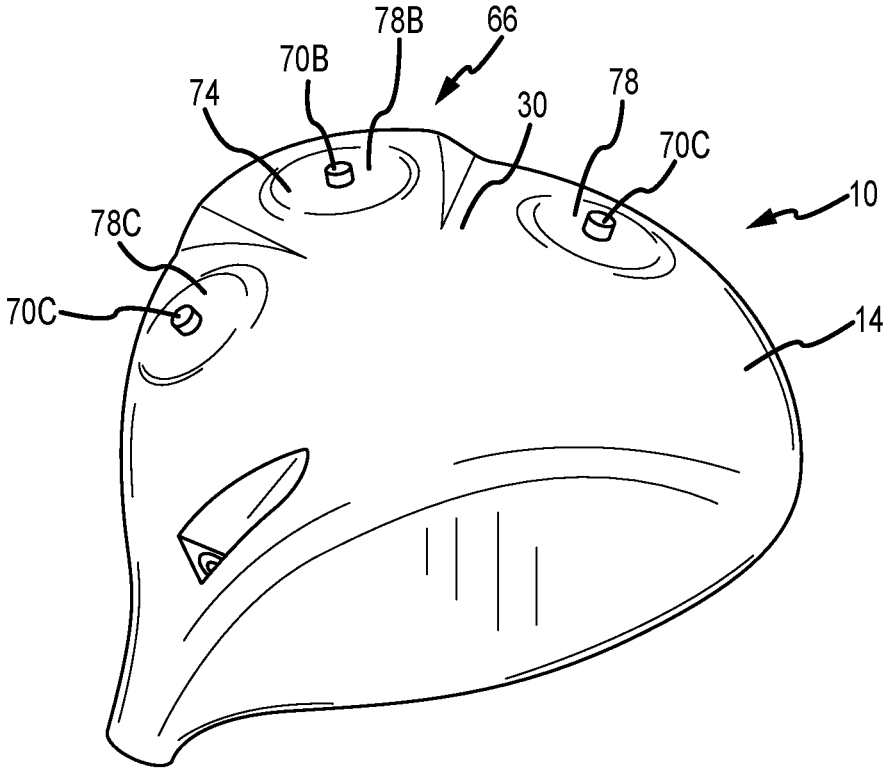

With reference to FIGS. 4 and 5, the club head 10 includes an adjustable weighting system 66. The adjustable weighting system 66 is adjustable by an end user to modify the club head 10 center of gravity 50 and/or moment of inertia and/or heel/toe bias to achieve desired performance characteristics (e.g., forgiveness, spin, trajectory) under various circumstances. The adjustable weighting system 66 is a low profile system and thereby does not significantly shift or change the club head 10 MOI when compared to a club head not including the adjustable weighting system 66. Further, the low profile adjustable weighting system 66 ensures that shifts in the club head 10 CG occur mainly in a heel end 22 to toe end 18 direction keeping the overall club head 10 CG in a low and back location.

Referring to FIGS. 4 and 5, the adjustable weighting system 66 can include a plurality of raised portions 78. The plurality of raised portions 78 can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 66 includes three raised portions 78A, B, C. Each raised portion 78 comprises a discrete attachment location. Each discrete attachment location comprises a feature in the form of a protruding body 2470A, B, C. Further, the protruding bodies, 2470A, B, C can receive one or more weight 2482. In other embodiments the number of protruding bodies 70 varies. For example, in some embodiments the adjustable weighting system 66 includes just a single protruding body 70. In some embodiments the adjustable weighting system 66 includes two protruding bodies 70. In some embodiments the adjustable weighting system 66 includes more than three protruding bodies 70. For example, in some embodiments, the adjustable weighting system 66 can include 3, 4, 5 or 6 protruding bodies 70. In some embodiments, one or more of the protruding bodies 70 extends from one or more areas of the club head 10 other than that illustrated. For example, in some embodiments one or more of the protruding bodies 70 extends from the crown or top 26. In other embodiments, the protruding bodies 70 can extend from the heel end 22, the toe end 18, the rear end 34, the trailing edge 71, the skirt or the periphery portions of the club head body 14. Accordingly, the number and locations of the protruding bodies 70 can correspond to the number of weight shifting options of the adjustable weight system 66.

In the illustrated embodiment, the three protruding bodies 70A, B, C are generally spaced evenly apart from one another, such that a first of the protruding bodies 70A is positioned generally at the toe or toe end 18, a second of the protruding bodies 70C is positioned generally at the heel or heel end 22, and a third of the protruding bodies 70B is positioned between the toe or toe end 18 and the heel or heel end 22. Each of the protruding bodies 70A, B, C defining a discrete attachment location for securing a weight 82 to the club head 10. In contrast to other adjustable weighting systems wherein the weight can be coupled at any, or at an infinite, or at an unlimited number of locations across the club head 10. In other embodiments, the protruding bodies 70A, B, C are positioned differently. For example, in some embodiments, the protruding bodies 70A, B, C can be spaced unevenly from one another. In these or other embodiments, the two or more protruding bodies 70A, B, C are positioned generally at the toe or toe end 18, and a single protruding body 70A, B, C is positioned at the heel or heel end 22. In some embodiments two or more protruding bodies 70A, B, C are positioned generally at the heel or heel end 22, and a single protruding body 70A, B, C is positioned at the toe or toe end 18. In other embodiments, the protruding bodies 70A, B, C can be positioned at any location on the club head 14 being spaced any distance apart from one another.

In the illustrated embodiment, the protruding bodies 70A, B, C are each positioned generally adjacent a trailing edge 72 (FIG. 4) of the club head 10. The trailing edge 72 extends between the toe or toe end 18 and the heel or heel end 22, and defines an intersection of the sole or bottom 30 and the crown or top 26 along the rear or back end 34. In other embodiments, one or more of the protruding bodies 70A, B, C are positioned away from the trailing edge 72 (e.g., more centrally within the sole or bottom 30, or more centrally within the crown or top 26).

As illustrated in FIG. 5, the protruding bodies 70A, B, C each extend from an outer surface 74 of the club head body 14. In the illustrated construction, the outer surface 74 includes three raised portions 78. The protruding bodies 70A, B, C extend generally perpendicularly from the raised portions 78. In the illustrated embodiment the raised portions 78 are each generally elevated, planar surfaces along the club head 10, and the protruding bodies 70A, B, C extend from centers of the raised portions 78. However, in other embodiments the raised portions 78 have different shapes or contours, and/or the protruding bodies 70A, B, C extend from areas other than the centers of the raised portions 78.

The protruding bodies 70A, B, C extend outwardly from the outer surface 74, and may be of any shapes and any configurations such that one or more weights may be coupled to the protruding bodies 70A, B, C (as opposed to being coupled to ports where the ports are holes or cavities within the body of the club that include for example internal threads to couple to external threads on the weights). For example, in the illustrated embodiment, the protruding bodies 70A, B, C are each generally cylindrical in shape. In other embodiments, the protruding bodies 70A, B, C have square cross-sections, rectangular cross-sections, triangular cross-sections, or any other shapes configured to harbor the complementary weight having a cavity configured to fits around the protruding body 70A,B,C. The weights 82 may be coupled to the club head 14, such that a portion of the weight 82 extends beyond the outer contour of the club head body 14. In the illustrated embodiment, the center of gravity of each weight 82 is positioned within 1 inch from the trailing edge 72, or periphery of the club head body 14. In other embodiments, the center of gravity of each weight 82 can be positioned within 0.9, 0.8, 0.7, 0.6, 0.5, 0.4, 0.3, 0.2 or 0.1 inches of the trailing edge 72, or periphery of the club head body 14.

As illustrated in FIG. 4, weights 82 are coupled to the protruding bodies 70. In the illustrated embodiments, each weight 82 has a cylindrical shape comprising an aperture 86 extending there through. Each of the weights 82 is identical in size and shape, although in other embodiments the size and shape of one weight 82 may differ from the size and shape of another weight 82. For example, in some embodiments, the weight 82 may have a circular, triangular, rectangular, polygonal, trapezoidal, or any other suitable shape. The weight 82 can be described as a shallow weight 82, such that the weight 82 is low profile. For example, in some embodiments, the weight 82 can include a height which can be between 0.05 to 1.5 inches In other embodiments, the weight 82 can include a height which is between 0.05-0.1, 0.1-0.2, 0.2-0.3, 0.3-0.4, 0.4-0.5, 0.5-0.6, 0.6-0.7, 0.7-0.8, 0.8-0.9, 0.9-1.0, 1.0-1.1, 1.1-1.2, 1.2-1.3, 1.3-1.4 or 1.4-1.5 inches. In some embodiments, the height of the weight 82 can correspond with the height of the protruding body 70, such that the top of the weight 82 is flush with the top of the protruding body 70 when coupled together. In other embodiments, the height of the weight 82 can be less than the height of the protruding body 70, such that the protruding body 70 extends past the top of the weight 82 when coupled together. In other embodiments, the height of the weight 82 can be greater than the height of the protruding body 70, such that the weight 82 extends past the top of the protruding body 70 when coupled together.

In the illustrated embodiment, the apertures extending through the weights 82 are generally cylindrical apertures 86 that are sized and shaped to receive the protruding bodies 70. In other embodiments, the apertures 86 can comprise other shaped corresponding with the shapes of the protruding bodies 70. For example. The apertures 86 can have a polygonal, triangular, rectangular, circular, trapezoidal, ovular, elliptical, or any other suitable shaped cross-section extending through the weight 82. The apertures 86 are through apertures 86 that extend entirely through the weights 82. However, in other embodiments the weights 82 have blind apertures extending only partially through the weight 82.

In some embodiments, the protruding bodies 70A, B, C have external threads, and the weights 82 have internal threads within the apertures 86, such that the weights 82 are threadably coupled to the protruding bodies 70A, B, C. In other embodiments, the weights 82 are coupled to the protruding bodies 70A, B, C with friction fits, with snap-fit mechanisms, with set screws positioned within threaded inner surfaces of the protruding bodies 70A, B, C, or with other structures.

In the illustrated embodiment, the weights 82 are generally flat, to increase club head moment of inertia. In some embodiments, the weights 82 are made of different materials such that they vary in mass. For example, one weight 82 may be made of a high density material, such as tungsten, and the remaining weights 82 may be made of a less dense material, such as polyurethane or another plastic. In other embodiments, the weights 82 may have different sizes or volumes such that they vary in mass. For example, one weight 82 may have a greater volume than the remaining weights 82. In some embodiments, each of the weights 82 may vary in volume from one another and thus vary in mass. In some embodiments, the weights 82 may vary in both volume and material from one another. In some embodiments, one of the structures labeled as 82 is not a weight, but rather a light-weight (e.g., light-weight plastic) cover that snap-fits or otherwise couples to one of the protruding bodies 70. In some embodiments, the weights may vary between 0.1-50 g. For example, in embodiments having a plurality of weights 82, one or more of the weights 82 may vary between 0-10 g, one or more of the weights 82 may vary between 10-20 g, one or more of the weights 82 may vary between 20-30, one or more of the weights 82 may vary between 30-40 g, and one or more of the weights 82 may vary between 40-50 g. In some embodiments, a first weight 82 may vary between 0-10 g, a second weight 82 may vary between 10-20 g, a third weight 82 may vary between 20-30, a fourth weight 82 may vary between 30-40 g, and a fifth weight 82 may vary between 40-50 g. In other embodiments, a first weight 82 may vary between 1-5 g, and a second and third weight 82 may vary between 5-30 g. In other embodiments, a first and second weight 82 may vary between 1-10 g, and a third and fourth weight 82, may vary between 5-25 g. In some embodiments, a first weight 6382 can have a mass of 8.5 grams, and a second and third weight 6382 each can have a mass of 1.5 grams. In other embodiments, a first weight 6382 can have a mass of 12 grams, and a second and third weight 6382 each can have a mass of 1.5 grams. In other embodiments, a first weight 6382 can have a mass of 8.5 grams, and a second and third weight 6382 each can have a mass of 0.75 grams. In other embodiments, a first weight 6382 can have a mass of 10-20 g, 10-25 g, or 15-25 g, and the remaining weight 6382 (e.g. second, third, fourth, fifth weight 6382) can have a mass of 0.25-2.5 g, 0.25-5 g, 0.25-7.5 g, 0.25 to 10 g. In other embodiments, a first weight 6382, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights 82 may have the same mass or may have a varying mass between 0.1-50 g.

With continued reference to FIGS. 4 and 5, in the illustrated embodiment each of the protruding bodies 70A, B, C receives a weight 82. In other embodiments, one or more of the protruding bodies 70A, B, C receives a weight 82, while the remaining protruding bodies 70A, B, C are bare and uncovered, or are covered with another material or structure. In some embodiments, one or more of the protruding bodies 70A, B, C receives more than one weight 82. In some embodiments, one or more of the protruding bodies 70A, B, C does not extend past an outer profile of the club head 10, such that even if the protruding body 70A, B, C is left bare and uncovered, the protruding body will not interfere with or disrupt a golfer's swing.

The weights 82 may be strategically positioned on the protruding bodies 70A, B, C to achieve a desired club head 10 center of gravity position and/or moment of inertia and/or heel/toe bias. For example, in some embodiments a heavier weight 82 is positioned on the protruding body 70B located between the toe or toe end 18 and the heel or heel end 22, while lighter weights are positioned on the protruding bodies 70A, B near the toe or toe end 18 and the heel or heel end 22. The aforementioned weight 82 placement can result in the center of gravity remaining centered while being shifted towards the back end 34 of the club head 10. In some embodiments a heavier weight 82 is positioned on the protruding body 70C near the heel or heel end 22, while lighter weights 82 are positioned on the protruding body 70A near the toe or toe end 18 and on the protruding body 70B that is located between the toe or toe end 18 and the heel or heel end 22. The aforementioned weight 82 placement can result in the center of gravity being shifted towards the heel end 22 of the club head 10. In some embodiments a heavier weight 82 is positioned on the protruding body 70A near the toe or toe end 18, while lighter weights 82 are positioned on the protruding body 70C near the heel or heel end 22 and on the protruding body 70B that is located between the toe or toe end 18 and the heel or heel end 22. The aforementioned weight 6382 placement can result in the center of gravity being shifted towards the toe end 6318 of the club head 6310. In some embodiments one or more of the protruding bodies 70A, B, C are of equal size and shape, such that one weight may be interchangeably used with each of the protruding bodies 70A, B, C. In some embodiments, one or more of the protruding bodies 70A, B, C can have a differing size and shape, such that each protruding body 70A, B, C has its own corresponding weight 82 or set of weights 82. In some embodiments, multiple different weights 82 may be used interchangeably with the same protruding body 70A, B, C.

In some embodiments the protruding bodies 70A, B, C include exterior threads, and the corresponding weights that couple to the protruding bodies 70A, B, C include interior threads (e.g., in apertures of the weights similar to the weights 82 described above), such that the weights are threadably coupled to the protruding bodies 70A, B, C. In other embodiments, the weights 82 are coupled to the protruding bodies 70A, B, C with friction fits, with snap-fit mechanisms, with set screws positioned within threaded inner surfaces of the protruding bodies 70A, B, C, or with other structures.

The adjustable weighting system 66 of golf club head 10 maintains or prevents a significant reduction in club head moment of inertia, and low and back club head center of gravity positioning, compared to a club head devoid of an adjustable weighting system. The adjustable weighting system 66 of golf club head 10 maintains a high club head moment of inertia and a low and back club head CG position due to the low profile of the weighting system and the perimeter positioning of the one or more weights. The club head 10 having the adjustable weighting system 66 can have similar or identical parameters and measurements as club head 100 described above.

Figure 6:
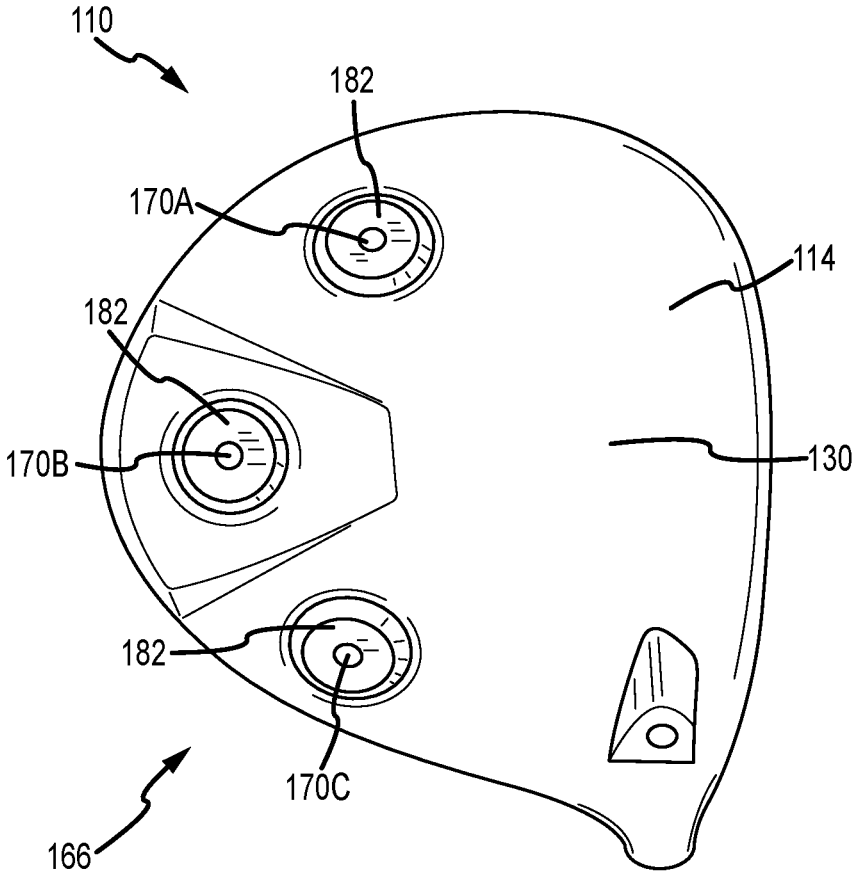
FIGS. 6 and 7 are bottom and partial perspective views, respectively, of a golf club head according to another embodiment.
Figure 7:
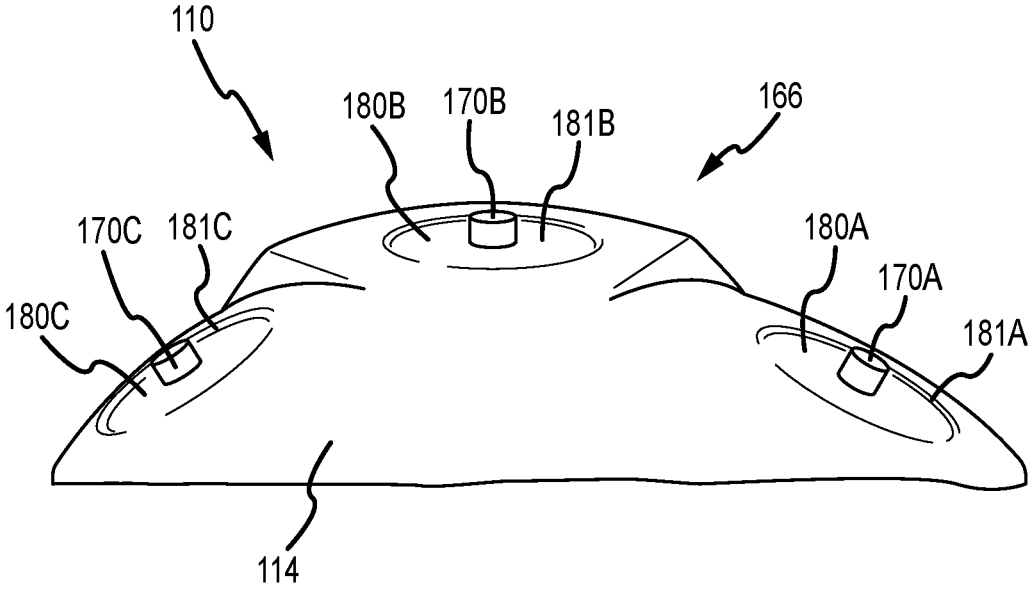

FIGS. 6 and 7 illustrate a club head 110 having a club head body 114. The club head 110 includes an adjustable weighting system 166 that is adjustable by an end user to modify the club head 110 center of gravity and/or moment of inertia and/or heel/toe bias to achieve desired performance characteristics (e.g., forgiveness, spin, trajectory) under various circumstances. The adjustable weighting system 166 is a low profile system and thereby does not significantly shift or change the club head 100 MOI when compared to a club head not including the adjustable weighting system 166. Further, the low profile adjustable weighting system 166 ensures that shifts in the club head 100 CG occur mainly in a heel end 122 to toe end 118 direction keeping the overall club head 100 CG in a low and back location.

The adjustable weighting system 166 is similar to the adjustable weighting system 66, except the adjustable weighting system 166 includes a plurality of recessed portions 180A, B, C instead of a plurality of raised portions 78. Each recessed portion 180A, B, C can comprise a recessed surface 181A, B, C. The recessed surfaces 181A, B, C can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 166 includes three recessed portions 180A, B, C each having a recessed surface 181A, B, C. The recessed surfaces 181A, B, C each comprise a discrete attachment location. The discrete attachment locations each comprise features which can be in the form of protruding bodies 170A, B, C. Further, the protruding bodies can be configured to receive a weight 182, except the weighting system 166 includes a recess 180. The weight 182 can be similar to the weight 82 described above and can have the same size, shape, and weight. In the illustrated embodiment, the adjustable weighting system 166 includes three protruding bodies 170 (A, B, C), positioned in the same configuration as described in the adjustable weighting system 66. Each protruding body 170A, B, C defining a discrete attachment location for securing a weight 182 to the club head 110. In contrast to other adjustable weighting systems wherein the weight can be coupled at any, or at an infinite, or at an unlimited number of locations across the club head 10. The protruding bodies 170 may be of any shapes and any configurations such that one or more weights 182 may be coupled to the protruding bodies 170 (as opposed to being coupled to ports where the ports are holes or cavities within the body of the club that include for example internal threads to couple to external threads on the weights). For example, in the illustrated embodiment, the protruding bodies 170 are each generally cylindrical in shape. In other embodiments, the protruding bodies 170 have square cross-sections, rectangular cross-sections, triangular cross-sections, or any other shapes. Further, the protruding bodies 170 may be positioned at any position on the club head body 114 similar to the protruding bodies 70 and club head body 14.

As illustrated in FIG. 7, the protruding bodies 170 each extend outwardly from an outer surface 174 of the club head body 114 along a sole or bottom 130 of the club head 110. The club head 110 includes three recessed portions 180 (in contrast to the three raised portions 78 in FIGS. 4 and 5). The recessed portion 180 includes a recessed surface 181 positioned at a depth offset from the sole 130 of the club head 10. The protruding bodies 170 extend generally perpendicularly from recessed surfaces 181 in the recessed portions 180. The recessed surfaces 181 forming part of the overall outer surface 174 of the club head 110. In the illustrated embodiment the recessed surfaces 181 are each generally recessed, planar surfaces along the club head 110, and the protruding bodies 170 extend from centers of the recessed surfaces 181. However, in other embodiments the recessed surfaces 181 have different shapes or contours, and/or the protruding bodies 170 extend from areas other than the centers of the recessed portions 170. The recessed surfaces 181 may extend a depth of 0.01 to 0.5 inches into the club head body 14. For example, in some embodiments the recessed surfaces 181 may extend a depth of 0.01 to 0.05, 0.03 to 0.07, 0.05 to 0.1, 0.07 to 0.15, 0.1 to 0.2, 0.15 to 0.25, 0.2 to 0.3, 0.25 to 0.35, 0.3 to 0.4, 0.35 to 0.45, 0.4 to 0.5 inches into the club head 14. The recessed surface 181 may extend a depth into the club head body 114 such that when the weights 182 are coupled to the club head body 114, the weights 182 extend at least partially beyond the outer contour of the club head body 114.

The adjustable weighting system 166 of golf club head 110 maintains or prevents a significant reduction in club head moment of inertia, and low and back club head center of gravity positioning, compared to a club head devoid of an adjustable weighting system. The adjustable weighting system 166 of golf club head 110 maintains a high club head moment of inertia and a low and back club head CG position due to the low profile of the weighting system and the perimeter positioning of the one or more weights. The club head 110 having the adjustable weighting system 166 can have similar or identical parameters and measurements as club head 100 described above.

Figure 9:
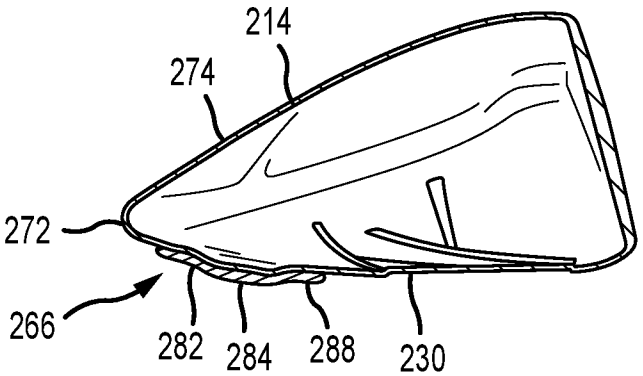
FIGS. 8-10 are bottom, cross-sectional, and partial perspective views, respectively, of a golf club head according to another embodiment.
Figure 10:
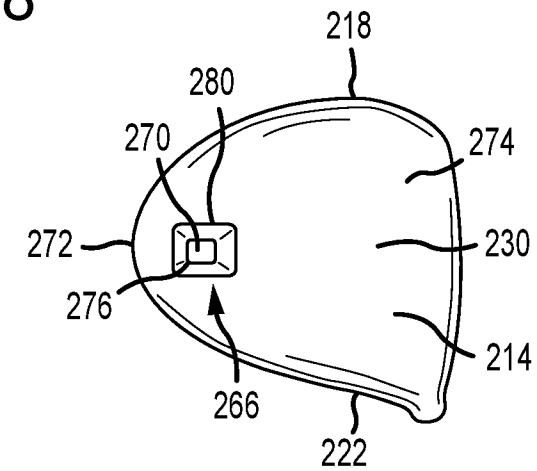
Figure 8:
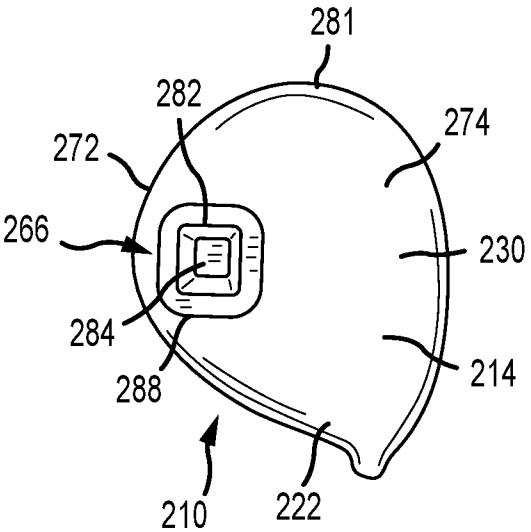

FIGS. 8-10 illustrate a club head 210 having a club head body 214. The club head 210 includes an adjustable weighting system 266 that is adjustable by an end user to modify the club head 210 center of gravity and/or moment of inertia and/or heel/toe bias to achieve desired performance characteristics (e.g., forgiveness, spin, trajectory) under various circumstances. The adjustable weighting system 266 is a low profile system and thereby does not significantly shift or change the club head 210 MOI when compared to a club head not including the adjustable weighting system 266. Further, the low profile adjustable weighting system 266 ensures that shifts in the club head 210 CG occur mainly in a heel end 222 to toe end 218 direction keeping the overall club head 210 CG in a low and back location.

Similar to the adjustable weighting systems 66 and 166, the adjustable weighting system 266 includes at least one discrete attachment location. The at least one discrete attachment location can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 266 includes one discrete attachment position. The discrete attachment location comprises a feature in the form of a protruding body 270.

As illustrated in FIGS. 8 and 9 the protruding body 270 is configured to receive at least one weight 282. The protruding body 270 may be of any shape and any configuration such that one or more weights may be coupled to the protruding body 270 (as opposed to being coupled to ports where the ports are holes or cavities within the body of the club that include for example internal threads to couple to external threads on the weights). The weight 282 may be coupled to the club head 214, such that a portion of the weight 282 extends beyond the outer contour of the club head body 214.

In the illustrated embodiment adjustable weighting system 266 includes a single protruding body 270 that extends outwardly from an outer surface 274 of the club head body 214. The protruding body 270 extends from a generally central position between the heel end 222 and toe end 218 of the club head body 210. In other embodiments, the protruding body 270 can extend from any position on the club head 210 similar to the protrusions 70, 170. The protruding body 270 (FIG. 10) defines a discrete attachment location for securing a weight 282 to the club head 210. In contrast to other adjustable weighting systems wherein the weight can be coupled at any, or at an infinite, or at an unlimited number of locations across the club head 10. The protruding body 270 has generally a square cross-sectional shape, which tapers moving away from the outer surface 274 of the club head body 214, such that the generally square cross-section decreases in size moving away from the outer surface 274. As illustrated in FIG. 10, the protruding body 270 has rounds 276 and fillets 280, which give the protruding body 270 a smooth appearance and shape. In other embodiments, the protruding body 270 can have a generally circular, triangular, polygonal, trapezoidal or any other suitable cross-sectional shape.

With continued reference to FIGS. 8-10, the weight 282 couples to the protruding body 270 via a frictional or snap-fit arrangement. The weight 282 is similar to the weights 82, 182, except the weight 282 comprises a first portion 284 which is offset from a surrounding second portion 288 instead of an aperture 86, 186. As illustrated in FIG. 9, the first portion 284 fits over and presses against the protruding body 270, and the second portion 288 that is offset from and extends around the first portion 284 presses against the outer surface 274 of the club head 210.

While only a single protruding body 270 and a single weight 282 are illustrated, in other embodiments the adjustable weighting system 266 includes multiple protruding bodies 270 and multiple weights 282 similar to the adjustable weighting systems 66, 166. Additionally, in other embodiments the location of the protruding body or bodies 270 can differ from that illustrated similar to the adjustable weighting systems 66, 166.

Further, in some embodiments, the adjustable weighting system 266 can comprise a plurality of weights 282. The plurality of weights 282 are made of different materials such that they vary in mass. For example, one weight 282 may be made of a high density material, such as tungsten, and the remaining weights 282 may be made of a less dense material, such as polyurethane or another plastic. In other embodiments, the weights 282 may have different sizes or volumes such that they vary in mass. For example, one weight 282 may have a greater volume than the remaining weights 282. In some embodiments, each of the weights 282 may vary in volume from one another and thus vary in mass. In some embodiments, the weights 282 may vary in both volume and material from one another. In some embodiments, one of the structures labeled as 282 is not a weight, but rather a light-weight (e.g., light-weight plastic) cover that snap-fits or otherwise couples to one of the features 270A, B, C. In some embodiments, the weights 282 may vary between 0.1-50 g. For example, in embodiments having a plurality of weights 282, one or more of the weights 282 may vary between 0-10 g, one or more of the weights 282 may vary between 10-20 g, one or more of the weights 282 may vary between 20-30, one or more of the weights 282 may vary between 30-40 g, and one or more of the weights 282 may vary between 40-50 g. In some embodiments, a first weight 282 may vary between 0-10 g, a second weight 282 may vary between 10-20 g, a third weight 282 may vary between 20-30, a fourth weight 82 may vary between 30-40 g, and a fifth weight 282 may vary between 40-50 g. In other embodiments, a first weight 282 may vary between 1-5 g, and a second and third weight 282 may vary between 5-30 g. In other embodiments, a first and second weight 282 may vary between 1-10 g, and a third and fourth weight 282, may vary between 5-25 g. In some embodiments, a first weight 282 can have a mass of 8.5 grams, and a second and third weight 282 each can have a mass of 1.5 grams. In other embodiments, a first weight 282 can have a mass of 12 grams, and a second and third weight 282 each can have a mass of 1.5 grams. In other embodiments, a first weight 282 can have a mass of 8.5 grams, and a second and third weight 282 each can have a mass of 0.75 grams. In other embodiments, a first weight 282 can have a mass of 10-20 g, 10-25 g, or 15-25 g, and the remaining weight 282 (e.g. second, third, fourth, fifth weight 282) can have a mass of 0.25-2.5 g, 0.25-5 g, 0.25-7.5 g, 0.25 to 10 g. In other embodiments, a first weight 282, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights 282 may have the same mass or may have a varying mass between 0.1-50 g.

The adjustable weighting system 266 of golf club head 210 maintains or prevents a significant reduction in club head moment of inertia, and low and back club head center of gravity positioning, compared to a club head devoid of an adjustable weighting system. The adjustable weighting system 266 of golf club head 210 maintains a high club head moment of inertia and a low and back club head CG position due to the low profile of the weighting system and the perimeter positioning of the one or more weights. The club head 210 having the adjustable weighting system 266 can have similar or identical parameters and measurements as club head 100 described above.

Figure 11:
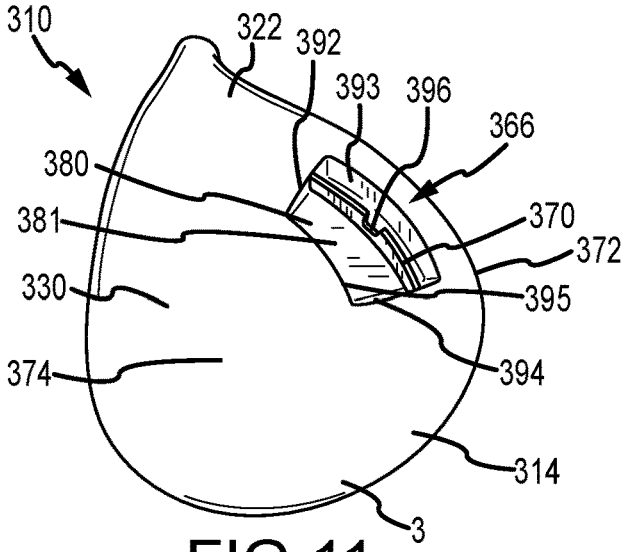
FIGS. 11-13 are perspective views of a golf club head according to another embodiment.
Figure 12:
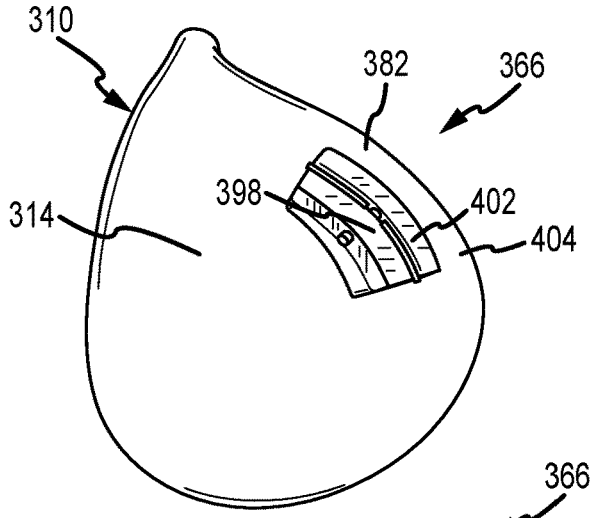
Figure 13:
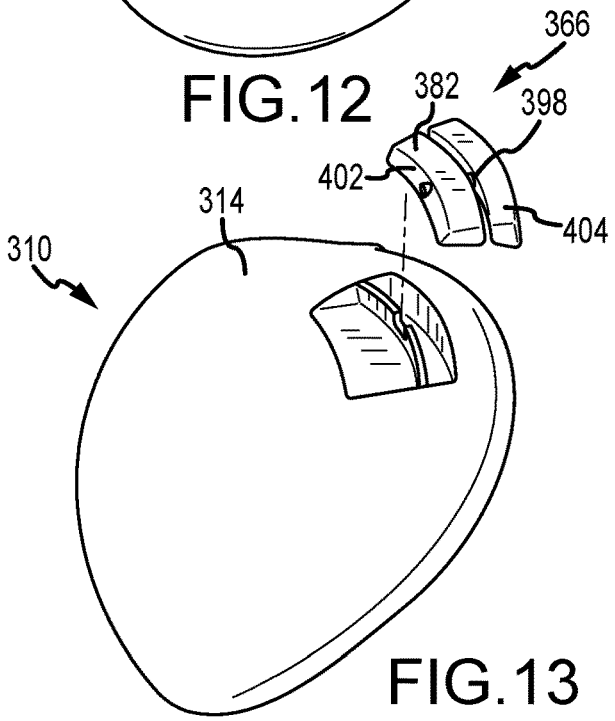

FIGS. 11-13 illustrate a club head 310 having a club head body 314. The club head 310 includes an adjustable weighting system 366 that is adjustable by an end user to modify the club head 310 center of gravity and/or moment of inertia and/or heel/toe bias to achieve desired performance characteristics (e.g., forgiveness, spin, trajectory) under various circumstances. The adjustable weighting system 366 is a low profile system and thereby does not significantly shift or change the club head 310 MOI when compared to a club head not including the adjustable weighting system 366. Further, the low profile adjustable weighting system 366 ensures that shifts in the club head 310 CG occur mainly in a heel end 322 to toe end 318 direction keeping the overall club head 310 CG in a low and back location.

Referring to FIGS. 11-13, the adjustable weight system 366 can comprise a recessed portion 380. The recessed portion 380 comprises a recessed surface 381. The recessed surface 381 can include at least one discrete attachment location. The at least one discrete attachment location can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the recessed portion 381 includes one discrete attachment location. The discrete attachment location comprises a feature in the form of a protruding body 370. In the illustrated embodiment, the protruding body 370 is a rib extending perpendicularly from the recessed surface 381 within the recessed portion 380. Further, the protruding body 370 can comprise a weight 382.

Referring again to FIGS. 11-13, in the illustrated embodiment, the recessed portion 380 comprises a back wall 393, a front edge 395, a first edge 392, and second edge 394. In the illustrated embodiment, the recessed portion 380 extends across a portion of the sole 330 between the center and the heel end 322 following the contour of the trailing edge 373 of the club head 310. In other embodiments, the recessed portion 380 can extend across any portion of the sole 330 of club head 310. Further, the recessed portion 380 can follow the contour of the trailing edge 372 in a curvilinear manner or the recessed portion 380 can extend in a linear manner across the club head 310. In other embodiments, the recessed portion 380 can exist on the sole 330, the trailing edge 372, the crown 326 or top portion, the heel end 322, or the toe end 324 of the club head 310.

In the illustrated embodiment, the recessed surface 381 is tapered from a shallowest part of the recessed portion at the first edge 392 to the deepest part of the recessed portion at the back wall 393. In other embodiments, the recessed portion 380 can have a constant depth, such that the recessed surface 380 extends offset and substantially parallel to the sole 330 of the club head 310. Further, in the illustrated embodiment, the recessed portion 380 has a depth of 0.2 inches offset from the sole 330 of the club head 10. In other embodiments, the recessed portion 380 can have a depth of 0.05 to 1 inches offset from the sole 330 of the club head 310. For example, in some embodiments, the recessed portion 380 can have a depth of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches offset from the sole 30 of the club head 310. The recessed portion 380 can be positioned at any location on the club head 310.

With respect to the number of neighboring protruding bodies 370 and their position the adjustable weighting system 366 can be similar to the adjustable weighting systems 66, 166, 266. The adjustable weighting system 366 includes at least one protruding body 370 (FIG. 11) that receives a weight 382 (FIGS. 12 and 13). In the illustrated embodiment, the adjustable weighting system 366 includes just a single protruding body 370, although other embodiments include more than one protruding body 370. The protruding body 370 defining a discrete attachment location for securing a weight 382 to the club head 310. In contrast to other adjustable weighting systems wherein the weight can be coupled at any, or at an infinite, or at an unlimited number of locations across the recessed portion 380.

The protruding body 370 may be of any shape and any configuration such that one or more weights may be coupled to the protruding body 370 (as opposed to being coupled to ports where the ports are holes or cavities within the body of the club that include for example internal threads to couple to external threads on the weights, creating a low profile weighting system). In the illustrated embodiment, the protruding body 370 is a rib positioned within a recessed portion 380 of the club head 310 along a sole or bottom 330 of the club head 310. The protruding body 370 extends outwardly from the recessed surface 381, and entirely across the recessed portion 380, from the first edge 392 of the recessed portion 380 to the second edge 394 of the recessed portion 380. However, in other embodiments the protruding body 370 extends only partially across the recessed portion 380. For example, in some embodiments the protruding body 370 does not contact the first edge 392 or the second edge 394, and is generally isolated within the recessed portion 380.

With continued reference to FIG. 11, the protruding body 370 includes a slot 396 configured to receive a portion of the weight 382. The slot 396 is located generally centrally within the protruding body 370 between the first edge 392 and the second edge 394. In other embodiments the slot 396 is located at another location along the protruding body 370. In the illustrated embodiment, the slot 396 comprises a rectangular shape. In other embodiments, the slot 396 can comprise a circular, triangular, polygonal, trapezoidal or any other suitable shape. Further, the slot 396 extends through the entire depth of the protruding body 370, measured as the distance from the recessed surface 381 to the top of the protruding body 370. In other embodiments, the slot 396 can extend through a portion of the depth of the protruding body 370. For example, in some embodiments, the slot 396 can extend 10%, 20%, 30%, 40%, 50%, 60%, 70%, 80%, 90%, or 100% of the depth of the protruding body 370. In some embodiments, the protruding body 370 can include more than one slot 396.

In the illustrated embodiment, the weight 382 includes a first portion 402 and a second portion 404. The first portion 402 and the second portion 404 are separated by a gap and connected only by a post 398. The gap between the first portion 402 and the second portion 404 is configured to receive the protruding body 370. The first portion 402 and the second portion 404 slide into the recessed portion 380 of the club head 310 on either side of the protruding body 370 when the weight 382 is coupled to the protruding body 370. The post 398 is configured to fit within the slot 396 when the first portion 402 and second portion 404 are positioned on either side of the protruding body 370. For example, in some embodiments, the post 398 can be rectangular, circular, triangular, polygonal, trapezoidal or any other suitable shape corresponding with the slot 396. Illustrated in FIGS. 12 and 13, is the weight 382 including the post 398 that is sized and shaped to fit into the slot 396 (e.g., in a snap-fit arrangement), to secure the weight 382 onto the protruding body 370.

While only a single weight 382 is illustrated, in other embodiments, the protruding body 370 receives more than one weight 382 (e.g., by use of more than one slot 396). In some embodiments, the adjustable weighting system 366 includes more than one protruding body 370, each of which receives one or more weights 382.

Further, in some embodiments, the adjustable weighting system 366 can comprise a plurality of weights 3823. The plurality of weights 382 are made of different materials such that they vary in mass. For example, one weight 382 may be made of a high density material, such as tungsten, and the remaining weights 382 may be made of a less dense material, such as polyurethane or another plastic. In other embodiments, the weights 382 may have different sizes or volumes such that they vary in mass. For example, one weight 382 may have a greater volume than the remaining weights 382. In some embodiments, each of the weights 382 may vary in volume from one another and thus vary in mass. In some embodiments, the weights 382 may vary in both volume and material from one another. In some embodiments, one of the structures labeled as 382 is not a weight, but rather a light-weight (e.g., light-weight plastic) cover that snap-fits or otherwise couples to one of the features 370A, B, C. In some embodiments, the weights 382 may vary between 0.1-50 g. For example, in embodiments having a plurality of weights 382, one or more of the weights 382 may vary between 0-10 g, one or more of the weights 382 may vary between 10-20 g, one or more of the weights 382 may vary between 20-30, one or more of the weights 382 may vary between 30-40 g, and one or more of the weights 382 may vary between 40-50 g. In some embodiments, a first weight 382 may vary between 0-10 g, a second weight 382 may vary between 10-20 g, a third weight 382 may vary between 20-30, a fourth weight 82 may vary between 30-40 g, and a fifth weight 382 may vary between 40-50 g. In other embodiments, a first weight 382 may vary between 1-5 g, and a second and third weight 382 may vary between 5-30 g. In other embodiments, a first and second weight 382 may vary between 1-10 g, and a third and fourth weight 382, may vary between 5-25 g. In some embodiments, a first weight 382 can have a mass of 8.5 grams, and a second and third weight 382 each can have a mass of 1.5 grams. In other embodiments, a first weight 382 can have a mass of 12 grams, and a second and third weight 382 each can have a mass of 1.5 grams. In other embodiments, a first weight 382 can have a mass of 8.5 grams, and a second and third weight 382 each can have a mass of 0.75 grams. In other embodiments, a first weight 382 can have a mass of 10-20 g, 10-25 g, or 15-25 g, and the remaining weight 382 (e.g. second, third, fourth, fifth weight 382) can have a mass of 0.25-2.5 g, 0.25-5 g, 0.25-7.5 g, or 0.25 to 10 g. In other embodiments, a first weight 382, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights 382 may have the same mass or may have a varying mass between 0.1-50 g.

The adjustable weighting system 366 of golf club head 310 maintains or prevents a significant reduction in club head moment of inertia, and low and back club head center of gravity positioning, compared to a club head devoid of an adjustable weighting system. The adjustable weighting system 366 of golf club head 310 maintains a high club head moment of inertia and a low and back club head CG position due to the low profile of the weighting system and the perimeter positioning of the one or more weights. The club head 310 having the adjustable weighting system 366 can have similar or identical parameters and measurements as club head 100 described above.

Figure 14:
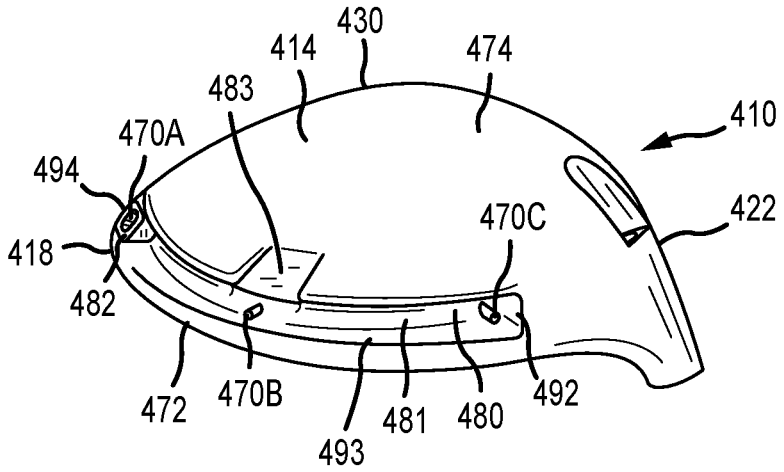
FIGS. 14 and 15 are perspective views of a golf club head according to another embodiment.
Figure 15:
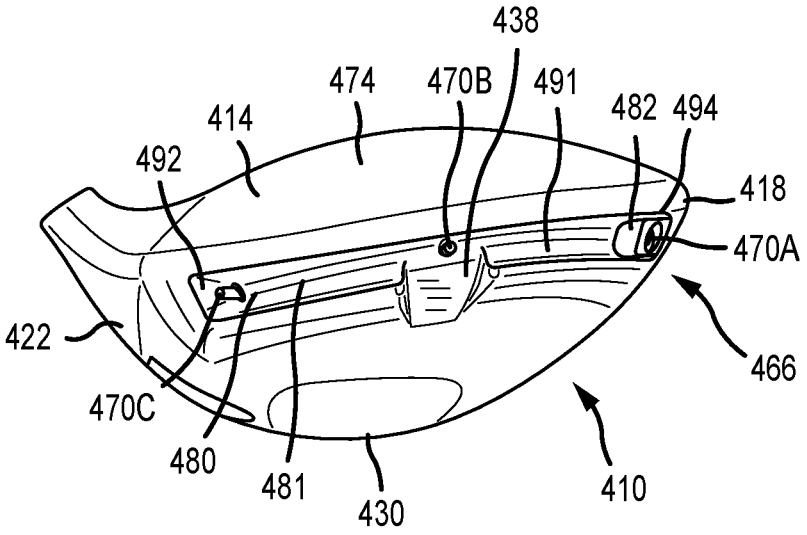

FIGS. 14 and 15 illustrate a club head 410 having a club head body 414. The club head 410 includes an adjustable weighting system 466 that is adjustable by an end user to modify the club head 410 center of gravity and/or moment of inertia and/or heel/toe bias to achieve desired performance characteristics (e.g., forgiveness, spin, trajectory) under various circumstances. The adjustable weighting system 466 is a low profile system and thereby does not significantly shift or change the club head 410 MOI when compared to a club head not including the adjustable weighting system 466. Further, the low profile adjustable weighting system 466 ensures that shifts in the club head 410 CG occur mainly in a heel end 422 to toe end 418 direction keeping the overall club head 410 CG in a low and back location.

Similar to the adjustable weighting system 366, the adjustable weighting system 466 can comprise a recessed portion 480. The recessed portion 480 comprises a recessed surface 481. The recessed surface 481 can include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 366 comprises a recessed surface 381 comprising three discrete attachment locations. Each discrete attachment location comprises a feature in the form of a protruding body 470A, B, C. Further, the protruding body 370 can comprise a weight 382.

Referring again to FIGS. 14 and 15, the recessed surface 481 defines a groove, channel, and/or recessed track that extends along a sole or bottom 430 of the club head 410, adjacent a trailing edge 472, and extends generally in an arcuate configuration from the toe or toe end 418 to the heel or heel end 422. The recessed portion 480 is similar to the recessed portion 380, except it is positioned adjacent the trailing edge 474. The recessed portion 480 comprises a first edge 492 near the heel end 422, a second edge 494 near the toe end 422, a back wall 493 near the trailing edge 472, a wall 491 opposite the back wall 493, and a recessed surface 481 that forms part of an overall outer surface 474 of the club head 410.

With continued reference to FIGS. 14 and 15, the recessed portion 480 further comprises a segment 483 of the recessed surface 481 that extends inwardly toward a center of the club head 410. The segment 483 extends along the sole 430 away from the back wall 493 or trailing edge 472 at location between the first edge 492 and the second edge 494 of the recessed portion 480. The segment 483 provides an enlarged area within which to couple, for example, a larger weight to a protruding body 470C positioned adjacent to the segment 483, than to the first and second protruding bodies 470A, B positioned near the toe and heel ends 418, 422 of the club head 410. In the illustrated embodiment, the segment 483 tapers from the recessed surface 481 to the sole 430 of the club head 410. The tapered segment 483 creates a ramp type surface extending away from the front edge 493 towards the center of the sole 430. In some embodiments, the segment 483 can extend for a length of 0.1 to 2 inches away from the front edge 493 towards the center of the sole 430. For example, in some embodiments, the segment 483 can extend 0.1 to 0.5, 0.3 to 0.7, 0.5 to 1.0, 0.8 to 1.2, 1.0 to 1.4, 1.2 to 1.6, 1.4 to 1.8, or 1.6 or 2.0 inches away from the front edge 493 towards the center of the sole 430.

The recessed portion 480 comprises a length measured as the distance between the first edge 492 and the second edge 49. In some embodiments, the recessed portion 480 can have a length which extends the majority of the distance from the heel end 422 to the toe end 424. In other embodiments, the recessed portion 480 can have a length which extends a portion of the way between the heel end 422 and the toe end 424. Further, in the illustrated embodiment, the recessed portion 480 has a depth of 0.2 inches measured as the distance the recessed surface 481 is offset from the sole 430 of the club head 410. In other embodiments, the recessed portion 480 can have a depth of 0.05 to 1 inches offset from the sole 430 of the club head 410. For example, in some embodiments, the recessed portion 480 can have a depth of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches offset from the sole 430 of the club head 410.

With respect to the number of neighboring protruding bodies 470, their position, and their shape the adjustable weighting system 466 is similar to the adjustable weighting systems 66, 166. The adjustable weighting system 466 includes at least one protruding body 470 that receives a weight. The weights (not shown) can be similar in size, shape and mass to the weight 82 described above. In the illustrated embodiment, the adjustable weighting system 466 includes three protruding bodies 470A, B, C. Each protruding body 470A, B, C defining a discrete attachment location for securing a weight 482 to the club head 410. In contrast to other adjustable weighting systems wherein the weight can be coupled at any, or at an infinite, or at an unlimited number of locations across the recessed portion. In other embodiments, the adjustable weighting system 466 can include 1, 2, 3, 4, 5, 6, 7 or 8 protruding bodies.

The protruding bodies 470 may be of any shapes and any configurations such that one or more weights may be coupled to the protruding bodies 470A,B,C (as opposed to being coupled to ports where the ports are holes or cavities within the body of the club that include for example internal threads to couple to external threads on the weights). For example, in the illustrated embodiment, the protruding bodies 470A, B, C are each generally cylindrical in shape. In other embodiments, the protruding bodies 470A, B, C have square cross-sections, rectangular cross-sections, triangular cross-sections, or any other shapes. Further, the protruding bodies 470A, B, C are positioned within the recessed portion 480 of the club head 410.

The protruding bodies 470A, B, C extend outwardly from the outer surface 474. One of the protruding bodies 470A extends from the recessed surface 481 generally at the toe or toe end 418, one of the protruding bodies 470C extends from the recessed surface 481 generally at the heel or heel end 422, and one of the protruding bodies 470B extends from the recessed surface 481 generally between the toe or toe end 418 and the heel or heel end 422. In other embodiments, any number of protruding bodies 470 can extends outwardly from any location along the outer surface 474. For example, in some embodiments, there can be 1, 2, 3, 4, 5, or 6 protruding bodies 474 extending outwardly from the outer surface 474. Further, in the illustrated embodiment, the protruding bodies 474 can be spaced equidistance from one another. In other embodiments, the protruding bodies 474 can be spaced a varying distance from one another. For example, the protruding bodies 474 can be spaced at any point between the first edge 492 and the second edge 494 spaced by a distance of 0.1 to 3 inches between one another. In other embodiments, the protruding bodies 474 can be spaced at any point between the first edge 492 and the second edge 494 spaced by a distance of 0.1 to 0.5, 0.3 to 1.0, 0.7 to 1.5, 1.0 to 2.0, 1.5 to 2.5, or 2.0 to 3.0 inches between one another. In some embodiments the protruding bodies 470 include exterior threads, and the corresponding weights that couple to the protruding bodies 470 include interior threads (e.g., in apertures of the weights similar to the weights 82 described above), such that the weights are threadably coupled to the protruding bodies 470. In other embodiments, the weights are coupled to the protruding bodies 470 with friction fits, with snap-fit mechanisms, with set screws positioned within threaded inner surfaces of the protruding bodies 470, or with other structures.

In the illustrated embodiment, in some embodiments, each of the weights (not shown) can have the same shape and size. In other embodiments, the weights can vary in shape and size, resulting in different weights having varying masses. Further, in some embodiments, the weights are made of different materials such that they vary in mass. For example, one weight may be made of a high density material, such as tungsten, and the remaining weights may be made of a less dense material, such as polyurethane or another plastic. In other embodiments, the weights may have different sizes or volumes such that they vary in mass. For example, one weight may have a greater volume than the remaining weights. In some embodiments, each of the weights may vary in volume from one another and thus vary in mass. In some embodiments, the weights may vary in both volume and material from one another. In some embodiments, one of the weights can be a light-weight (e.g., light-weight plastic) cover that snap-fits or otherwise couples to one of the protruding bodies 470A, B, C. In some embodiments, the weights may vary between 0.1-50 g. For example, in embodiments having a plurality of weights, one or more of the weights may vary between 0-10 g, one or more of the weights may vary between 10-20 g, one or more of the weights may vary between 20-30, one or more of the weights may vary between 30-40 g, and one or more of the weights may vary between 40-50 g. In some embodiments, a first weight may vary between 0-10 g, a second weight may vary between 10-20 g, a third weight may vary between 20-30, a fourth weight 82 may vary between 30-40 g, and a fifth weight may vary between 40-50 g. In other embodiments, a first weight may vary between 1-5 g, and a second and third weight may vary between 5-30 g. In other embodiments, a first and second weight may vary between 1-10 g, and a third and fourth weight, may vary between 5-25 g. In some embodiments, a first weight can have a mass of 8.5 grams, and a second and third weight each can have a mass of 1.5 grams. In other embodiments, a first weight can have a mass of 12 grams, and a second and third weight each can have a mass of 1.5 grams. In other embodiments, a first weight can have a mass of 8.5 grams, and a second and third weight each can have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The weights may be strategically positioned on the protruding bodies 470A, B, C to achieve a desired club head 410 center of gravity position and/or moment of inertia and/or heel/toe bias. For example, in some embodiments, a heavier weight is positioned on the third protruding body 470B, located between the toe or toe end 418 and the heel or heel end 422, while lighter weights are positioned on the first and second protruding bodies 470A, C near the toe or toe end 418 and the heel or heel end 422. The aforementioned weight placement can result in the center of gravity remaining centered while being shifted towards the back end 6334 of the club head 410. In some embodiments, a heavier weight is positioned on the second protruding body 470C near the heel or heel end 422, while lighter weights are positioned on the first protruding body 470A near the toe or toe end 418 and on the third protruding body 470B that is located between the toe or toe end 418 and the heel or heel end 422. The aforementioned weight placement can result in the center of gravity being shifted towards the heel end 422 of the club head 410. In some embodiments, a heavier weight is positioned on the first protruding body 470A near the toe or toe end 418, while lighter weights are positioned on the protruding body second 470C near the heel or heel end 422 and on the third protruding body 470B that is located between the toe or toe end 418 and the heel or heel end 422. The aforementioned weight placement can result in the center of gravity being shifted towards the toe end 418 of the club head 410. In many embodiments, one or more of the protruding bodies 470A, B, C are of equal size and shape, such that one weight may be interchangeably used with each of the protruding bodies 470A, B, C. In some embodiments, one or more of the protruding bodies 470A, B, C can have a differing size and shape, such that each protruding body 470A, B, C has its own corresponding weight or set of weights.

The adjustable weighting system 466 of golf club head 410 maintains or prevents a significant reduction in club head moment of inertia, and low and back club head center of gravity positioning, compared to a club head devoid of an adjustable weighting system. The adjustable weighting system 466 of golf club head 410 maintains a high club head moment of inertia and a low and back club head CG position due to the low profile of the weighting system and the perimeter positioning of the one or more weights. The club head 410 having the adjustable weighting system 466 can have similar or identical parameters and measurements as club head 100 described above.

Figure 16:
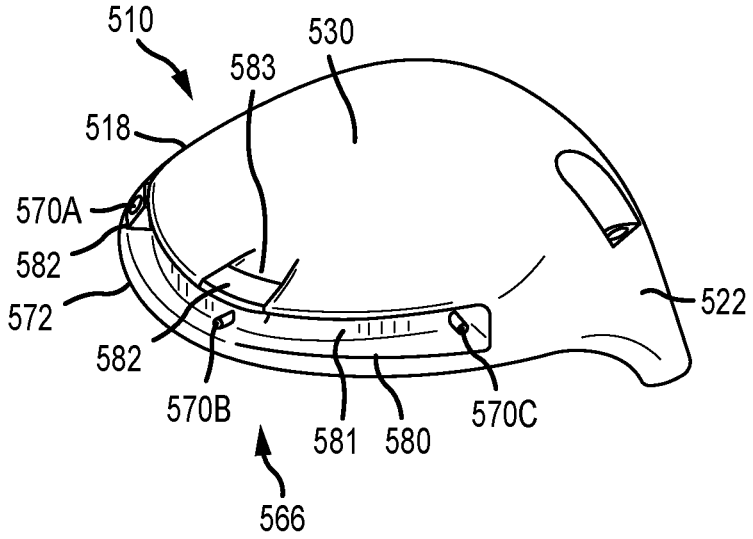
FIGS. 16 and 17 are perspective views of a golf club head according to another embodiment.
Figure 17:
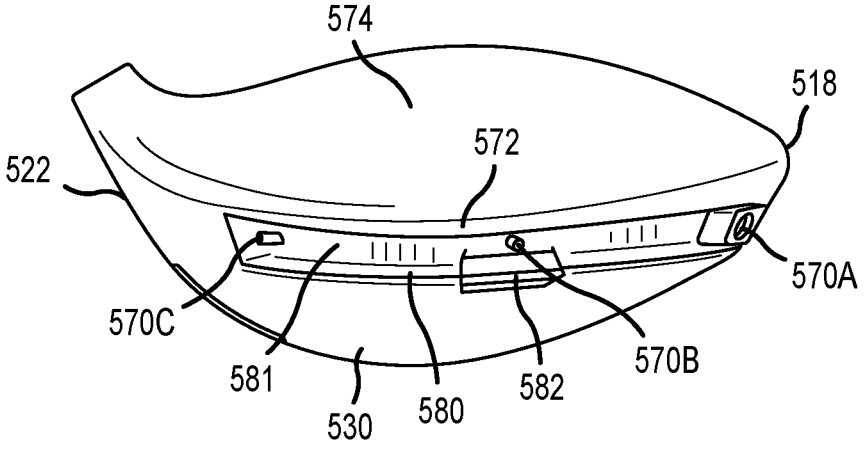

FIGS. 16 and 17 illustrate a club head 510 having a club head body 514. The club head 510 includes an adjustable weighting system 566 that is adjustable by an end user to modify the club head 510 center of gravity and/or moment of inertia and/or heel/toe bias to achieve desired performance characteristics (e.g., forgiveness, spin, trajectory) under various circumstances. The adjustable weighting system 566 is a low profile system and thereby does not significantly shift or change the club head 510 MOI when compared to a club head not including the adjustable weighting system 566. Further, the low profile adjustable weighting system 566 ensures that shifts in the club head 510 CG occur mainly in a heel end 522 to toe end 518 direction keeping the overall club head 510 CG in a low and back location.

Similar to the adjustable weighting system 466, the adjustable weighting system 566 can comprise a recessed portion 580. The recessed portion 580 comprises a recessed surface 581. The recessed surface 581 can include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 566 comprises a recessed surface 581 including three discrete attachment locations. The discrete attachment locations each comprise a feature in the form of a protruding body 570A, B, C. Further, the protruding bodies 570A, B, C can comprise a weight 582.

As illustrated in FIGS. 16 and 17, similar to the recessed portion 480, the recessed portion 580 is generally a groove, channel, and/or recessed track that extends along the sole or bottom 530, adjacent a trailing edge 572 of the club head 510, and extends generally in an arcuate configuration from the toe or toe end 518 to the heel or heel end 522. Further, the recessed portion 580 comprises a segment 583 similar to the segment 483 of the recess 580.

In the illustrated embodiment, one of the protruding bodies 570A is positioned generally at the toe or toe end 518, one of the protruding bodies 570C is positioned generally at the heel or heel end 522, and the other protruding body 570B is positioned between the toe or toe end 518 and the heel or heel end 522. Each protruding body 570A, B, C defining a discrete attachment location for securing a weight 582 to the club head 510. In contrast to other adjustable weighting systems wherein the weight can be coupled at any, or at an infinite, or at an unlimited number of locations across the recessed portion. Further, Similar to the protruding bodies 470 the protruding bodies 570 may be of any shapes and any configurations such that one or more weights may be coupled to the protruding bodies 570 (as opposed to being coupled to ports where the ports are holes or cavities within the body of the club that include for example internal threads to couple to external threads on the weights). For example, in the illustrated embodiment, the protruding bodies 570 are each generally cylindrical in shape. In other embodiments, the protruding bodies 570 have square cross-sections, rectangular cross-sections, triangular cross-sections, or any other shapes.

With continued reference to FIGS. 16 and 17, the adjustable weighting system 566 includes a weight 582 that is positioned on the club head 510 adjacent to the protruding body 570 such that the weight 582 forms a portion of a wall that defines the recessed portion 580. In the illustrated embodiment, the weight 582 can be permanently coupled (e.g. glued, epoxied, welded, brazed, co-molded) to the club head 510. In other embodiments, the weight 582 is coupled to the club head 510 using another protruding body 570 (e.g., a fourth protruding body 570D) positioned within the segment 583. The weight 582 can have any shape. For example, the weight 582 can be rectangular, circular, triangular, trapezoidal, polygonal, or any other suitable shape. In many embodiments, the weight 582 is heavier than the movable weights configured to couple with the protruding bodies 570A, B, C. For example, in the illustrated embodiment, the weight 582 has a mass of 20 g. In other embodiments, the weight 582 can have a mass between 0.5 to 50 g. In other embodiments, the weight 582 can have a mass between 0.5 to 2 g, 1 to 5 g, 3 to 7 g, 5 to 10 g, 7 to 12 g, 10 to 15 g, 15 to 20 g, 20 to 25 g, or 25 to 30 g. The movable weights (not shown) configured to couple with the protruding bodies 570A,B,C can be similar in mass, size, shape, and volume to the weight 82 described above.

The adjustable weighting system 566 of golf club head 510 maintains or prevents a significant reduction in club head moment of inertia, and low and back club head center of gravity positioning, compared to a club head devoid of an adjustable weighting system. The adjustable weighting system 566 of golf club head 510 maintains a high club head moment of inertia and a low and back club head CG position due to the low profile of the weighting system and the perimeter positioning of the one or more weights. The club head 510 having the adjustable weighting system 566 can have similar or identical parameters and measurements as club head 100 described above.

Figure 18:
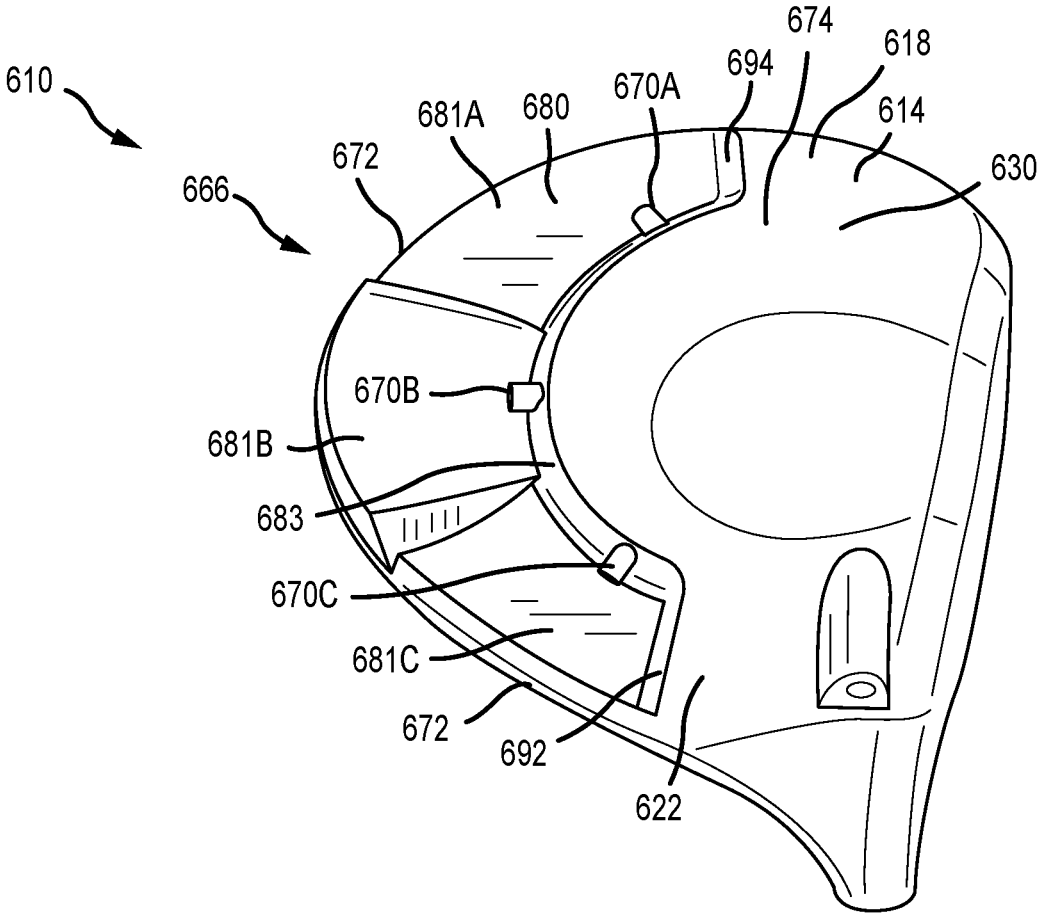
FIG. 18 is a perspective view of a golf club head according to another embodiment.

FIG. 18 illustrates a club head 610 having a club head body 614. The club head 610 includes an adjustable weighting system 666 that is adjustable by an end user to modify the club head 610 center of gravity and/or moment of inertia and/or heel/toe bias to achieve desired performance characteristics (e.g., forgiveness, spin, trajectory) under various circumstances. The adjustable weighting system 666 is a low profile system and thereby does not significantly shift or change the club head 610 MOI when compared to a club head not including the adjustable weighting system 666. Further, the low profile adjustable weighting system 666 ensures that shifts in the club head 610 CG occur mainly in a heel end 622 to toe end 618 direction keeping the overall club head 610 CG in a low and back location.

Referring to FIG. 18, the adjustable weight system 666 can comprise a recessed portion 680. The recessed portion 680 can comprise a plurality of recessed surfaces 681 and a wall 683. The recessed surfaces 681 and/or the wall 683 can include a plurality of discrete attachment locations. The plurality of discrete attachment locations can comprise features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the wall 683 of the recessed portion 683 comprises three discrete attachment locations. Each discrete attachment location comprises a feature in the form of a protruding body 670A, B, C. Further, the protruding bodies 670A, B, C can comprise a weight. Further still, the recessed portion 680 comprises three recessed surfaces 681A, B, C.

Referring again to FIG. 18, in the illustrated embodiment, the recessed portion 680 includes a wall 683, a first edge 692 near the heel end 622 and a second edge 694 near the toe end 618. Further, the recessed portion 680 includes three distinct recessed surfaces 681A, B, C. The recessed surfaces 681A, B, C are disposed adjacent to each other along a sole or bottom 630 of the club head 610. Each recessed surface 681A, B, C can be disposed at a various depth to the recessed surface 681A, B, C adjacent to it, which each form part of an overall outer surface 674 of the club head 610. The recessed surfaces 681 are separated from a remainder of the sole or bottom 630 by the wall 693. The recessed surfaces 681A, B, C have a width defined as the distance they extend between the trailing edge 672 of the club head 610 and the wall 483. In the illustrated embodiment, each of the recessed surface 681A, B, C share a wall 483 and have a width of 1 inch. In other embodiments, the recessed surfaces 681A, B, C can have a width between 0.1 to 3 inches. For example, in some embodiments, the width of the recessed surfaces 681A, B, C can be between 0.1 to 0.5, 0.3 to 1.0, 0.7 to 1.3, 1.0 to 1.5, 1.3 to 1.7, 1.5 to 2.0, 1.7 to 2.3, 2 to 2.5, 2.3 to 2.7, or 2.5 to 3 inches. Further, in other embodiments, the recessed surfaces 681A, B, C can each comprise their own first wall 693 and therefore have differing widths.

In the illustrated embodiment, the recessed surfaces 681A, B, C are positioned adjacent each other, such that a first recessed surface 681A is positioned proximate the second edge 694 near the toe end 618, a second recessed surface 681C is positioned proximate the first edge 694 near the heel end 622, and a third recessed surface 681B is positioned between the first edge 692 near the heel end 622 and the second edge 694 near the toe end 618. As illustrated in FIG. 18, the three recessed surfaces 681A, B, C comprise varying depths measured as the distance offset from the sole 630 of the club head 610. In the illustrated embodiment, the recessed surface 681B is raised or has a shallower depth compared to the recessed surfaces 681A, C. In other embodiments, any of the recessed surfaces 681A, B, C can be raised or have a shallower depth than any of the other recessed surface 681A, B, C. For example, in some embodiments, the middle recessed surface 681B can be lower than the recessed surfaces 681A, C proximate the heel and toe ends 618, 622 of the club head 610. In other embodiments, the recessed surface 681A, the recessed surface 681B, and recessed surface 681C can have varying depths relative the sole 630 of the club head 610. The recessed surfaces 681A, B, C can have depths of 0.05 to 1 inches offset from the sole 630. For example, in some embodiments, the recessed surfaces 681A, B, C can have depths of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches offset from the sole 630. Further, in the illustrated embodiment, recessed surfaces 681A, C proximate the toe end 618 and the heel end 622 of the club head 610 can be tapered towards the trailing edge 672. In other embodiments, the recessed surfaces 681A, C can extend generally parallel to the sole 630 towards the trailing edge 672. In other embodiments, any of the recessed surfaces 681681A, B, C can taper towards the trailing edge 672 and any of the remaining recessed surfaces 681681A,B,C can extend substantially parallel to the sole 630 surface. Further, in other embodiments, the recessed portion 680 can comprise 1, 2, 3, 4, 5, 6, or any other number of recessed surfaces 681.

With respect to the number of neighboring protruding bodies 670 and their positioning the adjustable weight system 666 is similar to the adjustable weighting systems 66, 166, 266, 366, 466, 566. The adjustable weighting system 666 includes at least one protruding body 670 that receives a weight. The weight (not shown) can be similar to the weight 82, described above. In the illustrated embodiment, the adjustable weighting system 666 includes three protruding bodies 670A,B,C each defining a discrete attachment location for securing a weight 682 to the club head 610. In contrast to other adjustable weighting systems wherein the weight can be coupled at any, or at an infinite, or at an unlimited number of locations across the recessed portion 680. In other embodiments, the adjustable weighting system 666 can include more or less that three protruding bodies 670.

The protruding bodies 670A, B, C can be similar to the protruding bodies 70, 170, 470, 570 described above and may be of any shapes and any configurations such that one or more weights may be coupled to the protruding bodies 670A, B, C (as opposed to being coupled to ports where the ports are holes or cavities within the body of the club that include for example internal threads to couple to external threads on the weights). For example, in the illustrated embodiment, the protruding bodies 670 are each generally cylindrical in shape. In other embodiments, the protruding bodies 670 have square cross-sections, rectangular cross-sections, triangular cross-sections, or any other shapes.

The protruding bodies 670A, B, C extend outwardly from the outer surface 674. In the illustrated embodiment, protruding bodies 670A, B, C extend outward from the wall 694 in a direction generally towards the trailing edge 672. In other embodiments, the protruding bodies 670 A, B, C can extend outward from the recessed surface 681. Further, in the illustrated embodiment, one of the protruding bodies 670A is positioned generally at the recessed surface 681A or toe end 618 and extends from the wall 683, one of the protruding bodies 670C is positioned generally at the recessed surface 681C or heel end 622 and extends from the wall 683, and the other protruding body 670B is positioned between the recessed surface 681A or toe end 618 and the recessed surface 681C or heel end 622 and extends from the wall 683. In other embodiments, there can be 1, 2, 3, 4, 5, or 6 protruding bodies 670 extending outwardly from the outer surface 674. Further, in some embodiments, the protruding bodies 674 can be spaced equidistance from one another. In other embodiments, the protruding bodies 674 can be spaced a varying distance from one another. For example, the protruding bodies 674 can be spaced at any point between the first edge 692 and the second edge 694 spaced by a distance of 0.1 to 3 inches between one another. In other embodiments, the protruding bodies 674 can be spaced at any point between the first edge 692 and the second edge 694 spaced by a distance of 0.1 to 0.5, 0.3 to 1.0, 0.7 to 1.5, 1.0 to 2.0, 1.5 to 2.5, or 2.0 to 3.0 inches between one another.

In the illustrated embodiment, in some embodiments, each of the weights (not shown) can have the same shape and size. In other embodiments, the weights can vary in shape and size, resulting in different weights having varying masses. Further, in some embodiments, the weights are made of different materials such that they vary in mass. For example, one weight may be made of a high density material, such as tungsten, and the remaining weights may be made of a less dense material, such as polyurethane or another plastic. In other embodiments, the weights may have different sizes or volumes such that they vary in mass. For example, one weight may have a greater volume than the remaining weights. In some embodiments, each of the weights may vary in volume from one another and thus vary in mass. In some embodiments, the weights may vary in both volume and material from one another. In some embodiments, one of the protruding bodies 670A, B, C can comprise a light-weight (e.g., light-weight plastic) cover that snap-fits or otherwise couples to one of the protruding bodies 670A, B, C. In some embodiments, the weights may vary between 0.1-50 g. For example, in embodiments having a plurality of weights, one or more of the weights may vary between 0-10 g, one or more of the weights may vary between 10-20 g, one or more of the weights may vary between 20-30, one or more of the weights may vary between 30-40 g, and one or more of the weights may vary between 40-50 g. In some embodiments, a first weight may vary between 0-10 g, a second weight may vary between 10-20 g, a third weight may vary between 20-30, a fourth weight 82 may vary between 30-40 g, and a fifth weight may vary between 40-50 g. In other embodiments, a first weight may vary between 1-5 g, and a second and third weight may vary between 5-30 g. In other embodiments, a first and second weight may vary between 1-10 g, and a third and fourth weight, may vary between 5-25 g. In some embodiments, a first weight can have a mass of 8.5 grams, and a second and third weight each can have a mass of 1.5 grams. In other embodiments, a first weight can have a mass of 12 grams, and a second and third weight each can have a mass of 1.5 grams. In other embodiments, a first weight can have a mass of 8.5 grams, and a second and third weight each can have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The weights may be strategically positioned on the protruding bodies 670A, B, C to achieve a desired club head 610 center of gravity position and/or moment of inertia and/or heel/toe bias. For example, in some embodiments, a heavier weight is positioned on the third protruding body 670B, located between the toe or toe end 618 and the heel or heel end 622, while lighter weights are positioned on the first and second protruding bodies 670A, C near the toe or toe end 618 and the heel or heel end 622. The aforementioned weight placement can result in the center of gravity remaining centered while being shifted towards the back end 6334 of the club head 610. In some embodiments, a heavier weight is positioned on the second protruding body 670C near the heel or heel end 622, while lighter weights are positioned on the first protruding body 670A near the toe or toe end 618 and on the third protruding body 670B that is located between the toe or toe end 618 and the heel or heel end 622. The aforementioned weight placement can result in the center of gravity being shifted towards the heel end 622 of the club head 610. In some embodiments, a heavier weight is positioned on the first protruding body 670A near the toe or toe end 618, while lighter weights are positioned on the protruding body second 670C near the heel or heel end 622 and on the third protruding body 670B that is located between the toe or toe end 618 and the heel or heel end 622. The aforementioned weight placement can result in the center of gravity being shifted towards the toe end 618 of the club head 610. In many embodiments, one or more of the protruding bodies 670A, B, C are of equal size and shape, such that one weight may be interchangeably used with each of the protruding bodies 670A, B, C. In some embodiments, one or more of the protruding bodies 670A, B, C can have a differing size and shape, such that each protruding body 670A, B, C has its own corresponding weight or set of weights.

The adjustable weighting system 666 of golf club head 610 maintains or prevents a significant reduction in club head moment of inertia, and low and back club head center of gravity positioning, compared to a club head devoid of an adjustable weighting system. The adjustable weighting system 666 of golf club head 610 maintains a high club head moment of inertia and a low and back club head CG position due to the low profile of the weighting system and the perimeter positioning of the one or more weights. The club head 610 having the adjustable weighting system 666 can have similar or identical parameters and measurements as club head 100 described above FIGS. 19 and 20 illustrate a club head 710 having a club head body 714. The club head 710 includes an adjustable weighting system 766 that is adjustable by an end user to modify the club head 710 center of gravity and/or moment of inertia and/or heel/toe bias to achieve desired performance characteristics (e.g., forgiveness, spin, trajectory) under various circumstances. The adjustable weighting system 766 is a low profile system and thereby does not significantly shift or change the club head 710 MOI when compared to a club head not including the adjustable weighting system 766. Further, the low profile adjustable weighting system 766 ensures that shifts in the club head 710 CG occur mainly in a heel end 722 to toe end 718 direction keeping the overall club head 710 CG in a low and back location.

Figure 19:
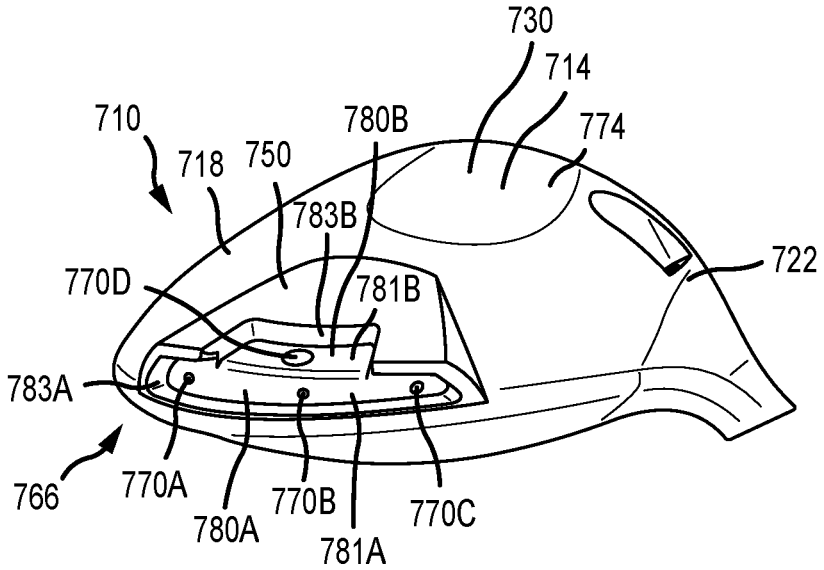
FIGS. 19 and 20 are perspective views of a golf club head according to another embodiment.
Figure 20:
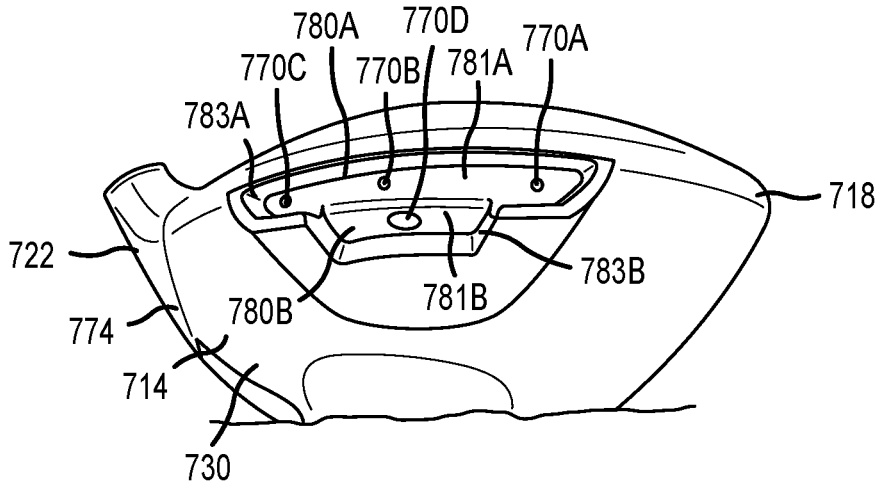

Referring to FIGS. 19-20, the adjustable weight system 766 can comprise an extended portion 750. The extended portion 750 comprises at least one recessed portion 780. The recessed portion 780 comprises a recessed surface 781. The recessed surface 781 can include a plurality of discrete attachment locations. The plurality of discrete attachment locations can comprise features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weight system 766 comprises two recessed portions 780A, B having two recessed surfaces 781A, 781B. The two recessed surfaces 781A, B including a total of four discrete attachment locations. The discrete attachment locations can comprise any of the features mentioned in the list above. In the illustrated embodiment, the features 770 are illustrated by a circle on the recessed surfaces 781A, 781B.

Referring again to FIGS. 19-20, in the illustrated embodiment, the extended portion 750 is protruded outward from the sole 730 and extends from a first end 751 near the center of the sole 730 to a second end 752 at or near the trailing edge 772. The surface of the extended portion 750 forming a part of the overall outer surface 774 of the club head 710. In other embodiments, the extended portion 750 can have a first end 751 positioned at any point between the trailing edge 772 and the center of the sole 730. In the same or other embodiments, the extended portion 750 can have a second end 752 positioned at any point between the first end 751 and the trailing edge 772. Further, the extended portion 750 comprises a width measured as the distance it extends from a heel 722 to a toe 718 direction. In the illustrated embodiment, the extended portion 750 has a width which increases from near the center of the sole 730 to the trailing edge 772 of the club head 710. In other embodiments, the width of the extended portion 750 can increase, decrease or remain constant from the first end 751 to the second end 752. Additionally, the extended portion 750 protrudes outwards from the sole 730 at a height measured at the distance from the sole 730 to the top surface 755 of the extended portion 750. In the illustrated embodiment, the height of the extended portion 750 increases from the first end 751 to the second end 752. In other embodiments, the height of the extended portion 750 can increase, decrease or remain the same from the first end 751 to the second end 752 of the extended portion 750. The extended portion 750 can have a height between 0.05 to 1 inches. For example, in some embodiments, the height of the extended portion 750 can be between 0.05 to 0.15, 0.1 to 0.2, 0.15 to 0.25, 0.2 to 0.3, 0.25 to 0.35, 0.3 to 0.4, 0.35 to 0.45, 0.4 to 0.5, 0.45 to 0.55, 0.5 to 0.6, 0.55 to 0.65, 0.6 to 0.7, 0.65 to 0.75, 0.7 to 0.8, 0.75 to 0.85, 0.8 to 0.9, 0.85 to 0.95, or 0.9 to 1.0 inches.

Referring again to FIGS. 19-20, in the illustrated embodiment, the adjustable weighting system 766 includes two recessed portion 780A, B each having a recessed surface 781A, B. The recessed portions 780A, B are disposed both disposed in the first end 751 of the extended portion 750. Each recessed surface 781A, B comprises a wall 783A,B defining a perimeter of the recessed portion 780A,B and separating the recessed surface 781A, B from the surface of the extended portion 750. In the illustrated embodiment, the recessed portion 780A, B are generally adjacent to each other, such that a first recessed surface 781A faces the trailing edge 772 of the club head 710, and a second recessed surface 782B is substantially perpendicular with the first recessed surface 781A and substantially parallel with the top surface 755 of the extended portion 750. In other embodiments, the recessed portion 780 and thus the recessed surfaces 781 can be positioned in any position along the extended portion 750. Further, each recessed portion 780A, B comprises a depth measured as the distance the recessed surface 781A, B is offset from the surface of the extended portion 750. In many embodiments, the recessed surfaces 781A, B can have depths of 0.05 to 1 inches. For example, in some embodiments, the recessed surfaces 781A, B can have depths of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches.

For purposes of this example, the features 770 will be referred to as protruding bodies 770, however the feature 770 can refer to any of the features 770 mentioned above. With respect to the number of neighboring protruding bodies 770 and their positioning the adjustable weight system 766 is similar to the adjustable weighting systems 66, 166, 266, 366, 466, 566, 666. The adjustable weighting system 766 includes at least one protruding body 770 that receives a weight. The weight (not shown) can be similar to the weight 82, described above. In the illustrated embodiment, the adjustable weighting system 766 includes four protruding bodies 770A, B, C, D although other embodiments can include more or less that four protruding bodies 770. Each protruding body 770A, B, C, D defining a discrete attachment location for securing a weight 782 to the club head 710. In contrast to other adjustable weighting systems wherein the weight can be coupled at any, or at an infinite, or at an unlimited number of locations across the recessed portion.

The protruding bodies 770 are similar to the protruding bodies 70, 170, 470, 570, 670 described above, and may be of any shapes and any configurations such that one or more weights may be coupled to the protruding bodies 770 (as opposed to being coupled to ports where the ports are holes or cavities within the body of the club that include for example internal threads to couple to external threads on the weights). For example, the protruding bodies 770 may be cylindrical in shape, have square cross-sections, rectangular cross-sections, triangular cross-sections, or have any other shapes.

The protruding bodies 770A, B, C, D extend outwardly from the outer surface 774. Three of the protruding bodies 770A, B, C are positioned on the recessed surface 781A, and the fourth protruding body 770D is positioned on the other recessed surface 781B. More specifically, a first protruding body 770 A is positioned near the toe end 818, a second protruding body is positioned near the heel end 822, a third protruding body 770C is positioned between the toe and heel end 818, 822, a fourth protruding body 770D is positioned centered on the recessed surface 781B. In other embodiments the protruding body or bodies 770A, B, C, D are positioned at different locations. As illustrated in FIGS. 19 and 20, one of the protruding bodies 770D positioned on the recessed surface 781B is larger than the other protruding bodies 770A, B, C (as schematically illustrated by the larger circle). The larger protruding body 770D may, for example, be coupled to a heavier swing weight to alter a center of gravity (CG) position and reduce of a moment of inertia (MOI), while the other protruding bodies 770A, B, C may, for example, may be coupled to smaller swing weights to affect ball flight path, depending upon a fade or draw bias. In some embodiments the protruding bodies 770A, B, C, D are all of equal size, but one of the protruding bodies 770A, B, C, D is coupled to a heavier weight than the other protruding bodies 770A, B, C, D. In other embodiments, the protruding bodies 770A, B, C, D are the same size and are coupled to weights having the same mass. Further, the protruding bodies 770A, B, C, D may be located at any position within the recessed portions 780A,B. In some embodiments, the protruding bodies 770A, B, C, D may be positioned equidistance between one another within the recessed portion 780A, B. In other embodiments, the protruding bodies 770A, B, C, D may be positioned at a variable distance between one another within the recessed portion 780A, B. The weights (not shown) configured to couple with the protruding bodies 770A,B, C, D can have the same mass, size, shape as the weights 82 described above. Further, shifting the weights between the protruding bodies 770A, B, C can have the same effects as discussed in previous embodiments. However, shifting a heavier weight to the protruding body 770D can further shift the club head CG lower and further back on the club head 710, affecting the spin imparted on the golf ball.

The adjustable weighting system 766 of golf club head 710 maintains or prevents a significant reduction in club head moment of inertia, and low and back club head center of gravity positioning, compared to a club head devoid of an adjustable weighting system. The adjustable weighting system 766 of golf club head 710 maintains a high club head moment of inertia and a low and back club head CG position due to the low profile of the weighting system and the perimeter positioning of the one or more weights. The club head 710 having the adjustable weighting system 766 can have similar or identical parameters and measurements as club head 100 described above.

Figure 21:
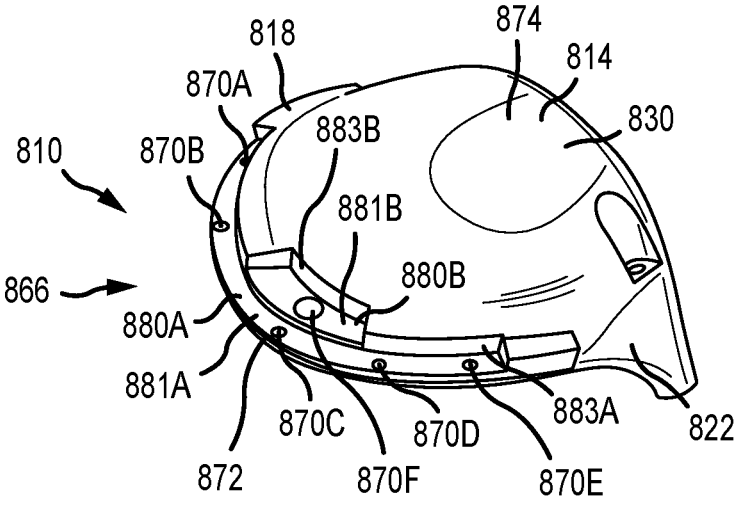
FIGS. 21 and 22 are perspective views of a golf club head according to another embodiment.
Figure 22:
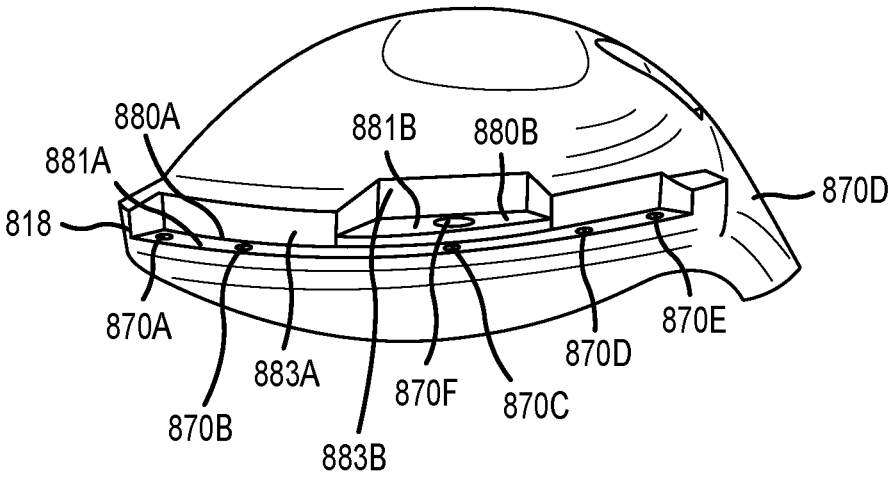

FIGS. 21 and 22 illustrate a club head 810 having a club head body 814. The club head 810 includes an adjustable weighting system 866 that is adjustable by an end user to modify the club head 810 center of gravity and/or moment of inertia and/or heel/toe bias to achieve desired performance characteristics (e.g., forgiveness, spin, trajectory) under various circumstances. The adjustable weighting system 866 is a low profile system and thereby does not significantly shift or change the club head 810 MOI when compared to a club head not including the adjustable weighting system 866. Further, the low profile adjustable weighting system 866 ensures that shifts in the club head 810 CG occur mainly in a heel end 822 to toe end 818 direction keeping the overall club head 810 CG in a low and back location.

Referring to FIGS. 21-22, the adjustable weight system 866 can comprise an extended portion 850 having a recessed portion 880. The recessed portion 880 comprising at least one recessed surface 881. The recessed surface 881 can include a plurality of discrete attachment locations. The plurality of discrete attachment locations can comprise features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 866 comprises a recessed portion 880 having two recessed surfaces 881A, 881B. The two recessed surfaces 881A, B including a total of six discrete attachment locations. The discrete attachment locations can comprise any of the features mentioned in the list above. In the illustrated embodiment, the features 870A, B, C, D, E, F are illustrated by a circle on the recessed surfaces 881A, 881B. The features 870A, B, C, D, E, F are further configured to comprise at least one weight (not shown).

Referring to FIGS. 21-22, in the illustrated embodiment, the extended portion 850 extends from a first end 851 on the sole 830 to a second end 852 at or near the trailing edge 872. The extended portion 850 follows the contour of the trailing edge 872 from the heel end 822 to the toe end 818 of the club head 810. The surface of the extended portion 850 forming a part of the overall surface 874 of the club head 810. The extended portion 850 has a length measured as the distance the first end 851 on the sole 830 to the second end 852 at or near the trailing edge 872. In many embodiments, the extended portion 850 can have a length of 0.1 to 2 inches. For example, in some embodiments, the extended portion 850 can have a length of 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches. Additionally, the extended portion 850 protrudes outwards from the sole 830 at a height measured at the distance from the sole 830 to a top surface 855 of the extended portion 850. In the illustrated embodiment, the height of the extended portion 850 increases from the first end 851 to the second end 852. In other embodiments, the height of the extended portion 850 can increase, decrease or remain the same from the first end 851 to the second end 852 of the extended portion 850. The extended portion 850 can have a height between 0.05 to 1 inches. For example, in some embodiments, the height of the extended portion 850 can be between 0.05 to 0.15, 0.1 to 0.2, 0.15 to 0.25, 0.2 to 0.3, 0.25 to 0.35, 0.3 to 0.4, 0.35 to 0.45, 0.4 to 0.5, 0.45 to 0.55, 0.5 to 0.6, 0.55 to 0.65, 0.6 to 0.7, 0.65 to 0.75, 0.7 to 0.8, 0.75 to 0.85, 0.8 to 0.9, 0.85 to 0.95, or 0.9 to 1.0 inches.

Similar to the adjustable weighting system 766, in the illustrated embodiment, the adjustable weighting system 866 comprises two recessed portions 880A, B each having a recessed surface 881A, B. Further, each recessed portion 880A, B comprises a wall 883A, B defining a perimeter of the recessed portion 880A, B and separating the recessed surfaces 881A, B from the surface 874 of the club head 810. The recessed surface 881A, B are positioned adjacent each other, however alternative to the recessed surfaces 781A, B of the recessed portions 780A,B, the recessed surfaces 881A, B face the same direction substantially parallel with the top surface 855 of the extended portion 850. In the illustrated embodiment, a first one of the recessed portions 880A is positioned adjacent the trailing edge 872 and has a width which extends from the heel end 822 to the toe end 818 of the club head 820. Further, a second one of the recessed portions 880B is offset from the trailing edge by the width of the first recessed portion 880A and is positioned between the heel end 822 and toe end 818 of the club head 810. Further, the recessed portions 880A, B have a depth measured as the distance the recessed surface 881A, B is offset from the outer surface 874. In the illustrated embodiment, the depth of the recessed surface 881A is greater than the depth of the recessed surface 881B. In other embodiments, the depth of the recessed surface 881A can be less than the depth of the recessed surface 881B. In many embodiments, the recessed surfaces 881A, B can have depths of 0.05 to 1 inches. For example, in some embodiments, the recessed surfaces 881A, B can have depths of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches. In other embodiments, the adjustable weight system 866 can have any number of recessed portions 880. For example, the adjustable weight system 866 can have 1, 2, 3, 4, 5, 6, 7, or 8 recessed portions 880.

For purposes of this example, the features 870 will be referred to as protruding bodies 870, however the feature 870 can refer to any of the features 870 mentioned above. With respect to the number of neighboring protruding bodies 870 and their position the adjustable weight system 866 is similar to the adjustable weighting system 66, 166, 266, 366, 466, 566, 666, 766. The adjustable weighting system 866 includes at least one protruding body 880 (illustrated schematically by the circles marked on the figures) that receives a weight. The weight (not shown) can be similar to the weights 82, described above. In the illustrated embodiment, the adjustable weighting system 866 includes six protruding bodies 870A, B, C, D, E, F. In other embodiments, the adjustable weight system 866 can comprise 1, 2, 3, 4, 5, 6, 7, or 8 protruding bodies 870 and the recessed portions 880A, B can be positioned on any outer surface 874 of the club head 810.

The protruding bodies 870 can be similar to the protruding bodies 70, 170, 470, 570, 670, 770 and may be of any shapes and any configurations such that one or more weights may be coupled to the protruding bodies 870 (as opposed to being coupled to ports where the ports are holes or cavities within the body of the club that include for example internal threads to couple to external threads on the weights). For example, the protruding bodies 870 may be cylindrical in shape, have square cross-sections, rectangular cross-sections, triangular cross-sections, or have any other shapes.

The protruding bodies 870A, B, C, D, E, F extend outwardly from the recessed surfaces 881A, B. In the illustrated embodiment, there are five protruding bodies 870A, B, C, D, E positioned on one of the recessed surface 881A (i.e., the lower recessed surface 881 positioned adjacent the trailing edge 872), and a sixth protruding body 870F is positioned on the second recessed surface 881B (i.e., the raised recessed surface 881, offset from the trailing edge 872). More specifically, a first protruding body 870A is positioned generally at the toe end 818, a second protruding body 870E is positioned generally at the heel end 822, a third protruding body 870C is positioned between the toe end 818 and the heel end 822, a fourth protruding body 870B is positioned between the first protruding body 870A and the third protruding body 870C, a fifth protruding body is positioned between the third protruding body 870C and the second protruding body 870E, and finally a sixth protruding body 870F is positioned centered on the recessed surface 881B. Each protruding body 870A, B, C, D, E, F defining a discrete attachment location for securing a weight 882 to the club head 810. In contrast to other adjustable weighting systems wherein the weight can be coupled at any, or at an infinite, or at an unlimited number of locations across the recessed portion. In other embodiments the protruding body or bodies 870A, B, C, D, E, F are positioned at different locations. As illustrated in FIGS. 21 and 22, the protruding body 870F on the raised recess surface 881B is larger than the other protruding bodies 870A, B, C, D, E. The larger protruding body 870F may, for example, be used to couple to a heavier weight than the other protruding bodies 870A, B, C, D, E (e.g., to a heavier swing weight). In some embodiments the protruding bodies 870A, B, C, D, E, F are all of equal size, but one of the protruding bodies 870A, B, C, D, E, F is coupled to a heavier weight than the other protruding bodies 870A, B, C, D, E, F. In other embodiments, the protruding bodies 870A, B, C, D, E, F are the same size and are coupled to weights having the same mass. Further, the protruding bodies 870A, B, C, D, E, F may be located at any position within the recessed portion 880A, B. In some embodiments, the protruding bodies 870A, B, C, D, E, F may be positioned equidistance between one another within the recessed portion 880A, B. In other embodiments, the protruding bodies 870A, B, C, D, E, F may be positioned at a variable distance between one another within the recessed portion 880A, B. The weights (not shown) configured to couple with the protruding bodies 870A, B, C, D can have the same mass, size, shape as the weights 82 described above. Further, shifting the weights between the protruding bodies 870A, B, C, D, in a toe to heel manner can have the same effects as discussed in previous embodiments (Shifting the CG from the heel end 922 to the toe end 918). However, shifting a heavier weight to the protruding body 870E can further shift the club head CG lower and forward on the club head 810, affecting the spin imparted on the golf ball.

The adjustable weighting system 866 of golf club head 810 maintains or prevents a significant reduction in club head moment of inertia, and low and back club head center of gravity positioning, compared to a club head devoid of an adjustable weighting system. The adjustable weighting system 866 of golf club head 810 maintains a high club head moment of inertia and a low and back club head CG position due to the low profile of the weighting system and the perimeter positioning of the one or more weights. The club head 810 having the adjustable weighting system 866 can have similar or identical parameters and measurements as club head 100 described above.

Figure 23:
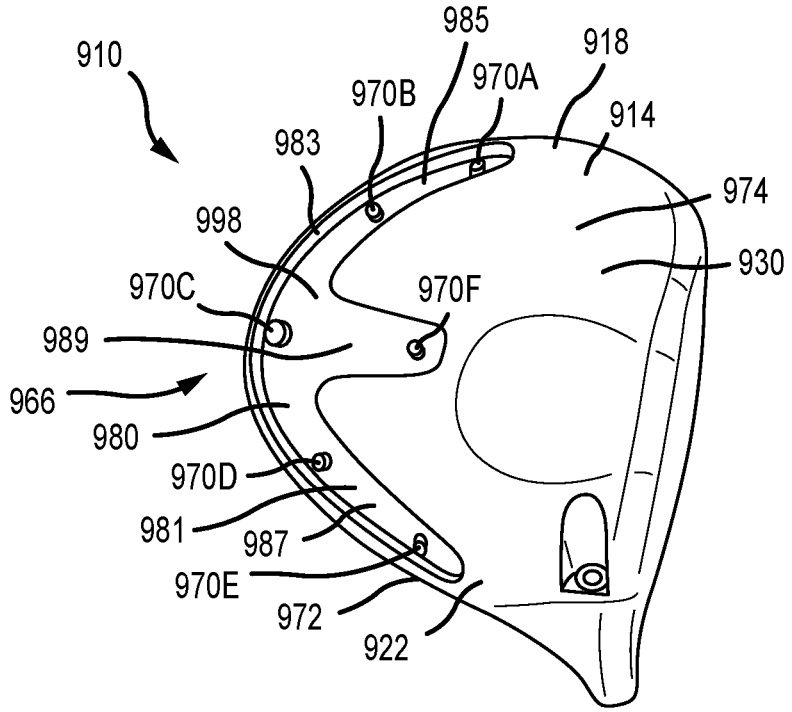
FIGS. 23 and 24 are perspective views of a golf club head according to another embodiment.
Figure 24:
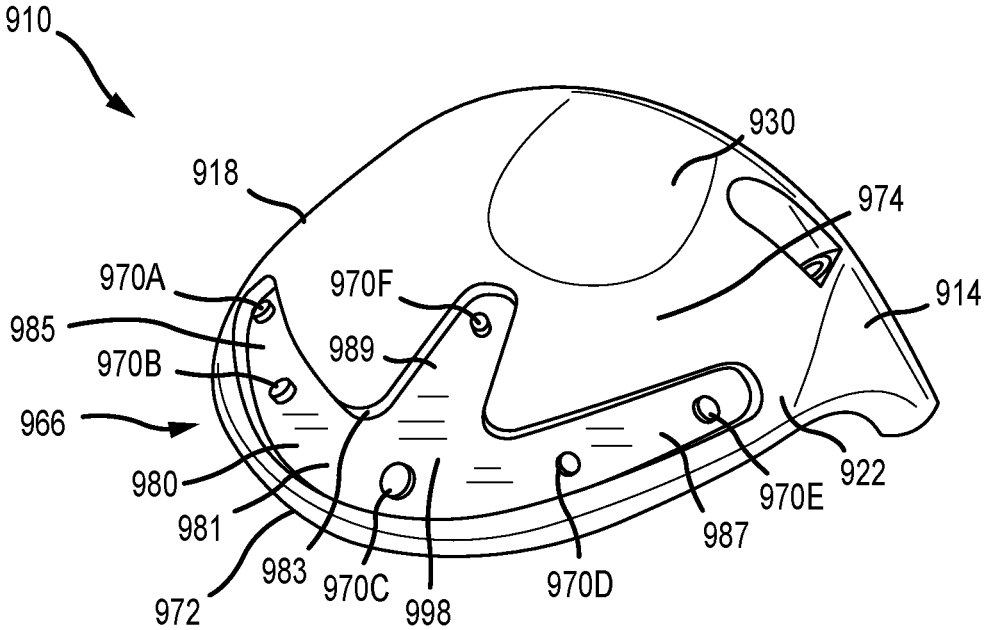

FIGS. 23 and 24 illustrate a club head 910 having a club head body 914. The club head 910 includes an adjustable weighting system 966 that is adjustable by an end user to modify the club head 910 center of gravity and/or moment of inertia and/or heel/toe bias to achieve desired performance characteristics (e.g., forgiveness, spin, trajectory) under various circumstances. The adjustable weighting system 966 is a low profile system and thereby does not significantly shift or change the club head 910 MOI when compared to a club head not including the adjustable weighting system 966. Further, the low profile adjustable weighting system 966 ensures that shifts in the club head 910 CG occur mainly in a heel end 922 to toe end 918 direction keeping the overall club head 910 CG in a low and back location.

Referring to FIGS. 23-24, the adjustable weight system 966 can comprise a recessed portion 980. The recessed portion 980 comprises a recessed surface 981, which can include a plurality of discrete attachment locations. The plurality of discrete attachment locations can comprise features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weight system 966 comprises a recessed surface including 6 discrete attachment locations. The discrete attachment locations each having a feature in the form of a protruding bodies 970. Further, the protruding bodies 970 are configured to receive a weight.

Referring again to FIGS. 23-24, the recessed portion 980 includes a wall 983 that defines a perimeter around the recessed surface 981, and separates the recessed surface 981 from a remainder of the outer surface 974 or sole 930. As illustrated in FIGS. 23 and 24, the recessed surface 981 has a first portion 985 that extends from an intersection region 998 toward a toe or toe end 918 of the club head 910, a second portion 987 that extends from the intersection region 998 toward to a heel or heel end 922 of the club head 910, and a third portion 989 that extends generally inwardly from the intersection region 998 toward a center of the sole or bottom 930. In the illustrated embodiment, the first and second portions 985, 987 extend 3 inches from the center of the intersection region 998, while the third portion 998 extends 1.5 inches from the center of the intersection region 998. In other embodiments, the first, second and third portions 985, 987, 989 can extend an equal distance from the center of the intersection region 998. In other embodiments, the first, second and third portion 985, 987, 989 can all extend different distances from the center of the intersection region 998. In some embodiments, the first, second and third portions 985, 987, 989 can extend between 0.5 to 4 inches from the center of the intersection region 998. In other embodiments, the first, second and third portions 985, 987, 989 can extend between 0.5 to 1.0, 0.75 to 1.25, 1.0 to 1.5, 1.25 to 1.75, 1.5 to 2.0, 1.75 to 2.25, 2.0 to 2.5, 2.25 to 2.75, 2.5 to 3.0, 2.75 to 3.25, 3.0 to 3.5, 3.25 to 3.75, or 3.5 to 4.0 inches from the center of the intersection region 998. Further, the recessed portion 980 has a depth measured as the distance from the outer surface 974 or sole 930 to the recessed surface 981. In the illustrated embodiment, the recessed surface 981 has a constant depth across all of the first, second, and third portions 985, 957,959 of the recessed surface 981. In many embodiments, the recessed surface 981 can have a depth of between 0.05 to 1 inches. For example, in some embodiments, the recessed surface 981 can have depth of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches.

With respect to the number of neighboring protruding bodies 970 A,B,C,D,E,F and their position the adjustable weighting system 966 can be similar to the adjustable weighting systems 66, 166, 466, 566, 666, 766, 866. In the illustrated embodiment, the adjustable weighting system 966 includes at least one protruding body 970 that receives a weight. In the illustrated embodiment, the adjustable weighting system 966 includes six protruding bodies 970A, B, C, D, E, F. The protruding bodies 970 are positioned within a recessed portion 980 of the club head 910 along a sole or bottom 930 of the club head 910. In other embodiments, the adjustable weighting system 966 can comprise 1, 2, 3, 4, 5, 6, 7, or 8 protruding bodies 970.

The protruding bodies 970A, B, C, D, E, F are similar to the protruding bodies 70, 170, 470, 570, 670, 770, 870 and may be of any shapes and any configurations such that one or more weights may be coupled to the protruding bodies 970 (as opposed to being coupled to ports where the ports are holes or cavities within the body of the club that include for example internal threads to couple to external threads on the weights). The weights (not shown) can be similar to the weight 82, described above. For example, the protruding bodies 970 may be cylindrical in shape, have square cross-sections, rectangular cross-sections, triangular cross-sections, or have any other shapes.

The protruding bodies 970 extend outwardly from the outer surface 974 of the club head 910. In the illustrated embodiment, a first two of the protruding bodies 970A, B are positioned on the first portion 985, a second two of the protruding bodies 970A, B, D, E, are positioned on the second portion 987, one of the protruding bodies 970D is positioned on the third portion 989, and the remaining protruding body 970C is positioned on the intersecting region 998. Each of the protruding bodies A, B, C, D, E, F defining a discrete attachment location for securing a weight 982 to the club head 910. In contrast to other adjustable weighting systems wherein the weight can be coupled at any, or at an infinite, or at an unlimited number of locations across the recessed portion. More specifically, a first protruding body 970A is positioned generally at the toe end 918, a second protruding body 970E is positioned generally at the heel end 922, a third protruding body 970C is positioned between the toe end 918 and the heel end 922, a fourth protruding body 970B is positioned on the first portion 985 between the first protruding body 970A and the third protruding body 970C, a fifth protruding body 970E is positioned on the second portion 987 between the third protruding body 970C and the second protruding body 970E, and finally a sixth protruding body 970F is positioned at point nearest the face on the third portion 989. In other embodiments the protruding body or bodies 970 are positioned at different locations. For example, in some embodiments, the protruding body or bodies 970A, B, C, D, E, F can be equally distributed across the first, second and third portion 985, 987, 989. In other embodiments, the protruding bodies can be more heavily distributed in the third region 989. In some embodiments, the protruding bodies 970A, B, C, D, E, F can be separated by an equal distance between one another. In other embodiments, the distance between the protruding bodies 970A, B, C, D, E, F can vary from protruding body 970 to protruding body 970. Further, as illustrated in FIGS. 23 and 24, the fifth protruding body 970E positioned at the intersection region 998 is larger than the other protruding bodies 970A, B, C, D, F. The larger protruding body 970E may, for example, be used to couple to a heavier weight than the other protruding bodies 970A, B, C, D, F (e.g., to a heavier swing weight). In some embodiments the protruding bodies 970A, B, C, D, E, F are all of equal size, but one of the protruding bodies 970A, B, C, D, E, F is coupled to a heavier weight than the other protruding bodies 970A, B, C, D, E, F. In other embodiments, the protruding bodies 970A, B, C, D, E, F are all of equal size and each is coupled to a weight having a different mass than the other protruding bodies 970A, B, C, D, E, F. In other embodiments, the protruding bodies 970A, B, C, D, E, F are all of equal size and are all coupled to weights having the same mass. The weights (not shown) configured to couple with the protruding bodies 970A, B, C, D, E, F can have the same mass, size, and shape as the weights 82 described above. Further, shifting the weights between the protruding bodies 970A, B, C, D, E in a toe to heel manner can have the same effects as discussed in previous embodiments (Shifting the CG from the heel end 922 to the toe end 918). Further, shifting a heavier weight to the protruding body 970D can shift the club head 910 CG towards the front of the club head 910 affecting the spin imparted on the ball.

The adjustable weighting system 966 of golf club head 910 maintains or prevents a significant reduction in club head moment of inertia, and low and back club head center of gravity positioning, compared to a club head devoid of an adjustable weighting system. The adjustable weighting system 966 of golf club head 910 maintains a high club head moment of inertia and a low and back club head CG position due to the low profile of the weighting system and the perimeter positioning of the one or more weights. The club head 910 having the adjustable weighting system 966 can have similar or identical parameters and measurements as club head 100 described above.

Figure 25:
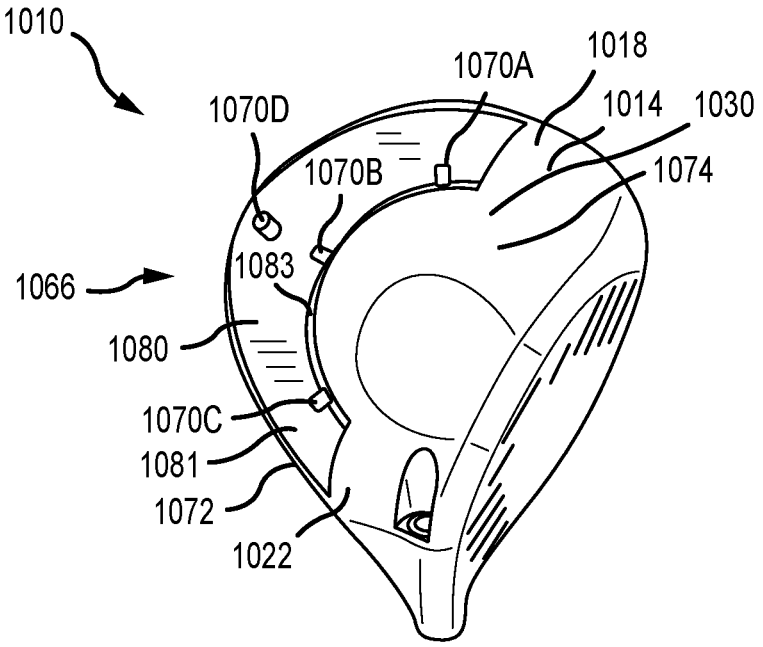
FIGS. 25 and 26 are perspective views of a golf club head according to another embodiment.
Figure 26:
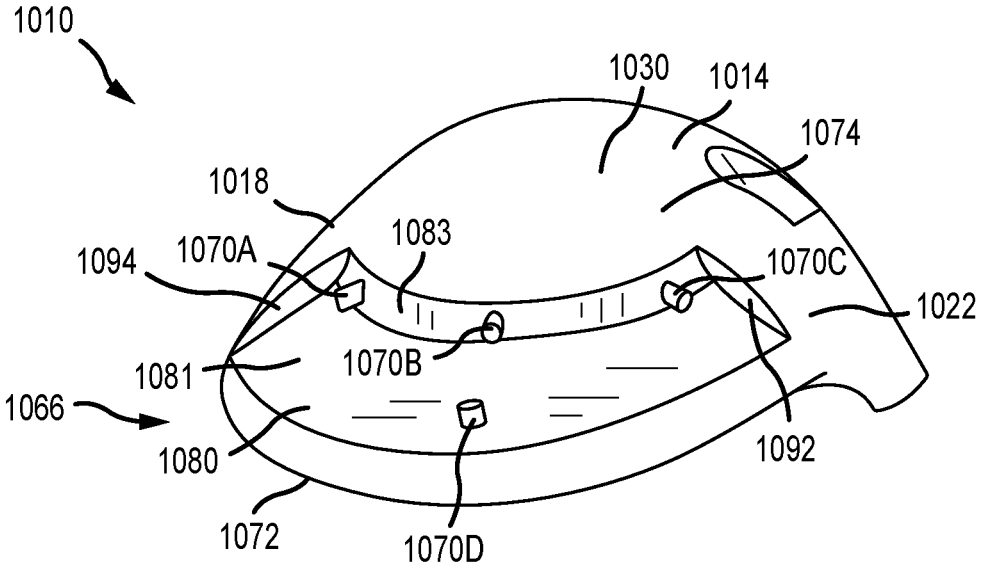

FIGS. 25 and 26 illustrate a club head 1010 having a club head body 1014. The club head 1010 includes an adjustable weighting system 1066 that is adjustable by an end user to modify the club head 1010 center of gravity and/or moment of inertia and/or heel/toe bias to achieve desired performance characteristics (e.g., forgiveness, spin, trajectory) under various circumstances. The adjustable weighting system 1066 is a low profile system and thereby does not significantly shift or change the club head 1010 MOI when compared to a club head not including the adjustable weighting system 1066. Further, the low profile adjustable weighting system 1066 ensures that shifts in the club head 1010 CG occur mainly in a heel end 1022 to toe end 1018 direction keeping the overall club head 1010 CG in a low and back location.

Referring to FIGS. 25-26 the adjustable weight system 1066 can comprise a recessed portion 1080 having a recessed surface 1081. The recessed portion 1080 can be configured to include a plurality of discrete attachment locations. The plurality of discrete attachment locations can comprise features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weight system 1066 includes a recessed portion 1080 including four discrete attachment locations. The four discrete attachment locations each comprising a feature in the form of a protruding bodies 1070A, B, C, D. In other embodiments, the adjustable weighting system 1066 can comprise any number of protruding bodies 1070. Further, the protruding bodies 1070 can be configured to receive a weight.

The recessed portion 1080 is similar to the recessed portion 680, except the recessed portion 680 comprises only a single recessed surface 681. In the illustrated embodiment, the recessed portion 1080 includes a recessed surface 1081. The recessed surface 1081 is disposed along a sole or bottom 1030 of the club head 1010, forming part of an overall outer surface 1074 of the club head 1010. The recessed surface 1081 is disposed adjacent a trailing edge 1072 of the club head 1010. The recessed surface 1081 is separated from a remainder of the outer surface 1074 or sole 1030 by a wall 1083, a first edge 1092 proximate the heel end 1022 of the club head 1010, and a second edge 1094 proximate a toe end 1028 of the club head 1010. As illustrated in FIGS. 25 and 26, the recessed portion 1080 extends generally in an arcuate configuration from the second edge 1094 proximate the toe or toe end 1018 to the first edge 1092 proximate the heel or heel end 1022 of the club head 1010. The recessed surface 1081 has a width defined as the distance it extends between the trailing edge 1072 of the club head 1010 and the wall 1093. In the illustrated embodiment, the recessed surface 1081 has a width of 1 inch. In other embodiments, the recessed surface 1081 can have a width between 0.1 to 3 inches. For example, in some embodiments, the width of the recessed surface 1081 can be between 0.1 to 0.5, 0.3 to 1.0, 0.7 to 1.3, 1.0 to 1.5, 1.3 to 1.7, 1.5 to 2.0, 1.7 to 2.3, 2 to 2.5, 2.3 to 2.7, or 2.5 to 3 inches. Further, the recessed surface 1081 comprises a depth measured as the distance between the recessed surface 1081 and the sole 1030 of the club head 1010. The recessed surface 1081 can have a depth of 0.05 to 1 inches. For example, in some embodiments, the recessed surface 1081 can have a depth of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches. Further, in the illustrated embodiment, the depth of the recessed surface 1081 tapers from the wall 1093 to the trailing edge 1072 of the club head 1010. In other embodiments, the recessed surface 1081 can extend generally parallel to the surface of the sole 1030 towards the trailing edge 672.

With respect to the number of neighboring protruding bodies 1070 and their position, the adjustable weighting system 1066 can be similar to 66, 166, 466, 566, 666, 766, 866, 966. In the illustrated embodiment, the adjustable weighting system 1066 includes at least one protruding body 1070 that receives a weight. The weight can be similar to the weight 82 described above. In the illustrated embodiment, the adjustable weighting system 1066 includes four protruding bodies 1070A, B, C, D.

The protruding body 1070A,B,C,D can be similar to the protruding bodies 70, 170, 470, 570, 670, 770, 870, 970 and may be of any shapes and any configurations such that one or more weights may be coupled to the protruding bodies 10701070A, B, C, D (as opposed to being coupled to ports where the ports are holes or cavities within the body of the club that include for example internal threads to couple to external threads on the weights). For example, the protruding bodies 1070 may be cylindrical in shape, have square cross-sections, rectangular cross-sections, triangular cross-sections, or have any other shapes.

The protruding bodies 1070A, B, C, D extend outwardly from the outer surface 1074. In the illustrated embodiment, three of the protruding bodies 1070A, B, C extend from the wall 1083 and a fourth protruding body 1070D extends from the recesses surface 1081. More specifically, a first protruding body 1070A is positioned generally at the toe or toe end 1018 and extends from the first wall 1083, a second protruding body 1070C is positioned generally at the heel or heel end 1022 and extends from the first wall 1083, a third protruding body 1070B is positioned between the toe or toe end 1018 and the heel or heel end 1022 and extends from the first wall 1083, and a finally a fourth protruding body 1070D is positioned generally between the toe end 1028 and the heel end 1022 and extends from the recessed surface 1081. Each of the first, second and third protruding bodies 1070 extends from the first wall 1083 towards the trailing edge 1072. Further, each protruding body 1070A, B, C, D defining a discrete attachment location for securing a weight to the club head 1010. In contrast to other adjustable weighting systems wherein the weight can be coupled at any, or at an infinite, or at an unlimited number of locations across the recessed portion. In other embodiments, there can be 1, 2, 3, 4, 5, 6, 7, or 8 protruding bodies 1070 extending outwardly from the outer surface 1074 within the recessed portion 1080. Further, in some embodiments, the protruding bodies 1070A, B, C, D can be spaced equidistance from one another. In other embodiments, the protruding bodies 1070A, B, C, D can be spaced a varying distance from one another. For example, the protruding bodies 1070A, B, C, D can be located at any point between the first edge 1092 and the second edge 1094 spaced by a distance of 0.1 to 3 inches between one another. In other embodiments, the protruding bodies 1070A, B, C, D can be located at any point between the first edge 1092 and the second edge 1094 spaced by a distance of 0.1 to 0.5, 0.3 to 1.0, 0.7 to 1.5, 1.0 to 2.0, 1.5 to 2.5, or 2.0 to 3.0 inches between one another. Further, in some embodiments, one of the protruding bodies 1070A, B, C, D can be larger than the other protruding bodies. The larger protruding body 1070A, B, C, D may, for example, be used to couple a heavier weight than the other protruding bodies 1070A, B, C, D (e.g. to a heavier swing weight). In some embodiments the protruding bodies 1070A, B, C, D are all of equal size, but one of the protruding bodies 1070A, B, C, D is coupled to a heavier weight than the other protruding bodies 1070A,B,C,D. In other embodiments, the protruding bodies 1070A, B, C, D are all of equal size and each is coupled to a weight having a different mass than the other protruding bodies 1070A, B, C, D. In other embodiments, the protruding bodies 1070A, B, C, D are all of equal size and are all couple to weights having the same mass. The weights (not shown) configured to couple with the protruding bodies 1070A, B, C, D can have the same mass, size, and shape as the weights 82 described above. Further, shifting the weights between the protruding bodies 1070A, B, C in a toe to heel manner can have the same effects as discussed in previous embodiments (Shifting the CG from the heel end 1022 to the toe end 1018). However, because the protrusions 1070A, B, C are positioned further from the trailing edge 1072 of the club head 1010 they can have a greater effect on the spin imparted on the ball. Further, shifting a heavier weight to the protruding body 1070D can shift the club head 1010 CG further back on the club head 1010 also adjusting the spin imparted on the ball.

The adjustable weighting system 966 of golf club head 910 maintains or prevents a significant reduction in club head moment of inertia, and low and back club head center of gravity positioning, compared to a club head devoid of an adjustable weighting system. The adjustable weighting system 966 of golf club head 910 maintains a high club head moment of inertia and a low and back club head CG position due to the low profile of the weighting system and the perimeter positioning of the one or more weights. The club head 910 having the adjustable weighting system 966 can have similar or identical parameters and measurements as club head 100 described above.

Figure 27:
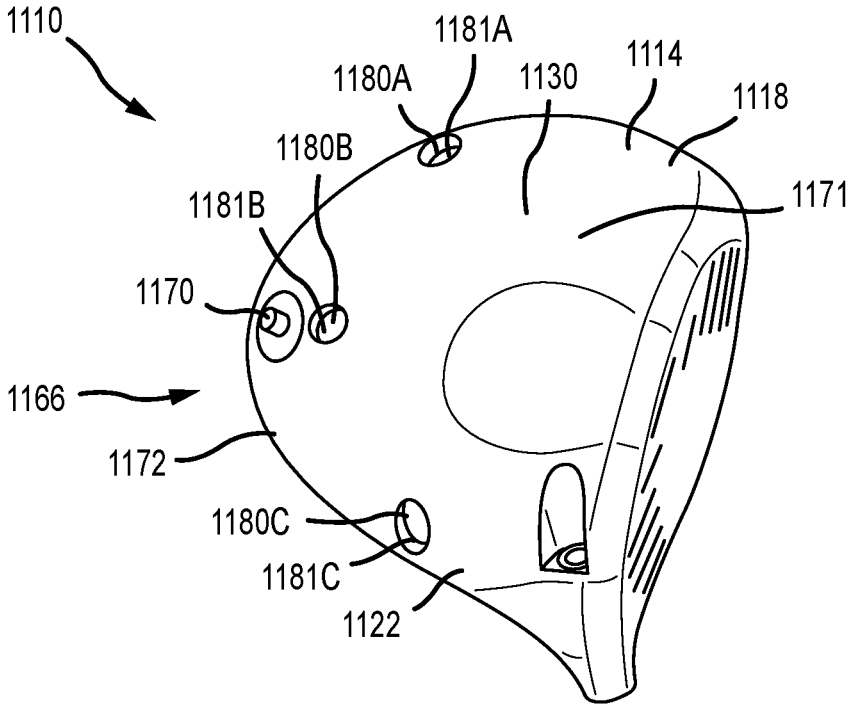
FIGS. 27 and 28 are perspective views of a golf club head according to another embodiment.
Figure 28:
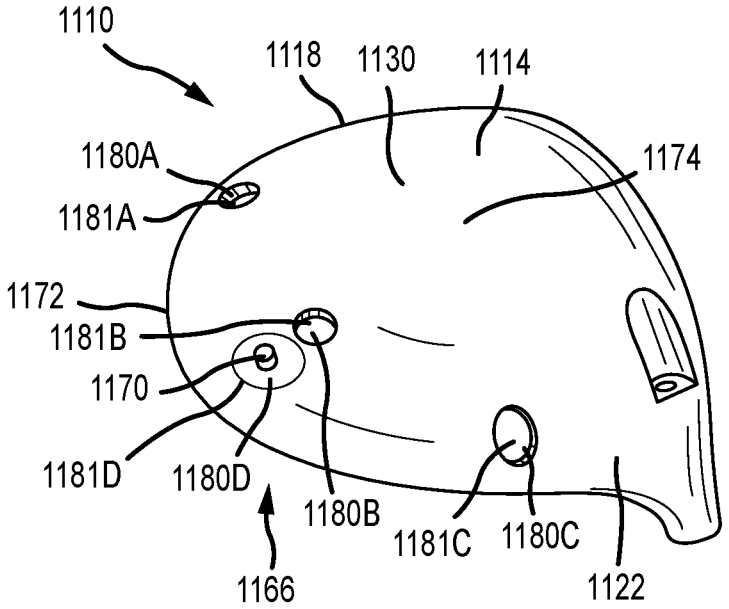

FIGS. 27 and 28 illustrate a club head 1110 having a club head body 1114. The club head 1110 includes an adjustable weighting system 1166 that is adjustable by an end user to modify the club head 1110 center of gravity and/or moment of inertia and/or heel/toe bias to achieve desired performance characteristics (e.g., forgiveness, spin, trajectory) under various circumstances. The adjustable weighting system 1166 is a low profile system and thereby does not significantly shift or change the club head 1110 MOI when compared to a club head not including the adjustable weighting system 1166. Further, the low profile adjustable weighting system 1166 ensures that shifts in the club head 1110 CG occur mainly in a heel end 1122 to toe end 1118 direction keeping the overall club head 1110 CG in a low and back location.

Referring to FIGS. 27-28, the adjustable weight system 1166 can comprise a recessed portion 1180 having a recessed surface 1181. The recessed surface 1181 can include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the plurality of discrete attachment locations can comprise protruding bodies 1066. In the illustrated embodiment, the adjustable weight system 1166 comprises four recessed surfaces 1181 each comprising a discrete attachment location. One of the discrete attachment locations comprises a feature in the form of a protruding body 1170, the three other discrete attachment locations can comprise any of the features described in the aforementioned list. In other embodiments, there can be 1, 2, 3, 4, 5, 6, 7 or 8 protruding bodies 1170. Further, each protruding body 1170 can be configured to receive a weight.

Referring again to FIGS. 27-28, the adjustable weight system 1166 comprises four recessed portions 1180A, B, C, D. In the illustrated embodiment, the recessed portions 1180A, B, C, D are circular indentations (e.g., concave, flat, etc.) including recessed surfaces 1181A, B, C, D along a sole or bottom 1130 of the club head 1110. Further, the recessed portions 1180A, B, C, D include walls 1183A, B, C, D separating the recessed surfaces 1181A, B, C, D from the sole 1130 of the club head 1110. The recessed surfaces 1181A, B, C, D forming part of an overall outer surface 1174 of the club head 1110. The recessed portions 1180A, B, C, D include a depth measure as the distance from the recessed surface 1181A, B, C, D to the sole 1130 of the club head 1110. In many embodiments, the recessed surfaces 1181A, B, C, D can have depths of 0.05 to 1 inches. For example, in some embodiments, the recessed surfaces 1181A, B, C, D can have depths of 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches.

As illustrated in FIGS. 27-28, the recessed portions 1181A, B, C, D are disposed near a trailing edge 1172 of the club head 1010, generally in an area located between a toe or toe end 1118 of the club head 1110 and a heel or heel end 1122 of the club head 1010. More specifically, a first recessed portion 1180A is positioned near the toe end 118, a second recessed portion 1180C is positioned near the heel end 1122, a third recessed portion 1180C is positioned between the toe end 1118 and the heel end 1122, and finally a fourth recessed portion 1180D is positioned adjacent the third recessed portion 1180C proximate the trailing edge 1172. In other embodiments, the recessed surface 1181 can be positioned along any portion of the club head 1110. Further, in the illustrated embodiment, the fourth recessed portion 1180D is larger in size than the first, second and third recessed portions 1180A, B, C. In other embodiments, the recessed portions 1180A, B, C, D can all be the same size or the recessed portions 1180A, B, C, D can all vary in size. Further, in other embodiments, the recessed portions 1180A, B, C, D can be positioned in any location and at any distance from one another on the club head body 1110. In other embodiments, there can be 1, 2, 3, 4, 5, 6, 7, or 8 recessed portions 1180.

In the illustrated embodiment, the adjustable weighting system 1166 includes a single protruding body 1170. The protruding body 1170 is generally cylindrical in shape and is positioned within the recessed portion 1180D of the club head 1110. Although, in other embodiments, the adjustable weighting system 1166 can comprise 1, 2, 3, 4, 5, 6, 7, or 8 protruding bodies 1170.

The protruding body 1170 can be similar to the protruding bodies 70, 170, 470, 570, 670, 770, 870, 970, 1070 and may be of any shape and any configuration such that one or more weights may be coupled to the protruding body 1170 (as opposed to being coupled to ports where the ports are holes or cavities within the body of the club that include for example internal threads to couple to external threads on the weights). In the illustrated embodiment, the protruding body 1170 is cylindrical in shape. In some embodiments the protruding body 1170 has a square cross-section, a rectangular cross-section, a triangular cross-section, or any other shape. Further, the protruding bodies 1170 can be positioned at any location on the club head 1110.

Further, the protruding body 1170 extends outwardly from the outer surface 1174 of the recessed portion 1180A. The protruding body 1170 extends generally perpendicularly from the recessed surface 1181A, and from a central area of the recessed surface 1181A. Although in FIGS. 27-28 only one protruding body 1170 is shown in the recessed portion 1180A, in other embodiments, the recessed portions 1180B, C, D can comprise the one protruding body 1170. In other embodiments, two or more of the recessed portions 1180A, B, C, D can comprise protruding bodies 1170. Each of the recessed portions 1180A, B, C, D comprises a discrete attachment location for securing a weight to the club head 1110. In contrast to other adjustable weighting systems wherein the weight can be coupled at any, or at an infinite, or at an unlimited number of locations across the recessed portion. In other embodiments, one or more protruding bodies 1170 are movable between the first, second, third, and fourth recessed portion 1180A, B, C, D. The weights (not shown) configured to couple with the protruding bodies 1170 can have the same mass, size, and shape as the weights 82 described above. Further, shifting the weights between the recessed portions 1180A, B, C, D in a toe to heel end can have the same effects as discussed in previous embodiments (shifting the CG from the heel end 1122 to the toe end 1118). However, shifting a heavier weight to the recessed surface 1180 D can further shift the club head CG lower and back on the club head 1110, affecting the spin imparted on the golf ball.

The adjustable weighting system 1166 of golf club head 1110 maintains or prevents a significant reduction in club head moment of inertia, and low and back club head center of gravity positioning, compared to a club head devoid of an adjustable weighting system. The adjustable weighting system 1166 of golf club head 1110 maintains a high club head moment of inertia and a low and back club head CG position due to the low profile of the weighting system and the perimeter positioning of the one or more weights. The club head 1110 having the adjustable weighting system 1166 can have similar or identical parameters and measurements as club head 100 described above.

Figure 29:
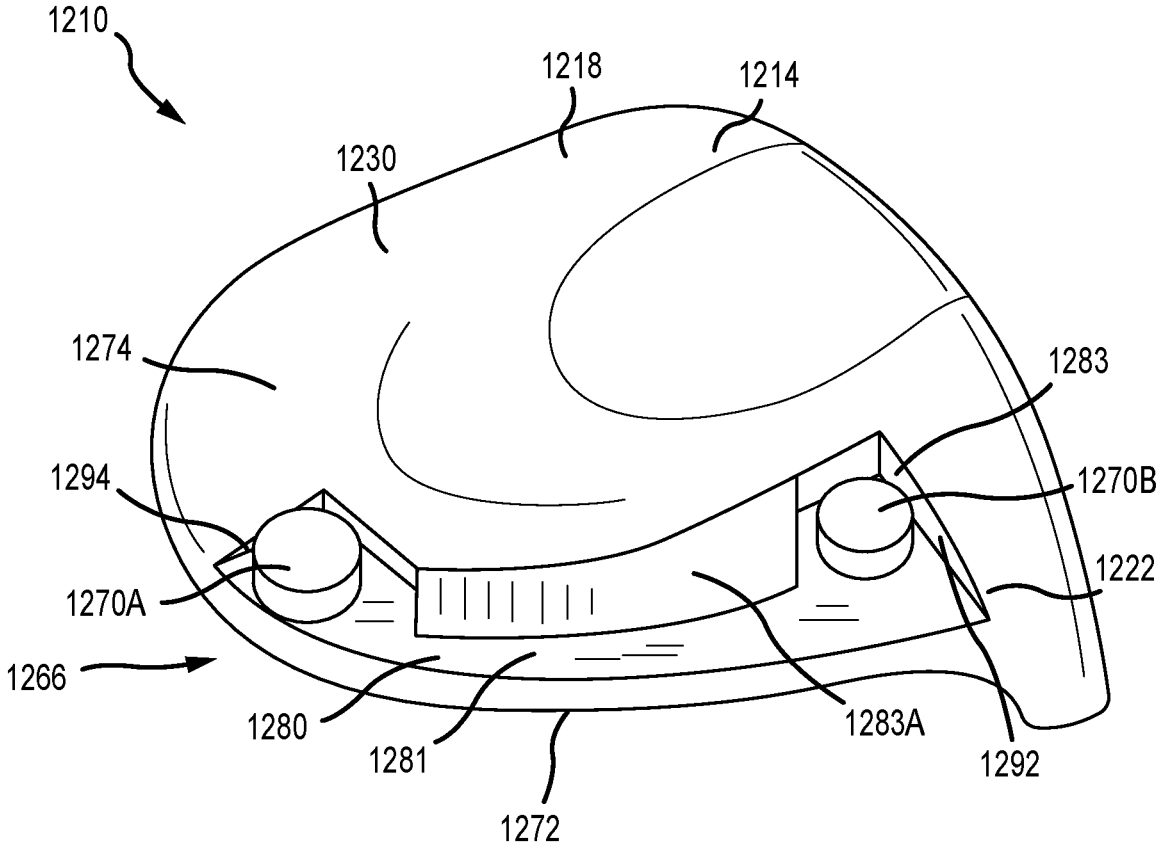
FIG. 29 is a perspective view of a golf club head according to another embodiment.

FIG. 29 illustrates a club head 1210 having a club head body 1214. The club head 1210 includes an adjustable weighting system 1266 that is adjustable by an end user to modify the club head 1210 center of gravity and/or moment of inertia and/or heel/toe bias to achieve desired performance characteristics (e.g., forgiveness, spin, trajectory) under various circumstances. The adjustable weighting system 1266 is a low profile system and thereby does not significantly shift or change the club head 1210 MOI when compared to a club head not including the adjustable weighting system 1266. Further, the low profile adjustable weighting system 1266 ensures that shifts in the club head 1210 CG occur mainly in a heel end 1222 to toe end 1218 direction keeping the overall club head 1210 CG in a low and back location.

Referring to FIG. 29, the adjustable weight system 1266 can comprise a recessed portion 1280. The recessed portion 1280 comprises a recessed surface 1281 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1266 comprises a recessed surface 1281 including two discrete attachment locations. Each discrete attachment location comprising a feature in the form of a protruding bodies 1270A, B. Further, each protruding body 1270A, B can comprise 1 or more weights.

Referring again to FIG. 29, the recessed portion 1280 can be similar to the recessed portion 1080, except the recessed portion 1280 comprises a varying width, and extends across only the heel end 1222 of the club head 1210. In other embodiments, the recessed surface 1281 can be positioned proximate the toe end 1218 of the club head 1210, or the recessed surface 1281 can extend the entire portion of the club head 1210 extending between the toe end 1218 and the heel end 1222. In the illustrated embodiment, the recessed portion 1280 includes a recessed surface 1281 along a sole or bottom 1230 of the club head 1210. The recessed surface 1281 forming part of an overall outer surface 1274 of the club head 1210. The recessed surface 1281 is separated from a remainder of the sole or bottom 1230 by a wall 1283, a first edge 1292 proximate the heel end 1222, and a second edge 1294 between the heel end 1222 and the toe end 1218. The recessed surface 1281 is disposed adjacent a trailing edge 1272 of the club head 1210, and extends generally in an arcuate configuration from a heel or heel end 1222 (first edge 1292) of the club head 1210 to a position that is located between the heel or heel end 1222 of the club head 1210 and a toe or toe end 1218 (second edge 1294) of the club head 1210. In the illustrated embodiments, portions of the wall 1283 near the first and second edge 1292, 1294 extend generally perpendicular to the recessed surface 1281, and one portion 1283*a* of the wall 1283 between the first and second edge 1292, 1294 extends generally at an inclined angle relative to the recessed surface 1281. In the illustrated embodiment, the wall 1283*a* extends at an obtuse angle relative to the recessed surface 1281. In other embodiments, the wall 1283*a* can extend at an acute angle relative to the recessed surface 1282*a*. Further, the depth of the recessed surface 1281 relative to the sole 1230 (measured as the distance from the recessed surface 1281 to the sole 1230) varies from the first edge 1292 to the second edge 1294. In the illustrated embodiment, the depth of the recessed surface 1281 relative to the sole 1230 decreases from the first edge 1292 to the second edge 1294. In other embodiments, the depth of the recessed surface 1281 relative to the sole 1230 can increase, decrease or remain constant from the first edge 1292 to the second edge 1294. For example, in some embodiments, the depth of the recessed surface 1281 relative to the sole 1230 can vary from 0.05 to 1 inches. In other embodiments, the depth of the recessed surface 1281 relative to the sole 1230 can vary from 0.05 to 0.1, 0.1 to 0.2, 0.2 to 0.3, 0.3 to 0.4, 0.4 to 0.5, 0.5 to 0.6, 0.6 to 0.7, 0.7 to 0.8, 0.8 to 0.9, or 0.9 to 1 inches. The recessed surface 1281 further comprises a width measured as the distance from at or near the trailing edge 1272 inward to the wall 1283. In the illustrated embodiment, the width of the recessed surface 1281 is greatest near the first and second edge 1292, 1294 and smallest between the first and second edge 1292, 1294 or adjacent to the portion 1283*a* of the first wall 1283. In other embodiments, the width of the recessed surface 1281 can increase, decrease or remain the same from the first edge 1292 to the second edge 1294 of the recessed surface 1281. For example, the width of the recessed surface 1281 can vary from 0.1 to 3 inches. In other embodiments, the width of the recessed surface 1281 can vary from 0.1 to 0.5, 0.3 to 1.0, 0.7 to 1.3, 1.0 to 1.5, 1.3 to 1.7, 1.5 to 2.0, 1.7 to 2.3, 2 to 2.5, 2.3 to 2.7, or 2.5 to 3 inches.

With respect to the number of neighboring protruding bodies 1270 and their position the adjustable weight system 1280 can be similar to the adjustable weighting systems 66, 166, 466, 566, 666, 766, 866, 966, 1066, 1166. In the illustrated embodiment, the adjustable weighting system 1266 includes at least one protruding body 1270 that receives a weight. The weight can be similar to the weights 82 described above. In the illustrated embodiment, the adjustable weighting system 1266 includes two protruding bodies 1270A, B. The protruding bodies 1270 are positioned within a recessed portion 1280 of the club head 1210. In other embodiments, the adjustable weighting system 1266 can comprise 1, 2, 3, 4, 5, 6, 7, or 8 protruding bodies 1270 and can be positioned anywhere on the club head 1210.

The protruding bodies 1270A, B can be similar to the protruding bodies 70, 170, 270, 470, 570, 670, 770, 870, 970, 1070, 1170 and may be of any shapes and any configurations such that one or more weights may be coupled to the protruding bodies 1270A, B (as opposed to being coupled to ports where the ports are holes or cavities within the body of the club that include for example internal threads to couple to external threads on the weights). In the illustrated embodiment, the protruding bodies 1270A, B are cylindrical in shape. In other embodiments, the protruding bodies 1270A, B may have square cross-sections, rectangular cross-sections, triangular cross-sections, or have any other shapes.

The protruding bodies 1270A, B extend outwardly from the outer surface 1274. As illustrated in FIG. 29, a first one of the protruding bodies 1270A is located at a first position at or near the second edge 1294, and a second one of the protruding bodies 1270B is located at a second position at or near the first edge 1292 near the heel end 1222 of the club head 1210. Each protruding body 1270 A, B defining a discrete attachment location for securing a weight to the club head 1210. In contrast to other adjustable weighting systems wherein the weight can be coupled at any, or at an infinite, or at an unlimited number of locations across the recessed portion. As discussed above, the recessed surface 1281 is generally wider at the locations near the first and second protruding bodies 1270A, B than at locations between the first and second protruding bodies 1270A, B, such that the first wall 1283 partially surrounds the protruding bodies 1270. In other embodiments, the recessed surface 1281 can comprise 1, 2, 3, 4, 5, 6, or 7 protruding bodies 1270.

The weights (not shown) configured to couple with the protruding bodies 1270A, B can have the same mass, size, and shape as the weights 82 described above. Further, shifting the weights between the protruding bodies 1270A, B in a font-toe to back-center manner can shift the CG between the center and the toe, while also changing it from the front to the back.

The adjustable weighting system 1266 of golf club head 1210 maintains or prevents a significant reduction in club head moment of inertia, and low and back club head center of gravity positioning, compared to a club head devoid of an adjustable weighting system. The adjustable weighting system 1266 of golf club head 1210 maintains a high club head moment of inertia and a low and back club head CG position due to the low profile of the weighting system and the perimeter positioning of the one or more weights. The club head 1210 having the adjustable weighting system 1266 can have similar or identical parameters and measurements as club head 100 described above.

Figure 30:
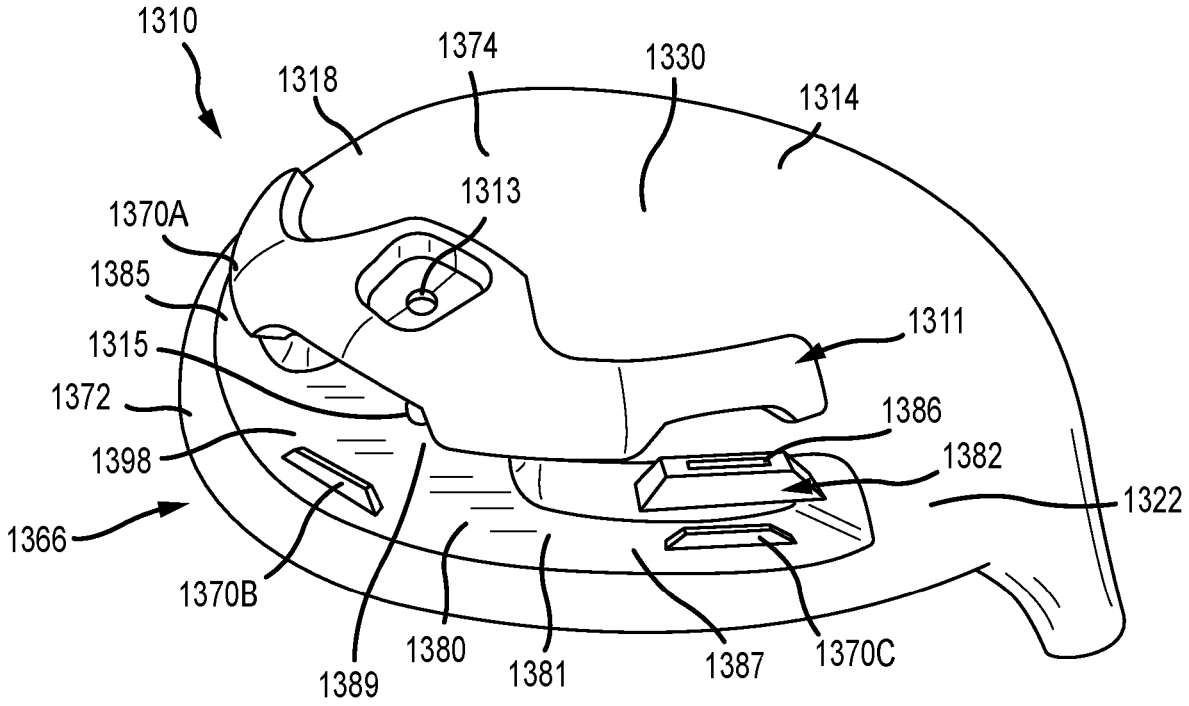
FIG. 30 is a perspective view of a golf club head according to another embodiment.

FIG. 30 illustrates a club head 1310 having a club head body 1314. The club head 1310 includes an adjustable weighting system 1366 that is adjustable by an end user to modify the club head 1310 center of gravity and/or moment of inertia and/or heel/toe bias to achieve desired performance characteristics (e.g., forgiveness, spin, trajectory) under various circumstances. The adjustable weighting system 1366 is a low profile system and thereby does not significantly shift or change the club head 1310 MOI when compared to a club head not including the adjustable weighting system 1366. Further, the low profile adjustable weighting system 1366 ensures that shifts in the club head 1310 CG occur mainly in a heel end 1322 to toe end 1318 direction keeping the overall club head 1310 CG in a low and back location.

Referring to FIG. 30, the adjustable weighting system 1366 can comprise a recessed portion 1380. The recessed portion 1380 comprises a recessed surface 1381 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1366 comprises a recessed portion 1381 including four discrete attachment locations. The four discrete attachment locations each comprising a feature in the form of a protruding body 1370 (three in the form of a rib and one in the form of a peg). Further, the protruding bodies 1370 can comprise one or more weights. Finally, the adjustable weighting system 1366 can include a cover 1311 comprising a same shape as the recessed portion 1380. The cover 1311 can be coupled to the recessed portion 1380 through the use of the protruding bodies and an extra weight or fastener.

Referring again to FIG. 30, the recessed portion 1380 is similar to the recessed portion 980 having a first a first portion 1385 that extends from an intersection region 1398 toward a toe or toe end 1318 of the club head 1310, a second portion 1387 that extends from the intersection region 1398 toward to a heel or heel end 1322 of the club head 1310, and a third portion 1389 that extends generally inwardly from the intersection region 1398 toward a center of the sole or bottom 1330. Further, the recessed portion 1380 has a recessed surface 1381 similar to the recessed surface 981. The recessed portion 1380 and recessed surface 1381 can have the same width, depth and dimensions as the recessed portion 980 and recessed surface 981.

With respect to the number of neighboring protruding bodies 1370 and their position the adjustable weighting system 1366 can be similar to the adjustable weighting systems 66, 166, 266, 366, 466, 566, 666, 766, 866, 966, 1066, 1166, 1266. In the illustrated embodiment, the adjustable weighting system 1366 includes four protruding bodies 1370A, B, C, 1315 (three of which 1370B, C, 1315 are visible in FIG. 30). Further, the protruding bodies 1370 A, B, C are generally elongate ribs having a trapezoidal shape, and are positioned within a recessed portion 1380 of the club head 1310. The protruding body 1315 is a peg style protruding body 1370 having generally a cylindrical shape.

The protruding bodies 1370A, B, C, 1315 may be of any shapes and any configurations such that one or more weights may be coupled to the protruding bodies 1370A, B, C, 1315 (as opposed to being coupled to ports where the ports are holes or cavities within the body of the club that include for example internal threads to couple to external threads on the weights). For example, in other embodiments the protruding bodies 1370A, B, C, 1315 may be cylindrical in shape, have square cross-sections, rectangular cross-sections, triangular cross-sections, or have any other shapes. Further, the protruding bodies 1370A, B, C, 1315 may be positioned at any location on the club head 1310.

The protruding bodies 1370A, B, C, 1315 extend outwardly from the outer surface 1374. The protruding bodies 1370A, B, C, 1315 extend generally perpendicularly from the recessed surface 1381. As illustrated in FIG. 30, a first one of the protruding bodies 1370A (not visible) is located at the first portion 1385 of the recessed portion 1380 near the toe end 1318, a second one of the protruding bodies 1370C is located at the second portion 1387 of the recessed portion 1380 near the heel end 1322, a third one of the protruding bodies 1370B is located at the intersecting region 1398 between the first and second portions 1385, 1387 of the recessed portion, and finally a fourth one of the protruding bodies 1315 is positioned in third portion 1385 of the recessed portion. Each of the protruding bodies 1370A, B, C, 1325 defining a discrete attachment location for securing a weight 1382 to the club head 1310. In contrast to other adjustable weighting systems wherein the weight can be coupled at any, or at an infinite, or at an unlimited number of locations across the recessed portion. Other embodiments include different locations for the protruding bodies 1370A, B, C, 1315.

With continued reference to FIG. 30, the weights 1382 (one illustrated) have general elongate shapes that correspond to the shapes of the protruding bodies 1370 A, B, C. In many embodiments, the adjustable weighting system 1366 comprises 1, 2, 3, 4, 5, 6, 7, or 8 weights 1382 configured to couple with the protrusions 1370A, B, C. The weights 1382 include generally elongate apertures 1386 that are sized and shaped to receive the protruding bodies 1370A, B, C. The protruding body 1315 can be configured to couple with a weight similar to the weight 82 or to the weight 1382. The apertures 1386 are through apertures that extend entirely through the weights 1382. However, in other embodiments the weights 1382 instead have blind apertures. In some embodiments, the weights 1382 are made of different materials such that they vary in mass. For example, one weight 1382 may be made of a high density material, such as tungsten, and the remaining weights 1382 may be made of a less dense material, such as polyurethane or another plastic. In other embodiments, the weights 1382 may have different sizes or volumes such that they vary in mass. For example, one weight 1382 may have a greater volume than the remaining weights 1382. In some embodiments, each of the weights 1382 may vary in volume from one another and thus vary in mass. In some embodiments, the weights 1382 may vary in both volume and material from one another. In some embodiments, one of the structures labeled as 1382 is not a weight, but rather a light-weight (e.g., light-weight plastic) cover that snap-fits or otherwise couples to one of the protruding bodies 1370A, B, C. In some embodiments, the weights may vary between 0.1-50 g. For example, in embodiments having a plurality of weights 1382, one or more of the weights 1382 may vary between 0-10 g, one or more of the weights 1382 may vary between 10-20 g, one or more of the weights 1382 may vary between 20-30, one or more of the weights 1382 may vary between 30-40 g, and one or more of the weights 1382 may vary between 40-50 g. In some embodiments, a first weight 1382 may vary between 0-10 g, a second weight 1382 may vary between 10-20 g, a third weight 1382 may vary between 20-30, a fourth weight 1382 may vary between 30-40 g, and a fifth weight 1382 may vary between 40-50 g. In other embodiments, a first weight 1382 may vary between 1-5 g, and a second and third weight 1382 may vary between 5-30 g. In other embodiments, a first and second weight 1382 may vary between 1-10 g, and a third and fourth weight 1382, may vary between 5-25 g. In some embodiments, a first weight 1382 has a mass of 8.5 grams, and a second and third weight 1382 each have a mass of 1.5 grams. In other embodiments, a first weight 1382 has a mass of 12 grams, and a second and third weight 1382 each have a mass of 1.5 grams. In other embodiments, a first weight 1382 has a mass of 8.5 grams, and a second and third weight 1382 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight 1382 can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

In the illustrated embodiment, the weights 1382 are coupled to the protruding bodies 1370 A, B, C with friction fits (e.g., by pressing the weights 1382 over the protruding bodies 1370A, B, C, or using a tool to attach or remove the weights 1382). In other embodiments the weights 1382A, B, C are coupled to the protruding bodies 1370A, B, C with snap fit mechanisms, with threaded arrangements, with set screws positioned within threaded inner surfaces of the protruding bodies 1370A, B, C, or with other structures. In many embodiments, each protruding body 1370A, B, C can comprise a weight 1382.

The weights may be strategically positioned on the protruding bodies 1370A, B, C to achieve a desired club head 1310 center of gravity position and/or moment of inertia and/or heel/toe bias. For example, in some embodiments, a heavier weight is positioned on the third protruding body 1370B, located between the toe or toe end 1318 and the heel or heel end 1322, while lighter weights are positioned on the first and second protruding bodies 1370A, C near the toe or toe end 1318 and the heel or heel end 1322. The aforementioned weight placement can result in the center of gravity remaining centered while being shifted towards the back end 1334 of the club head 1310. In some embodiments, a heavier weight is positioned on the second protruding body 1370C near the heel or heel end 1322, while lighter weights are positioned on the first protruding body 1370A near the toe or toe end 1318 and on the third protruding body 1370B that is located between the toe or toe end 1318 and the heel or heel end 1322. The aforementioned weight placement can result in the center of gravity being shifted towards the heel end 1322 of the club head 1310. In some embodiments, a heavier weight is positioned on the first protruding body 1370A near the toe or toe end 1318, while lighter weights are positioned on the protruding body second 1370C near the heel or heel end 1322 and on the third protruding body 1370B that is located between the toe or toe end 1318 and the heel or heel end 1322. The aforementioned weight placement can result in the center of gravity being shifted towards the toe end 1318 of the club head 1310. Finally, in some embodiments, a heavier weight 1382 can be positioned on the fourth protruding body 1370D in the third portion of the recess further from the trailing edge 1372, while lighter weights can be positioned on the first, second and third protrusions 1370A, B, C positioned near the toe end 1318, the heel end 1322 and between the toe end 1318 and the heel end 1322. The aforementioned weight placement can result in the CG being shifted towards the front of the club head 1310 effecting the spin imparted on the ball. In many embodiments, one or more of the protruding bodies 1370A, B, C are of equal size and shape, such that one weight may be interchangeably used with each of the protruding bodies 1370A, B, C. In some embodiments, one or more of the protruding bodies 1370A, B, C can have a differing size and shape, such that each protruding body 1370A, B, C has its own corresponding weight or set of weights.

The adjustable weighting system 1366 of golf club head 1310 maintains or prevents a significant reduction in club head moment of inertia, and low and back club head center of gravity positioning, compared to a club head devoid of an adjustable weighting system. The adjustable weighting system 1366 of golf club head 1310 maintains a high club head moment of inertia and a low and back club head CG position due to the low profile of the weighting system and the perimeter positioning of the one or more weights. The club head 1310 having the adjustable weighting system 1366 can have similar or identical parameters and measurements as club head 100 described above.

With continued reference to FIG. 30, the club head 1310 further includes a cover 1311. In the illustrated embodiment, the cover 1311 has a shape or profile that generally mirrors the shape or profile of the recessed portion 1380. The cover 1311 is coupled to the sole or bottom 1330, and covers the protruding bodies 1370A, B, C and the corresponding weights 1382. In the illustrated embodiment, the cover 1311 defines an aperture 1313 that fits over (e.g., in a friction or snap-fit arrangement) the protrusion 1315 on the recessed surface 1381. The cover 1311 also defines an outer recess 1316 for a sole weight. The sole weight can be similar to the weights 82 or the sole weight can be similar to the weights 1382. Further, in some embodiments, the sole weight can function as a swing weight (e.g. being heavier than the weights 1382). However, in other embodiments the cover 1311 does not include the outer recess 1316 and/or the aperture 1313. Rather, the cover 1311 is solely a protective barrier and/or outer surface of the club head body 1314 that covers the recessed portion 1380 and the weights 1382 within the recessed portion 1380.

Figure 31:
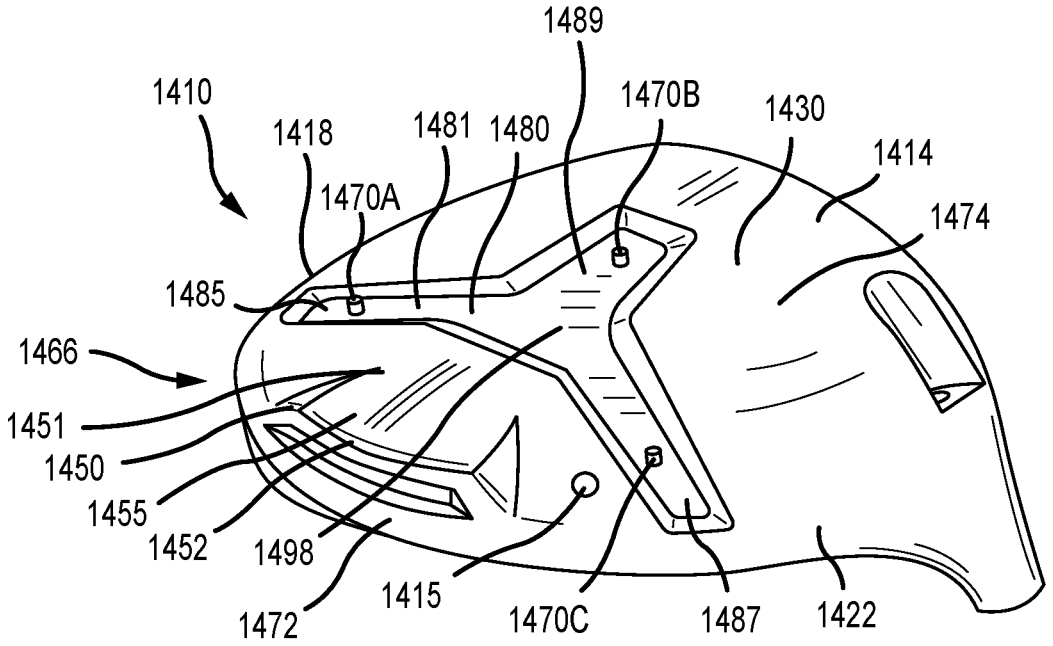
FIG. 31 is a perspective view of a golf club head according to another embodiment.

FIG. 31 illustrates a club head 1410 having a club head body 1414. The club head 1410 includes an adjustable weighting system 1466 that is adjustable by an end user to modify the club head 1410 center of gravity and/or moment of inertia and/or heel/toe bias to achieve desired performance characteristics (e.g., forgiveness, spin, trajectory) under various circumstances. The adjustable weighting system 1466 is a low profile system and thereby does not significantly shift or change the club head 1410 MOI when compared to a club head not including the adjustable weighting system 1466. Further, the low profile adjustable weighting system 1466 ensures that shifts in the club head 1410 CG occur mainly in a heel end 1422 to toe end 1418 direction keeping the overall club head 1410 CG in a low and back location.

Referring to FIG. 31, the adjustable weighting system 1466 can comprise a recessed portion 1480. The recessed portion 1480 comprises a recessed surface 1481 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1480 a recessed surface 1480 including three discrete attachment locations. The three discrete attachment locations each comprising a feature in the form of a protruding bodies 1470A, B, C. Further, each of the protruding bodies 1470A, B, C can comprise one or more weights.

Referring again to FIG. 31, the recessed portion 1480 is similar to the recessed portions 980, 1380, having a first a first portion 1485 that extends from an intersection region 1498 toward a toe or toe end 1418 of the club head 1410, a second portion 1487 that extends from the intersection region 1498 toward to a heel or heel end 1422 of the club head 1410, and a third portion 1489 that extends generally forward from the intersection region 1498 towards the face or strike plate 1438 of the club head 1410. However, the intersection region 1498 of the recessed portion 1480 is positioned near or at the center of the sole 1430 as opposed to being positioned adjacent the trailing edge 1472 (such as the intersecting regions 1398, 998 are positioned adjacent the trailing edges 972, 1372) Further, the recessed portion 1480 has a recessed surface 1481 similar to the recessed surfaces 981, 1381. Thus, the recessed portion 1480 and recessed surface 1481 can have the same width, depth and dimensions as the recessed portions 980, 1380 and recessed surfaces 981, 1381.

With respect to the number of neighboring protruding bodies 1470A, B, C their position, their shape, and their size the adjustable weighting system 1466 can be similar to the adjustable weighting systems 66, 166, 266, 366, 466, 566, 666, 766, 866, 966, 1066, 1166, 1266, and 1366. In the illustrated embodiment, the adjustable weighting system 1466 includes three protruding bodies 1470A, B, C.

The protruding bodies 1470A, B, C may be of any shapes and any configurations such that one or more weights may be coupled to the protruding bodies 1470A, B, C (as opposed to being coupled to ports where the ports are holes or cavities within the body of the club that include for example internal threads to couple to external threads on the weights). In the illustrated embodiment, the protruding bodies 1470A, B, C are cylindrical in shape. In other embodiments, the protruding bodies 1470A, B, C have square cross-sections, rectangular cross-sections, triangular cross-sections, or have any other shapes.

Further, the protruding bodies 1470A, B, C are positioned within a recessed portion 1480 of the club head 1410. The protruding bodies 1470A, B, C extend generally perpendicularly in an outward direction from the recessed surface 1481. In the illustrated embodiment, a first one of the protruding bodies 1470A extends from the first portion 1485 near the toe end 1418, a second one of the protruding bodies 1470C extends from the second portion 1487 near the heel end 1422, and a third one of the protruding bodies 1470B extends from the third portion 1489 between the toe and heel end 1418, 1422 of the club head 1410. Each of the protruding bodies 1470 A, B, C defining a discrete attachment location for securing a weight to the club head 1410. In contrast to other adjustable weighting systems wherein the weight can be coupled at any, or at an infinite, or at an unlimited number of locations across the recessed portion.

With continued reference to FIG. 31, the club head 1410 further includes an additional protruding body 1415 that extends from the outer surface 1474 of the club head 1410, generally adjacent the recessed portion 1480. The additional protrusion 1415 may be used, for example, to receive a cover (e.g., similar to the cover 1311 described above). Finally, the club head 1410 also includes an extended portion 1450 similar to the extended portion 750 having a top surface 1455 extending from a first end 1451 between the trailing edge 1472 and the center of the sole 1430 to a second end 1452 positioned at the trailing edge 1472. The width and height of the extended portion 1450 can vary similar to the extended portion 750.

The weights (not shown) configured to couple with the protruding bodies 1470A, B, C can have the same mass, size, and shape as the weights 82 described above. Further, shifting the weights between the protruding bodies 1470A, C, in a toe to heel manner can have the same effects as discussed in previous embodiments (Shifting the CG from the heel end 1422 to the toe end 1218). Further, shifting a heavier weight to the protruding body 1470B can shift the club head 1410 CG towards the front of the club head 1410 affecting the spin imparted on the ball.

The adjustable weighting system 1466 of golf club head 1410 maintains or prevents a significant reduction in club head moment of inertia, and low and back club head center of gravity positioning, compared to a club head devoid of an adjustable weighting system. The adjustable weighting system 1466 of golf club head 1410 maintains a high club head moment of inertia and a low and back club head CG position due to the low profile of the weighting system and the perimeter positioning of the one or more weights. The club head 1410 having the adjustable weighting system 1466 can have similar or identical parameters and measurements as club head 100 described above.

Figure 32:
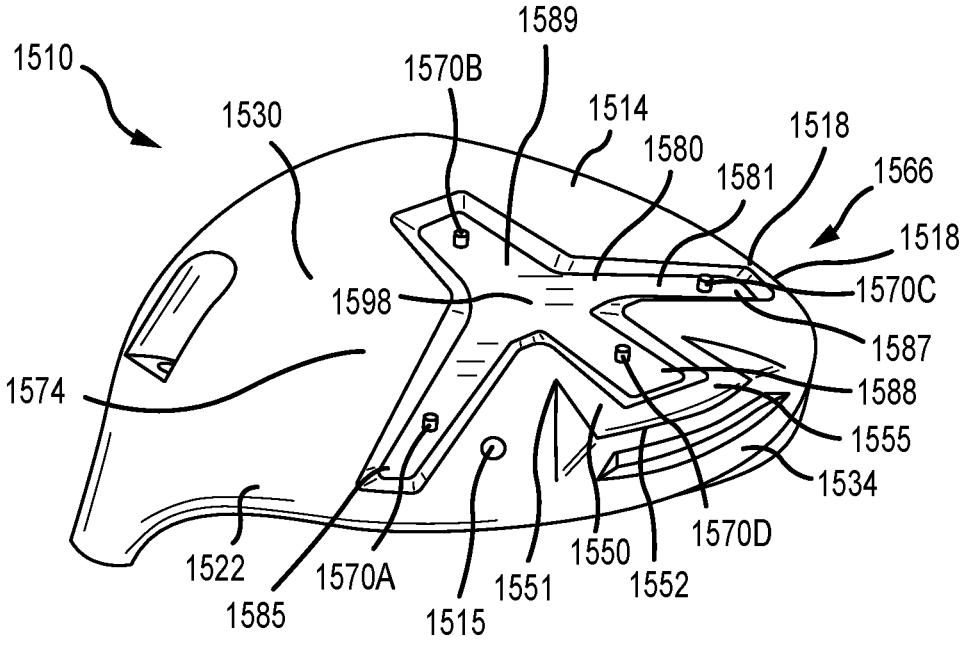
FIG. 32 is a perspective view of a golf club head according to another embodiment.

FIG. 32 illustrates a club head 1510 having a club head body 1514. The club head 1510 includes an adjustable weighting system 1566 that is adjustable by an end user to modify the club head 1510 center of gravity and/or moment of inertia and/or heel/toe bias to achieve desired performance characteristics (e.g., forgiveness, spin, trajectory) under various circumstances. The adjustable weighting system 1566 is a low profile system and thereby does not significantly shift or change the club head 1510 MOI when compared to a club head not including the adjustable weighting system 1566. Further, the low profile adjustable weighting system 1566 ensures that shifts in the club head 1510 CG occur mainly in a heel end 1522 to toe end 1518 direction keeping the overall club head 1510 CG in a low and back location.

Referring to FIG. 32, the adjustable weighting system 1566 includes a recessed portion 1580, The recessed portion 1580 comprising a recessed surface 1581 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1566 includes a recessed surface 1581 comprising four discrete attachment locations. The four discrete attachment locations each comprising a feature in the form of a protruding body 1570A, B, C, D. Further, in the illustrated embodiment, the club head 1510 includes an extended portion 1550 comprising a portion of the recessed surface 1581.

Referring again to FIG. 32, in the illustrated embodiment, the extended portion 1550 is similar to the extended portions 750, 1450. The extended portion 1550 includes a top surface 1555 extending from a first end 1551, positioned between the trailing edge 1572 and a center of the sole 1530, to a second end 1552, positioned near or at the trailing edge 1572. The width and height of the extended portion 1550 can vary similarly to the width and height of the extended portion 750, 1450 described above.

Referring again to FIG. 32, the recessed portion 1580 is similar to the recessed portion 1480 having an intersection region 1598 positioned near the center of the sole 1530, a first portion 1585 that extends from the intersection region 1598 toward a toe or toe end 1518 of the club head 1510, a second portion 1587 that extends from the intersection region 1598 toward to a heel or heel end 1522 of the club head 1510, and a third portion 1589 that extends generally forward from the intersection region 1598 toward a face or strike plate (not shown). However, the recessed portion 1580 includes a fourth portion 1588 that extends from the intersection region 1598 generally backwards towards the trailing edge 1572 between the first and second portions 1585, 1587. In the illustrated embodiment, the fourth portion 1588 extends onto the top surface 1555 of the extended portion 1550. Further, the recessed portion 1580 has a recessed surface 1581 similar to the recessed surface 981, 1281, 1381. The recessed portion 1580 and recessed surface 1581 can have the same width, depth and dimensions as the recessed portions 980, 1280, 1380 and recessed surfaces 981, 1281, 1381.

With respect to the number of neighboring protruding bodies 1570A, B, C, D their position, their shape, and their size the adjustable weighting system 1566 can be similar to the adjustable weighting systems 66, 166, 266, 366, 466, 566, 666, 766, 866, 966, 1066, 1166, 1266, 1366, and 1466. In the illustrated embodiment, the adjustable weighting system 1566 includes four protruding bodies 1570A, B, C, D each defining an attachment point for a weight (not shown). The weight can be similar to the weight 82 described above.

The protruding bodies 1570 A, B, C, D may be of any shapes and any configurations such that one or more weights may be coupled to the protruding bodies 1570A, B, C, D (as opposed to being coupled to ports where the ports are holes or cavities within the body of the club that include for example internal threads to couple to external threads on the weights). In the illustrated embodiment, the protruding bodies 1570A, B, C, D are cylindrical in shape. In other embodiments, the protruding bodies 1570A, B, C, D have square cross-sections, rectangular cross-sections, triangular cross-sections, or have any other shapes.

The protruding bodies 1570A, B, C, D can be positioned at any location in the recessed portion 1580 and extend generally perpendicularly from the recessed surface 1581. In the illustrated embodiment, a first one of the protruding bodies 1570A extends from the first portion 1585, a second one of the protruding bodies 1570C extends from the second portion 1587, a third one of the protruding bodies 1570B extends from the third portion 1589, and a fourth one of the protruding bodies 1570D extends from the fourth portion 1588. Each of the protruding bodies 1570A, B, C, D defining a discrete attachment location for securing a weight to the club head 1510. In contrast to other adjustable weighting systems wherein the weight can be coupled at any, or at an infinite, or at an unlimited number of locations across the recessed portion. In other embodiments, the protruding bodies 1570A, B, C, D can be positioned in different locations in the recessed portion 1580 or the club head 1510. Finally, in other embodiments, the adjustable weighting system 1566 can include 1, 2, 3, 4, 5, 6, 7, or 8 protruding bodies 1570.

The weights (not shown) configured to couple with the protruding bodies 1570A, B, C, D can have the same mass, size, and shape as the weights 82 described above. Further, shifting the weights between the protruding bodies 1570A, C in a toe to heel manner can have the same effects as discussed in previous embodiments (Shifting the CG from the heel end 1522 to the toe end 1518). Further, shifting a heavier weight to the protruding body 1570B, D can shift the club head 1566 CG towards the front or the back of the club head 1566 affecting the spin imparted on the ball.

The adjustable weighting system 1566 of golf club head 1566 maintains or prevents a significant reduction in club head moment of inertia, and low and back club head center of gravity positioning, compared to a club head devoid of an adjustable weighting system. The adjustable weighting system 1566 of golf club head 1566 maintains a high club head moment of inertia and a low and back club head CG position due to the low profile of the weighting system and the perimeter positioning of the one or more weights. The club head 1566 having the adjustable weighting system 1566 can have similar or identical parameters and measurements as club head 100 described above.

With continued reference to FIG. 32, the club head 1510 further includes an additional protrusion 1515 that extends from the outer surface 1574 of the club head 1510, generally adjacent the recessed portion 1580. The additional protrusion 1515 may be used, for example, to receive a cover (e.g., similar to the protrusion 1315 and cover 1311 described above).

Figure 33:
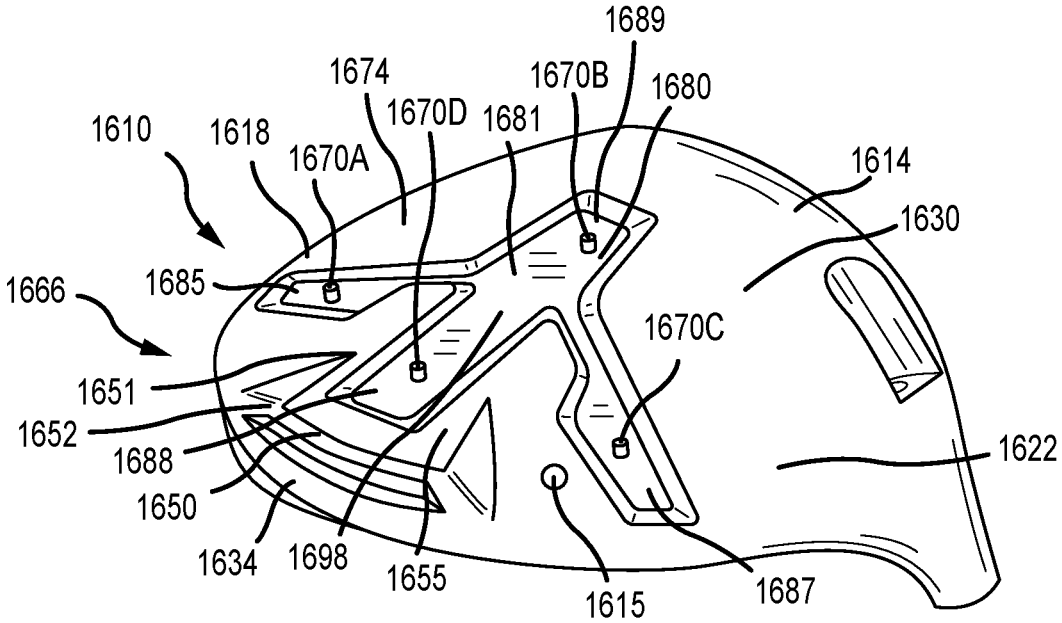
FIGS. 33 and 34 are perspective views of a golf club head according to another embodiment.
Figure 34:
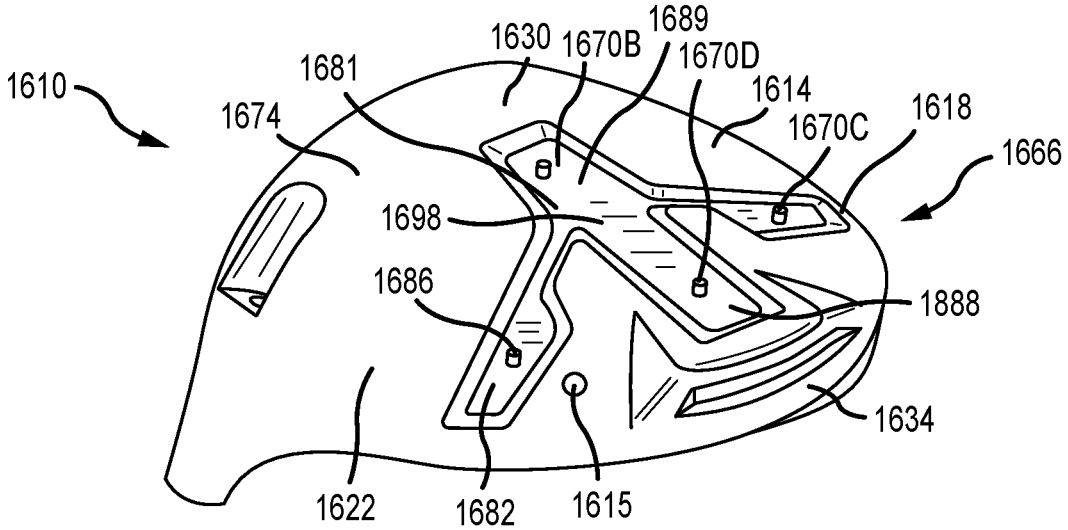

FIGS. 33 and 34 illustrate a club head 1610 having a club head body 1614. The club head 1610 includes an adjustable weighting system 1666 that is adjustable by an end user to modify the club head 1610 center of gravity and/or moment of inertia and/or heel/toe bias to achieve desired performance characteristics (e.g., forgiveness, spin, trajectory) under various circumstances. The adjustable weighting system 1666 is a low profile system and thereby does not significantly shift or change the club head 1610 MOI when compared to a club head not including the adjustable weighting system 1666. Further, the low profile adjustable weighting system 1666 ensures that shifts in the club head 1610 CG occur mainly in a heel end 1622 to toe end 1618 direction keeping the overall club head 1610 CG in a low and back location.

Referring to FIGS. 33-34, in the illustrated embodiment, the adjustable weighting system 1666 includes a recessed portion 1680. The recessed portion 1680 comprising a recessed surface 1681 can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1666 includes a recessed surface 1681 comprising four discrete attachment locations. Each of the four discrete attachment locations comprising a feature in the form of protruding bodies 1670A, B, C, D. Further, in the illustrated embodiment, the club head 1610 includes an extended portion 1650 comprising a portion of the recessed surface 1681.

Referring again to FIGS. 33-34, in the illustrated embodiment, the extended portion 1650 is similar to the extended portions 750, 1450, 1550. The extended portion 1650 includes a top surface 1655 extending from a first end 1651, positioned between the trailing edge 1672 and a center of the sole 1630, to a second end 1652, positioned at or near the trailing edge 1672. The width and height of the extended portion 1650 can vary similarly to the width and height of the extended portion 750, 1450 described above.

As illustrated in FIGS. 33-34, the recessed portion 1680 is similar to the recessed portion 1580 having an intersection region 1698 positioned near the center of the sole 1630, a first portion 1685 that extends from the intersection region 1698 toward a toe or toe end 1618 of the club head 1610, a second portion 1687 that extends from the intersection region 1698 toward to a heel or heel end 1622 of the club head 1610, a third portion 1689 that extends generally forward from the intersection region 1698 toward a face or strike plate (not shown), and a fourth portion 1688 that extends from the intersection region 1698 generally backwards towards the trailing edge 1672 between the first and second portions 1685, 1687. However, the first portion 1685 and the second portion 1657 of the recessed portion 1680 comprise varying widths. In the illustrated embodiment, a width of the recessed portion is larger near the heel or heel end 1622 and the toe or toe end 1618 of the first and second portions 1689, 1691, than toward areas of the first and second portions 1689, 1691 that are closer to the intersection region 1698. In other embodiments, the width of the first and second portion 1685, 1687 can increase, decrease and/or remain constant from near the intersection region 1698 to near the toe and heel ends 1618, 1622, respectively. Further, the recessed portion 1580 has a recessed surface 1581 similar to the recessed surface 981, 1281, 1381. The recessed portion 1580 and recessed surface 1581 can have the same width, depth and dimensions as the recessed portions 980, 1280, 1380 and recessed surfaces 981, 1281, 1381.

With respect to the number of neighboring protruding bodies 1670A, B, C, D their position, their shape, and their size the adjustable weighting system 1666 can be similar to the adjustable weighting systems 66, 166, 266, 366, 466, 566, 666, 766, 866, 966, 1066, 1166, 1266, 1366, 1466, and 1566. In the illustrated embodiment, the adjustable weighting system 1666 includes four protruding bodies 1670A, B, C, D within the recessed portion 1680, each defining an attachment point for a weight 1682.

The protruding bodies 1670A, B, C, D may be of any shapes and any configurations such that one or more weights may be coupled to the protruding bodies 1670A, B, C, D (as opposed to being coupled to ports where the ports are holes or cavities within the body of the club that include for example internal threads to couple to external threads on the weights). In the illustrated embodiment, the protruding bodies 1670A, B, C, D are cylindrical in shape. In other embodiments, the protruding bodies 1670A, B, C, D have square cross-sections, rectangular cross-sections, triangular cross-sections, or have any other shapes.

The protruding bodies 1670A, B, C, D can be positioned at any location in the recessed portion 1680 and extend generally perpendicularly from the recessed surface 1681. In the illustrated embodiment, a first one of the protruding bodies 1670A extends from the first portion 1685, a second one of the protruding bodies 1670C extends from the second portion 1687, a third one of the protruding bodies 1670B extends from the third portion 1689, and a fourth one of the protruding bodies 1670D extends from the fourth portion 1688. Each of the protruding bodies 1670A, B, C, D defining a discrete attachment location for securing a weight 1682 to the club head 1610. In contrast to other adjustable weighting systems wherein the weight can be coupled at any, or at an infinite, or at an unlimited number of locations across the recessed portion. By moving a weight 1682 forward and back between the third and fourth protruding bodies 1670 B, D the center of gravity can be shifted towards the strike plate or towards the rear end. By moving the weights 1682 between the first a second protruding bodies 1670A, C the center of gravity can be shifted in a toe end 1618 to heel end 1622 direction. In other embodiments, the protruding bodies 1670A, B, C, D can be positioned in different locations in the recessed portion 1680 or the club head 1610. Finally, in other embodiments, the adjustable weighting system 1666 can include 1, 2, 3, 4, 5, 6, 7, or 8 protruding bodies 1670.

As illustrated in FIG. 34, the adjustable weighting system 1666 can include a weight 1682. The weight 1682 may take the shape of the recessed portion 1680. For example, in the illustrated embodiment a single weight 1682 is illustrated, which fits down onto the first portion 1685. The weight 1682 includes a generally cylindrical aperture 1686 that is sized and shaped to receive the protruding body 1670A in the first portion 1685. The aperture 1686 is a through aperture that extends entirely through the weight 1682. However, in other embodiments the weight or weights 1682 have blind apertures. In some embodiments, the protruding body or bodies 1670A, B, C, D have external threads, and the weight or weights 1682 have internal threads within the apertures 1686, such that the weights 1682 are threadably coupled to the protruding bodies 1670. In other embodiments, the weight or weights 1682 are coupled to the protruding bodies 1670A, B, C, D with friction fits, with snap-fit mechanisms, with set screws positioned within threaded inner surfaces of the protruding bodies 1670A, B, C, D, or with other structures.

In the illustrated embodiment, the weights 1682 are generally flat, to increase club head moment of inertia, although other embodiments include different shapes than that illustrated. In some embodiments, the weights 1682 are made of different materials such that they vary in mass. For example, one weight 1682 may be made of a high density material, such as tungsten, and the remaining weights 1682 may be made of a less dense material, such as polyurethane or another plastic. In other embodiments, the weights 1682 may have different sizes or volumes such that they vary in mass. For example, one weight 1682 may have a greater volume than the remaining weights 1682. In some embodiments, each of the weights 1682 may vary in volume from one another and thus vary in mass. In some embodiments, the weights 1682 may vary in both volume and material from one another. In some embodiments, one of the structures labeled as 1682 is not a weight, but rather a light-weight (e.g., light-weight plastic) cover that snap-fits or otherwise couples to one of the protruding bodies 1670A, B, C, D. In some embodiments, the weights may vary between 0.1-50 g. For example, in embodiments having a plurality of weights 1682, one or more of the weights 1682 may vary between 0-10 g, one or more of the weights 1682 may vary between 10-20 g, one or more of the weights 1682 may vary between 20-30, one or more of the weights 1682 may vary between 30-40 g, and one or more of the weights 1682 may vary between 40-50 g. In some embodiments, a first weight 1682 may vary between 0-10 g, a second weight 1682 may vary between 10-20 g, a third weight 1682 may vary between 20-30, a fourth weight 1682 may vary between 30-40 g, and a fifth weight 1682 may vary between 40-50 g. In other embodiments, a first weight 1682 may vary between 1-5 g, and a second and third weight 1682 may vary between 5-30 g. In other embodiments, a first and second weight 1682 may vary between 1-10 g, and a third and fourth weight 1682, may vary between 5-25 g. In some embodiments, a first weight 1682 has a mass of 8.5 grams, and a second and third weight 1682 each have a mass of 1.5 grams. In other embodiments, a first weight 1682 has a mass of 12 grams, and a second and third weight 1682 each have a mass of 1.5 grams. In other embodiments, a first weight 1682 has a mass of 8.5 grams, and a second and third weight 1682 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 33 and 34, in the illustrated embodiment one of the protruding bodies 1670A receives a weight 1682. In other embodiments, one or more of the protruding bodies 1670A, B, C, D receives a weight 1682, while the remaining protruding bodies 1670A, B, C, D are bare and uncovered, or are covered with another material or structure. In some embodiments, one or more of the protruding bodies 1670A, B, C, D receives more than one weight 1682. In some embodiments, one or more of the protruding bodies 1670A, B, C, D does not extend past an outer profile of the club head 1610, such that even if the protruding body 1670A, B, C, D is left bare and uncovered, the protruding body will not interfere with or disrupt a golfer's swing. Further, in some embodiments, the protruding bodies 1670B, D can comprise weights similar to the weights 82, while the weights 1670A, C can comprise weights 1682.

The weights 1682 configured to couple with the protruding bodies 1670A, B, C, D can be strategically positioned to adjust the club head 1610 CG. Shifting the weights between the protruding bodies 1670A, C in a toe to heel manner can have the same effects as discussed in previous embodiments (Shifting the CG from the heel end 1622 to the toe end 1618). Further, shifting a heavier weight to the protruding body 1670B, D can shift the club head 1666 CG towards the front or the back of the club head 1666 affecting the spin imparted on the ball.

The adjustable weighting system 1666 of golf club head 1666 maintains or prevents a significant reduction in club head moment of inertia, and low and back club head center of gravity positioning, compared to a club head devoid of an adjustable weighting system. The adjustable weighting system 1666 of golf club head 1666 maintains a high club head moment of inertia and a low and back club head CG position due to the low profile of the weighting system and the perimeter positioning of the one or more weights. The club head 1666 having the adjustable weighting system 1666 can have similar or identical parameters and measurements as club head 100 described above.

With continued reference to FIGS. 33 and 34, the club head 1610 further includes an additional protrusion 1615 that extends from the outer surface 1674 of the club head 1610, generally adjacent the recessed portion 1680. The additional protrusion 1615 may be used, for example, to receive a cover (e.g., similar to the cover 1311 described above).

Figure 35:
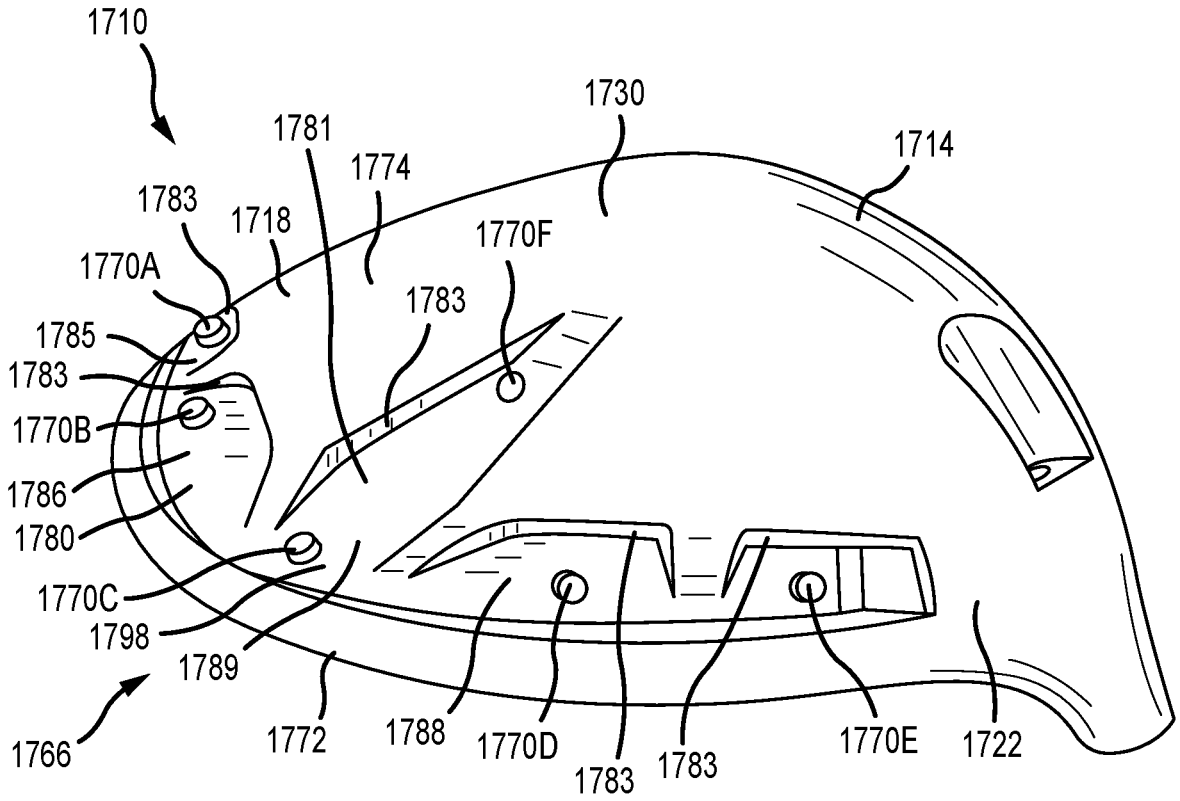
FIG. 35 is a perspective view of a golf club head according to another embodiment.

FIG. 35 illustrates a club head 1710 having a club head body 1714. The club head 1710 includes an adjustable weighting system 1766. The adjustable weighting system 1766 is adjustable by an end user to modify the club head 1710 center of gravity and/or moment of inertia and/or heel/toe bias to achieve desired performance characteristics (e.g., forgiveness, spin, trajectory) under various circumstances. The adjustable weighting system 1766 is a low profile system and thereby does not significantly shift or change the club head 1710 MOI when compared to a club head not including the adjustable weighting system 1766. Further, the low profile adjustable weighting system 1766 ensures that shifts in the club head 1710 CG occur mainly in a heel end 1722 to toe end 1718 direction keeping the overall club head 1710 CG in a low and back location.

Referring to FIG. 35, the adjustable weighting system 1766 includes a recessed portion 1780, The recessed portion 1780 comprising a recessed surface 1781 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1766 includes a recessed surface 1781 comprising six discrete attachment locations. Each of the six discrete attachment locations comprising a feature in the form of a protruding body 1770A, B, C, D, E, F.

Referring again to FIG. 35, the recessed portion 1780 is similar to the recessed portion 980, 1380 having a first a first portion 1785 that extends from an intersection region 1798 toward a toe or toe end 1718, a second portion 1787 that extends from the intersection region 1798 toward to a heel or heel end 1722, a third portion 1789 that extends generally inwardly from the intersection region 1798 toward a center of the sole or bottom 1730. However, the recessed portion 1780 further includes a fourth portion 1786 extending between the first portion 1785 and the toe end 1718, and a fifth portion 1788 extending between the second portion 1787 and the heel end 1722. In the illustrated embodiment, the first, second, fourth and fifth portions 1785, 1787, 1786, 1788 extend in an arcuate configuration from the toe end 1718 to the heel end 1722. Further, the recessed portion 1780 has a recessed surface 1781 similar to the recessed surfaces 981, 1381. The recessed portion 1780 and recessed surface 1781 can have the same width, depth and dimensions as the recessed portions 980, 1380 and recessed surfaces 981, 1381. As illustrated in FIG. 35, the walls 1783 generally define and partially separate the first portion 1789, the second portion 1791, the third portion 1793, the fourth portion 1795, and the fifth portion 1797 from each other.

With respect to the number of neighboring protruding bodies 1770A, B, C, D, E, F their position, their shape, and their size the adjustable weighting system 1766 can be similar to the adjustable weighting systems 66, 166, 266, 366, 466, 566, 666, 766, 866, 966, 1066, 1166, 1266, 1366, 1466, 1566, and 1666. In the illustrated embodiment, the adjustable weighting system 1766 includes six protruding bodies 1770A, B, C, D, E, F each defining an attachment point for a weight (not shown). The weight can be similar to the weight 82 or the weight 1682 described above.

The protruding bodies 1770A, B, C, D, E, F may be of any shapes and any configurations such that one or more weights may be coupled to the protruding bodies 1770A, B, C, D, E, F (as opposed to being coupled to ports where the ports are holes or cavities within the body of the club that include for example internal threads to couple to external threads on the weights). In the illustrated embodiment, the protruding bodies 1770A, B, C, D, E, F are cylindrical in shape. In other embodiments, the protruding bodies 1770A, B, C, D, E, F have square cross-sections, rectangular cross-sections, triangular cross-sections, or have any other shapes.

The protruding bodies 1770A, B, C, D, E, F can be positioned at any location in the recessed portion 1780 and extend generally perpendicularly from the recessed surface 1781. In the illustrated embodiment, a first one of the protruding bodies 1770A extends from the fourth portion 1786 nearest the toe end 1718, a second one of the protruding bodies 1770E extends from the sixth portion 1788 nearest the heel end 1722, a third one of the protruding bodies 1770F extends from the third portion 1789, a fourth one of the protruding bodies 1770B extends from the first portion 1785, a fifth one of the protruding bodies 1770D extends from the second portion 1787, and a sixth one of the protruding bodies 1770C extends from the intersection region 1798 of the third portion 1793, the fourth portion 1795, and the fifth portion 1797. Each of the protruding bodies 1770A, B, C defining a discrete attachment location for securing a weight (not shown) to the club head 10. In contrast to other adjustable weighting systems wherein the weight can be coupled at any, or at an infinite, or at an unlimited number of locations across the recessed portion.

The weights can be similar to the weights 81, 1682 described above. By moving a weight between the third and sixth protruding bodies 1670 C, F the center of gravity can be shifted towards the strike plate or towards the rear end. Further, by moving the weights between the first, second, fourth, fifth, and sixth protruding bodies 1770A, B, C, D, E the center of gravity can be shifted in a toe 1718 to heel 1722 direction. In other embodiments, the protruding bodies 1770A, B, C, D, E, F can be positioned in different locations within the recessed portion 1780 or the club head 1710. Finally, in other embodiments, the adjustable weighting system 1766 can include 1, 2, 3, 4, 5, 6, 7, or 8 protruding bodies 1770.

The adjustable weighting system 1766 of golf club head 1766 maintains or prevents a significant reduction in club head moment of inertia, and low and back club head center of gravity positioning, compared to a club head devoid of an adjustable weighting system. The adjustable weighting system 1766 of golf club head 1766 maintains a high club head moment of inertia and a low and back club head CG position due to the low profile of the weighting system and the perimeter positioning of the one or more weights. The club head 1766 having the adjustable weighting system 1766 can have similar or identical parameters and measurements as club head 100 described above.

Figure 36:
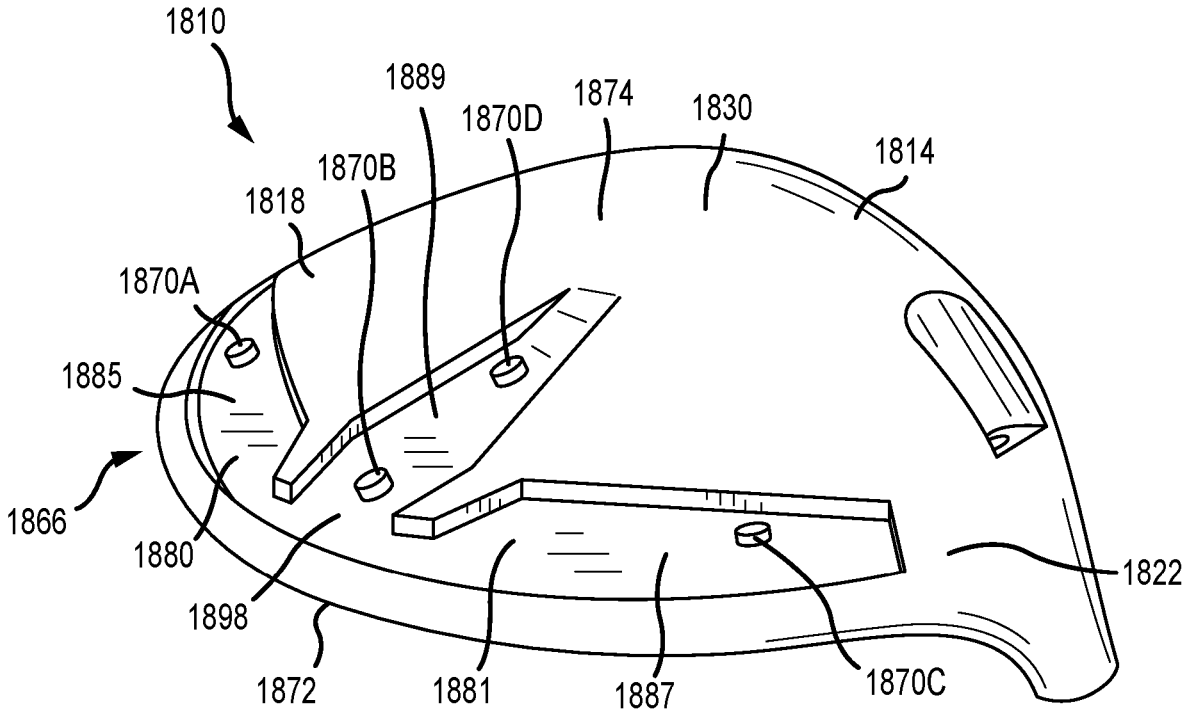
FIG. 36 is a perspective view of a golf club head according to another embodiment.

FIG. 36 illustrates a club head 1810 having a club head body 1814. The club head 1810 includes an adjustable weighting system 1866. The adjustable weighting system 1866 is adjustable by an end user to modify the club head 1810 center of gravity and/or moment of inertia and/or heel/toe bias to achieve desired performance characteristics (e.g., forgiveness, spin, trajectory) under various circumstances. The adjustable weighting system 1866 is a low profile system and thereby does not significantly shift or change the club head 1810 MOI when compared to a club head not including the adjustable weighting system 1866. Further, the low profile adjustable weighting system 1866 ensures that shifts in the club head 1810 CG occur mainly in a heel end 1822 to toe end 1818 direction keeping the overall club head 1810 CG in a low and back location.

Referring to FIG. 36 the adjustable weight system 1866 can comprise a recessed portion 1880. The recessed portion 1880 can comprise a recessed surface 1881 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1866 includes a recessed surface 1881 comprising four discrete attachment locations. The four discrete attachment locations each comprising a feature in the form of a protruding body 1870A, B, C, D. Each protruding body 1870A, B, C, D configured to receive a weight.

Referring again to FIG. 36, the recessed portion 1866 is similar to the recessed portions 980, 1380, 1780 having a first portion 1885 that extends from an intersection region 1898 towards a toe end 1818, a second portion 1887 that extends from the intersection region 1898 towards a heel end 1822, and a third portion 1889 that extends generally inwardly from the intersection region 1898 toward a center of the sole 1830. Similar to the recessed portions 980, 1380, 1780, the first and second portions 1885, 1887 of the recessed portion 1880 extend generally from a toe end 1818 to a heel end 1822 following the contour of the trailing edge 1872. However, the first portions 1885 and the second portion 1887 of the recessed portion 1880 comprise varying widths. In the illustrated embodiment, the width of the first portion and second portions 1885, 1887 is larger near the toe and heel ends 1818, 1822 of the first and second portion 1885, 1887, than toward the area of the first and second portions 1885, 1887 directly adjacent to the intersection region 1898. Additionally, in the illustrated embodiment, the third portion 1889 includes a width, which increases from the intersection region 1898 to a point of maximum width and decreases from the point of maximum width towards the center of the sole 1830. In other embodiments, the width of the first, second and third portions 1885, 1887, 1889 can increase, decrease and/or remain constant from the intersection region 1898 towards the toe end 1818, heel end 1822, and center of the sole 1830 respectively. Further, the recessed portion 1880 can comprise a recessed surface 1881. The recessed surface 1881 can have a width, depth and dimensions similar to the width depth and dimensions as the recessed surface 981, 1381, 1781 of recessed portions 980, 1380, 1780.

With respect to the number of neighboring protruding bodies 1870A, B, C, D their position, their shape and their size the adjustable weighting system 1866 can be similar to the adjustable weighting systems 66, 166, 266, 366, 466, 566, 666, 766, 866, 966, 1066, 1166, 1266, 1366, 1466, 1566, 1666, and 1766. In the illustrated embodiment, the adjustable weighting system 1866 includes four protruding bodies 1870A, B, C, D each defining an attachment point for a weight (not shown). The weight can be similar to the weights 82, 1682 described above.

The protruding bodies 1870A, B, C, D may be of any shapes and any configurations such that one or more weights may be coupled to the protruding bodies 1870A, B, C, D (as opposed to being coupled to ports where the ports are holes or cavities within the body of the club that include for example internal threads to couple to external threads on the weights). In the illustrated embodiment, the protruding bodies 1870A, B, C, D are cylindrical in shape. In other embodiments, the protruding bodies 1870 have square cross-sections, rectangular cross-sections, triangular cross-sections, or have any other shapes.

The protruding bodies 1870A, B, C, D can be positioned at any location in the recessed portion 1880 and extend generally perpendicularly from the recessed surface 1881. In the illustrated embodiment, a first one of the protruding bodies 1870A extends from the first portion 18885, a second one of the protruding bodies 1870C extends from the second portion 1887, a third one of the protruding bodies 1870B extends from the third portion 1893 near the intersection region 1898, and a fourth one of the protruding bodies 1870D extends from the third portion 1889 near the center of the sole 1830. Each of the protruding bodies 1870A, B, C defining a discrete attachment location for securing a weight (not shown) to the club head 1810. In contrast to other adjustable weighting systems wherein the weight can be coupled at any, or at an infinite, or at an unlimited number of locations across the recessed portion. The weights can be similar to the weights 81, 1682 described above. By moving a weight between the third and fourth protruding bodies 1870B, D, the club head center of gravity can be shifted towards the strike plate (not shown) or towards the rear end. By moving a weight between the first and second protruding bodies 1870A, C, the club head center of gravity can be shifted towards the toe end 1818 or the heel end 1822.

The adjustable weighting system 1866 of golf club head 1866 maintains or prevents a significant reduction in club head moment of inertia, and low and back club head center of gravity positioning, compared to a club head devoid of an adjustable weighting system. The adjustable weighting system 1866 of golf club head 1866 maintains a high club head moment of inertia and a low and back club head CG position due to the low profile of the weighting system and the perimeter positioning of the one or more weights. The club head 1866 having the adjustable weighting system 1866 can have similar or identical parameters and measurements as club head 100 described above.

Figure 37:
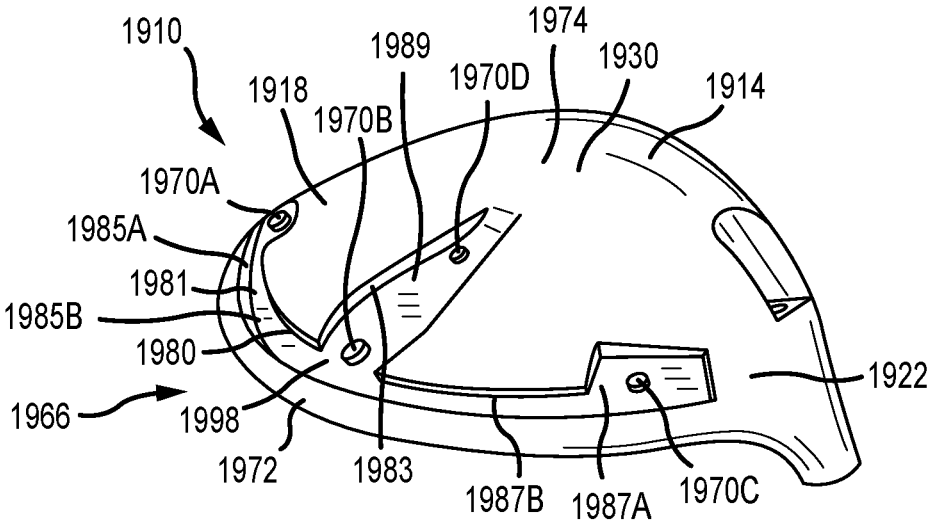
FIGS. 37 and 38 are perspective views of a golf club head according to another embodiment.
Figure 38:
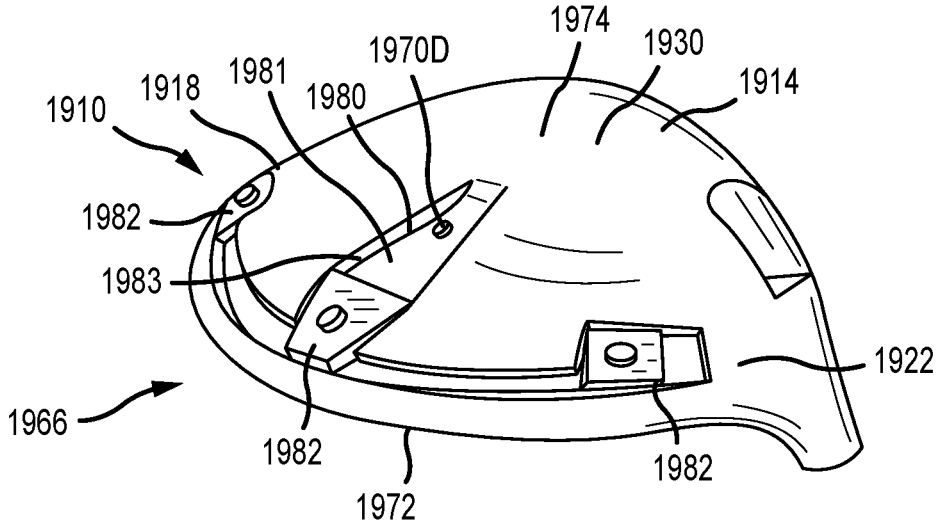

FIGS. 37 and 38 illustrate a club head 1910 having a club head body 1914. The club head 1910 includes an adjustable weighting system 1966. The adjustable weighting system 1966 is adjustable by an end user to modify the club head 1910 center of gravity and/or moment of inertia and/or heel/toe bias to achieve desired performance characteristics (e.g., forgiveness, spin, trajectory) under various circumstances. The adjustable weighting system 1966 is a low profile system and thereby does not significantly shift or change the club head 1910 MOI when compared to a club head not including the adjustable weighting system 1966. Further, the low profile adjustable weighting system 1966 ensures that shifts in the club head 1910 CG occur mainly in a heel end 1922 to toe end 1918 direction keeping the overall club head 1910 CG in a low and back location.

Referring to FIG. 36 the adjustable weight system 1966 can comprise a recessed portion 1980. The recessed portion 1980 can comprise a recessed surface 1981 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 1966 includes a recessed surface 1981 comprising four discrete attachment locations. Each of the four discrete attachment locations comprises a feature in the form of a protruding body 1970A, B, C, D. Each protruding body 1970A, B, C, D configured to receive a weight.

Referring again to FIG. 36, the recessed portion 1966 is similar to the recessed portions 980, 1380, 1780, 1880 having a first portion 1985 that extends from an intersection region 1998 towards a toe end 1918, a second portion 1987 that extends from the intersection region 1998 towards a heel end 1922, and a third portion 1989 that extends generally inwardly from the intersection region 1998 toward a center of the sole 1930. Similar to the recessed portions 980, 1380, 1780, 1880 the first and second portions 1985, 1987 of the recessed portion 1980 extend generally from a toe end 1918 to a heel end 1922 following the contour of the trailing edge 1972. However, the first portions 1985 and the second portion 1987 of the recessed portion 1980 comprise varying widths. In the illustrated embodiment, the first portion 1985 comprises a first part 1985A adjacent the toe end 1818 having a greater width than a second part 1985B having a constant width extending from the intersection region 1998 to the first part 1985A of the first portion 1985. Further, the second portion 1987 comprises a first part 1987A adjacent the heel end 1822 having a greater width than a second part 1987B having a constant width extending from the intersection region 1998 to the first part 1987A of the second portion 1987. Additionally, in the illustrated embodiment, the third portion 1989 includes a width which increases from the intersection region 1998 to a point of maximum width and decreases from the point of maximum width towards the center of the sole 1930. In other embodiments, the width of the first, second and third portions 1985, 1987, 1989 can increase, decrease and/or remain constant from the intersection region 1998 towards the toe end 1918, heel end 1922, and center of the sole 1930 respectively. Further, the recessed portion 1980 can comprise a recessed surface 1981. The recessed surface 1981 can have a width, depth and dimensions similar to the width depth and dimensions as the recessed surface 981, 1381, 1781, 1881 of recessed portions 980, 1380, 1780, 1880.

With respect to the number of neighboring protruding bodies 1970A, B, C, D their position, their shape and their size the adjustable weighting system 1966 can be similar to the adjustable weighting systems 66, 166, 266, 366, 466, 566, 666, 766, 866, 966, 1066, 1166, 1266, 1366, 1466, 1566, 1666, 1766, and 1866. In the illustrated embodiment, the adjustable weighting system 1966 includes four protruding bodies 1970A, B, C, D each defining an attachment point for a weight 1982.

The protruding bodies 1970A, B, C, D may be of any shapes and any configurations such that one or more weights may be coupled to the protruding bodies 1970A, B, C, D (as opposed to being coupled to ports where the ports are holes or cavities within the body of the club that include for example internal threads to couple to external threads on the weights). In the illustrated embodiment, the protruding bodies 1970A, B, C, D are cylindrical in shape. In other embodiments, the protruding bodies 1970 have square cross-sections, rectangular cross-sections, triangular cross-sections, or have any other shapes.

The protruding bodies 1980A, B, C, D can be positioned at any location within the recessed portion 1980 extending generally perpendicularly from the recessed surface 1981. In the illustrated embodiment, a first one of the protruding bodies 1970A extends from the first portion 1985, a second one of the protruding bodies 1970C extends from the second portion 1987, a third one of the protruding bodies 1970B extends from the third portion 1989 near the intersection region 1998, and a fourth one of the protruding bodies 1970D extends from the third portion 1989 near the center of the sole 1930. Each of the protruding bodies 1970A, B, C defining a discrete attachment location for securing a weight to the club head 1910. In contrast to other adjustable weighting systems wherein the weight can be coupled at any, or at an infinite, or at an unlimited number of locations across the recessed portion.

As illustrated in FIG. 38, the adjustable weighting system 1966 can include a weight 1982. The weight 1982 may take the shape of any part of the recessed portion 1980. For example, in the illustrated embodiment, three weights 1982 are illustrated, a first and second weight 1982 fit into the first part of the first and second portions 1985A, 1987A, and a third weight 1982 fits into the third portion 1989 near the intersection region 1998. The weight 1982 includes a generally cylindrical aperture 1986 that is sized and shaped to receive the protruding bodies 1970A, B, C, D. The aperture 1986 is a through aperture that extends entirely through the weight 1982. However, in other embodiments the weight or weights 1982 have blind apertures. In some embodiments, the protruding body or bodies 1970A, B, C, D have external threads, and the weight or weights 1982 have internal threads within the apertures 1986, such that the weights 1982 are threadably coupled to the protruding bodies 1970A, B, C, D. In other embodiments, the weight or weights 1982 are coupled to the protruding bodies 1970A, B, C, D with friction fits, with snap-fit mechanisms, with set screws positioned within threaded inner surfaces of the protruding bodies 1970A, B, C, D, or with other structures.

Referring again to FIG. 38, the weights 1982 may have different shapes, depending on whether the weights 1982 are being positioned on the first and second protruding bodies 1970A, C or the third and fourth protruding bodies 1970B, C. In some embodiments one or more of the protruding bodies 1970A, B, C, D is not coupled to a weight 1982. In these embodiments, the protruding body 1970A, B, C, D may be left bare and uncovered, or may be covered by another structure (e.g., similar to the cover 1311). In some embodiments, one of the structures labeled as 1982 in FIG. 38 is not a weight, but rather a light-weight (e.g., light-weight plastic) cover that snap-fits or otherwise couples to one of the protruding bodies 1970. Additionally, in some embodiments the weight 1982 (or cover) is sized and shaped to fit against a wall 1983 that surrounds the recessed surface 1981, and to press against the wall 1983 via a friction fit to help further hold the weight 1982 in place. Thus, the wall 1983 may act to help couple (and in some cases align and orientate) a particularly-shaped weight 1982. By moving a weight 1982 between the third and fourth protruding bodies 1870B, D, the club head center of gravity can be shifted towards the strike plate (not shown) or towards the rear end. By moving a weight 1982 between the first and second protruding bodies 1870A, C, the club head center of gravity can be shifted towards the toe end 1818 or the heel end 1822.

In the illustrated embodiment, the weights 1982 are generally flat, to increase club head moment of inertia, although other embodiments include different shapes than that illustrated. In some embodiments, the weights 1982 are made of different materials such that they vary in mass. For example, one weight 1982 may be made of a high density material, such as tungsten, and the remaining weights 1982 may be made of a less dense material, such as polyurethane or another plastic. In other embodiments, the weights 1982 may have different sizes or volumes such that they vary in mass. For example, one weight 1982 may have a greater volume than the remaining weights 1982. In some embodiments, each of the weights 1982 may vary in volume from one another and thus vary in mass. In some embodiments, the weights 1982 may vary in both volume and material from one another. In some embodiments, one of the structures labeled as 1982 is not a weight, but rather a light-weight (e.g., light-weight plastic) cover that snap-fits or otherwise couples to one of the protruding bodies 1970A, B, C, D. In some embodiments, the weights may vary between 0.1-50 g. For example, in embodiments having a plurality of weights 1982, one or more of the weights 1982 may vary between 0-10 g, one or more of the weights 1982 may vary between 10-20 g, one or more of the weights 1982 may vary between 20-30, one or more of the weights 1982 may vary between 30-40 g, and one or more of the weights 1982 may vary between 40-50 g. In some embodiments, a first weight 1982 may vary between 0-10 g, a second weight 1982 may vary between 10-20 g, a third weight 1982 may vary between 20-30, a fourth weight 1982 may vary between 30-40 g, and a fifth weight 1982 may vary between 40-50 g. In other embodiments, a first weight 1982 may vary between 1-5 g, and a second and third weight 1682 may vary between 5-30 g. In other embodiments, a first and second weight 1982 may vary between 1-10 g, and a third and fourth weight 1982, may vary between 5-25 g. In some embodiments, a first weight 1982 has a mass of 8.5 grams, and a second and third weight 1982 each have a mass of 1.5 grams. In other embodiments, a first weight 1982 has a mass of 12 grams, and a second and third weight 1982 each have a mass of 1.5 grams. In other embodiments, a first weight 1982 has a mass of 8.5 grams, and a second and third weight 1982 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

By moving a weight between the third and fourth protruding bodies 1970B, D, the club head center of gravity can be shifted towards the strike plate (not shown) or towards the rear end. By moving a weight between the first and second protruding bodies 1970A, C, the club head center of gravity can be shifted towards the toe end 1818 or the heel end 1822.

The adjustable weighting system 1966 of golf club head 1966 maintains or prevents a significant reduction in club head moment of inertia, and low and back club head center of gravity positioning, compared to a club head devoid of an adjustable weighting system. The adjustable weighting system 1966 of golf club head 1966 maintains a high club head moment of inertia and a low and back club head CG position due to the low profile of the weighting system and the perimeter positioning of the one or more weights. The club head 1966 having the adjustable weighting system 1966 can have similar or identical parameters and measurements as club head 100 described above.

Figure 39:
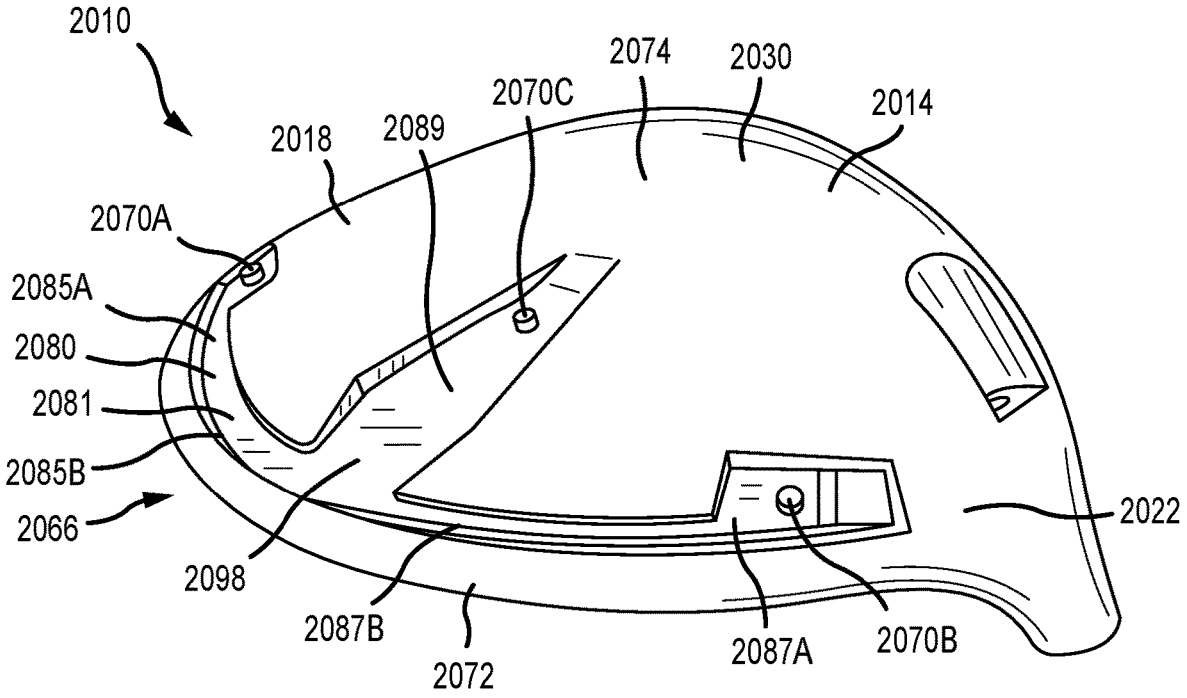
FIG. 39 is a perspective view of a golf club head according to another embodiment.

FIG. 39 illustrates a club head 2010 having a club head body 2014. The club head 2010 includes an adjustable weighting system 2066. The adjustable weighting system 2066 is adjustable by an end user to modify the club head 2010 center of gravity and/or moment of inertia and/or heel/toe bias to achieve desired performance characteristics (e.g., forgiveness, spin, trajectory) under various circumstances. The adjustable weighting system 2066 is a low profile system and thereby does not significantly shift or change the club head 2010 MOI when compared to a club head not including the adjustable weighting system 2066. Further, the low profile adjustable weighting system 2066 ensures that shifts in the club head 2010 CG occur mainly in a heel end 2022 to toe end 2018 direction keeping the overall club head 2010 CG in a low and back location.

The adjustable weighting system 2066 comprises a recessed portion 2080 having a recessed surface 2081 configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2066 comprises a recessed surface 2081 including three discrete attachment locations. The three discrete attachment locations each having a feature in the form of a protruding body 2070A, B, C. The recessed portion 2080, recessed surface 2081, and protruding bodies 2070A, B, C of the club head 2010 are the same as the recessed portion 1980, recessed surface 1981, and protruding bodies 1970A, B, C, D of the adjustable weight system 1966. However, the adjustable weighting system 2066 comprises only three protruding bodies 2070A, B, C. In FIG. 39, it can be seen that the adjustable weighting system 2066 does not include a protruding body 2070 in the third portion 2089 near the intersection region 2098, such as protrusion 1970B of the adjustable weight system 1966 shown in FIGS. 37 and 38.

The adjustable weighting system 2066 of golf club head 2010 maintains or prevents a significant reduction in club head moment of inertia, and low and back club head center of gravity positioning, compared to a club head devoid of an adjustable weighting system. The adjustable weighting system 2066 of golf club head 2066 maintains a high club head moment of inertia and a low and back club head CG position due to the low profile of the weighting system and the perimeter positioning of the one or more weights. The club head 2066 having the adjustable weighting system 2066 can have similar or identical parameters and measurements as club head 100 described above.

Figure 40:
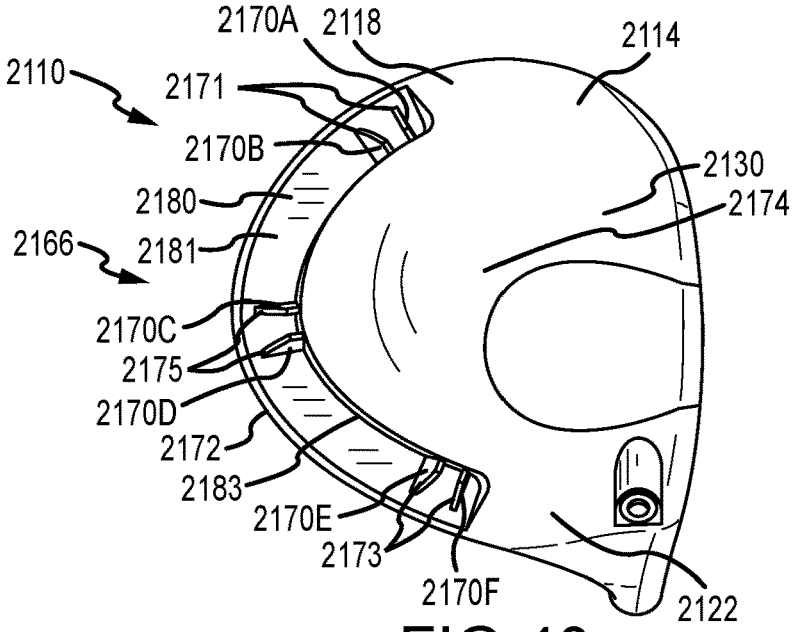
FIGS. 40 and 41 are bottom and rear views of a gold club head according to another embodiment.
Figure 41:
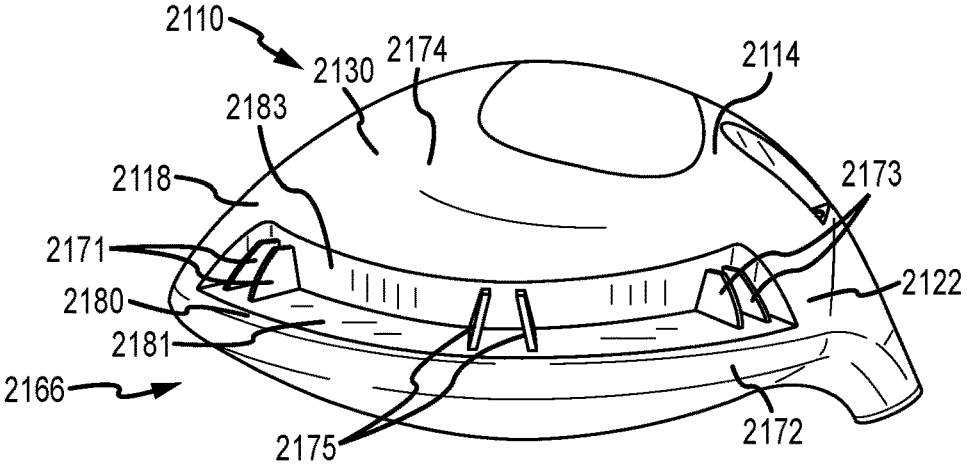

FIGS. 40 and 41 illustrate a club head 2110 having a club head body 2114. The club head 2110 includes an adjustable weighting system 2166 that is adjustable by an end user to modify the club head 2110 center of gravity and/or moment of inertia and/or heel/toe bias to achieve desired performance characteristics (e.g., forgiveness, spin, trajectory) under various circumstances. The adjustable weighting system 2166 is a low profile system and thereby does not significantly shift or change the club head 2110 MOI when compared to a club head not including the adjustable weighting system 2166. Further, the low profile adjustable weighting system 2166 ensures that shifts in the club head 2110 CG occur mainly in a heel end 2122 to toe end 2118 direction keeping the overall club head 2110 CG in a low and back location.

Referring to FIGS. 40-41, the adjustable weighting system 2166 can comprise a recessed portion 2180. The recessed portion 2180 is defined by a recessed surface 2181 and a wall 2183. The recessed surface 2181 and/or the wall 2183 can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2180 comprises a recessed surface 2181 including three discrete attachment locations. The three discrete attachment locations each including two features in the form of a protruding body 2170A, B, C, D, E, F. Further, the protruding bodies 2170A, B, C, D, E, F are positioned in pairs across the length of the recessed portion 2170, wherein each pair of protruding bodies 2170A, B, C, D, E,F defining a discrete attachment location for securing a weight to the club head 2110. In contrast to other adjustable weighting systems wherein the weight can be coupled at any, or at an infinite, or at an unlimited number of locations across the recessed portion.

Referring again to FIGS. 40-41 the recessed portion 2180 extends from near the toe end 2118 in an arcuate manner to near the heel end 2222 following the contour of the trailing edge 2172. The recessed portion 2180 is defined by the recessed surface 2180 being offset and separated from the sole 2130 of the club head 2110. In some embodiments, the recessed surface 2180 extends substantially parallel to the sole 2130 of the club head 2110, while the wall 2183 extends substantially perpendicular to the sole 2130 of the club head 2110. The recessed portion 2180 includes a depth measured as the distance between the recessed surface 2181 and the sole 2130 of the club head 2110 (or the height of the wall 2183). In the illustrated embodiment, the recessed portion 2180 has a constant depth along its length from the toe end 2118 to the heel end 2122. In other embodiments, the recessed portion 2180 can have an increasing, decreasing or constant depth along its length from the toe end 2118 to the heel end 2122. Thus, when a weight (not shown) is coupled to the club head 2110 in one region of the recessed portion 2180, the weight may fit flush in the recessed portion 2180 and/or be concealed by the wall 2183. When the weight is coupled to the club head 2110 in a different region of the recessed portion 2180, a portion of the weight may protrude beyond the wall 2183 as the depth is less than the height of the weight.

In many embodiments, the recessed portion 2180 has a shallow depth ensuring the adjustable weight system 2166 remains low profile. For example, in some embodiments, the recessed portion 2180 has a maximum depth of 0.25 inches. In other embodiments, the recessed portion 2180 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 2180 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 2180 includes a width measured as the distance between the wall 2183 and the end of the recessed portion at or near the trailing edge 2172. In the illustrated embodiments, the recessed portion 2180 includes a constant width. In other embodiments, the recessed portion 2180 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 40-41, the recessed portion 2180 can include one or more protruding bodies 2170 defining a discrete attachment location for securing a weight to the club head 2110. In the illustrated embodiment, the adjustable weight system 2166 comprises six protruding bodies 2170A, B, C, D, E, F. The protruding bodies 2170A, B, C, D, E, F are rib style bodies extending perpendicularly from both the wall 2183 and the recessed surface 2181. In other embodiments, the protruding bodies 2170A, B, C, D, E, F can be other features for coupling a weight to the club head such as an aperture, recess, ports capable of receiving a fastener, notches, tabs, cutout regions, ribs, grooves, pegs, hooks, magnets, programmable magnets or any other suitable attachment means. In other embodiments, the recessed portion 2180 can comprise one, two, three, four, five, six, seven, eight, nine or ten features 2170. In many embodiments, the protruding bodies 2170A, B, C, D, E, F are positioned only on the recessed surface 2181 of the recessed portion 2180. In other embodiments, the protruding bodies 2170A, B, C, D, E, F can be positioned only on the wall 2183 of the recessed portion 2180.

As illustrated and discussed above, the protruding bodies 2170A, B, C, D, E, F are disposed within the recessed portion 2180 extending partially from the wall 2183 and partially from the recessed surface 2181 such that one or more weights may be releasably coupled to the club head 2110 along the recessed portion 2180. The protruding bodies 2170A, B, C, D, E, F are disposed in pairs along the recessed portion 2180. The pairs of protruding bodies 2170 A, B, C, D, E, F define the discrete attachment locations for securing a weight to the recessed portion 2180. The pairs of protruding bodies 2170A, B, C, D, E, F can be separated from adjacent pairs of protruding bodies 2170A, B, C, D, E, F by a distance of greater than 0.2 inches, greater than 0.3 inches, greater than 0.4 inches, greater than 0.5 inches, greater than 0.8 inches, greater than 1.0 inches, greater than 1.25 inches, greater than 1.5 inches, greater than 2.0 inches, greater than 2.5 inches, greater than 3.0 inches, greater than 3.5 inches, or greater than 4.0 inches. In the illustrated embodiment, a first pair 2171 of the protruding bodies 2170A, B is positioned near the toe end 2118 of the recessed portion 2180, a second pair 2175 of the protruding bodies 2170E, F is positioned near the heel end 2122 of the recessed portion 2180, and a third pair 2173 of the protruding bodies 2170C, B between toe and heel ends 2118, 2122 of the recessed portion 2180. The protruding bodies 2170A, C, E of the first, second and third pair 2171, 2173, 2175 of protruding bodies can comprise any distance between the corresponding protruding bodies 2170B, D, F of the first, second and third pair 2171, 2173, 2175. For example, in some embodiments, the protruding bodies 2170 A, B, C, D, E, F making up and of the first, second or third pair of protruding bodies 2171, 2173, 2175 can be separated by a distance of less than 1.0 inches, less than 0.75 inches, less than 0.5 inches, less than 0.4 inches, less than 0.3 inches, less than 0.2 inches, or less than 0.1 inches.

Further, the protruding bodies 2170A, B, C, D, E, F may be of any shapes and any configurations such that one or more weights may be coupled to the protruding bodies 2170A, B, C, D, E, F or to the pairs of protruding bodies 2171, 2173, 2175 (as opposed to being coupled to ports where the ports are holes or cavities within the body of the club that include for example internal threads to couple to external threads on the weights). In the illustrated embodiment, the protruding bodies 2170A, B, C, D, E, F are ribs. More specifically, in the illustrated embodiment, the protruding bodies 2170A, B, C, D, E, F are shaped as ribs which extend from the wall 2183 along the recessed surface 2181 towards the trailing edge 2172. Further, the protruding bodies 2170A, B, C, D, E, F comprise a maximum height near the wall 2183 and taper towards the recessed sole 2130 as they extend towards the trailing edge. In other embodiments, the protruding bodies 2170A, B, C, D, E, F have square cross-sections, rectangular cross-sections, triangular cross-sections, or have any other shapes.

Figure 42:
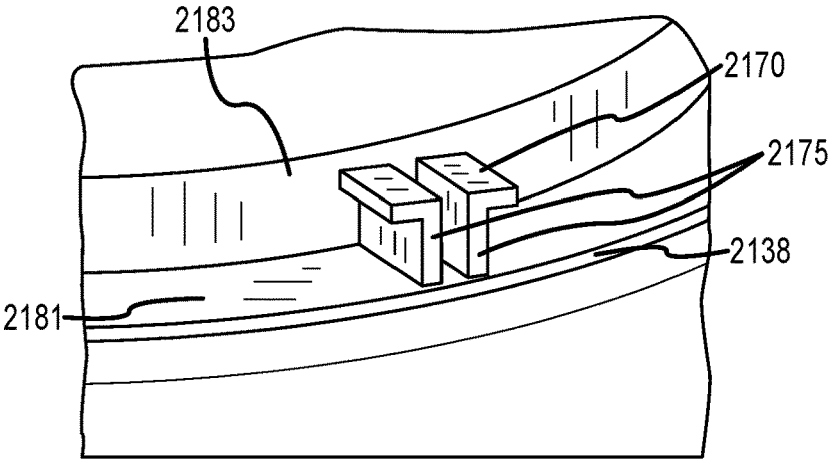
FIG. 42 is a perspective view of an alternative protruding body for the golf club head of FIGS. 40 and 41.

Turning now to FIG. 42 another embodiment of the protruding bodies 2170 is illustrated. In the illustrated embodiment, one or more of the protruding bodies 2170 may have an L-shaped rib profile (as opposed to the straight rib profile illustrated in FIGS. 40 and 42). The L-shaped rib profile extends away from the wall 2183 along the recessed surface 2181 towards the back end 2138. As illustrated in FIG. 42, in some embodiments, the protruding bodies 2170 may form a pair having oppositely-facing L-shaped profiles which are configured to receive and/or engage and hold a weight. In other embodiments, the protruding bodies 2170 may form a pair having facing L-shaped profiles which are configured to receive and/or engaged and a hold a weight.

Figure 43:
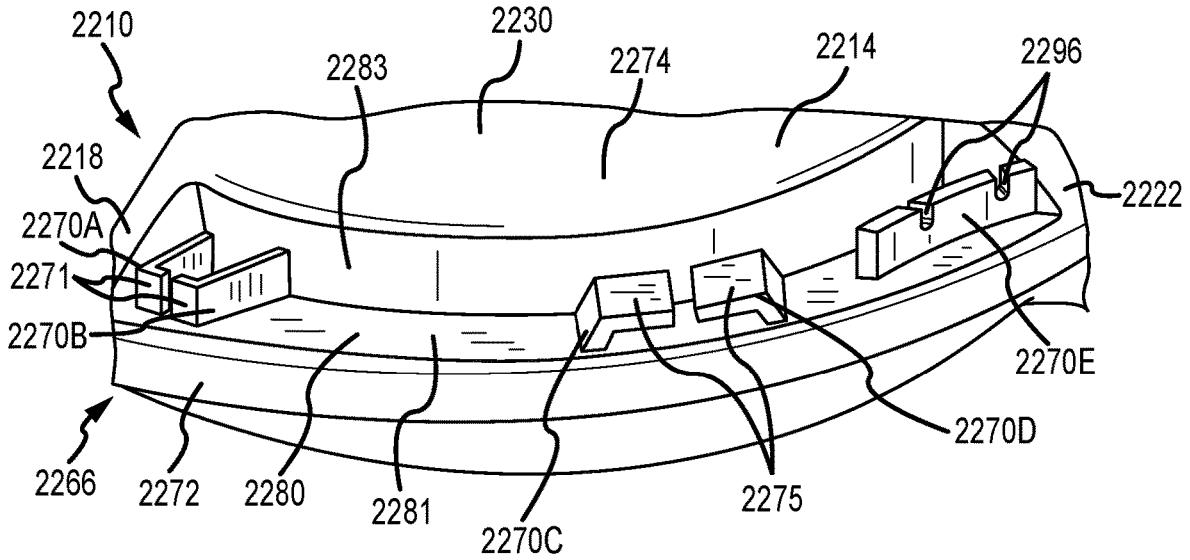
FIG. 43 is a perspective view of a golf club head according to another embodiment.

Turning now to FIG. 43, another embodiment of a recessed portion 2280 is illustrated. The recessed portion 2280 can be considered the same or similar to the recessed portion 2180, except that the protruding bodies 2270A, B, C, D, E of the recessed portion 2280 comprise a various shapes. For example, the protruding bodies 2270A, B forming a pair 2271 near the toe end 2218 of the recessed portion 2280 comprise an L-shaped rib profile. The protruding bodies 2270A, B are similar to the protruding bodies 2170 of FIG. 42 except the L-shaped profile extends away from the recessed portion 2281. The protruding bodies 2270C, 2270D forming the pair 2275 between the toe and heel end 2218, 2222 of the recessed portion 2280 comprise an L-shaped rib profile. The protruding bodies 2270C, D are similar to the protruding bodies 2170 of FIG. 42 except the rib extending from the recessed surface 2281 is not perpendicular with the recessed surface 2281. Finally, the protruding body 2270E is positioned near the heel end 2222 of the recessed portion 2280. The protruding body 2270 is in the shape of an elongated rib extending perpendicular from to the recessed surface 2281 and being spaced from the wall 2183. In the illustrated embodiment, the elongated rib of the protruding body 2170E forms a curvature, which is opposite the curvature of the trailing edge 2272. Additionally, the elongated rib of the protruding body 2170E comprises at least on notch extending inward the rib. In other embodiments, elongated rib of the protruding body 2270E can extend in a linear fashion across the recessed surface 2281. In other embodiments, the protruding body 2270E can comprise 1, 2, 3, 4, 5, or six notches configured to secure a weight. Further, it should be noted that in the illustrated embodiment, some of the protruding bodies 2270A, B, C, D form pairs 2271, 2275, while other protruding bodies 2270E do not form pairs.

Figure 44:
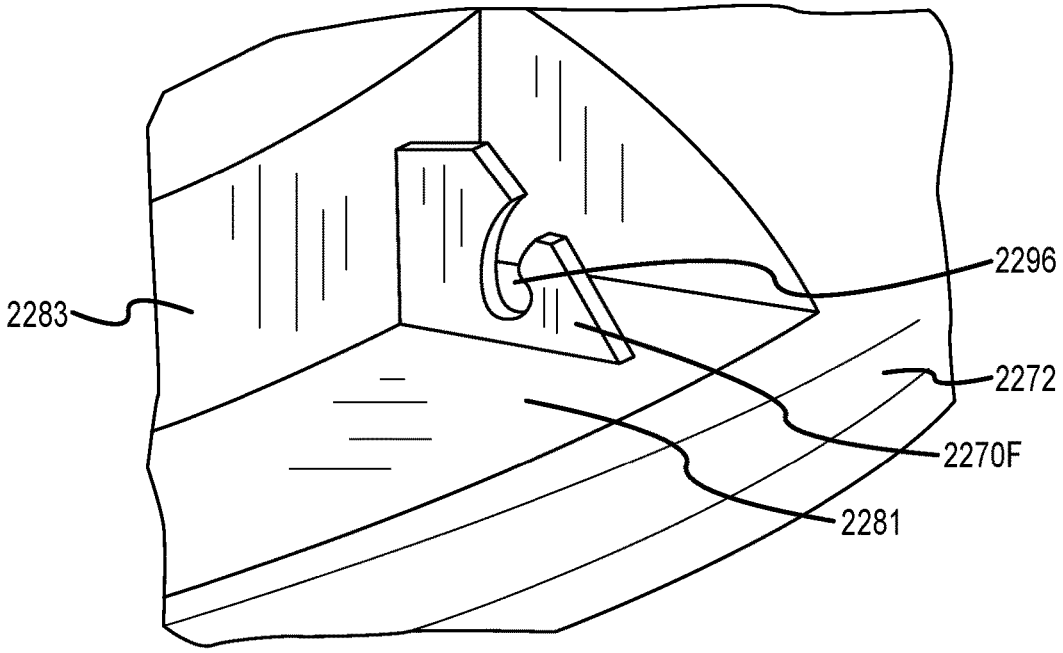
FIG. 44 is a perspective view of an alternative protruding body for the golf club head of FIG. 43.

Turning now to FIG. 44, another embodiment of a protruding body 2270F is illustrated. The protruding body is similar to the protruding bodies 2170A, B, C, D, E, F extending substantially perpendicularly from both the wall 2283 and the recessed surface 2281. Further, the protruding body 2270F tapers from near the wall 2283 towards the trailing edge 2272. However, in contrast to the protruding bodies 2170A, B, C, D, E, F the protruding body 2270F comprises a slot 2296. The slot 2296 may be used to secure a weight to the club head 2210 (e.g., with a snap-fit arrangement). In other embodiments, the protruding body 2270F can comprise 1, 2, 3, 4, 5, or 6 slots 2296.

Figure 45:
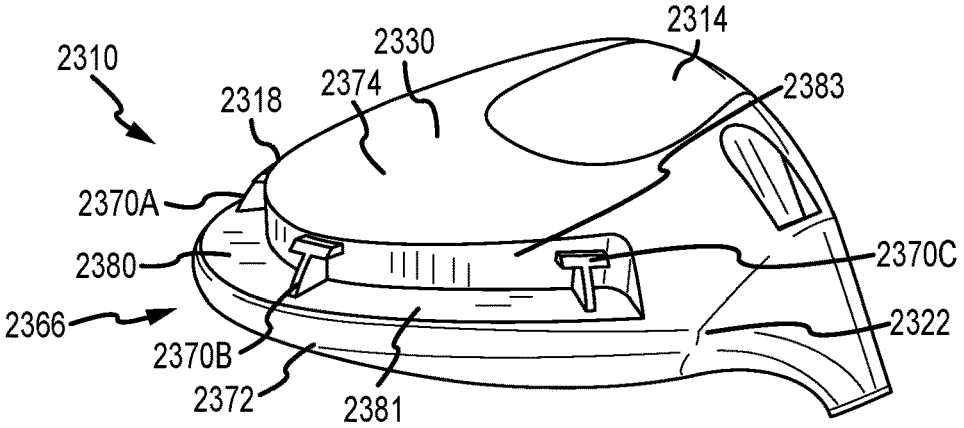
FIG. 45 is a perspective view of a golf club head according to another embodiment.
Figure 46:
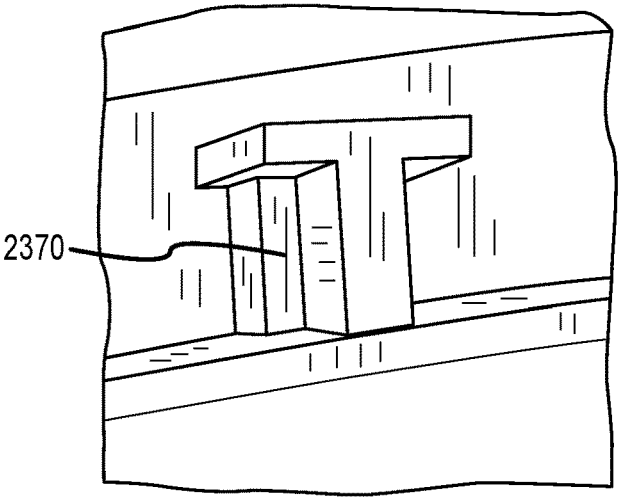
FIGS. 46 and 47 are perspective views of an alternative protruding body for the golf club head of FIG. 45.
Figure 47:
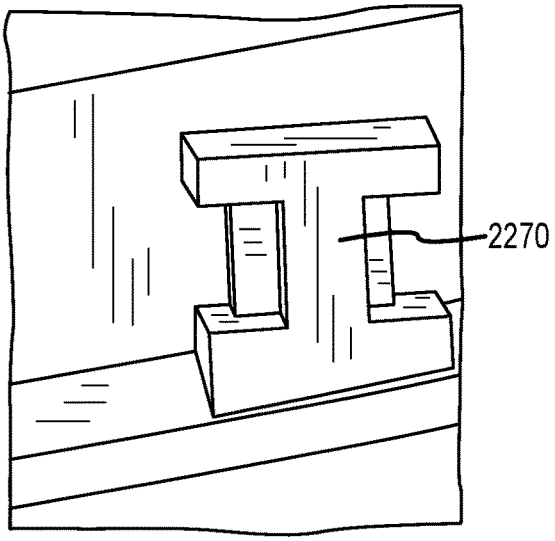

With reference to FIG. 45, another embodiment of a recessed portion 2380 comprising protruding bodies 2370A, B, C is illustrated. The recessed portion 2380 can be considered the same or similar to the recessed portion 2180, 2280, however, the protruding bodies 2370A, B, C have a different shape than any of the aforementioned protruding bodies 2170, 2270. For example, the protruding bodies 2370A, B, C comprise a T-shaped rib profile. Referring now to FIG. 46, in some embodiments, the protruding bodies 2370A, B, C can be T-shaped rib having a two-step rib extending towards the wall 2383. With reference to FIG. 47, in some embodiments one or more of the protruding bodies 2370A, B, C may have an I-shaped structure (as opposed to T-shaped as in FIGS. 45 and 46).

As discussed above, each of the protruding bodies 2170, 2270, 2370 or pair of protruding bodies 2171, 2173, 2175, 2271, 2275 can be configured to receive and/or engage and secure a weight (not shown). In some embodiments, the weight can include a notch, a slot or an aperture corresponding with the shapes and or features discussed above with respect to the protruding bodies 2170, 2270, 2370. In other embodiments, the weight can be devoid of an aperture or slots, or notches. In other embodiments, the weights can be configured to be couple to the protruding bodies 2170, 2270, 2370 through a friction fit, a snap-fit mechanism, with a set-screw, or with any other suitable structure.

The weights of each of the aforementioned adjustable weighting systems 2166, 2266, 2366 may be strategically positioned on the pairs of protruding bodies 2171, 2172, 2175 to achieve a desired club head 2110 center of gravity position and/or moment of inertia and/or heel/toe bias. For example, in some embodiments, a heavier weight is positioned on the third protruding body pair 2175, located between the toe or toe end 2118 and the heel or heel end 12122, while lighter weights are positioned on the first and second protruding bodies 2171, 2173 near the toe or toe end 2118 and the heel or heel end 2122. The aforementioned weight placement can result in the center of gravity remaining centered while being shifted towards the back end 2134 of the club head 2110. In some embodiments, a heavier weight is positioned on the second protruding body pair 2173 near the heel or heel end 2122, while lighter weights are positioned on the first protruding body pair 2171 near the toe or toe end 2118 and on the third protruding body 2175 that is located between the toe or toe end 2118 and the heel or heel end 2122. The aforementioned weight placement can result in the center of gravity being shifted towards the heel end 2122 of the club head 2110. In some embodiments, a heavier weight is positioned on the first protruding body pair 2171 near the toe or toe end 2118, while lighter weights are positioned on the second protruding body pair 2173 near the heel or heel end 2122 and on the third protruding body pair 2175 that is located between the toe or toe end 2118 and the heel or heel end 2122. The aforementioned weight placement can result in the center of gravity being shifted towards the toe end 2118 of the club head 2110. In many embodiments, one or more of the protruding bodies pairs 2171, 2173, 2175 are of equal size and shape, such that one weight may be interchangeably used with each of the protruding bodies pairs 2171, 2173, 2175. In some embodiments, one or more of the protruding bodies pairs 2171, 2173, 2175 can have a differing size and shape, such that each protruding body pairs 2171, 2173, 2175 has its own corresponding weight or set of weights.

The adjustable weighting system 2166, 2266, 2366 of golf club head 2110, 2210, 2310 maintains or prevents a significant reduction in club head moment of inertia, and low and back club head center of gravity positioning, compared to a club head devoid of an adjustable weighting system. The adjustable weighting system 2166, 2266, 2366 of golf club head 2110, 2210, 2310 maintains a high club head moment of inertia and a low and back club head CG position due to the low profile of the weighting system and the perimeter positioning of the one or more weights. The club head 2110, 2210, 2310 having the adjustable weighting system 2166, 2266, 2366 can have similar or identical parameters and measurements as club head 100 described above.

Figure 49:
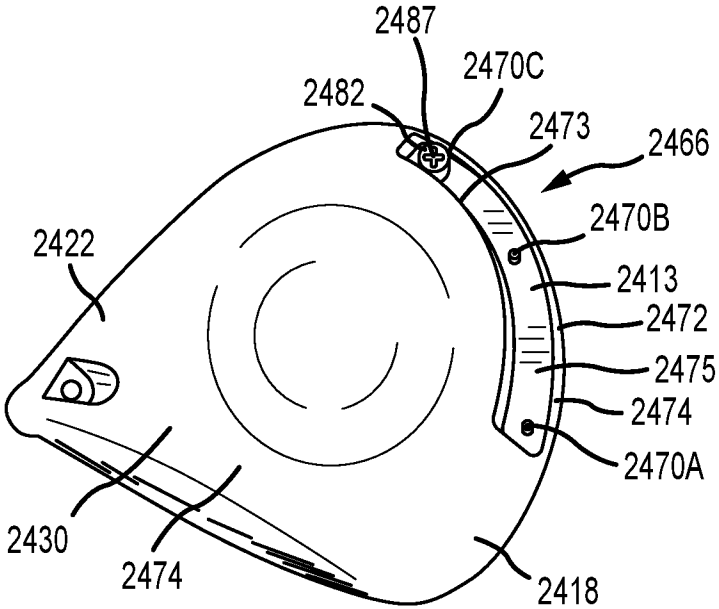
FIGS. 48-50 are perspective views of a golf club head according to another embodiment.
Figure 48:
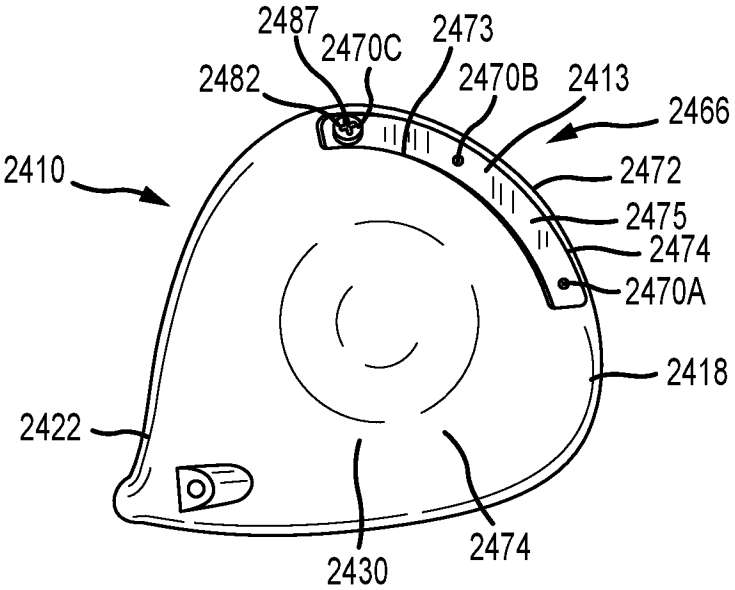
Figure 50:
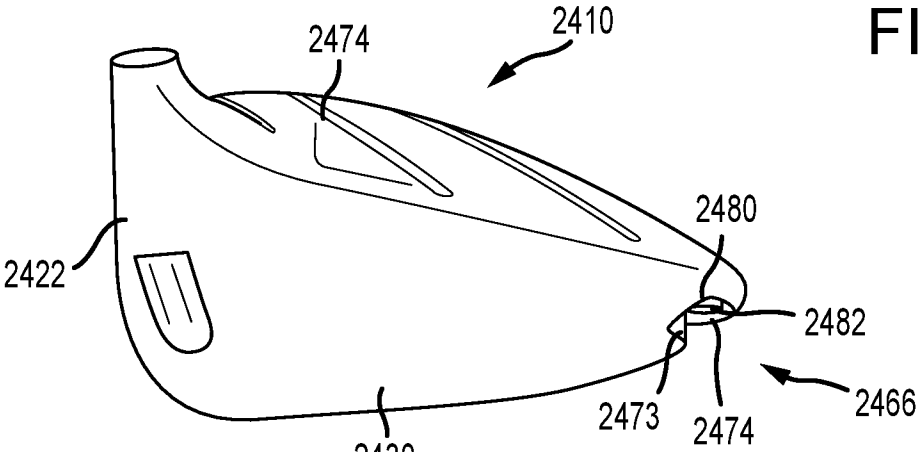

FIGS. 48-50 illustrate a club head 2410 having a club head body 2414. The club head 2410 includes an adjustable weighting system 2466 that is adjustable by an end user to modify the club head 2410 center of gravity and/or moment of inertia and/or heel/toe bias to achieve desired performance characteristics (e.g., forgiveness, spin, trajectory) under various circumstances. The adjustable weighting system 2466 is a low profile system and thereby does not significantly shift or change the club head 2410 MOI when compared to a club head not including the adjustable weighting system 2466. Further, the low profile adjustable weighting system 2466 ensures that shifts in the club head 2410 CG occur mainly in a heel end 2422 to toe end 2418 direction keeping the overall club head 2410 CG in a low and back location.

Referring to FIGS. 48 and 50, the adjustable weighting system 2466 can comprise a channel 2413. The channel 2413 comprises a third surface 2413 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2466 includes a third surface 2413 comprising three discrete attachment locations. The three discrete attachment locations each comprising a feature in the form of a protruding body 2470A, B, C. Further, the protruding bodies, 2470A, B, C can receive one or more weight 2482.

Referring again to FIGS. 48-50, the channel 2413 extends from near the toe end 2418 in an arcuate manner to a point between the toe end 2418 and the heel end 2422. The channel 2413 generally follows the contour of the trailing edge 2472. The channel 2413 is defined by a first surface 2473, a second surface 2474 disposed opposite the first surface 2473, and a third surface 2475 that extends between the first surface 2473 and the second surface 2474. In some embodiments, the first surface 2473 extends parallel to the second surface 2474, and perpendicular to the third surface 2475. The channel 2413 includes a depth measured as the distance between the third surface 2413 and the sole 2430 of the club head 2410 (or the height of the first surface 2473). In the illustrated embodiment, the channel 2413 has a constant depth along its length from the toe end 2418 to a point between the toe and heel end 2418, 2422. In other embodiments, the channel 2413 can have an increasing, decreasing or constant depth along its length from the toe end 2418 to the heel end 2422. Thus, when a weight 2482 is coupled to the club head 2410 in one region of the channel 2413, the weight 2482 may be concealed by the first and/or second surface 2473, 2474. When the weight 2482 is coupled to the club head 2410 in a different region of the channel 2413, a portion of the weight 2482 may protrude outward from the first and/or second surface 2473, 2474.

In many embodiments, the channel 2413 has a shallow depth ensuring the adjustable weight system 2466 remains low profile. For example, in some embodiments, the channel 2413 has a maximum depth of 0.24 inches. In other embodiments, the channel 2413 can have a maximum depth of 1.5, 1.24, 1.0, 0.9, 0.8, 0.7, 0.6, 0.5, 0.4, 0.3, 0.2, or 0.1 inches. In other embodiments, the depth of the channel 2413 can vary within the range of 0.05 to 0.24, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 2413 includes a width measured as the distance between the first surface 2473 and the second surface 2474. In the illustrated embodiments, the channel 2413 includes a constant width. In other embodiments, the channel 2413 can have an increasing, decreasing and/or constant width. In many embodiments, the width can be less than 2.0 inches. For example, in some embodiments, the width can be less than 2.0, 1.75, 1.5, 1.24, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 48-50, the channel 2413 can include one or more protruding bodies 2470 defining a discrete attachment location for securing a weight to the club head 2410. In contrast to other adjustable weighting systems wherein the weight can be coupled at any, or at an infinite, or at an unlimited number of locations across the recessed portion. Referring to FIGS. 48 and 49, in the illustrated embodiment, the channel 2413 includes three protruding bodies 2470A, B, C. The protruding bodies 2470A, B, C, are shown as cylindrical post comprising external threads. In other embodiments, the protruding bodies 2470A, B, C can be an aperture, recess, ports capable of receiving a fastener, notches, tabs, cutout regions, ribs, grooves, pegs, hooks, magnets, programmable magnets or any other suitable attachment means. In other embodiments, the channel 2413 can comprise one, two, three, four, five, six, seven, eight, nine or ten protruding bodies 2470.

As illustrated, the protruding bodies 2470A, B, C are disposed within the channel 2413 along the third surface 2413 such that one or more weights 2482 may be releasable coupled to the club head 2410 along the channel 2413. More specifically, a first protruding body 2470A is positioned at or near the toe end 2418 of the channel 2413, a second protruding body 2470C is positioned at or near the heel end 2422 of the channel 2413, and a third protruding body 2470B is positioned between the toe and heel end 2418, 2422 of the channel 2413. In some embodiments, the protruding bodies 2470A, B, C can be positioned on the first surface 2473 of the channel 2413. In other embodiments, the protruding bodies 2470A, B, C can be positioned on the first surface 2473 and the third surface 2413 of the channel 2413.

With continued reference to FIG. 48-50, the weights 2482 have a generally cylindrical shape correspond with the cylindrical shape of the protruding bodies 2470A, B, C. Further, the internal portion of the weight can include internal threads configured to engage with the external threads on the protruding bodies 2470A, B, C. In other embodiments, the weights 2482 can have a circular, triangular, trapezoidal, polygonal or any other suitable shape configured to fit within the channel 2413. As illustrated in FIG. 50, the weights 2482 each include a tool receiving aperture 2487 that receives a tool to tighten and/or loosen the weights 2482. In the illustrated embodiment tool receiving aperture 2487 has a generally star shape. In some embodiments, the weights 2482 include tool receiving apertures 2487 of different sizes, or include a head portion having an outer shape (e.g., hexagonal) that is configured to engage with a tool to facilitate tightening and/or loosening of the weights 4582 (e.g., with a torque wrench that clicks into place once a weight is secured). In the illustrated embodiment, the adjustable weighting system 2466 comprises two weights 2482. In other embodiments, the adjustable weighting system 2466 can comprise one, three or five weights 2482 corresponding with the number of protruding bodies 2470A, B, C. In other embodiments, the adjustable weighting system 2466 can comprise more or less weights 2482 than the number of protruding bodies 2470A, B, C. For example, the adjustable weighting system 2466 can comprise one, two, three, four, five, six, seven, eight, nine or ten weights 2482.

In embodiments wherein the adjustable weight system 2466 comprises more than one weight 2482, each of the weights 2482 can have the same shape and size. In other embodiments, the weights 2482 can vary in shape and size, resulting in weights 2482 having varying masses. Further, in some embodiments, the weights 2482 are made of different materials such that they vary in mass. For example, one weight 2482 may be made of a high density material, such as tungsten, and the remaining weights 2482 may be made of a less dense material, such as polyurethane or another plastic. In other embodiments, the weights 2482 may have different sizes or volumes such that they vary in mass. For example, one weight 2482 may have a greater volume than the remaining weights 2482. In some embodiments, each of the weights 2482 may vary in volume from one another and thus vary in mass. In some embodiments, the weights 2482 may vary in both volume and material from one another. In some embodiments, one of the structures labeled as 2482 is not a weight, but rather a light-weight (e.g., light-weight plastic) cover that snap-fits or otherwise couples to one of the protruding bodies 2470A, B, C. In some embodiments, the weights 2482 may vary between 0.1-50 g. For example, in embodiments having a plurality of weights 2482, one or more of the weights 82 may vary between 0-10 g, one or more of the weights 2482 may vary between 10-20 g, one or more of the weights 2482 may vary between 20-30, one or more of the weights 2482 may vary between 30-40 g, and one or more of the weights 2482 may vary between 40-50 g. In some embodiments, a first weight 2482 may vary between 0-10 g, a second weight 2482 may vary between 10-20 g, a third weight 2482 may vary between 20-30, a fourth weight 82 may vary between 30-40 g, and a fifth weight 2482 may vary between 40-50 g. In other embodiments, a first weight 2482 may vary between 1-5 g, and a second and third weight 2482 may vary between 5-30 g. In other embodiments, a first and second weight 2482 may vary between 1-10 g, and a third and fourth weight 2482, may vary between 5-24 g. In some embodiments, a first weight 2482 has a mass of 8.5 grams, and a second and third weight 2482 each have a mass of 1.5 grams. In other embodiments, a first weight 2482 has a mass of 12 grams, and a second and third weight 2482 each have a mass of 1.5 grams. In other embodiments, a first weight 2482 has a mass of 8.5 grams, and a second and third weight 2482 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 48-50, in the illustrated embodiment one of the protruding bodies 2470A, B, C receives a weight 2482, while the remaining protruding bodies 2470A, B, C are bare and uncovered, or are covered with another material or structure. In other embodiments, each of the protruding bodies 2470A, B, C receives a weight 2482. In some embodiments, one or more of the protruding bodies 2470A, B, C receives more than one weight 2482. In some embodiments, one or more of the protruding bodies 2470A, B, C does not extend past an outer profile of the club head 2410, such that even if the protruding body 2470A, B, is left bare and uncovered, the protruding body 2470A, B, C, and or channel 2413 will not interfere with or disrupt a golfer's swing.

The weights 2482 may be strategically positioned on the protruding bodies 2470A, B, C to achieve a desired club head 2410 center of gravity position and/or moment of inertia and/or heel/toe bias. For example, in some embodiments, a heavier weight 2482 is positioned on the third protruding body 2470B, located between the toe or toe end 2418 and the heel or heel end 2422, while lighter weights are positioned on the protruding bodies 2470A, B near the toe or toe end 2418 and the heel or heel end 2422. The aforementioned weight 2482 positions results in the center of gravity remaining centered while being shifted towards the back end 2434 of the club head 2410. In some embodiments, a heavier weight 2482 is positioned on the second protruding body 2470B near the heel or heel end 2422, while lighter weights 2482 are positioned on the first protruding body 6270A near the toe or toe end 2418 and on the second protruding body 2470B that is located between the toe or toe end 6318 and the heel or heel end 6322. The aforementioned weight 2482 positions results in the center of gravity being shifted towards the heel end 2422 of the club head 2410. In some embodiments, a heavier weight 2482 is positioned on the first protruding body 2470A near the toe or toe end 2418, while lighter weights 2482 are positioned on the second protruding bodies 6270D near the heel or heel end 2422 and on the third protruding body 2470C that is located between the toe or toe end 2418 and the heel or heel end 2422. The aforementioned weight 2482 positions results in the center of gravity being shifted towards the toe end 2418 of the club head 2410. In many embodiments, one or more of the protruding bodies 2470A, B, C are of equal size and shape, such that one weight may be interchangeably used with each of the protruding bodies 2470A, B, C. In some embodiments, one or more of the protruding bodies 2470A, B, C can have a differing size and shape, such that each protruding body 2470A, B, C has its own corresponding weight 2482 or set of weights 2482.

The adjustable weighting system 2466 of golf club head 2466 maintains or prevents a significant reduction in club head moment of inertia, and low and back club head center of gravity positioning, compared to a club head devoid of an adjustable weighting system. The adjustable weighting system 2466 of golf club head 2466 maintains a high club head moment of inertia and a low and back club head CG position due to the low profile of the weighting system and the perimeter positioning of the one or more weights. The club head 2466 having the adjustable weighting system 2466 can have similar or identical parameters and measurements as club head 100 described above.

Figure 51:
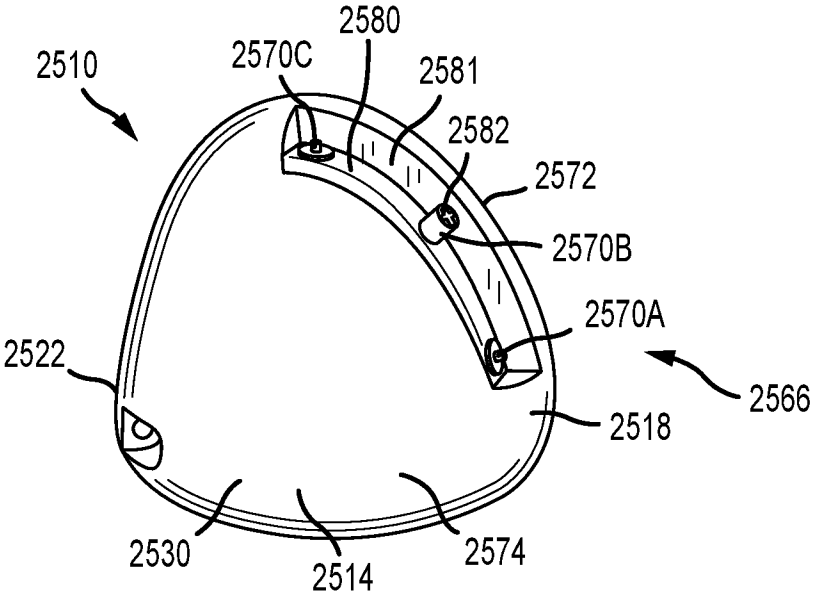
FIGS. 51 and 52 are perspective views of a golf club head according to another embodiment.
Figure 52:
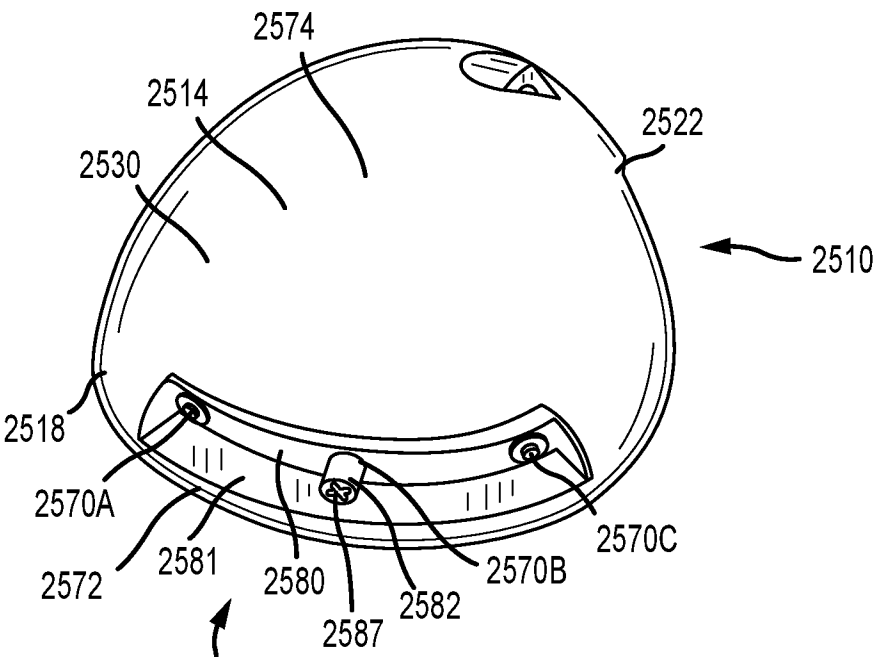

FIGS. 51-52 illustrate a club head 2510 having a club head body 2514. The club head 2510 includes an adjustable weighting system 2566 that is adjustable by an end user to modify the club head 2510 center of gravity and/or moment of inertia and/or heel/toe bias to achieve desired performance characteristics (e.g., forgiveness, spin, trajectory) under various circumstances. The adjustable weighting system 2566 is a low profile system and thereby does not significantly shift or change the club head 2510 MOI when compared to a club head not including the adjustable weighting system 2566. Further, the low profile adjustable weighting system 2566 ensures that shifts in the club head 2510 CG occur mainly in a heel end 2522 to toe end 2518 direction keeping the overall club head 2510 CG in a low and back location.

Referring to FIGS. 51 and 52, the adjustable weighting system 2566 can comprise a recessed portion 2580. The recessed portion 2580 comprises a recessed surface 2581 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2566 includes a recessed surface 2581 comprising three discrete attachment locations. The three discrete attachment locations each comprising a feature in the form of a protruding bodies 2570A, B, C. Further, the protruding bodies 2570A, B, C can be configured to receive a weight 2582.

Referring again to FIGS. 51-52, the recessed portion 2580 extends from near the toe end 2518 in an arcuate manner to a point between the toe end 2518 and the heel end 2522. The recessed portion generally follows the contour of the trailing edge 2572. The recessed portion 2580 is defined by a recessed surface 2581 being offset from the sole 2520 of the club head 2510 by a wall 2583. Generally, the recessed surface 2581 extends substantially parallel to the sole 2530 of the club head 2510 while the wall 2583 generally extends substantially perpendicular to the recessed surface 2581. In other embodiments, the wall 2583 can extend at an angle between the recessed surface 2581 and the sole 2530. The recessed portion 2581 includes a depth measured as the distance between the recessed surface 2581 and the sole 2530 of the club head 2510 (or the height of the wall 2583). In the illustrated embodiment, the recessed portion 2580 has a constant depth along its length from the toe end 2518 to the heel end 2522. In other embodiments, the recessed portion 2580 can have an increasing, decreasing or constant depth along its length from the toe end 2518 to the heel end 2522. Thus, when a weight 2582 is coupled to the club head 2510 in one region of the recessed portion 2580, the weight 2582 may be concealed by the wall 2583. When the weight 2582 is coupled to the club head 2510 in a different region of the recessed portion 2580, a portion of the weight 2582 may protrude outward from the wall 2583.

In many embodiments, the channel 2513 has a shallow depth ensuring the adjustable weight system 2566 remains low profile. For example, in some embodiments, the recessed portion 2580 has a maximum depth of 0.25 inches. In other embodiments, the recessed portion 2580 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 2580 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 2580 includes a width measured as the distance between the wall 2583 and the trailing edge 2572 or back end 2534. In the illustrated embodiments, the recessed portion 2580 includes a constant width. In other embodiments, the recessed portion 2580 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 51-52, the recessed portion 2580 can include one or more protruding bodies 2570 defining a discrete attachment location for securing a weight to the club head 2510. In contrast to other adjustable weighting systems wherein the weight can be coupled at any, or at an infinite, or at an unlimited number of locations across the recessed portion. Referring to FIGS. 48 and 49, in the illustrated embodiment, the recessed portion 2580 includes three protruding bodies 2570A, B, C. The protruding bodies 2570A, B, C, are shown as cylindrical post comprising external threads. In other embodiments, the protruding bodies 2570A, B, C can be an aperture, recess, ports capable of receiving a fastener, notches, tabs, cutout regions, ribs, grooves, pegs, hooks, magnets, programmable magnets or any other suitable attachment means. In other embodiments, the recessed portion 2580 can comprise one, two, three, four, five, six, seven, eight, nine or ten protruding bodies 2570.

As illustrated, the protruding bodies 2570A, B, C are disposed within the recessed portion 2580 along the recessed surface 2581 such that one or more weights 2582 may be releasable coupled to the club head 2510 along the recessed portion 2580. More specifically, a first protruding body 2570A is positioned at or near the toe end 2518 of the recessed portion 2580, a second protruding body 2570C is positioned at or near the heel end 2522 of the recessed portion 2580, and a third protruding body 2570B is positioned between the toe and heel end 2518, 2522 of the recessed portion 2580. In some embodiments, the protruding bodies 2570A, B, C can be positioned on the wall 2583 of the recessed portion 2580. In other embodiments, the protruding bodies 2570A, B, C can be positioned on the wall 2583 and the recessed surface 2581 of the recessed portion 2580.

With continued reference to FIGS. 51-52, the weights 2582 have a generally cylindrical shape correspond with the cylindrical shape of the protruding bodies 2570A, B, C. Further, the internal portion of the weight can include internal threads configured to engage with the external threads on the protruding bodies 2570A, B, C. In other embodiments, the weights 2582 can have a circular, triangular, trapezoidal, polygonal or any other suitable shape configured to fit within the recessed portion 2580. As illustrated in FIG. 52, the weights 2582 each include a tool receiving aperture 2587 that receives a tool to tighten and/or loosen the weights 2582. In the illustrated embodiment tool receiving aperture 2587 has a generally star shape. In some embodiments, the weights 2582 include tool receiving apertures 2587 of different sizes, or include a head portion having an outer shape (e.g., hexagonal) that is configured to engage with a tool to facilitate tightening and/or loosening of the weights 2582 (e.g., with a torque wrench that clicks into place once a weight is secured).

In the illustrated embodiment, the adjustable weighting system 2566 comprises two weights 2582. In other embodiments, the adjustable weighting system 2566 can comprise one, three or five weights 2582 corresponding with the number of protruding bodies 2570A, B, C. In other embodiments, the adjustable weighting system 2566 can comprise more or less weights 2582 than the number of protruding bodies 2570A, B, C. For example, the adjustable weighting system 2566 can comprise one, two, three, four, five, six, seven, eight, nine of ten weights 2582.

In embodiments wherein the adjustable weight system 2566 comprises more than one weight 2582, each of the weights 2582 can have the same shape and size. In other embodiments, the weights 2582 can vary in shape and size, resulting in weights 2582 having varying masses. Further, in some embodiments, the weights 2582 are made of different materials such that they vary in mass. For example, one weight 2582 may be made of a high density material, such as tungsten, and the remaining weights 2582 may be made of a less dense material, such as polyurethane or another plastic. In other embodiments, the weights 2582 may have different sizes or volumes such that they vary in mass. For example, one weight 2582 may have a greater volume than the remaining weights 2582. In some embodiments, each of the weights 2582 may vary in volume from one another and thus vary in mass. In some embodiments, the weights 2582 may vary in both volume and material from one another. In some embodiments, one of the structures labeled as 2582 is not a weight, but rather a light-weight (e.g., light-weight plastic) cover that snap-fits or otherwise couples to one of the protruding bodies 2570A, B, C. In some embodiments, the weights 2582 may vary between 0.1-50 g. For example, in embodiments having a plurality of weights 2582, one or more of the weights 82 may vary between 0-10 g, one or more of the weights 2582 may vary between 10-20 g, one or more of the weights 2582 may vary between 20-30, one or more of the weights 2582 may vary between 30-40 g, and one or more of the weights 2582 may vary between 40-50 g. In some embodiments, a first weight 2582 may vary between 0-10 g, a second weight 2582 may vary between 10-20 g, a third weight 2582 may vary between 20-30, a fourth weight 82 may vary between 30-40 g, and a fifth weight 2582 may vary between 40-50 g. In other embodiments, a first weight 2582 may vary between 1-5 g, and a second and third weight 2582 may vary between 5-30 g. In other embodiments, a first and second weight 2582 may vary between 1-10 g, and a third and fourth weight 2582, may vary between 5-25 g. In some embodiments, a first weight 2582 has a mass of 8.5 grams, and a second and third weight 2582 each have a mass of 1.5 grams. In other embodiments, a first weight 2582 has a mass of 12 grams, and a second and third weight 2582 each have a mass of 1.5 grams. In other embodiments, a first weight 2582 has a mass of 8.5 grams, and a second and third weight 2582 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 51-52, in the illustrated embodiment one of the protruding bodies 2570A, B, C receives a weight 2582, while the remaining protruding bodies 2570A, B, C are bare and uncovered, or are covered with another material or structure. In other embodiments, each of the protruding bodies 2570A, B, C receives a weight 2582. In some embodiments, one or more of the protruding bodies 2570A, B, C receives more than one weight 2582. In some embodiments, one or more of the protruding bodies 2570A, B, C does not extend past an outer profile of the club head 2510, such that even if the protruding body 2570A, B, is left bare and uncovered, the protruding body 2570A, B, C, and or recessed portion 2580 will not interfere with or disrupt a golfer's swing.

The weights 2582 may be strategically positioned on the protruding bodies 2570A, B, C to achieve a desired club head 2510 center of gravity position and/or moment of inertia and/or heel/toe bias. For example, in some embodiments, a heavier weight 2582 is positioned on the third protruding body 2570B, located between the toe or toe end 2518 and the heel or heel end 2522, while lighter weights are positioned on the protruding bodies 2570A, B near the toe or toe end 2518 and the heel or heel end 2522. The aforementioned weight 2582 positions results in the center of gravity remaining centered while being shifted towards the back end 2534 of the club head 2510. In some embodiments, a heavier weight 2582 is positioned on the second protruding body 2570B near the heel or heel end 2522, while lighter weights 2582 are positioned on the first protruding body 6270A near the toe or toe end 2518 and on the second protruding body 2570B that is located between the toe or toe end 6318 and the heel or heel end 6322. The aforementioned weight 2582 positions results in the center of gravity being shifted towards the heel end 2522 of the club head 2510. In some embodiments, a heavier weight 2582 is positioned on the first protruding body 2570A near the toe or toe end 2518, while lighter weights 2582 are positioned on the second protruding bodies 6270D near the heel or heel end 2522 and on the third protruding body 2570C that is located between the toe or toe end 2518 and the heel or heel end 2522. The aforementioned weight 2582 positions results in the center of gravity being shifted towards the toe end 2518 of the club head 2510. In many embodiments, one or more of the protruding bodies 2570A, B, C are of equal size and shape, such that one weight may be interchangeably used with each of the protruding bodies 2570A, B, C. In some embodiments, one or more of the protruding bodies 2570A, B, C can have a differing size and shape, such that each protruding body 2570A, B, C has its own corresponding weight 2582 or set of weights 2582.

The adjustable weighting system 2566 of golf club head 2566 maintains or prevents a significant reduction in club head moment of inertia, and low and back club head center of gravity positioning, compared to a club head devoid of an adjustable weighting system. The adjustable weighting system 2566 of golf club head 2566 maintains a high club head moment of inertia and a low and back club head CG position due to the low profile of the weighting system and the perimeter positioning of the one or more weights. The club head 2566 having the adjustable weighting system 2566 can have similar or identical parameters and measurements as club head 100 described above.

Figure 53:
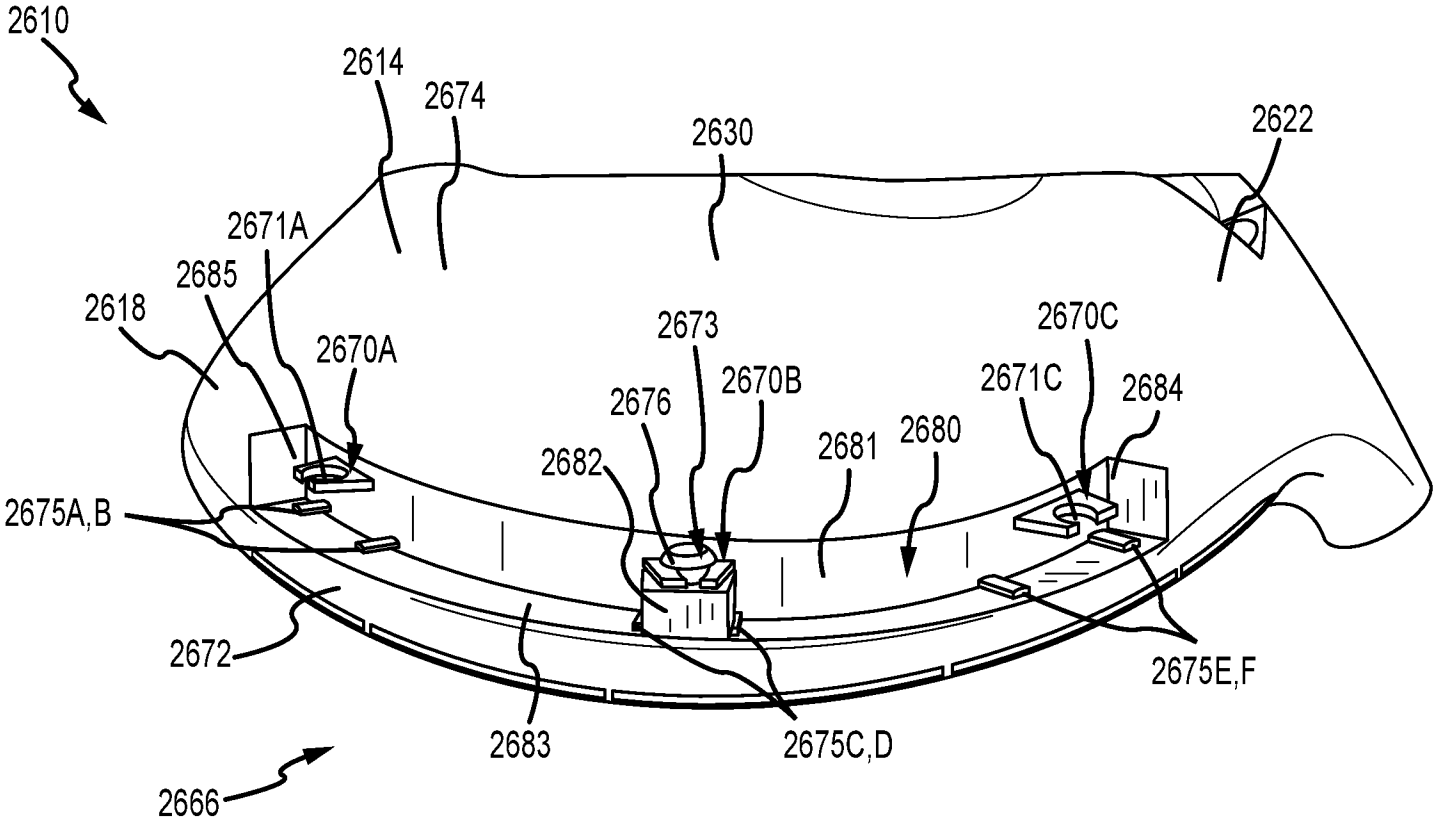
FIGS. 53 and 54 are perspective view of a golf club head according to another embodiment.
Figure 54:
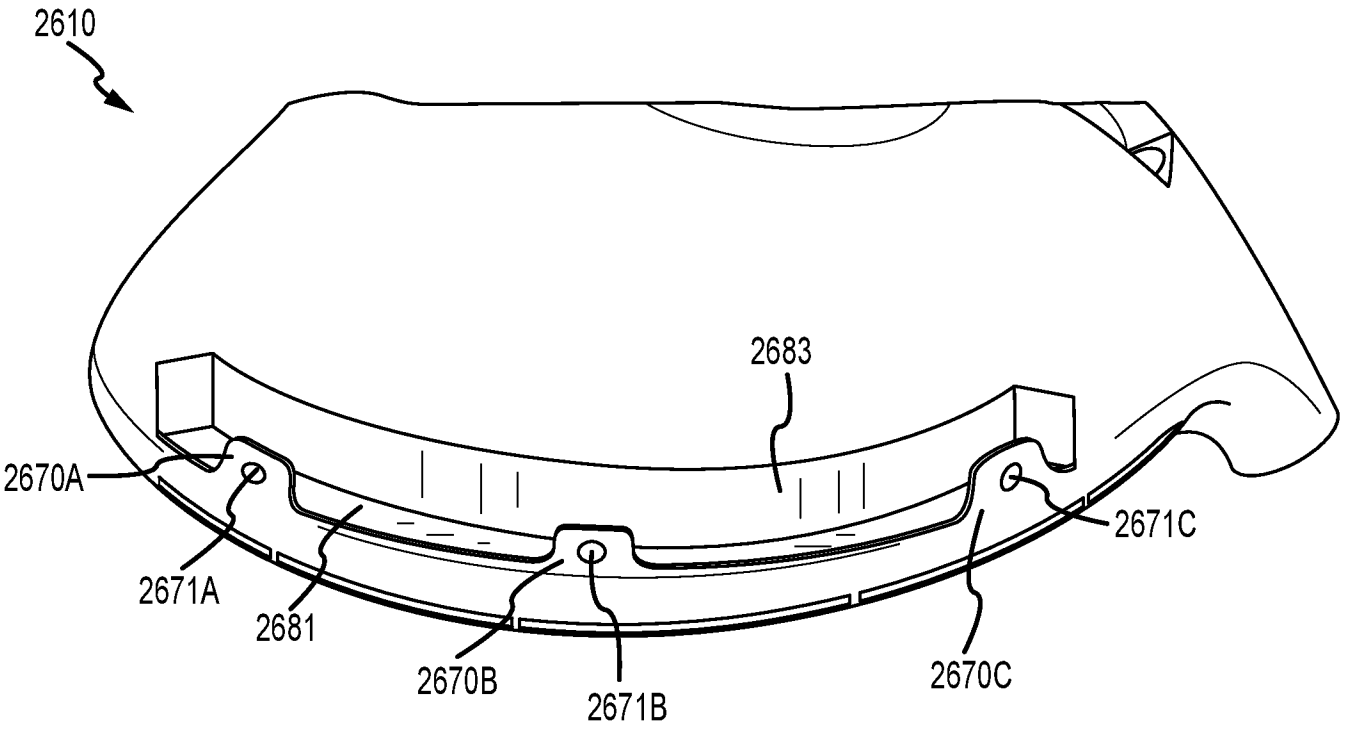

FIGS. 53 and 54 illustrate a club head 2610 having a club head body 2614. The club head 2610 includes an adjustable weighting system 2666 that is adjustable by an end user to modify the club head 2610 center of gravity and/or moment of inertia and/or heel/toe bias to achieve desired performance characteristics (e.g., forgiveness, spin, trajectory) under various circumstances. The adjustable weighting system 2666 is a low profile system and thereby does not significantly shift or change the club head 2610 MOI when compared to a club head not including the adjustable weighting system 2666. Further, the low profile adjustable weighting system 2666 ensures that shifts in the club head 2610 CG occur mainly in a heel end 2622 to toe end 2618 direction keeping the overall club head 2610 CG in a low and back location.

Referring to FIG. 53, the adjustable weighting system 2666 can comprise a recessed portion 2680. The recessed portion 2680 comprises a recessed surface 2681 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2666 includes a recessed portion 2680 comprising three discrete attachment locations. The three discrete attachment locations each having a 3 features in the form of one protruding body 2670 A, B, C and two protruding ribs 2675A, B, C, D, E, F.

Referring again to FIG. 53, the recessed portion 2680 extends from a first end 2685 near the toe end 2618 of the golf club head 2610 in an arcuate manner to a second end 2684 near the heel end 2622 of the club head 2610. Generally, the recessed portion 2680 follows the contour of the trailing edge 2672. The recessed portion 2680 is defined by a recessed surface 2681 being offset from the sole 2620 of the club head 2610 by a wall 2683. Generally, the recessed surface 2681 extends substantially parallel to the sole 2630 of the club head 2610 while the wall 2683 generally extends substantially perpendicular to the recessed surface 2681. In other embodiments, the wall 2683 can extend at an angle between the recessed surface 2681 and the sole 2630. The recessed portion 2681 includes a depth measured as the distance between the recessed surface 2681 and the sole 2630 of the club head 2610 (or the height of the wall 2683). In the illustrated embodiment, the recessed portion 2680 has a constant depth along its length from the toe end 2618 to the heel end 2622. In other embodiments, the recessed portion 2680 can have an increasing, decreasing or constant depth along its length from the toe end 2618 to the heel end 2622. Thus, when a weight 2682 is coupled to the club head 2610 in one region of the recessed portion 2680, the weight 2682 may be concealed by the wall 2683. When the weight 2682 is coupled to the club head 2610 in a different region of the recessed portion 2680, a portion of the weight 2682 may protrude outward from the wall 2683.

In many embodiments, the recessed portion 2680 has a shallow depth ensuring the adjustable weight system 2666 remains low profile. For example, in some embodiments, the recessed portion 2680 has a maximum depth of 26 inches. In other embodiments, the recessed portion 2680 can have a maximum depth of 1.5, 1.26, 1.0, 0.9, 0.8, 0.7, 0.6, 0.5, 0.4, 0.3, 0.2, or 0.1 inches. In other embodiments, the depth of the recessed portion 2680 can vary within the range of 0.05 to 0.26, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 2680 includes a width measured as the distance between the wall 2683 and the trailing edge 2672 or back end 2634. In the illustrated embodiments, the recessed portion 2680 includes a constant width. In other embodiments, the recessed portion 2680 can have an increasing, decreasing and/or constant width. In many embodiments, the width can be less than 2.0 inches. For example, in some embodiments, the width can be less than 2.0, 1.75, 1.5, 1.26, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

With reference to FIG. 53, the protruding bodies 2670 A, B, C may be of any shapes and any configurations such that one or more weights may be coupled to the protruding bodies 2670 A, B, C (as opposed to being coupled to ports where the ports are holes or cavities within the body of the club that include for example internal threads to couple to external threads on the weights). In the illustrated embodiment, the protruding bodies 2670 A, B, C are protruding ribs, each having an aperture 2671. In other embodiments, the protruding bodies 2670 A, B, C have other shapes (e.g., with circular cross-sections, triangular cross-sections, or any other shapes). A second one of the protruding bodies 2670C is located generally at a heel or heel end 2622 of the club head 2610, a first one of the protruding bodies 2670A is located generally at a toe or toe end 2618 of the club head 2610, and a third body 2670B is located generally between the heel or heel end 2622 and the toe or toe end 2618. In other embodiments more or less than three protruding bodies 2670 are provided, for example at locations different than that illustrated. For example, in some embodiments five protruding bodies 2670 are provided, with one of the protruding bodies 2670 being located generally at the heel or heel end 2622, one of the protruding bodies 2670 being located at the toe or toe end 2618, and the other three protruding bodies 2670 being located between the heel or heel end 2622 and the toe or toe end 2618.

As illustrated in FIG. 53, the adjustable weighting system 2666 includes six additional protruding ribs 2675A, B, C, D, E, F, although other embodiments include different numbers of additional protruding ribs 2675. As illustrated in FIG. 53, each of the three protruding bodies 2670A, B, C are positioned adjacent (and generally opposite to) two of the additional protruding ribs 2675A, B, C, D, E, F. Thus, a first two of the additional protruding ribs 2675A, C are located generally at the toe end 2618 of the club head 2610, a third two of the additional protruding ribs 2675E, F are located generally at the heel 2622 of the club head 2610, and a second two of the additional protruding ribs 2675C, D are located generally between the heel or heel end 2622 and the toe or toe end 2618. Each of the protruding bodies 2670A, B, C in combination with a pair of protruding ribs 2675A, B, C, D, E, F defining a discrete attachment location for securing a weight to the club head 2610. In contrast to other adjustable weighting systems wherein the weight can be coupled at any, or at an infinite, or at an unlimited number of locations across the recessed portion.

The protruding bodies 2670A, B, C and the protruding ribs 2675A, B, C, D, E, F are configured to receive weights 2682, and to hold the weights 2682. For example, to attach a weight 2682 to the club head 2610, the weight 2682 is moved (e.g., slid) into an area between two of the protruding ribs 2675A, B, C, D, E, F, such that the protruding ribs 2675A, B, C, D, E, F act as guides located on opposite sides of the weight 2682, and such that the weight 2682 is positioned adjacent to or in contact with the protruding body 2670A, B, C and its corresponding aperture 2671A, B, C. The weight 2682 includes a set of internal threads (e.g., in a blind borehole in the weight 2682). To secure the weight 2682 in place, a fastener 2673 is inserted through the aperture 2671 and into engagement with the internal threads of the weight 2682. The fastener 2673 includes a head 2676 that is larger than the aperture 2671, such that when the fastener 2673 is tightened, the head 2676 presses against the protruding body 2670A, B, C, and the weight 2682 is pressed against the outer surface 2674, thereby holding the weight 2682 within the recessed portion 2680. The additional protruding ribs 2675A, B, C, D, E, F prevent the weight 2682 from rotating within the recessed portion 2680 after the fastener 2673 has been inserted into the weight 2682. In some embodiments, the fastener 2673 includes a receiving geometry (e.g., a slot or opening on the head 2676), and the receiving geometry mates with a fastening tool (e.g., torque wrench) to tighten or loosen the fastener 2673. It should be noted that the fastener 2673 is comprised of a density that is less than or equal to the density of the club head 2610.

In some embodiments, one or more of the protruding bodies 2670A, B, C and the additional protruding ribs 2675A, B, C, D, E, F are disposed on other surfaces in the recessed portion 2680. For example, as illustrated schematically in FIG. 54, in some embodiments, the recessed portion 2680 can further include three more protruding bodies 2670D, E, F extending from the rear surface 2681. As illustrated, each of the protruding bodies 2679D, E, F extend perpendicular to the rear surface 2681 and are positioned adjacent to the protruding bodies 2670A, B, C and/or the protruding ribs 2675A, B, C, D, E, F. The additional protruding bodies 2670D, E, F can further support the weight 2682 from shifting along the X-axis 62 (FIG. 2). In some embodiments, the additional protruding bodies 2670D, E, F can further comprise apertures 2671D, E, F similar to the apertures 2671A, B, C.

The weight 2682 may be any shape such as a cube, or any variation thereof. In some embodiments, the weight 2682 is made at least partially of steel, tungsten, aluminum, titanium, vanadium, chromium, cobalt, nickel, other metals, metal alloys, or any combination thereof. In some embodiments, only a portion of the weight 2682 is positioned within the recessed portion 2682 when the weight 2682 is coupled to the club head 2610.

Further, in some embodiments, the weights 2682 are made of different materials such that they vary in mass. For example, one weight 2682 may be made of a high density material, such as tungsten, and the remaining weights 2682 may be made of a less dense material, such as polyurethane or another plastic. In other embodiments, the weights 2682 may have different sizes or volumes such that they vary in mass. For example, one weight 2682 may have a greater volume than the remaining weights 2682. In some embodiments, each of the weights 2682 may vary in volume from one another and thus vary in mass. In some embodiments, the weights 2682 may vary in both volume and material from one another. In some embodiments, one of the structures labeled as 2682 is not a weight, but rather a light-weight (e.g., light-weight plastic) cover that snap-fits or otherwise couples to one of the protruding bodies 2670A, B, C. In some embodiments, the weights 2682 may vary between 0.1-50 g.

For example, in embodiments having a plurality of weights 2682, one or more of the weights 82 may vary between 0-10 g, one or more of the weights 2682 may vary between 10-20 g, one or more of the weights 2682 may vary between 20-30, one or more of the weights 2682 may vary between 30-40 g, and one or more of the weights 2682 may vary between 40-50 g. In some embodiments, a first weight 2682 may vary between 0-10 g, a second weight 2682 may vary between 10-20 g, a third weight 2682 may vary between 20-30, a fourth weight 82 may vary between 30-40 g, and a fifth weight 2682 may vary between 40-50 g. In other embodiments, a first weight 2682 may vary between 1-5 g, and a second and third weight 2682 may vary between 5-30 g. In other embodiments, a first and second weight 2682 may vary between 1-10 g, and a third and fourth weight 2682, may vary between 5-26 g. In some embodiments, a first weight 2682 has a mass of 8.5 grams, and a second and third weight 2682 each have a mass of 1.5 grams. In other embodiments, a first weight 2682 has a mass of 12 grams, and a second and third weight 2682 each have a mass of 1.5 grams. In other embodiments, a first weight 2682 has a mass of 8.5 grams, and a second and third weight 2682 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The weights 2682 may be strategically positioned on the protruding bodies 2670A, B, C to achieve a desired club head 2610 center of gravity position and/or moment of inertia and/or heel/toe bias. For example, in some embodiments, a heavier weight 2682 is positioned on the third protruding body 2670B, located between the toe or toe end 2618 and the heel or heel end 2622, while lighter weights are positioned on the protruding bodies 2670A, B near the toe or toe end 2618 and the heel or heel end 2622. The aforementioned weight 2682 positions results in the center of gravity remaining centered while being shifted towards the back end 2634 of the club head 2610. In some embodiments, a heavier weight 2682 is positioned on the second protruding body 2670B near the heel or heel end 2622, while lighter weights 2682 are positioned on the first protruding body 6270A near the toe or toe end 2618 and on the second protruding body 2670B that is located between the toe or toe end 6318 and the heel or heel end 6322. The aforementioned weight 2682 positions results in the center of gravity being shifted towards the heel end 2622 of the club head 2610. In some embodiments, a heavier weight 2682 is positioned on the first protruding body 2670A near the toe or toe end 2618, while lighter weights 2682 are positioned on the second protruding bodies 6270C near the heel or heel end 2622 and on the third protruding body 2670B that is located between the toe or toe end 2618 and the heel or heel end 2622. The aforementioned weight 2682 positions results in the center of gravity being shifted towards the toe end 2618 of the club head 2610. In many embodiments, one or more of the protruding bodies 2670A, B, C are of equal size and shape, such that one weight may be interchangeably used with each of the protruding bodies 2670A, B, C. In some embodiments, one or more of the protruding bodies 2670A, B, C can have a differing size and shape, such that each protruding body 2670A, B, C has its own corresponding weight 2682 or set of weights 2682.

The adjustable weighting system 2666 of golf club head 2666 maintains or prevents a significant reduction in club head moment of inertia, and low and back club head center of gravity positioning, compared to a club head devoid of an adjustable weighting system. The adjustable weighting system 2666 of golf club head 2666 maintains a high club head moment of inertia and a low and back club head CG position due to the low profile of the weighting system and the perimeter positioning of the one or more weights. The club head 2666 having the adjustable weighting system 2666 can have similar or identical parameters and measurements as club head 100 described above.

FIGS. 55-58 illustrate a club head 2710 (and a variation thereof in FIG. 160A) having a club head body 2714. The club head 2710 includes an adjustable weighting system 2766 that is adjustable by an end user to modify the club head 2710 center of gravity and/or moment of inertia and/or heel/toe bias to achieve desired performance characteristics (e.g., forgiveness, spin, trajectory) under various circumstances. The adjustable weighting system 2766 is a low profile system and thereby does not significantly shift or change the club head 2710 MOI when compared to a club head not including the adjustable weighting system 2766. Further, the low profile adjustable weighting system 2766 ensures that shifts in the club head 2710 CG occur mainly in a heel end 2722 to toe end 2718 direction keeping the overall club head 2710 CG in a low and back location.

Referring to FIGS. 55-58, the adjustable weighting system 2766 can comprise a recessed portion 2780. The recessed portion 2780 comprises a recessed surface 2781 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 2766 includes a recessed surface 2781 comprising three discrete attachment locations. The three discrete attachment locations include 3 features in the form of protruding bodies 2770A, B, C.

Referring again to FIGS. 55-58, the recessed portion 2780 extends from a first end 2785 near the toe end 518 of the golf club head 2710 in an arcuate manner to a second end 2784 near the heel end 2722 of the club head 2710. Generally, the recessed portion 2780 follows the contour of the trailing edge 2772. The recessed portion 2780 is defined by a recessed surface 2781 being offset from the sole 2720 of the club head 2710 by a wall 2783. Generally, the recessed surface 2781 extends substantially parallel to the sole 2730 of the club head 2710 while the wall 2783 generally extends substantially perpendicular to the recessed surface 2781. In other embodiments, the wall 2783 can extend at an angle between the recessed surface 2781 and the sole 2730. The recessed portion 2781 includes a depth measured as the distance from the recessed surface 2781 to the sole 2730 in a direction perpendicular to the recessed surface 2781 (or the height of the wall 2783). In the illustrated embodiment, the recessed portion 2780 has a constant depth. In other embodiments, the recessed portion 2780 can have an increasing, decreasing and/or constant depth along its length from the toe end 2718 to the heel end 2722. Thus, in these or other embodiments, when a weight 2782 is coupled to the club head 2710 in one region of the recessed portion 2780, the weight 2782 may be concealed by the wall 2783. When the weight 2782 is coupled to the club head 2710 in a different region of the recessed portion 2780, a portion of the weight 2782 may protrude outward from the wall 2783.

In many embodiments, the recessed portion 2780 has a shallow depth ensuring the adjustable weight system 2766 remains low profile. For example, in some embodiments, the recessed portion 2780 has a maximum depth of 0.25 inches. In other embodiments, the recessed portion 2780 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 2780 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 2780 includes a width measured as the distance between the wall 2783 and the trailing edge 2772 or back end 2734. In the illustrated embodiments, the recessed portion 2780 includes a constant width. In other embodiments, the recessed portion 2780 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 55-58, the recessed portion 2780 can include one or more protruding bodies 2770A, B, C each defining a discrete attachment location for securing a weight 2782 to the club head 2710. In contrast to other adjustable weighting systems, wherein the weight can be coupled at any or at an infinite or at an unlimited number of locations across the recessed portion. Referring to FIGS. 55-58, in the illustrated embodiments, the recessed portion 2780 includes three protruding bodies 2770A, B, C. The protruding bodies 2770 may be of any shapes and any configurations such that one or more weights may be coupled to the protruding bodies 2770 (as opposed to being coupled to ports where the ports are holes or cavities within the body of the club that include for example internal threads to couple to external threads on the weights). In the illustrated embodiment, the protruding bodies 2770A, B, C are protruding ribs, each having a slot 2771A, B, C. In the illustrated embodiment, the slot 2771A, B, C extends inward from the top surface of the protruding body 2770 having a varying width. In other embodiments, the slot 2771A, B, C can comprise internal threads configured to receive a threaded fastener (not show). In other embodiments, the slot 2771A, B, C can be a smooth surface configured to have a threaded fastener fed through the slot 2771A, B, C to be received in a weight 27821*n* other embodiments, the protruding bodies 2770A, B, C can be a protruding body, aperture, recess, ports capable of receiving a fastener, notches, tabs, cutout regions, ribs, grooves, pegs, hooks, magnets, programmable magnets or any other suitable attachment means. In other embodiments, the recessed portion 2780 can comprise one, two, three, four, five, six, seven, eight, nine or ten protruding bodies 2770. Further, the protruding bodies 2770 can have any shape. For example, the protruding bodies 2770 can be cylindrical, triangular, rectangular, ovular, trapezoidal, polygonal or any other suitable shape.

As illustrated, the protruding bodies 2770A, B, C, D, E are disposed within the recessed portion 2780 along the recessed surface 2781 such that one or more weights 2782 may be releasable coupled to the club head 2710 along the recessed portion 2780. More specifically, a first protruding body 2770A is positioned near the first end 2785 or the toe end 2718, a second protruding body 2770C is positioned near the second end 2784 or the heel end 2722, a third protruding body 2770B is positioned between the first and second end 2785, 2784 or between the toe and heel end 2718, 2722. The protruding bodies 2770A, B, C extend from the recessed surface 2781 at or near the trailing edge 2772, such that there is a gap between the protruding body 2770A, B, C, and the wall 2783 configured to receive a weight 2782. Each of the protruding bodies 2770A, B, C defining a discrete attachment location for securing a weight to the club head 2710. In contrast to other adjustable weighting systems wherein the weight can be coupled at any, or at an infinite, or at an unlimited number of locations across the recessed portion. In other embodiments, the protruding bodies 2770A, B, C, D, E can be positioned on the wall 2783 of the recessed portion 2780. In other embodiments, the protruding bodies 2770A, B, C can be positioned on the wall 2783 and the recessed surface 2781 of the recessed portion 2780.

With continued reference to FIGS. 55-58, the weights 2782 have a generally rectangular shape corresponding with the shape of the gap between the protruding bodies 2770A, B, C and the wall 2783. In other embodiments, the weights 2782 can have a circular, triangular, trapezoidal, polygonal or any other suitable shape configured to fit within the recessed portion 2780. In the illustrated embodiment, the adjustable weighting system 2766 comprises one weight 2782. In other embodiments, the adjustable weighting system 2766 can comprise three or five weights 2782 corresponding with the number of protruding bodies 2770A, B, C, D, E. In other embodiments, the adjustable weighting system 2766 can comprise more or less weights 2782 than the number of protruding bodies 2770A, B, C,D, E. For example, the adjustable weighting system 2766 can comprise one, two, three, four, five, six, seven, eight, nine or ten weights 2782. In some embodiments, In the illustrated embodiment, the weight 2782 comprises a protrusion 2775 configured to slide into a corresponding slot 2771A, B, C. In some embodiments, the weight 2782 and protrusion 2775 are sized and shaped to frictionally engage a portion of the wall 2783 and/or a portion of the protruding body 2770A, B,C and corresponding slot 2771A, B, C. In some embodiments the weight 2782 and protrusion 2775 snaps into the slot 2771A, B, C. For example, in some embodiments the slot 2771A, B, C has varying widths, such that the protrusion 2775 of the weight 2782 initially presses apart material on either side of the slot 2771A, B, C as the protrusion 2775 slides down the slot 2771A, B, C, until the slot 2771A, B, C widens. The material then returns to secure the weight 2782 and the protrusion 2775. In other embodiments, the weights 2782 can comprise apertures extending entirely through the weight 2782 sized and configured to receive a threaded fastener (not shown). The apertures can be positioned on the weight 2782 such that they align with the slots 2771A, B, C of the protruding bodies 2770A, B, C. The screw fastener can be thread through the slot 2771A, B, C and be received or engage the aperture on the corresponding weight 2782, thus securing the weight 2782 to the recessed portion 2780. In other embodiments, the weight 2782 is sized and shaped to frictionally engage a portion of the wall 2783 and/or a portion of the protruding body 2770A, B, C. In some embodiments the weight 2782 snaps into the slot 2771A, B, C. For example, in some embodiments, the weight 2782 can comprise a protrusion instead of an aperture configured to be received within the slot 2771. In some embodiments, the slot 2771A, B, C has varying widths, such that the protrusion initially presses apart material on either side of the slot 2771A, B, C as the protrusion 2775 slides down the slot 2771, until the slot 2771 widens. The material then returns to secure the weight 2782.

Figure 55:
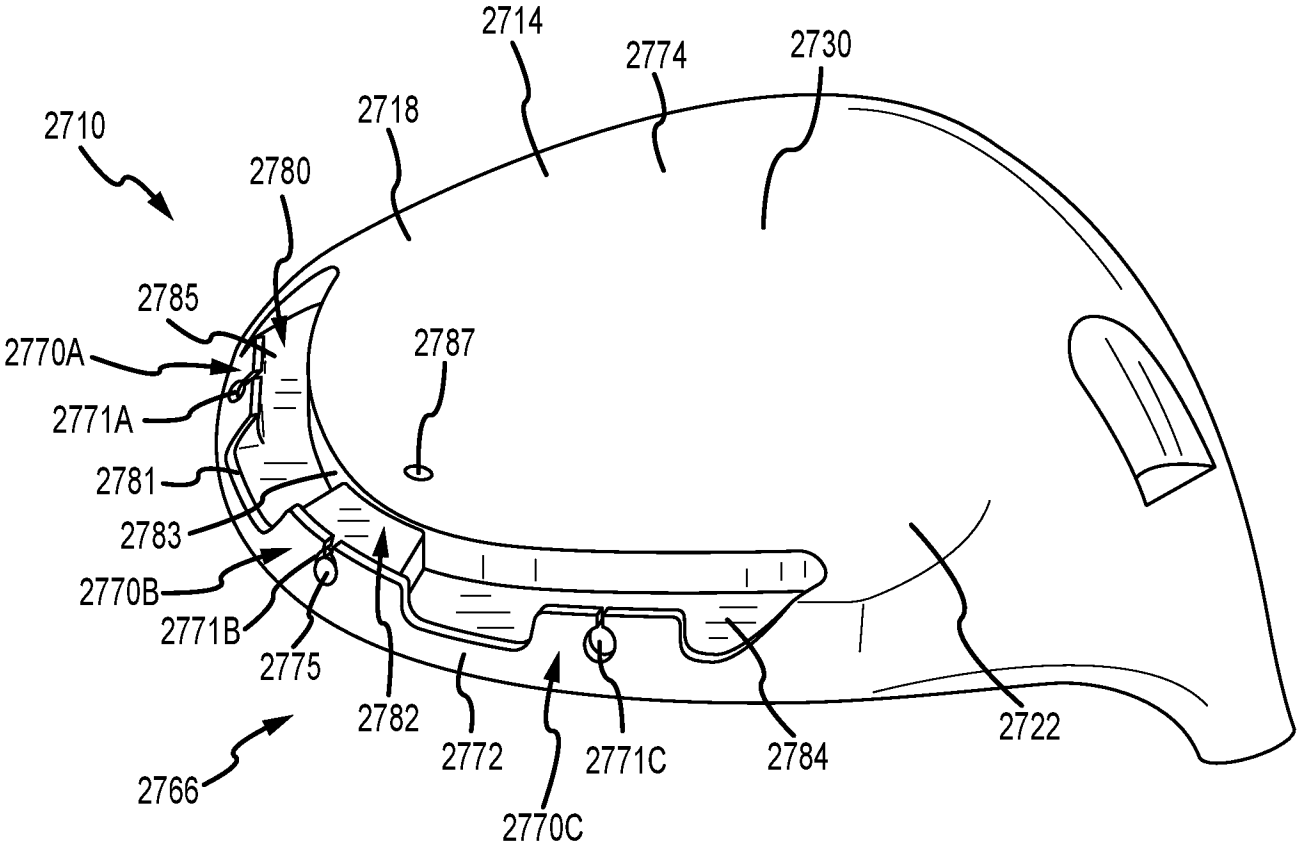
FIGS. 55-58 are perspective views of a golf club head according to another embodiment.
Figure 57:
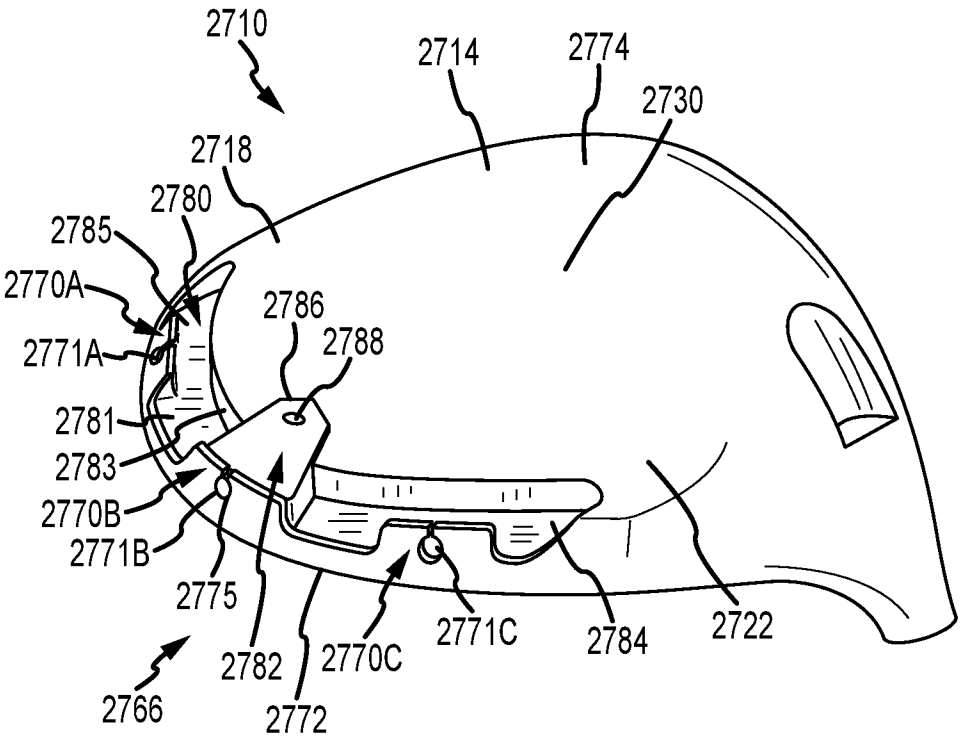
Figure 56:
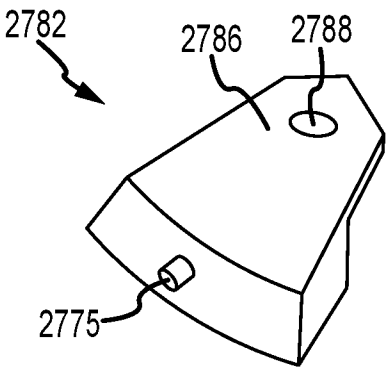

With reference to FIGS. 56 and 57, in some embodiments, one or more of the weights 2782 can be a swing weight that includes an extension 2786 that extends out of the recessed portion 2780 and over a portion of the sole or bottom 2730. As illustrated in FIG. 55, the sole or bottom 2730 can includes at least one aperture 2787. In some embodiments the weight 2782 includes a locking structure 2788 on the extension 2786 that is configured to extend into the aperture 2787 to further couple and lock the weight 2782 to the club head 2710. In some embodiments, the locking structure 2788 is a fastener that extends from or through the extension 2786 and into the aperture 2787 in the sole or bottom 2730. In some embodiments the aperture 2787 is threaded to receive the fastener. In some embodiments multiple apertures 2787 are provided, to permit the weight 2782 to be moved to various locations on the club head 2710.

Figure 58:
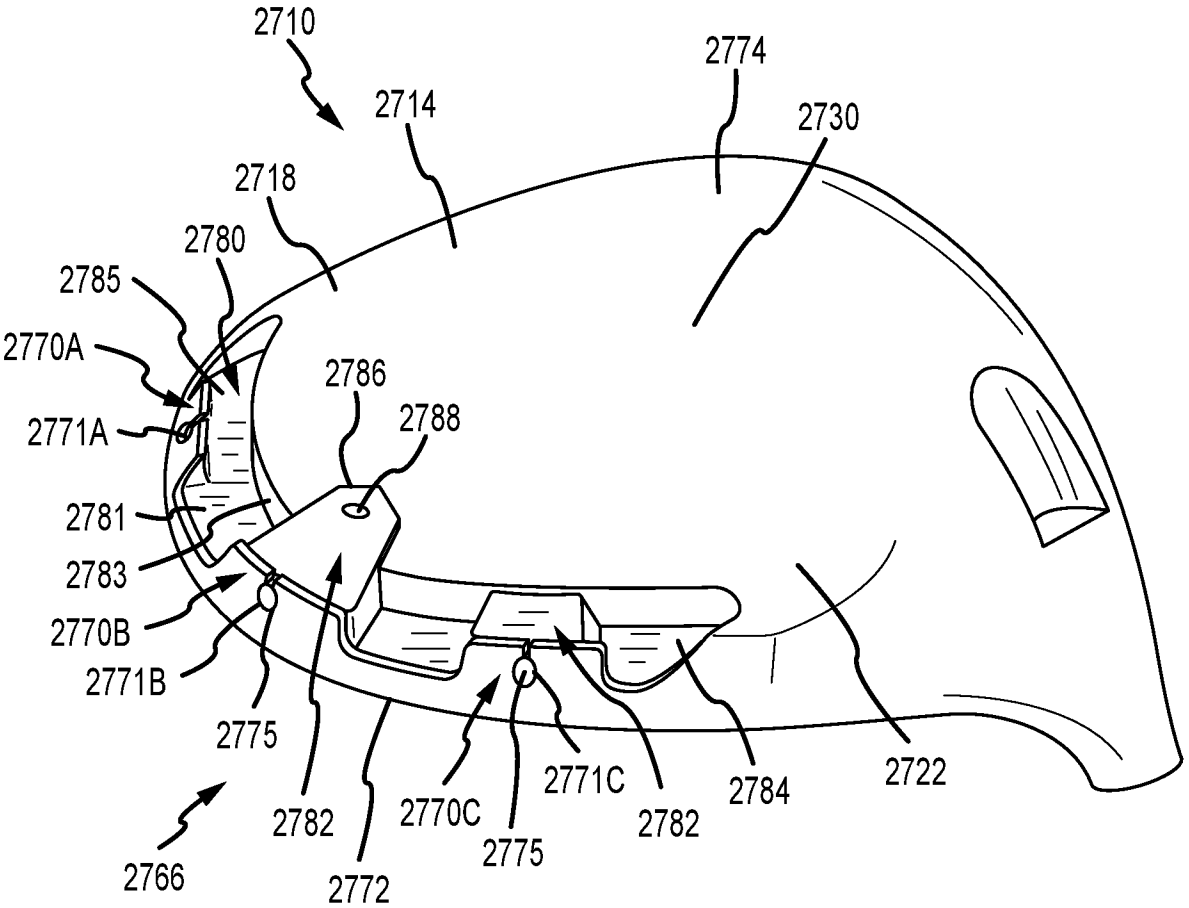

With reference to FIG. 58, in some embodiments the adjustable weighting system 2766 includes a variety of weights 2782. For example, as illustrated in FIG. 58, in some embodiments a first one of the weights 2782 is a swing weight with the extension 2786 as described above, and a second one of the weights 2782 does not include the extension 2786. The second weight 2782 may be moved as desired to or from the first protruding bodies 2770A, at the toe or toe end 2718 and to or from the protruding body 2770 at the heel or heel end 2722.

With reference to FIGS. 56-58, in some embodiments one of the weights 2782 are coupled to and fit over at least a portion of another one of the weights 2782. For example, in some embodiments the weight 2782 illustrated as a swing weight in FIGS. 56-58 (i.e., the weight 2782 having the extension 2786) has a hollow interior, and is sized and shaped to fit over at least a portion of the other, smaller weight 2782 illustrated in FIGS. 55 and 58. In some embodiments, two of the weights 2782 are coupled together first prior to insertion into the recessed portion 2780. For example, one of the smaller weights 2782 in FIGS. 55 and 58 may first be inserted into the hollow interior of the swing weight 2782, and then the combined weights 2782 may be inserted into the recessed portion 2780. In some embodiments one or more of the weights 2782 does not include the protrusion 2775, so as to facilitate fitting such a weight 2782 within another one of the weights 2782. In some embodiments, one of the protrusions 2775 (e.g., the protrusion on the larger swing weight 2782 in FIGS. 56-58) includes a hollow interior to receive the protrusion 2775 of the smaller weight 2782 in FIGS. 55 and 58. In some embodiments one of the weights 2782 includes a slot, or other opening, that slides over the protrusion 2775 of another one of the weights 2782. Other embodiments include various other manners of coupling one weight 2782 over at least a portion of another weight 2782.

In embodiments wherein the adjustable weight system 2766 comprises more than one weight 2782, each of the weights 2782 can have the same shape and size. In other embodiments, the weights 2782 can vary in shape and size, resulting in weights 2782 having varying masses. Further, in some embodiments, the weights 2782 are made of different materials such that they vary in mass. For example, one weight 2782 may be made of a high density material, such as tungsten, and the remaining weights 2782 may be made of a less dense material, such as polyurethane or another plastic. In other embodiments, the weights 2782 may have different sizes or volumes such that they vary in mass. For example, one weight 2782 may have a greater volume than the remaining weights 2782. In some embodiments, each of the weights 2782 may vary in volume from one another and thus vary in mass. In some embodiments, the weights 2782 may vary in both volume and material from one another. In some embodiments, one of the structures labeled as 2782 is not a weight, but rather a light-weight (e.g., light-weight plastic) cover that snap-fits or otherwise couples to one of the protruding bodies 2770A, B, C. In some embodiments, the weights 2782 may vary between 0.1-50 g. For example, in embodiments having a plurality of weights 2782, one or more of the weights 82 may vary between 0-10 g, one or more of the weights 2782 may vary between 10-20 g, one or more of the weights 2782 may vary between 20-30, one or more of the weights 2782 may vary between 30-40 g, and one or more of the weights 2782 may vary between 40-50 g. In some embodiments, a first weight 2782 may vary between 0-10 g, a second weight 2782 may vary between 10-20 g, a third weight 2782 may vary between 20-30, a fourth weight 82 may vary between 30-40 g, and a fifth weight 2782 may vary between 40-50 g. In other embodiments, a first weight 2782 may vary between 1-5 g, and a second and third weight 2782 may vary between 5-30 g. In other embodiments, a first and second weight 2782 may vary between 1-10 g, and a third and fourth weight 2782, may vary between 5-25 g. In some embodiments, a first weight 2782 has a mass of 8.5 grams, and a second and third weight 2782 each have a mass of 1.5 grams. In other embodiments, a first weight 2782 has a mass of 12 grams, and a second and third weight 2782 each have a mass of 1.5 grams. In other embodiments, a first weight 2782 has a mass of 8.5 grams, and a second and third weight 2782 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 55-58, in the illustrated embodiment one of the protruding bodies 6270A, B, C, D, E receives a weight 2782, while the remaining protruding bodies 2770A, B, C, D, E are bare and uncovered, or are covered with another material or structure. In other embodiments, each of the protruding bodies 2770A, B, C, D, E receives a weight 2782. In some embodiments, one or more of the protruding bodies 2770A, B, C receives more than one weight 2782. In some embodiments, one or more of the protruding bodies 2770A, B, C, D, E does not extend past an outer profile of the club head 2710, such that even if the protruding body 2770A, B, C, D, E is left bare and uncovered, the protruding body 2770A, B, C, D, E and or recessed portion 2780 will not interfere with or disrupt a golfer's swing.

The weights 2782 may be strategically positioned on the protruding bodies 2770A, B, C, D, E to achieve a desired club head 2710 center of gravity position and/or moment of inertia and/or heel/toe bias. For example, in some embodiments, a heavier weight 2782 is positioned on the protruding body 2770C, located between the toe or toe end 2718 and the heel or heel end 2722, while lighter weights are positioned on the protruding bodies 2770A,B, D, E near the toe or toe end 2718 and the heel or heel end 2722. The aforementioned weight 2782 positions results in the center of gravity remaining centered while being shifted towards the back end 2734 of the club head 2710. In some embodiments, a heavier weight 2782 is positioned on the protruding body 2770E and/or 2770D near the heel or heel end 2722, while lighter weights 2782 are positioned on the protruding body 6270A, B near the toe or toe end 2718 and on the protruding body 2770C that is located between the toe or toe end 6318 and the heel or heel end 6322. The aforementioned weight 2782 positions result in the center of gravity being shifted towards the heel end 2722 of the club head 2710. In some embodiments, a heavier weight 2782 is positioned on the protruding body 2770A and/or 2770B near the toe or toe end 2718, while lighter weights 2782 are positioned on the protruding bodies 6270D, E near the heel or heel end 2722 and on the protruding body 2770C that is located between the toe or toe end 2718 and the heel or heel end 2722. The aforementioned weight 2782 positions results in the center of gravity being shifted towards the toe end 2718 of the club head 2710. In many embodiments, one or more of the protruding bodies 2770A, B, C, D, E are of equal size and shape, such that one weight may be interchangeably used with each of the protruding bodies 2770A, B, C, D, E. In some embodiments, one or more of the protruding bodies 2770A, B, C, D, E can have a differing size and shape, such that each protruding bodies 2770A, B, C, D, E has its own corresponding weight 2782 or set of weights 2782.

The adjustable weighting system 2766 of golf club head 2766 maintains or prevents a significant reduction in club head moment of inertia, and low and back club head center of gravity positioning, compared to a club head devoid of an adjustable weighting system. The adjustable weighting system 2766 of golf club head 2766 maintains a high club head moment of inertia and a low and back club head CG position due to the low profile of the weighting system and the perimeter positioning of the one or more weights. The club head 2766 having the adjustable weighting system 2766 can have similar or identical parameters and measurements as club head 100 described above.

Figure 67:
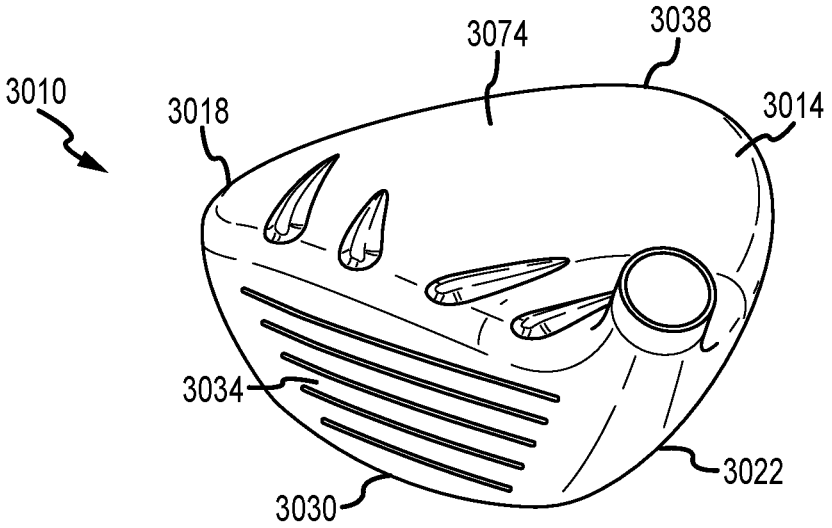
FIG. 67 is a perspective view of a golf club head according to another embodiment.
Figure 68:
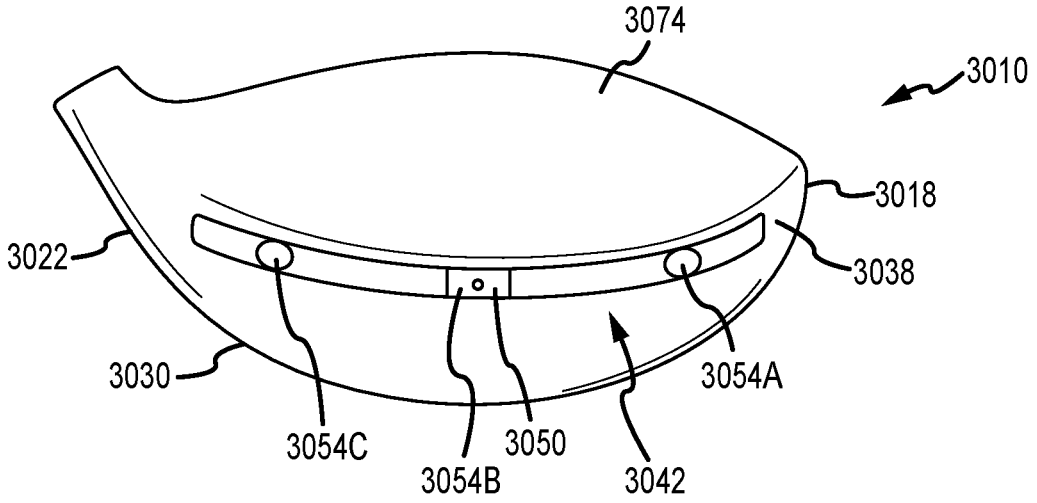
FIG. 68 is a rear view of the golf club head of FIG. 67.

FIGS. 67-68 illustrate a club head 3010 having a club head body 3014. The club head 3010 includes an adjustable weighting system 3042 that is adjustable by an end user to modify the club head 3010 center of gravity and/or moment of inertia and/or heel/toe bias to achieve desired performance characteristics (e.g., forgiveness, spin, trajectory) under various circumstances. The adjustable weighting system 3042 is a low profile system and thereby does not significantly shift or change the club head 3010 MOI when compared to a club head not including the adjustable weighting system 3042. Further, the low profile adjustable weighting system 3042 ensures that shifts in the club head 3010 CG occur mainly in a heel end 3022 to toe end 3018 direction keeping the overall club head 3010 CG in a low and back location.

Figure 69:
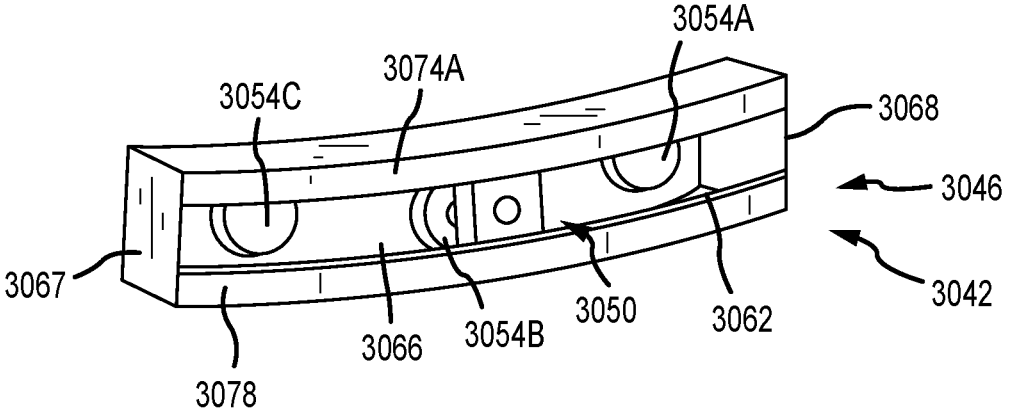
FIG. 69 is an illustration of an adjustable weighting system of the golf club head of FIG. 67.

Referring to FIG. 67-69, the adjustable weighting system 3042 can comprise a channel 3046. The channel 3046 comprises a back wall 3066 that can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 3042 includes a back wall 3066 comprising three discrete attachment locations. Each discrete attachment location comprises a feature in the form of a protruding body 2470A, B, C Further, the protruding bodies, 2470A, B, C can receive one or more weight 2482.

Figure 70:
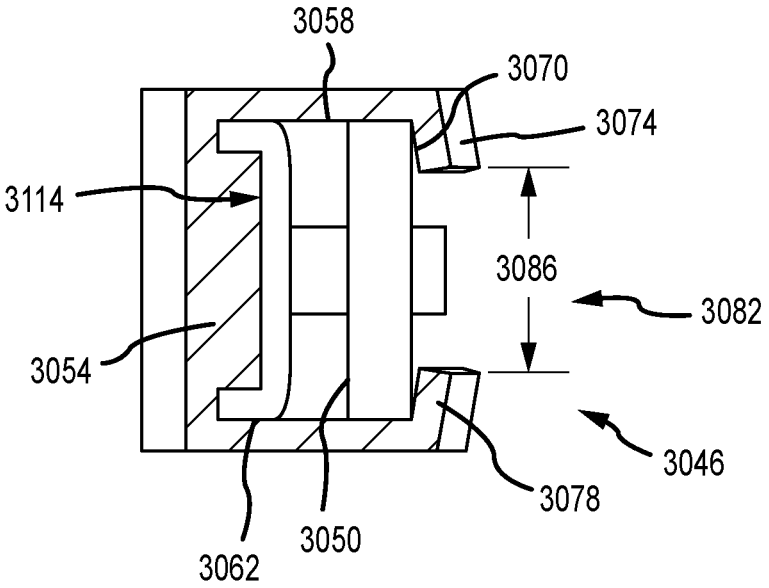
FIG. 70 is a cross-sectional view of the adjustable weighting system of FIG. 69.

As illustrated in FIGS. 69 and 70, the channel 3046 of the adjustable weighting system 3042 comprises a top wall 3058, a bottom wall 3062 opposite the top wall 3058, a back wall 3066, an inner wall 3070 opposite the back wall 3066, a first sidewall 3067, and a second sidewall 3068 opposite the first sidewall 3067. The channel 3046 of the adjustable weighting system 3042 further comprises a top lip 3074 and a bottom lip 3078. The top lip 3074 extends from the crown 3018 toward the sole 3022, and the bottom lip 3078 extends from the sole 3022 toward the crown 3018. An opening 3082 is created between the top lip 3074 and the bottom lip 3078, wherein the opening 3082 comprises an opening distance 3086. The top lip 3074 and the bottom lip 3078 of the adjustable weighting system 3042 prevent the adjustable weight 3050 from being removed from the channel 3046 of the adjustable weighting system 3042.

The protruding bodies 3054 of the adjustable weight system 3042 are configured to be received by the adjustable weight 3050. The protruding bodies 3054 of the adjustable weight system 3042 extend perpendicular from the back wall 3066 of the channel 3046 toward the opening 3082 of the adjustable weighting system 3042. In some embodiments, the protruding bodies 3054 can comprise at least 1 protruding body 3054, at least 2 protruding bodies 3054, at least 3 protruding bodies 3054, at least 4 protruding bodies 3054, at least 5 protruding bodies 3054, or at least 6 protruding bodies 3054. Further, the protruding bodies 3054 can be evenly spaced apart from a heel end 3030 to a toe end 3026 within the channel 3046 of the adjustable weighting system 3042; while in other embodiments, some of the protruding bodies 3054 are not evenly spaced apart. In some embodiments, the protruding bodies 3054 can be spaced out in increments from one another, concentrated near the toe end 3026, near the heel end 3030, bordering the crown 3018, the sole 3022, or the crown 3018 and sole 3022. For example, two protruding bodies 3054 are positioned near the toe end 3026, while one protruding body 3054 is positioned near heel end 3030, or all three protruding 3054 bodies are positioned near the heel end 3030. Each of the protruding bodies 3070A, B, C defining a discrete attachment location for securing a weight to the club head 3010. In contrast to other adjustable weighting systems wherein the weight can be coupled at any, or at an infinite, or at an unlimited number of locations across the recessed portion.

Figure 62:
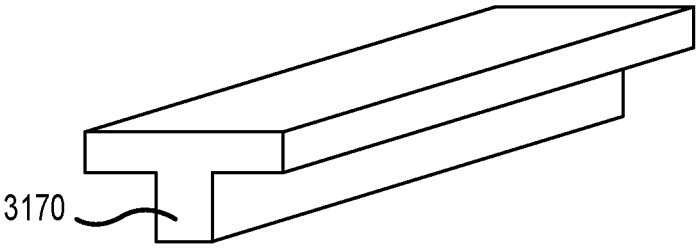

The protruding bodies 3054 of the adjustable weighting system 3042 can further comprise a cross-sectional shape. The cross-sectional shape of the protruding bodies 3054 can be cylindrical. In other embodiments, the protruding bodies 3054 can have a square cross-section, a rectangular cross-section, a triangular cross-section, or any other shaped cross-section. In some embodiments, the protruding bodies 3054 can comprise the same cross-sectional shape. For example, all three protruding bodies 3054 of the adjustable weighting system 3042 can comprise a cylindrical cross-sectional shape as illustrated in FIG. 62. While in other embodiments, the protruding bodies 3054 can comprise different cross-sectional shapes.

The protruding bodies 3054 of the adjustable weighting system 3042 can further still comprise a material. The material of the protruding bodies 3054 can be steel, tungsten, aluminum, titanium, vanadium, chromium, cobalt, nickel, other metals, metal alloys, composite polymer material, non-metallic materials, polymer components, or any combination thereof. The material of the protruding bodies 3054 can further be a programmed magnet.

Figure 71:
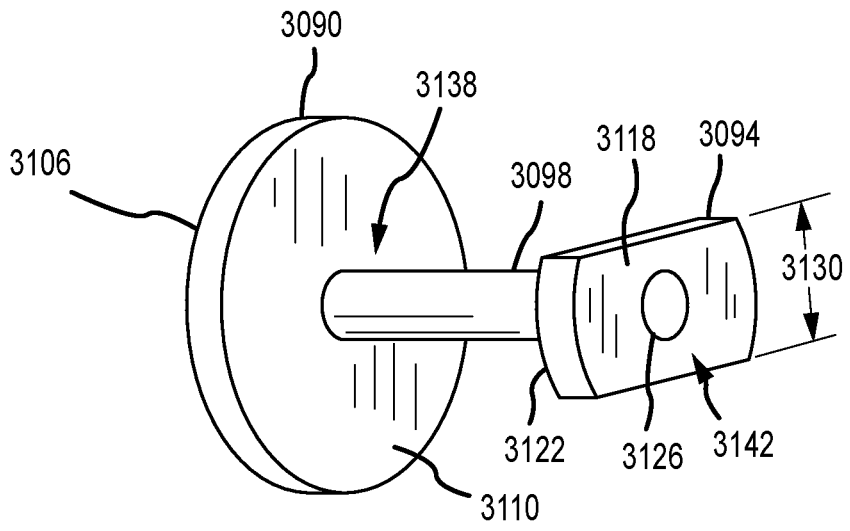
FIG. 71 is a perspective view of an adjustable weight of the golf club head of FIG. 67 in one configuration.
Figure 72:
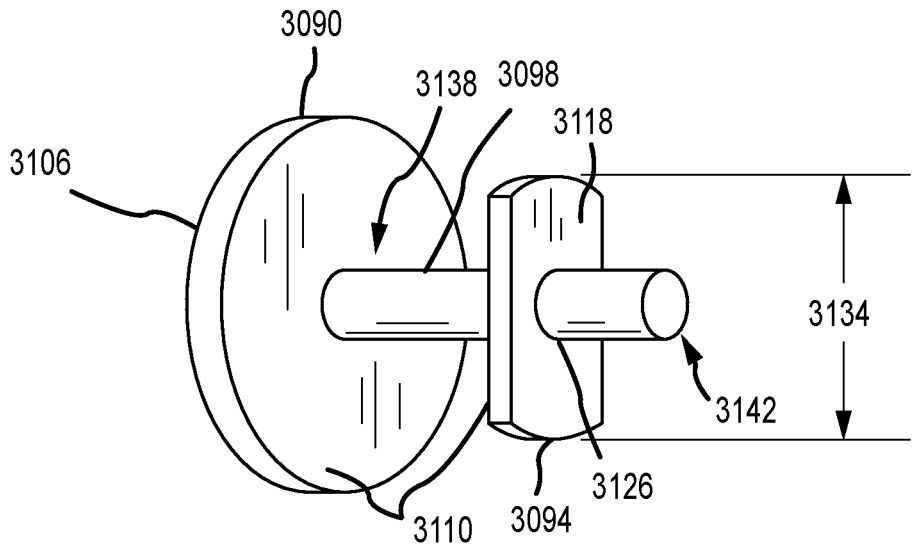
FIG. 72 is a perspective view of the adjustable weight of the golf club head of FIG. 67 in another configuration.

As illustrated in FIGS. 71 and 72, the adjustable weight 3050 of the adjustable weighting system 3042 comprises a first component 3090, and a second component 3094 non adjacent to the first component 3090. The adjustable weight 3050 can comprise a third component 3098 extending from the first component 3090 and being received within the second component 3094. The first component 3090 of the adjustable weight 3050 comprises a width 3102 greater than the opening distance 3086 of the channel 3046, thus preventing the adjustable weight 3050 from being removed from the club head 3010.

The back surface 3106 of the first component 3090 of the adjustable weight 3050 comprises a recess 3114 to be configured to receive the protruding bodies 3054. The recess 3114 of the first component 3090 comprises a cross-sectional shape that is complimentary to the cross-sectional shape of the protruding bodies 3054. For example, in some embodiments, the cross-sectional shape of the recess 3114 can be cylindrical to house a cylindrical protruding body 3054. In other embodiments, the recess 3114 can comprise a square cross-section, a rectangular cross-section, a triangular cross-section, or any other shape to be complimentary to the cross-sectional shape of the protruding bodies 3054.

The first component 3090 further comprises a material. The material of the first component 3090 can be steel, tungsten, aluminum, titanium, vanadium, chromium, cobalt, nickel, other metals, metal alloys, composite polymer material, non-metallic materials, polymers components, or any combination thereof. The material of the first component 3090 can further be a programmable magnet. A programmable magnet is a magnetic structure that is coded with distinctive correlating patterns with alternating polarity, designed to achieve a desired behavior. The different desired behaviors achieved by the programmable magnet are aligning, attaching, latching, and spring. The programmable magnets used herein are coded to display spring-like behaviors. The programmed magnets comprise an equilibrium point wherein the programmed magnets either repel or attract one another to constantly reach this equilibrium point. If the programmed magnets were be pushed together, they would repel, and if they were pulled apart, they would attract. The programmed magnet can be coded to comprise an equilibrium point as described above, but can be further coded to attract and attach when the programmed magnets are aligned in a certain configuration relative to one another. In some embodiments, the first component comprises a programmable magnet material.

The second component 3094 of the adjustable weight 3050 comprises a front surface 3118, a back surface 3122, facing the front surface 3118 of the first component 3090, and an aperture 3126 housing the third component 3098. The second component 3094 of the adjustable weight 3050 further comprises a minimum width 3130 and a maximum width 3134. The minimum width 3130 of the second component 3094 is less than the opening distance 3086 of the channel 3046 of the adjustable weighting system 3042. The maximum width 3134 of the second component 3094 is greater than the opening distance 3086 of the channel 3046 of the adjustable weighting system 3042.

The second component 3094 further comprises a material. The material of the second component 3094 can be steel, tungsten, aluminum, titanium, vanadium, chromium, cobalt, nickel, other metals, metal alloys, composite polymer material, non-metallic materials, polymer components, or any combination thereof. The material of the second component 3094 can further be a programmable magnet similar to the spring-like programmed magnet as described above.

Figure 73:
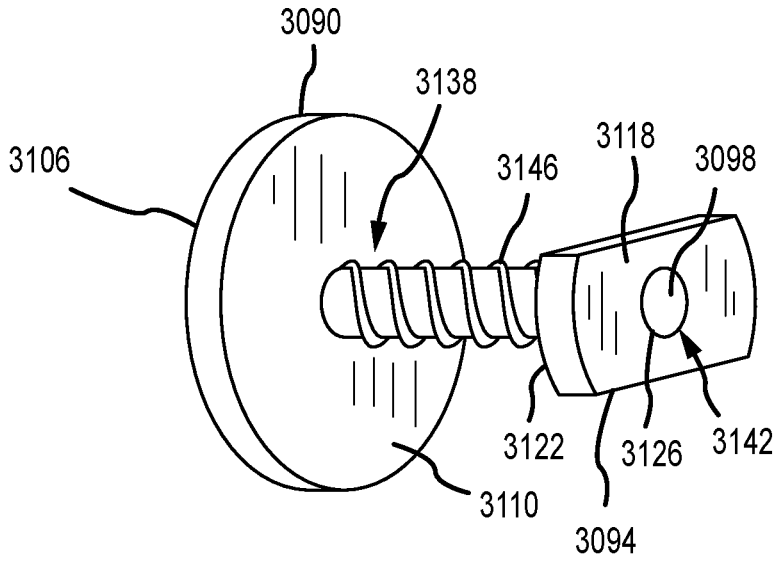
FIG. 73 is a perspective view of an adjustable weight of the golf club head of FIG. 67 according to another embodiment.

As illustrated in FIGS. 71-73, the third component 3098 of the adjustable weight 3050 is a cylindrical rod comprising a first end 3138 and a second end 3142. The first end 3138 of the third component 3098 is configured to be attached to the front surface 3110 of the first component 3090. The second end 3142 of the third component 3098 is configured to be received within the aperture 3126 of the second component 3094, wherein the second component 3094 is rotatable about the third component 3098. The second component 3094 can further move along the third component 3098 from the second end 3142 toward the first end 3138.

The third component 3098 of the adjustable weight 3050 further comprises a material. The material of the third component 3098 can be steel, tungsten, aluminum, titanium, vanadium, chromium, cobalt, nickel, other metals, metal alloys, composite polymer material, non-metallic materials, polymer components, or any combination thereof.

In other embodiments, as illustrated in FIG. 73, the adjustable weight 3050 can further comprise a fourth component 3146 positioned between the first component 3090 and the second component 3094 and housing a portion of the third component 3098. The fourth component 3146 comprises a first end 3150 and a second end 3152. The first end 3150 of the fourth component 3146 is attached to the front surface 3110 of the first component 3090, and the second end 3154 of the fourth component 3146 is attached to the back surface 3122 of the second component 3094. The fourth component 3146 further comprises a material having a spring constant. The material having a spring constant can be a spring or elastomer with resistance when compressed.

In some embodiments, the first and second components 3090 and 3094 of the adjustable weight 3050 can comprise the same material. In other embodiments, the first component 3090 of the adjustable weight 3050 can comprise a different material than the second component 3094 of the adjustable weight 3050. In other embodiments, the third component 3098 can comprise a different material than the first and second component 3090 and 3094, or the same material as the first component 3090, the second component 3094, or both the first and second component 3090 and 3094.

In some embodiments, wherein the first and second components 3090 and 3094 comprise a programmable magnet, the first component 3090 and the second component 3094 are programmed to have spring like behaviors. When no force is acting on the first and second components 3090 and 3094 to compress or expand from one another, the adjustable weight 3050 is at equilibrium (first component 3090 and second component 3094 are at a constant distance from one another). When the first and second components 3090 and 3094 are compressed together, the adjustable weight 3050 is trying to reach equilibrium. When the adjustable weight 3050 tries to reach equilibrium, the second component 3094 of the adjustable weight 3050 repels against the first component 3090 of the adjustable weight 3050.

In alternative embodiments, wherein the first and second components 3090 and 3094 comprise a programmable magnet, the first component 3090 and the second component 3094 are programmed to have spring like behaviors. The adjustable weight 3050 is at equilibrium (as described above), when the first and second component 3090 and 3094 are aligned in one configuration, and are attracted to one another and attached, when the second component 3094 is rotated to be aligned in another configuration relative to the first component 3090.

In other embodiments, where the adjustable weight 3050 comprises the first component, 3090, the second component 3094, the third component 3098, and the fourth component 3146, the fourth component 3146 provides the adjustable weight 3050 spring-like behaviors as described above. When no force is acting on the first, second and fourth component 3090, 3094, and 3146, the adjustable weight 3050 is at equilibrium (first component 3090 and second component 3094 are at a constant distance from one another). When the first and second components 3090 and 3094 are compresses together, the fourth component 3146 expands against the first component 3090 and the second component 3094 to regain equilibrium.

As illustrated in FIG. 69, the adjustable weight 3050 is housed within the channel 3046 of the adjustable weight system 3042. As illustrated in FIG. 71, the adjustable weight 3050 is in a first configuration 3158, wherein no force is acting on the second component 3094 of the adjustable weight 3050 to compress or expand relative to the first component 3090 of the adjustable weight 3050. In the first configuration 3158 of the adjustable weight 3050, minimum width 3130 of the second component 3094 is parallel to the opening distance 3086 of the channel 3046; while the maximum width 3134 of the second component 3094 is perpendicular to the opening distance 3086 of the channel 3046. Because the minimum width 3130 of the second component 3094 is less than the opening distance 3086, the first configuration 3158 allows the adjustable weight 3050 to be positioned anywhere along the channel 3046 wherein a protruding body 3054A, B, C exists. When positioning the adjustable weight 3050 within the channel 3046 in a desired location for CG and MOI, the recess 3114 on the back surface 3106 of the first component 3090 receives one of the protruding bodies 3054A, B, C.

A tool is then applied to the second component 3094 of the adjustable weight 3050 to transition the adjustable weight 3050 into a second configuration 3162 as illustrated in FIG. 72. The tool pushes the second component 3094 beyond the top and bottom lip 3074 and 3078, and rotates the second component 3094 about the third component 3098. In the second configuration 3162 of the adjustable weight 3050, the maximum width 3134 of the second component 3094 is parallel to the opening distance 3186 of the opening 3082 of the channel 3046 and the minimum width 3130 of the second component 3094 is perpendicular to the opening distance 3186 of the opening 3082 of the channel 3046. Further, in the second configuration 3094 of the adjustable weight 3050, the front surface 3118 of the second component 3094 abuts the inner wall 3070 of the top and bottom lip 3074 and 3078. Because the adjustable weight 3050 is programmed to exhibit spring-like behaviors, the first and second component 3090 and 3094 repel each other, creating a press fit of the adjustable weight 3050 within the channel 3046 of the adjustable weighting system 3042. The second configuration 3162 of the adjustable weight 3050 secures the adjustable weight 3050 onto the protruding bodies 3054 within the channel 3046, thus preventing the movement of center of gravity and moment of inertia post adjustment.

The tool can also transition the adjustable weight 3050 back into the first configuration 3158. The tool further compresses the second component 3094 of the adjustable weight 3050 toward the first component 3090 of the adjustable weight 3050, and then rotates the second component 3094 about the third component 3098 into the first configuration. The front surface 3118 of the second component 3094 no longer abuts the inner wall 3070 of the top and bottom lip 3074 and 3078, thus not creating a press fit of the adjustable weight 3050 within the channel 3046 of the adjustable weighting system 3042. Once the recess 3114 of the first component 3090 of the adjustable weight 3050 releases one of the protruding bodies 3054, the adjustable weight 305 can reposition within the channel 3046 of the adjustable weighting system 3042 to another one of the protruding bodies 3054A, B, C.

In another embodiment, the adjustable weight 3050 comprises a first, a second, a third and a fourth component 3090, 3094, 3098, and 3146. In this embodiment, the first component 3090 and the second component 3094 comprise a material that is not a programmable magnet. The adjustable weight 3050 is modified from a first configuration 3158 to a second configuration 3162 in a similar fashion using the tool as described above. When the adjustable weight 3050 is in the second configuration 3162, the fourth component 3146 is compressed and thus pushes against the first and second component 3090 and 3094 of the adjustable weight 3050. The pushing of the fourth component 3146 on the first and second component 3090 and 3094 creates a press fit within the channel 3046 of the adjustable weighting system 3042. The press fit of the adjustable weight 3050 within the channel 3046 of the adjustable weighting system 3042 secures the adjustable weight 3050 onto one of the protruding bodies and thus prevent the center of gravity and moment of inertia from changing post adjustment.

In another embodiment (not pictured), the adjustable weight 3050 comprises a first and a second component 3090 and 3094 void of a third component 3098 positioned between the first and second components 3090 and 3094. In this embodiment, the first component 3090 and the second component 3094 comprise a material that is a programmable magnet. Further, in this embodiment, the protruding bodies 3054 of the adjustable weighting system 3042 comprise a material that is a programmable magnet. When the second component 3094 is aligned in one configuration relative to the first component 3090, the first and second component 3090 and 3094 are at an equilibrium point and are non-adjacent to one another. When the adjustable weight 3050 are at an equilibrium point, the adjustable weight 3050 can be positioned anywhere along the channel 3046 of the adjustable weight 3042 system corresponding with the protruding bodies 3054A, B, C. When positioning the adjustable weight 3050 within the channel 3046 in a desired location for CG and MOI, the adjustable weight 3050 can be positioned over one of the protruding bodies 3054A, B, C. Using a tool, the second component 3094 can then be rotated to be aligned in another configuration relative to the first component 3090, wherein the first component 3090, the second component 3094 and the protruding body 3054 positioned underneath the recess 3114 on the back surface 3106 of the first component 3090 attract one another and attach at that distinct location within the channel 3046.

These embodiments allow an end user the ability to adjust placement of the adjustable weight 3050 along the channel 3046 of the adjustable weighting system 3042 at the distinct locations of the protruding bodies 3054A, B, C to affect the center of gravity, moment of inertia and the heel/toe bias of the club head. Affecting the center of gravity, moment of inertia and heel/toe bias of the club head allow for the end user to achieve desired performance characteristics. Altering the moment of inertia of the club head can in turn alter the forgiveness of the golf club, flight direction of the golf ball.

Referring to FIGS. 69-73, in the illustrated embodiments, one of the protruding bodies 3054A, B, C receives an adjustable weight 3050. In other embodiments, one or more of the protruding bodies 3054A, B, C receives an adjustable weight 3050, while the remaining protruding bodies 3054A, B, C are bare and uncovered, or are covered with another material or structure. In some embodiments, one or more of the protruding bodies 3054A, B, C receives more than one adjustable weight 3050. In some embodiments, one or more of the protruding bodies 3054A, B, C does not extend past an outer profile of the club head 10, such that even if the protruding body 3054A, B, C is left bare and uncovered, the protruding body 3054A, B, C and or channel 3046 will not interfere with or disrupt a golfer's swing.

In the illustrated embodiment, each of the adjustable weights 3050 is illustrated having the same shape and size. In other embodiments, the adjustable weights 3050 can vary in shape and size, resulting in different adjustable weights 3050 having varying masses. Further, in some embodiments, the adjustable weights 3050 are made of different materials such that they vary in mass. For example, one adjustable weight 3050 may be made of a high density material, such as tungsten, and the remaining adjustable weights 3050 may be made of a less dense material, such as polyurethane or another plastic. In other embodiments, the adjustable weights 3050 may have different sizes or volumes such that they vary in mass. For example, one adjustable weight 3050 may have a greater volume than the remaining adjustable weights 3050. In some embodiments, each of the adjustable weights 3050 may vary in volume from one another and thus vary in mass. In some embodiments, the adjustable weights 3050 may vary in both volume and material from one another. In some embodiments, one of the structures labeled as 3082 is not a weight, but rather a light-weight (e.g., light-weight plastic) cover that snap-fits or otherwise couples to one of the protruding bodies 3054A, B, C. In some embodiments, the adjustable weights 3050 may vary between 0.1-50 g. For example, in embodiments having a plurality of adjustable weights 3050, one or more of the weights 82 may vary between 0-10 g, one or more of the adjustable weights 3050 may vary between 10-20 g, one or more of the adjustable weights 3050 may vary between 20-30, one or more of the adjustable weights 3050 may vary between 30-40 g, and one or more of the adjustable weights 3050 may vary between 40-50 g. In some embodiments, a first adjustable weight 3050 may vary between 0-10 g, a second adjustable weight 3050 may vary between 10-20 g, a third adjustable weight 3050 may vary between 20-30, a fourth weight 82 may vary between 30-40 g, and a fifth adjustable weight 3050 may vary between 40-50 g. In other embodiments, a first adjustable weight 3050 may vary between 1-5 g, and a second and third adjustable weight 3050 may vary between 5-30 g. In other embodiments, a first and second adjustable weight 3050 may vary between 1-10 g, and a third and fourth adjustable weight 3050, may vary between 5-25 g. In some embodiments, a first adjustable weight 3050 has a mass of 8.5 grams, and a second and third adjustable weight 3050 each have a mass of 1.5 grams. In other embodiments, a first adjustable weight 3050 has a mass of 12 grams, and a second and third adjustable weight 3050 each have a mass of 1.5 grams. In other embodiments, a first adjustable weight 3050 has a mass of 8.5 grams, and a second and third adjustable weight 3050 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The adjustable weights 3050 may be strategically positioned on the protruding bodies 3054A, B, C to achieve a desired club head 3010 center of gravity position and/or moment of inertia and/or heel/toe bias. For example, in some embodiments, a heavier adjustable weight 3050 is positioned on the protruding body 3054B, located between the toe or toe end 3018 and the heel or heel end 3022, while lighter weights are positioned on the protruding bodies 3054A, C near the toe or toe end 3018 and the heel or heel end 3022. The aforementioned adjustable weight 3050 placement can result in the center of gravity remaining centered while being shifted towards the back end 3034 of the club head 3010. In some embodiments, a heavier adjustable weight 3050 is positioned on the protruding bodies 3054C near the heel or heel end 3022, while lighter adjustable weights 3050 are positioned on the protruding body 3054A near the toe or toe end 3018 and on the protruding body 3054B that is located between the toe or toe end 3018 and the heel or heel end 3022. The aforementioned adjustable weight 3050 placement can result in the center of gravity being shifted towards the heel end 3022 of the club head 3010. In some embodiments, a heavier adjustable weight 3050 is positioned on the protruding body 3054A near the toe or toe end 3018, while lighter adjustable weights 3050 are positioned on the protruding body 3054C near the heel or heel end 3022 and on the protruding body 3054B that is located between the toe or toe end 3018 and the heel or heel end 3022. The aforementioned adjustable weight 3050 placement can result in the center of gravity being shifted towards the toe end 3018 of the club head 3010. In many embodiments, one or more of the protruding bodies 3054A, B, C are of equal size and shape, such that one weight may be interchangeably used with each of the protruding bodies 3054A, B, C. In some embodiments, one or more of the protruding bodies 3054A, B, C can have a differing size and shape, such that each protruding bodies 3054A, B, C has its own corresponding adjustable weight 3050 or set of adjustable weights 3050.

The adjustable weighting system 3066 of golf club head 3066 maintains or prevents a significant reduction in club head moment of inertia, and low and back club head center of gravity positioning, compared to a club head devoid of an adjustable weighting system. The adjustable weighting system 3066 of golf club head 3066 maintains a high club head moment of inertia and a low and back club head CG position due to the low profile of the weighting system and the perimeter positioning of the one or more weights. The club head 3066 having the adjustable weighting system 3066 can have similar or identical parameters and measurements as club head 100 described above.

In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

Figure 59:
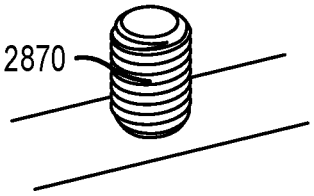
FIGS. 59-62 are illustrations of various shapes and sizes for protruding bodies.
Figure 60:
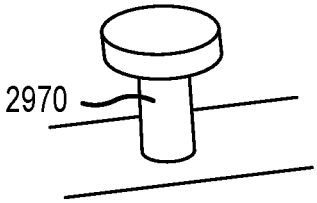
Figure 61:
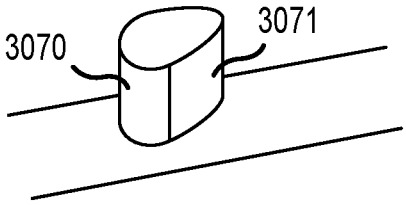

With respect to any of the embodiments discussed above, FIGS. 59-62 illustrate further concepts of protruding bodies that may be used. For example, FIG. 59 illustrates a threaded protruding body 2870, FIG. 60 illustrates a protruding body 2970 having a shape designed to be held by a chuck (e.g., collet chuck), FIG. 61 illustrates a protruding body 3070 having a flat surface 3071, and FIG. 62 illustrates a protruding body 3170 that forms a rail. Each of these protruding bodies may be used to receive and hold one or more weights on a club head.

Figure 63:
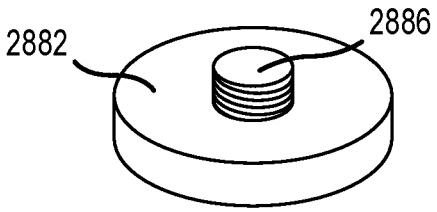
FIGS. 63-66 are illustrations of various types of structures that may be used on weights to attach to protruding bodies.
Figure 64:
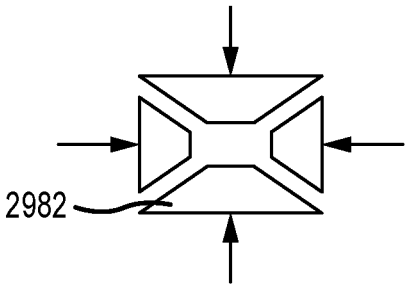
Figure 65:
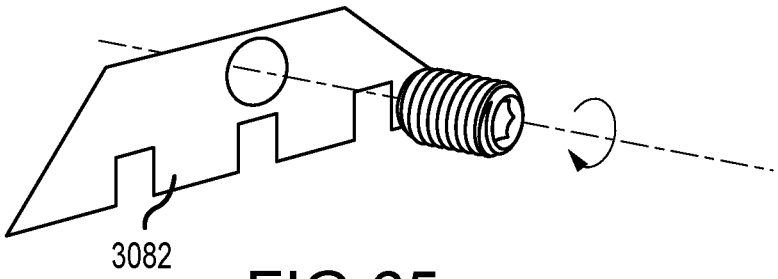
Figure 66:
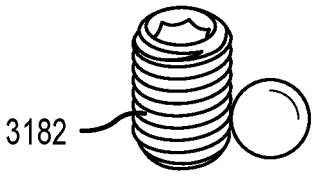

With respect to any of the embodiments discussed above FIGS. 63-66 illustrate further concepts of weights that may be used. For example, FIG. 63 illustrates a weight 2882 with a threaded aperture 2886 to couple to a threaded protruding body (e.g., the protruding body 2870 in FIG. 59), FIG. 64 illustrates the concept of using a chuck (e.g., collet chuck) on a weight 2982 to couple to a protruding body (e.g., the protruding body 2970 in FIG. 60), FIG. 65 illustrates the concept of using a set screw and a flat to couple a weight 3082 to a protruding body (e.g., the protruding body 3070 in FIG. 61), and FIG. 66 illustrates the concept of using a ball bearing and a set screw to couple a weight 3182 to a protruding body (e.g., by screwing in the set screw to force the ball bearing against a portion of the weight and the protruding body to hold the weight onto the protruding body).

FIGS. 74-77 illustrate a club head 3210 having a club head body 3214. The club head 3210 can be similar to the club head bodies mentioned above. The club head 3210 includes an adjustable weighting system 3266 comprising a cable 3269 and a tensioner 3267 that is adjustable by an end user to modify the club head 3210 center of gravity and/or moment of inertia and/or heel/toe bias to achieve desired performance characteristics (e.g., forgiveness, spin, trajectory) under various circumstances. The adjustable weighting system 3266 is positioned within a recessed portion 3280 of the club head 3210. The adjustable weighting system 3266 is a low profile system and thereby does not significantly shift or change the club head 3210 MOI when compared to a club head not including the adjustable weighting system 3266. Further, the low profile adjustable weighting system 3266 ensures that shifts in the club head 3210 CG occur mainly in a heel end 3222 to toe end 3218 direction keeping the overall club head 3210 CG in a low and back location.

Figure 74:
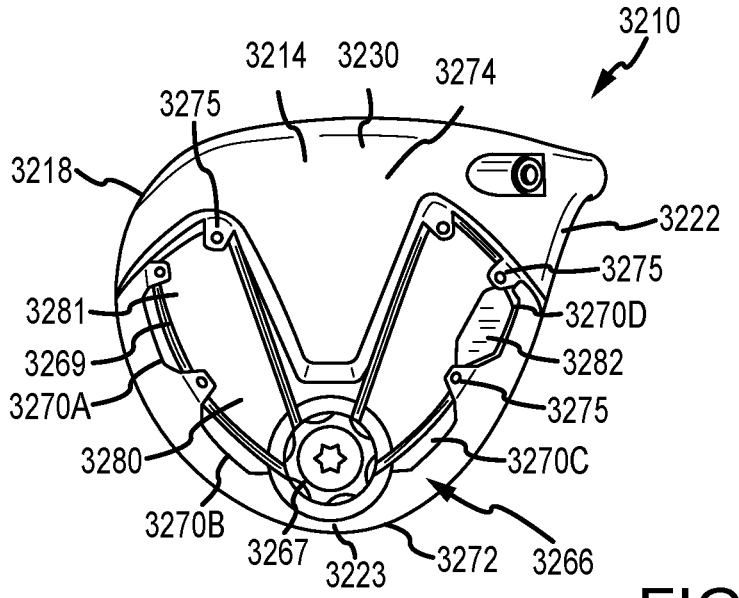
FIG. 74 is a perspective view of a golf club head according to another embodiment.
Figure 75:
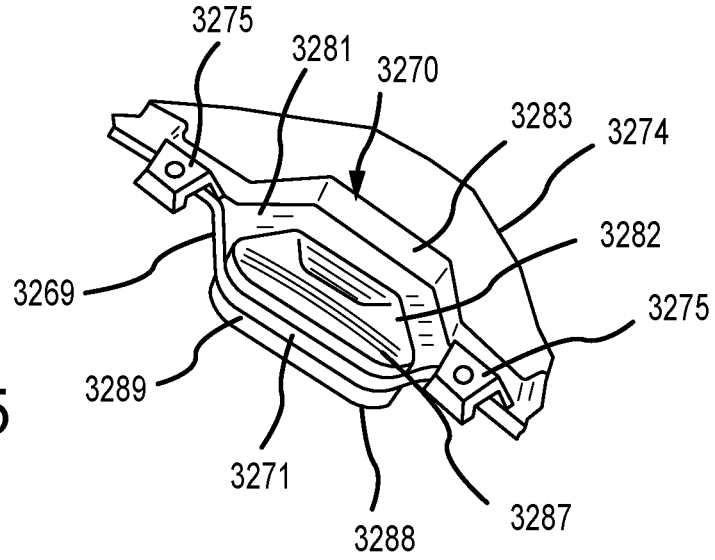
FIGS. 75-77 are perspective views of alternate golf club heads having adjustable weighting systems.

As illustrated in FIG. 74, the recessed portion 3280 is positioned on a portion of a sole or bottom 3230 of the club head 3210. The recessed portion 3280 is generally along the back portion perimeter of the club head 3210. The recessed portions 3280 comprises a portion of a heel end 3222, a portion of a rear 3276, and a portion of a toe end 3218 of the club head 3210 of the sole 3230 wherein the recessed portion 3280 forms a U-shape on the sole 3230. In other embodiments, the recessed portion 3280 can form other shapes as well. The recessed portion 3280 comprises a recessed surface 3281. In some embodiments, the recessed portion 3280 may comprise a recessed surface 3281 along a crown or top of the club head 3210. The recessed surface 3281 is separated from a remainder of an outer surface 3274 of the sole 3230 by a wall 3283 (FIG. 75). As illustrated in FIG. 75, the wall 3283 is, at least along portions thereof, perpendicular (or in some embodiments inclined/declined at a different angle) to the recessed surface 3281.

In many embodiments, the recessed portion 3280 includes a plurality of discrete attachment locations. The plurality of discrete attachment locations can comprise various features 3270 including protruding bodies, apertures or recesses or ports capable of receiving a fastener, notches or tabs or cutout regions, ribs or grooves, pegs, hooks, magnets, programmable magnets, or any other suitable attachment means. The features 3270 of the recessed portion 3280 are defined as indentations within the wall 3283 adjacent a trailing edge 3272, wherein the features 3270 can comprise a portion of the wall 3283. The features 3270 define a discrete attachment location for securing the weight 3282 to the club head 3210. In contrast to other adjustable weighting systems wherein the weight can be coupled at any, or at an infinite, or at an unlimited number of locations across the recessed portion. In one embodiment as illustrated in FIGS. 74 and 75, each of the features 3270 form an indent with three walls from the wall 3283, wherein a profile of each feature 3270 is a trapezoidal shape. In other embodiments, each of the features 3270 form an indent with any number of walls (e.g., two, three, four, five, six, or seven walls), wherein each of the features 3270 is any profile shape (e.g., triangular, square, trapezoidal, rectangular, pentagonal, hexagonal, heptagonal, or octagonal). In other embodiments, the features 3270 can form one singular curved wall into the wall 3283, wherein the indent is a partial circle. In the illustrated embodiment, the recessed portion 3280 includes four features 3270, a first feature 3270A near the toe end 3218, a second feature 3270D near the heel end 3222, a third feature 3270B between the first feature 3270A and the second feature 3270D, and a fourth feature 3270C between the second feature 3270D and the third feature 3270B. Although, other embodiments can comprise different numbers of features 3270 (e.g., one feature 3270, two features 3270, three features 3270, four features 3270, five features 3270, six features 3270, seven features 3270, eight features 3270, etc.).

In one embodiment, two of the features 3270 are located generally at the heel end 3222 of the club head 3210, and the remaining two features 3270 are located generally at the toe end 3218 of the club head 3210, wherein the position of the features 3270 is symmetrical from the heel end 3222 to the toe end 3218. In other embodiments, the position of the features 3270 is not symmetrical. In other embodiments still, the recessed portion 3280 can comprise any number combination of features on the heel end 3222, and the toe end 3218. For example, the recessed portion 3280 can comprise two features 3270 in the heel end 3222 and one feature on the toe end 3218, or the recessed portion 3280 can comprise three features 3270 on both the heel end 3222, and the toe end 3218.

Figure 76:
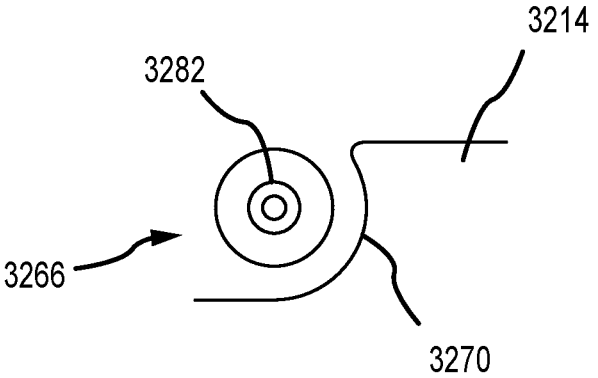
Figure 77:
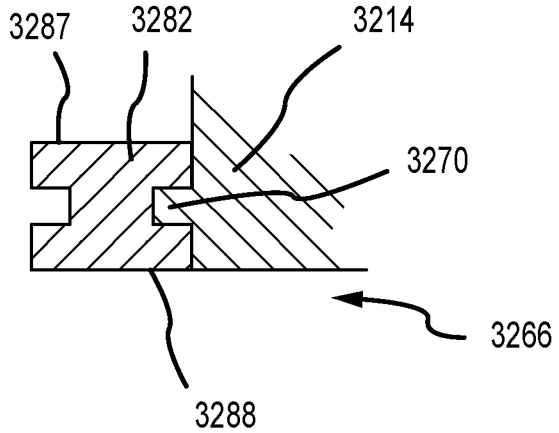

The features 3270 are configured to receive weights 3282. The different positions of the features 3270 in the recessed portion 3280 allow for adjustment of the center of gravity based on the different positioning and distribution of the weights 3282. The weights 3282 comprise a top surface 3287, a bottom surface 3288, and sidewalls 3289. The weights 3282 further comprise a general cross-sectional shape such as a cylinder, a triangular prism, a cube, a rectangular prism, a pentagonal prism, a hexagonal prism, or etc. In some embodiments as illustrated in FIG. 77, the weights 3282 can comprise an I-beam like cross-sectional shape. In other embodiments as illustrated in FIG. 76, the weights 3282 can comprise a circular cross-sectional shape. In many embodiments, the cross-sectional shape of the weights 3282 are complimentary to the profile shape of the features 3270. As illustrated in FIG. 74, the club head 3210 comprises one weight 3282. In other embodiments, the club head 3210 can comprise more than one weight 3282, such as one weight 3282, two weights 3282, three weights 3282, four weights 3282, five weights 3282, six weights 3282, seven weights 3282, or eight weights 3282.

The weights 3282 further comprise a mass. The mass of the weights 3282 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3282 can be 3 grams, 6 grams, 9 grams, 12 grams, 15 grams, 18 grams, 21 grams, 24 grams, 27 grams, 30 grams, 33 grams, or 35 grams. In embodiments wherein the club head 3210 comprises multiple weights 3282, the weights 3282 can all comprise the same mass, or all have different masses. For example, the club head 3210 comprises three weights 3282 with the first weight 3282 having a mass of 12 grams, and both the second and third weights 3282 having a mass of 5 grams. In another example, the club head 3210 comprises four weights 3282 with the first weight 3282 having a mass of 20 grams, the second weight 3282 having a mass of 15 grams, the third weight 3282 having a mass of 10 grams, and the fourth weight 3282 having a mass of 7 grams.

The weights 3282 can further comprise a groove 3271. The groove 3271 is positioned on one of the sidewalls 3289 of the weights 3282. The groove 3271 is oriented parallel to the top and bottom surface 3287 and 3288. The grooves 3271 comprise a partial circle shape. In other embodiments, the weights 3282 is void of the groove 3271 and can comprise an aperture extending through a center of the weights 3282 instead. The apertures is oriented parallel to the top and bottom surface 3287 and 3288. The groove 3271 or aperture are configured to receive the cable 3269 of the adjustable weighting system 3266. In other embodiments (not pictured), the weights 3282 can be void of the groove 3271 and comprise ribs configured to receive the cable 3269.

The adjustable weighting system 3266 is positioned within the recessed portion 3280 on the sole 3230 of the club head body 3214. As stated above, the adjustable weighting system 3266 comprises the tensioner 3267 and the cable 3269 configured to be attached to the tensioner 3267. As illustrated in FIG. 74, the tensioner 3267 is positioned in a general center adjacent the trailing edge 3272 on the recessed surface 3281. In other embodiments the tensioner 3267 can be positioned at other locations on the recessed surface 3281 (e.g., near the toe end 3218, near the heel end 3222, more central on the sole 3230 distal from the trailing edge 3272, etc.). The tensioner 3267 can be attached to the club head 3210 by way of fastener, protrusions, hooks, adhesive or by other attachment means. When the tensioner 3267 is attached to the recessed portion 3280 of the club head 3210, the tensioner 3267 does not extend past the lowest point of the club head 3210 when at address. In some embodiments, the tensioner 3267 can be flush with the outer surface 3274 of the sole 3230.

In some embodiments, the tensioner 3267 acts as a winch and ratchet mechanism, wherein the winch and ratchet mechanism reels in a cable and comprises an automatic locking system when it rotates clockwise, preventing counterclockwise movement without user input. The tensioner 3267 is configured to be attached to the cable 3269. The tensioner 3267 can be rotated to manipulate the amount of the cable 3269 is free, wherein when the tensioner 3267 is rotated clockwise, the cable 3269 winds up around the tensioner 3267. The winch and ratchet mechanism prevents the tensioner from rotating counterclockwise, therefore preventing the cable 3269 from unwinding.

Figure 74A:
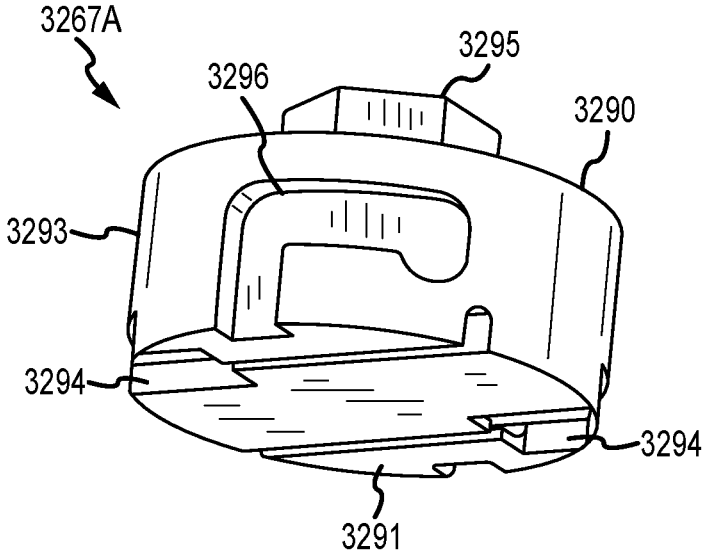
FIG. 74A is a perspective view of a tensioner mechanism for the golf club head of FIG. 74.
Figure 74A:
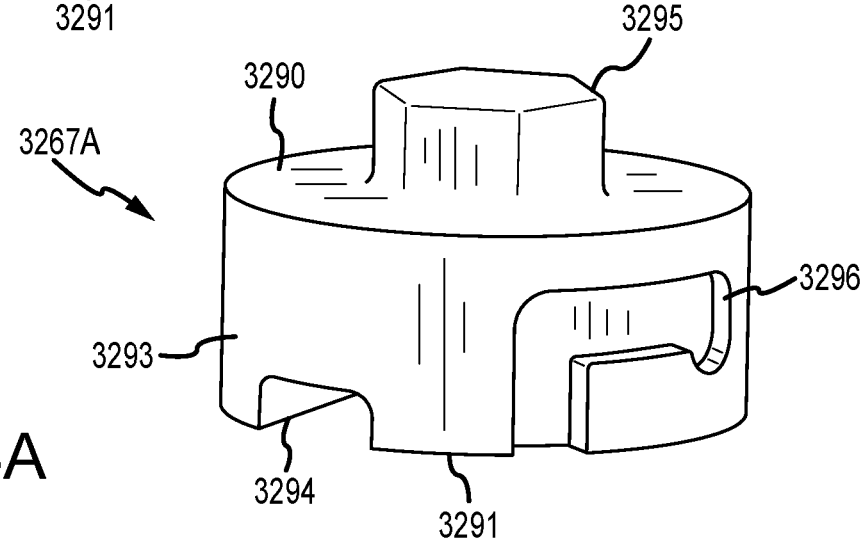

In other embodiments, the adjustable weighting system 3266 can comprise a tensioner, wherein the tensioner is a J-slot tensioner 3267A as illustrated in FIG. 74A. The J-slot tensioner 3267A comprises a top surface 3290, a bottom surface 3291, and a side surface 3293. The bottom surface 3291 of the J-slot tensioner comprises cable receiving geometry 3294, configured to receive the cable 3269. As illustrated, the top surface 3290 comprises a protrusion 3295 configured to receive a tool (not shown) to rotate the J-slot tensioner 3267A. In other embodiments, the top surface 3290 can comprise a protrusion 3295 of any shape, or can comprise a bore, or blind aperture configured to receive any rotating tool. The side surface 3293 of the J-slot tensioner 3267A comprises two J-slot 3296 (one on the opposite side of the other, and in inversed directions) extending upward from the bottom surface 3291, continuing laterally parallel to the top and bottom surfaces 3290 and 3291, and extending slightly downward toward the bottom surface 3291, forming a "J" shape. The J-slot tensioner 3267A and the cable 3269 can be coupled to the club head 3210 at a tensioner housing (not pictured), wherein a spring washer (not pictured) is disposed between the club head 3210 and the J-slot tensioner 3267A. The protrusions of the tensioner housing is configured to be received within the J-slots 3296. The spring washer pushes on the J-slot tensioner 3267A, wherein the protrusion of the tensioner housing prevents the J-slot tensioner 3267A from rotating (first orientation). The J-slot tensioner 3267A can be pressed downward and rotated clockwise to tighten the cable 3269. The spring washer then pushes on the J-slot tensioner 3267A, wherein the protrusions of the tensioner housing is positioned at the end of the J-slot 3296, preventing the J-slot tensioner 3267A from rotating (second configuration). The J-slot tensioner 3267A can be incorporated into any of the adjustable weighting systems defined hereon after comprising a cable to secure the weights.

The cable 3269 of the adjustable weighting system 3266 is configured to be receive by the tensioner 3267, and runs along the wall 3283 of the recessed portion 3280, held in place by guide elements 3275. The cable 3269 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3269 can be made of baling twine, parachute cord material, nylon, Kevlar, polymer tweed, steel wire with polymer coating, any metallic wire with polymer coating or etc.

In some embodiments, as illustrated in FIGS. 74 and 75, the club head body 3210 includes one or more guide elements 3275 (e.g., hooks, protrusions, rails etc.) that receive and guide the cable 3269 along the features 3270, and retain the cable 3269 within the recessed portion 3280. The guide elements 3275 extend from the wall 3282 toward the recessed surface 3281. The guide elements 3275 are disposed between each of the features 3270. In the illustrated embodiment, the club head body 3210 comprises six guide elements 3275. In other embodiments, the club head body can comprise less than, or more than six guide elements 3275 (e.g., one guide element 3275, two guide elements 3275, three guide elements 3275, four guide elements 3275, five guide elements 3275, six guide elements 3275, seven guide elements 3275, eight guide elements 3275, nine guide elements 3275, or ten guide elements 3275).

The tensioner 3267 can be rotated (e.g., twisted) in increments to adjust a tension in the cable 3269. When the tensioner 3267 is rotated clockwise, the cable 3269 winds around the tensioner 3267 and is tightened, increasing the cable tension. The tightened cable 3269 presses on the groove 3271 of the weights 3282. The sidewalls 3289 of the weights 3282 abut against the features 3270, wherein the weights 3282 can be flush with the outer surface 3274 of the sole 3230. In other embodiments, when the sidewalls 3289 of the weights 3282 abut against the features 3270, the weights 3282 can extend past the outer surface 3274 of the sole 3230, however, still do not extend past the lowest point of the club head 3210 when at address. In other embodiments still, when the sidewalls 3289 of the weights 3282 abut against the features 3270, the weights 3282 do not extend to, or past the outer surface 3274 of the sole 3230. In other embodiments, the cable 3269 can be retracted by other means other than by the tensioner 3267.

When the tensioner 3267 is in a released orientation (i.e., pressed downward, or pulled upward), the cable 3269 unwinds from the tensioner 3267, wherein the tension in the cable 3269 decrease. As the tension in the cable 3269 decreases, the cable 3269 loosens and the weights 3282 are no longer pressed against the features 3270. The weights 3282 can then be repositioned by an end user to different features 3270 in the recessed portion 3280 and secured into place by manipulating the tensioner 3267 as stated above. In embodiments where the weights 3282 comprise an aperture instead of the groove 3271, the weights 3282 can be slid along the cable 3269 to reposition the weights 3282, without being removed from the cable 3269. Repositioning the weights 3282 reconfigures the center of gravity (CG) of the club head 3210. For example, the weights 3282 can be positioned in the second feature 3270D near the toe end 3218 to shift the CG toward the toe end 3218 to correct ball trajectory for players who are typically slice a ball. For another example, the weights 3282 can be positioned in the feature 3270A near the heel end 3222 to shift the CG toward the heel end 3222 to correct ball trajectory for players who typically hook the ball.

In some embodiments, the tensioner 3267 is in a naturally locked position wherein the tensioner 3267 can be pressed downward to engage rotational movement of the winch and ratchet mechanism in order to loosen the cable 3269. Similar to the description above, the tensioner 3267 can be rotated clockwise to tighten and generate a desired tension to hold the weight or weights 3282 in place in the features 3270. To loosen the cable and release the tension from the weights 3282, the tensioner 3267 pressed downward toward the club head 3210. When the tension is released (i.e., when the cable 3269 is loosen/extended), the cable 3269 can be removed from the groove 3271 of the weight or weights 3282, and the weight or weights 3282 can then be removed entirely from the club head 3210. The weight or weights 3282 can then be repositioned into a different feature 3270 along the club head 3210, in order to change the CG of the club head 3210. When the weight or weights 3282 are positioned into place within the features 3270, the tensioner 3267 can be pulled upward and rotated clockwise to tighten the weights 3282. The tensioner 3267 is automatically locked and is prevented in rotating counterclockwise (i.e., unwinding the cable 3269). In other embodiments, the tensioner 3267 is in a naturally locked orientation, wherein the tensioner 3267 is pulled upward to engage the rotational movement of the winch and ratchet mechanism to loosen the cable 3269. In other embodiments, a tool is required to rotate the tensioner 3267 to release and/or increase tension in the cable 3267.

The club head 3210 having the adjustable weighting system 3266 comprising the tensioner 3267 (or other cable adjustment means) and the cable 3269 described above can optimize the performance of the golf club. The adjustable weighting system 3266 allows for the club head 3210 to adjust the already low and back CG about the x-axis (heel-to-toe end) without having to sacrifice a relatively high moment of inertia (MOI) similar to that of a club head void of an adjustable weight system. Shifting the CG about the x-axis allows for players to correct a slice or a hook in ball trajectory.

The club head 3210 having the tensioner 3267 and the cable 3269 adjustable weight system 3266 further has an utility regarding ease of manufacturing compared to club heads with more complex structures to house a weight (i.e., deep weight ports, multiple weight ports, rail systems, weight covers/caps). The weight(s) 3282 coupled to the club head 3210 are secured by the tension of the cable 3269, which create a friction between a surface of the weight(s) 3282 and the recessed surface 3281 of the club head 3210. The tension and frictional force eliminates the need for the club head 3210 to be manufactured with a weight housing structure having complex internal/external geometries in order to secure the weight(s) 3282. Thereby reducing the material and mass associated with the complex weight housing structure. The mass saved from the lack of the weight housing structure can then be positioned elsewhere on the club head 3210 to increase strength and/or mass in that location. The tension and friction created by the cable 3269 further eliminates the need for screw-type fasteners, thus the weight(s) 3282 and club head 3210 do not require manufacturing a threaded aperture to receive the fastener. The lack of the screw-type fastener and threaded aperture reduces the cost of manufacturing and increase production.

Further, the cable 3269 of the adjustable weighting system 3266 is lightweight, strong, and can be incorporated in a number of different patterns on an outer surface 3274 of the club head 3210. The different patterns allows for the weight (s) 3282 to be place in a number of different locations on the sole 3230 because the weight(s) 3282 are not limited to specific weight housing structures. The number of different weight positions can help fine tune the CG placement to adjust the ball spin and trajectory for individual players. The cable 3269 can further be strategically placed in such a pattern that the cable 3269 can reinforce specific locations on the club head 3210. The material and pattern of the cable 3269 can further still act as a sound dampener and absorb vibration experienced by the club head 3269 during impact, thereby reducing unwanted sound, and unwanted stress during a game.

The adjustable weighting system 3266 of golf club head 3210 maintains or prevents a significant reduction in club head moment of inertia, and low and back club head center of gravity positioning, compared to a club head devoid of an adjustable weighting system. The adjustable weighting system 3266 of golf club head 3210 maintains a high club head moment of inertia and a low and back club head CG position due to the low profile of the weighting system and the perimeter positioning of the one or more weights. The club head 3210 having the adjustable weighting system 3266 can have similar or identical parameters and measurements as club head 100 described above.

FIGS. 78-81 illustrate a club head 3310 having a club head body 3314. The club head 3310 includes an adjustable weighting system 3366 positioned comprising a cable 3369 and a tensioner 3367 that is adjustable by an end user to modify the club head 3310 center of gravity and/or moment of inertia and/or heel/toe bias to achieve desired performance characteristics (e.g., forgiveness, spin, trajectory) under various circumstances. The adjustable weighting system 3366 is a low profile system and thereby does not significantly shift or change the club head 3310 MOI when compared to a club head not including the adjustable weighting system 3366. Further, the low profile adjustable weighting system 3366 ensures that shifts in the club head 3310 CG occur mainly in a heel end 3322 to toe end 3318 direction keeping the overall club head 3310 CG in a low and back location.

Figure 78:
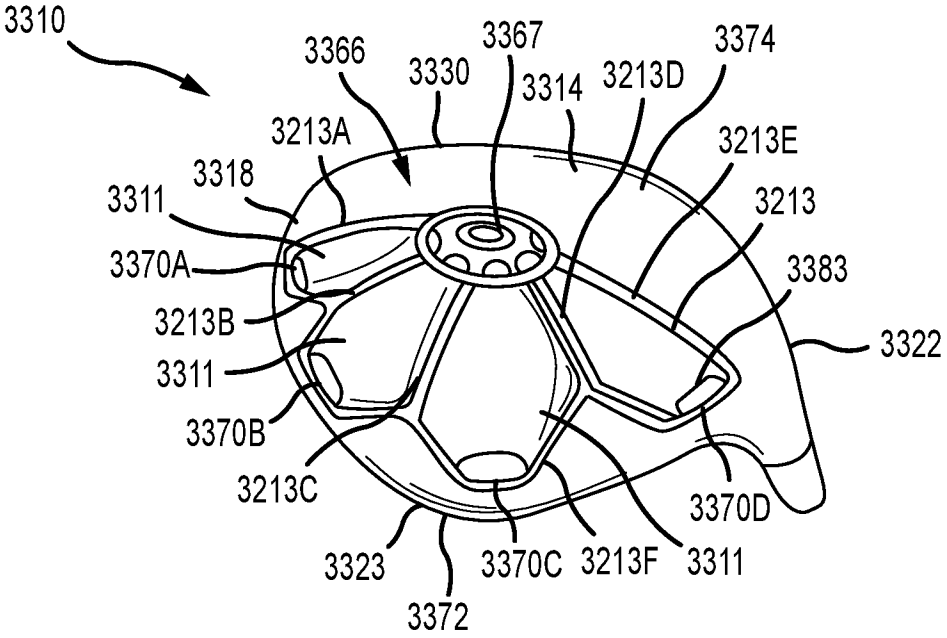
Figure 81:
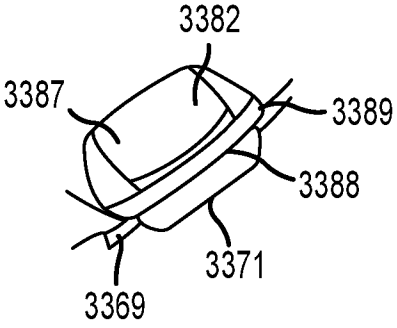
Figure 80:
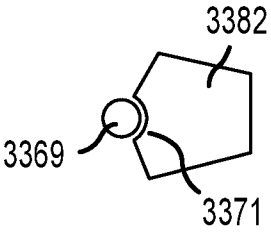

The adjustable weighting system 3366 is positioned on a sole 3330 of the club head 3310. As illustrated in FIG. 78, the sole 3330 of the club head 3310 comprises a plurality of channels 3213 that are interconnected. In some embodiments, the channels 3213 extend radially from a central location on the sole 3330 toward a trailing edge 3372 of the golf club head 3310 near a toe end 3318, a rear 3323, and a heel end 3222. In other embodiments, the channel 3213 can extend radially from any location on the sole 3330 toward the trailing edge 3372 of the golf club head 3310. The channels 3213 are connected proximal the trailing edge 3372 in a zigzag like pattern, wherein the channels 3213 form polygonal sectioned portions 3311. In many embodiments, the outer surface of the polygonal sectioned portions 3311 is flush with the outer surface 3374 of the sole 3330. In other embodiments, the polygonal sectioned portions 3311 are raised portions extending past the contour of the outer surface 3374 of the sole 3330, however, does not extend past the lowest portion of the club head 3310 when at address. The channels 3213 are separated from the polygonal sectioned portions 3311 and the remainder of the sole 3330 by a wall 3383. The wall 3383 is, at least a portion thereof, perpendicular (or in some embodiments inclined/declined at a different angle) to the channels 3213. In the illustrated embodiment, the club head 3310 comprises six channels 3213, with five of the six channels 3213 extending radially. In this embodiment, a first channel 3213A is positioned near the toe end 3318, a second channel 3213E is positioned near the heel end 3322, a third channel 3213B positioned between the first channel 3213A and the second channel 3213E, a fourth channel 3213D positioned between the second channel 3213E, a fifth channel 3213C positioned between the third channel 3213B, the fourth channel 3213D, and a sixth channel 3213F (or trailing edge channel 3213F) interconnecting all the radially extending channels 3213. In other embodiments, the club head 3310 can comprise any number of channels 3213, such as one channel 3213, two channels 3213, three channels 3213, four channels 3213, five channels 3213, six channels 3213, seven channels 3213, eight channels 3213, or nine channels 3213.

Figure 79:
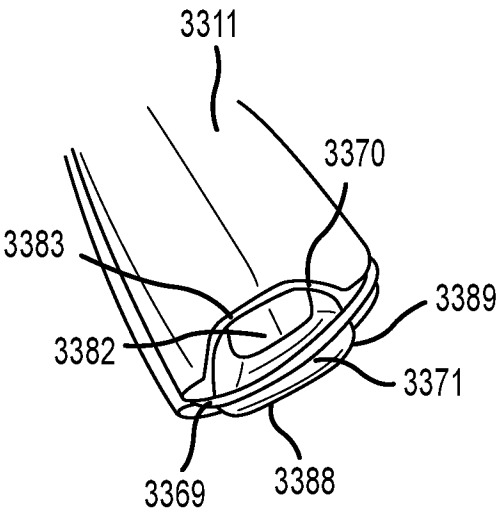
FIGS. 78-81 are perspective views of a golf club head according to another embodiment.

In many embodiments, the channels 3213 system includes a plurality of discrete attachment locations. The plurality of discrete attachment locations can comprise various features 3370 including protruding bodies, apertures or recesses or ports capable of receiving a fastener, notches or tabs or cutout regions, ribs or grooves, pegs, hooks, magnets, programmable magnets, or any other suitable attachment means. The features 3370 define a discrete attachment location for securing the weight 3382 to the club head 3310. In contrast to other adjustable weighting systems wherein the weight can be coupled at any, or at an infinite, or at an unlimited number of locations across the recessed portion. The features 3370 of the channels 3213 are defined as indentations within the walls 3383 of the channel 3213 near the trialing edge 3372. As illustrated in FIGS. 78 and 79, each of the features 3370 form an indent with three walls within the wall 3383, wherein each feature 3370 has a profile of a trapezoidal shape. In other embodiments, each of the features 3370 form an indent with any number of walls within the wall 3383 to form a profile shape (e.g., triangular, square, trapezoidal, rectangular, rectangular, pentagonal, hexagonal, heptagonal, or octagonal). In other embodiments, the features 3370 can form one singular curved wall into the wall 3383, wherein the indent is a partial circle. In the illustrated embodiment, the adjustable weighting system 3366 includes four features 3370, a first feature 3370A near the toe end 3318, a second feature 3370D near the heel end 3322, a third feature 3370B between the first feature 3370A and the second feature 3370D, and a fourth feature 3370C between the second feature 3370D and the third feature 3370B. Although other embodiments include different numbers of features 3370 (e.g., one feature 3370, two features 3370, three features 3370, four features 3370, five features 3370, six features 3370, seven features 3370, or eight features 3370, etc.).

In some embodiments, the features 3370 can be positioned at the wall 3383 of the channel 3213 adjacent the trailing edge 3372. In other embodiments, the features 3370 can be positioned at the wall 3383 adjacent the polygonal sectioned portions 3311 as illustrated in FIG. 78. In other embodiments still, the features 3370 can be positioned in a combination at the wall 3383 adjacent the trailing edge 3372, and at the wall 3383 adjacent the polygonal sectioned portions 3311. In one embodiment, the features 3370 can be spaced evenly apart, wherein the position of the feature 3370 is symmetrical from the toe end 3318 to the heel end 3322. For example, two of the features 3370 are located generally at the heel end 3322 of the club head 3310, and two of the features 3370 are located generally at the toe end 3318 of the club head 3310. In other embodiments, the position of the features 3370 is asymmetrical, wherein the features 3370 can be positioned more near the toe end 3318, more near the heel end, 3322, or more near the rear 3323. For example, the channel 3213 can comprise three features 3370 near the heel end 3322, and one feature 3370 near the toe end 3318. The different positions of the features 3370 allow for adjustment of the CG based on the different positioning and distribution of the weights 3382.

The weights 3382 of the club head 3310 can be similar to the weights 3282 of the club head 3210. The weights 3382 are configured to be received within the features 3370 of the channels 3213. The weights 3382 comprise a top surface 3387, a bottom surface 3388, and sidewalls 3389. The weights 3382 further comprise a general cross-sectional shape such as a cylinder, a triangular prism, a cube, a rectangular prism, a pentagonal prism, a hexagonal prism, or etc. In many embodiments, the cross-sectional shape of the weights 3382 are complimentary to the profile shape of the features 3370. The club head 3310 can comprise any number of weight 3382. For example, in some embodiments, the club head 3310 can comprise one weight 3382, two weights 3382, three weights 3382, four weights 3382, five weights 3382, six weights 3382, seven weights 3382, or eight weights 3382. When the weights 3382 are positioned in the features 3370, the weights 3382 are flush with the outer surface 3374 of the sole 3330. In other embodiments, when the weights 3382 are positioned in the features 3370, the weight 3382 can extend past the outer surface 3374 of the sole 3330, but not past the lowest point of the club head 3310 is at address. In other embodiments still, the weight 3382 does not extend to or past the outer surface 3374 of the sole 3330.

The weights 3382 further comprise a mass. The mass of the weights 3382 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3382 can be 3 grams, 6 grams, 9 grams, 12 grams, 15 grams, 18 grams, 21 grams, 24 grams, 27 grams, 30 grams, 33 grams, or 35 grams. In embodiments wherein the club head 3310 comprises multiple weights 3382, the weights 3382 can all comprise the same mass, or all have different masses. For example, the club head 3310 comprises three weights 3382 with the first weight 3382 having a mass of 12 grams, and both the second and third weights 3382 having a mass of 5 grams. In another example, the club head 3310 comprises four weights 3382 with the first weight 3382 having a mass of 20 grams, the second weight 3382 having a mass of 15 grams, the third weight 3382 having a mass of 10 grams, and the fourth weight 3382 having a mass of 7 grams.

The weight 3382 can further comprise a groove 3371. The groove 3371 is positioned on one of the sidewalls 3389 of the weights 3382, oriented parallel to the top and bottom surface 3387 and 3388, and is configured to receive the cable 3369. In some embodiments the groove 3371 has a C-shaped (or other shaped) contour, so as to retrieve and facilitate retention of the cable 3369.

The adjustable weighting mechanism 3366 comprises the tensioner 3367 and the cable 3369. The tensioner 3367 is positioned in a general center location on the sole 3330, disposed at a junction of where the channels 3213 radially extend. Although in other embodiments the tensioner 3367 can be positioned at other locations along the sole 3330 of the club head 3310, as long as the tensioner 3367 is disposed at a junction of wherein the channels 3213 radially extend. The tensioner 3367 can be attached to the club head 3310 by way of fastener or by an adhesive. When the tensioner 3367 is attached to the club head 3310, the tensioner 3367 does not extend past the lowest part of the club head 3310 when at address, thereby not obstructing a player's swing. In other embodiments, the tensioner 3367 can be flush with the outer surface 3374 of the sole 3330.

The cable 3369 of the adjustable weighting system 3366 is similar to the cable 3269 of the adjustable weighting system 3266 (e.g., material, etc.). The cable 3369 is configured to be received be the tensioner 3367 and the channels 3213. In FIG. 78, the cable 3369 is receive within the first channel 3213A, along the trailing edge channel 3213F, and within the second channel 3213E, wherein the inner channels 3213 (third fourth, and fifth channels 3213B, 3213C, and 3213D) are void of the cable 3369. In other embodiments, the inner channels 3213 (third fourth, and fifth channels 3213B, 3213C, and 3213D) comprise a protrusion the entire length of the inner channels 3213. In other embodiments, the cable 3369 can be repositioned to be receive by any of the inner channels 3213. For example, a club head 3310 comprising five channels 3213 extending radially from the tensioner 3367, and the cable 3369 is positioned in the first channel 3213A, in the trailing edge channel 3213F, and in the fourth channel 3213D. The cable 3369 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3369 can be made of baling twine, parachute cord material, nylon, Kevlar, polymer tweed, steel wire with polymer coating, any metallic wire with polymer coating or etc.

The tensioner 3367 is similar to the tensioner 3267 of the club head 3210, wherein the tensioner acts as a winch and ratchet mechanism configured to receive the cable 3369. In other embodiments, the tensioner 3367 can be a J-slot tensioner similar to J-slot tensioner 3267 as described above. When the cable 3369 is coupled to the tensioner 3367, the tensioner 3367 can be rotated (e.g., twisted) in increments to adjust a tension in the cable 3369. The cable 3369, in turn, is coupled to (to include being pressed against) the groove 3371 or aperture of the weights 3382, and extends within one or more of the various channels 3313 defined along the bottom or sole 3330. When the tensioner 3367 is rotated clockwise, the cable 3369 is tightened, and the cable 3369 presses the weight or weights 3382 creating a force firmly against the weight or weights 3382 on the walls 3383 of the club head body 3310, wherein the sidewalls 3389 of the weight or weights 3382 abut the walls of the features 3370. As illustrated in FIGS. 78 and 79, each weight 3382 has a shape and size that generally complements the shape and size of the feature 3370, such that surfaces of the weight 3382 fit tightly against the wall 3383 and prevents the weights 3382 from shifting within the channel 3213. In other embodiments, the cable 3369 can be tightened by other means other than by the tensioner 3367.

The tensioner 3367 can (pulled upward and/or pressed downward) to decrease the tension in the cable 3369. As the tension decreases in the cable 3369, the cable loosens and the weights 3382 can then be repositioned (or slid for the weights 3382 with the apertures) to different features 3370 on the sole 3330 to adjust the CG. For example, the weights 3382 can be repositioned to from the third feature 3370B to the second feature 3370D near the heel end 3322 to correct ball flight for a player who typically hooks the ball. In some embodiments, during adjustment of the weight 3382, a portion of the cable 3369 can be moved to a different channel 3313, depending upon a number of weights 3282 being used. In other embodiments, the cable 3369 can be loosen by other means other than by the tensioner 3367.

In some embodiments, the tensioner 3367 is naturally in a locked position, wherein the tensioner 3367 is pressed downward to engage the winch and ratchet mechanism to loosen the cable 3369. When the tension is released (e.g., when the cable 3369 is extended), the cable 3369 may be removed from the groove 3371 of the weight 3382, and the weight 3382 may then be removed entirely from the club head 3310. The weight 3382 can than be repositioned into a different, discrete feature 3370 along the club head 3310, in order to change a CG of the club head 3310. In other embodiments, the tensioner is naturally in a locked position, wherein the tensioner 3367 is pulled upward to engage the winch and ratchet mechanism to loosen the cable 3369. In other embodiments, a tool is required to engage and rotate the tensioner 3367 and/or to release tension in the cable 3367.

The club head 3310 having the adjustable weighting system 3366 comprises the tensioner (or other adjustment means) and the cable described above can optimize the performance of the golf club. The adjustable weighting system 3366 allows for the club head 3310 to adjust the already low and back center of gravity about the x-axis (heel-to-toe end), and about the y-axis (strikeface-to-rear) without having to sacrifice a relatively high (MOI) similar to that of a club head void of an adjustable weight system. Shifting the CG about the x-axis allows for players to correct a slice or a hook in ball trajectory, while shifting the CG about the y-axis allows for players to control the spin imparted on a ball.

The club head 3310 having the tensioner 3367 and the cable 3369 adjustable weight system 3366 further have an utility regarding ease of manufacturing compared to club heads with more complex structures to house a weight (i.e., deep weight ports, multiple weight ports, rail systems, weight covers/caps). The weight(s) 3382 coupled to the club head 3310 are secured by the tension of the cable 3369, which create a friction between the surfaces of the weight(s) 3382 and a surface of the features 3370. The tension and frictional force eliminates the need for the club head 3310 to be manufactured with a weight housing structure having complex internal/external geometries in order to secure the weight(s) 3382. Thereby reducing the material and mass associated with the complex weight housing structure. The mass saved from the lack of the weight housing structure can then be positioned elsewhere on the club head 3310 to increase strength and/or mass in that location. The tension and friction created by the cable 3369 further eliminates the need for screw-type fasteners, thus the weight(s) 3382 and the club head 3310 do not require manufacturing a threaded aperture to receive the fastener. The lack of the fastener and threaded aperture reduces the cost of manufacturing and increase production.

Further, the cable 3369 of the adjustable weighting system 3366 is lightweight, strong, and can be incorporated in a number of different patterns on the outer surface 3374 of the club head 3310. The different patterns allows for the weight (s) 3382 to be place in a number of different locations on the sole 3330 because the weight(s) 3382 are not limited to specific weight housing structures. The number of different weight positions can help fine tune the CG placement to adjust the ball spin and trajectory for individual players. The cable 3369 can further be strategically placed in such a pattern that the cable 3369 can reinforce specific locations on the club head 3310. The material and pattern of the cable 3369 can further still act as a sound dampener and absorb vibration experienced by the club head 3310 during impact, thereby reducing unwanted sound, and unwanted stress during a game.

The adjustable weighting system 3366 of golf club head 3310 maintains or prevents a significant reduction in club head moment of inertia, and low and back club head center of gravity positioning, compared to a club head devoid of an adjustable weighting system. The adjustable weighting system 3366 of golf club head 3310 maintains a high club head moment of inertia and a low and back club head CG position due to the low profile of the weighting system and the perimeter positioning of the one or more weights. The club head 3310 having the adjustable weighting system 3366 can have similar or identical parameters and measurements as club head 100 described above.

Figure 82:
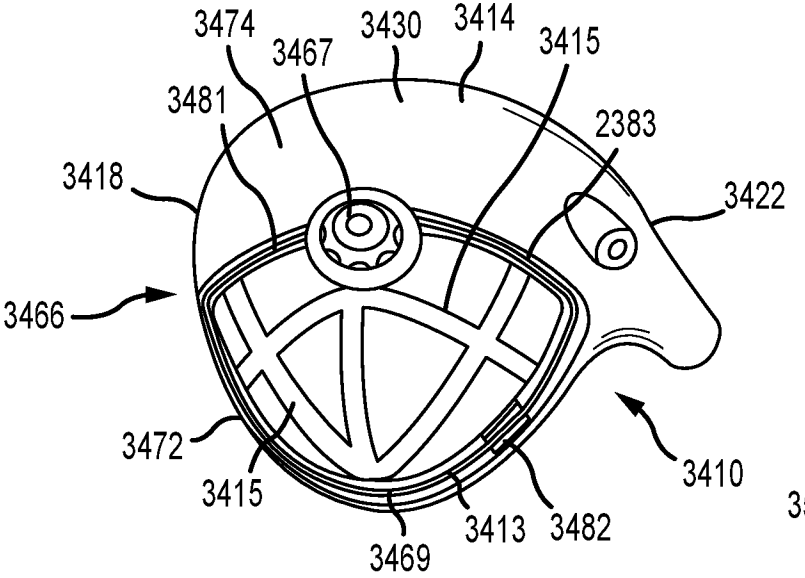
FIG. 82 is a perspective view of a golf club head according to another embodiment.

FIG. 82 illustrates a club head 3410 having a club head body 3414. The club head 3410 includes an adjustable weighting system 3466 comprising a cable 3469 and a tensioner 3467 that is adjustable by an end user to modify the club head 3410 center of gravity and/or moment of inertia and/or heel/toe bias to achieve desired performance characteristics (e.g., forgiveness, spin, trajectory) under various circumstances. The adjustable weighting system 3466 is a low profile system and thereby does not significantly shift or change the club head 3410 MOI when compared to a club head not including the adjustable weighting system 3466. Further, the low profile adjustable weighting system 3466 allows shifts in the club head 3410 CG to occur in a heel end 3422 to toe end 3418 direction keeping the overall club head 3410 CG in a low and back location. The low profile adjustable weighting system 3466 allows shifts in the club head 3410 CG to occur about a y-axis (front to rear) to adjust the ball spin.

The adjustable weighting system 3466 is positioned on a sole 3430 of the club head 3410. As illustrated in FIG. 82, the sole 3430 comprises a channel 3413 and a plurality of visual details 3415. The channel 3413 is shallow and lightweight compared to other channels having tracks and deep weight housings. The channel 3413 extends from a generally central location on the sole 3430 of the club head 3410, toward a toe end 3418, along a trailing edge 3472 toward a heel end 3422, and back toward the general central location on the sole 3430. The channel 3413 comprises channel wall 3483, and a channel floor 3481. In some embodiments, the channel walls 3483 are, at least a portion thereof, perpendicular (or in some embodiments inclined/declined at a different angle) to the channel floor 3481. In other embodiments, the channel walls 3483 and the channel floor 3481 are one continuous wall wherein the cross-section of the channel 3413 is a partial circle or partial ellipse. The channel 3413 is configured to receive weights 3482, and the cable 3469.

In some embodiments, the visual details 3415 of the club head 3410 can be aesthetic lines flush with the surface of the sole. In other embodiments, the visual details 3415 can be raised lines extending from the outer surface 3474 of the sole 3430. In other embodiments still, the visual details 3415 can be indentations or grooves into the outer surface 3474 of the sole 3430. In the embodiments wherein the visual details 3415 are grooves, the visual details 3415 can be configured to receive the weights 3482 and the cable 3469.

Illustrated in FIG. 82. The club head 3410 comprises one weight 3482. In other embodiments, the club head 3410 comprises any number of weights 3482 such as one weight 3482, two weights 3482, three weights 3482, four weights 3482, five weights 3482, six weights 3482, seven weights 3482, or eight weights 3482. The weights 3482 can be similar to the weights 3282, and 3382 as described above. The weights 3482 comprises a generally elongated structures having a top surface, a bottom surface, a first end, a second end, and sidewalls. In some embodiments, the weight 3482 further comprising a general square cross-section. In other embodiments, the weight 3482 can have other cross-sectional shapes such as a trapezoid, or any four sided polygonal shape, any number sided polygonal shape, or a circle. In many embodiments, the cross-sectional shape of the weight 3482 is complementary to the cross-sectional shape of the channel 3413, wherein the bottom surface, and sidewalls of the weight 3482 abut against the channel walls 3483 and the channel floor 3481.

In many embodiments, the weights 3482 further comprises a groove (not pictured). The groove is positioned on the top surface of the weights 3482, extending in a direction from the first end to the second end of the weights 3482. The groove of the weights 3482 is configured to receive the cable 3469. In other embodiments, instead of the groove, the weights 3482 can comprise an aperture (not pictured) extending through the center from the first end to the second end of the weights 3482. The aperture of the weights 3482 is configured to receive the cable 3469.

In some embodiments, the weights 3482 can further comprise a friction member (not pictured). The friction member is positioned on the bottom surface of the weights 3482. In other embodiments, the friction member can be positioned on the sidewalls of the weights 3482. In other embodiments still, the friction member can be positioned on a combination of the bottom surface, and the sidewalls of the weights 3482. The friction member allows for dampening of sound and vibration during impact with a ball. The friction member helps secure and further prevents the weights 3482 from shifting within the channel 3413 when the weights 3482 are locked in place by cable tension.

The adjustable weighting system 3466 comprises the tensioner 3467 and the cable 3469. As illustrated in FIG. 82, the tensioner 3467 is positioned in a generally central location on the sole 3430, disposed between the channels 3413 extending toward the generally central location on the sole 3430 of the club head 3410. Although in other embodiments, the tensioner 3467 can be positioned at other locations along the club head 3410, as long as the tensioner 3467 is disposed between the junction of the channel 3413. The tensioner 3467 can be attached to the recessed to the club head 3410 by way of fastener or by an adhesive. When the tensioner 3467 is attached to the club head 3410, the height of the tensioner 3467 does not extend past the lowest point of the club head 3410 when at address. In other embodiments, the tensioner 3467 can be flush with the outer surface 3474 of the sole 3430.

The cable 3469 of the adjustable weighting system 3410 is similar to the cables 3269, and 3369 as described above. The cable 3469 is configured to be attached to the tensioner 3467 and within the channel 3413. In other embodiments, the cable 3469 can extend and retract by other means other than the tensioner 3467. The cable 3469 can be received within the channel 3413 or any of the visual details 3415. The cable 3469 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3469 can be made of baling twine, parachute cord material, nylon, Kevlar, polymer tweed, steel wire with polymer coating, any metallic wire with polymer coating or etc.

The tensioner 3467 is similar to the tensioners 3267, 3367 as described above, wherein the tensioner 3467 is a winch and ratchet mechanism. In other embodiments, the tensioner 3467 can be a J-slot tensioner similar to J-slot tensioner 3267 as described above. When the cable 3469 is coupled to the tensioner 3467, the tensioner 367 can be rotated (e.g., twisted) in increments to adjust a tension in the cable 3469. The cable 3469, in turn, is coupled to the groove of the weights 3482 (or the cable 3569 passes through an aperture weights 3482), and such that the cable 3469 presses the weight or weights 3482 against the channel floor 3481 and channel walls 3483 of the channels 3413. In some embodiments, the sidewalls of the weights 3482 abut against the channel walls 3483 and channel floor 3481. In other embodiments with weights 3482 having friction members, the friction members in combination with the sidewalls of the weights 3482 can abut the channel walls 3483 and channel floor 3481.

The tensioner 3467 can be pushed downward, or pulled upward to release the tension and loosen the cable 3469. Once the cable 3469 is loosened, the weights 3482 can be taken out and repositioned anywhere along the channel 3413. In embodiments with weights 3482 having apertures instead of grooves, the weights can be slid within the channel 3413 without being removed from the cable 3469. Once the weights 3482 are repositioned, the tensioner 3467 can tighten up the cable 3469 to secure the weights 3482 within the channel 3413 by tension and friction. The ability to reposition the weights 3482 to different positioned along the channel 3413 allows for an end user to adjust the CG of the club head 3410. For example, the weight 3482 can be repositioned from near the toe end 3418 to near the heel end 3422, wherein ball trajectory can be corrected for a player who tends to hook the ball. In other embodiments, the cable 3469 can be tightened/loosened by other means other than by the tensioner 3467.

In some embodiments, the tensioner 3467 is naturally in a locked position, wherein the tensioner 3467 is pressed downward to engage the winch and ratchet mechanism to release tension from the cables 3469. When the tension is released (e.g., when the cable 3469 is extended), the weight 3482 may then be repositioned into a different area along the channels 3413, so as to change a center of gravity of the club head 3410. In some embodiments, the tensioner 3467 is naturally in a locked position, wherein the tensioner 3467 is pulled upward to engage the winch and ratchet mechanism to release tension from the cables 3469. In some embodiments, a tool is required to rotate the tensioner 3467 and/or to release tension in the cable 3467.

The club head 3410 having the adjustable weighting system 3466 comprises a tensioner 3467 (or other adjustment means) and the cable 3469 described above can optimize the performance of the golf club. The adjustable weighting system 3466 allows for the club head 3410 to adjust the already low and back center of gravity about the x-axis (heel-to-toe end), and about the y-axis (strikeface-to-rear) without having to sacrifice a relatively high MOI similar to that of a club head void of an adjustable weight system. Shifting the CG about the x-axis allows players to correct a slice or a hook in ball trajectory, while shifting the CG about the y-axis allows players to control the spin imparted on a ball.

The club 3410 head having the tensioner 3467 and the cable 3469 adjustable weight system further have an utility regarding ease of manufacturing compared to club heads with more complex structures to house a weight (i.e., deep weight ports, multiple weight ports, rail systems, weight covers/caps). The weight(s) 3482 coupled to the channel 3413 are secured by the tension of the cable 3469, which create a friction between a surface of the weight(s) 3482 and the channel walls 3483 and the channel floor 3481 of the channel 3413. The tension and frictional force eliminates the need for the club head 3410 to be manufactured with a weight housing structure having complex internal/external geometries in order to secure the weight(s) 3482. Thereby reducing the material and mass associated with the complex weight housing structure. The mass saved from the lack of the weight housing structure can then be positioned elsewhere on the club head 3482 to increase strength and/or mass in that location. The tension and friction created by the cable 3469 further eliminates the need for screw-type fasteners, thus the weight(s) 3482 and club head 3410 do not require manufacturing a threaded aperture to receive the fastener. The lack of the fastener and threaded aperture reduces the cost of manufacturing and increase production.

Further, the cable 3469 of the adjustable weighting system 3466 is lightweight, strong, and can be incorporated with the channel(s) 3413 in a number of different patterns on the club head 3410. The different patterns allows for the weight(s) 3482 to be place in a number of different locations on the sole 3430 because the weight(s) 3430 are not limited to specific weight housing structures. The number of different weight positions can help fine tune the CG placement to adjust the ball spin and trajectory for individual players. The cable 3469 can further be strategically placed in such a pattern that the cable 3469 can reinforce specific locations on the club head 3410. The material and pattern of the cable 3469 can further still act as a sound dampener and absorb vibration experienced by the club head 3410 during impact, thereby reducing unwanted sound, and unwanted stress during a game.

The adjustable weighting system 3466 of golf club head 3410 maintains or prevents a significant reduction in club head moment of inertia, and low and back club head center of gravity positioning, compared to a club head devoid of an adjustable weighting system. The adjustable weighting system 3466 of golf club head 3410 maintains a high club head moment of inertia and a low and back club head CG position due to the lightweight adjustable weighting system 3466, and lack of a complex internal/external weight housing structure. The club head 3410 having the adjustable weighting system 3466 can have similar or identical parameters and measurements as club head 100 described above.

Figure 83:
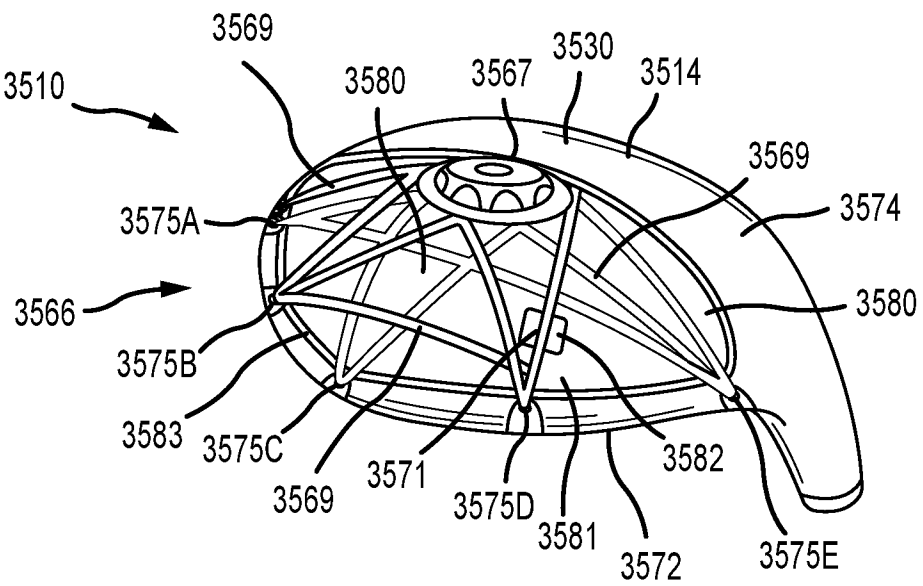
FIG. 83 is a perspective view of a golf club head according to another embodiment.

FIG. 83 illustrates a club head 3510 having a club head body 3514. The club head 3510 includes an adjustable weighting system 3566 comprising a cable 3569 and a tensioner 3567 that is adjustable by an end user to modify the club head 3510 center of gravity and/or moment of inertia and/or heel/toe bias to achieve desired performance characteristics (e.g., forgiveness, spin, trajectory) under various circumstances. The adjustable weighting system 3566 is a low profile system and thereby does not significantly shift or change the club head 3510 MOI when compared to a club head not including the adjustable weighting system 3566. Further, the low profile adjustable weighting system 3566 allows shifts in the club head 3510 CG to occur in a heel end 3522 to toe end 3518 direction keeping the overall club head 3510 CG in a low and back location. The low profile adjustable weighting system 3566 allows shifts in the club head 3510 CG to occur about a y-axis (front to rear) to adjust the ball spin.

In some embodiments, the adjustable weighting system 3566 is positioned within a shallow recessed portion 3580 of a sole 3530 of the club head 3510. The recessed portion 3580 is shallow and does not comprise complex geometries compared to other club heads with deep, complex and heavy weight ports. In other embodiments, the club head 3510 is void of the recessed portion 3580 and the adjustable weighting system 3566 is positioned on an outer surface 3574 of the sole 3530. As illustrated in FIG. 83, the recessed portion 3580 is positioned on a portion of a sole 3530 of the club head 3510. The recessed portion 3580 extends from a heel end 3522, along a trailing edge 3572, a toe end 3518, and a generally central positioned on the sole 3530, forming a partial imperfect circle shape. In other embodiments, the recessed portion 3580 can form any shape on the sole 3530 of the club head 3510. The recessed portion 3580 comprises a recessed surface 3581. The recessed portion 3580 is separated from a remaining outer surface 3574 of the sole 3530 by a wall 3583. The wall 3583, or at least a portion thereof, is perpendicular (or in some embodiments inclined/declined at a different angle) to the recessed surface 3581

In the illustrated embodiment, the adjustable weighting system 3566 comprises the tensioner 3567, the cable 3569, and a plurality of guide elements 3575. The tensioner 3567 is positioned generally centrally on the sole 3530 (or centrally on the sole 3530 within the recessed portion 3580) of the club head 3510, although in other embodiments the tensioner 3567 can be positioned at other locations along the club head 3510. For example, the tensioner 3567 can be positioned near the toe end 3518, near the heel end 3522, or adjacent to the trailing edge 3574. The tensioner 3567 can be attached to the club head by way of adhesive if by fasteners. When the tensioner 3567 is attached to the club head 3510, the tensioner 3567 does not extend past the lowest part of the club head 3510 when at address, thereby not obstructing a player's swing. In some embodiments, the tensioner 3567 is flush with the outer surface 3574 of the sole 3530.

The plurality of guide elements 3575 of the adjustable weighting system 3566 are configured to receive and guide the cable 3569. The guide elements 3575 are positioned adjacent a trailing edge 3572 along the toe end 3518, the rear 3523, and the heel end 3522 of the club head 3510. In embodiments with the recessed portion 3580, the guide elements 3575 are positioned adjacent the trailing edge 3572, extending from the wall 3583. In the illustrated embodiment, the club head 3510 comprises five guide elements 3573: a first guide element 3573A near the toe end 3518, a second guide element 3573E near the heel end 3522, a third guide element 3573C in a general center between the first guide element 3573A and the second guide element 3573E, a fourth guide element 3573B between the first guide element 3573A and third guide element 3575C, and a fifth guide 3573D between the second guide element 3573E and the third guide element 3573C. Although in other embodiments, the club had 3510 can comprise different numbers of guide elements 3573, as well as different locations for the guide elements 3573. For example, the club head 3510 can comprise one guide element 3573, two guide elements 3573, three guide elements 3573, four guide elements 3573, five guide elements 3573, six guide elements 3573, guide elements 3573, seven guide elements 3573, or eight guide elements 3573. The cable 3569 is engaged with the guide elements 3573, which re-route the cable or cables 3569 back toward the tensioner 3567, thus forming a crisscrossing network that provides a variety of different positions and numbers of different positions (e.g., one, two, three, four, five, six, seven, or eight, etc.) for the weight or weights 3582.

The cable 3569 of the adjustable weighting system 3566 is similar to the cables 3269, 3369, and 3469 (e.g., the material used for the cables, the measurements of the cables, etc.). The cable 3569 is configured to be received by the tensioner 3567 and the guide elements 3575. The cable 3579 can be fed within the tensioner 3567, and is looped to different guide elements 3575 to create a web-like design on a portion of the sole 3530. In some embodiments, the cable 3569 can be attached to the tensioner 3567, and some of the guide members 3575, wherein the remaining guide elements 3575 do not receive the cable 3569. For example in embodiments with four guide elements 3573, the cable 3569 is received by the first and third guide elements 3575A and 3573B near the toe end 3518, while the second and fourth guide elements 3575D and 3575C near the heel end 3522 are void of the cable 3569. In another example, the cable 3569 is received by every other guide element 3575 for a more spaced out web-like design. The cable 3569 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3569 can be made of baling twine, parachute cord material, nylon, Kevlar, polymer tweed, steel wire with polymer coating, any metallic wire with polymer coating or etc.

The cable 3569 is further configured to be received by a groove 3571 of a weight 3582 The weight 3582 of the club head 3510 can be similar to the weights 3282, 3382, and 3482 as described above. The weight 3582 comprise a top surface, and a bottom surface. The top surface comprises the groove 3571. The groove 3571 is configured to receive the cable 3569 of the adjustable weighting system 3566. In some embodiments the groove 3571 has a C-shaped (or other shaped) contour, so as to facilitate retention of the cable 3569 along the top surface of the weight 3582. In some embodiments void of the groove 3583, the weight 3582 comprises a through aperture (not pictured) to receive the cable 3569, such that the weight 3582 may slide along the cable 3569. The weights 3582 further comprise a cross-sectional shape generally curved to the contour of the recessed surface 3581 (or the outer surface 3574) of the sole 3530. In some embodiments, the cross-sectional shape of the weights 3582 can be a cube, a rectangular prism, a curved rectangular prism, a pentagonal prism, a hexagonal prism, or any polygonal shape. In many embodiments, the club head 3510 can comprise any number of weights, such as one weight 3582, two weights 3582, three weights 3582, four weights 3582, five weights 3582, six weights 3582, seven weights 3582, or eight weights 3582.

In some embodiments, the weights 3582 can further comprise a friction member positioned on the bottom surface of the weights 3582. The friction member can be made of polymers such as low-density polyethylene (LDPE), high-density polyethylene (HDPE), polypropylene (PP), polyvinyl chloride (PVC), polystyrene (PS), teflon (Polytetrafluoroethylene), thermoplastic polyurethanes, natural polyisoprene, synthetic polyisoprene, polybutadiene, chloroprene rubber, butyl rubber, styrene-butadiene nitrile rubber or any other polymer, elastomers, and friction/dampening material. When the weight 3582 is coupled to the adjustable weighting system 3566, the friction member on the weight 4982 is adjacent the recessed surface 3581 (or outer surface 3574) of the sole 3530, which creates a frictional force to prevent the weight 3582 from shifting on the sole 3530. The friction member can be attached to the weights 3582 by adhesion or any other means. The friction member can further act as a dampener for sound and vibration. Dampening the sound and vibration can be more pleasing to an end user, as well as relieve stress during impact.

The intricate web-like design of the cable 3569 allows for the weights 3582 to be positioned onto the club head 3510 at multiple locations. For example, the weight 3582 can be positioned on the club head near the toe end 3518, near the toe end 3518 proximate the rear 3523, near the toe end 3518 proximate the center of the club head 3510, near the toe end 3518 proximate the strikface, near the heel end 3522, near the heel end 3522 proximate the rear 3523, near the heel end proximate the strikeface, or near the heel end 3522 proximate the center of the club head 3510. Having multiple locations to place the weight 3582 can help the end user to fine tune the CG of the club head 3510 to help correct hook, slice, or ball spin.

The tensioner 3567 is similar to the tensioner 3267, 3367, and 3467, wherein the tensioner acts as a winch and ratchet mechanism. In other embodiments, the tensioner 3567 can be a J-slot tensioner similar to J-slot tensioner 3267 as described above. When the cable 3569 is coupled to the tensioner 3567, the tensioner 3567 can be rotated (e.g., twisted) in increments to adjust a tension in the cable or cables 3569. The cable 3569, in turn, is coupled to the groove 3571 of the weight 3582. In other embodiments, the cable 3569 receive through the aperture of the weight 3582. When the tensioner 3567 is rotated clockwise, the cable 3569 is tightened, and the cable 3569 presses on the groove 3572 (or aperture) of the weight 3582 creating a force on the weight 3582 firmly against the recessed surface 3581 (or outer surface 3574). In some embodiments, the force created by the tension placed on the weight 3582 against the sole 3530 of the club head 3510 secures the weight 3582 onto the club head 3510. In other embodiments, wherein the weight 3582 comprise the friction member, a frictional force is created between the abutting surfaces of the friction member of the weight 3582 and of sole 3530 of the club head 3510. The two forces created secures the weight 3582 onto the club head 3510 and prevents the weight 3582 from sliding or shifting on the sole 3530. In other embodiments, the cable 3569 can be retracted by other means other than by the tensioner 3567.

The tensioner 3567 can be pressed downward (or pulled upward) to decrease the tension in the cable 3569 and loosen the cable 3569 on the weigh 3582. When the cable 3569 is loose, the weight 3582 can be repositioned to a different location the club head 3510. In embodiments where the weight 3582 comprise an aperture instead of the groove 3571, the weight 3582 can be slid along the cable 3569 to be repositioned to different locations on the club head 3510. Reposition the weight 3582 can affect the CG. For example, the weights 3582 can be positioned near the heel end 3522 to correct ball trajectory for a player who tends to hook the ball. In another example, the weights 3582 can be positioned near the toe end 3518 and more back toward the trailing edge 3572 to correct ball trajectory for a player who tends to slice the ball and decreased ball spin. In other embodiments, the cable 3569 can be loosened by other means other than by the tensioner 3567.

In some embodiments, the tensioner 3567 is naturally in a locked position, wherein the tensioner 3567 is pressed downward to engage the winch and ratchet mechanism, to release the tension of in the cable 3569. When the tension is released (e.g., when the cable 3569 is loosened), the weight 3582 may then be repositioned into different areas along the club head 3510 to adjust the center of gravity without the restriction of distinct locations. In other embodiments, the tensioner 3567 is naturally in a locked position, wherein the tensioner 3567 is pulled upward to engage the winch and ratchet mechanism, to release the tension of in the cable 3569. In some embodiments, a tool is required to rotate the tensioner 3567 and/or to release tension in the cable 3569.

The club head 3510 having the adjustable weighting system 3566 comprises a tensioner 3567 (or other cable adjustment means) and the cable 3569 described above can optimize the performance of the golf club. The adjustable weighting system 3566 allows for the club head 3510 to adjust the already low and back CG about the x-axis (heel-to-toe end), and about the y-axis (strikeface-to-rear) without having to sacrifice a relatively high MOI similar to that of a club head void of an adjustable weight system. Shifting the CG about the x-axis allows players to correct a slice or a hook in ball trajectory, while shifting the CG about the y-axis allows players to control the spin imparted on a ball.

The club head 3510 having the tensioner 3567 and the cable 3569 adjustable weight system 3566 further have an utility regarding ease of manufacturing compared to club heads with more complex structures to house a weight (i.e., deep weight ports, multiple weight ports, rail systems, weight covers/caps). The weight(s) 3582 coupled to the club head body 3514 are secured by the tension of the cable 3569, which create a friction between the friction member of the weight(s) 5382 and the recessed surface 3581 (or outer surface 3574) of the sole 3530. The tension and frictional force eliminates the need for the club head 3510 to be manufactured with a weight housing structure having complex internal/external geometries in order to secure the weight(s). Thereby reducing the material and mass associated with the complex weight housing structure. The mass saved from the lack of the weight housing structure can then be positioned elsewhere on the club head 3510 to increase strength and/or mass in that location. The tension and friction created by the cable 3569 further eliminates the need for screw-type fasteners, thus the weight(s) 3582 and club head 3510 do not require manufacturing a threaded aperture to receive the fastener. The lack of the fastener and threaded aperture reduces the cost of manufacturing and increase production.

Further, the cable 3569 of the adjustable weighting system 3566 is lightweight, strong, and can be incorporated in a number of different patterns on the sole 3530 of the club head 3510. The different patterns allows for the weight(s) 3582 to be place in a number of different locations on the sole 3530 because the weight(s) 3582 are not limited to specific weight housing structures. The number of different weight positions can help fine tune the CG placement to adjust the ball spin and trajectory for individual players. The cable 3569 can further be strategically placed in such a pattern that the cable 3569 can reinforce specific locations on the club head 3510. The material and pattern of the cable 3569 can further still act as a sound dampener and absorb vibration experienced by the club head 3510 during impact, thereby reducing unwanted sound, and unwanted stress during a game.

The adjustable weighting system 3566 of golf club head 3510 maintains or prevents a significant reduction in club head moment of inertia, and low and back club head center of gravity positioning, compared to a club head devoid of an adjustable weighting system. The adjustable weighting system 3566 of golf club head 3510 maintains a high club head moment of inertia and a low and back club head CG position due to the lightweight adjustable weighting system 3566, and lack of a complex internal/external weight housing structures. The club head 3510 having the adjustable weighting system 3566 can have similar or identical parameters and measurements as club head 100 described above.

Figure 85:
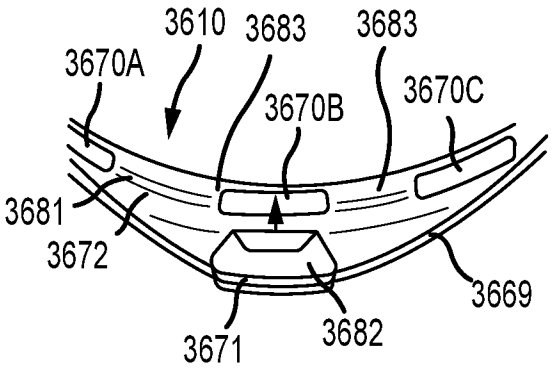
FIGS. 84 and 85 are perspective views of a golf club head according to another embodiment.
Figure 84:
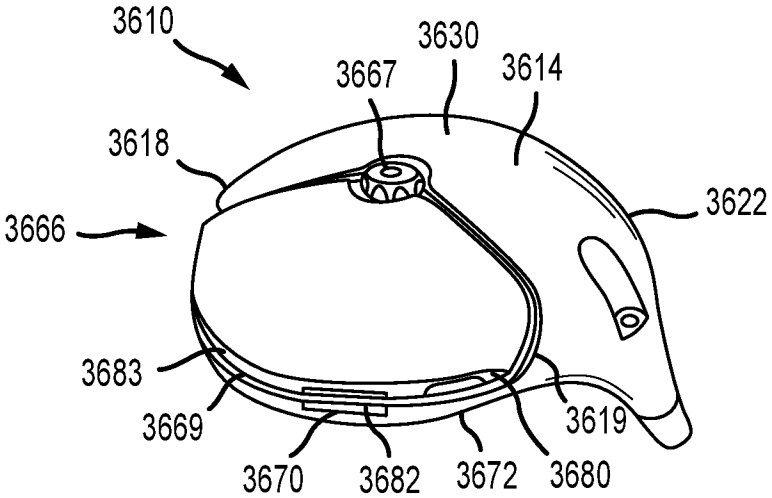

FIGS. 84 and 85 illustrate a club head 3610 having a club head body 3614. The club head 3610 includes an adjustable weighting system 3666 comprising a cable 3669 and a tensioner 3667 that is adjustable by an end user to modify the club head 3610 center of gravity and/or moment of inertia and/or heel/toe bias to achieve desired performance characteristics (e.g., forgiveness, spin, trajectory) under various circumstances. The adjustable weighting system 3666 is a low profile system and thereby does not significantly shift or change the club head 3610 MOI when compared to a club head not including the adjustable weighting system 3666. Further, the low profile adjustable weighting system 3666 ensures that shifts in the club head 3610 CG occur mainly in a heel end 3622 to toe end 6318 direction keeping the overall club head 6310 CG in a low and back location.

The adjustable weighting system 3666 is positioned on a sole 3630 of the club head 3610. As illustrated in FIG. 84, the sole 3630 comprises an outer surface 3674 wherein the outer surface 3674 comprises a channel 3613. The channel 3613 extends into the outer surface 3674, extending from a general central location of the sole 3630 toward a toe end 3618, along a trailing edge 3672 toward a heel end 3622, and back toward the general central location of the sole 3630. The channel 3613 comprises walls 3683 that separates the channel 3613 from the outer surface 3674 of the sole 3630, and a bottom wall 3681 disposed between the walls 3683 of the channel 3613.

As illustrated in FIG. 85, the channel 3613 further comprises a plurality of discrete attachment locations. The plurality of discrete attachment locations can comprise various features 3670 including protruding bodies, apertures or recesses or ports capable of receiving a fastener, notches or tabs or cutout regions, ribs or grooves, pegs, hooks, magnets, programmable magnets, or any other suitable attachment means. The features 3670 define a discrete attachment location for securing the weight 3682 to the club head 3610. In contrast to other adjustable weighting systems wherein the weight can be coupled at any, or at an infinite, or at an unlimited number of locations across the recessed portion. In the illustrated embodiment, the features 3670 are notches embedded within the bottom wall 3681 of the channel 3613 along the trailing edge 3672 to secure a weight 3682, wherein the walls 3683 of the channel 3613 partially encases the features 3670. The channel 3613 can comprise any number of features such as one feature 3670, two features 3670, three features 3670, four features 3670, five features 3670, six features 3670, seven features 3670, or eight features 3670. In some embodiments, each of the features 3670 is spaced equidistant from one another. In other embodiments, each of features 3670 is spaced at any distance from one another. For example, there can be two features 3670 proximal to one another at the toe end 3618, and one feature 3670 distal from the prior two features 3670, at the heel end 3622. In some embodiments, the features 3670 are defined generally by three sides formed in the bottom wall 3681 of the channel 3613, forming a generally trapezoidal-shaped area to receive and secure a weight 3682. In other embodiments, the features 3670 are notches that are defined by any number of sides (e.g., two sides, three sides, four sides, five sides, or six sides) to have other shapes (e.g., circular, triangular, square, pentagonal, hexagonal, etc.). In other embodiments, the features 3670 can comprise a partial spherical shape, a partial cylindrical shape, or any other partial circular shape. In the illustrated embodiment, the features 3670 are covered notches, as opposed for example to the open notches illustrated in FIG. 74.

The weights 3682 configured to be received by the features 3670 are similar to the weights 3282, 3382, 3482, and 3582 as described above. The weights 3682 comprise a general shape such as a cylinder, a triangular prism, a cube, a rectangular prism, a pentagonal prism, a hexagonal prism, or etc. As illustrated in FIG. 85, the weights 3682 each comprise a shape and size that is complementary to the features 3670, such that the weights 3682 fit within the features 3670 and surfaces of the weights 3682 abut tightly against the walls 3683 and bottom wall 3681 of the feature 3670. In some embodiments, the club head 3610 can comprise one weight 3682. In other embodiments, the club head 3610 can comprise any number of weights 3682 such as one weight 3682, two weights 3682, three weights 3682, four weights 3682, five weights 3682, six weights 3682, seven weights 3682, or eight weights 3682.

The weights 3682 further comprise a mass. The mass of the weights 3682 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3782 can be 1 gram, 2 grams, 3 grams, 6 grams, 9 grams, 12 grams, 15 grams, 18 grams, 21 grams, 24 grams, 27 grams, 30 grams, 33 grams, or 35 grams. In embodiments wherein the club head 6210 comprises multiple weights 3682, the weights 3682 can all comprise the same mass, or all have different masses. For example, the club head 3610 comprises three weights 3682 with the first weight 3682 having a mass of 12 grams, and both the second and third weights 3682 having a mass of 5 grams. In another example, the club head 3610 comprises four weights 3682 with the first weight 3682 having a mass of 20 grams, the second weight 3682 having a mass of 15 grams, the third weight 3682 having a mass of 10 grams, and the fourth weight 3682 having a mass of 7 grams.

In some embodiments, the weights 3682 comprise a groove 3671 on a surface of the weights 3682 exposed when positioned within the features 3670. The groove 3671 is configured to receive the cable 3669 of the adjustable weighting system 3666. In some embodiments the groove 3671 has a C-shaped (or other shaped) contour, so as to facilitate retention of the cable 3669 along the surface of the weight 3682. In some embodiments void of the groove 3671, the weight 3582 comprises a through aperture (not pictured) to receive the cable 3669, such that the weight 3682 may slide along the cable 3669.

The adjustable weighting system 3666 comprises the tensioner 3667, and the cable 3669. As illustrated in FIG. 84, the tensioner 3667 is positioned in a general central along the sole 3630 of the club head 3610 disposed between the channel 3613 extending from the central location toward the toe end 3618, and the channel 3613 extending from the heel end 3622 toward the central location on the sole 3630. Although, in other embodiments the tensioner 3667 can be positioned at other locations along the club head 3610, just as long as the tensioner 3667 is disposed between the junction of the channel 3613 extending from the toe end 3618 and the heel end 3622. The tensioner 3667 can be attached to the club head 3610 by way of a fastener or by an adhesive. When the tensioner 3667 is attached to the club head 3610, the tensioner 3667 does not pass the lowest point of the club head 3610 to not obstruct a player's swing. In other embodiments, the tensioner 3667 can be flush with the outer surface 3674 of the sole 3630.

The cable 3669 of the adjustable weighing system 3666 is similar to the cable 3267, 3367, 3467, and 3567 as described above (e.g., measurements, materials, etc.). The cable 3669 is configured to be couple to the tensioner 3667 and received within the channel 3613. The cable 3669 is further received within the groove 3671 of the weights 3682. The cable 3669 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3669 can be made of baling twine, parachute cord material, nylon, Kevlar, polymer tweed, steel wire with polymer coating, any metallic wire with polymer coating or etc.

The tensioner 3667 is similar to the tensioners 3267, 3367, 3467, and 3567 wherein the tensioner acts as a winch and ratchet mechanism. In other embodiments, the tensioner 3667 can be a J-slot tensioner similar to J-slot tensioner 3267 as described above. The tensioner 3667 may be rotated (e.g., twisted) in increments to adjust a tension in the cable 3669. The cable 3669, in turn, is coupled to the weights 3682 (e.g., positioned along an external groove 3671 or within the aperture in the weights 3682). When the tensioner 3667 is rotated clockwise, the cable 3669 is tightened, and the cable 3669 presses on the weights 3682 to abut against the features 3670 of the channel 3613. The tension of the cable 3669 on the weights 3682 create a force on the weights 3682 onto the wall 4683, and bottom wall 3681 of the features 3670 to prevent the weights 3682 from popping out or shifting within the channel 3613.

The tensioner 3667 can be pressed downward (or pulled upward) to release the tension to loosen the cable 3669. As the cable 3669 loosens, the weights 3682 can then be taken out of the features 3670 and repositioned to a different feature 3670 to adjust the CG of the club head 3610. For example, the weights 3682 can be repositioned from a feature 3670 near the heel to the feature 3670 near the toe end 3618 to correct a player who tends to slice the ball. In embodiments where the weights 3682 comprise an aperture instead of a groove 3671, the weights 3682 can be taken out of the features 3670 and can slide along the cable 3669 (without being removed from the cable 3669) to be repositioned. In some embodiments, the tensioner 3667 is naturally in a locked stated, wherein the tensioner 3667 must be pressed-down to engage the rotation movement of the winch and ratchet mechanism to loosen the cable 3669. In some embodiments, the tensioner 3667 is naturally in a locked stated, wherein the tensioner 3667 must be pulled upward to engage the rotation movement of the winch and ratchet mechanism to loosen the cable 3669. In some embodiments, a tool is required to rotate the tensioner 3667 to increase tension, and/or to release tension in the cable 3669. In other embodiments, the cable 4669 can be retracted/loosened by other means other than by the tensioner 3667.

The club head 3610 having the adjustable weighting system 3666 comprises a tensioner 3667 (or other cable adjustment means) and the cable 3669 described above can optimize the performance of the golf club. The adjustable weighting system 3666 allows for the club head 3610 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 3610 having the tensioner 3667 and the cable 3669 adjustable weight system 3666 further have an utility regarding ease of manufacturing compared to club heads with more complex structures to house a weight (i.e., deep weight ports, multiple weight ports, rail systems, weight covers/caps). The weight(s) 3682 coupled to the club head body 3614 are secured by the tension of the cable 3669, which create a force on the weight(s) 3682 onto the feature 3670. The tension produced force eliminates the need for the club head 3610 to be manufactured with a weight housing structure having complex internal/external geometries in order to secure the weight(s) 3682. Thereby reducing the material and mass associated with the complex weight housing structure. The mass saved from the lack of the weight housing structure can then be positioned elsewhere on the club head 3610 to increase strength and/or mass in that location. The tension produced force created by the cable further eliminates the need for screw-type fasteners, thus the weight(s) 3682 and club head 3610 do not require manufacturing a threaded aperture to receive the fastener. The lack of the fastener and threaded aperture reduces the cost of manufacturing and increase production.

Further, the cable 3669 of the adjustable weighting system 3666 is lightweight, strong, and can be incorporated with the channel 3613 in a number of different patterns on an outer surface 3674 of the club head. The different patterns allows for the weight(s) 3682 to be place in a number of different locations on the sole 3630 because the weight(s) 3682 are not limited to specific weight housing structures. The number of different weight positions can help fine tune the CG placement to adjust the ball spin and trajectory for individual players. The cable 3669 can further be strategically placed in such a pattern that the cable 3669 can reinforce specific locations on the club head 3610. The material and pattern of the cable 3610 can further still act as a sound dampener and absorb vibration experienced by the club head during impact, thereby reducing unwanted sound, and unwanted stress during a game.

The adjustable weighting system 3666 of golf club head 3610 maintains or prevents a significant reduction in club head moment of inertia, and low and back club head center of gravity positioning, compared to a club head devoid of an adjustable weighting system. The adjustable weighting system 3666 of golf club head 3610 maintains a high club head moment of inertia and a low and back club head CG position due to the low profile of the weighting system and the perimeter positioning of the one or more weights. The club head 3610 having the adjustable weighting system 3666 can have similar or identical parameters and measurements as club head 100 described above FIGS. 86 and 87 illustrate a club head 3710 having a club head body 3714. The club head 3710 includes an adjustable weighting system 3766 comprising a cable 3769 and a tensioner 3767 that is adjustable by an end user to modify the club head 3710 center of gravity and/or moment of inertia and/or heel/toe bias to achieve desired performance characteristics (e.g., forgiveness, spin, trajectory) under various circumstances. The adjustable weighting system 3766 is a low profile system and thereby does not significantly shift or change the club head 3710 MOI when compared to a club head not including the adjustable weighting system 3766. Further, the low profile adjustable weighting system 3766 ensures that shifts in the club head 3710 CG occur mainly in a heel end 3722 to toe end 3718 direction keeping the overall club head 3710 CG in a low and back location.

Figure 86:
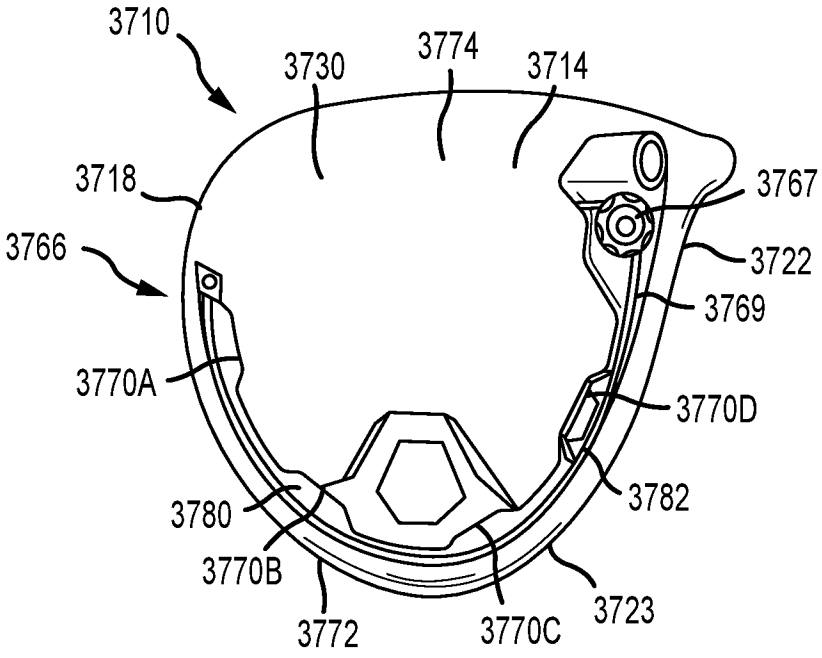

The adjustable weighting system 3766 is positioned on a sole 3730 of the club head 3710. As illustrated in FIG. 86, the sole 3730 comprises a recessed portion 3780 extending along the trailing edge 3772, from a heel end 3722, toward a rear 3723, and toward a toe end 3718, wherein the recessed portion 3780 forms an almost parallel perimeter along the trailing edge 3772. In other embodiments, the recessed portion 3780 can be placed anywhere on the sole 3730 and form any shape. The recessed portion 3780 is separated from the rest of an outer surface 3774 of the sole 3730 by a wall 3783. The wall 3783 is, at least a portion thereof, perpendicular (or in some embodiments inclined/declined at a different angle) to the recessed portion 3780.

In the illustrated embodiment, the recessed portion 3780 comprises a plurality of discrete attachment locations. The plurality of discrete attachment locations can comprise various features 3770 including protruding bodies, apertures or recesses or ports capable of receiving a fastener, notches or tabs or cutout regions, ribs or grooves, pegs, hooks, magnets, programmable magnets, or any other suitable attachment means. The features 3770 define a discrete attachment location for securing the weight 3782 to the club head 3710. In contrast to other adjustable weighting systems wherein the weight can be coupled at any, or at an infinite, or at an unlimited number of locations across the recessed portion. In the illustrative embodiments, the features 3770 are indentations into the wall 3783 positioned farthest from the trailing edge 3772. As illustrated in FIG. 86, the recessed portion 3780 comprises four features 3770, a first feature 3770A near the toe end 3718, a second feature 3770D near the heel end 3722, a third feature 3770B between the first feature 3770A and the second feature 3770D, and a fourth feature 3770C between the second feature 3770D and the third feature 3770B. Although in other embodiments, the recessed portion 3780 can comprise any numbers of features 3770. For example, the recessed portion 3780 can comprise any number of features 3770, such as one feature 3770, two features 3770, three features 3770, four features 3770, five features 3770, six features 3770, seven features 3770, or eight features 3770. Each of the features 3770 are spaced generally equally apart from one another. In other embodiments, the features 3770 can be spaced any distance apart from one another. In some embodiments, the feature 3770 are defined generally as indentation with three sides formed into the wall 3783, forming a generally trapezoidal-shaped area. In other embodiments, the features 3770 can form any number of sides into the wall 3783 that have other profile shapes (e.g., circular, triangular, etc.). In other embodiments still, the features 3770 can form a curved wall into the wall 3783, forming a partial circle shape, or partial ellipse shape.

Figure 87:
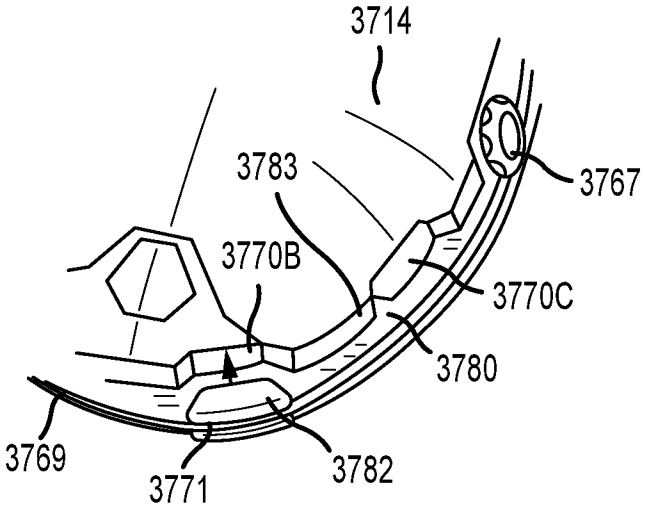
FIGS. 86 and 87 are perspective views of a golf club head according to another embodiment.

The weights 3782 to be received by the features 3770 are similar to the weights 3282, 3382, 3482, 3582, and 3682 as described above. As illustrated in FIG. 87, the weights 3782 each have a general cross-sectional shape and size (cylindrical, cubicle, rectangular, trapezoidal, etc.). In many embodiments, the general cross-sectional shape and size of the weights 382 are complementary to the profile shapes of the general features 3770, such that surfaces of the weights 3782 abut against the features 3770 of the recessed portion 3780.

The weights 3782 further comprise a mass. The mass of the weights 3782 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3782 can be 1 gram, 2 grams, 3 grams, 6 grams, 9 grams, 12 grams, 15 grams, 18 grams, 21 grams, 24 grams, 27 grams, 30 grams, 33 grams, or 35 grams. In embodiments wherein the club head 3710 comprises multiple weights 3782, the weights 3782 can all comprise the same mass, or all have different masses. For example, the club head 3710 comprises three weights 3782 with the first weight 3782 having a mass of 12 grams, and both the second and third weights 3782 having a mass of 5 grams. In another example, the club head 3710 comprises four weights 3782 with the first weight 3782 having a mass of 20 grams, the second weight 3782 having a mass of 15 grams, the third weight 3782 having a mass of 10 grams, and the fourth weight 3782 having a mass of 7 grams.

The weights 3782 can further comprise a groove 3771 positioned on a surface of the weights 3782 configured to receive a cable 3769. The groove 3771 is positioned on a surface of the weights 3782 opposite the surfaces of the weights 3782 abutting the features 3770. In some embodiments the groove 3771 has a C-shaped (or other shaped) contour, so as to facilitate retention of the cable 3769 along the top surface of the weight 3782. In other embodiments void of the groove 3771, the weights 3782 comprise a through aperture (not pictured) configured to receive the cable 3769.

The adjustable weighting system 3766 comprises the tensioner 3767 and the cable 3769. The tensioner 3767 is positioned in the recessed portion 3780 adjacent a heel or heel end 3722 of the club head 3710. Although in other embodiments, the tensioner 3767 can be positioned at other locations in the recessed portion 3780 along the club head 3710 such as the toe end 3718. The tensioner 3767 can be attached to the club head 3710 by way of fastener or by an adhesive. When the tensioner 3767 is attached to the club head 3710, the tensioner 3767 does not extend past the lowest point of the club head 3710 when at address. In other embodiments, the tensioner 3767 can be flush with the outer surface 3774 of the sole 3730.

The cable 3769 of the adjustable weighting system 3766 is configures to be positioned within the recessed portion 3780. The cable 3769 comprises a first end and a second end. The first end of the cable 3769 is configured to be coupled to the tensioner 3767, while the second end of the cable 3769 is configure to be attached/fixed at an opposite end of the club head 3710 from the tensioner 3767. For example, in the illustrated embodiment with the tensioner 3767 positioned at the heel end 3722, the second end of the cable 3769 is attached/fixed at the toe end 3722 of the club head 3710. The cable 3769 can be similar to the cables 3269, 3369, 3469, 3569, and 3669 as described above. The cable 3769 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3769 can be made of baling twine, parachute cord material, nylon, Kevlar, polymer tweed, steel wire with polymer coating, any metallic wire with polymer coating or etc.

The tensioner 3767 is similar to the tensioners 3267, 3367, 3467, 3567, and 3667 as described above, wherein the tensioner 3767 acts as a winch and ratchet mechanism. In other embodiments, the tensioner 3767 can be a J-slot tensioner similar to J-slot tensioner 3267 as described above. The tensioner 3767 may be rotated (e.g., twisted) in increments to adjust a tension in the cable 3769. The cable 3769, in turn, is coupled to one or more of the weights 3782 (e.g., positioned along an external groove 3771 or within the aperture in the weights 3782). When the tensioner 3767 is rotated clockwise, the cable 3769 is tightened, and the cable 3769 presses on the weights 3782 creating a force against the features 3770 of the recessed portion 3780 to secure the weights 3782. When the weights 3782 abut against the features 3770, the weights 3782 are flush with the outer surface 3774 of the sole 3730. In other embodiments, when the weights 3782 abut against the features 3270, the weights 3782 can extend past the outer surface 3774 of the sole 3230, however, still do not extend past the lowest point of the club head 3710 when at address. In other embodiments still, when the weights 3782 abut against the features 3770, the weights 3782 do not extend to, or past the outer surface 3774 of the sole 3230. In other embodiments, the cable 3769 can be retracted by other means other than by the tensioner 3767.

The tensioner 3767 can be pressed downward (or pulled upward) to loosen the tension on the cable 3769. As the tension in the cable 3769 decreases, the weights 3782 are no longer pressed against the features 3770 of the recessed portion 3780. The weights 3782 can then be removed from the features 3770 and be repositioned by an end user to different features 3770 within the recessed portion 3780. In embodiments where the weights 3782 comprise an aperture instead of the groove 3771, the weights 3782 can be slid along the cable 3769 to reposition the weights 3782. Repositioning the weights 3782 reconfigures the CG of the club head 3710. For example in the illustrated embodiment, the weight 3782 can be repositioned from the first feature 3770A to the second feature 3770D near the heel end 3722, wherein the CG shift toward the heel end 3722 helps correct ball trajectory for players who tend to hook the ball. In other embodiments, the cable 3769 can be loosened by other means other than by the tensioner 3767.

In some embodiments, the tensioner 3767 is in a naturally locked position, wherein the tensioner 3767 can be pressed downward to engage rotational movement of the winch and ratchet mechanism in order to release tension of the cable 3769 on the weights 3782. When the tension is released (e.g., when the cable 3769 is extended/loosened), the weights 3782 may then be repositioned into a different features 3770 along the club head 3710 to change the center of gravity. In other embodiments, the tensioner 3767 is in a naturally locked configuration, wherein the tensioner 3767 can be pulled upward to engage rotational movement of the winch and ratchet mechanism to release tension of the cable 3769 on the weights 3782. In some embodiments, a tool is required to rotate the tensioner 3767 and/or to release tension in the cable 3769.

The club head 3710 having the adjustable weighting system 3766 comprises a tensioner 3767 (or other cable adjustment means) and the cable 3769 described above can optimize the performance of the golf club. The adjustable weighting system 3766 allows for the club head 3710 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 3710 having the tensioner 3767 and the cable 3769 adjustable weight system 3766 further have an utility regarding ease of manufacturing compared to club heads with more complex structures to house a weight (i.e., deep weight ports, multiple weight ports, rail systems, weight covers/caps). The weight(s) 3782 coupled to the club head body 3714 are secured by the tension of the cable 3769, which create a force on the weight(s) 3782 onto the feature (s) 3770 of the club head 3710. The tension produced force eliminates the need for the club head 3710 to be manufactured with a weight housing structure having complex internal/external geometries in order to secure the weight(s) 3782. Thereby reducing the material and mass associated with the complex weight housing structure. The mass saved from the lack of the weight housing structure can then be positioned elsewhere on the club head to increase strength and/or mass in that location. The tension created force of the cable 3769 further eliminates the need for screw-type fasteners, thus the weight(s) 3782 and the club head 3710 do not require manufacturing a threaded aperture to receive the fastener. The lack of the fastener and threaded aperture reduces the cost of manufacturing and increase production.

Further, the cable 3769 of the adjustable weighting system 3766 is lightweight, strong, and can be incorporated in a number of different patterns on recessed portion 3780 of the club head 3710. The different patterns allows for the weight (s) 3782 to be place in a number of different locations on the sole 3830 because the weight(s) 3782 are not limited to specific weight housing structures. The number of different weight positions can help fine tune the CG placement to adjust the ball spin and trajectory for individual players. The cable 3769 can further be strategically placed in such a pattern that the cable can reinforce specific locations on the club head 3710. The material and pattern of the cable 3769 can further still act as a sound dampener and absorb vibration experienced by the club head 3710 during impact, thereby reducing unwanted sound, and unwanted stress during a game.

The adjustable weighting system 3766 of golf club head 3710 maintains or prevents a significant reduction in club head moment of inertia, and low and back club head center of gravity positioning, compared to a club head devoid of an adjustable weighting system. The adjustable weighting system 3766 of golf club head 3710 maintains a high club head moment of inertia and a low and back club head CG position due to the low profile of the weighting system and the perimeter positioning of the one or more weights. The club head 3710 having the adjustable weighting system 3766 can have similar or identical parameters and measurements as club head 100 described above.

Figure 89:
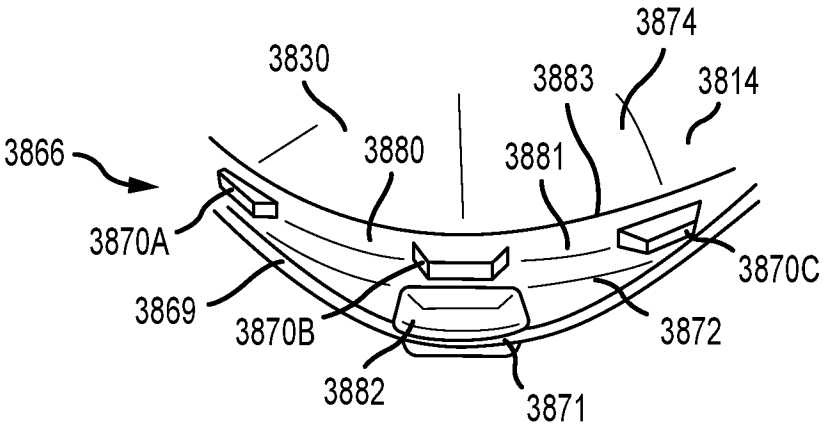
FIGS. 88 and 89 are perspective views of a golf club head according to another embodiment.
Figure 88:
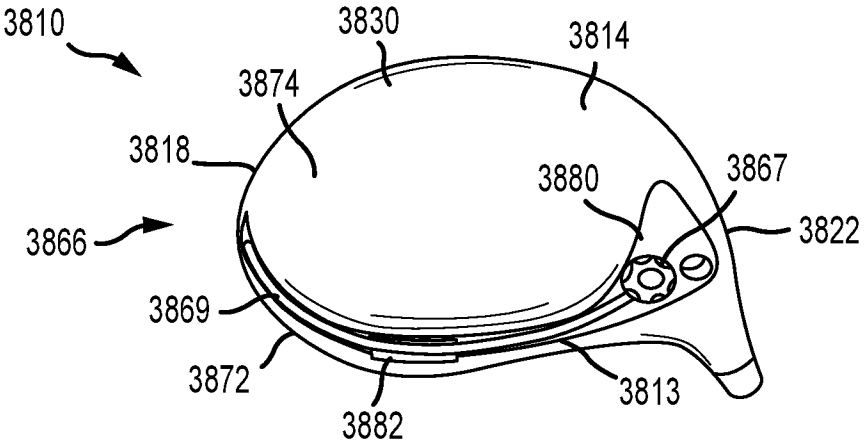

FIGS. 88 and 89 illustrate a club head 3810 having a club head body 3814. The club head 3810 includes an adjustable weighting system 3866 comprising a cable 3869 and a tensioner 3867 that is adjustable by an end user to modify the club head 3810 center of gravity and/or moment of inertia and/or heel/toe bias to achieve desired performance characteristics (e.g., forgiveness, spin, trajectory) under various circumstances. The adjustable weighting system 3866 is a low profile system and thereby does not significantly shift or change the club head 3810 MOI when compared to a club head not including the adjustable weighting system 3866. Further, the low profile adjustable weighting system 3866 ensures that shifts in the club head 3810 CG occur mainly in a heel end 3822 to toe end 3818 direction keeping the overall club head 3810 CG in a low and back location.

The adjustable weighting system 3866 is positioned within a recessed portion 3880 of the club head 3810. As illustrated in FIG. 88, the recessed portion 3880 is positioned on a sole 3830 of the club head 3810. The recessed portion 3880 comprises a portion of a heel end 3822, and extends along a trailing edge 3872 toward a toe end 3818 to form a channel 3813. The recessed portion 3880 and the channel 3813 further comprises a recessed surface 3881. The recessed surface 3881 is separated by a remaining exterior surface 3874 of the sole 38030 by a wall 3883. The wall 3883 is, at least along portions thereof, perpendicular (or in some embodiments inclined/declined/curved at a different angle) to the recessed surface 3881. In some embodiments, the recessed portion 3880 may include a recessed surface 3881 along a crown or top of the club head 3810.

In many embodiments, the channel 3813 comprises a plurality of discrete attachment locations. The plurality of discrete attachment locations can comprise various features 3870 including protruding bodies, apertures or recesses or ports capable of receiving a fastener, notches or tabs or cutout regions, ribs or grooves, pegs, hooks, magnets, programmable magnets, or any other suitable attachment means. The features 3870 define a discrete attachment location for securing the weight 3882 to the club head 3810. In contrast to other adjustable weighting systems wherein the weight can be coupled at any, or at an infinite, or at an unlimited number of locations across the recessed portion. In the illustrated embodiment, the features 3870 are protrusions extending from the recessed surface 3881 along the channel 3813 to secure weights 3882. The features 3870 comprises sidewalls and forms a prismatic shape. As illustrated in FIG. 89, the features 3870 form a trapezoidal prism, while in other embodiments, the features can form any shape such as a pyramid or any prismatic shape (e.g., cylindrical, triangular, rectangular, pentagonal, hexagonal, etc.). Further illustrated in FIG. 89, the channel 3813 comprises three features 3870. However, in other embodiments, the channel 3813 can comprise any number of features 3870, such as one feature 3870, two features 3870, three features 3870, four features 3870, five features 3870, six features 3870, seven features 3870, or eight features 37870.

The features 3870 can be spaced generally evenly apart from one another. In other embodiments, the features 3870 are spaced at any distance apart from one another. In some embodiments, the channel 3813 comprises three features 3870, wherein a first feature 3870 is positioned at the toe end 3818, a second feature 3870 is positioned at the heel end 3822, and a third feature 3870 is positioned at a general center between the first feature 3870A and the second feature 3870C, are all equidistant form one another. In another embodiment, the channel 3813 comprises three features 3870 wherein the first and third features 3870A and 3870B are positioned at the more near the toe end 3818, and the third feature 3870C is positioned in between the heel end 3822 and the general center of the trailing edge 3872.

The features 3870 are configured to receive weights 3882 similar to the weights 3282, 3382, 3482, 3582, 3682, and 3782 (shape, material, etc.). The different positions of the features 3870 in the channel 3813 allow for adjustment of the center of gravity based on the different positioning and distribution of the weights 3882. As illustrated in FIG. 89, the club head 3810 comprises one weight 3882. However, in other embodiments, the club head 3810 can comprise any number of weights 3882, such as one weight 3882, two weights 3882, three weights 3882, four weights 3882, five weights 3882, six weights 3882, seven weights 3882, or eight weights 3882. The weights 3882 comprise a top surface, and a bottom surface opposite the top surface. When the weights 3882 are coupled to the channel 3813, the bottom surface of the weights 3882 is adjacent to the recessed surface 3881. The bottom surface of the weights 3882 comprises a notch (not pictured) configured to receive the features 3870 of the channel 3813. The notch of the weights 3882 having a cross-sectional shape. The cross-sectional shape of the notch is complementary to the shape of the features 3870. The top surface comprises a groove 3871, wherein the groove 3871 is configured to receive the cable of the adjustable weight system 3866. In some embodiments the groove 3871 has a C-shaped (or other shaped) contour, in order to facilitate retention of the cable 3869 along the top surface of the weights 3882. In some embodiments void of the groove 3883, the weights 3882 comprises a through aperture (not pictured) to receive the cable 3869, such that the weights 3882 may slide along the cable 3869

The weights 3882 further comprise a mass. The mass of the weights 3882 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3882 can be 1 gram, 2 grams, 3 grams, 6 grams, 9 grams, 12 grams, 15 grams, 18 grams, 21 grams, 24 grams, 27 grams, 30 grams, 33 grams, or 35 grams. In embodiments wherein the club head 3810 comprises multiple weights 3882, the weights 3882 can all comprise the same mass, or all have different masses. For example, the club head 3810 comprises three weights 3882 with the first weight 3882 having a mass of 12 grams, and both the second and third weights 3882 having a mass of 5 grams. In another example, the club head 3810 comprises four weights 3882 with the first weight 3882 having a mass of 20 grams, the second weight 3882 having a mass of 15 grams, the third weight 3882 having a mass of 10 grams, and the fourth weight 3882 having a mass of 7 grams.

As stated above, the adjustable weighting system 3866 comprises the tensioner 3867 and the cable 3869 configured to be attached to the tensioner 3869. As illustrated in FIG. 88, the tensioner 3867 is positioned on the recessed surface 3881 at the heel end 3822, although in other embodiments the tensioner 3867 is positioned at other locations along the recessed surface 3881 (e.g., at the toe end 3818, at the rear 3823, etc.). The tensioner 3867 can be attached to the club head 3810 by way of fastener or by an adhesive. When the tensioner 3867 is attached to the recessed portion 3880 of the club head 3810, the tensioner 3867 does not extend past the lowest point of the club head 3810 when at address. In other embodiments, the tensioner 3867 can be flush with the outer surface 3874, or the recessed surface 3881 of the club head 3810.

The cable 3869 of the adjustable weighting system 3866 is configures to be received within the recessed portion. The cable 3869 comprises a first end and a second end, wherein the first end is configured to be coupled to the tensioner 3867, and the second end is attached/fixed at a location on the club head 3810 opposite the location of the tensioner 3867. For example in the illustrated embodiment, the tensioner 3867 is positioned on the heel end 3822 of the club head, the second end of the cable 3869 is attached/fixed to the toe end 3818 of the club head 3810. The cable 3869 can be similar to the cables 3269, 3369, 3469, 3569, 3669, and 3769 as described above. The cable 3869 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3869 can be made of baling twine, parachute cord material, nylon, Kevlar, polymer tweed, steel wire with polymer coating, any metallic wire with polymer coating or etc.

The tensioner 3867 is similar to the tensioners 3267, 3367, 3467, 3567, 3667, and 3767 as described above, wherein the tensioner 3867 acts as a winch and ratchet mechanism. In other embodiments, the tensioner 3867 can be a J-slot tensioner similar to J-slot tensioner 3267 as described above. The tensioner 3867 may be rotated (e.g., twisted) in increments to adjust a tension in the cable 3869. The cable 3869, in turn, is coupled to the weights 3882 (e.g., positioned along an external groove 3871, or the aperture in the weight or weights 3882, so as to press against the weights 3882). When the tensioner 3867 is rotated clockwise, the cable 3869 is tightened (e.g., retracted), and the cable 3869 presses on the weights 3882 and abuts the notch of the weights 3882 against the features 3870, securing the weights within the channel 3813. When the weights 3882 are secured, the weights 3882 are flush with the outer surface 3874 of the sole 3830. In other embodiments, the weights 3883 can extend past the outer surface 3874 of the sole 3830, but not past the lowest point of the sole 3830. In other embodiments still, the weights 3882 do not extend all the way to the outer surface 3874 of the sole 3830. In other embodiments, the cable 3869 can be retracted by other means other than by the tensioner 3867.

The tensioner 3867 can be pressed (or pulled) to loosen the tension on the cable 3869. As the tension in the cable 3869 decreases, the features 3870 are no longer abutting against the notches of the weights 3882. The weights 3882 can then be removed from the features 3870 and be repositioned by an end user to different features 3870 within the channel 3813. In embodiments where the weights 3882 comprise an aperture instead of the groove 3871, the weights 3882 can be slid along the cable 3869 to reposition the weights 3882. Repositioning the weights 3782 reconfigures the center of gravity of the club head 3710. For example, when the weights 3782 are repositioned from the first feature 3870A positioned near the toe end 3818 to the second feature 3870C near the heel end 3822, the CG shift toward the heel end 3822 helps correct ball trajectory for a player who tends to hook the ball. In other embodiments, the cable 3869 can be loosened by other means other than by the tensioner 3867.

In some embodiments, the tensioner 3867 is in naturally locked position, wherein the tensioner 3867 can be pressed downward to engage the rotational movement of the winch and ratchet mechanism in order to release the tension in the cable 3869. When the tension is released (e.g., when the cable 3869 is extended/loosened), the weights 3882 may then be repositioned (placed or slid) onto a different area along the club head 3810 (e.g., onto a different protruding feature 3870). In other embodiments, the tensioner 3867 is in a naturally locked configuration, wherein the tensioner 3867 can be pulled upward to engage rotational movement of the winch and ratchet mechanism to release the tension in the cable 3869. In some embodiments, a tool is required to rotate the tensioner 3867 and/or to release tension in the cable 3869.

The club head 3810 having the adjustable weighting system 3866 comprises the tensioner 3867 (or other cable adjustment means) and the cable 3869 described above can optimize the performance of the golf club. The adjustable weighting system 3866 allows for the club head 3810 to adjust the already low and back center of gravity about the x-axis (heel-to-toe end) without having to sacrifice a relatively high moment of inertia (MOI) similar to that of a club head void of an adjustable weight system. Shifting the CG about the x-axis allows for players to correct a slice or a hook in ball trajectory.

The club head 3810 having the tensioner 3867 and the cable 3869 adjustable weight system 3866 further have an utility regarding ease of manufacturing compared to club heads with more complex structures to house a weight (i.e., deep weight ports, multiple weight ports, rail systems, weight covers/caps). The weight(s) 3882 coupled to the features 3870 are secured by the tension of the cable 3869, which create a force on the notch of the a surface of the weight(s) and a surface of the club head. The tension and frictional force eliminates the need for the club head to be manufactured with a weight housing structure having complex internal/external geometries in order to secure the weight(s). Thereby reducing the material and mass associated with the complex weight housing structure. The mass saved from the lack of the weight housing structure can then be positioned elsewhere on the club head to increase strength and/or mass in that location. The tension and friction created by the cable further eliminates the need for screw-type fasteners, thus the weight(s) and club head do not require manufacturing a threaded aperture to receive the fastener. The lack of the fastener and threaded aperture reduces the cost of manufacturing and increase production.

Further, the cable 3869 of the adjustable weighting system 3866 is lightweight, strong, and can be incorporated in a number of different patterns on an outer surface 3874 of the club head 3810. The different patterns allows for the weight (s) 3882 to be place in a number of different locations on the sole 3830 because the weight(s) 3882 are not limited to specific weight housing structures. The number of different weight positions can help fine tune the center of gravity placement to adjust the ball spin and trajectory for individual players. The cable 3869 can further be strategically placed in such a pattern that the cable 3869 can reinforce specific locations on the club head 3810. The material and pattern of the cable 3869 can further still act as a sound dampener and absorb vibration experienced by the club head 3810 during impact, thereby reducing unwanted sound, and unwanted stress during a game.

The adjustable weighting system 3866 of golf club head 3810 maintains or prevents a significant reduction in club head moment of inertia, and low and back club head center of gravity positioning, compared to a club head devoid of an adjustable weighting system. The adjustable weighting system 3866 of golf club head 3810 maintains a high club head moment of inertia and a low and back club head CG position due to the low profile of the weighting system and the perimeter positioning of the one or more weights. The club head 3810 having the adjustable weighting system 3866 can have similar or identical parameters and measurements as club head 100 described above.

FIGS. 90-98 illustrate a club head 3910 having a club head body 3914. The club head 3910 includes an adjustable weighting system 3966 comprising a weight 3982, a cable 3969, and a tensioner 3967 that is adjustable by an end user to modify the club head 3910 center of gravity and/or moment of inertia and/or heel/toe bias to achieve desired performance characteristics (e.g., forgiveness, spin, trajectory) under various circumstances. The adjustable weighting system 3966 is a low profile system and thereby does not significantly shift or change the club head 3910 MOI when compared to a club head not including the adjustable weighting system 3966. Further, the low profile adjustable weighting system 3966 ensures that shifts in the club head 3910 CG occur mainly in a heel end 3922 to toe end 3918 direction keeping the overall club head 3910 CG in a low and back location.

Figure 90:
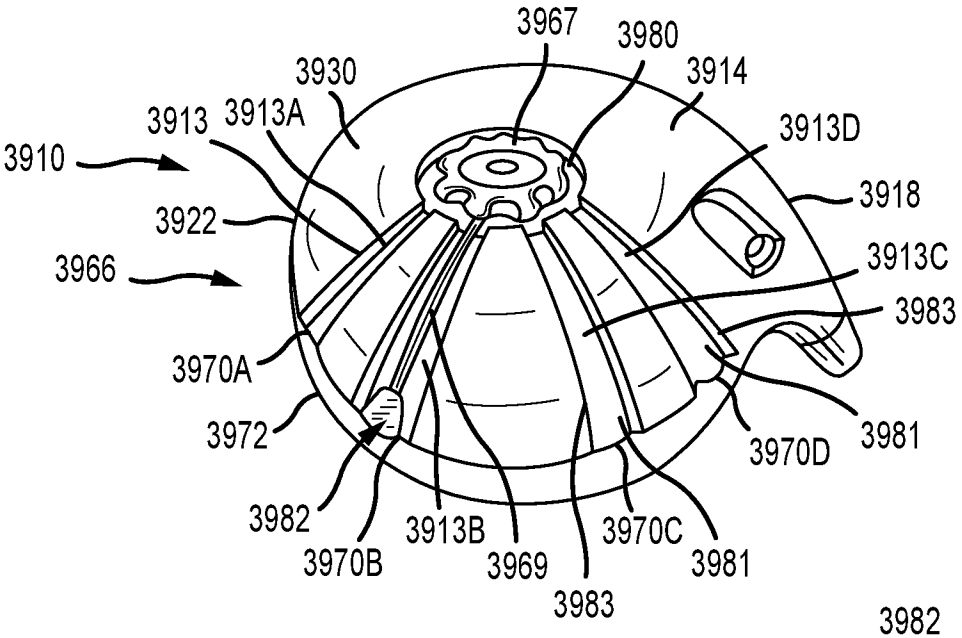
Figure 95:
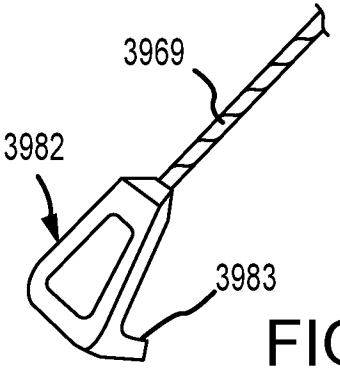
Figure 94:
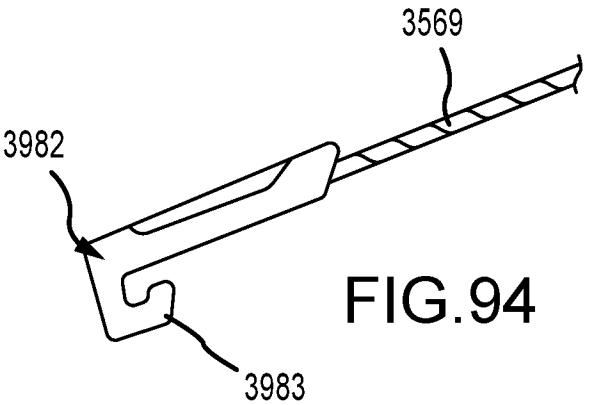

The adjustable weighting system 3966 is positioned on a sole 3930 of the club head 3910. As illustrated in FIG. 90, the sole 3930 of the club head 3910 comprises channels 3913. The channels 3913 extend radially from a generally central location of the sole 3930 toward a trailing edge 3972. In other embodiments, the channels 3913 can extend radially from any location on the sole 3930 (e.g., central positioned proximate a toe end 3918, central positioned proximate a heel end 3922, etc.). As illustrated in FIG. 90, the club head 3910 comprises four channels 3913, a first channel 3913A near the toe end 2918, a second channel 3913D proximate the heel end 3922, a third channel 3913B between the first channel 3913A and the second channel 3913D, and a fourth channel 3913C between the third channel 3913B and the second channel 3913D. In other embodiments, the club head 3910 can comprise any number of channels 3913, such as one channel 3913, two channels 3913, three channels 3913, four channels 3913, five channels 3913, six channels 3913, seven channels 3913, or eight channels 3913.

Figure 93:
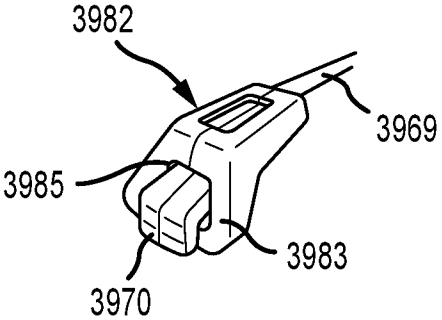
Figure 96:
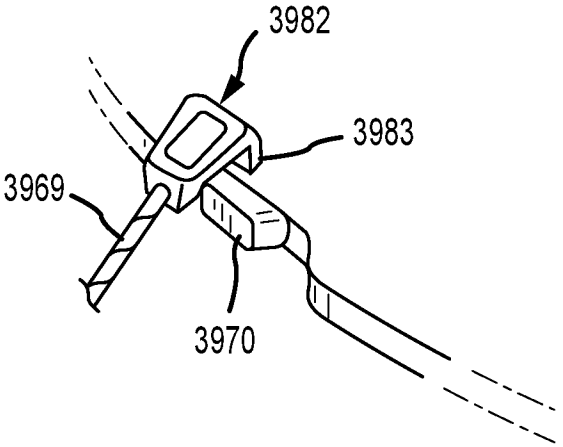

The channels 3913 comprise a recessed surface 3981, wherein the recessed surface 3981 is separated from the remaining outer surface 3974 of the sole 3930 by a wall 3984. The recessed surface 3981 of the channels 3913 comprise a groove (not shown), wherein the groove can comprise a plurality of discrete attachment locations. The plurality of discrete attachment locations can comprise various features 3970 including protruding bodies, apertures or recesses or ports capable of receiving a fastener, notches or tabs or cutout regions, ribs or grooves, pegs, hooks, magnets, programmable magnets, or any other suitable attachment means. The features 3970 define a discrete attachment location for securing the weight 3982 to the club head 3910. In contrast to other adjustable weighting systems wherein the weight can be coupled at any, or at an infinite, or at an unlimited number of locations across the recessed portion. The feature 3970 is a protrusion (e.g., a peg, a lip, a ledge, or any other protrusion configured to receive a hook-like formations on the weight 3982 of the adjustable weighting system 2966). The feature 3970 is positioned within the recessed surface 3981, adjacent the trailing edge 3972. In one embodiment, the feature 3970 extends within the groove toward the trailing edge 3972 (either parallel with the recessed surface 3981, or at an angle). In another embodiment, the feature 3970 extends within the groove toward the trailing edge 3972 and then bends downward toward the sole 3930 to create a hook-like protrusion as illustrated in FIG. 93. In another embodiment still, the feature 3970 extends within the groove toward the trailing edge 3972 and then bends upward away from the club head 3910 to create a hook-like protrusion as illustrated in FIG. 96. In embodiments wherein the feature 3970 extends toward the trailing edge 3972 and then bends upward away from the club head 3910, the feature 3970 does not extend past the lowest point of the golf club head 3910 when the club head 3910 is at address.

Figure 91:
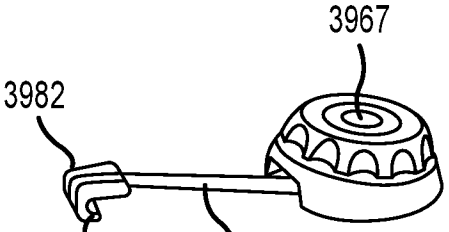
FIGS. 90-98 are perspective views of a golf club head according to another embodiment.
Figure 92:
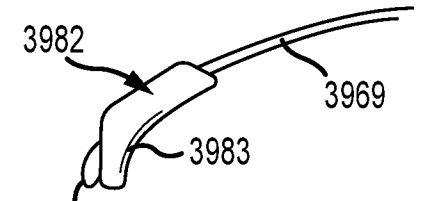

The adjustable weighting system 3966 comprises the tensioner the 3967, the cable 3969, and the weight 3982. As illustrated in FIGS. 90 and 91, the tensioner 3967 of the adjustable weighting system 3966 is positioned generally in a central location on the sole 3930 of the club head 3910, disposed between the radially extending channels 3913. Although in other embodiments, the tensioner 3967 can be positioned at other locations along the club head 3910, as long as the tensioner 3967 is disposed between the radially extending channels 3913. The tensioner 3967 can be attached to the club head 3910 by way of fastener or by an adhesive. When the tensioner 3967 is attached to the club head 3310, the tensioner 3967 does not extend past the lowest part of the club head 3910 when at address, thereby not obstructing a player's swing. The tensioner 3967 is configured to be coupled to the channel 3969 of the adjustable weighting system 3966.

Figure 98:
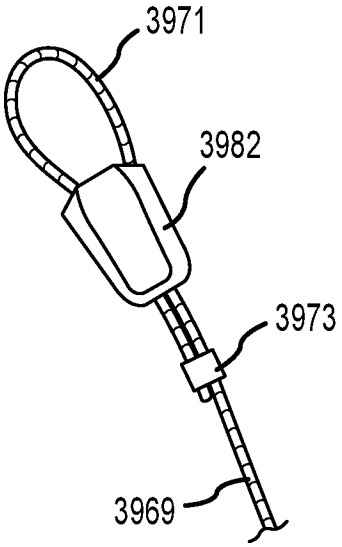
Figure 97:
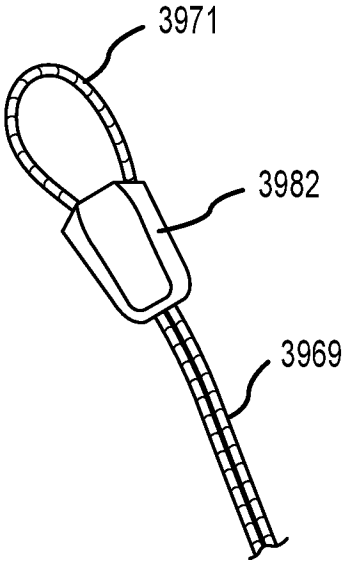

The cable 3969 of the adjustable weighting system 3966 is similar to the cables 3269, 3369, 3469, 3569, 3769, and 3869 as described above. The cable 3969 comprises a first end and a second end. The first end of the cable 3969 is configured to attach to the tensioner 3967. In some embodiments, the second end of the cable 3969 is configured to be coupled to the weight 3982, such that the weight 3982 is configured to couple to the feature 3970. In other embodiments as illustrated in FIGS. 97 and 98, the second end of the cable 3969 is coupled to the weights such that the second end of the cable 3969 creates a loop 3971 configured to couple to the feature 3970. In embodiments wherein the second end of the cable 3969 forms the loop 391, the weight 3982, or a clip attached to the second end and the cable can secure the loop 3971 to prevent unraveling. The cable 3969 are positioned within any of the channels 3913. In one example, the cable 3969 can be positioned in channel 3913B as illustrated in FIG. 90. In another example, the cable 3969 can be positioned in channel 3913D closest to the heel end 3922. The different positioning of the cable 3969 allows for the weight 3982 coupled to the cable 3969 to adjust the weight distribution of the club head 3910. The cable 3969 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3969 can be made of baling twine, parachute cord material, nylon, Kevlar, polymer tweed, steel wire with polymer coating, any metallic wire with polymer coating or etc.

In some embodiments as illustrated in FIGS. 91-96, the weight 3982 is an elongated body having a receiving region 3983. The receiving region is a hook-like lip extending downward from the elongated body of the weight 3982 toward the sole 3930 of the club head 3910. In some embodiments, the receiving region 3983 can be a solid lip configured to hook over the feature 3970 and press against the feature 3970 to secure the weight 3982 from detaching from the feature 3970. In other embodiments, the receiving region 3983 can comprise an aperture 3985. The aperture 3985 is configured to receive the feature 3970 and the remaining portion of the receiving region presses up against the groove of the channel 3913 to secure the weight 3982 from detaching from the feature 3970. In other embodiments still illustrated in FIG. 94, the receiving region 3983 of the weight 3982 can curve into a J-shape to encase the feature 3970, securing the weight 3982 from detaching. In other embodiments as illustrated in FIGS. 97 and 98, the weight 3982 is void of a receiving region 3983 and is not configured to receive the feature 3970. The weight 3982 is an elongated body configured to receive and secure the cable 3969 as the cable 3969 forms the loop 3971. In embodiments wherein the cable 3969 forms the loop 3971, the cable can be couple to more than one weight 3982 (e.g., one weight 3982, two weights 3982, three weights 3982, four weights 3982, or five weights 3982).

The weight 3982 further comprise a mass. The mass of the weight 3982 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3982 can be 3 grams, 6 grams, 9 grams, 12 grams, 15 grams, 18 grams, 21 grams, 24 grams, 27 grams, 30 grams, 33 grams, or 35 grams. In embodiments wherein the cable 3969 can couple to multiple weights 3982, the weights 3982 can all comprise the same mass, or all have different masses. For example, the cable 3969 is coupled to three weights 3982 with the first weight 3982 having a mass of 12 grams, and both the second and third weights 3982 having a mass of 5 grams. In another example, the couple is coupled to two weights 3982 with the first weight 3982 having a mass of 10 grams, and the second weight 3982 having a mass of 7 grams.

In some embodiments, when the weight 3982 is coupled to the feature 3970 (or the loop 3971 of the cable 3969 is coupled to the feature 3970), the weight 3982 is flush with the outer surface 3974 of the sole 3930. In other embodiments, the weight 3982 extend past the outer surface 3974 of the sole 3930, but does not extend past the lowest point of the club head 3910 at address to avoid obstructing a player's swing. In other embodiments still, the weight 3982 does not extend to the outer surface 3974 of the sole 3930 of the club head 3910.

The tensioner 3967 is similar to the tensioners 3267, 3367, 3467, 3567, 3667, 3767, and 3867 as described above, wherein the tensioner 3967 acts as a winch and ratchet mechanism. In other embodiments, the tensioner 3967 can be a J-slot tensioner similar to J-slot tensioner 3267 as described above. The tensioner 3967 may be rotated (e.g., twisted) in increments to adjust a tension in the cable 3969. The cable 3969, in turn, is coupled to one or more of the weights 3982 (e.g., the weights 3982 being permanently or removably fixed at the second end of the cable 3969). When receiving region 3983 of the weight 3982 is coupled to one of the features 3970, the tensioner 3967 is rotated clockwise, the cable 3969 is tightened (e.g., retracted), and the weight are thus pulled firmly against the feature 3970 grooves of the channels 3913. The pull on the weight 3982 creates a force against the feature 3970 (or groove of the channel 3969), which prevents the weight 3982 from popping off the feature 3970. In the embodiment illustrated in FIGS. 97 and 98, the cable 3969 itself forms the loop 3971, which is configured to receive the feature 3970. When the loop 3971 is coupled to the feature 3970, and the tensioner 3967 is rotated clockwise, the cable 3969 tightens and the loop 3971 is pulled firmly against the feature 3970. The pull on the loop 3971 creates a force against the features 3970 to secure the coupling of the loop 3971 and the feature 3970. Various other types of hooks, loops, and/or other structure may be used to couple the weight 3982 or loop 3971 to the feature 3970. In other embodiments, the cable 3969 can be retracted by other means other than by the tensioner 3967.

When the tensioner 3967 is pressed (or pulled) the tension is loosened on the cable 3969. As the tensioner in the cable decreases 3969, the receiving region 3983 of the weight (or the loop 3971 of the cable 3969) is no longer pressed against the feature 3970. The weight 3982 (or loop 3971) can then be removed from the feature 3970 and be repositioned to a different feature 3970 in a different channel 3913. The ability to reposition the cable 3969 and weight 3982 to a different channel 3913 allows for the center of gravity of the golf club head to shift about the heel to toe without having to sacrifice a relatively high moment of inertia similar to a golf club head without adjustable weighting. For example, when the cable 3969 and weight 3982 are positioned within the channel 3913A to shift the center of gravity toward the toe end 3918, wherein a CG toward the toe end 3918 will help center ball flight for players who tend to hook their shots.

In some embodiments, the tensioner 3967 is in a naturally locked orientation, wherein the tensioner 3967 can be pressed to engage the rotational movement of the winch and ratchet mechanism in order to loosen tension in the cable 3969. When the tension is released (e.g., when the cable 3969 is extended), the weight 3982 may then be repositioned onto a different area along the club head 3910 (e.g., may be secured to a different feature 3970). During the repositioning of the weights 3982, the cable 3969 may be moved from one channel 3913 to a different channel 3913. In other embodiments, the tensioner 3967 is naturally in a locked orientation, wherein the tensioner 3967 can be pulled upward to engage the rotational movement of the winch and ratchet mechanism to release the tension of the cable 3969. In some embodiments, a tool is required to rotate the tensioner 3967 and/or to release tension in the cable 3969.

The club head 3910 having the adjustable weighting system 1966 comprises the tensioner 3967 (or other cable adjustment means) and the cable 3969 described above can optimize the performance of the golf club. The adjustable weighting system 3966 allows for the club head 3910 to adjust the already low and back center of gravity about the x-axis (heel-to-toe end), and about the y-axis (strikeface-to-rear) without having to sacrifice a relatively high moment of inertia (MOI) similar to that of a club head void of an adjustable weight system. Shifting the CG about the x-axis allows for players to correct a slice or a hook in ball trajectory, while shifting the CG about the y-axis allows for players to control the spin imparted on a ball.

The club head 3910 having the tensioner 3967 and the cable 3969 adjustable weight system 3966 further have an utility regarding ease of manufacturing compared to club heads with more complex structures to house a weight (i.e., deep weight ports, multiple weight ports, rail systems, weight covers/caps). The weight(s) 3982 coupled to the club head body 3914 are secured by the tension of the cable, which create a abutment force on the weight(s) 3982 onto the feature 3970. The abutment force eliminates the need for the club head 3910 to be manufactured with a weight housing structure having complex internal/external geometries in order to secure the weight(s) 3982. Thereby reducing the material and mass associated with the complex weight housing structure. The mass saved from the lack of the weight housing structure can then be positioned elsewhere on the club head 3982 to increase strength and/or mass in that location. The abutment force created by the cable 3969 further eliminates the need for screw-type fasteners, thus the weight(s) 3982 and club head 3910 do not require manufacturing a threaded aperture to receive the fastener. The lack of the fastener and threaded aperture reduces the cost of manufacturing and increase production.

Further, the cable 3969 of the adjustable weighting system 3966 is lightweight, strong, and can be incorporated with the channels 3913 in a number of different patterns on an outer surface 3974 of the club head 3910. The different patterns allows for the weight(s) 3982 to be place in a number of different locations on the sole 3930 because the weight(s) 3982 are not limited to specific weight housing structures. The number of different weight positions can help fine tune the center of gravity placement to adjust the ball spin and trajectory for individual players. The cable 3969 can further be strategically placed in such a pattern that the cable 3969 can reinforce specific locations on the club head 3910. The material and pattern of the cable 3969 can further still act as a sound dampener and absorb vibration experienced by the club head 3910 during impact, thereby reducing unwanted sound, and unwanted stress during a game.

The adjustable weighting system 3966 of golf club head 3910 maintains or prevents a significant reduction in club head moment of inertia, and low and back club head center of gravity positioning, compared to a club head devoid of an adjustable weighting system. The adjustable weighting system 3966 of golf club head 3910 maintains a high club head moment of inertia and a low and back club head CG position due to the low profile of the weighting system and the perimeter positioning of the one or more weights. The club head 3910 having the adjustable weighting system 3966 can have similar or identical parameters and measurements as club head 100 described above.

Figure 99:
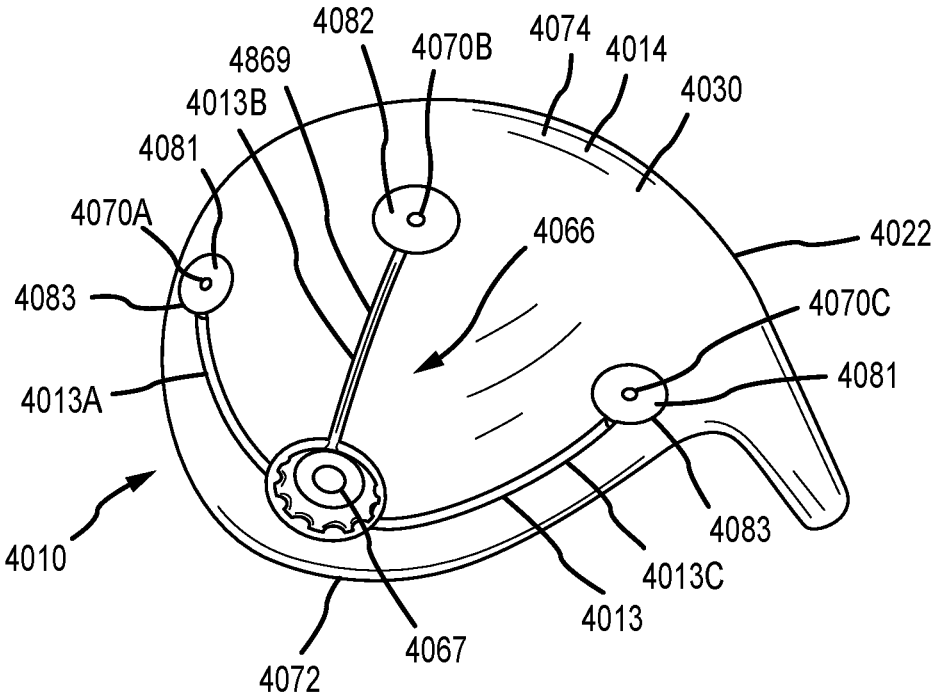
FIGS. 99 and 100 are perspective views of golf club head according to another embodiment.
Figure 100:
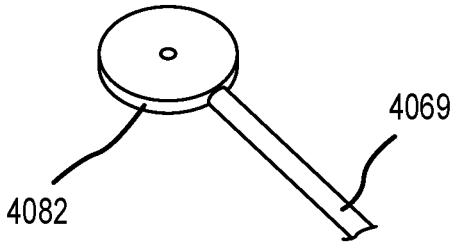

FIGS. 99 and 100 illustrate a club head 4010 having a club head body 4014. The club head 4010 includes an adjustable weighting system 4066 comprises a weight 4082, a cable 4069, and a tensioner 4067 that is adjustable by an end user to modify the club head 4010 center of gravity and/or moment of inertia and/or heel/toe bias to achieve desired performance characteristics (e.g., forgiveness, spin, trajectory) under various circumstances. The adjustable weighting system 4066 is a low profile system and thereby does not significantly shift or change the club head 4010 MOI when compared to a club head not including the adjustable weighting system 4066. Further, the low profile adjustable weighting system 4066 ensures that shifts in the club head 4010 CG occur in a heel end 4022 to toe end 4018 direction keeping the overall club head 4010 CG in a low and back location. The adjustable weighting system 4066 can further shift the CG about the y-axis (front and rear) to adjust ball spin.

The adjustable weighting system 4066 is positioned on a sole 4030 of the club head 4010. As illustrated in FIG. 99, the sole 4030 of the club head 4010 comprises channels 4013. The channels 4013 extend from a generally central position adjacent a trailing edge 4072, toward a center, toward a toe end 4018, and/or toward a heel end 4022 of the sole 4030. In other embodiments, the channels 4013 can extend form any position on the sole 4030 of the club head 4010. In the illustrated, the sole 4030 comprises three channels 4013: a first channel 4013A running along the trailing edge 4072, toward the toe end 4018, a second channel 4013C running along the trailing edge 4072, toward the heel end 4022, and a third channel 4013B between the first channel 4013A and the second channel 4013C, extending toward a general center of the sole 4030. In other embodiments, the sole 4030 can comprise any number of channels 4013, such as one channel 4013, two channels 4013, three channels 4013, four channels 4013, five channels 4013, and five channels 4013. The channels 4013 comprise a recessed surface 4081, wherein the recessed surface 4081 is separated from the remaining outer surface 4074 of the sole by a wall 4083.

In the illustrated embodiments, the channels 4013 extend from the generally central positioned adjacent the trailing edge 4072 and extends into a recessed portion 4080 forming a circular recess. In other embodiments, the recessed portion 4080 can form any polygonal recess shape (e.g, triangular, square, trapezoidal, rectangular, pentagonal, hexagonal, etc.). The recessed portion 4080 comprises a plurality of discrete attachment locations. The plurality of discrete attachment locations can comprise various features 4070 including protruding bodies, apertures or recesses or ports capable of receiving a fastener, notches or tabs or cutout regions, ribs or grooves, pegs, hooks, magnets, programmable magnets, or any other suitable attachment means. The features 4070 define a discrete attachment location for securing the weight 4082 to the club head 4010. In contrast to other adjustable weighting systems wherein the weight can be coupled at any, or at an infinite, or at an unlimited number of locations across the recessed portion. The feature 4070 is a protrusion extending from a general center of the recessed portion. In some embodiments, the feature 4070 is flush with an outer surface 4074 of the sole 4030. In other embodiments, the feature 4070 does not extend past the outer surface 4074 of the sole 4030. The recessed portion 4080 and feature 4070 are configured to receive a weight 4082 of the adjustable weighting system.

The adjustable weighting system 4066 comprises the tensioner 4067, the cable 4069, and the weight 4082. As illustrated in FIG. 4067, the tensioner is positioned on the generally central location on the sole 4030, adjacent the trailing edge 4072, and disposed between the intersection of the channels 4013. Although, in other embodiments, the tensioner 4067 can be positioned at other locations on the sole 4030, just as long as the tensioner 4067 is disposed between the intersection of the channels 4013. The tensioner 4067 can be attached to the club head 4010 by way of fastener or by an adhesive. When the tensioner 4067 is attached to the sole 4010 of the club head 4010, the tensioner does not extend past the lowest point of the club head 4010 when at address.

The cable 4069 of the adjustable weighting system 4066 is similar to the cables 3269, 3369, 3469, 3569, 3769, 3869, and 3969 as described above. The cable 4069 comprises a first end and a second end. The first end of the cable 4069 is configured to attach to the tensioner 4067, while the second end of the cable 4069 is configured to attach to the weight 4082. The cable 4069 is positioned within any of the channels 4010 to effect the weight distribution and CG of the club head 410. For example in the illustrated embodiment, the cable 4069 can be positioned in the third channel 4013B, wherein the third channel 4013B is located in the general center can give a player a neutral ball trajectory for player who typically is a straight shooter. The cable 4069 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4069 can be made of baling twine, parachute cord material, nylon, Kevlar, polymer tweed, steel wire with polymer coating, any metallic wire with polymer coating or etc.

In some embodiments as illustrated in FIGS. 99 and 100, the weight 4082 is a general circular shape. In other embodiments, the weight 4082 can have any polygonal shape such as a triangular, square, rectangular, pentagonal, hexagonal or etc. In many embodiments, the weights 4082 are shaped similar to the polygonal shape of the recessed portion 4080 but slightly smaller, wherein when the weight 4082 is received within the recessed portion 4080, there is a gap around the perimeter of the weight 4082 which allows an end user room to retrieve the weight 4082. The weight 4082 comprises an aperture (not pictured) positioned on a bottom surface of the weight 4082. The aperture of the weight 4082 is configure to receive the feature 4070 of the recessed portion 4080 which is complementary to the aperture of the weight 4082. When the weight 4082 is positioned within the recessed portion 4080, the weight 4082 is flush with the outer surface 4072 of the sole 4030. In other embodiments, the weight 4082 is not flush with the outer surface 4072 of the sole 4030, wherein the weight 4082 can extend past, or does not extend to the outer surface 4072 of the sole 4030.

The weight 4082 further comprise a mass. The mass of the weight 4082 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4082 can be 1 gram, 2 grams, 3 grams, 6 grams, 9 grams, 12 grams, 15 grams, 18 grams, 21 grams, 24 grams, 27 grams, 30 grams, 33 grams, or 35 grams.

The tensioner 4067 is similar to the tensioner 3267, 3367, 3467, 3567, 3667, 3767, 3867, and 3967 as described above, wherein the tensioner 4067 acts as a winch and ratchet mechanism. In other embodiments, the tensioner 4067 can be a J-slot tensioner similar to J-slot tensioner 3267 as described above. The tensioner 4067 may be rotated (e.g., twisted) in increments to adjust a tension in the cable 4069. The cable 4069, in turn, are coupled to the weight 4082 (e.g., the weight 4082 being permanently or removably fixed at a distal end of the cable or cables 4069), and are disposed within channels 4013 that also form part of the recessed portion 4080. The aperture of the weight 4082 receives the feature 4070 within the recessed portion 4080, which prevents the weight 402 from shifting. When the tensioner 4067 is rotated clockwise, the cable 4069 is tightened (e.g., retracted), and the weight is tightly latched onto the feature 4070 and is secured. In other embodiments, the cable 4069 can be retracted by other means other than by the tensioner 4067.

The tensioner 4067 can be pressed (or pulled) to loosen the tension on the cable 4069. As the tension in the cable 4069 decreases, the weight 4082 does not create a force onto the feature 4070 to secure the weight 4082. The weight 4082 can then be removed from the recessed portion 4080 and be repositioned by an end user onto different features 4070 of a different recessed portion 4080. In other embodiments, the cable 4069 can be retracted by other means other than by the tensioner 4067.

In some embodiments, the tensioner 4067 is in a naturally locked positioned and can be pressed downward to engage the rotational movement of the winch and ratchet mechanism in order to release tension in the cable or cables. When the tension is released (e.g., when the cable 4069 is extended), the weights 4082 may then be repositioned into a different recessed portion 4080 (e.g., may be secured to a different protruding feature 4070). In other embodiments, the tensioner 4067 is naturally in a locked portion, wherein the tensioner 4067 can be pulled upward away from the club head 4010 to engage the rotational movement to release the tension in the cable 4069. In some embodiments, the channels 4013 and/or the features 4070 include an undercut to facilitate retention of the weights 4082. In some embodiments, a tool is required to rotate the tensioner 4067 and/or to release tension in the cable 4069. In other embodiments, the cable 4069 can be loosened by other means other than by the tensioner 4067.

The club head 4010 having the adjustable weighting system 4066 comprises the tensioner 4067 (or other cable adjustment means) and the cable 4069 described above can optimize the performance of the golf club. The adjustable weighting system 4066 allows for the club head 4010 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory, and shifting the CG about the y-axis allows players to adjust the ball spin.

The club head 4010 having the tensioner 4067 and the cable 4069 adjustable weight system 4066 further have an utility regarding ease of manufacturing compared to club heads with more complex structures to house a weight (i.e., deep weight ports, multiple weight ports, rail systems, weight covers/caps). The weight 4082 coupled to the club head body 4010 are secured by the tension of the cable 4069, which create a friction between a surface of the weight 4082 and a surface of the recessed portion 4080 and the feature 4070. The tension and frictional force eliminates the need for the club head 4010 to be manufactured with a weight housing structure having complex internal/external geometries in order to secure the weight 4082. Thereby reducing the material and mass associated with the complex weight housing structure. The mass saved from the lack of the weight housing structure can then be positioned elsewhere on the club head 4010 to increase strength and/or mass in that location. The tension and friction created by the cable 4069 further eliminates the need for screw-type fasteners, thus the weight 4082 and club head 4010 do not require manufacturing a threaded aperture to receive the fastener. The lack of the fastener and threaded aperture reduces the cost of manufacturing and increase production.

Further, the cable 4069 of the adjustable weighting system 4066 is lightweight, strong, and can be incorporated with the channels 4013 in a number of different patterns on an outer surface 4074 of the club head 4010. The different patterns allows for the weight 4082 to be place in a number of different locations on the sole 4030 because the weight 4082 are not limited to specific weight housing structures. The number of different weight 4082 positions can help fine tune the center of gravity placement to adjust the ball spin and trajectory for individual players. The cable 4069 can further be strategically placed in such a pattern that the cable 4069 can reinforce specific locations on the club head 4010. The material and pattern of the cable 4069 can further still act as a sound dampener and absorb vibration experienced by the club head 4010 during impact, thereby reducing unwanted sound, and unwanted stress during a game.

The adjustable weighting system 4066 of golf club head 4010 maintains or prevents a significant reduction in club head moment of inertia, and low and back club head center of gravity positioning, compared to a club head devoid of an adjustable weighting system. The adjustable weighting system 4066 of golf club head 4010 maintains a high club head moment of inertia and a low and back club head CG position due to the lightweight adjustable weighting system 4166, and the lack of a complex internal/external weight housing structure. The club head 4010 having the adjustable weighting system 4066 can have similar or identical parameters and measurements as club head 100 described above.

Figure 101:
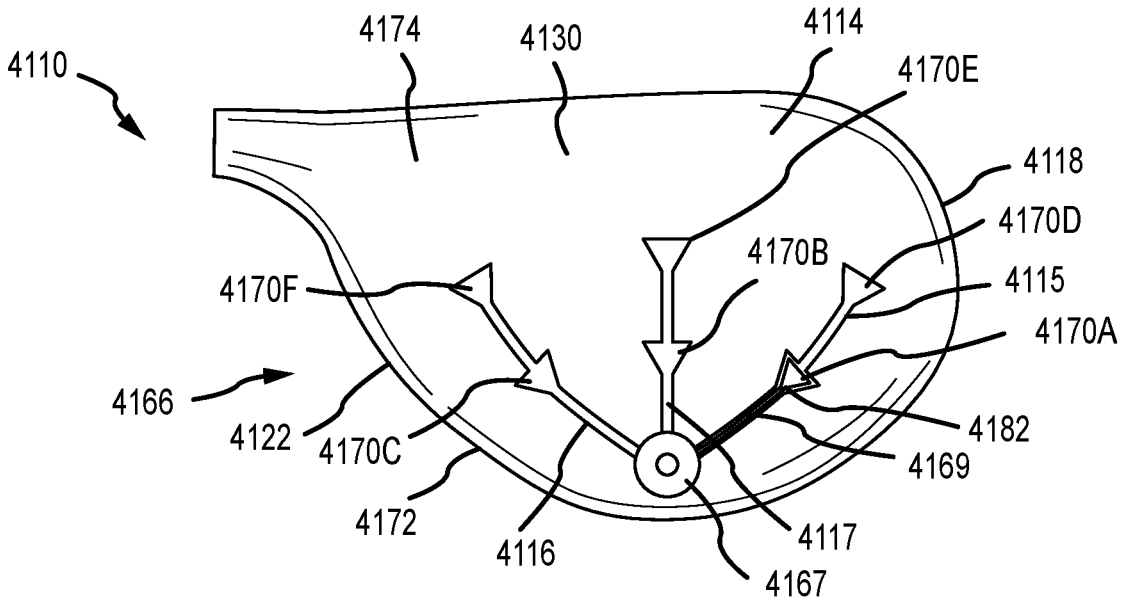
FIGS. 101 and 101A are perspective views of a golf club head according to another embodiment.

FIG. 101 illustrates a club head 4110 having a club head body 4114. The club head 4110 includes an adjustable weighting system 4166 that is adjustable by an end user to modify the club head 4110 center of gravity and/or moment of inertia and/or heel/toe bias to achieve desired performance characteristics (e.g., forgiveness, spin, trajectory) under various circumstances. The adjustable weighting system 4166 is a low profile system and thereby does not significantly shift or change the club head 4110 MOI when compared to a club head not including the adjustable weighting system 4166. Further, the low profile adjustable weighting system 4166 ensures that shifts in the club head 4110 CG occur mainly in a heel end 4122 to toe end 4118 direction keeping the overall club head 4110 CG in a low and back location. Although, the adjustable weighting systems allows for CG shifting about the y-axis (front to rear) to adjust ball spin.

The adjustable weighting system is positioned on a sole 4130 of the club head 4110. As illustrated in FIG. 101, the sole 4130 comprises channels 4113. The channels 4113 extend from a generally central location adjacent a trailing edge 4172, extending toward a center, toward a toe end 4118, toward a heel end 4122 of the sole 4130, or a combination thereof. In other embodiments, the channels 4113 can extend form any position on the sole 4130 of the club head 4110. In the illustrated, the sole 4130 comprises three channels 4113: a first channel 4115 running along the trailing edge 4172, toward the toe end 4118, a second channel 4116 running along the trailing edge 4172, toward the heel end 4122, and a third channel 4117 between the first channel 4113A and the second channel 4113C, extending toward a general center of the sole 4130. In other embodiments, the sole 4130 can comprise any number of channels 4113, such as one channel 4113, two channels 4113, three channels 4113, four channels 4113, five channels 4113, five channels 4113, six channels 4113, seven channels 4113, or eight channels 4113.

Figure 101A:
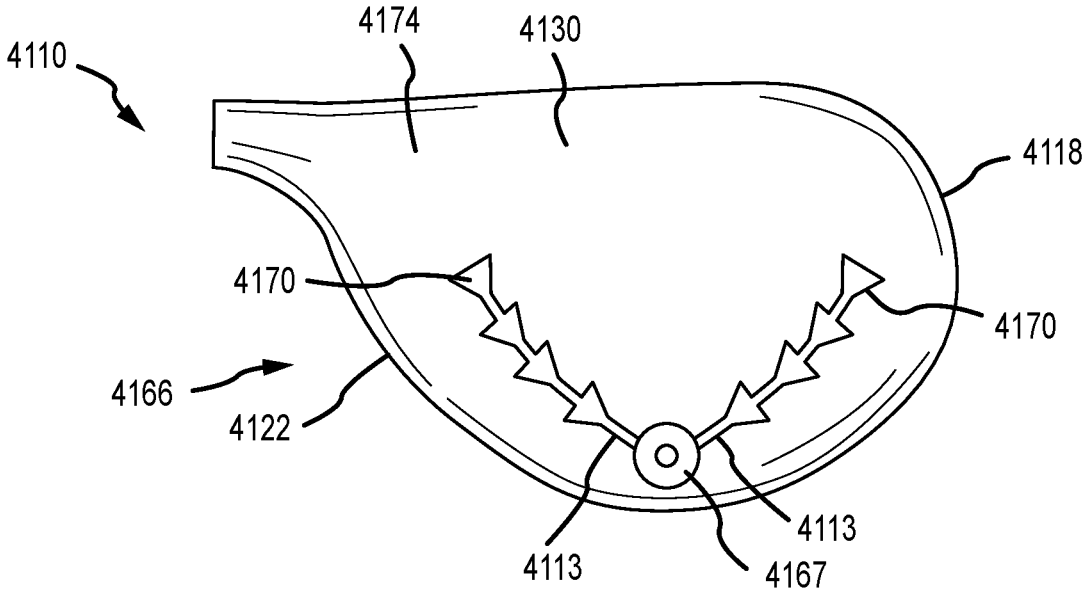

As illustrated in FIGS. 101 and 101A, the channels 4113 comprises a plurality of discrete attachment locations. The plurality of discrete attachment locations can comprise various features 4170 including protruding bodies, apertures or recesses or ports capable of receiving a fastener, notches or tabs or cutout regions, ribs or grooves, pegs, hooks, magnets, programmable magnets, or any other suitable attachment means. The features 4170 define a discrete attachment location for securing the weight 4182 to the club head 4110. In contrast to other adjustable weighting systems wherein the weight can be coupled at any, or at an infinite, or at an unlimited number of locations across the recessed portion. The features 4170 are notches or recessed portions positioned along the channels 4113 of the club head body 4110 configured to receive a weight 4182. The features 4170, are generally triangular in the illustrated embodiment, but in other embodiments may have different shapes and/or sizes such as circular, square, rectangular, pentagonal, hexagonal, octagonal, or any other polygonal shape. Further illustrated in FIG. 101, each channel 4113 comprises two features 4170: wherein a first feature 4170A is positioned rearward toward the trailing edge 4172 on the first channel 4115 near the toe end 4118, a second feature 4170C is positioned rearward toward the trailing edge 4172 on the second channel 4116 near the heel end 4122, a third feature 4170B positioned rearward toward the trailing edge 4172 between the first feature 4170A and the second feature 4170C, a fourth feature 4170D is positioned more forward toward a strikeface on the first channel 4115 near the toe end 4118, a fifth feature 4170F is positioned more forward toward the strikeface on the second channel 4416 near the heel end 4122, and a sixth feature 4170E is positioned more forward toward the strikeface on on the third channel 4117. In other embodiments, the channels 4113 can comprise any number of features 4170 (e.g., one feature 4170, two features 4170, three features 4170, four features 4170, five features 4170, six features 4170, seven features 4170, or eight features 4170). In some embodiments, each channel 4113 can comprise the same number of features 4170, while in other embodiments, each channel 4113 can comprise different number of features 4170. For example, the first channel 4115 can comprise three features 4170, while the second channel 4116 comprises two features 4170. The features 4170 can be space equidistant from one another. In other embodiments, the features 4170 can be spaced at any distance from one another. As illustrated in FIG. 101A, the features 4170 can overlap with one another.

The adjustable weighting system 4166 is comprises the tensioner 4167, the cable 4169, and the weight 4182. As illustrated in FIG. 101, the tensioner 4167 is positioned on a generally central location on the sole 4130 adjacent to the trailing edge 3172, and disposed between the intersection of the channels 4113. Although in other embodiments, the tensioner 4167 can be positioned at other locations on the sole 4130, and disposed between the intersection of the channels 4113. The tensioner 4167 can be attached to the club head 4110 by way of fastener or by an adhesive. When the tensioner 4167 is attached to the sole 4110 of the club head 4110, the tensioner 4167 does not extend past the lowest point of the club head 4110 when at address. In other embodiments, the tensioner 4167 is flush with the outer surface 4174 of the sole 4130.

The cable 4169 of the adjustable weighting system 4166 is similar to the cables 3269, 3369, 3469, 3569, 3769, 3869, 3969, and 4069 as described above. The cable 4169 comprises a first end and a second end. The first end of the cable 4169 is configured to attach to the tensioner 4167, while the second end of the cable 4169 is configured to attach to the weight 4182. The cable 4169 can be positioned within any of the channels 4113 (e.g., the first channel 4115, the second channel 4116, the third channel 4117), and paired with the different positioning of the features 4170 to effect the weight distribution and CG of the club head 4110. For example in the illustrated embodiment, the cable 4169 can be positioned in the first channel 4115, wherein the first channel 4115 is located at the toe end 4118 can correct a player who tends to slice a ball. The cable 4169 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4169 can be made of baling twine, parachute cord material, nylon, Kevlar, polymer tweed, steel wire with polymer coating, any metallic wire with polymer coating or etc. In other embodiments, the channel 4169 is not coupled to the tensioner 4167 and can be loosen/retracted by other means other than by the tensioner 4167.

In some embodiments as illustrated in FIG. 101, the weight 4182 is a general triangular shape. In other embodiments, the weight 4182 can have any polygonal shape such as a circular, square, rectangular, pentagonal, hexagonal, or any other geometric shape. In many embodiments, the weight 4182 is shaped similar to the polygonal shape of the feature 4170 but slightly smaller. Therefore, when the weight 4082 is received within the recessed portion 4080, there is a gap around the perimeter of the weight 4182, which allows an end user room to retrieve the weight 4182. When the weight 4182 is positioned within the feature 4170, the weight 4182 is flush with the outer surface 4174 of the sole 4130. In other embodiments, the weight 4182 is not flush with the outer surface 4174 of the sole 4030, wherein the weight 4182 can extend past, or does not extend to the outer surface 4174 of the sole 4130.

The weight 4182 further comprise a mass. The mass of the weight 4182 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4182 can be 1 grams, 2 grams, 3 grams, 6 grams, 9 grams, 12 grams, 15 grams, 18 grams, 21 grams, 24 grams, 27 grams, 30 grams, 33 grams, or 35 grams.

The tensioner 4167 is similar to the tensioner 3267, 3367, 3467, 3567, 3667, 3767, 3867, 3967, and 4067 as described above, wherein the tensioner 4167 acts as a winch and ratchet mechanism. In other embodiments, the tensioner 4167 can be a J-slot tensioner similar to J-slot tensioner 3267 as described above. The tensioner 4167 may be rotated (e.g., twisted) in increments to adjust a tension in the cable 4169. The cable 4169, in turn, is coupled to the weight 4182 (e.g., the weight 4182 being permanently or removably fixed at distal end of the cable 4169). When the tensioner 4167 is rotated, the cable 4169 is tightened (e.g., retracted), and the cable 4169 pulls the weight or weights 4182, to create a force firmly against the feature 4170 of the club head body 4010, thereby securing the weight 4182. In some embodiments, the channels 4113 and/or the features 4170 themselves include an undercut to facilitate retention of the weights 4182. In other embodiments, the channel 4169 can be retracted by other means other than by the tensioner 4167.

The tensioner 4167 can be pressed (or pulled) to loosen the tension on the cable 4169. As the tension in the cable 4069 decreases, the weight 4182 does not create a force onto the feature 4170 to secure the weight 4182. The weight 3882 can then be removed from the feature 4170 and be repositioned by an end user onto different features 4170 of the same channel 4113, or of different channels 4113. In other embodiments, the channel 4169 can be loosen by other means other than by the tensioner 4167.

In some embodiments, the tensioner 4167 is in a naturally locked orientation and can be pressed downward to engage the rotational movement of the winch and ratchet mechanism in order to release tension in the cable 4169. When the tension is released (e.g., when the cable 4169 is extended), the weights 4182 may then be repositioned onto different positions on the sole 4130 (e.g., may be secured to a different notched feature 4170). In other embodiments, the tensioner 4167 is naturally in a locked portion, wherein the tensioner 4167 can be pulled upward to engage the rotational movement to release the tension in the cable 4169. In some embodiments, a tool is required to rotate the tensioner 4167 and/or to release tension in the cable 4169.

The club head 4110 having the adjustable weighting system 4166 comprises the tensioner 4167 (or other cable adjustment means) and the cable 4169 described above can optimize the performance of the golf club. The adjustable weighting system 4166 allows for the club head 4110 to adjust the already low and back center of gravity about the x-axis (heel-to-toe end), and about the y-axis (strikeface-to-rear) without having to sacrifice a relatively high moment of inertia (MOI) similar to that of a club head void of an adjustable weight system. Shifting the CG about the x-axis allows for players to correct a slice or a hook in ball trajectory, while shifting the CG about the y-axis allows for players to control the spin imparted on a ball.

The club head 4110 having the tensioner 4167 and the cable 4169 adjustable weight system 4166 further have an utility regarding ease of manufacturing compared to club heads with more complex structures to house a weight (i.e., deep weight ports, multiple weight ports, rail systems, weight covers/caps). The weight(s) 4182 coupled to the feature(s) 4170 are secured by the tension of the cable, which create a friction between a surface of the weight(s) 4182 and a surface of the club head, as well as an abutment force within the feature(s) 4170. The abutment and frictional force eliminates the need for the club head 4110 to be manufactured with a weight housing structure having complex internal/external geometries in order to secure the weight(s) 4182. Thereby reducing the material and mass associated with the complex weight housing structure. The mass saved from the lack of the weight housing structure can then be positioned elsewhere on the club head 411 to increase strength and/or mass in that location. The abutment force and friction created by the cable 4169 further eliminates the need for screw-type fasteners, thus the weight(s) 4182 and club head 4110 do not require manufacturing a threaded aperture to receive the fastener. The lack of the fastener and threaded aperture reduces the cost of manufacturing and increase production.

Further, the cable 4169 of the adjustable weighting system 4166 is lightweight, strong, and can be incorporated with the channels 4113 in a number of different patterns on the outer surface 4174 of the club head 4110. The different patterns allows for the weight(s) 4182 to be place in a number of different locations on the sole 4130 because the weight(s) 4182 are not limited to specific weight housing structures. The number of different weight positions can help fine tune the CG placement to adjust the ball spin and trajectory for individual players. The cable 4169 can further be strategically placed in such a pattern that the cable 4169 can reinforce specific locations on the club head 4110. The material and pattern of the cable 4169 can further still act as a sound dampener and absorb vibration experienced by the club head during impact, thereby reducing unwanted sound, and unwanted stress during a game.

The adjustable weighting system 4166 of golf club head 4110 maintains or prevents a significant reduction in club head moment of inertia, and low and back club head center of gravity positioning, compared to a club head devoid of an adjustable weighting system. The adjustable weighting system 4166 of golf club head 4110 maintains a high club head moment of inertia and a low and back club head CG position due to the adjustable weighting system 4166 being lightweight and lack of complex internal/external weight housing structures. The club head 4110 having the adjustable weighting system 4166 can have similar or identical parameters and measurements as club head 100 described above.

Figure 102:
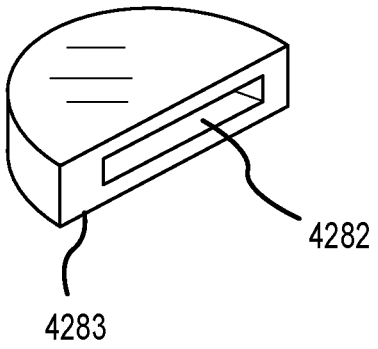
FIGS. 102 and 103 are perspective views of an adjustable weight according to another embodiment.
Figure 103:
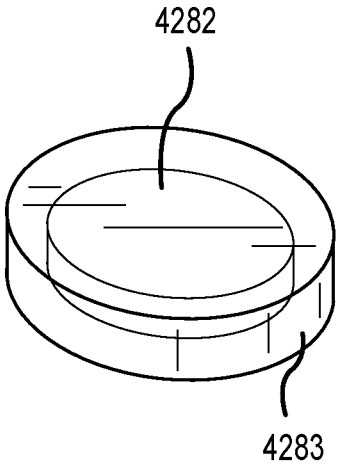

FIGS. 102 and 103 illustrate cross-sections of weights 4282 that are covered with a casing or casings 4283. The casing 4283 may be made, for example, of rubber, silicon, an elastomer, or other material. Some example of materials can be polymers such as low-density polyethylene (LDPE), high-density polyethylene (HDPE), polypropylene (PP), polyvinyl chloride (PVC), polystyrene (PS), teflon (Polytetrafluoroethylene), thermoplastic polyurethanes, natural polyisoprene, synthetic polyisoprene, polybutadiene, chloroprene rubber, butyl rubber, styrene-butadiene nitrile rubber or any other polymer, elastomers, and/or friction/dampening material. The weights 4282 with casings 4282 may be used in conjunction with any of the club heads described above, and may dampen vibrations between the weight 4282 and the club head during impact with a golf ball, thereby improving sound and durability of the club head. Additionally, any of the other weights described herein may also include a casing 4283 similar to that illustrated in FIGS. 102 and 103.

Figure 105:
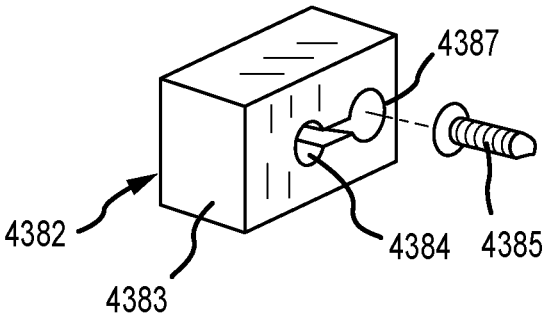

FIG. 105 illustrates a club head 4310 having a club head body 4314. The club head 4310 includes an adjustable weighting system 4366 that is adjustable by an end user to modify the club head 4310 center of gravity and/or moment of inertia and/or heel/toe bias to achieve desired performance characteristics (e.g., forgiveness, spin, trajectory) under various circumstances. The adjustable weighting system 4366 is a low profile system and thereby does not significantly shift or change the club head 4310 MOI when compared to a club head not including the adjustable weighting system 4366. Further, the low profile adjustable weighting system 4366 ensures that shifts in the club head 4310 CG occur mainly in a heel end 4322 to toe end 4318 direction keeping the overall club head 4310 CG in a low and back location.

Figure 104:
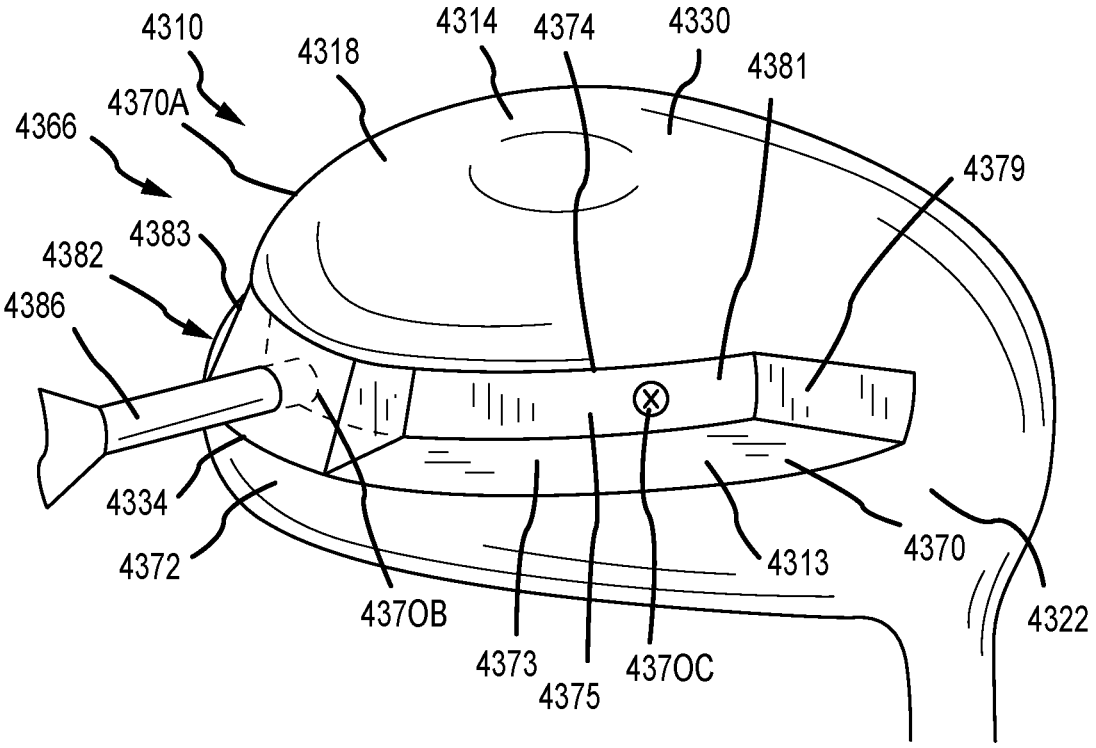
FIGS. 104 and 105 are perspective views of a golf club head and adjustable weight according to another embodiment.

As illustrated in FIGS. 104 and 105, the adjustable weighting system 4366 further comprises a plurality of discrete attachment locations. The plurality of discrete attachment locations can comprise various features 4370. In some embodiments, the features 4370 can be protruding bodies, apertures, recesses, ports capable of receiving a fastener, notches, tabs, cutout regions, ribs, grooves, pegs, hooks, magnets, programmable magnets, or any other suitable attachment means. The adjustable weighting system 4366 can further comprise a shallow channel or shallow recessed portion 4313. The channel 4313 is defined by three surfaces 4373, 4374, 4375, each of which can be configured to comprise at least one feature 4370. Each feature 4370 defines a discrete attachment location for securing a weight 4382 to the club head 4310. In the illustrated embodiment, the adjustable weighting system 4366 includes a channel 4313 comprising a plurality of features 4370, wherein the features 4370 in the illustrated embodiment are apertures.

The channel 4313 extends from near the toe end 4318 in an arcuate manner to near the heel end 4322 following the contour of the trailing edge 4372 of the club head 4310. The channel 4313 is defined by a first surface 4373, a second surface 4374 disposed opposite the first surface 4373, and a third surface 4375 that extends between the first surface 4373 and the second surface 4374. In some embodiments, the first surface 4373 extends parallel to the second surface 4374, and perpendicular to the third surface 4375. The channel 4313 is further defined in part by additional end surfaces 4379 that directly intersect the first surface 4373, the second surface 4374, and the third surface 4375. The additional end surfaces 4379 may provide added support and/or provide an abutment region or edge against which the weights 4383 may rest. In some embodiments, the weights 4382 can be flush with an outer surface 4390 of the club head 4310. The flush orientation may improve air flow characteristics during a swing to improve the club head 4310 aerodynamics.

The channel 4313 includes a depth measured along a direction toward a center of the club head 4310, and/or along a direction that is normal to the third surface 4375. In some embodiments, the channel 4313 can comprise a constant depth from the toe end 4318 to the heel end 4322. In the some embodiment, the channel 4313 can have a varying depth such that it is deeper in some areas than in other areas (e.g., may have a continuously or intermittently changing depth). In other embodiments, the channel depth 4313 can have an increasing, decreasing and/or constant depth along its length from the toe end 4318 to the heel end 4322. Thus, when a weight 4382 is coupled to the club head 4310 in one region of the channel 4313, the weight 4382 may fit flush in the channel 4313 and/or be concealed by the first and/or second surfaces 4373, 4374. When the weight 4382 is coupled to the club head 4310 in a different region of the channel 4313, a portion of the weight 4382 may protrude beyond the first and/or second surfaces 4373, 4374. In some embodiments, the channel 4313 includes a region or regions at the rear or back end 4334 where a portion of the weight 4382 protrudes beyond the first surface 4373 and/or the second surface 4374 when coupled.

In many embodiments, the channel 4313 has a shallow depth ensuring the adjustable weight system 4366 remains low profile. For example, in some embodiments, the channel 4313 has a maximum depth of 0.25 inches. In other embodiments, the channel 4313 can have a maximum depth of 1.5, 1.25, 1.0, 0.9, 0.8, 0.7, 0.6, 0.5, 0.4, 0.3, 0.2, or 0.1 inches. In other embodiments, the depth of the channel 4313 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 4313 includes a width measured as the distance between the first surface 4373 and the second surface 4374. In the illustrated embodiments, the channel 4313 includes a constant width. In other embodiments, the channel 4313 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 104 the channel 4313 can include one or more features 4370 defining a discrete attachment location for securing a weight 4382 to the club head 4310. The features 4370 are apertures positioned on the third surface 4375 of the channel 4313. In the illustrated embodiment, the adjustable weighting system 4366 comprises three features 4370: a first feature 4370A near the toe end 4318, a second feature 4370C near the heel end 5722, and a third feature 4370B in a general center between the first feature 4370A and the second feature 4370C. In other embodiments, the club head 4310 can comprise one, two, three, four, five, six, seven, eight, nine or ten features 4370. The features 4370 can be spaced evenly apart, or in other embodiments, the features 4370 can be spaced at any distance from one another.

The feature 4370 is configured to receive a fastener 4385. The fastener 4385 can comprise threading to be secured into the feature 4370. In other embodiments, the fastener 4385 can be secured into the feature 4370 by press-fit, an adhesive, or by any other coupling means.

In the illustrated embodiments, the weights 4382 comprises a first portion 4383, and a second portion 4384. The weights 4382 can have a generally rectangular shape corresponding with the shape of the channel 4313. In other embodiments, the weights 4382 can have a circular, triangular, trapezoidal, polygonal or any other suitable shape configured to fit within the channel 4313. In the illustrated embodiment, the adjustable weighting system 4366 comprises one weight 4382. In other embodiments, the adjustable weighting system 4366 can comprise more or less weights 4382 than the number of features 4370. For example, the adjustable weighting system 4366 can comprise one, two, three, four, five, six, seven, eight, nine to ten weights 4382. The weights 4382 can comprise an insertion aperture 4384 that extends entirely through the weight 4382. The insertion aperture 4384 is sized and shaped to receive a screw 4385. In some embodiments, the insertion aperture 4384 is threaded. To couple the weight 4382 to the club head 4310, at least a portion of the screw 4385 is passed through the insertion aperture 4384 in the weight 4382, and into one of the feature 4370. In some embodiments, the screw aperture 4371 has a diameter equivalent to a diameter of the insertion aperture 4384, although in other embodiments at least a portion of the insertion aperture 4384 may have a diameter larger than the diameter of the screw aperture 4371. In the illustrated embodiment, each screw aperture 4371 is threaded, such that the screw 4385 may be rotated and threaded in place into each of the feature 4370, and such that the weight 4382 may be held tightly in place within the channel 4313 after the screw 4385 has been rotated and threaded in place. In other embodiments, the weights 4382 can further be secured at the features 4370 through a friction fit, a snap-fit mechanism, with a set-screw, or with any other suitable structure.

In the illustrated embodiment each of the features 4370 can receive the fastener 4385, wherein the fastener 4385 extends through (or abuts the weight 4382, or abuts the blind aperture) the weight 4382. In other embodiments, one or more of the features 4370 receives a weight 4382, while the remaining features 4370 are bare and uncovered, or are covered with another material or structure. In some embodiments, one or more of the features 4370 receives more than one weight 4382.

With continued reference to FIGS. 104 and 105, a tool 4386 (e.g., common screwdriver, Allen wrench, specialized tool, etc.), may be provided to assist in the insertion and/or removal of the screw 4385. When the weight 4382 is to be moved, the tool 4386 may be used to loosen the screw 4385, so that the weight 4382 may be moved along the channel 4313 to a different feature 4370. The same tool 4386 may then be used again to tighten the screw into the new feature 4370. In some embodiments, more than one weight 4382 is provided in the channel 4313, and/or the channel 4313 has a varying width to accommodate weights 4382 of different sizes and shapes.

With continued reference to FIG. 105, in the illustrated embodiment the weight 4382 further includes a blind bore 4387 in communication with the insertion aperture 4384. The blind bore 4387 is sized and shaped to receive at least the head of the screw 4385, and is larger than the insertion aperture 4384. During use, the screw 4385 is threaded into the feature 4370, such that the head of the screw 4385 extends out of the screw aperture 4371. The weight 4382 is then placed over the head of the screw 4385, such that the head of the screw 4385 extends into the blind bore 4387. The weight 4382 is then shifted laterally in the channel 4313 such that the head of the screw 4385 passes into the smaller insertion aperture 4384. The tool 4386 is then used to tighten the screw 4385 down further into the feature 4370 to secure the weight 4382 in place onto the club head body 4314. To remove the weight 4382, the tool 4386 loosens the screw 4385. The weight 4382 is then shifted back such that the head of the screw 4385 passes into the larger blind bore 4387. The weight 4382 is then removed and moved over to a different location in the channel 4313.

While the embodiments described above utilize a screw 4385, screw apertures 4371, and insertion apertures 4384, yet other embodiments may utilize other structures to retain the weights 4382 within the channel 4313. For example, in some embodiments one or more clamps (not pictured) may be provided to releasably hold the weights 4382 within the channel 4313. In yet other embodiments, the weights 4382 themselves may be expanding weights, such that once the weights 4382 are placed within the channel 4313, the weights 4382 expand (e.g., naturally or with the aid of a tool) within the channel 4313, thereby creating a press fit within the channel 4313, securing the weights 4382 in place within the channel 4313.

In the illustrated embodiment, each of the weights 4382 is illustrated having the same shape and size. In other embodiments, the weights 4382 can vary in shape and size, resulting in different weights 4382 having varying masses. Further, in some embodiments, the weights 4382 are made of different materials such that they vary in mass. For example, one weight 4382 may be made of a high density material, such as tungsten, and the remaining weights 4382 may be made of a less dense material, such as polyurethane or another plastic. In other embodiments, the weights 4382 may have different sizes or volumes such that they vary in mass. For example, one weight 4382 may have a greater volume than the remaining weights 4382. In some embodiments, each of the weights 4382 may vary in volume from one another and thus vary in mass. In some embodiments, the weights 4382 may vary in both volume and material from one another. In some embodiments, one of the structures labeled as 4382 is not a weight, but rather a light-weight (e.g., light-weight plastic) cover that snap-fits or otherwise couples to one of the features 4370. In some embodiments, the weights 4382 may vary between 0.1-50 g. For example, in embodiments having a plurality of weights 4382, one or more of the weights 4382 may vary between 0-10 g, one or more of the weights 4382 may vary between 10-20 g, one or more of the weights 4382 may vary between 20-30, one or more of the weights 4382 may vary between 30-40 g, and one or more of the weights 4382 may vary between 40-50 g. In some embodiments, a first weight 4382 may vary between 0-10 g, a second weight 4382 may vary between 10-20 g, a third weight 4382 may vary between 20-30, a fourth weight 82 may vary between 30-40 g, and a fifth weight 4382 may vary between 40-50 g. In other embodiments, a first weight 4382 may vary between 1-5 g, and a second and third weight 4382 may vary between 5-30 g. In other embodiments, a first and second weight 4382 may vary between 1-10 g, and a third and fourth weight 4382, may vary between 5-25 g. In some embodiments, a first weight 4382 has a mass of 8.5 grams, and a second and third weight 4382 each have a mass of 1.5 grams. In other embodiments, a first weight 4382 has a mass of 12 grams, and a second and third weight 4382 each have a mass of 1.5 grams. In other embodiments, a first weight 4382 has a mass of 8.5 grams, and a second and third weight 4382 each have a mass of 0.75 grams. In other embodiments, the first weight 4382 can have a mass of 10, 11, 12, 13, 14, 15, 16, 17, 18, 19, 20, 21, 22, 23, 24, 25, 26, 27, 28, 29 or 30 grams and the second, third, and fourth weight 4382 can have a mass of 1, 2, 3, 4, 5, or 6 grams. In other embodiments, any number of weights 4382 may have the same mass or may have a varying mass between 0.1-50 g.

The weights 4382 may be strategically positioned and coupled to the features 4370 to achieve a desired club head 4310 center of gravity position and/or moment of inertia and/or heel/toe bias. For example, in some embodiments, a heavier weight 4382 is positioned at the feature 4370B, located between the toe or toe end 4318 and the heel or heel end 4322, while lighter weights are positioned on the feature 4370A near the toe or toe end 4318 and the feature 4370C near the heel or heel end 4322. The fastener 4385 can be coupled to the feature 4370 and weight 4382 to secure the weight 4382 within the channel 4313 at the distinct location. The aforementioned weight 4382 placement can result in the center of gravity remaining centered while being shifted towards the back end 4334 of the club head 4310. In some embodiments, a heavier weight 4382 is positioned on the feature 4370C near the heel or heel end 4322, while lighter weights 4382 are positioned on the feature 4370A near the toe or toe end 4318 and on the feature 4370B that is located between the toe or toe end 4318C and the heel or heel end 4322. The aforementioned weight 4382 placement can result in the center of gravity being shifted towards the heel end 4322 of the club head 4310. In some embodiments, a heavier weight 4382 is positioned on the feature 4370A near the toe or toe end 4318, while lighter weights 4382 are positioned on the feature 4370C near the heel or heel end 4322 and on the feature 4370B that is located between the toe or toe end 4318 and the heel or heel end 4322. The aforementioned weight 4382 placement can result in the center of gravity being shifted towards the toe end 4318 of the club head 4310. In many embodiments, one or more of the features 4370 are of equal size and shape, such that one weight may be interchangeably used with each of the features. In some embodiments, one or more of the features 4370 can have a differing size and shape, such that each features 4370 has its own corresponding weight 4382 or set of weights 4382.

The adjustable weighting system 4366 of golf club head 4310 maintains or prevents a significant reduction in club head moment of inertia, and low and back club head center of gravity positioning, compared to a club head devoid of an adjustable weighting system. The adjustable weighting system 4366 of golf club head 4310 maintains a high club head moment of inertia and a low and back club head CG position due to the low profile of the weighting system and the perimeter positioning of the one or more weights. The club head 4310 having the adjustable weighting system 4366 can have similar or identical parameters and measurements as club head 100 described above.

The adjustable weighting system 4366 of golf club head 4310 maintains or prevents a significant reduction in club head moment of inertia, and low and back club head center of gravity positioning, compared to a club head devoid of an adjustable weighting system. The adjustable weighting system 4366 of golf club head 4310 maintains a high club head moment of inertia and a low and back club head CG position due to the low profile of the weighting system and the perimeter positioning of the one or more weights. The club head 4310 having the adjustable weighting system 4366 can have similar or identical parameters and measurements as club head 100 described above.

Figure 106:
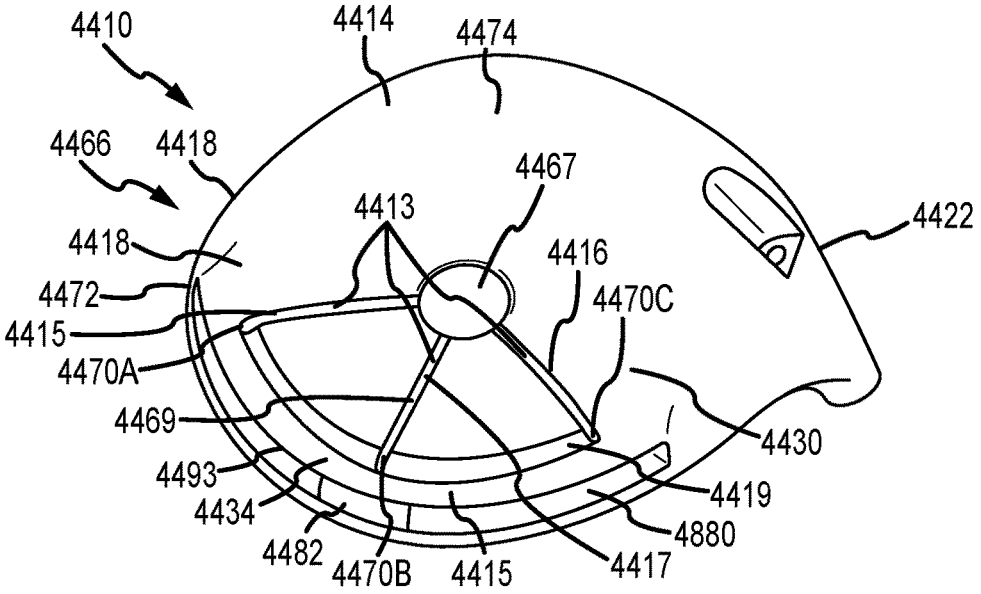
FIGS. 106-108 are perspective views of a golf club head according to another embodiment.
Figure 107:
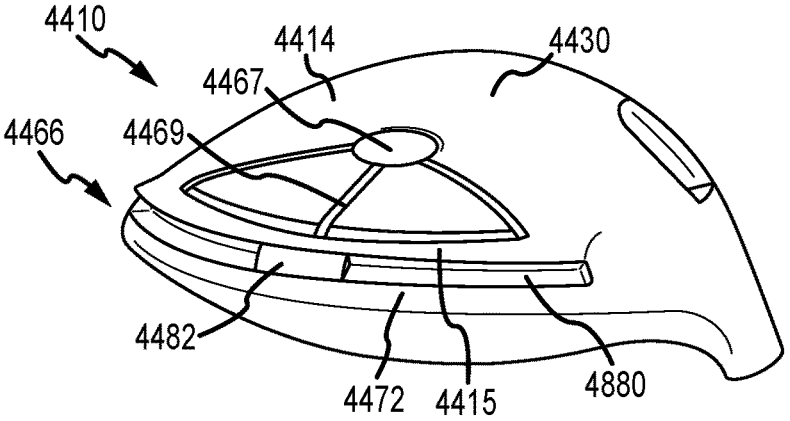
Figure 108:
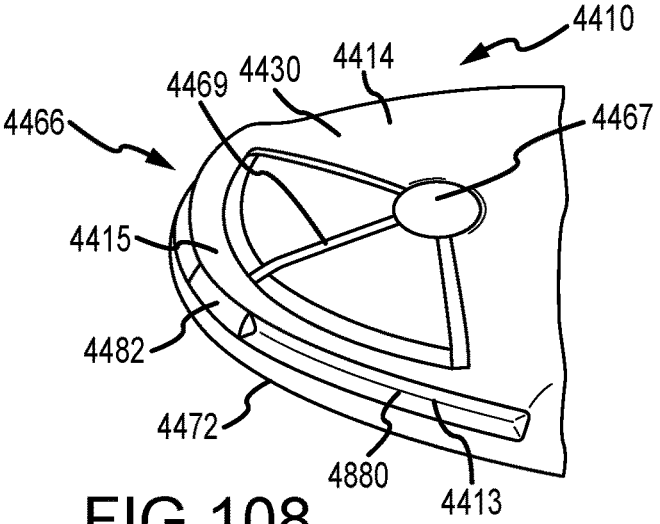

FIGS. 106-108 illustrate a club head 4410 having a club head body 4414. The club head 4410 includes an adjustable weighting system 4466 comprising a cable 4469, and a tensioner 4467 that is adjustable by an end user to modify the club head 4410 center of gravity and/or moment of inertia and/or heel/toe bias to achieve desired performance characteristics (e.g., forgiveness, spin, trajectory) under various circumstances. The adjustable weighting system 4466 is a low profile system and thereby does not significantly shift or change the club head 4410 MOI when compared to a club head not including the adjustable weighting system 4466. Further, the low profile adjustable weighting system 4466 ensures that shifts in the club head 4410 CG occur mainly in a heel end 4422 to toe end 4418 direction keeping the overall club head 4410 CG in a low and back location.

The adjustable weighting system 4466 is positioned on a sole 4430 of the club head 4410. As illustrated in FIGS. 106-108, the sole 4430 of the club head 4110 comprises channels 4413. The channels 4413 extend radially from a generally central location of the sole 4430 toward a trailing edge 4472. In other embodiments, the channels 4413 can extend radially from any location on the sole 4430 (e.g., central positioned proximate a toe end 4418, central positioned proximate a heel end 4422, etc.). As illustrated in FIG. 106, the club head 4410 comprises three channels 4413, a first channel 4415 near the toe end 4418, a second channel 4416 proximate the heel end 3922, and a third channel 4417 between the first channel 4415 and the second channel 4416 in a general center. In other embodiments, the club head 4410 can comprise any number of channels 4413, such as one channel 4413, two channels 4413, three channels 4413, four channels 4413, five channels 4413, six channels 4413, seven channels 4413, or eight channels 4413.

The sole 4430 further comprises a recessed portion 4480. The recessed portion 4480 is positioned along the trailing edge 4472 of the sole 4430, interconnecting the channels 4413. The sole 4430 further still comprises a lip 4415. The lip 4415 is integrally formed with an outer surface 4474 of the sole 4430 and extends along the trailing edge 4472, parallel over the recessed portion 4480. The lip 4415 is separated from the remainder of the sole 4430 by a gap 4419. A trailing edge channel 4493 is formed between the recessed portion 4480 and the lip 4415.

The trailing edge channel 4493 comprises a plurality of discrete attachment locations. The plurality of discrete attachment locations can comprise various features 4470 including protruding bodies, apertures or recesses or ports capable of receiving a fastener, notches or tabs or cutout regions, ribs or grooves, pegs, hooks, magnets, programmable magnets, or any other suitable attachment means. The features 4470 define a discrete attachment location for securing the weight 4482 to the club head 4410. In contrast to other adjustable weighting systems wherein the weight can be coupled at any, or at an infinite, or at an unlimited number of locations across the recessed portion. In the illustrated embodiments, the features 4470 is the junction of the channels 4413 intersecting the trailing edge channel 4493. In the illustrated embodiment, the club head comprises three features 4470, a first feature 4470A near the toe end 4418, a second feature 4470C near the heel end 4422, and a third feature 4470B in a general center between the first feature 4470A and the second feature 4470C. In other embodiment, the club head 4410 can comprise any number of features 4470, such as one feature 4470, two features 4470, three features 4470, four features 4470, five features 4470, six features 4470, seven features 4470, or eight features 4470. In many embodiments, there is the same number of features 4470 as there are number of channels 4413.

The feature 4470 of the club head 4410 is configured to receive a weight 4482. The locations of the feature 4470 along the trailing edge 4472 allows for the weight 4482 to adjust the CG about the x-axis. The weight 4482 comprises a top surface, and a bottom surface. The weight 4482 further comprises a general cross-sectional shape such as a cylinder, a triangular prism, a cube, a rectangular prism, a pentagonal prism, a hexagonal prism, or etc. In many embodiments, the cross-sectional shape of the weight 4482 is complimentary to a portion of the profile shape of the features 3270, wherein the top and bottom surfaces of the weight 4482 can touch the recessed portion and the lip when positioned within the feature 4470 and still be able to slide along within the feature. The weight 4482 has a width that is generally equivalent to a width of the channel 4413, such that the weight 4482 is prevented from rotating or twisting once it has been placed into the channel 4413.

The weight 4482 further comprise a mass. The mass of the weight 4482 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4482 can be 1 gram, 2 grams, 3 grams, 6 grams, 9 grams, 12 grams, 15 grams, 18 grams, 21 grams, 24 grams, 27 grams, 30 grams, 33 grams, or 35 grams.

The adjustable weighting system 4466 comprises a tensioner 4467, and a cable 4469. As illustrated in FIGS. 106-108, the tensioner 4467 is positioned in a general center on the sole 4430 of the club head 4410, disposed between the intersection of the radially extending channels 4413. Although in other embodiments, the tensioner 4467 can be positioned at other locations along the club head 4410, just as long as the tensioner 4467 is disposed between the intersection of the radially extending channels 4413. The tensioner 4467 can be attached to the club head 4410 by way of fastener or by an adhesive. When the tensioner 4467 is attached to the recessed portion 3280 of the club head 3210, the tensioner 4467 does not extend past the lowest point of the club head 4410 when at address. In the illustrated embodiments, the tensioner 4467 is flush with the outer surface 4474 of the sole 4430.

The cable 4469 of the adjustable weighting system is similar to the cables 3269, 3369, 3469, 3569, 3769, 3869, 3969, 4069, and 4169 as described above. The weight 4482 comprises a first end and a second end. The first end of the cable 4469 is configured to be attached to the tensioner 4467, while the second end of the cable 4469 is configure to be coupled to the weight 4482. The cable 4469 is coupled to the weight 4482 after the weight 4482 is placed within the feature 4470. The cable 4469 can be received within one of the channels 4413. As illustrated in FIG. 106, the cable is received within the third channel 4417. In other embodiments, cable 4469 can be receive within any of the channels 4413. The different positioning of the cable 4469 allows for the weight 4482 to couple to the distinctly located features 4470 to adjust the weight distribution of the club head 4410. The cable 4469 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4469 can be made of baling twine, parachute cord material, nylon, Kevlar, polymer tweed, steel wire with polymer coating, any metallic wire with polymer coating or etc. In other embodiments, the cable 4469 is not couple to the tensioner 4467 and can be retracted/loosened by other means other than by the tensioner 4467.

The tensioner 4467 is similar to the tensioners 3267, 3367, 3467, 3567, 3667, 3767, 3867, 3967, 4067, and 4167, wherein the tensioner 4467 acts as a winch and ratchet mechanism. In other embodiments, the tensioner 4467 can be a J-slot tensioner similar to J-slot tensioner 3267 as described above. The tensioner 4467 may be rotated (e.g., twisted) in increments to adjust a tension in the cable 4469. The cable 4469, in turn, is coupled to the weight 4482 (e.g., the weight 4482 being permanently or removably fixed at the second end of the cable 4469). When the tensioner 4467 is rotated clockwise, the cable 4469 is tightened (e.g., retracted), and the cable 4469 pulls the weight 4482 creating a force on the weight 4482 firmly against the feature 4470 at the junction of the channels 4413 and the trailing edge channel 4493. Further a frictional force is created between the abutting surfaces of the weight 4482 and surfaces of the trailing edge channel 4493 at the feature 4470. The two forces created secures the weight 4482 within the feature 4470 and prevents the weight 4482 from sliding within the feature 4470. In some embodiments, the channel 4413 includes an undercut to facilitate retention and sliding of the weight 4482 within the channel 4413. In other embodiments, the cable 4469 can be retracted by other means other than by the tensioner 4467.

When the tensioner 4467 loosens the tension on the cable 4469, the two forces no longer act on the weight 4482. Without the two forces, the weight 4482 no longer abuts the recessed surface 4480 at the feature 4470. The cable 4469 can then be repositioned to a different channel 4413 by sliding the weight 4482 along the trailing edge channel 4493. As the weight 4482 slides along the trailing edge channel 4493, the cable 4469 goes along the gap 4419. The weight 4482 can then be repositioned to a different feature 4470 and the cable 4469 can be repositioned to an associated channel 4413. The ability to reposition the cable 4469 and weight 4482 to a different channel 4413 and feature 4470 allows for the center of gravity of the golf club head to shift about the x-axis (heel-to-toe). For example, when the cable 4469 are positioned within the first channel 4415 and the weight 4482 is positioned in the associated first feature 4470A to shift the center of gravity toward the toe end 4418, wherein a CG toward the toe end 4418 will help center ball flight for players who tend to slice their shots. In other embodiments, the cable 4469 can be loosened by other means other than by the tensioner 4467.

In some embodiments, the tensioner 4467 is in a naturally locked orientation, wherein the tensioner 4467 is pressed downward to engage the rotational movement of the winch and ratchet mechanism in order to release tension in the cable 4469 to hold the weight 4482 in place at a desired channel 4413. When the tension is released (e.g., when the cable 4469 is extended), the weight 4482 may then be repositioned into a different feature 4470 along the channel 4413. In other embodiments, the tensioner 4467 is in a naturally locked orientation, wherein the tensioner is pulled upward to engage the rotational movement of the winch and ratchet mechanism to release the tension in the cable 4469. In some embodiments, a tool is required to rotate the tensioner 4467 and/or to release tension in the cable 4469.

The club head 4410 having the adjustable weighting system 4466 comprises the tensioner 4467 (or other cable adjustment means) and the cable 4469 described above can optimize the performance of the golf club. The adjustable weighting system 4466 allows for the club head 4410 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 4410 having the tensioner 4467 and the cable 4469 adjustable weight system 4466 further have an utility regarding ease of manufacturing compared to club heads with more complex structures to house a weight (i.e., deep weight ports, multiple weight ports, rail systems, weight covers/caps). The weight 4482 coupled to the club head body 4414 are secured by the tension of the cable 4469 within the feature 4470, which create an abutment force and friction between surfaces of the weight 4482 and surfaces of the trailing edge channel 4493 at the feature 4470. The abutment and frictional force eliminates the need for the club head 4410 to be manufactured with a weight housing structure having complex internal/external geometries in order to secure the weight 4482. Thereby reducing the material and mass associated with the complex weight housing structure. The mass saved from the lack of the weight housing structure can then be positioned elsewhere on the club head 4410 to increase strength and/or mass in that location. The abutment and friction force created by the cable 4469 and weight 4482 further eliminates the need for screw-type fasteners, thus the weight 4482 and club head 4410 do not require manufacturing a threaded aperture to receive the fastener. The lack of the fastener and threaded aperture reduces the cost of manufacturing and increase production.

Further, the cable 4469 of the adjustable weighting system 4466 is lightweight, strong, and can be incorporated with the channels 4413 in a number of different patterns on the outer surface 4474 of the club head 4410. The different patterns allows for the weight 4482 to be place in a number of different locations on the sole 4430 because the weight 4482 is not limited to specific weight housing structures. The number of different weight positions can help fine tune the center of gravity placement to adjust the ball spin and trajectory for individual players. The cable 4469 can further be strategically placed in such a pattern that the cable 4469 can reinforce specific locations on the club head 4410. The material and pattern of the cable 4460 can further still act as a sound dampener and absorb vibration experienced by the club head 4410 during impact, thereby reducing unwanted sound, and unwanted stress during a game.

The adjustable weighting system 4466 of golf club head 4410 maintains or prevents a significant reduction in club head moment of inertia, and low and back club head center of gravity positioning, compared to a club head devoid of an adjustable weighting system. The adjustable weighting system 4466 of golf club head 4410 maintains a high club head moment of inertia and a low and back club head CG position due to the low profile of the weighting system and the perimeter positioning of the one or more weights. The club head 4410 having the adjustable weighting system 4466 can have similar or identical parameters and measurements as club head 100 described above.

Figure 109:
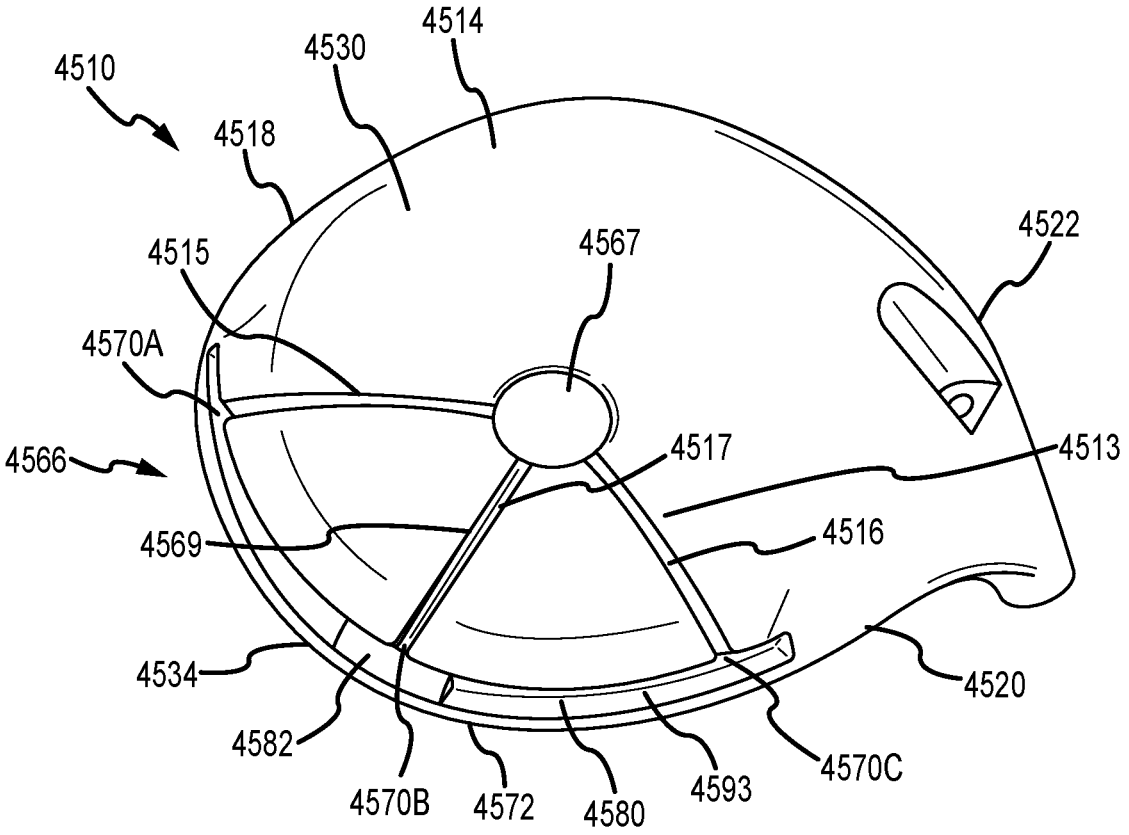
FIG. 109 is a perspective view of a golf club head according to another embodiment.

FIG. 109 illustrates a club head 4510 having a club head body 4514 similar to the club head body 4414. The club head 4510 includes an adjustable weighting system 4566 comprising a weight 4582, a cable 4569 and a tensioner 4567 that is adjustable by an end user to modify the club head 4510 center of gravity and/or moment of inertia and/or heel/toe bias to achieve desired performance characteristics (e.g., forgiveness, spin, trajectory) under various circumstances. The adjustable weighting system 4566 is a low profile system and thereby does not significantly shift or change the club head 4510 MOI when compared to a club head not including the adjustable weighting system 4566. Further, the low profile adjustable weighting system 4566 ensures that shifts in the club head 4510 CG occur mainly in a heel end 4522 to toe end 4518 direction keeping the overall club head 4510 CG in a low and back location.

The adjustable weighting system 4566 is positioned on a sole 4530 of the club head 4510. As illustrated in FIG. 109, the sole 4530 of the club head 4510 comprises channels 4513. The channels 4513 extend radially from a generally central location of the sole 4530 toward a trailing edge 4572. In other embodiments, the channels 4513 can extend radially from any location on the sole 4530 (e.g., central positioned proximate a toe end 4518, central positioned proximate a heel end 4522, etc.). As illustrated in FIG. 109, the club head 4510 comprises three channels 4513, a first channel 4515 near the toe end 4518, a second channel 4516 proximate the heel end 4522, and a third channel 4517 in a general center between the first channel 4515 and the second channel 4516. In other embodiments, the club head 4510 can comprise any number of channels 4513, such as one channel 4513, two channels 4513, three channels 4513, four channels 4513, five channels 4513, six channels 4513, seven channels 4513, or eight channels 4513.

The sole 4530 further comprises an elongated channel 4593 extending along the trailing edge 4572, wherein the channels 4513 integrally extend into the elongated channel 4593. The adjustable weighting system 4566 includes a plurality of discrete attachment locations. The plurality of discrete attachment locations can comprise various features 4570 including protruding bodies, apertures or recesses or ports capable of receiving a fastener, notches or tabs or cutout regions, ribs or grooves, pegs, hooks, magnets, programmable magnets, or any other suitable attachment means. The features 4570 define a discrete attachment location for securing the weight 4582 to the club head 4510. In contrast to other adjustable weighting systems wherein the weight can be coupled at any, or at an infinite, or at an unlimited number of locations across the recessed portion. The junction of the elongated channel 4593 and the channels 4513 form the feature 4570. In the illustrated embodiment, the club head 4510 comprises three features 4570: a first feature 4570A at the junction of the elongated channel 4593 and the first channel 4515 near the toe end 4518, a second feature 4570C at the junction of the elongated channel 4593 and the second channel 4516 near the heel end 4522, and a third feature 4570B at the junction of the elongated channel 4593 and the third channel 4517 between the first feature 4570A, and the second feature 4570C. In other embodiments, the club head 4510 can comprise any number of features 4570, such as one feature 4570, two features 4570, three features 4570, four features 4570, five features 4570, six features 4570, seven features 4570, or eight features 4570.

The feature 4570 of the club head 4510 is configured to receive a weight 4582. The feature 4570 at several different distinct locations along the elongated channel 4593 allows for the weight 4582 to adjust the CG about the x-axis. The weight 4582 comprises a general cross-sectional shape such as a cylinder, a triangular prism, a cube, a rectangular prism, a pentagonal prism, a hexagonal prism, or etc. In many embodiments, the cross-sectional shape of the weight 4582 is complimentary to the cross-sectional shape of the feature 4570 at the junction of the elongated channel 4593 and the channels 4513, wherein a portion of the surfaces of the weight 4582 abut a portion of the surfaces of the feature 4570 when the weight 4582 is placed within the feature 4570.

The weight 4582 further comprise a mass. The mass of the weight 4582 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3782 can be 3 grams, 6 grams, 9 grams, 12 grams, 15 grams, 18 grams, 21 grams, 24 grams, 27 grams, 30 grams, 33 grams, or 35 grams.

The adjustable weighting system 4566 comprises a tensioner 4567 and a cable 4569. The tensioner 4567 is positioned in a general center on the sole 4530 of the club head 4510, disposed between the intersection of the radially extending channels 4513. Although in other embodiments, the tensioner 4567 can be positioned at other locations along the club head 4510 as long as the tensioner 4567 is disposed between the intersection of the radially extending channels 4513. The tensioner 4567 can be attached to the club head 4510 by way of fastener or by an adhesive. When the tensioner 4567 is attached to the club head 4510, the tensioner 4467 does not extend past the lowest point of the club head 4510 when at address. In the illustrated embodiments, the tensioner 4567 is flush with the outer surface 4574 of the sole 4530.

The cable 4569 of the adjustable weighting system 4510 is similar to the cables 3269, 3369, 3469, 3569, 3769, 3869, 3969, 4069, 4169, and 4469 as described above. The weight 4582 comprises a first end and a second end. The first end of the cable 4569 is configured to be attached to the tensioner 4567, while the second end of the cable 4569 is configure to be coupled to the weight 4582. In other embodiments, the cable 4569 can extend and retract by other means other than the tensioner 4567. The cable 4569 can be received within one of the channels 4513. As illustrated in FIG. 109, the cable 4569 is received within the third channel 4517. In other embodiments, the cable 4569 can be receive within any of the channels 4513, wherein the weight 4582 is received within the feature 4570 corresponding to that channel 4513. The different positioning of the cable 4569 allows for the weight 4582 coupled to the cable 4469 to adjust the CG of the club head 4510.

The tensioner 4567 is similar to the tensioners 3267, 3367, 3467, 3567, 3667, 3767, 3867, 3967, 4067, 4167, and 4467, wherein the tensioner 4567 acts as a winch and ratchet mechanism. In other embodiments, the tensioner 4567 can be a J-slot tensioner similar to J-slot tensioner 3267 as described above. The tensioner 4567 may be rotated (e.g., twisted) in increments to adjust a tension in the cable 4569. The cable 4569, in turn, is coupled to the weight 4582 (e.g., the weight 4582 being permanently or removably fixed at a distal end of the cable 4569). When the tensioner 4567 is rotated clockwise, the cable 4569 is tightened (e.g., retracted), and the cable 4569 pulls the weight 4582 creating a force on the weight 4582 firmly against the feature 4570 of the club head body 4510. Further, a frictional force is created between the abutting surfaces of the weight 4582 and of the feature 4570. The two forces created secures the weight 4582 within the feature 4570 and prevents the weight 4582 from sliding, shifting, or coming out within the feature 4570. In other embodiments, the cable 4569 can be retracted by other means other than by a tensioner.

When the tensioner 4567 loosens the tension on the cable 4569, the two forces no longer act on the weight 4582. Without the two forces, the weight 4582 does not abut the feature 4570. The weight 4582 can then be taken out of the feature 4570, and the cable 4569 can be repositioned to a different channel 4513, wherein the weight 4582 is repositioned to a corresponding feature 4570. The ability to reposition the cable 4569 and weight 4582 to a different channel 4513 and feature 4570 allows for the CG of the club head 4510 to shift about the heel end 4522, and toe end 4518. For example, when the cable 4569 and weight 4582 are repositioned from the third channel 4517 and third feature 4570B to the first channel 4515 and first feature 4570A, the CG shifts toward the toe end 4518, wherein a CG toward the toe end 4518 will help center ball flight for players who tend to slice their shots. In other embodiments, the channel 4569 can be loosen by other means other than by the tensioner 4567.

In some embodiments, the tensioner 4567 is in a naturally locked orientation, wherein the tensioner 4567 is pressed downward to engage the rotational movement of the winch and ratchet mechanism in order to release tension in the cable 4569. When the tension is released (e.g., when the cable 4569 is extended), the weight 4582 may then be repositioned into a different feature 4570. In other embodiments, the tensioner 4567 is in a naturally locked orientation, wherein the tensioner 4567 is pulled upward to engage the rotational movement of the winch and ratchet mechanism to release the tension in the cable 4569. In some embodiments, a tool is required to rotate the tensioner 4567 and/or to release tension in the cable 4569.

The club head 4510 having the adjustable weighting system 4566 comprises the tensioner 4567 (or other cable adjustment means) and the cable 4569 described above can optimize the performance of the golf club. The adjustable weighting system 4566 allows for the club head 4510 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 4510 having the tensioner 4567 and the cable 4569 adjustable weight system 4566 further have an utility regarding ease of manufacturing compared to club heads with more complex structures to house a weight (i.e., deep weight ports, multiple weight ports, rail systems, weight covers/caps). The weight 4582 coupled to the feature 4570 are secured by the tension of the cable 4569, which create an abutment and friction force between a surface of the weight 4582 and surfaces of the feature 4570. The tension, abutment force and frictional force eliminates the need for the club head 4510 to be manufactured with a weight housing structure having complex internal/external geometries in order to secure the weight(s). Thereby reducing the material and mass associated with the complex weight housing structure. The mass saved from the lack of the weight housing structure can then be positioned elsewhere on the club head 4510 to increase strength and/or mass in that location. The tension, abutment force, and friction created by the cable 4569 further eliminates the need for screw-type fasteners, thus the weight 4582 and club head 4510 do not require manufacturing a threaded aperture to receive the fastener. The lack of the fastener and threaded aperture reduces the cost of manufacturing and increase production.

Further, the cable 4569 of the adjustable weighting system 4566 is lightweight, strong, and can be incorporated with the channels 4513 in a number of different patterns on the outer surface 4574 of the club head. The different patterns allows for the weight 4582 to be place in a number of different locations on the sole 4530 because the weight 4582 is not limited to specific weight housing structures. The number of different weight positions can help fine tune the center of gravity placement to adjust the ball spin and trajectory for individual players. The cable 4569 can further be strategically placed in such a pattern that the cable 4569 can reinforce specific locations on the club head 4510. The material and pattern of the cable 4569 can further still act as a sound dampener and absorb vibration experienced by the club head 4510 during impact, thereby reducing unwanted sound, and unwanted stress during a game.

The adjustable weighting system 4566 of golf club head 4510 maintains or prevents a significant reduction in club head moment of inertia, and low and back club head center of gravity positioning, compared to a club head devoid of an adjustable weighting system. The adjustable weighting system 4566 of golf club head 4510 maintains a high club head moment of inertia and a low and back club head CG position due to the low profile of the weighting system and the perimeter positioning of the one or more weights. The club head 4510 having the adjustable weighting system 4566 can have similar or identical parameters and measurements as club head 100 described above.

Figure 110:
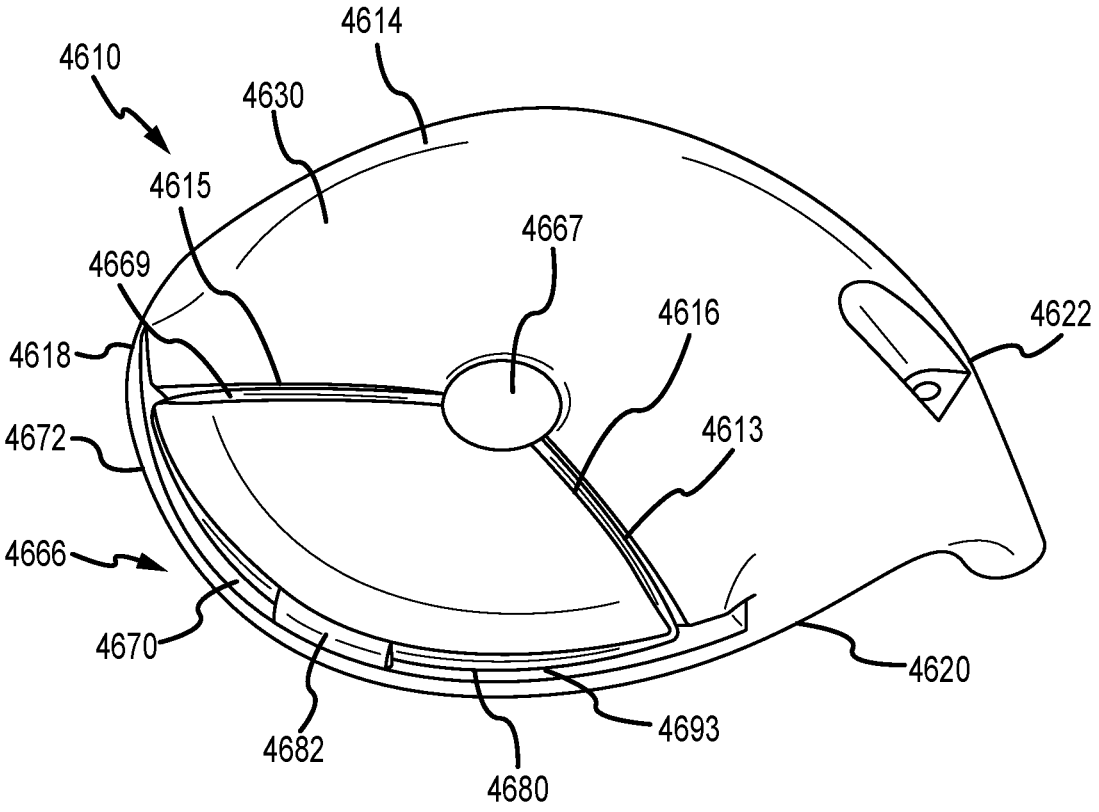
FIG. 110 is a perspective view of a golf club head according to another embodiment.

FIG. 110 illustrates a club head 4610 having a club head body 4614. The club head 4610 includes an adjustable weighting system 4666 that is adjustable by an end user to modify the club head 4610 center of gravity and/or moment of inertia and/or heel/toe bias to achieve desired performance characteristics (e.g., forgiveness, spin, trajectory) under various circumstances. The adjustable weighting system 4666 is a low profile system and thereby does not significantly shift or change the club head 4610 MOI when compared to a club head not including the adjustable weighting system 4666. Further, the low profile adjustable weighting system 4666 ensures that shifts in the club head 6310 CG occur mainly in a heel end 4622 to toe end 4618 direction keeping the overall club head 4610 CG in a low and back location.

The adjustable weighting system 4666 is positioned on a sole 4630 of the club head 4610. As illustrated in FIG. 110, the sole 4630 of the club head 4610 comprises channels 4613. The channels 4613 extend radially from a generally central location of the sole 4630 toward a trailing edge 4672. In other embodiments, the channels 4613 can extend radially from any location on the sole 4630 (e.g., central positioned proximate the toe end 4618, central positioned proximate the heel end 4622, etc.). As illustrated in FIG. 110, the club head 4610 comprises two channels 4613, a first channel 4615 near the toe end 4618, and a second channel 4616 proximate the heel end 4622. In other embodiments, the club head 4610 can comprise any number of channels 4613, such as one channel 4613, two channels 4613, three channels 4613, four channels 4613, five channels 4613, six channels 4613, seven channels 4613, or eight channels 4613. The channels 4613 receive a cable 4669 of the adjustable weighting system 4666. The channels 4613 are sized and shaped to contact and/or otherwise guide and retain the cable 4669. In some embodiments, the channels 4613 have a C-shaped or other shaped profile to facilitate retention of the cable 4669.

The sole 4630 further comprises an elongated channel 4617. The elongated channel 4617 is positioned along the trailing edge 4672, running from the toe end 4618 to the heel end 4622 in an arcuate fashion, wherein the channels 4613 integrally extend into the elongated channel 4617. The elongated channel 4617 is configured to receive the cable 4669. The elongated channel 4617 is shallow and lightweight compared to other club head channels having complex geometries, tracks, and deep weight housing.

The elongated channel 4617 of the club head 4610 is further configured to receive a weight 4682. The weight 4682 comprises a general cross-sectional shape such as a cylinder, a triangular prism, a cube, a rectangular prism, a pentagonal prism, a hexagonal prism, or etc. In many embodiments, the cross-sectional shape of the weight 4682 is complementary to a profile shape of the elongated channel 4617, wherein when the weight 4682 is placed within the elongated channel 4617, a portion of the surfaces of the weight 4682 abuts a portion of the surfaces of the elongated channel 4617. When the weight 4682 is positioned within the elongated channel 4617, the weight 4682 is able to slide along within the elongated channel 4617. As illustrated in FIG. 110, the club head 4610 comprises one weight 4682. In other embodiments, the club head 4610 can comprise any number of weights, such as one weight 4682, two weights 4682, three weights 4682, four weights, 4682, five weights 4682, six weights 4682, seven weights 4682, or eight weights 4682.

The weight 4682 further comprise a mass. The mass of the weight 4682 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 3782 can be 1 gram, 2 grams, 3 grams, 6 grams, 9 grams, 12 grams, 15 grams, 18 grams, 21 grams, 24 grams, 27 grams, 30 grams, 33 grams, or 35 grams. In embodiments wherein the club head 4610 comprises multiple weights 4682, the weights 4682 can all comprise the same mass, or all have different masses. For example, the club head 4610 comprises three weights 4682 with the first weight 4682 having a mass of 5 grams, and both the second and third weights 4682 having a mass of 12 grams. In another example, the club head 4610 comprises four weights 4682 with the first weight 4682 having a mass of 7 grams, the second weight 4682 having a mass of 10 grams, the third weight 4682 having a mass of 15 grams, and the fourth weight 4682 having a mass of 20 grams.

The weight 4682 can further comprise a groove (not pictured). When the weight 4682 is portioned to within the elongated channel 4617, the groove is positioned on a surface of the weight 4682 adjacent the elongated channel 4617. The groove 4682 comprise a partial circle shape. In other embodiments, the weights 4682 is void of the groove and can comprise an aperture (not pictured) extending through a center of the weight 4682 instead. The groove 4671 or aperture are configured to receive the cable 4669 of the adjustable weighting system 4666.

The adjustable weighting system 4666 also comprises a tensioner 4667 and the cable 4669 coupled to the tensioner 4667 at both ends of the cable 4669. The tensioner 4667 is positioned in a general central location sole 4630 at a junction of the channels 4613 (i.e., junction of the first channel 4615 and the second channel 4616). Although in other embodiments, the tensioner 4667 can be positioned at other locations along the club head 4610 on the sole 4630, just as long as the tensioner 4667 is positioned at the junction of the channels 4613. The tensioner 4667 can be attached to the club head 4610 by way of fastener or by an adhesive. When the tensioner 4667 is attached to the club head 4610, the tensioner 4667 does not extend past the lowest point of the club head 4610 when at address. In the illustrated embodiment, the tensioner 4667 is flush with the outer surface 4674 of the sole 4630.

The cable 4669 of the adjustable weighting system 4666 is similar to the cables 3269, 3369, 3469, 3569, 3769, 3869, 3969, 4069, 4169, 4469, and 4569 as described above. The cable 4669 is coupled to the tensioner 4667, received within the first channel 4615, received within the elongated channel 4617, and received within the second channel 4616 back to the tensioner 4667. In other embodiments, the cable 4669 can extend and retract by other means other than the tensioner 4667. The cable 4669 is configured to receive the groove (or aperture) of the weight 4682. The cable 4469 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4669 can be made of baling twine, parachute cord material, nylon, Kevlar, polymer tweed, steel wire with polymer coating, any metallic wire with polymer coating or etc.

The tensioner 4667 is similar to the tensioners 3267, 3367, 3467, 3567, 3667, 3767, 3867, 3967, 4067, 4167, 4467, 4567, wherein the tensioner 4667 acts as a winch and ratchet mechanism. In other embodiments, the tensioner 4667 can be a J-slot tensioner similar to J-slot tensioner 3267 as described above. The tensioner 4667 may be rotated (e.g., twisted) in increments to adjust a tension in the cable 4669. The cable 4669, in turn, is coupled to the weight 4682 (e.g., to a groove along an exterior of the weight 4682, through an aperture within the weight 4682, or otherwise). When the tensioner 4667 is rotated clockwise, the cable 4669 is tightened (e.g., retracted), and the cable 4669 pulls the weight 4682 creating a force on the weight 4682 firmly against the elongated channel 4617 of the club head body 4610. Further, a frictional force is created between the abutting surfaces of the weight 4682 and surfaces of the elongated channel 4617. The two forces created secures the weight 4682 within the elongated channel 4617 and prevents the weight 4682 from sliding or shifting within the elongated channel 4617. In other embodiments, the cable 4669 can be retracted by other means other than by a tensioner.

When the tensioner 4667 loosens the tension on the cable 4669, the two forces no longer act on the weight 4682. Without the two forces, the weight 4682 does not abut the elongated channel 4617. Thus, in the embodiment of FIG. 110, the weight 4682 is movable (slidable) along the cable 4669 within the elongated channel 4617 (e.g., to an infinite number of positions) when the tensioner 4667 has relieved the tension in the cable 4669, and the cable 4669 may remain in the channels 4613 and the elongated channel 4617 during adjustment of the weight 4682. The ability to reposition the weight 4682 to a different location within the elongated channel 4617 allows for the CG of the club head 4610 to shift about the heel end 4622, and toe end 4618. For example, when the weight 4682 is repositioned from a general center of the elongated channel 4617 to near the toe end 4618, the CG shifts toward the toe end 4618, which can help center ball flight for players who tend to slice their shots. In other embodiments, the cable 4669 can be loosen by other means other than by a tensioner.

In some embodiments, the tensioner 4667 is in a naturally locked orientation, wherein the tensioner 4667 is pressed downward to engage the rotational movement of the winch and ratchet mechanism to release tension in the cable 4669. When the tension is released (e.g., when the cable 4669 is extended), the weight 4682 may then be repositioned (slid) into a different position within the elongated channel 4617. In other embodiments, the tensioner 4567 is in a naturally locked orientation, wherein the tensioner 4667 is pulled upward to engage the rotational movement of the winch and ratchet mechanism to release tension in the cable 4669. In some embodiments, a tool is required to rotate the tensioner 4667 and/or to release tension in the cable 4669.

The club head 4610 having the adjustable weighting system 4666 comprises the tensioner 4667 (or other cable adjustment means) and cable 4669 described above can optimize the performance of the golf club. The adjustable weighting system 4666 allows for the club head 4610 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 4610 having the tensioner 4678 and the cable 4669 adjustable weight system 4666 further have an utility regarding ease of manufacturing compared to club heads with more complex structures to house a weight (i.e., deep weight ports, multiple weight ports, rail systems, weight covers/caps). The weight(s) 4682 coupled to the elongated channel 4617 are secured by the tension of the cable, which create an abutment and friction forces between a surface of the weight(s) 4682 and surfaces of the elongated channel 4617. The tension, abutment and frictional forces eliminates the need for the club head 4610 to be manufactured with a weight housing structure having complex internal/external geometries in order to secure the weight(s) 4682. Thereby reducing the material and mass associated with the complex weight housing structure. The mass saved from the lack of the weight housing structure can then be positioned elsewhere on the club head 4610 to increase strength and/or mass in that location. The tension, abutment and friction forces created by the cable 4669 further eliminates the need for screw-type fasteners, thus the weight(s) 4682 and club head do not require manufacturing a threaded aperture to receive the fastener. The lack of the fastener and threaded aperture reduces the cost of manufacturing and increase production.

Further, the cable 4669 of the adjustable weighting system 4666 is lightweight, strong, and can be incorporated with the channels 4613 in a number of different patterns on the outer surface 4674 of the club head 4610. The different patterns allows for the weight(s) 4682 to be place in a number of different locations on the sole 4630 because the weight(s) 4682 not limited to specific weight housing structures. The number of different weight positions can help fine tune the center of gravity placement to adjust the ball spin and trajectory for individual players. The cable 4669 can further be strategically placed in such a pattern that the cable 4669 can reinforce specific locations on the club head 4610. The material and pattern of the cable 4669 can further still act as a sound dampener and absorb vibration experienced by the club head 4610 during impact, thereby reducing unwanted sound, and unwanted stress during a game.

The adjustable weighting system 4669 of golf club head 4610 maintains or prevents a significant reduction in club head moment of inertia, and low and back club head center of gravity positioning, compared to a club head devoid of an adjustable weighting system. The adjustable weighting system 4669 of golf club head 4610 maintains a high club head moment of inertia and a low and back club head CG position due to the low profile of the weighting system and the perimeter positioning of the one or more weights. The club head 4610 having the adjustable weighting system 4669 can have similar or identical parameters and measurements as club head 100 described above.

Figure 111:
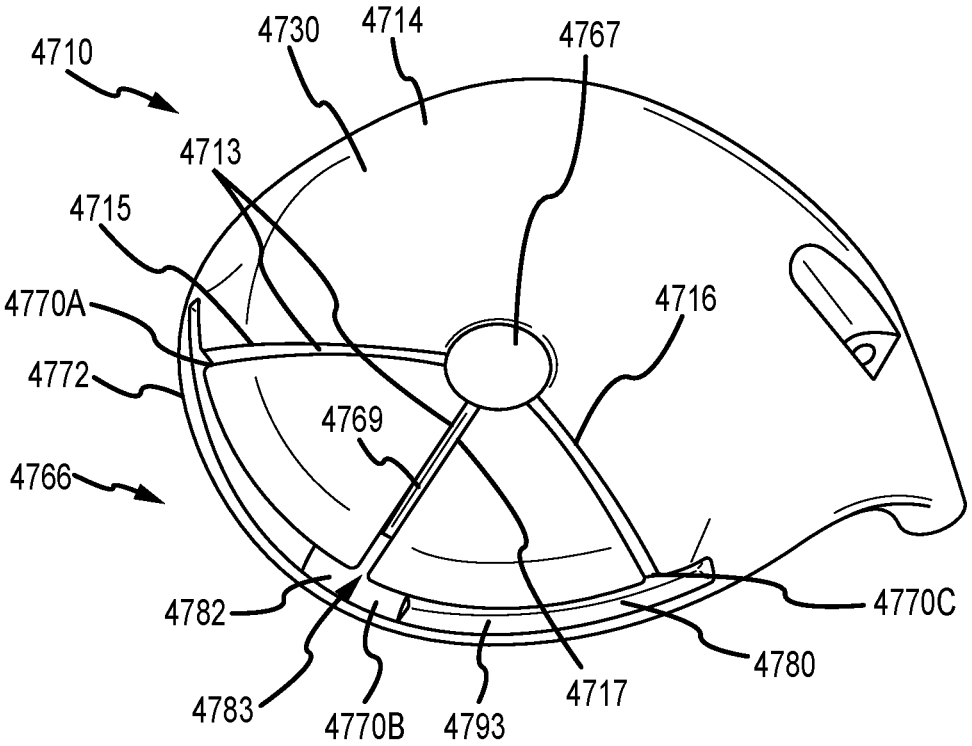
FIGS. 111 and 112 are perspective views of a golf club head and turnbuckle according to another embodiment.
Figure 112:
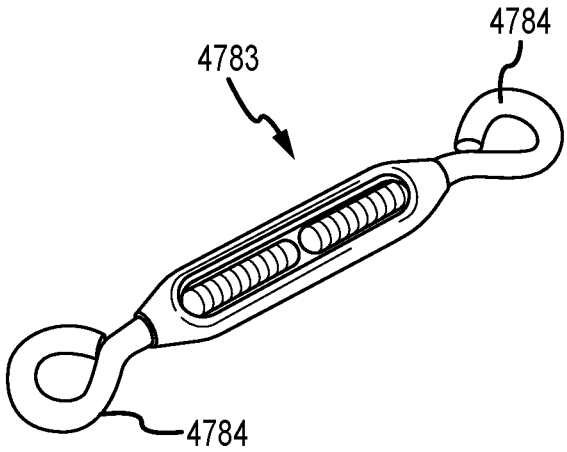
Figure 113:
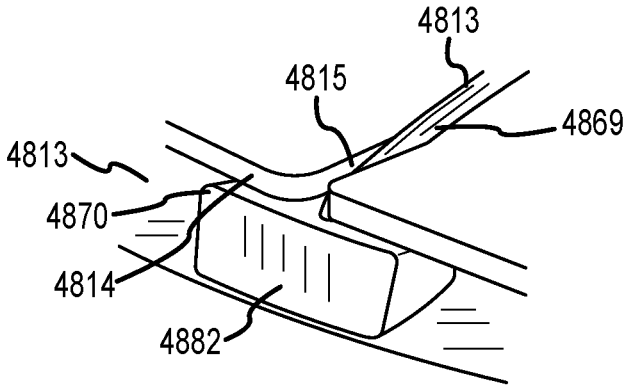
FIGS. 113-116 are perspective views of a golf club head and adjustable weight according to another embodiment.
Figure 114:
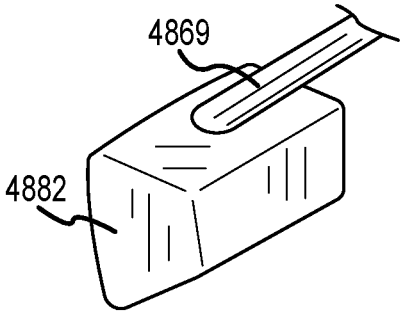

FIGS. 111 and 112 illustrate a club head 4710 having a club head body 4714. The club head 4710 includes an adjustable weighting system 4766 that is adjustable by an end user to modify the club head 4710 center of gravity and/or moment of inertia and/or heel/toe bias to achieve desired performance characteristics (e.g., forgiveness, spin, trajectory) under various circumstances. The adjustable weighting system 4766 is a low profile system and thereby does not significantly shift or change the club head 4710 MOI when compared to a club head not including the adjustable weighting system 4766. Further, the low profile adjustable weighting system 4766 ensures that shifts in the club head 4710 CG occur mainly in a heel end 4722 to toe end 4718 direction keeping the overall club head 4710 CG in a low and back location.

The adjustable weighting system 4766 is positioned on a sole 4730 of the club head 4710. As illustrated in FIG. 111, the sole 4730 of the club head 4710 comprises channels 4513. The channels 4713 extend radially from a generally central location of the sole 4730 toward a trailing edge 4772. In other embodiments, the channels 4713 can extend radially from any location on the sole 4730 (e.g., central positioned proximate the toe end 4718, central positioned proximate the heel end 4722, etc.). As illustrated in FIG. 111, the club head 4710 comprises three channels 4713, a first channel 4715 near the toe end 4718, a second channel 4716 proximate the heel end 4722, and a third channel 4717 between the first channel 4715 and the second channel 4716 in a general center. In other embodiments, the club head 4710 can comprise any number of channels 4713, such as one channel 4713, two channels 4713, three channels 4713, four channels 4713, five channels 4713, six channels 4713, seven channels 4713, or eight channels 4713. The channels 4713 are retention guides for a cable 4769. Thus, each of the channels 4713 is sized and shaped to contact and/or otherwise guide and retain the cable 4769. In some embodiments, the channels 4713 have a C-shaped or other shaped profile to facilitate retention of the cable 4769.

In the illustrated embodiment, the sole 3730 further comprises an elongated channel 4793 positioned along the trailing edge 4772 in an arcuate fashion, wherein the channels 4713 integrally extend into the elongated channel 4793. The elongated channel 4793 comprises a general cross-sectional shape such as a cylinder, a triangular prism, a cube, a rectangular prism, a pentagonal prism, a hexagonal prism, or etc. The adjustable weighting system 4766 includes a plurality of discrete attachment locations. The plurality of discrete attachment locations can comprise various features 4770 including protruding bodies, apertures or recesses or ports capable of receiving a fastener, notches or tabs or cutout regions, ribs or grooves, pegs, hooks, magnets, programmable magnets, or any other suitable attachment means. The features 4770 define a discrete attachment location for securing the weight 4782 to the club head 4710. In contrast to other adjustable weighting systems wherein the weight can be coupled at any, or at an infinite, or at an unlimited number of locations across the recessed portion. The junction of the channels 4713 and the elongated channel 4793 form the feature 4770. The feature 4770 is configured to receive a weight 4782. As illustrated in FIG. 111, the club head 4710 comprises three features 4770, a feature 4770A near the toe end 4718 at the junction of the elongated channel 3793 and the first channel 3715, a second feature 4770C proximate the heel end 4722 at the junction of the elongated channel 3793 and the second channel 3716, and a third feature 4770B between the first feature 4770A and the second feature 4770C at the junction of the elongated channel 3793 and the third channel 3717. In other embodiments, the club head 4710 can comprise any number of features 4770, such as one feature 4770, two features 4770, three features 4770, four features 4770, five features 4770, six features 4770, seven features 4770, or eight features 4770.

The weight 4782 comprises a general cross-sectional shape such as a cylinder, a triangular prism, a cube, a rectangular prism, a pentagonal prism, a hexagonal prism, or etc. In many embodiments, the cross-sectional shape of the weight 4782 is complimentary to a profile shape of the features 4770, wherein a portion of the surfaces of the weight 4782 abut a portion of the surfaces of the feature 4770 when the weight 4782 is placed within the feature 4770.

The weight 4782 further comprise a mass. The mass of the weight 4782 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4782 can be 1 gram, 2 grams, 3 grams, 6 grams, 9 grams, 12 grams, 15 grams, 18 grams, 21 grams, 24 grams, 27 grams, 30 grams, 33 grams, or 35 grams.

In some embodiments, the adjustable weighting system 4766 comprises a tensioner 4767 and the cable 4769 coupled to the tensioner 4767 at one end of the cable 4769. The tensioner 4767 is positioned in a general center on the sole 4730 of the club head 4710, disposed at an intersection of the radially extending channels 4713. Although in other embodiments, the tensioner 4767 is positioned at other locations on the sole 4730 of the club head 4710, still disposed at an intersection of the radially extending channels 4713. The tensioner 4767 can be attached to the club head 4710 by way of fastener or by an adhesive. When the tensioner 4767 is attached to the club head 4710, the tensioner 4767 does not extend past the lowest point of the club head 4710 when at address. In other embodiments, the tensioner 4767 is flush with the outer surface 4774 of the sole 4730.

The cable 4769 of the adjustable weighting system 4766 is similar to the cables 3269, 3369, 3469, 3569, 3769, 3869, 3969, 4069, 4169, 4469, 4569, 4669 as described above. The cable 3769 comprises a first end and a second end. In some embodiments, the first end of the cable 4769 is configured to be attached to the tensioner 4767, while the second end of the cable 4769 is configure to be coupled to the weight 4782. In other embodiments, the cable 7 can extend and retract by other means other than the tensioner 4767. The cable 4769 can be received within one of the channels 4713. As illustrated in FIG. 111, the cable 4769 is received within the third channel 4717. In other embodiments, cable 4769 can be receive within any of the channels 4713. The different positioning of the cable 4769 allows for the weight 4782 coupled to the cable 4469 to be positioned at different features 4770 to adjust the CG of the club head 4710 about the x-axis. The cable 4769 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 3769 can be made of baling twine, parachute cord material, nylon, Kevlar, polymer tweed, steel wire with polymer coating, any metallic wire with polymer coating or etc. In other embodiments, the cable 4769 is not coupled to the tensioner 4767, and can be retracted/loosened by other means other than by the tensioner.

The tensioner 4567 is similar to the tensioners 3267, 3367, 3467, 3567, 3667, 3767, 3867, 3967, 4067, 4167, and 4467, wherein the tensioner 4567 acts as a winch and ratchet mechanism. In other embodiments, the tensioner 4767 can be a J-slot tensioner similar to J-slot tensioner 3267 as described above. The tensioner 4767 may be rotated (e.g., twisted) in increments to adjust a tension in the cable 4769. The cable 4769, in turn, is coupled to the weight 4782 with a turnbuckle 4783, which allows the weight 4782 to be rotated when not placed in the channel 4713. When the tensioner 4667 is rotated clockwise, the cable 4769 is tightened (e.g., retracted), and the cable 4769 pulls the weight 4782 creating a force on the weight 4782 firmly against the feature 4770. Further, a frictional force is created between the abutting surfaces of the weight 4782 and of the feature 4770. The two forces created secures the weight 4782 within the feature 4770. In other embodiments, the cable 4769 can be retracted by other means other than by a tensioner. When the tensioner 4767 loosens the tension on the cable 4769, the two forces no longer act on the weight 4782. Without the two forces, the weight 4782 does not abut the feature 4770. The weight 4782 can then be taken out of the feature 4770, and the cable 4769 can be repositioned to a different channel 4713. In other embodiments, the cable 4769 can be retracted by other means other than by the tensioner 4767.

In some embodiments, the tensioner 4767 is in a naturally locked orientation, wherein the tensioner 4767 is pressed downward to engage the rotational movement of the winch and ratchet mechanism to release tension in the cable 4769. In other embodiments, the tensioner 4767 is in a naturally locked orientation, wherein the tensioner 4767 is pulled upward to engage the rotational movement of the winch and ratchet mechanism to release tension in the cable 4769. In some embodiments, a tool is required to rotate the tensioner 4767 and/or to release tension in the cable 4769. In other embodiments, the cable 4769 can be loosened by other means other than by the tensioner 4767.

In some embodiments, the tensioner 4767 is not provided. Rather, the first end of the cable 4769 is fixed or otherwise anchored directly to the club head 4710 at the intersection of the radially extending channels 4713, and the second end of the cable 4769 is coupled to the turnbuckle 4783. The weight 4782 in turn is coupled to the turnbuckle 4782. Tension in the cable 4769 may be achieved by adjusting the turnbuckle 4783 itself (i.e., rotating one or both ends 4784 of the turnbuckle to shorten the overall length of the turnbuckle 4783 to pull the cable 4769). The tension created by the turnbuckle 4783 is sufficient to hold the weight 4782 against the feature 4770 of the club head body 4714. In some embodiments, one end 4784 of the turnbuckle 4783 is coupled (e.g., directly) to a central location on the sole or bottom 4730 of the club head body 4714 (or other location on the club head body 4714). One end of the cable 4769 is coupled to the turnbuckle 4783, and an opposite end of the cable 4769 is coupled to the weight 4782, such that the cable 4769 extends between the turnbuckle 4783 and the weight 4782. Other embodiments include different numbers and locations of turnbuckles than that illustrated.

The turnbuckle 4783 can be rotated in an opposite direction to lengthen the turnbuckle 4783 and release the tension in the cable 4769. When the cable 4770 is loose, the weight 4782 can be repositioned to a different location within the feature 4770 corresponding with a channel 4713. For example, the weight 4782 can initially be positioned within the third feature 4770B with the cable positioned in the third channel 4717. When the turnbuckle 4783 is rotated to loosen the cable 4769, the weight 4882 can be repositioned in the second feature 4770C and the cable 4769 is positioned within the corresponding second channel 4716. The turnbuckle 4783 can then be rotated to increase the tension in the cable 4769 to secure the weight 4782 in place. Repositioning the weight 4782 from a general center position to near the heel end 4722 can help correct ball trajectory for a player who tends to hook the ball.

The club head 4710 having the adjustable weighting system comprises the tensioner 4767 (or other cable adjustment means such as a turnbuckle 4783) and cable 4769 described above can optimize the performance of the golf club 4710. The adjustable weighting system 4766 allows for the club head 4710 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 4710 having the tensioner 4767 (or turnbuckle 4783) and the cable 4769 adjustable weight system 4766 further have an utility regarding ease of manufacturing compared to club heads with more complex structures to house a weight (i.e., deep weight ports, multiple weight ports, rail systems, weight covers/caps). The weight 4782 coupled to the feature 4770 are secured by the tension of the cable 4769, which create an abutment force and friction force between a surface of the weight 4782 and a surface of the club head 4710. The tension, abutment and frictional forces eliminates the need for the club head 4710 to be manufactured with a weight housing structure having complex internal/external geometries in order to secure the weight 4782. Thereby reducing the material and mass associated with the complex weight housing structure. The mass saved from the lack of the weight housing structure can then be positioned elsewhere on the club head 4710 to increase strength and/or mass in that location. The tension and friction created by the cable further eliminates the need for screw-type fasteners, thus the weight 4782 and club head 4710 do not require manufacturing a threaded aperture to receive the fastener. The lack of the fastener and threaded aperture reduces the cost of manufacturing and increase production.

Further, the cable 4769 of the adjustable weighting system 4766 is lightweight, strong, and can be incorporated with the channels 4713 in a number of different patterns on the outer surface 4774 of the club head 4710. The different patterns allows for the weight 4782 to be place in a number of different locations on the sole because the weight 4782 is not limited to specific weight housing structures. The number of different weight positions can help fine tune the center of gravity placement to adjust the ball spin and trajectory for individual players. The cable 4769 can further be strategically placed in such a pattern that the cable 4769 can reinforce specific locations on the club head 4710. The material and pattern of the cable 4769 can further still act as a sound dampener and absorb vibration experienced by the club head 4769 during impact, thereby reducing unwanted sound, and unwanted stress during a game.

The adjustable weighting system 4766 of golf club head 4710 maintains or prevents a significant reduction in club head moment of inertia, and low and back club head center of gravity positioning, compared to a club head devoid of an adjustable weighting system. The adjustable weighting system 4766 of golf club head 4710 maintains a high club head moment of inertia and a low and back club head CG position due to the low profile of the weighting system and the perimeter positioning of the one or more weights. The club head 4710 having the adjustable weighting system 4766 can have similar or identical parameters and measurements as club head 100 described above.

FIGS. 113-116 illustrate a club head 4810 having a club head body 4814. The club head 4810 includes an adjustable weighting system 4866 that is adjustable by an end user to modify the club head 4810 center of gravity and/or moment of inertia and/or heel/toe bias to achieve desired performance characteristics (e.g., forgiveness, spin, trajectory) under various circumstances. The adjustable weighting system 4866 is a low profile system and thereby does not significantly shift or change the club head 4810 MOI when compared to a club head not including the adjustable weighting system 4866. Further, the low profile adjustable weighting system 4866 ensures that shifts in the club head 4810 CG occur mainly in a heel end 4822 to toe end 4818 direction keeping the overall club head 4810 CG in a low and back location.

Figure 115:
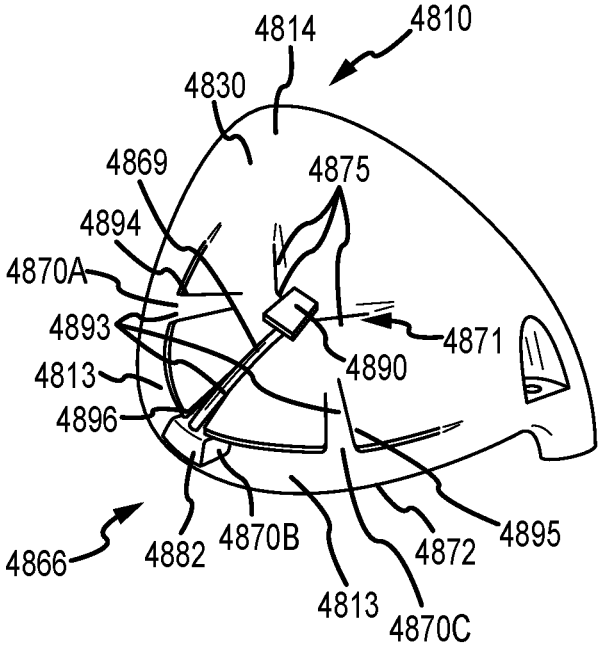

The adjustable weighting system 4866 is positioned on a sole 4830 of the club head 4810. As illustrated in FIG. 115, the sole 4830 of the club head 4810 comprises an outer surface 4874. The outer surface 4874 forms a lip along a trailing edge 4872, wherein the lip forms an elongated channel 4813 in between the lip and the club head 4810. In the illustrated embodiment, the elongated channel 4813 is located adjacent a trailing edge 4872, extends from a toe end 4818 to a heel end 4822 in an arcuate fashion. The elongated channel 4813 comprises a general cross-sectional shape such as a cylinder, a triangular prism, a cube, a rectangular prism, a pentagonal prism, a hexagonal prism, or etc.

The sole 4830 further comprise slots 4893. The slots 4893 are positioned on the lip of the outer surface 4874 above the elongated channel 4813, and extends toward a general center of the sole 4830. In the illustrated embodiment, the club head 4810 comprises three slots 4893, a first slot 4894 near the toe end 4818, a second slot 4895 near the heel end 4822, and centrally located third slot 4896 in between the first and the second slot 4894, and 4895. In other embodiments, the club head 4810 can comprise any number of slots 4893, such as one slot 4893, two slots 4893, three slots 4893, four slots 4893, five slots 4893, six slots 4893, seven slots 4893, or eight slots 4893. The slots 4893 are configure to receive a cable of the adjustable weight system 4866 and are retention guides for the cable 4869. Thus, each of the slots 4893 is sized and shaped to contact and/or otherwise guide and retain the cable 4869. In some embodiments, the slots 4893 have a C-shaped or other shaped profile to facilitate retention of the cable 4869. Other embodiments include different shapes and sizes of the slots 4893.

The sole further comprises a plurality of discrete attachment locations. The plurality of discrete attachment locations can comprise various features 4870 including protruding bodies, apertures or recesses or ports capable of receiving a fastener, notches or tabs or cutout regions, ribs or grooves, pegs, hooks, magnets, programmable magnets, or any other suitable attachment means. The features 4870 define a discrete attachment location for securing the weight 4882 to the club head 4810. In contrast to other adjustable weighting systems wherein the weight can be coupled at any, or at an infinite, or at an unlimited number of locations across the recessed portion. The features 4870 formed at the junction of the elongated channel 4813 and the slots 4893. In the illustrated embodiment, the club head 4810 comprises three features 4870, a first feature 4870A near the toe end 4818 at the junction of the elongated channel 4813 and the first slot 4894, a second feature 4870C near the heel end 4822 at the junction of the elongated channel 4813 and the second slot 4895, and centrally located third feature 4870 in at the junction of the elongated channel 4813 and the second slot 4896 between the first and the second features 4870A, and 4870C. In other embodiments, the club head 4810 can comprise any number of features 4870, such as one feature 4870, two features 4870, three features 4870, four features 4870, five features 4870, six features 4870, seven features 4870, or eight features 4870. In many embodiments, the number of features 4870 is the same number as slots 4793. The features 4870 is configured to receive a weight 4882.

The sole 4830 further comprises a recess 4871 located in a general center of the sole 4830. The recess 4871 forms a central lip with the outer surface 4874 of the sole 4830. In the illustrated embodiments the central lip of the recess 4871 has three generally linear portions 4875 angled relative to one another at oblique angles, although other embodiments include different profiles than that illustrated (e.g., curved, etc.), as well as different locations for a lip structure 4871 than that illustrated. The central lip of the recess 4871 is configured to receive a clip 4890 of the adjustable weighting system 4866.

The weight 4882 comprises a general cross-sectional shape such as a cylinder, a triangular prism, a cube, a rectangular prism, a pentagonal prism, a hexagonal prism, or etc. In many embodiments, the cross-sectional shape of the weight 4882 is complimentary to a cross-sectional shape of the features 4870, wherein a portion of the surfaces of the weight 4882 abut surfaces of the feature 4870 when the weight 4882 is placed within the feature 4870. Further, the weight 4882 comprise a width greater than a width of the slots 4893, wherein the weight 4882 cannot pass through the slots 4893.

The weight 4882 further comprise a mass. The mass of the weight 4882 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4882 can be 1 gram, 2 grams, 3 grams, 6 grams, 9 grams, 12 grams, 15 grams, 18 grams, 21 grams, 24 grams, 27 grams, 30 grams, 33 grams, or 35 grams.

Figure 116:
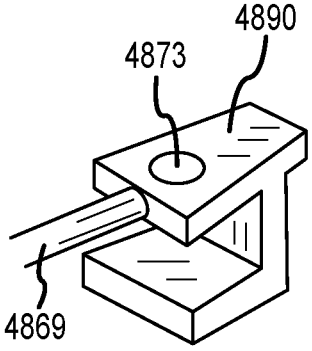
Figure 117:
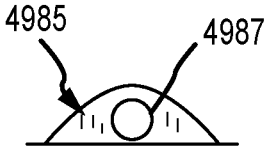
FIGS. 117-125 are perspective views of a golf club head and adjustable weights according to another embodiment.

The adjustable weighting system 4866 comprises the clip 4890 configured to receive the central lip of the recess 4871. As illustrated in FIGS. 115 and 116, the clip 4890 includes a U-shaped profile that allows the clip 4890 to be clipped onto the central lip of the recess 4871 and to be readjusted along the central lip of the recess 4871 as desired (e.g., by sliding the clip 4890 along the central lip or fully removing and then reattaching the clip 4890 to the central lip). Other embodiments include different profiles than that illustrated (e.g., C-shaped, etc.). In some embodiments, and with reference to FIG. 116, the clip 4890 includes a screw aperture 4873 that is used to receive a screw to selectively fasten the clip 4890 in place on the central lip of the recess 4871, thereby preventing movement of the clip 4890 during use.

The adjustable weighting system 4866 also comprises a cable 4869 coupled to the weight 4882 at one end of the cable 4869, and to the clip 4890 at an opposite end of the cable 4869. The cable 4869 is a sponge cord, although other embodiments include different types of cables 4869. The cable 4869 passes through the slot 4893 and engages the weight 4882 within the feature 4870. The cable 4869 can be made of a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4869 can be made of baling twine, parachute cord material, nylon, Kevlar, polymer tweed, steel wire with polymer coating, any metallic wire with polymer coating or etc.

To adjust the weight 4882, the clip 4890 is moved along or removed entirely from the central lip of the recess 4871 (e.g. by stretching the sponge cord). The tension of the cable 4869 secures the weight 4882 and the clip 4890 in place. In some embodiments a tool is used to remove the clip 4890 from the central lip of the recess 4871. The weight 4882 is moved along or removed entirely from the feature 4870. The weight 4882 and clip 4890 are then repositioned as desired. For example, the weight 4882 is moved to a different location feature 4870 along the elongate channel 4813, the clip 4890 is moved to a different location along the central lip of the recess 4871, and the cable 4869 is positioned within a different slot 4893. The weight 4882 can be repositioned so that the cable 4869 is repositioned from the first feature 4870A to the second feature 4870C, wherein the CG shifts toward the heel end 4822 to correct the ball trajectory of a player who tends to hook the ball.

The club head 4810 having the adjustable weighting system 4866 comprises the tensioner 4867 (or other cable adjustment means) and the cable 4869 described above can optimize the performance of the golf club. The adjustable weighting system 4866 allows for the club head 4810 to adjust the already low and back center of gravity about the x-axis (heel-to-toe end) without having to sacrifice a relatively high moment of inertia (MOI) similar to that of a club head void of an adjustable weight system. Shifting the CG about the x-axis allows for players to correct a slice or a hook in ball trajectory.

The club head 4810 having the tensioner 4867 and the cable 4869 adjustable weight system 4866 further have an utility regarding ease of manufacturing compared to club heads with more complex structures to house a weight (i.e., deep weight ports, multiple weight ports, rail systems, weight covers/caps). The weight 4882 coupled to the feature 3870 are secured by the tension of the cable 4869, which create an abutment force and friction force between a surface of the weight 4882 and surfaces of the feature 4870. The tension, abutment and frictional forces eliminates the need for the club head 4810 to be manufactured with a weight housing structure having complex internal/external geometries in order to secure the weight 4882. Thereby reducing the material and mass associated with the complex weight housing structure. The mass saved from the lack of the weight housing structure can then be positioned elsewhere on the club head 4810 to increase strength and/or mass in that location. The tension, abutment, and friction forces created by the cable 4869 further eliminates the need for screw-type fasteners, thus the weight 4882 and club head 4810 do not require manufacturing a threaded aperture to receive the fastener. The lack of the fastener and threaded aperture reduces the cost of manufacturing and increase production.

Further, the cable 4869 of the adjustable weighting system 4866 is lightweight, strong, and can be incorporated with the slots 4893 in a number of different patterns on the outer surface 4874 of the club head 4810. The different patterns allows for the weight 4882 to be place in a number of different locations on the sole 4830 because the weight 4882 is not limited to specific weight housing structures. The number of different weight positions can help fine tune the center of gravity placement to adjust the ball spin and trajectory for individual players. The cable 4869 can further be strategically placed in such a pattern that the cable 4869 can reinforce specific locations on the club head 4810. The material and pattern of the cable 4869 can further still act as a sound dampener and absorb vibration experienced by the club head 4810 during impact, thereby reducing unwanted sound, and unwanted stress during a game.

The adjustable weighting system 4866 of golf club head 4810 maintains or prevents a significant reduction in club head moment of inertia, and low and back club head center of gravity positioning, compared to a club head devoid of an adjustable weighting system. The adjustable weighting system 4866 of golf club head 4810 maintains a high club head moment of inertia and a low and back club head CG position due to the low profile of the weighting system and the perimeter positioning of the one or more weights. The club head 4810 having the adjustable weighting system 4866 can have similar or identical parameters and measurements as club head 100 described above.

FIGS. 117-125 illustrate a club head 4910 having a club head body 4914. The club head 4910 includes an adjustable weighting system 4966 that is adjustable by an end user to modify the club head 4910 center of gravity and/or moment of inertia and/or heel/toe bias to achieve desired performance characteristics (e.g., forgiveness, spin, trajectory) under various circumstances. The adjustable weighting system 4966 is a low profile system and thereby does not significantly shift or change the club head 4910 MOI when compared to a club head not including the adjustable weighting system 4966. Further, the low profile adjustable weighting system 4966 ensures that shifts in the club head 4910 CG occur mainly in a heel end 4922 to toe end 4918 direction keeping the overall club head 4910 CG in a low and back location.

Figure 118:
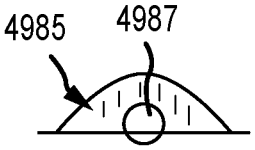
Figure 119:
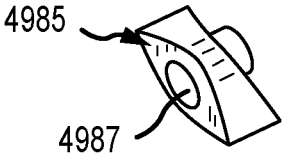
Figure 120:
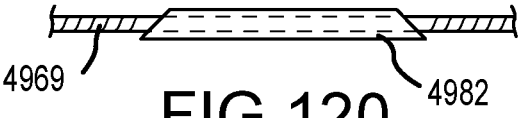
Figure 121:
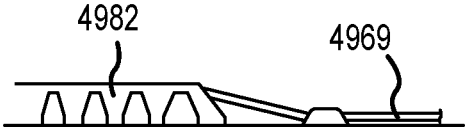
Figure 122:
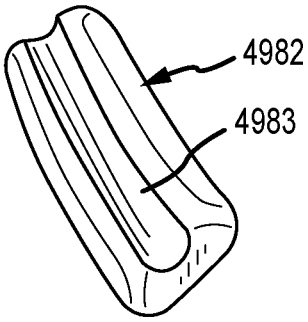
Figure 123:
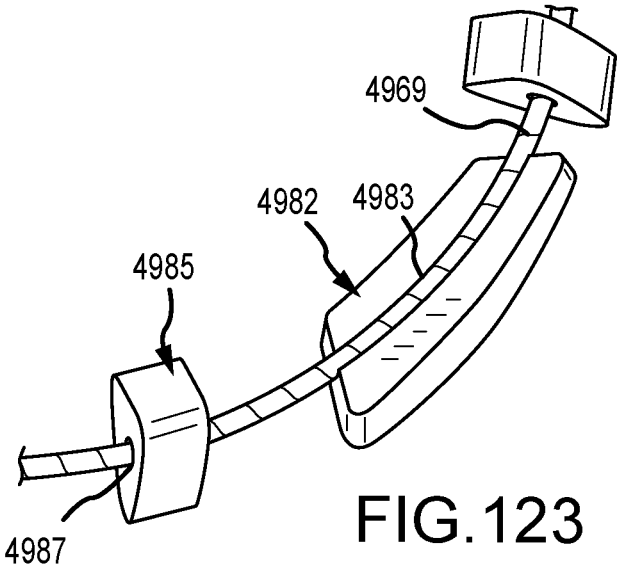
Figure 124:
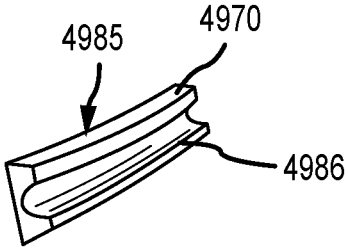

The adjustable weighting system 4966 is positioned on a sole 4930 of the club head 4910. With reference to FIGS. 117, 118, 119, 123, and 124, in some embodiments the sole 4930 comprises a cable guide or guides 4985 on the sole 4930 (e.g., one cable guide 4985, two cable guides 4985, three cable guides 4985, four cable guide 4985, five cable guides 4985, six cable guide 4985, or seven cable guides 4985). The cable guides 4985 are positioned on an outer surface 4974 of the sole 4930 along a trailing edge 4972. In some embodiments the cable guides 4985 are used solely for guiding the cable 4969, as opposed to adding a particular weight to a particular location or locations along the club head body 4914. In other embodiments, the cable guides 4985 can add weight to a particular location along the club head body 4914. The cable guides 4985 remain stationary. In the illustrated embodiment, the cable guides 4985 are a general rounded triangular shaped profile. In other embodiments, the cable guides 4985 can be any general shaped profile such as a square, a rectangle, a triangle, pentagon or any other general shaped profile, rounded or hard edged. In some embodiments one or more of the cable guides 4985 comprise a through aperture 4987 (FIGS. 117, 118, 119, 123), such that the cable 4969 are configured to pass through the through aperture 4987, and is thus guided. In other embodiments, the cable guide 4985 void of a through aperture 4987 can comprise a groove (not pictured), which forms a hook to receive, retain and guide the cable 4969. In many embodiments, the through aperture 4987 can be positioned above the outer surface 4974 of the sole 4930 (FIG. 117), while in other embodiments the through aperture 4987 can be positioned partially below the outer surface 4974 of the sole 4930 (FIG. 118). In other embodiments still, the through aperture 4987 can be positioned right at the outer surface 4974 of the sole 4930. In some embodiments (e.g., FIG. 124) one or more of the cable guides 4985 may also comprise a plurality of discrete attachment locations. The plurality of discrete attachment locations can comprise various features (not shown) including protruding bodies, apertures or recesses or ports capable of receiving a fastener, notches or tabs or cutout regions, ribs or grooves, pegs, hooks, magnets, programmable magnets, or any other suitable attachment means. The features define a discrete attachment location for securing the weight 4982 to the club head 4910. In contrast to other adjustable weighting systems wherein the weight can be coupled at any, or at an infinite, or at an unlimited number of locations across the recessed portion. For example, a weight 4982 may extend partially into the groove 4986 or otherwise be coupled to the guide 4985.

Figure 125:
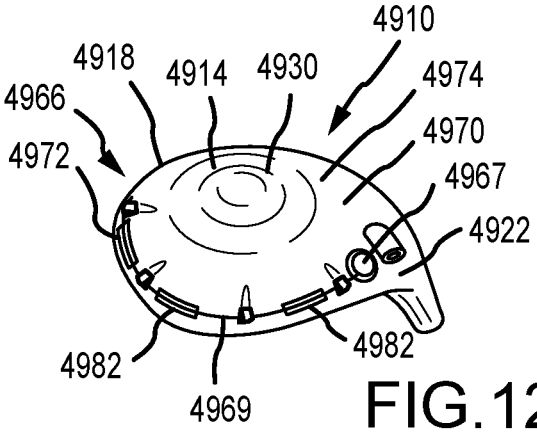

In some embodiments one or more of the weights 4982 has a generally curved profile, to match a curvature of the bottom or sole 4930. As illustrated in FIG. 125, each of the weights 4982 is coupled to a bottom or sole 4930 of the club head 4910 adjacent a trailing edge 4972 of the club head body 4914, although other embodiments include different locations for the weights 4982. The weights 4982 comprises a top surface and a bottom surface. The top surface of the weights 4982 comprises a groove 4983 configured to receive the cable 4969. In some embodiments the groove 4983 has a C-shaped (or other shaped) contour, so as to facilitate retention of the cable 4969 along the top surface of the weight 4982. In some embodiments void of the groove 4983, one or more of the weights 4982 includes a through aperture to receive the cable 4969, such that the weights 4982 may slide along the cable 4969. The weights 4982 further comprise a dampener (not pictured) attached to the bottom surface of the weights 4982, wherein the dampener is adjacent the outer surface 4974 of the sole 4930. When the weight 4982 is coupled to the adjustable weighting system 4966, the dampener on the weight 4982 creates a frictional force to prevent the weight 4982 from shifting on the sole 4930. In many embodiments, the club head 4910 can comprise any number of weights, such as one weight 4982, two weights 4982, three weights 4982, four weights 4982, five weights 4982, six weights 4982, seven weights 4982, or eight weights 4982.

The weights 4982 further comprise a mass. The mass of the weights 4982 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 4982 can be 3 grams, 6 grams, 9 grams, 12 grams, 15 grams, 18 grams, 21 grams, 24 grams, 27 grams, 30 grams, 33 grams, or 35 grams. In embodiments wherein the club head 4910 comprises multiple weights 4982, the weights 4982 can all comprise the same mass, or all have different masses. For example, the club head 4910 comprises three weights 4982 with the first weight 4982 having a mass of 12 grams, and both the second and third weights 4982 having a mass of 5 grams. In another example, the club head 4910 comprises four weights 3282 with the first weight 3282 having a mass of 20 grams, the second weight 3282 having a mass of 15 grams, the third weight 3282 having a mass of 10 grams, and the fourth weight 3282 having a mass of 7 grams.

The adjustable weighting system 4966 comprises a tensioner 4967 and a cable 4969. The tensioner 4967 is located at the heel end 4922 of the club head 4910, although in other embodiments the tensioner 4967 is located at a different location on the club head 4910 such as the toe end 4918. The tensioner 4967 can be attached to the club head 4910 by way of fastener or by an adhesive. When the tensioner 4967 is attached to the club head 4910, the tensioner 4967 does not extend past the lowest point of the club head 4910 when at address.

The cable 4969 of the adjustable weighting system 4966 is similar to the cables 3269, 3369, 3469, 3569, 3769, 3869, 3969, 4069, 4169, 4469, 4569, 4769, and 4869 as described above. The cable 4969 comprises a first end and a second end. The first end of the cable 4969 is configured to be attached to the tensioner 4967, while the second end is configured to be attached/fixed to the club head 4910 on the sole 4930 at the opposite end of the tensioner 4967. In other words, in embodiment with the tensioner 4967 positioned on the heel end 4922, the second end of the cable 4969 is fixed at the toe end 4918. Similarly, in embodiments with the tensioner 4967 positioned on the toe end 4918, the second end of the cable 4969 is fixed at the heel end 4922). In other embodiments, the cable 4969 can retract and extend by other means other than the tensioner 4967. The cable 4969 are configured to be received within the through apertures 4987 of grooves of the cable guides 4985. The cable 4969 can be a metallic material (e.g., steel wire rope, aluminum wire rope, copper wire rope, tungsten wire rope, nickel wire rope, silver wire rope, or any other metallic wire rope), a fiber, a polymer, a plastic, or a composite type rope. For example, the cable 4969 can be made of baling twine, parachute cord material, nylon, Kevlar, polymer tweed, steel wire with polymer coating, any metallic wire with polymer coating or etc.

The tensioner 4967 is similar to the tensioners 3267, 3367, 3467, 3567, 3667, 3767, 3867, 3967, 4067, 4167, and 4467, wherein the tensioner 4567 acts as a winch and ratchet mechanism to adjusts tension in the cable 4969 similar to the embodiments described above. In other embodiments, the tensioner 4967 can be a J-slot tensioner similar to J-slot tensioner 3267 as described above. When the tensioner 4967 is rotated clockwise, the tension created in the cable 4969 presses up against the groove 4983 (or aperture) of the weights 4982 to create a force on the weights 4982 against the sole 4930 of the club head body 4914. Further, a frictional force is created between the dampener of the weights 4982 and the outer surface 4974 (or feature) of the sole 4930. The two forces created secures the weight 4982 onto the outer surface 5974 of the sole 4930 and prevents the weight 4982 from sliding or shifting. In other embodiments, the cable 4969 can be retracted by other means other than by the tensioner 4967.

When the tensioner 4967 loosens the tension on the cable 4969, the two forces no longer act on the weight 4982. Without the two forces, the weight 4982 does not abut the outer surface 4974 (or feature) of the sole 4930. The weight 4982 can then decouple from the cable 4969 (or slide) and be repositioned to a different positioned along the cable 4969. The ability to reposition the weight 4582 along the cable 4969 allows for the CG of the club head 4910 to shift about the heel end 4922, and toe end 4918. For example, when the weight 4982 is repositioned from a location on the cable 4969 in general center between the toe end 4918 and the heel end 4922 to a location on the cable 4969 near the toe end, the CG shifts toward the toe end 4918. A CG shift toward the toe end 4918 will help center ball flight for players who tend to slice their shots.

In some embodiments, the tensioner 4967 is in a naturally locked orientation, wherein the tensioner 4967 is pressed downward to engage the rotational movement of the winch and ratchet mechanism to release tension in the cable 4969. In other embodiments, the tensioner 4967 is in a naturally locked orientation, wherein the tensioner 4967 is pulled upward to engage the rotational movement of the winch and ratchet mechanism to release tension in the cable 4869. In some embodiments, a tool is required to rotate the tensioner 4967 and/or to release tension in the cable 4969.

The club head 4910 having the adjustable weighting system 4966 comprises the tensioner 4967 (or other cable adjustment means) and the cable 4969 described above can optimize the performance of the golf club. The adjustable weighting system 4966 allows for the club head 4910 to adjust the already low and back center of gravity about the x-axis (heel-to-toe end) without having to sacrifice a relatively high moment of inertia (MOI) similar to that of a club head void of an adjustable weight system. Shifting the CG about the x-axis allows players to correct a slice or a hook in ball trajectory.

The club head 4910 having the tensioner 4967 and the cable 4969 adjustable weight system 4966 further have an utility regarding ease of manufacturing compared to club heads with more complex structures to house a weight (i.e., deep weight ports, multiple weight ports, rail systems, weight covers/caps). The weight(s) 4982 coupled to the club head body 4914 are secured by the tension of the cable 4969, which create an abutment and frictional forces between a surface of the weight(s) 4982 (or friction pad) and the outer surface 4974 of the club head 4910. The tension, abutment and frictional forces eliminates the need for the club head 4910 to be manufactured with a weight housing structure having complex internal/external geometries in order to secure the weight(s) 4982. Thereby reducing the material and mass associated with the complex weight housing structure. The mass saved from the lack of the weight housing structure can then be positioned elsewhere on the club head 4910 to increase strength and/or mass in that location. The tension, abutment, and frictional forces created by the cable 4969 further eliminates the need for screw-type fasteners, thus the weight(s) 4982 and club head 4910 do not require manufacturing a threaded aperture to receive the fastener. The lack of the fastener and threaded aperture reduces the cost of manufacturing and increase production.

Further, the cable 4969 of the adjustable weighting system 4966 is lightweight, strong, and can be incorporated in a number of different patterns on the outer surface 4974 of the club head 4910. The different patterns allows for the weight(s) 4982 to be place in a number of different locations on the sole because the weight(s) 4982 are not limited to specific weight housing structures. The number of different weight positions can help fine tune the center of gravity placement to adjust the ball spin and trajectory for individual players. The cable 4969 can further be strategically placed in such a pattern that the cable 4969 can reinforce specific locations on the club head 4910. The material and pattern of the cable 4969 can further still act as a sound dampener and absorb vibration experienced by the club head 4910 during impact, thereby reducing unwanted sound, and unwanted stress during a game.

The adjustable weighting system 4966 of golf club head 4910 maintains or prevents a significant reduction in club head moment of inertia, and low and back club head center of gravity positioning, compared to a club head devoid of an adjustable weighting system. The adjustable weighting system 4966 of golf club head 4910 maintains a high club head moment of inertia and a low and back club head CG position due to the low profile of the weighting system and the perimeter positioning of the one or more weights. The club head 4910 having the adjustable weighting system 4966 can have similar or identical parameters and measurements as club head 100 described above.

Figure 126:
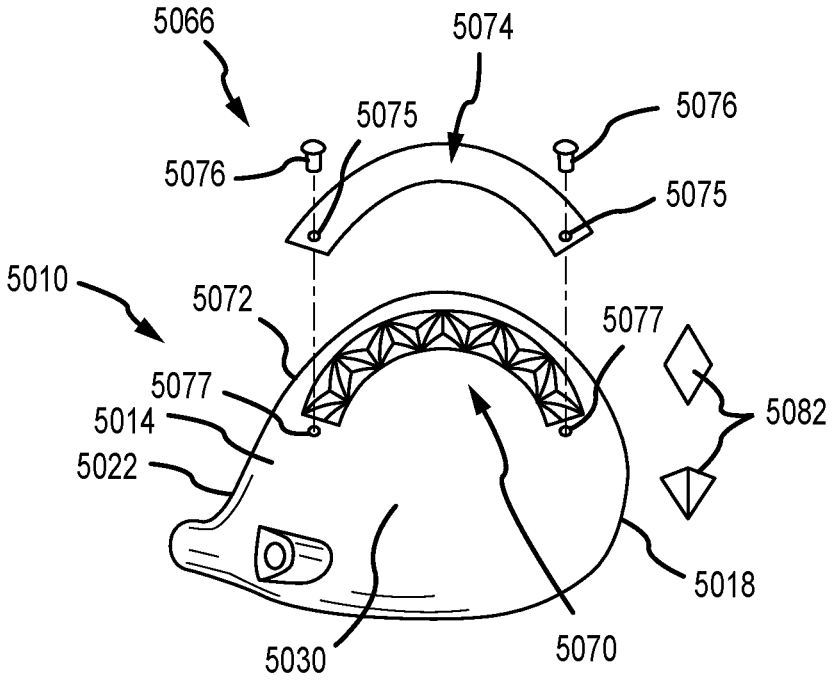
FIGS. 126 and 127 are perspective views of a golf club head according to another embodiment.
Figure 127:
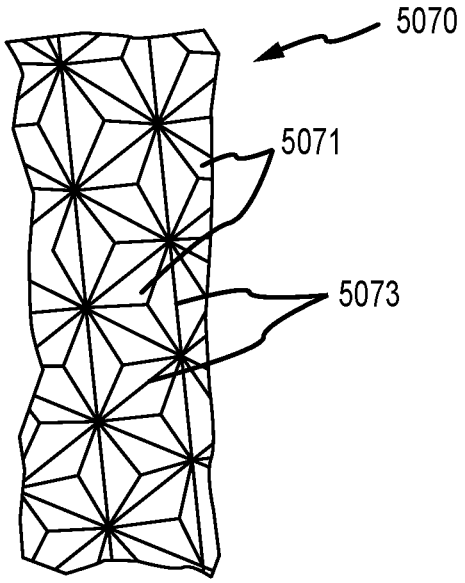

FIGS. 126 and 127 illustrate a club head 5010 having a club head body 5014. The club head 5010 includes an adjustable weighting system 5066 that is adjustable by an end user to modify the club head 5010 center of gravity and/or moment of inertia and/or heel/toe bias to achieve desired performance characteristics (e.g., forgiveness, spin, trajectory) under various circumstances. The adjustable weighting system 5066 is a low profile system and thereby does not significantly shift or change the club head 5010 MOI when compared to a club head not including the adjustable weighting system 5066. Further, the low profile adjustable weighting system 5066 ensures that shifts in the club head 5010 CG occur mainly in a heel end 5022 to toe end 5018 direction keeping the overall club head 5010 CG in a low and back location.

The adjustable weighting system 5066 is positioned on a sole 5030 of the club head 5010. The adjustable weighting system 5066 comprises a plurality of discrete attachment locations. The plurality of discrete attachment locations can comprise various features 5070 including protruding bodies, apertures or recesses or ports capable of receiving a fastener, notches or tabs or cutout regions, ribs or grooves, pegs, hooks, magnets, programmable magnets, or any other suitable attachment means. The features 5070 define a discrete attachment location for securing the weight 5082 to the club head 5010. In contrast to other adjustable weighting systems wherein the weight can be coupled at any, or at an infinite, or at an unlimited number of locations across the recessed portion. In the illustrated embodiment, the feature 5070 is a three-dimensional geometric pattern along the sole 5030 of the club head body 5014 adjacent a trailing edge 5072 creating a U-shaped strip. However, the feature 5070 can be of any shape and any configuration such that one or more weights may be coupled to (to include being pressed against) the features 5070. In other embodiments, the geometric pattern feature 5070 can extends to other areas of the sole 5030, or to other areas of the club head body 5014 (e.g., covering substantially all or all of the sole or bottom 5030), and can form any shape (e.g., partial circle, straight strip, zig-zag, W-shaped, V-shaped, etc.). In some embodiments, the feature 5070 extends the entire trailing edge 5072 extending from a toe end 5018 to a heel end 5022, while is other embodiments, the feature 5070 extends only a portion of the trailing edge 5070.

As illustrated in FIG. 127, in the illustrated embodiment the geometric pattern of the feature 5070 comprises a plurality of raised, three-sided pyramids 5071 that form a pattern of recesses 5073 between the pyramids 5071. Other embodiments include different shapes and any number of sided pyramids (e.g., four-sided pyramids, five-sided pyramids, six-sided pyramids, hemispherical bodies, rectangular protrusions, pentagonal prisms, any prismatic shape, etc.) that form recesses 5073. The raised portions of the feature 5070 can extend to be on the same level surface as an outer surface 5074 of the sole 5030. In other embodiments, the raised portions of the feature 5070 do not extend to the same level surface as the outer surface 5074. In other embodiments still, the raised portions of the features 5070 can extend past the outer surface 5074 without extending past the lowest point of the sole 5030 when at address in order to not obstruct a player's swing.

The feature 5070 of the adjustable weighting system 5066 is configured to receive a weight 5082 of the adjustable weighting system 5066. The weights 5082 are configured for distinct locations of the recesses 5073 of the features 5070. The weight 5082 comprises a diamond-like shape. In many embodiments, the weight 5082 can comprise a shape complimentary to the recesses 5073 of the feature 5070. The weight 5082 can be in any of the recesses 5073 of the feature 5073. In some embodiments, the club head 5010 can comprise one weight 5082. In other embodiments, the club head 5010 can comprise more than one weight 5082, such as two, three, four, five, six, seven, eight, nine, or ten weights 5082. In other embodiments still, the club head can comprise more than ten weights 5082, such as 12, 15, 18, 20, 23, 25, 28, or 30 weights 5082.

As illustrated in FIG. 126, the cover 5074 comprises a general elongated strip similar to the elongated strip of the cover 5074, but slightly longer. In many embodiments, the cover 5074 can comprise a shape identical or similar to the shape of the feature 5070. In other embodiments, the cover 5074 can comprise any shape, and cover any portion of the feature 5070 (e.g., a portion of the feature 5070, any portion of the sole 5030, a combination of a portion of the feature 5070 and any portion of the sole 5030).

The cover 5074 comprises an outer surface 5073, and an inner surface (not pictured). The outer surface 5073 of the cover 5074 can comprise a smooth surface and is flush with the outer surface 5074 of the sole 5030 when the weight 5082 is received by the feature 5070. The inner surface of the cover 5074 is configured to be adjacent to the feature 5070 and the weights 5082.

In some embodiments the weight 5082 is restrained from shifting by the surfaces of the three-sided pyramids 5071 or other surfaces of the geometric pattern feature 5070. In some embodiments, the weights 5082 are at least partially restrained by fasteners, clips, cables, or other structures. As illustrated in FIG. 126, in some embodiments the weights 5082 are at least partially restrained by a cover 5074. The cover 5074 fits over the geometric pattern feature 5070. In the illustrated embodiment, the cover 5074 includes two insertion apertures 5075, and two fasteners 5076 (e.g., screws) pass through the insertion apertures 5075 and into retention apertures 5077 in the club head body 5014. To repositioned the weight 5082, the cover 5074 is first removed, and the weight 5082 is then taken off of the geometric pattern feature 5070 (e.g., via a tool, or via hand without a tool if a tool was used to remove the cover 5074). The weight 5082 is then inserted onto a different recesses 5073 (distinct locations) of the geometric pattern feature 5070 (e.g., with the same tool) before the cover 5074 is re-attached. Repositioning the weights 5082 to different recesses 5073 of the feature 5070 can shift the CG of the club head 5010. For example, the weight 5082 can be positioned in the recesses 5073 near the heel end 5022 to shift the CG toward the heel end 5022 to help correct ball trajectory for a player who tends to hook the ball. In another example, the weight 5082 can be positioned in the recesses 5073 in a generally central location between the heel end 5022 and the toe end 5018 to keep the CG neutral, for a player who tends have straight ball trajectory.

The adjustable weighting system 5066 of golf club head 5010 maintains or prevents a significant reduction in club head moment of inertia, and low and back club head center of gravity positioning, compared to a club head devoid of an adjustable weighting system. The adjustable weighting system 5066 of golf club head 5010 maintains a high club head moment of inertia and a low and back club head CG position due to the low profile of the weighting system and the perimeter positioning of the one or more weights. The club head 5010 having the adjustable weighting system 5066 can have similar or identical parameters and measurements as club head 100 described above.

Figure 128:
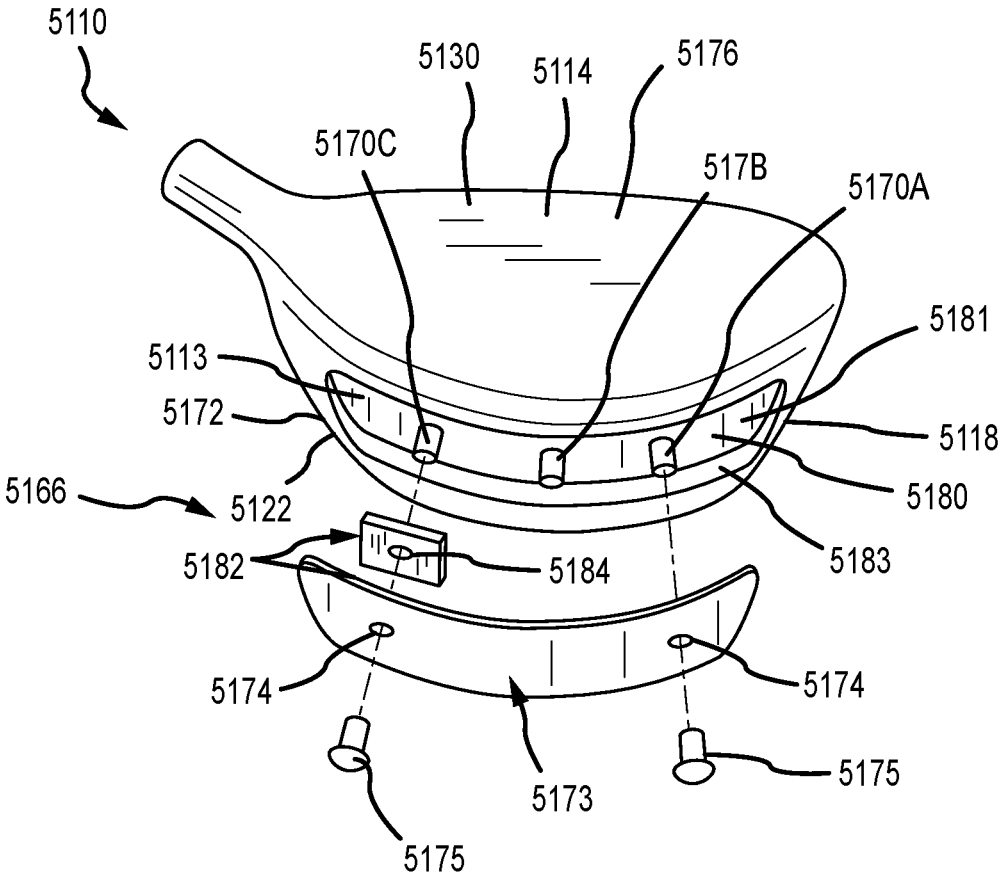
FIG. 128 is a perspective view of a golf club head according to another embodiment.

FIG. 128 illustrates a club head 5110 having a club head body 5114. The club head 5110 includes an adjustable weighting system 5166 that is adjustable by an end user to modify the club head 5110 center of gravity and/or moment of inertia and/or heel/toe bias to achieve desired performance characteristics (e.g., forgiveness, spin, trajectory) under various circumstances. The adjustable weighting system 5166 is a low profile system and thereby does not significantly shift or change the club head 5110 MOI when compared to a club head not including the adjustable weighting system 5166. Further, the low profile adjustable weighting system 5166 ensures that shifts in the club head 5110 CG occur mainly in a heel end 5122 to toe end 5118 direction keeping the overall club head 6310 CG in a low and back location.

As illustrated in FIG. 128, the adjustable weighting system 5166 can comprise a channel or recessed portion 5113 positioned on a sole 5130 along a trailing edge 5172. The channel 5113 comprises a recessed surface 5181, wherein the recessed surface 5181 is separated from the remaining outer surface 5176 of the sole 5130 by a wall 5183. The channel 5113 further comprises a plurality of discrete attachment locations. The plurality of discrete attachment locations can comprise various features 5170 including protruding bodies, apertures or recesses or ports capable of receiving a fastener, notches or tabs or cutout regions, ribs or grooves, pegs, hooks, magnets, programmable magnets, or any other suitable attachment means. The features 5170 define a discrete attachment location for securing the weight 5182 to the club head 5110. In contrast to other adjustable weighting systems wherein the weight can be coupled at any, or at an infinite, or at an unlimited number of locations across the recessed portion. In the illustrated embodiment, the feature 5170 is a protrusion extending from the recessed surface 5181. Each feature 5170 defines a discrete attachment location for securing a weight 5182 to the club head 5110, wherein the weights 5182 cannot be attached at infinite locations. In the illustrated embodiment, the adjustable weighting system 5166 includes a channel 5113 comprising three features 5170, a first feature 5170A near the toe end 5118, a second feature 5170C near the heel end 5122, and a third feature 5170B in a general center between the first feature 5170A and the second feature 5170C. In other embodiments, the channel 5113 can comprise any number of features 5170, such as one feature 5113, two features 5113, three features 5113, four features 5113, five features 5113, six features 5113, seven features 5113, or eight features 5113.

The channel 5113 includes a depth measured along a direction toward a center of the club head 5110, and/or along a direction that is normal to the recessed surface 5181 of the channel 5113. In the illustrated embodiment, the channel 5113 has a varying depth such that it is deeper in some areas than in other areas (e.g., may have a continuously or intermittently changing depth). In other embodiments, the channel depth 5113 can have an increasing, decreasing and/or constant depth along its length from the toe end 5118 to the heel end 5122. Thus, when a weight 5182 is coupled to the club head 5110 in one region of the channel 5113, the weight 5182 may fit flush in the channel 5113 and/or be concealed by wall 5183 of the channel 5113.

In many embodiments, the channel 5113 has a shallow depth ensuring the adjustable weight system 5166 remains low profile. For example, in some embodiments, the channel 5113 has a maximum depth of 0.25 inches. In other embodiments, the channel 5113 can have a maximum depth of 1.5, 1.25, 1.0, 0.9, 0.8, 0.7, 0.6, 0.5, 0.4, 0.3, 0.2, or 0.1 inches. In other embodiments, the depth of the channel 5113 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 5113 includes a width. In the illustrated embodiments, the channel 5113 includes a constant width. In other embodiments, the channel 5113 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

The weight 5182 of the adjustable weighting system 5166 have a generally rectangular shape corresponding with the shape of the channel 5113. In other embodiments, the weight 5182 can have a circular, triangular, trapezoidal, polygonal or any other suitable shape configured to fit within the channel 5113. In the illustrated embodiment, the adjustable weighting system 5166 comprises one weight 5182 configured to be coupled to the three features 5170A, B, C. In other embodiments, the adjustable weighting system 5166 can comprise more or less weights 5182 than the number of features 5170A, B, C. For example, the adjustable weighting system 5166 can comprise one, two, three, four, five, six, seven, eight, nine or ten weights 6382.

As illustrated in FIG. 128, the weights 5182 each include an aperture 5184 (e.g., through aperture) that is sized and shaped to fit over one of the feature 5170, so as to couple the weight 5182 to the channel 5113. In some embodiments, the features 5170 have a diameter or width that is approximately equal to or slightly larger than a diameter or width of the aperture 5184 of the weight 5182, such that the weights 5182 are coupled to the features 5170 via a frictional, press or interference fit. The weight 5182 can be positioned onto any feature 5170 to adjust the CG about the x-axis (heel-to-toe). For example in the illustrated embodiment, the weight 5182 can be repositioned from the second feature 5170C near the heel end 5122 to the first feature 5170A near the toe end 5118 to shift the CG toward the toe end 5118 to help correct the ball trajectory for a player who tends to slice the ball.

As illustrated in FIG. 128, in some embodiments, the weights 5182 are restrained at least partially by a cover 5173. The cover 5173 fits over the weights 5182 and features 5170 and channel 5113. In the illustrated embodiment, the cover 5173 includes two insertion apertures 5174, and two fasteners 5175 (e.g., screws) pass through the insertion apertures 5174 and into retention apertures (not illustrated) in the club head body 5114. To adjust a weight 5182, the cover 5173 is first removed, and the weight 5182 is then taken off of the feature 5170 (e.g., via a tool or via hand without a tool if a tool was used to remove the cover 5173) and inserted over a different feature 5170 (e.g., with the same tool) before the cover 5173 is re-attached. The cover 5173 is flush with the outer surface 5176 of the sole 5130.

The adjustable weighting system 5166 of golf club head 5110 maintains or prevents a significant reduction in club head moment of inertia, and low and back club head center of gravity positioning, compared to a club head devoid of an adjustable weighting system. The adjustable weighting system 5166 of golf club head 5110 maintains a high club head moment of inertia and a low and back club head CG position due to the low profile of the weighting system and the perimeter positioning of the one or more weights. The club head 5110 having the adjustable weighting system 5166 can have similar or identical parameters and measurements as club head 100 described above.

FIGS. 129-134 illustrate a club head 5210 having a club head body 5214. The club head 5210 includes an adjustable weighting system 5266 that is adjustable by an end user to modify the club head 5210 center of gravity and/or moment of inertia and/or heel/toe bias to achieve desired performance characteristics (e.g., forgiveness, spin, trajectory) under various circumstances. The adjustable weighting system 5266 is a low profile system and thereby does not significantly shift or change the club head 5210 MOI when compared to a club head not including the adjustable weighting system 5266. Further, the low profile adjustable weighting system 5266 ensures that shifts in the club head 5210 CG occur mainly in a heel end 5220 to toe end 5218 direction keeping the overall club head 5210 CG in a low and back location.

Figure 129:
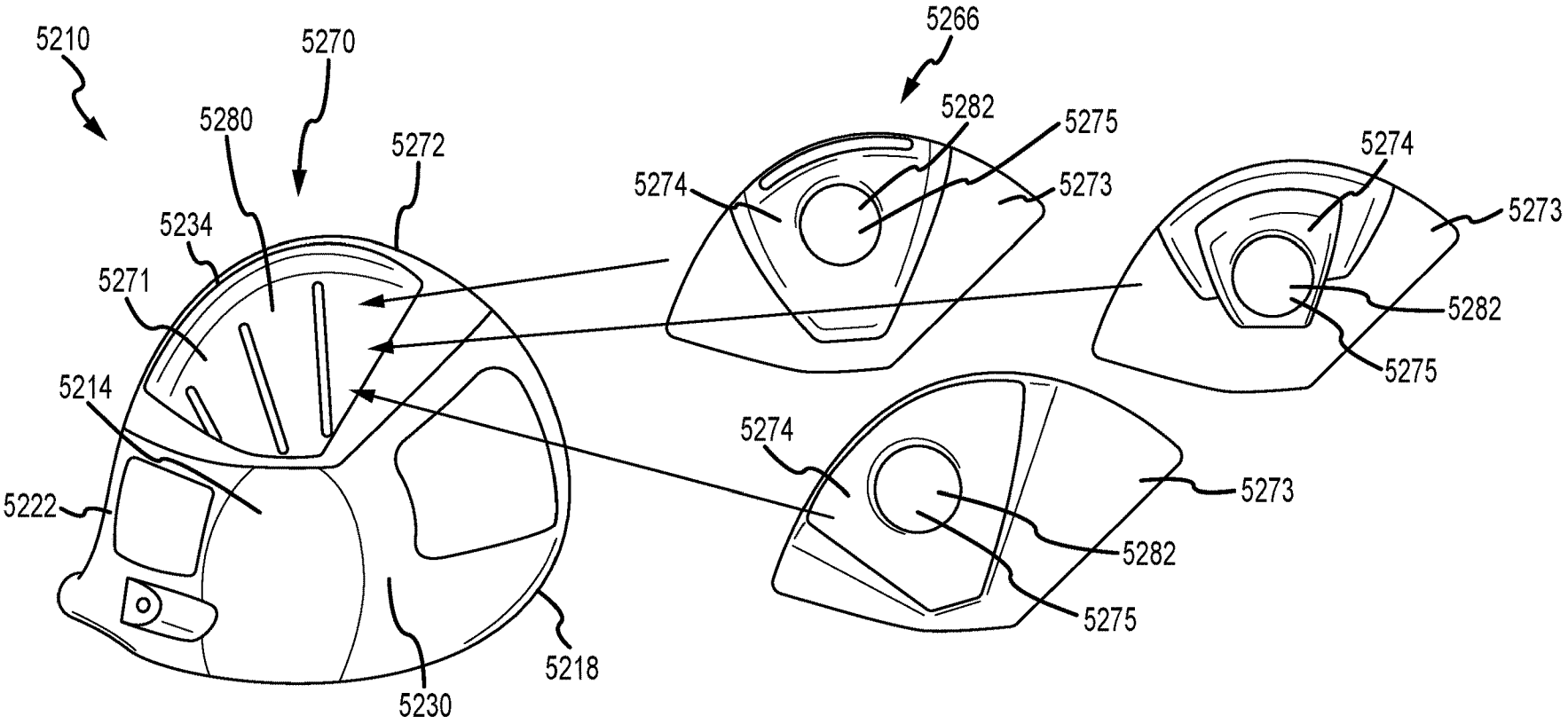
FIGS. 129-134 are perspective views of a golf club head and sole plates according to another embodiment.

The adjustable weighting system 5266 comprises a plurality of discrete attachment locations. The plurality of discrete attachment locations can comprise various features 5270 including protruding bodies, apertures or recesses or ports capable of receiving a fastener, notches or tabs or cutout regions, ribs or grooves, pegs, hooks, magnets, programmable magnets, or any other suitable attachment means. The features 5270 define a discrete attachment location for securing the weight 5282 to the club head 5210. In contrast to other adjustable weighting systems wherein the weight can be coupled at any, or at an infinite, or at an unlimited number of locations across the recessed portion. The feature 5270 is positioned along a sole or bottom 5230 of the club head body 5214, adjacent a trailing edge 5272 and defining a recessed portion or aperture. The feature (recessed portion) 5270 is along the trailing edge 5272 and extends into a general center portion of the sole 5230, forming a general seashell-like shape. In other embodiments, the feature 5270 can extend into any portion of the sole 5230 and form any shape (e.g., partial circle, partial ellipse, circle, square, triangular, etc.). As illustrated in FIG. 129, the feature 5270 is a generally flat surface comprising rib strictures extending toward the trailing edge 5272. In other embodiments, the feature 5270 can be a generally flat surface comprise any structural component (e.g., ribs, aperture, bore, grooves, etc.), or can be generally flat with no extra structural components. The feature 5270 is configured to receive a sole plate 5273 of the adjustable weighting system 5266.

The sole plates 5273 of the adjustable weighting system 5266 is configured to be received within the feature 5270. In the illustrated embodiment, the sole plate 5273 is positioned over the feature 5270 of the club head 5210. In other embodiments, the sole plate 5273 may be positioned over any other portion of the club head 5210, including a crown, toe, heel, etc. In some embodiments, more than one sole plate 5273 may be positioned on any combination of the above described regions of the club head 5210. In some embodiments, the cut-out region 5271 and/or the recessed portion or aperture 5280 are not present. Rather, the sole plates 5273 are coupled directly over an exterior surface of the club head body 5214 (e.g., along the sole or bottom 5230). In some embodiments, the club head body 5214 includes designated areas including shallow recessed portions, notches, or other designated areas that are sized and shaped to receive the sole plates 5273, such that when a sole plate 5273 is coupled to the designated area, at least a portion of the sole plate 5273 is generally flush with a remainder of the surrounding club head body 5214.

The sole plates 5273 can comprise a general shape and contour. In the illustrated embodiment, the sole plates comprise a seashell-like shape and contour to fit onto the sole 5230 of the club head 5210. In other embodiments, the sole plates can comprise any other general shape and contour such as a partial circle, partial ellipse, circle, square, triangular, pentagon, trapezoid etc. In many embodiments, the sole plates 5273 comprise a general shape and contour complimentary to the feature 5270 (recessed portion) of the club head 5210. In some embodiments the sole plates 5273 are of different size, shape, and/or material depending on the feature 5270. In some embodiments, one or more of the sole plates 5273 is formed of a plastic material. In other embodiments, sole plates 5273 are formed of other materials, such as composite, carbon fiber, metal, or a combination of the above described materials.

Figure 130:
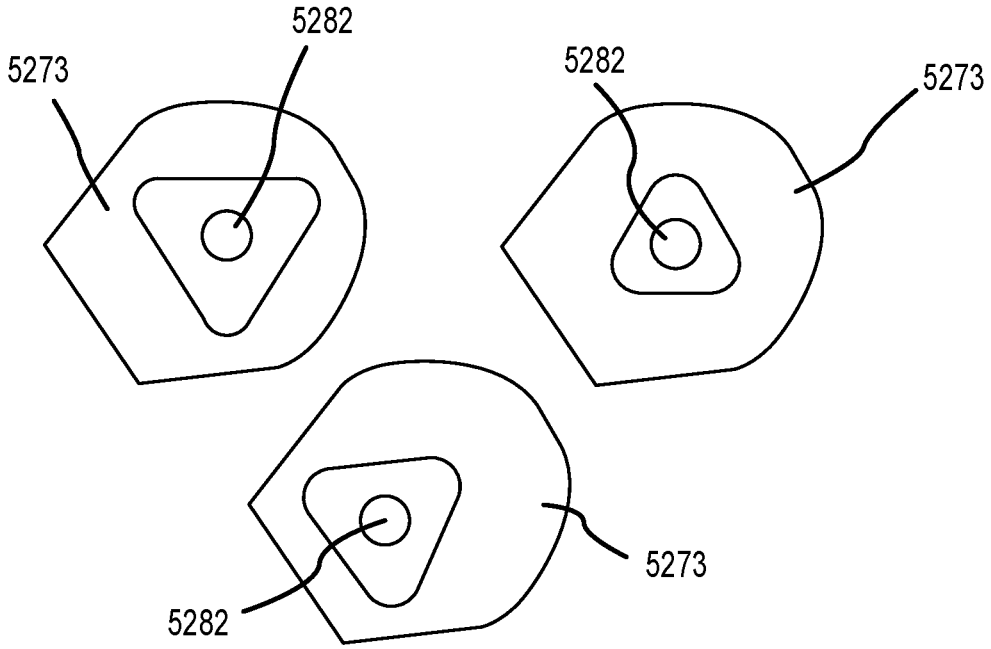
Figure 131:
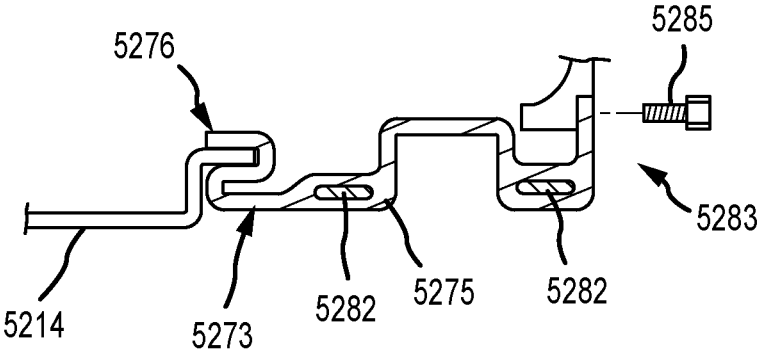
Figure 132:
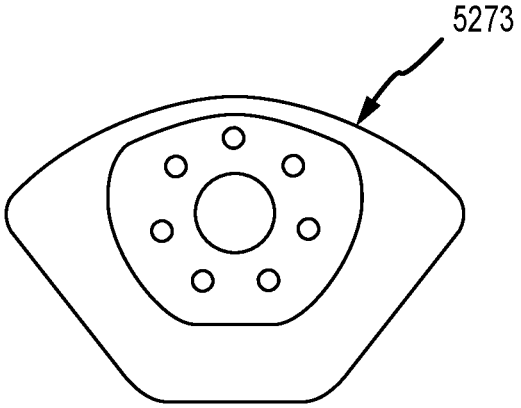

In the illustrated embodiment, each of the sole plates 5273 comprises a recessed region 5274, and a recess 5275 (FIG. 131) configured to receive one of the weights 5282 (e.g., swing weights). The weight 5282 is disposed within, or form part of, the sole plates 5273. In some embodiments the embedded weights 5282 are integrally formed with the sole plates 5273 by co-molding or co-casting. In other embodiments, the embedded weights 5282 are integrally formed with the sole plates 5273 using any other suitable process. In other embodiments, the weights 5282 can be separately formed and coupled to the sole plates 5273 by way of a fastener, or an adhesive or any other attachment means. In the illustrated embodiments, the sole plates 5273 each comprise one weight 5282, while in other embodiments, the sole plates 5273 can comprise more than one weight 5282. For example, the sole plates 5273 can comprise one, two, three, four, five, six, seven, or eight weights 5282. As illustrated in FIGS. 129 and 130, the weights 5282 are positioned at different locations within each of the sole plates 5273, such that use of a first sole plate 5273A will position additional weight in one area of the sole 5230 of the club head body 5214, use of a second sole plate 5273B will position additional weight in a different area of the sole 5230 of the club head body 5214, and use of a third sole plate 5273C will position additional weight in a different area of the sole 5230 of the club head body 5214. (e.g., to adjust a club head center of gravity). In some embodiments the weights 5282 are of different size, shape, and/or material depending on the sole plate 5273 that is used. In some embodiments, one or more of the weights 5282 comprises steel or tungsten, although other embodiments include different materials.

As illustrated in FIG. 129, the adjustable weighting system comprises three sole plates 5273, a first sole plate 5273A: a second sole plate 5273B, and a third sole plate 5273C. Each of the sole plates 5273 comprise a different weight 5282 position on the sole plate 5273. The different positions for the weights 5282 effect the CG of the club head 5210, wherein a shift in CG by the different sole plates 5273 (having different positioned weights 5282) can help correct ball trajectory for players who ten to hook, or slice. The positioning of the weight 5282 can be near the toe end 5218, be more rearward, be more forward, be near the heel end 5222, or any combination thereof. The positioning of the weight 5282 near the toe end 5218 shifts the CG toward the toe end 5282 to correct players who slice. The positioning of the weight 5282 near the heel end 5222 shifts the CG toward the heel end 5222 to correct players who hook. The positioning of the weight 5282 more forward, or rearward can affect ball spin.

Figure 133:
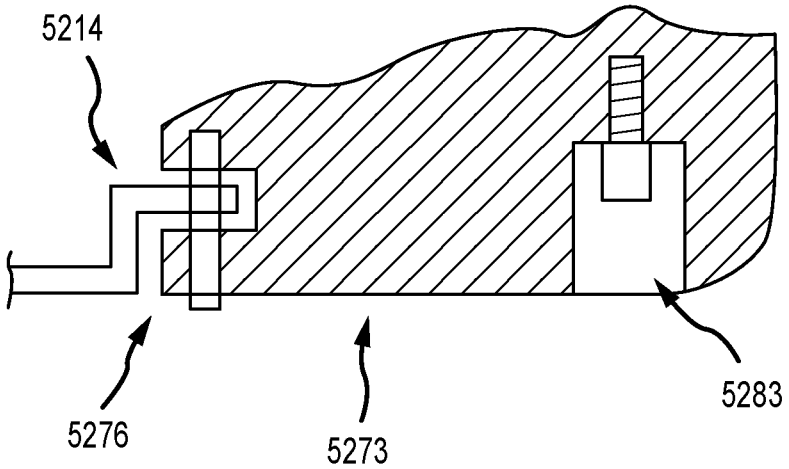
Figure 134:
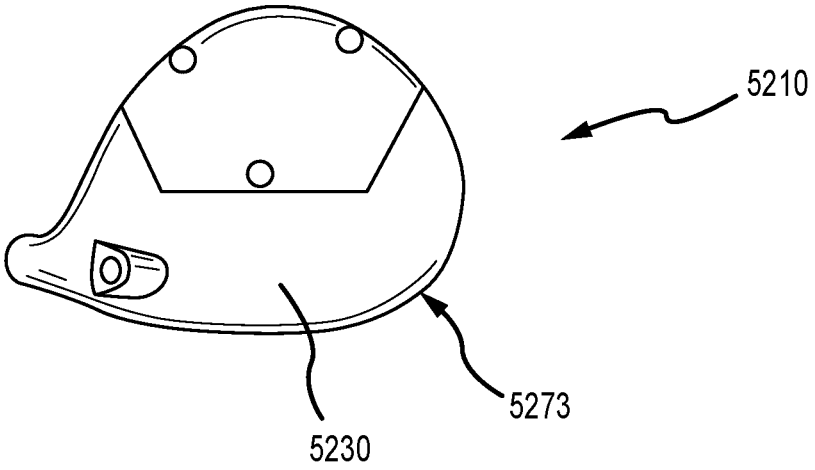

The sole plates 5273 may be coupled to the club head body 5214 in a variety of manners. For example, the sole plates 5273 may be coupled to the club head body 5214 via a frictional fit, lap joint, adhesive, fasteners, and/or snap-fit, or any other attachment means. As illustrated in FIGS. 131-134, in some embodiments the sole plate 5273 includes a snap-fit coupling region 5276, an embedded weight 5282, and/or a bolt/screw coupling arrangement including 5283 a bolt/screw 5285 to facilitate removable attachment of the sole plate 5273 to the club head body 5214. Illustrated in FIGS. 133 and 134 is a variation in geometry of the sole plate 5273 and orientation of the bolt/screw arrangement as opposed to the sole plate 5273 illustrated in FIGS. 132 and 133. The sole plates 5273 may be replaced so as to change the center of gravity of the club head 5210. In some embodiments, a tool is used to help remove and/or attach one or more of the sole plates 5273.

As illustrated in FIGS. 129 and 130, in some embodiments, the recessed region 5274 and the weight 5282 of the first sole plate 5273 are located centrally. As illustrated in FIGS. 129 and 130, the recessed region 5274 and the weight 5282 of the second sole plate 5273B are shifted toward the heel end 5220 of the club head 5210. As illustrated in FIGS. 129 and 130, the recessed region 5274 and the weight 5282 of the third sole plate 5273C are distal from the rear and near t toe end 5218 (relative to the second sole plate 5273). Accordingly, the first configuration of the club head 5210 having the first sole plate 5273A comprises a neutral head CG for players who typically hit straight. The second configuration of the club head 5210 having the second sole plate 5273B comprises a head CG shifted toward the heel end 5220 to help correct ball trajectory for players who tend to hook the ball. The third configuration of the club head 5210 having the third sole plate 5273C comprises a head CG shifted forward and toward the toe end 5218 relative to the second sole plate 5273 to help correct ball trajectory for players who tend to slice the ball.

Figure 135:
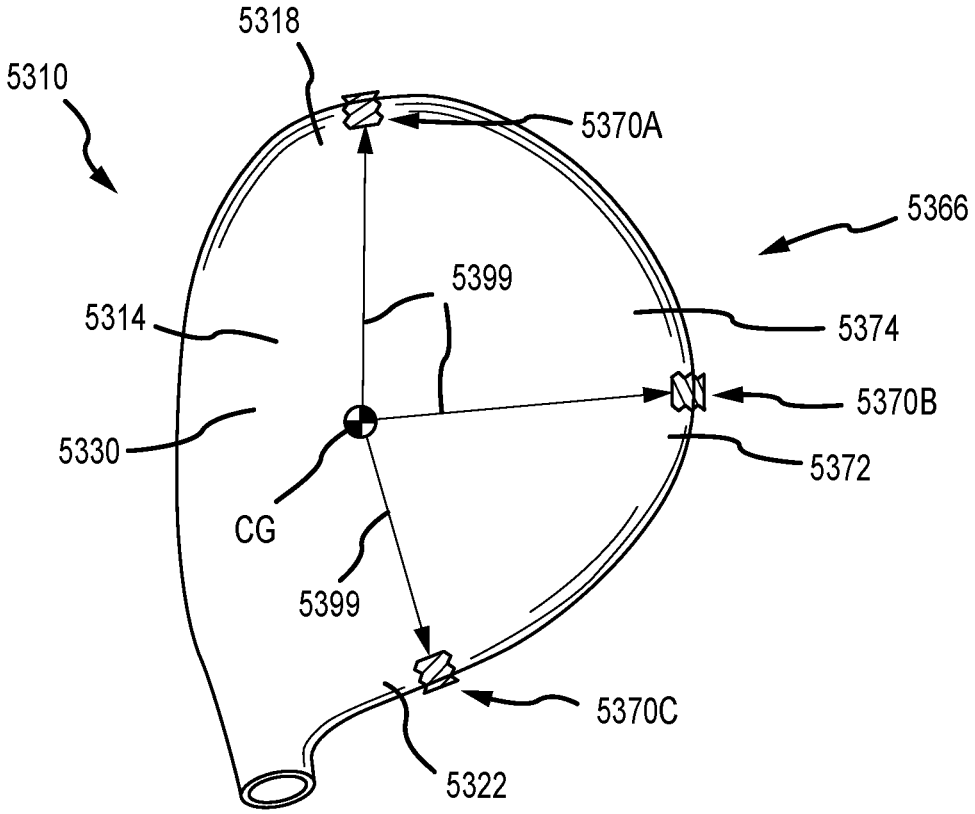
FIGS. 135 and 136 are perspective views of a golf club head according to another embodiment
Figure 136:
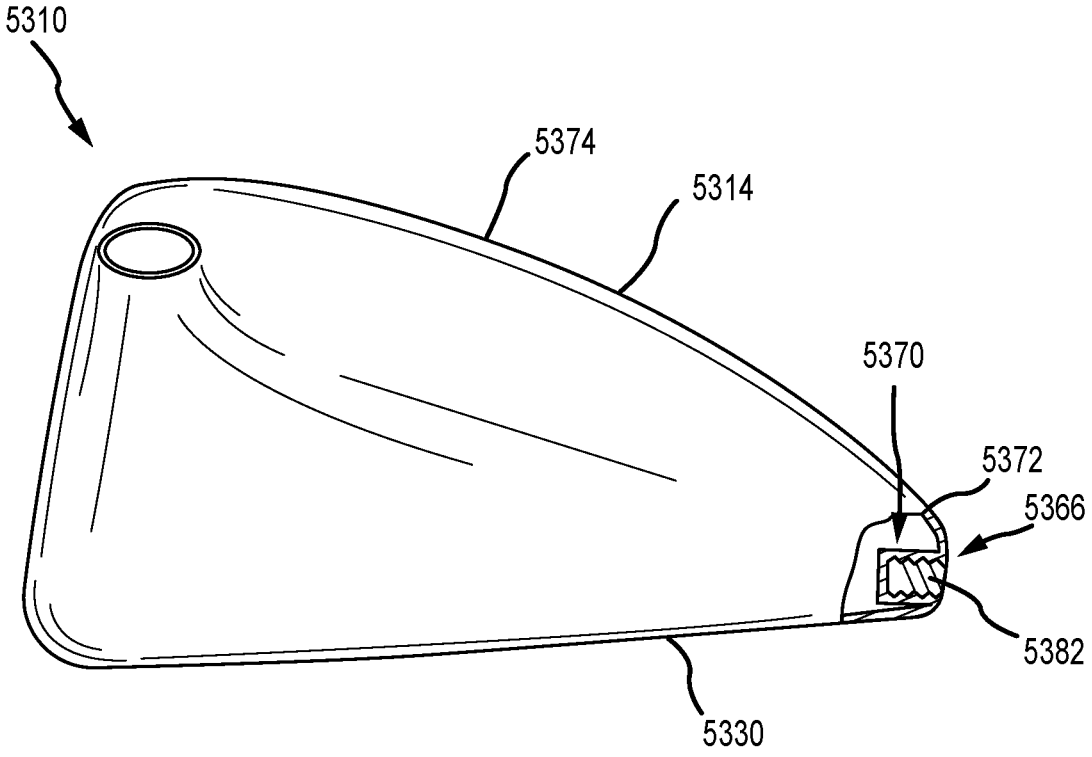

FIGS. 135 and 136 illustrate a club head 5310 having a club head body 5314. The club head 5310 includes an adjustable weighting system 5366 that is adjustable by an end user to modify the club head 5310 center of gravity and/or moment of inertia and/or heel/toe bias to achieve desired performance characteristics (e.g., forgiveness, spin, trajectory) under various circumstances. The adjustable weighting system 5366 is a low profile system and thereby does not significantly shift or change the club head 5310 MOI when compared to a club head not including the adjustable weighting system 5366. Further, the low profile adjustable weighting system 5366 ensures that shifts in the club head 5310 CG occur mainly in a heel end 5322 to toe end 5318 direction keeping the overall club head 5310 CG in a low and back location.

The adjustable weighting system 5366 includes a plurality of distinct attachment location. The plurality of discrete attachment locations can comprise various features 5370. In some embodiments, the features 5370 can be protruding bodies, apertures, recesses, ports capable of receiving a fastener, notches, tabs, cutout regions, ribs, grooves, pegs, hooks, magnets, programmable magnets, or any other suitable attachment means. The features 5370 define a discrete attachment location for securing the weight 5382 to the club head 5310. In contrast to other adjustable weighting systems wherein the weight can be coupled at any, or at an infinite, or at an unlimited number of locations across the recessed portion. In the illustrated embodiment, the features 5370 are shallow ports that have a threading. The features 5370 may be of any shape and any configuration such that one or more weights 5382 may be coupled to (to include being pressed against) the features 5370. The weights 5382 can be coupled, and decoupled to the feature 5370 by a tool.

In the illustrated embodiment, the features 5370 are positioned on a sole or bottom 5330 of the club head body 5314, adjacent a trailing edge 5372 that defines a perimeter of the club head 5310 extending between a crown and the sole 5330. As illustrated in FIG. 135, the club head 5310 comprises three features 5370, with a first feature 5370A near a toe end 5318, a second feature 5370C near the heel end 5322, and a third feature 5370B generally center at a rear 5323 between the first feature 5370A and the second feature 5370C. In other embodiments, the club head can comprise any number of features such as one feature 5370, two features 5370, three features 5370, four features 5370, five features 5370, six features 5370, seven features 5370, or eight features 5370. The features 5270 are configured to receive the weight 5382 (FIG. 136). The features 5370 can be positioned equidistant from one another. In other embodiments, the features 5370 can be spaced any distance away from one another. The different distinct locations of the low and shallow features 5370 allow for the weight 5382 to be affect the CG of the club head about an x-axis without sacrificing a relatively high MOI.

As illustrated in FIG. 136, the weight 5382 can be cylindrical in shape. In other embodiments, the weight 5382 can comprise any cross-sectional shape (e.g., square, triangular, rectangular, pentagonal, hexagonal, or any other polygonal shape). In many embodiments, the weight 5382 comprises a general shape that is complementary to the feature 5370, wherein surfaces of the weight 5382 abut surfaces of the feature 5370. In some embodiments, the weights 5382 are secured within the ports 5371 using one or more of a variety of mechanisms, such as, for example, threading, magnets, snap fit, etc. When the weight 5392 is received within the feature 5370, the weight 5382 are flush with an outer contour of the club head 5310. In other embodiments, when the weight 5392 is received within the feature 5370, the weight 5382 does not extend to the outer contour of the club head 5310. In some embodiments, the club head 5310 can comprise one weight 5382. In other embodiments, the club head 5310 can comprise any number of weights 5382, such as one weight 5382, two weights 5382, three weights 5382, four weights 5382, five weights 5382, six weights 5382, seven weights 5382, or eight weights 5382.

The weights 5382 comprises a material which comprise a mass. Further, in some embodiments, the weights 5382 can comprise materials such that they vary in mass. For example, one weight 5382 may be made of a high density material, such as tungsten, and the remaining weights 5382 may be made of a less dense material, such as polyurethane or another plastic. In other embodiments, the weights 5382 may have different sizes or volumes such that they vary in mass. For example, one weight 5382 may have a greater volume than the remaining weights 5382. In some embodiments, each of the weights 5382 may vary in volume from one another and thus vary in mass. In some embodiments, the weights 5382 may vary in both volume and material from one another. In some embodiments, one of the structures labeled as 5382 is not a weight, but rather a light-weight (e.g., light-weight plastic) cover that snap-fits or otherwise couples to one of the features 5370A, B, C. In some embodiments, the weights 5382 may vary between 0.1-50 g. For example, in embodiments having a plurality of weights 5382, one or more of the weights 82 may vary between 0-10 g, one or more of the weights 5382 may vary between 10-20 g, one or more of the weights 5382 may vary between 20-30, one or more of the weights 5382 may vary between 30-40 g, and one or more of the weights 5382 may vary between 40-50 g. In some embodiments, a first weight 5382 may vary between 0-10 g, a second weight 5382 may vary between 10-20 g, a third weight 5382 may vary between 20-30, a fourth weight 82 may vary between 30-40 g, and a fifth weight 5382 may vary between 40-50 g. In other embodiments, a first weight 5382 may vary between 10-20 g, 10-25 g, 15-20 g or 15-25 g, and a second and third weight 5382 may vary between 0.25-10 g. In other embodiments, a first and second weight 5382 may vary between 1-10 g, and a third and fourth weight 5382, may vary between 5-25 g. In some embodiments, a first weight 5382 has a mass of 8.5 grams, and a second and third weight 5382 each have a mass of 1.5 grams. In other embodiments, a first weight 5382 has a mass of 12 grams, and a second and third weight 5382 each have a mass of 1.5 grams. In other embodiments, a first weight 5382 has a mass of 8.5 grams, and a second and third weight 5382 each have a mass of 0.75 grams. In other embodiments, a first weight 5382 can have a mass of 10, 11, 12, 13, 14, 15, 16, 17, 18, 19, 20, 21, 22, 23, 24, 25, 26, 27, 28, 29 or 30 grams, and the second, third, and fourth weight 5382 can have a mass of 1, 2, 3, 4, 5, or 6 grams. In other embodiments, any number of weights 5382 may have the same mass or may have a varying mass between 0.1-50 g.

In one embodiment, a first weight 5382 is positioned in the first feature 5370A, a second weight 5382 is in positioned in the second feature 5370C, and a third weight 5382 is position in third feature 5370B. In other embodiments, any number of weights 5382 are positioned anywhere along the club head body 5314 (e.g., along the perimeter). For in other embodiments, a first weight 5382 can be positioned in a feature 5370 in between the toe end 5318 and a rear 5323 at the trailing edge 5372 and a second weight 5382 can be positioned in a feature 5370 in between the rear 5323 and the heel end 5322 at the trailing edge 5372.

In the illustrated embodiment, all of the weights 5382 are positioned at a minimum distance 5399 from a center of gravity (CG) of the club head body 5314. The minimum distance of the weights 5382 from the CG of the club head body 5314 can range from approximately 1.0 inches to 2.6 inches (e.g. approximately 1.0 inches, approximately 1.2 inches, approximately 1.4 inches, approximately 1.6 inches, approximately 1.8 inches, approximately 2.0 inches, approximately 2.2 inches, approximately 2.4 inches, or approximately 2.6 inches). Other embodiments include different values and ranges.

From a side view of the golf club head 5310, as illustrated in FIG. 136, the adjustable weights 5382 are positioned around the perimeter (a "skirt"), where the crown meets the sole or bottom 5330. More specifically, the adjustable weights 5382 are positioned within a maximum distance of approximately 0.450 inches to approximately 0.550 inches inward from the perimeter of the club head when viewed from a top or side view (e.g. the maximum distance from the perimeter can be approximately 0.450 inches, approximately 0.460 inches, approximately 0.470 inches approximately 0.480 inches approximately 0.490 inches approximately 0.500 inches approximately 0.510 inches approximately 0.520 inches approximately 0.530 inches approximately 0.540 inches, or approximately 0.550 inches). Further, the adjustable weights 5382 are positioned approximately perpendicular to a perimeter surface (e.g., recessed surface) to provide a uniform club head shape to maintain club head shape and aerodynamics. Other embodiments include different values and ranges, as well as different orientations of the weights 5382.

The adjustable weights 5382 allow for a player to manipulate the ball flight (e.g. back spin and side spin, correcting a slice or hook) by adjusting the positioning of the club head weights 5382. The positioning of the adjustable weights 5382 in the shallow feature 5370 positioned along the perimeter allows for the golf club head 5310 to maintain a high moment of inertia (MOI). The user is able to adjust ball flight while maintaining a high MOI. The high MOI will prevent rotation of the club head 5310 when swinging, resulting in a higher forgiveness and straighter hits. In one example, the weight 5382 can be repositioned from the first feature 5370A to the second feature 5370C, wherein the weight 5370 shifts the CG toward the heel end 5322 to correct ball trajectory for players who tend to hook the ball.

The adjustable weighting system 5366 of golf club head 5310 maintains or prevents a significant reduction in club head moment of inertia, and low and back club head center of gravity positioning, compared to a club head devoid of an adjustable weighting system. The adjustable weighting system 5366 of golf club head 5310 maintains a high club head moment of inertia and a low and back club head CG position due to the low profile of the weighting system and the perimeter positioning of the one or more weights. The club head 5310 having the adjustable weighting system 5366 can have similar or identical parameters and measurements as club head 100 described above.

Figure 137:
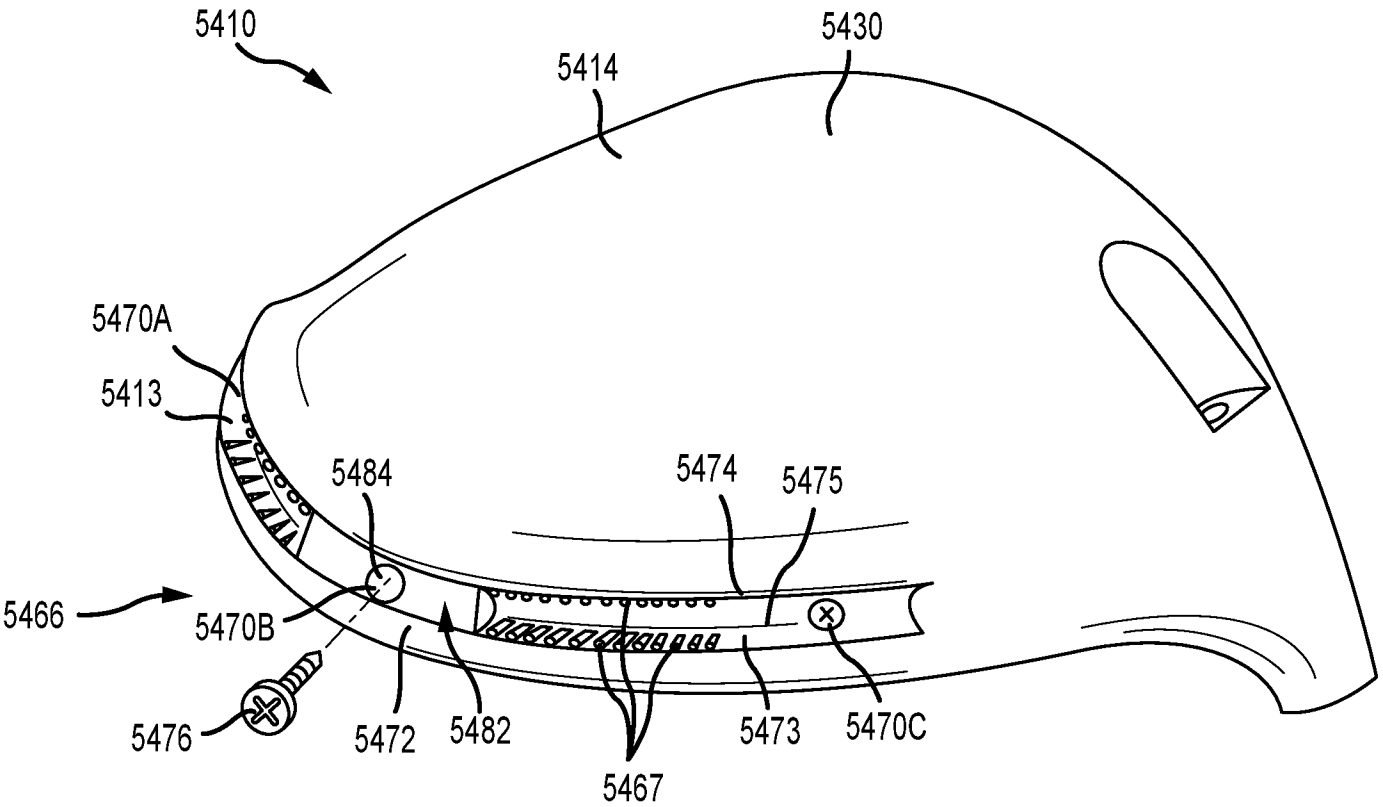
FIG. 137 is a perspective view of a golf club head according to another embodiment.

FIG. 137 illustrates a club head 5410 having a club head body 5414. The club head 5410 includes an adjustable weighting system 5466 that is adjustable by an end user to modify the club head 5410 center of gravity and/or moment of inertia and/or heel/toe bias to achieve desired performance characteristics (e.g., forgiveness, spin, trajectory) under various circumstances. The adjustable weighting system 5466 is a low profile system and thereby does not significantly shift or change the club head 5410 MOI when compared to a club head not including the adjustable weighting system 5466. Further, the low profile adjustable weighting system 5466 ensures that shifts in the club head 5410 CG occur mainly in a heel end 5422 to toe end 5418 direction keeping the overall club head 5410 CG in a low and back location As illustrated in FIG. 137, the adjustable weighting system 5466 further comprises a plurality of discrete attachment locations. The plurality of discrete attachment locations can comprise various features 5470. In some embodiments, the features 5470 can be protruding bodies, apertures, recesses, ports capable of receiving a fastener, notches, tabs, cutout regions, ribs, grooves, pegs, hooks, magnets, programmable magnets, or any other suitable attachment means. The features 5470 define a discrete attachment location for securing the weight 5482 to the club head 5410. In contrast to other adjustable weighting systems wherein the weight can be coupled at any, or at an infinite, or at an unlimited number of locations across the recessed portion. The adjustable weighting system 5466 can further comprise a shallow channel or shallow recessed portion 5413. The channel 5413 is defined by three surfaces 5473, 5474, 5475, each of which can be configured to comprise at least one feature 5470. Each feature 5470 defines a discrete attachment location for securing a weight 5482 to the club head 5410. In the illustrated embodiment, the adjustable weighting system 5466 includes a channel 5413 comprising a plurality of features 5470, wherein the features 5470 in the illustrated embodiment are apertures.

The channel 5413 extends from near the toe end 5418 in an arcuate manner to near the heel end 5422 following the contour of the trailing edge 5472 of the club head 5410. The channel 5413 is defined by a first surface 5473, a second surface 5474 disposed opposite the first surface 5473, and a third surface 5475 that extends between the first surface 5473 and the second surface 5474. In some embodiments, the first surface 5473 extends parallel to the second surface 5474, and perpendicular to the third surface 5475. The channel 5413 is further defined in part by additional end surfaces 5479 that directly intersect the first surface 5473, the second surface 5474, and the third surface 5475. The additional end surfaces 5479 may provide added support and/or provide an abutment region or edge against which the weights 5483 may rest. In some embodiments, the weights 5482 can be flush with an outer surface 5490 of the club head 5410. The flush orientation may improve air flow characteristics during a swing to improve the club head 5410 aerodynamics.

The channel 5413 includes a depth measured along a direction toward a center of the club head 5410, and/or along a direction that is normal to the third surface 5475. In some embodiments, the channel 5413 can comprise a constant depth from the toe end 5418 to the heel end 5422. In the some embodiment, the channel 5413 can have a varying depth such that it is deeper in some areas than in other areas (e.g., may have a continuously or intermittently changing depth). In other embodiments, the channel depth 5413 can have an increasing, decreasing and/or constant depth along its length from the toe end 5418 to the heel end 5422. Thus, when a weight 5482 is coupled to the club head 5410 in one region of the channel 5413, the weight 5482 may fit flush in the channel 5413 and/or be concealed by the first and/or second surfaces 5473, 5474. When the weight 5482 is coupled to the club head 5410 in a different region of the channel 5413, a portion of the weight 5482 may protrude beyond the first and/or second surfaces 5473, 5474. In some embodiments, the channel 5413 includes a region or regions at the rear or back end 5434 where a portion of the weight 5482 protrudes beyond the first surface 5473 and/or the second surface 5474 when coupled.

In many embodiments, the channel 5413 has a shallow depth ensuring the adjustable weight system 5466 remains low profile. For example, in some embodiments, the channel 5413 has a maximum depth of 0.25 inches. In other embodiments, the channel 5413 can have a maximum depth of 1.5, 1.25, 1.0, 0.9, 0.8, 0.7, 0.6, 0.5, 0.4, 0.3, 0.2, or 0.1 inches. In other embodiments, the depth of the channel 5413 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 5413 includes a width measured as the distance between the first surface 5473 and the second surface 5474. In the illustrated embodiments, the channel 5413 includes a constant width. In other embodiments, the channel 5413 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 153 the channel 5413 can include one or more features 5470 defining a discrete attachment location for securing a weight 5482 to the club head 5410. The features 5470 are apertures, wherein the apertures can comprise an inner threading to receive a threaded fastener 5476. The features 5470 is positioned on the third surface 5475 of the channel 5413. In other embodiments, the features 5470 can be positioned on the first, second and/or third surface 5473, 5474, 5475 of the channel 5413. In the illustrated embodiment, the adjustable weighting system 5466 comprises three features 5470: a first feature 5470A near the toe end 5418, a second feature 5470C near the heel end 5422, and a third feature 5470B in a general center between the first feature 5470A and the second feature 5470C. In other embodiments, the channel 5413 can comprise one, two, three, four, five, six, seven, eight, nine or ten features 5470. The features 5470 can be spaced evenly apart, or in other embodiments, the features 5470 can be spaced at any distance from one another.

The weights 5482 have a generally rectangular shape corresponding with the shape of the channel 5413. In other embodiments, the weights 5482 can have a circular, triangular, trapezoidal, polygonal or any other suitable shape configured to fit within the channel 5413. In the illustrated embodiment, the adjustable weighting system 5466 comprises one weight 5482. In other embodiments, the adjustable weighting system 5466 can comprise more or less weights 5482 than the number of features 5470A, B, C. For example, the adjustable weighting system 5466 can comprise one, two, three, four, five, six, seven, eight, nine to ten weights 5482. In the illustrated embodiment, the weights 5482 comprise apertures extending entirely through the weight 5482 sized and configured to receive the threaded fastener 5476. The threaded fastener 5476 can be threaded through the weight 5482 into the corresponding feature 5470, thus securing the weight 5482 to the channel 5413. In some embodiments, the weight 5482 can comprise a filet for receiving the top portion of the screw and therefore the screw can sit flush with the outer portion of the weight 5482. In other embodiments, the weight 5482 can comprise a blind aperture not extending entirely through the weight 5482. In other embodiments, the weight 5482 can be devoid of an aperture. In other embodiments, the weights 5482 can further be secured the features 5470 through a friction fit, a snap-fit mechanism, with a set-screw, or with any other suitable structure.

In the illustrated embodiment each of the features 5470A, B, C can receives the threaded fastener 5476 extended through the weight 5482. In other embodiments, one or more of the features 5470A, B, C receives a weight 5482, while the remaining features 5470A, B, C are bare and uncovered, or are covered with another material or structure. In some embodiments, one or more of the features 5470A, B, C receives more than one weight 5482.

In the illustrated embodiment, each of the weights 5482 is illustrated having the same shape and size. In other embodiments, the weights 5482 can vary in shape and size, resulting in different weights 5482 having varying masses. Further, in some embodiments, the weights 5482 are made of different materials such that they vary in mass. For example, one weight 5482 may be made of a high density material, such as tungsten, and the remaining weights 5482 may be made of a less dense material, such as polyurethane or another plastic. In other embodiments, the weights 5482 may have different sizes or volumes such that they vary in mass. For example, one weight 5482 may have a greater volume than the remaining weights 5482. In some embodiments, each of the weights 5482 may vary in volume from one another and thus vary in mass. In some embodiments, the weights 5482 may vary in both volume and material from one another. In some embodiments, one of the structures labeled as 5482 is not a weight, but rather a light-weight (e.g., light-weight plastic) cover that snap-fits or otherwise couples to one of the features 5470A, B, C. In some embodiments, the weights 5482 may vary between 0.1-50 g. For example, in embodiments having a plurality of weights 5482, one or more of the weights 5482 may vary between 0-10 g, one or more of the weights 5482 may vary between 10-20 g, one or more of the weights 5482 may vary between 20-30, one or more of the weights 5482 may vary between 30-40 g, and one or more of the weights 5482 may vary between 40-50 g. In some embodiments, a first weight 5482 may vary between 0-10 g, a second weight 5482 may vary between 10-20 g, a third weight 5482 may vary between 20-30, a fourth weight 82 may vary between 30-40 g, and a fifth weight 5482 may vary between 40-50 g. In other embodiments, a first weight 5482 may vary between 1-5 g, and a second and third weight 5482 may vary between 5-30 g. In other embodiments, a first and second weight 5482 may vary between 1-10 g, and a third and fourth weight 5482, may vary between 5-25 g. In some embodiments, a first weight 5482 has a mass of 8.5 grams, and a second and third weight 5482 each have a mass of 1.5 grams. In other embodiments, a first weight 5482 has a mass of 12 grams, and a second and third weight 5482 each have a mass of 1.5 grams. In other embodiments, a first weight 5482 has a mass of 8.5 grams, and a second and third weight 5482 each have a mass of 0.75 grams. In other embodiments, a first weight 5482 can have a mass of 1, 2, 3, 4, 5, or 6 grams, and the second, third, and fourth weight 5482 can have a mass of 10, 11, 12, 13, 14, 15, 16, 17, 18, 19, 20, 21, 22, 23, 24, 25, 26, 27, 28, 29 or 30 grams. In other embodiments, any number of weights 5482 may have the same mass or may have a varying mass between 0.1-50 g.

The weights 5482 may be strategically positioned on the features 5470A, B, C to achieve a desired club head 5410 center of gravity position and/or moment of inertia and/or heel/toe bias. For example, in some embodiments, a heavier weight 5482 is positioned on the feature 5470B, located between the toe or toe end 5418 and the heel or heel end 5422, while lighter weights are positioned on the features 5470A, C near the toe or toe end 5418 and the heel or heel end 5422. The aforementioned weight 5482 placement can result in the center of gravity remaining centered while being shifted towards the back end 5434 of the club head 5410. In some embodiments, a heavier weight 5482 is positioned on the features 5470C near the heel or heel end 5422, while lighter weights 5482 are positioned on the feature 5470A near the toe or toe end 5418 and on the feature 5470B that is located between the toe or toe end 5418 and the heel or heel end 5422. The aforementioned weight 5482 placement can result in the center of gravity being shifted towards the heel end 5422 of the club head 5410. In some embodiments, a heavier weight 5482 is positioned on the feature 5470A near the toe or toe end 5418, while lighter weights 5482 are positioned on the feature 5470C near the heel or heel end 5422 and on the feature 5470B that is located between the toe or toe end 5418 and the heel or heel end 5422. The aforementioned weight 5482 placement can result in the center of gravity being shifted towards the toe end 5418 of the club head 5410. In many embodiments, one or more of the features 5470A, B, C are of equal size and shape, such that one weight may be interchangeably used with each of the features 5470A, B, C. In some embodiments, one or more of the features 5470A, B, C can have a differing size and shape, such that each features 5470A, B, C has its own corresponding weight 5482 or set of weights 5482.

With continued reference to FIG. 137, the weighting system 5466 also includes ribs 5467 within the channel 5413 positioned on the first and second surface 5475 and 5474. The ribs 5467 facilitate positioning and/or retention of the weights 5482 within the channel 5413. For example, as illustrated in FIG. 137, in some embodiments the ribs 5467 are positioned between the distinct attachment locations of the features 5470 along the channel 5413 for the weights 5482. The channel 5413 is free of ribs 5467 in the distinct attachment locations of the features 5470. The ribs 5467 prevent or inhibit the weights 5482 from being inserted into the channel 5413 in any regions other than the distinct attachment locations of the features 5470. In some embodiments, one or more of the ribs 5467 helps to align the weight 5482 into the distinct attachment locations of the features 5470. For example, the ribs 5467 may act as guide members or rails that facilitate insertion and alignment of the weights 5482 into only the distinct attachment location of the features 5470, such that the ribs 5467 are positioned on either sides of the weight 5482. In the illustrated embodiment the ribs 5467 extend parallel to one another, and are disposed on opposite walls 5473, 5475 that define the channel 5413. In some embodiments, the ribs 5467 provide a tactile, or haptic feedback to the user, allowing the user to hear and/or feel the movement of the weight 5482 as the weight 5482 is slid for example within the channel 5413 over the ribs until the weight 5482 reaches one of the distinct attachment locations of the features 5470. Other embodiments include different numbers, sizes, orientations, and arrangements of ribs 5467 than that illustrated.

The adjustable weighting system 5466 of golf club head 5410 maintains or prevents a significant reduction in club head moment of inertia, and low and back club head center of gravity positioning, compared to a club head devoid of an adjustable weighting system. The adjustable weighting system 5466 of golf club head 5410 maintains a high club head moment of inertia and a low and back club head CG position due to the low profile of the weighting system and the perimeter positioning of the one or more weights. The club head 5410 having the adjustable weighting system 5466 can have similar or identical parameters and measurements as club head 100 described above.

Figure 138:
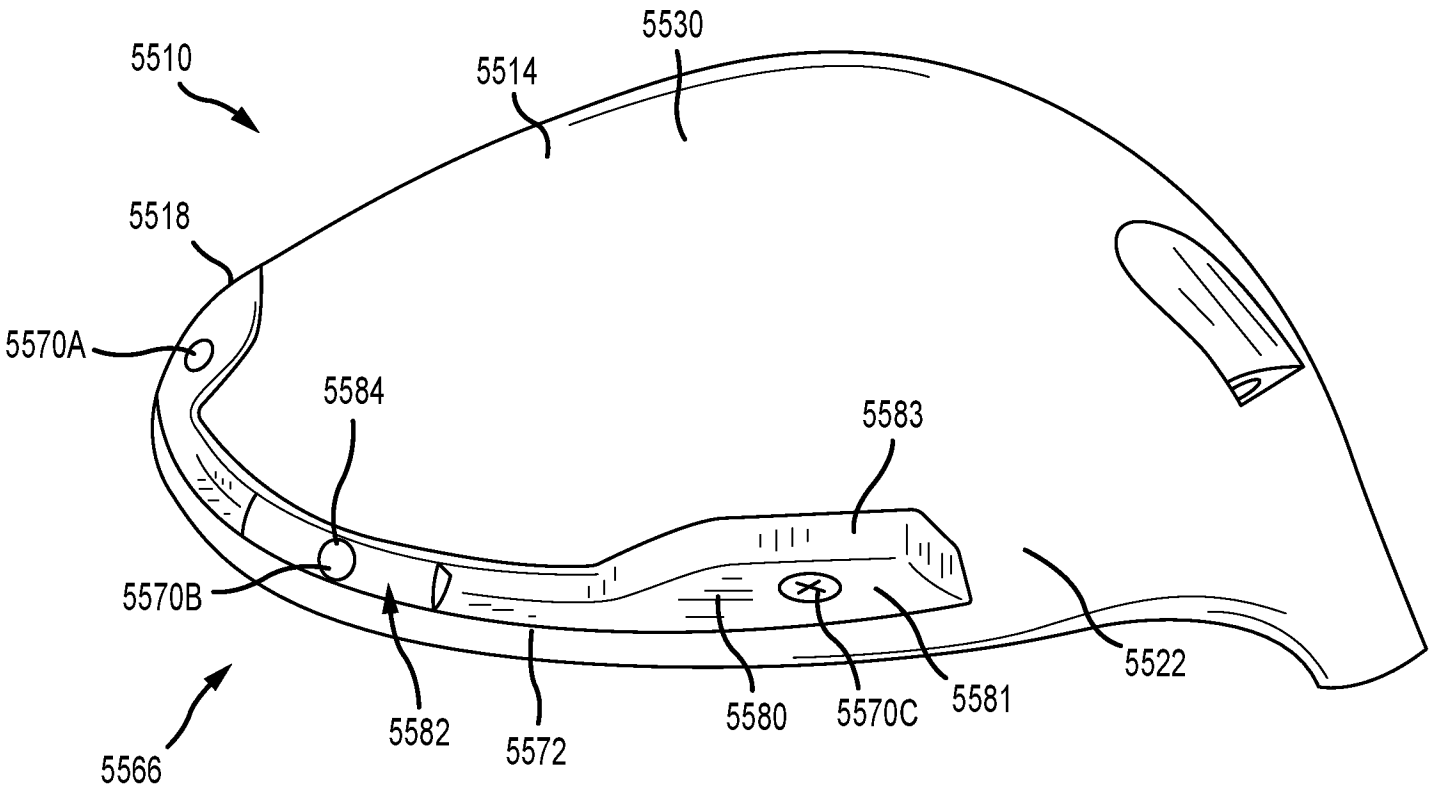
FIGS. 138-141 are perspective views of a golf club head according to another embodiment.
Figure 139:
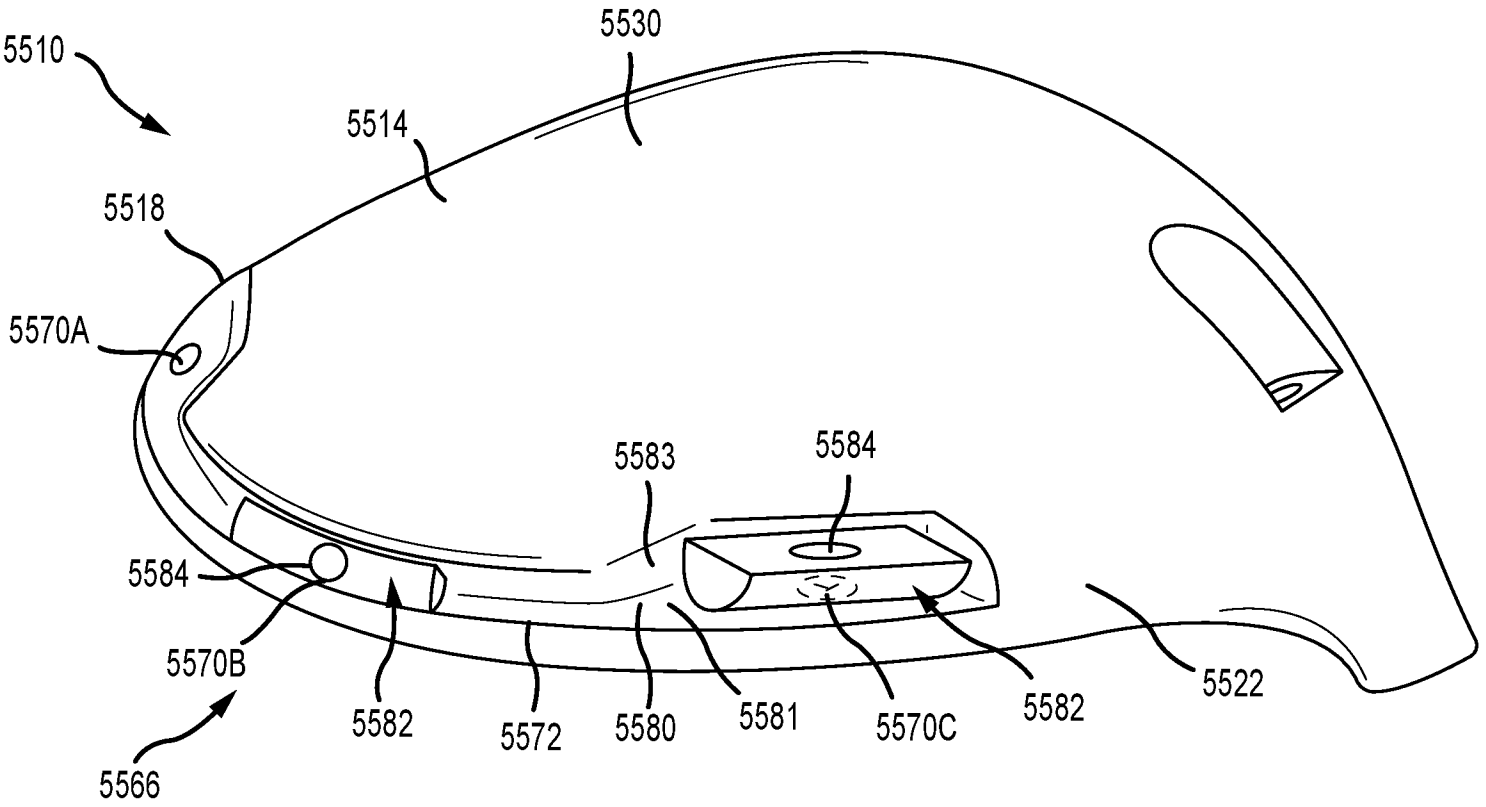
Figure 140:
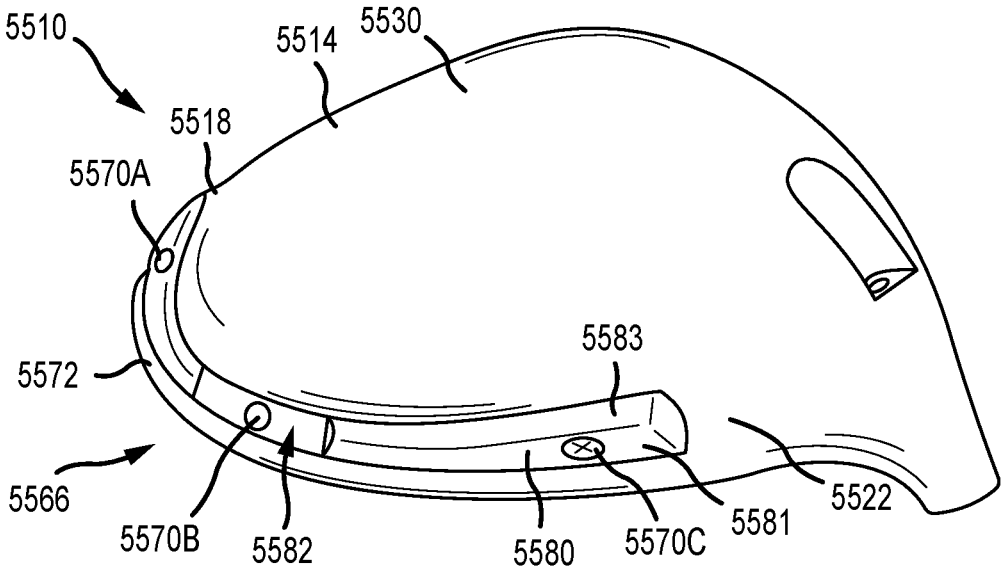
Figure 141:
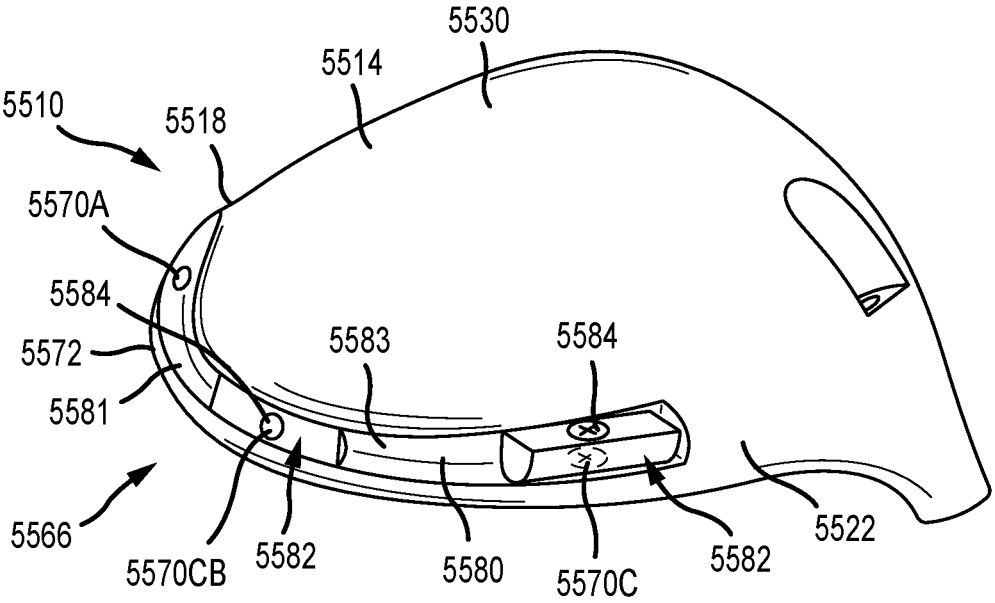

FIGS. 138-139 illustrates a club head 5510 having a club head body 5514. The club head 5510 includes an adjustable weighting system 5566 that is adjustable by an end user to modify the club head 5510 center of gravity and/or moment of inertia and/or heel/toe bias to achieve desired performance characteristics (e.g., forgiveness, spin, trajectory) under various circumstances. The adjustable weighting system 5566 is a low profile system and thereby does not significantly shift or change the club head 5510 MOI when compared to a club head not including the adjustable weighting system 5566. Further, the low profile adjustable weighting system 5566 ensures that shifts in the club head 5510 CG occur mainly in a heel end 5522 to toe end 5518 direction keeping the overall club head 5510 CG in a low and back location.

As illustrated in FIGS. 138-141, the adjustable weighting system 5566 further comprises a plurality of discrete attachment locations. The plurality of discrete attachment locations can comprise various features 5570. In some embodiments, the features 5570 can be protruding bodies, apertures, recesses, ports capable of receiving a fastener, notches, tabs, cutout regions, ribs, grooves, pegs, hooks, magnets, programmable magnets, or any other suitable attachment means. The features 5570 define a discrete attachment location for securing the weight 5582 to the club head 5510. In contrast to other adjustable weighting systems wherein the weight can be coupled at any, or at an infinite, or at an unlimited number of locations across the recessed portion. The adjustable weighting system 5566 can further comprise a shallow channel or shallow recessed portion 5513. The channel 5513 is defined by three surfaces 5573, 5574, 5575, each of which can be configured to comprise at least one feature 5570. Each feature 5570 defines a discrete attachment location for securing a weight 5582 to the club head 5510. In the illustrated embodiment, the adjustable weighting system 5566 includes a channel 5513 comprising a plurality of features 5570, wherein the features 5570 in the illustrated embodiment are apertures.

The channel 5513 extends from near the toe end 5518 in an arcuate manner to near the heel end 5522 following the contour of the trailing edge 5572 of the club head 5510. The channel 5513 is defined by a first surface 5573, a second surface 5574 disposed opposite the first surface 5573, and a third surface 5575 that extends between the first surface 5573 and the second surface 5574. In some embodiments, the first surface 5573 extends parallel to the second surface 5574, and perpendicular to the third surface 5575. In some embodiments, a portion of the channel 5513 is void of one of the surfaces. For example in the illustrated embodiment, the heel end 5522 portion and the toe end 5518 portion of the channel 5513 is void of the second surface 5574. The channel 5513 is further defined in part by additional end surfaces 5579 that directly intersect the first surface 5573, the second surface 5574, and the third surface 5575. The additional end surfaces 5579 may provide added support and/or provide an abutment region or edge against which the weights 5583 may rest. In some embodiments, the weights 5582 can be flush with an outer surface 5590 of the club head 5510. The flush orientation may improve air flow characteristics during a swing to improve the club head 5510 aerodynamics.

The channel 5513 includes a depth measured along a direction toward a center of the club head 5510, and/or along a direction that is normal to the third surface 5575. In the illustrated embodiment, the depth of the channel 5513 at the rear 5523 is more shallow than the depth of the channel 5513 at the heel end 5522 and the toe end 5518. In some embodiments, the channel 5513 can comprise a constant depth from the toe end 5518 to the heel end 5522. In the some embodiment, the channel 5513 can have a varying depth such that it is deeper in some areas than in other areas (e.g., may have a continuously or intermittently changing depth). In other embodiments, the channel depth 5513 can have an increasing, decreasing and/or constant depth along its length from the toe end 5518 to the heel end 5522. Thus, when a weight 5582 is coupled to the club head 5510 in one region of the channel 5513, the weight 5582 may fit flush in the channel 5513 and/or be concealed by the first and/or second surfaces 5573, 5574. When the weight 5582 is coupled to the club head 5510 in a different region of the channel 5513, a portion of the weight 5582 may protrude beyond the first and/or second surfaces 5573, 5574. In some embodiments, the channel 5513 includes a region or regions at the rear or back end 5534 where a portion of the weight 5582 protrudes beyond the first surface 5573 and/or the second surface 5574 when coupled.

In many embodiments, the channel 5513 has a shallow depth ensuring the adjustable weight system 5566 remains low profile. For example, in some embodiments, the channel 5513 has a maximum depth of 0.25 inches. In other embodiments, the channel 5513 can have a maximum depth of 1.5, 1.25, 1.0, 0.9, 0.8, 0.7, 0.6, 0.5, 0.4, 0.3, 0.2, or 0.1 inches. In other embodiments, the depth of the channel 5513 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 5513 includes a width measured as the distance between the first surface 5573 and the second surface 5574. In the illustrated embodiments, the channel 5513 includes a constant width. In other embodiments, the channel 5513 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 138-139, the channel 5513 can include one or more features 5570 defining a discrete attachment location for securing a weight 5582 to the club head 5510. The features 5570 are apertures, wherein the apertures can comprise an inner threading to receive a threaded fastener (not pictured). In the illustrated embodiment, the adjustable weighting system 5566 comprises three features 5570: a first feature 5570A near the toe end 5518, a second feature 5570C near the heel end 5522, and a third feature 5570B in a general center between the first feature 5570A and the second feature 5570C. In other embodiments, the channel 5513 can comprise one, two, three, four, five, six, seven, eight, nine or ten features 5570. In the illustrated embodiment, the first feature 5570A and second feature 5570C are positioned on the first surface 5573, and the third feature 5570B is positioned on the third surface 5575 of the channel 5513. In other embodiments, the features 5570 can be positioned on the first, second and/or third surface 5573, 5574, 5575 of the channel 5513. The features 5570 can be spaced evenly apart, or in other embodiments, the features 5570 can be spaced at any distance from one another.

The weights 5582 have a generally rectangular shape corresponding with the shape of the channel 5513. In other embodiments, the weights 5582 can have a circular, triangular, trapezoidal, polygonal or any other suitable shape configured to fit within the channel 5513. In the illustrated embodiment, the adjustable weighting system 5566 comprises one weight 5582. In other embodiments, the adjustable weighting system 5566 can comprise more or less weights 5582 than the number of features 5570A, B, C. For example, the adjustable weighting system 5566 can comprise one, two, three, four, five, six, seven, eight, nine to ten weights 5582. In the illustrated embodiment, the weights 5582 comprise apertures extending entirely through the weight 5582 sized and configured to receive the fastener. The fastener can be threaded through the weight 5582 into the corresponding feature 5570, thus securing the weight 5582 to the channel 5513. In some embodiments, the weight 5582 can comprise a filet for receiving the top portion of the screw and therefore the screw can sit flush with the outer portion of the weight 5582. In other embodiments, the weight 5582 can comprise a blind aperture not extending entirely through the weight 5582. In other embodiments, the weight 5582 can be devoid of an aperture. In other embodiments, the weights 5582 can further be secured the features 5570 through a friction fit, a snap-fit mechanism, with a set-screw, or with any other suitable structure.

In the illustrated embodiment each of the features 5570A, B, C can receives the fastener extended through the weight 5582. In other embodiments, one or more of the features 5570A, B, C receives a weight 5582, while the remaining features 5570A, B, C are bare and uncovered, or are covered with another material or structure. In some embodiments, one or more of the features 5570A, B, C receives more than one weight 5582.

In the illustrated embodiment, each of the weights 5582 is illustrated having the same shape and size. In other embodiments, the weights 5582 can vary in shape and size, resulting in different weights 5582 having varying masses. Further, in some embodiments, the weights 5582 are made of different materials such that they vary in mass. For example, one weight 5582 may be made of a high density material, such as tungsten, and the remaining weights 5582 may be made of a less dense material, such as polyurethane or another plastic. In other embodiments, the weights 5582 may have different sizes or volumes such that they vary in mass. For example, one weight 5582 may have a greater volume than the remaining weights 5582. In some embodiments, each of the weights 5582 may vary in volume from one another and thus vary in mass. In some embodiments, the weights 5582 may vary in both volume and material from one another. In some embodiments, one of the structures labeled as 5582 is not a weight, but rather a light-weight (e.g., light-weight plastic) cover that snap-fits or otherwise couples to one of the features 5570A, B, C. In some embodiments, the weights 5582 may vary between 0.1-50 g. For example, in embodiments having a plurality of weights 5582, one or more of the weights 5582 may vary between 0-10 g, one or more of the weights 5582 may vary between 10-20 g, one or more of the weights 5582 may vary between 20-30, one or more of the weights 5582 may vary between 30-40 g, and one or more of the weights 5582 may vary between 40-50 g. In some embodiments, a first weight 5582 may vary between 0-10 g, a second weight 5582 may vary between 10-20 g, a third weight 5582 may vary between 20-30, a fourth weight 82 may vary between 30-40 g, and a fifth weight 5582 may vary between 40-50 g. In other embodiments, a first weight 5582 may vary between 1-5 g, and a second and third weight 5582 may vary between 5-30 g. In other embodiments, a first and second weight 5582 may vary between 1-10 g, and a third and fourth weight 5582, may vary between 5-25 g. In some embodiments, a first weight 5582 has a mass of 8.5 grams, and a second and third weight 5582 each have a mass of 1.5 grams. In other embodiments, a first weight 5582 has a mass of 12 grams, and a second and third weight 5582 each have a mass of 1.5 grams. In other embodiments, a first weight 5582 has a mass of 8.5 grams, and a second and third weight 5582 each have a mass of 0.75 grams. In other embodiments, a first weight 5582 can have a mass of 10, 11, 12, 13, 14, 15, 16, 17, 18, 19, 20, 21, 22, 23, 24, 25, 26, 27, 28, 29 or 30 grams, and the second, third, and fourth weight 5582 can have a mass of 1, 2, 3, 4, 5, or 6 grams. In other embodiments, any number of weights 5582 may have the same mass or may have a varying mass between 0.1-50 g.

The weights 5582 may be strategically positioned on the features 5570A, B, C to achieve a desired club head 5510 center of gravity position and/or moment of inertia and/or heel/toe bias. For example, in some embodiments, a heavier weight 5582 is positioned on the feature 5570B, located between the toe or toe end 5518 and the heel or heel end 5522, while lighter weights are positioned on the features 5570A, C near the toe or toe end 5518 and the heel or heel end 5522. The aforementioned weight 5582 placement can result in the center of gravity remaining centered while being shifted towards the back end 5534 of the club head 5510. In some embodiments, a heavier weight 5582 is positioned on the features 5570C near the heel or heel end 5522, while lighter weights 5582 are positioned on the feature 5570A near the toe or toe end 5518 and on the feature 5570B that is located between the toe or toe end 5518 and the heel or heel end 5522. The aforementioned weight 5582 placement can result in the center of gravity being shifted towards the heel end 5522 of the club head 5510. In some embodiments, a heavier weight 5582 is positioned on the feature 5570A near the toe or toe end 5518, while lighter weights 5582 are positioned on the feature 5570C near the heel or heel end 5522 and on the feature 5570B that is located between the toe or toe end 5518 and the heel or heel end 5522. The aforementioned weight 5582 placement can result in the center of gravity being shifted towards the toe end 5518 of the club head 5510. In many embodiments, one or more of the features 5570A, B, C are of equal size and shape, such that one weight may be interchangeably used with each of the features 5570A, B, C. In some embodiments, one or more of the features 5570A, B, C can have a differing size and shape, such that each features 5570A, B, C has its own corresponding weight 5582 or set of weights 5582.

The adjustable weighting system 5566 of golf club head 5510 maintains or prevents a significant reduction in club head moment of inertia, and low and back club head center of gravity positioning, compared to a club head devoid of an adjustable weighting system. The adjustable weighting system 5566 of golf club head 5510 maintains a high club head moment of inertia and a low and back club head CG position due to the low profile of the weighting system and the perimeter positioning of the one or more weights. The club head 5510 having the adjustable weighting system 5566 can have similar or identical parameters and measurements as club head 100 described above.

Figure 142:
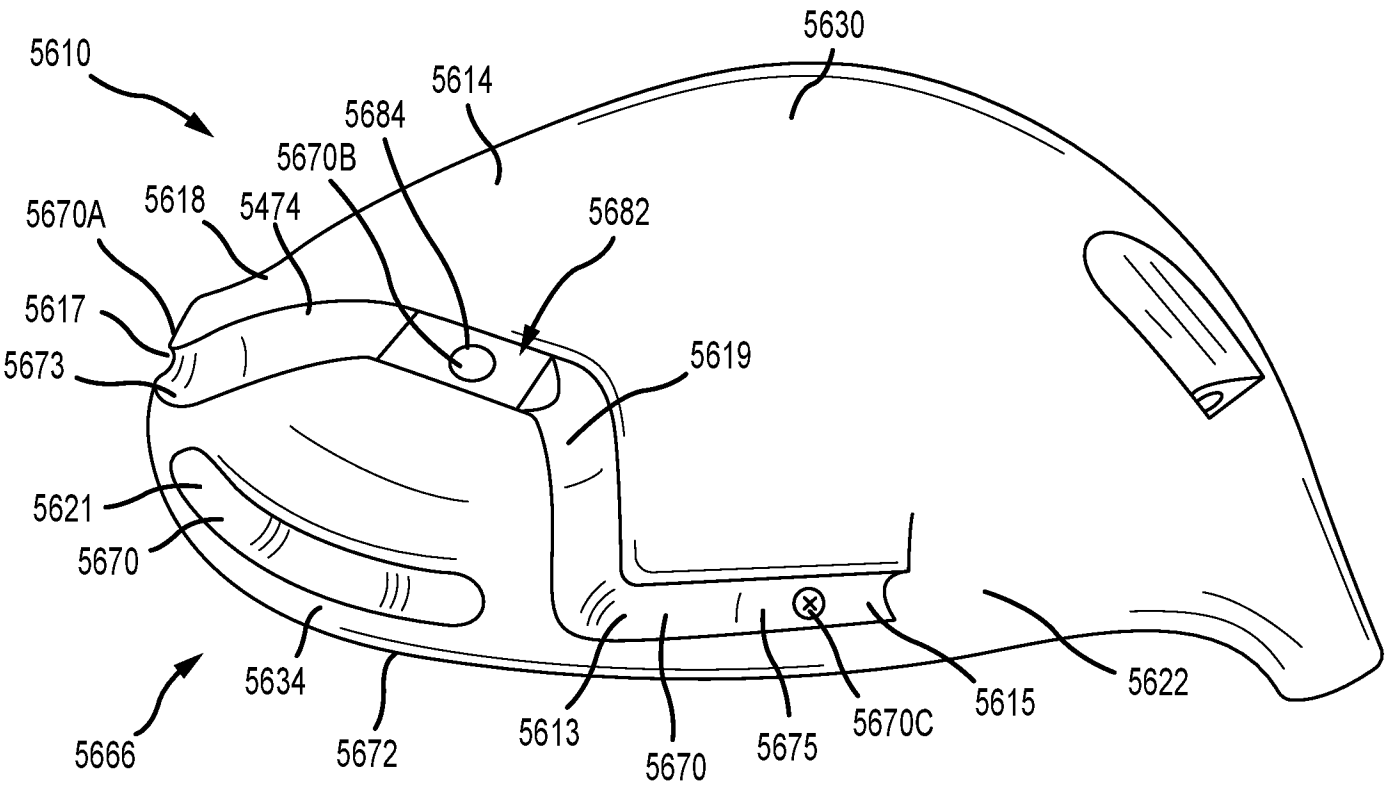
FIG. 142 is a perspective view of a golf club head according to another embodiment.

FIG. 142 illustrates a club head 5610 having a club head body 5614. The club head 5610 includes an adjustable weighting system 5666 that is adjustable by an end user to modify the club head 5610 center of gravity and/or moment of inertia and/or heel/toe bias to achieve desired performance characteristics (e.g., forgiveness, spin, trajectory) under various circumstances. The adjustable weighting system 5666 is a low profile system and thereby does not significantly shift or change the club head 5610 MOI when compared to a club head not including the adjustable weighting system 5666. Further, the low profile adjustable weighting system 5666 ensures that shifts in the club head 5610 CG occur mainly in a heel end 5622 to toe end 5618 direction keeping the overall club head 5610 CG in a low and back location.

As illustrated in FIG. 142, the adjustable weighting system 5666 further comprises a plurality of discrete attachment locations. The plurality of discrete attachment locations can comprise various features 5670. In some embodiments, the features 5670 can be protruding bodies, apertures, recesses, ports capable of receiving a fastener, notches, tabs, cutout regions, ribs, grooves, pegs, hooks, magnets, programmable magnets, or any other suitable attachment means. The features 5670 define a discrete attachment location for securing the weight 5682 to the club head 5610. In contrast to other adjustable weighting systems wherein the weight can be coupled at any, or at an infinite, or at an unlimited number of locations across the recessed portion. The adjustable weighting system 5666 can further comprise a shallow channel or shallow recessed portion 5613. The first channel 5613 is defined by three surfaces 5673, 5674, 5675, each of which can be configured to comprise at least one feature 5670. Each feature 5670 defines a discrete attachment location for securing a weight 5682 to the club head 5610. In the illustrated embodiment, the adjustable weighting system 5666 includes a first channel 5613 comprising a plurality of features 5670, wherein the features 5670 in the illustrated embodiment are apertures.

The first channel 5613 extends from near the toe end 5618 proximate a trailing edge 5672, then continues near a rear 5623, extending away from the trailing edge 5672, and continues near the heel end 5622 proximate the trailing edge 5672 of the club head 5610. In the illustrated embodiment, the first channel 5613 forms a slope-like shape at the rear 5623. In the exemplary embodiment, the club head 5610 can further comprise a second channel 5671. The second channel 5671 is positioned on the sole 5630, near the rear 5623 along the trialing edge. The first channel 5613 is defined by a first surface 5673, a second surface 5674 disposed opposite the first surface 5673, and a third surface 5675 that extends between the first surface 5673 and the second surface 5674. In some embodiments, the first surface 5673 extends parallel to the second surface 5674, and perpendicular to the third surface 5675. In some embodiments, a portion of the first channel 5613 is void of one of the surfaces. The first channel 5613 is further defined in part by additional end surfaces 5679 that directly intersect the first surface 5673, the second surface 5674, and the third surface 5675. The additional end surfaces 5679 may provide added support and/or provide an abutment region or edge against which the weights 5683 may rest. In some embodiments, the weights 5682 can be flush with an outer surface 5690 of the club head 5610. The flush orientation may improve air flow characteristics during a swing to improve the club head 5610 aerodynamics.

The first channel 5613 can further comprise a width. The width of the first channel 5613 is measured from perpendicular from the first surface 5673 to the second surface 5674. In the illustrated embodiment, the width of the first channel 5613 at the rear 5623 is less than the width of the first channel 5613 at the heel end 5622 and the toe end 5618. In some embodiments, the first channel 5613 can comprise a constant width from the toe end 5618 to the heel end 5622. In the some embodiment, the first channel 5613 can have a varying width such that it is wider in some areas than in other areas (e.g., may have a continuously or intermittently changing width). In other embodiments, the channel depth 5613 can have an increasing, decreasing and/or constant width along its length from the toe end 5618 to the heel end 5622. In other embodiments, the first channel 5613 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

The first channel 5613 includes a depth measured along a direction toward a center of the club head 5610, and/or along a direction that is normal to the third surface 5675. In the illustrated embodiment, the depth of the first channel 5613 at the rear 5623 is more shallow than the depth of the first channel 5613 at the heel end 5622 and the toe end 5618. In some embodiments, the first channel 5613 can comprise a constant depth from the toe end 5618 to the heel end 5622. In the some embodiment, the first channel 5613 can have a varying depth such that it is deeper in some areas than in other areas (e.g., may have a continuously or intermittently changing depth). In other embodiments, the channel depth 5613 can have an increasing, decreasing and/or constant depth along its length from the toe end 5618 to the heel end 5622. Thus, when a weight 5682 is coupled to the club head 5610 in one region of the first channel 5613, the weight 5682 may fit flush in the first channel 5613 and/or be concealed by the first and/or second surfaces 5673, 5674. When the weight 5682 is coupled to the club head 5610 in a different region of the first channel 5613, a portion of the weight 5682 may protrude beyond the first and/or second surfaces 5673, 5674. In some embodiments, the first channel 5613 includes a region or regions at the rear or back end 5634 where a portion of the weight 5682 protrudes beyond the first surface 5673 and/or the second surface 5674 when coupled.

In many embodiments, the first channel 5613 has a shallow depth ensuring the adjustable weight system 5666 remains low profile. For example, in some embodiments, the first channel 5613 has a maximum depth of 0.25 inches. In other embodiments, the first channel 5613 can have a maximum depth of 1.5, 1.25, 1.0, 0.9, 0.8, 0.7, 0.6, 0.5, 0.4, 0.3, 0.2, or 0.1 inches. In other embodiments, the depth of the first channel 5613 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches.

Referring again to FIGS. 140-141, the first channel 5613 can include one or more features 5670 defining a discrete attachment location for securing a weight 5682 to the club head 5610. The features 5670 are apertures, wherein the apertures can comprise an inner threading to receive a fastener (not pictured). In the illustrated embodiment, the adjustable weighting system 5666 comprises three features 5670: a first feature 5670A near the toe end 5618, a second feature 5670C near the heel end 5622, and a third feature 5670B in a general center between the first feature 5670A and the second feature 5670C. In other embodiments, the first channel 5613 can comprise one, two, three, four, five, six, seven, eight, nine or ten features 5670. In the illustrated embodiment, the first feature 5670A and second feature 5670C are positioned on the first surface 5673, and the third feature 5670B is positioned on the third surface 5675 of the first channel 5613. In other embodiments, the features 5670 can be positioned on the first, second and/or third surface 5673, 5674, 5675 of the first channel 5613. The features 5670 can be spaced evenly apart, or in other embodiments, the features 5670 can be spaced at any distance from one another.

The weights 5682 have a generally rectangular shape corresponding with the shape of the first channel 5613. In other embodiments, the weights 5682 can have a circular, triangular, trapezoidal, polygonal or any other suitable shape configured to fit within the first channel 5613. In the illustrated embodiment, the adjustable weighting system 5666 comprises one weight 5682. In other embodiments, the adjustable weighting system 5666 can comprise more or less weights 5682 than the number of features 5670A, B, C. For example, the adjustable weighting system 5666 can comprise one, two, three, four, five, six, seven, eight, nine to ten weights 5682. In the illustrated embodiment, the weights 5682 comprise apertures extending entirely through the weight 5682 sized and configured to receive the fastener. The threaded fastener can be threaded through the weight 5682 into the corresponding feature 5670, thus securing the weight 5682 to the first channel 5613. In some embodiments, the weight 5682 can comprise a filet for receiving the top portion of the screw and therefore the screw can sit flush with the outer portion of the weight 5682. In other embodiments, the weight 5682 can comprise a blind aperture not extending entirely through the weight 5682. In other embodiments, the weight 5682 can be devoid of an aperture. In other embodiments, the weights 5682 can further be secured the features 5670 through a friction fit, a snap-fit mechanism, with a set-screw, or with any other suitable structure.

In the illustrated embodiment each of the features 5670A, B, C can receives the fastener extended through the weight 5682. In other embodiments, one or more of the features 5670A, B, C receives a weight 5682, while the remaining features 5670A, B, C are bare and uncovered, or are covered with another material or structure. In some embodiments, one or more of the features 5670A, B, C receives more than one weight 5682.

In the illustrated embodiment, each of the weights 5682 is illustrated having the same shape and size. In other embodiments, the weights 5682 can vary in shape and size, resulting in different weights 5682 having varying masses. Further, in some embodiments, the weights 5682 are made of different materials such that they vary in mass. For example, one weight 5682 may be made of a high density material, such as tungsten, and the remaining weights 5682 may be made of a less dense material, such as polyurethane or another plastic. In other embodiments, the weights 5682 may have different sizes or volumes such that they vary in mass. For example, one weight 5682 may have a greater volume than the remaining weights 5682. In some embodiments, each of the weights 5682 may vary in volume from one another and thus vary in mass. In some embodiments, the weights 5682 may vary in both volume and material from one another. In some embodiments, one of the structures labeled as 5682 is not a weight, but rather a light-weight (e.g., light-weight plastic) cover that snap-fits or otherwise couples to one of the features 5670A, B, C. In some embodiments, the weights 5682 may vary between 0.1-50 g. For example, in embodiments having a plurality of weights 5682, one or more of the weights 5682 may vary between 0-10 g, one or more of the weights 5682 may vary between 10-20 g, one or more of the weights 5682 may vary between 20-30, one or more of the weights 5682 may vary between 30-40 g, and one or more of the weights 5682 may vary between 40-50 g. In some embodiments, a first weight 5682 may vary between 0-10 g, a second weight 5682 may vary between 10-20 g, a third weight 5682 may vary between 20-30, a fourth weight 82 may vary between 30-40 g, and a fifth weight 5682 may vary between 40-50 g. In other embodiments, a first weight 5682 may vary between 1-5 g, and a second and third weight 5682 may vary between 5-30 g. In other embodiments, a first and second weight 5682 may vary between 1-10 g, and a third and fourth weight 5682, may vary between 5-25 g. In some embodiments, a first weight 5682 has a mass of 8.5 grams, and a second and third weight 5682 each have a mass of 1.5 grams. In other embodiments, a first weight 5682 has a mass of 12 grams, and a second and third weight 5682 each have a mass of 1.5 grams. In other embodiments, a first weight 5682 has a mass of 8.5 grams, and a second and third weight 5682 each have a mass of 0.75 grams. In other embodiments, a first weight 5682 can have a mass of 10, 11, 12, 13, 14, 15, 16, 17, 18, 19, 20, 21, 22, 23, 24, 25, 26, 27, 28, 29 or 30 grams, and the second, third and fourth weight 5682 can have a mass of 1, 2, 3, 4, 5, or 6 grams. In other embodiments, any number of weights 5682 may have the same mass or may have a varying mass between 0.1-50 g.

The weights 5682 may be strategically positioned on the features 5670A, B, C to achieve a desired club head 5610 center of gravity position and/or moment of inertia and/or heel/toe bias. For example, in some embodiments, a heavier weight 5682 is positioned on the feature 5670B, located between the toe or toe end 5618 and the heel or heel end 5622, while lighter weights are positioned on the features 5670A, C near the toe or toe end 5618 and the heel or heel end 5622. The aforementioned weight 5682 placement can result in the center of gravity remaining centered while being shifted towards the back end 5634 of the club head 5610. In some embodiments, a heavier weight 5682 is positioned on the features 5670C near the heel or heel end 5622, while lighter weights 5682 are positioned on the feature 5670A near the toe or toe end 5618 and on the feature 5670B that is located between the toe or toe end 5618 and the heel or heel end 5622. The aforementioned weight 5682 placement can result in the center of gravity being shifted towards the heel end 5622 of the club head 5610. In some embodiments, a heavier weight 5682 is positioned on the feature 5670A near the toe or toe end 5618, while lighter weights 5682 are positioned on the feature 5670C near the heel or heel end 5622 and on the feature 5670B that is located between the toe or toe end 5618 and the heel or heel end 5622. The aforementioned weight 5682 placement can result in the center of gravity being shifted towards the toe end 5618 of the club head 5610. In many embodiments, one or more of the features 5670A, B, C are of equal size and shape, such that one weight may be interchangeably used with each of the features 5670A, B, C. In some embodiments, one or more of the features 5670A, B, C can have a differing size and shape, such that each features 5670A, B, C has its own corresponding weight 5682 or set of weights 5682.

The adjustable weighting system 5666 of golf club head 5610 maintains or prevents a significant reduction in club head moment of inertia, and low and back club head center of gravity positioning, compared to a club head devoid of an adjustable weighting system. The adjustable weighting system 5666 of golf club head 5610 maintains a high club head moment of inertia and a low and back club head CG position due to the low profile of the weighting system and the perimeter positioning of the one or more weights. The club head 5610 having the adjustable weighting system 5666 can have similar or identical parameters and measurements as club head 100 described above.

FIG. 137 illustrates a club head 5710 having a club head body 5714. The club head 5710 includes an adjustable weighting system 5766 that is adjustable by an end user to modify the club head 5710 center of gravity and/or moment of inertia and/or heel/toe bias to achieve desired performance characteristics (e.g., forgiveness, spin, trajectory) under various circumstances. The adjustable weighting system 5766 is a low profile system and thereby does not significantly shift or change the club head 5710 MOI when compared to a club head not including the adjustable weighting system 5766. Further, the low profile adjustable weighting system 5766 ensures that shifts in the club head 5710 CG occur mainly in a heel end 5722 to toe end 5718 direction keeping the overall club head 5710 CG in a low and back location.

Figure 143:
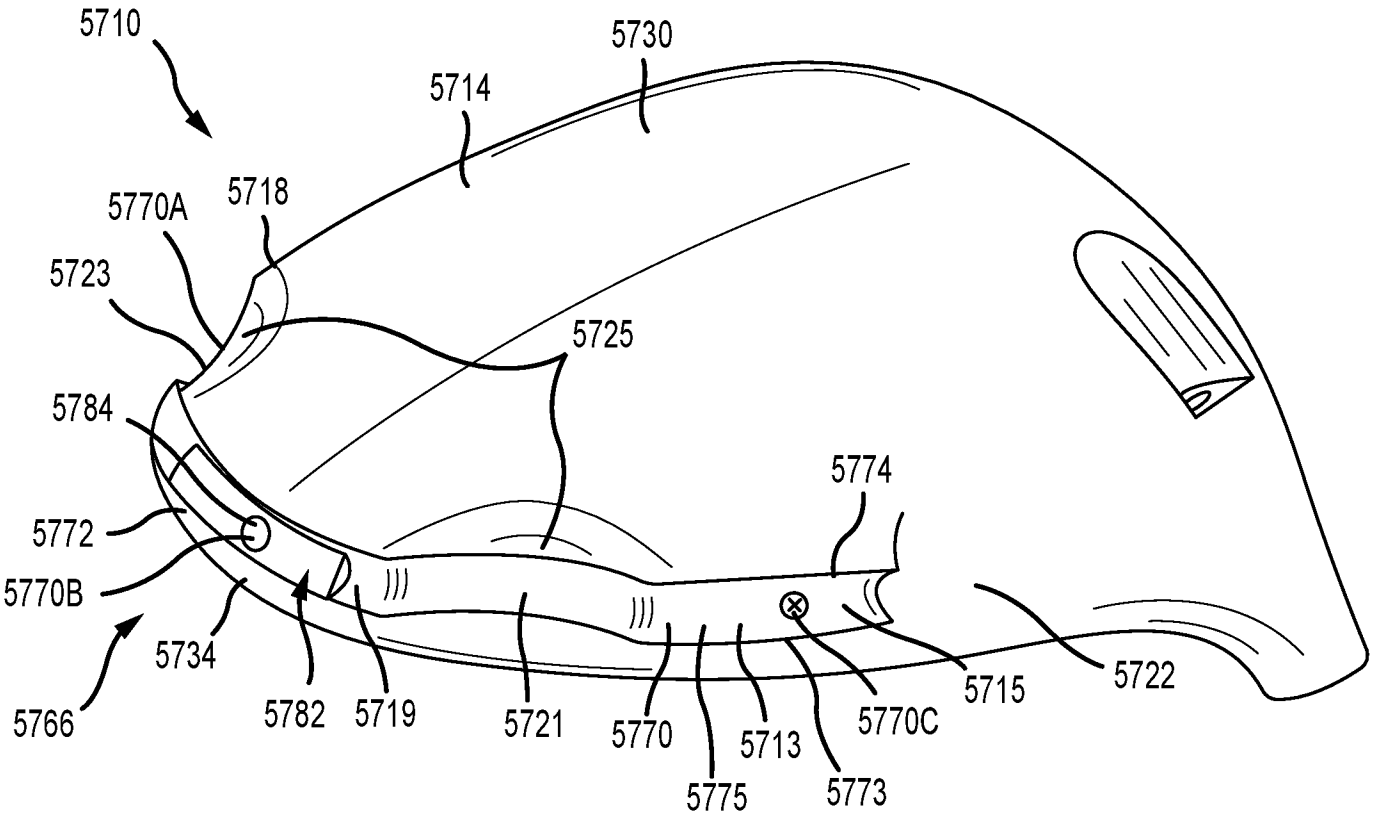
FIG. 143 is a perspective view of a golf club head according to another embodiment.

As illustrated in FIG. 143, the adjustable weighting system 5766 further comprises a plurality of discrete attachment locations. The plurality of discrete attachment locations can comprise various features 5770. In some embodiments, the features 5770 can be protruding bodies, apertures, recesses, ports capable of receiving a fastener, notches, tabs, cutout regions, ribs, grooves, pegs, hooks, magnets, programmable magnets, or any other suitable attachment means. The features 5770 define a discrete attachment location for securing the weight 5782 to the club head 5710. In contrast to other adjustable weighting systems wherein the weight can be coupled at any, or at an infinite, or at an unlimited number of locations across the recessed portion. The adjustable weighting system 5766 can further comprise a shallow channel or shallow recessed portion 5713. The channel 5713 is defined by three surfaces 5773, 5774, 5775, each of which can be configured to comprise at least one feature 5770. Each feature 5770 defines a discrete attachment location for securing a weight 5782 to the club head 5710. In the illustrated embodiment, the adjustable weighting system 5766 includes a channel 5713 comprising a plurality of features 5770, wherein the features 5770 in the illustrated embodiment are apertures.

The channel 5713 extends from near the toe end 5718 in an arcuate manner to near the heel end 5722 following the contour of the trailing edge 5772 of the club head 5710. The channel 5713 is defined by a first surface 5773, a second surface 5774 disposed opposite the first surface 5773, and a third surface 5775 that extends between the first surface 5773 and the second surface 5774. In some embodiments, the first surface 5773 extends parallel to the second surface 5774, and perpendicular to the third surface 5775. The channel 5713 is further defined in part by additional end surfaces 5779 that directly intersect the first surface 5773, the second surface 5774, and the third surface 5775. The additional end surfaces 5779 may provide added support and/or provide an abutment region or edge against which the weights 5783 may rest. In some embodiments, the weights 5782 can be flush with an outer surface 5790 of the club head 5710. The flush orientation may improve air flow characteristics during a swing to improve the club head 5710 aerodynamics.

The channel 5713 includes a depth measured along a direction toward a center of the club head 5710, and/or along a direction that is normal to the third surface 5775. In some embodiments, the channel 5713 can comprise a constant depth from the toe end 5718 to the heel end 5722. In the some embodiment, the channel 5713 can have a varying depth such that it is deeper in some areas than in other areas (e.g., may have a continuously or intermittently changing depth). In other embodiments, the channel depth 5713 can have an increasing, decreasing and/or constant depth along its length from the toe end 5718 to the heel end 5722. Thus, when a weight 5782 is coupled to the club head 5710 in one region of the channel 5713, the weight 5782 may fit flush in the channel 5713 and/or be concealed by the first and/or second surfaces 5773, 5774. When the weight 5782 is coupled to the club head 5710 in a different region of the channel 5713, a portion of the weight 5782 may protrude beyond the first and/or second surfaces 5773, 5774. In some embodiments, the channel 5713 includes a region or regions at the rear or back end 5734 where a portion of the weight 5782 protrudes beyond the first surface 5773 and/or the second surface 5774 when coupled.

In many embodiments, the channel 5713 has a shallow depth ensuring the adjustable weight system 5766 remains low profile. For example, in some embodiments, the channel 5713 has a maximum depth of 0.25 inches. In other embodiments, the channel 5713 can have a maximum depth of 1.5, 1.25, 1.0, 0.9, 0.8, 0.7, 0.6, 0.5, 0.4, 0.3, 0.2, or 0.1 inches. In other embodiments, the depth of the channel 5713 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 5713 includes a width measured as the distance between the first surface 5773 and the second surface 5774. In the illustrated embodiments, the channel 5713 includes a constant width. In other embodiments, the channel 5713 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 143 the channel 5713 can include one or more features 5770 defining a discrete attachment location for securing a weight 5782 to the club head 5710. The features 5770 are apertures, wherein the apertures can comprise an inner threading to receive a fastener (not shown). The features 5770 is positioned on the third surface 5775 of the channel 5713. In other embodiments, the features 5770 can be positioned on the first, second and/or third surface 5773, 5774, 5775 of the channel 5713. In the illustrated embodiment, the adjustable weighting system 5766 comprises three features 5770: a first feature 5770A near the toe end 5718, a second feature 5770C near the heel end 5722, and a third feature 5770B in a general center between the first feature 5770A and the second feature 5770C. In other embodiments, the channel 5713 can comprise one, two, three, four, five, six, seven, eight, nine or ten features 5770. The features 5770 can be spaced evenly apart, or in other embodiments, the features 5770 can be spaced at any distance from one another.

The weights 5782 have a generally rectangular shape corresponding with the shape of the channel 5713. In other embodiments, the weights 5782 can have a circular, triangular, trapezoidal, polygonal or any other suitable shape configured to fit within the channel 5713. In the illustrated embodiment, the adjustable weighting system 5766 comprises one weight 5782. In other embodiments, the adjustable weighting system 5766 can comprise more or less weights 5782 than the number of features 5770A, B, C. For example, the adjustable weighting system 5766 can comprise one, two, three, four, five, six, seven, eight, nine or ten weights 5782. In the illustrated embodiment, the weights 5782 comprise apertures extending entirely through the weight 5782 sized and configured to receive the fastener. The fastener can be threaded through the weight 5782 into the corresponding feature 5770, thus securing the weight 5782 to the channel 5713. In some embodiments, the weight 5782 can comprise a filet for receiving the top portion of the screw and therefore the screw can sit flush with the outer portion of the weight 5782. In other embodiments, the weight 5782 can comprise a blind aperture not extending entirely through the weight 5782. In other embodiments, the weight 5782 can be devoid of an aperture. In other embodiments, the weights 5782 can further be secured the features 5770 through a friction fit, a snap-fit mechanism, with a set-screw, or with any other suitable structure.

In the illustrated embodiment each of the features 5770A, B, C can receives the fastener extended through the weight 5782. In other embodiments, one or more of the features 5770A, B, C receives a weight 5782, while the remaining features 5770A, B, C are bare and uncovered, or are covered with another material or structure. In some embodiments, one or more of the features 5770A, B, C receives more than one weight 5782.

In the illustrated embodiment, each of the weights 5782 is illustrated having the same shape and size. In other embodiments, the weights 5782 can vary in shape and size, resulting in different weights 5782 having varying masses. Further, in some embodiments, the weights 5782 are made of different materials such that they vary in mass. For example, one weight 5782 may be made of a high density material, such as tungsten, and the remaining weights 5782 may be made of a less dense material, such as polyurethane or another plastic. In other embodiments, the weights 5782 may have different sizes or volumes such that they vary in mass. For example, one weight 5782 may have a greater volume than the remaining weights 5782. In some embodiments, each of the weights 5782 may vary in volume from one another and thus vary in mass. In some embodiments, the weights 5782 may vary in both volume and material from one another. In some embodiments, one of the structures labeled as 5782 is not a weight, but rather a light-weight (e.g., light-weight plastic) cover that snap-fits or otherwise couples to one of the features 5770A, B, C. In some embodiments, the weights 5782 may vary between 0.1-50 g. For example, in embodiments having a plurality of weights 5782, one or more of the weights 5782 may vary between 0-10 g, one or more of the weights 5782 may vary between 10-20 g, one or more of the weights 5782 may vary between 20-30, one or more of the weights 5782 may vary between 30-40 g, and one or more of the weights 5782 may vary between 40-50 g. In some embodiments, a first weight 5782 may vary between 0-10 g, a second weight 5782 may vary between 10-20 g, a third weight 5782 may vary between 20-30, a fourth weight 82 may vary between 30-40 g, and a fifth weight 5782 may vary between 40-50 g. In other embodiments, a first weight 5782 may vary between 1-5 g, and a second and third weight 5782 may vary between 5-30 g. In other embodiments, a first and second weight 5782 may vary between 1-10 g, and a third and fourth weight 5782, may vary between 5-25 g. In some embodiments, a first weight 5782 has a mass of 8.5 grams, and a second and third weight 5782 each have a mass of 1.5 grams. In other embodiments, a first weight 5782 has a mass of 12 grams, and a second and third weight 5782 each have a mass of 1.5 grams. In other embodiments, a first weight 5782 has a mass of 8.5 grams, and a second and third weight 5782 each have a mass of 0.75 grams. In other embodiments, a first, second, and third weight 5782 can have a mass of 1, 2, 3, 4, 5, or 6 grams, and the fourth weight 5782 can have a mass of 10, 11, 12, 13, 14, 15, 16, 17, 18, 19, 20, 21, 22, 23, 24, 25, 26, 27, 28, 29 or 30 grams. In other embodiments, any number of weights 5782 may have the same mass or may have a varying mass between 0.1-50 g.

The weights 5782 may be strategically positioned on the features 5770A, B, C to achieve a desired club head 5710 center of gravity position and/or moment of inertia and/or heel/toe bias. For example, in some embodiments, a heavier weight 5782 is positioned on the feature 5770B, located between the toe or toe end 5718 and the heel or heel end 5722, while lighter weights are positioned on the features 5770A, C near the toe or toe end 5718 and the heel or heel end 5722. The aforementioned weight 5782 placement can result in the center of gravity remaining centered while being shifted towards the back end 5734 of the club head 5710. In some embodiments, a heavier weight 5782 is positioned on the features 5770C near the heel or heel end 5722, while lighter weights 5782 are positioned on the feature 5770A near the toe or toe end 5718 and on the feature 5770B that is located between the toe or toe end 5718 and the heel or heel end 5722. The aforementioned weight 5782 placement can result in the center of gravity being shifted towards the heel end 5722 of the club head 5710. In some embodiments, a heavier weight 5782 is positioned on the feature 5770A near the toe or toe end 5718, while lighter weights 5782 are positioned on the feature 5770C near the heel or heel end 5722 and on the feature 5770B that is located between the toe or toe end 5718 and the heel or heel end 5722. The aforementioned weight 5782 placement can result in the center of gravity being shifted towards the toe end 5718 of the club head 5710. In many embodiments, one or more of the features 5770A, B, C are of equal size and shape, such that one weight may be interchangeably used with each of the features 5770A, B, C. In some embodiments, one or more of the features 5770A, B, C can have a differing size and shape, such that each features 5770A, B, C has its own corresponding weight 5782 or set of weights 5782.

With continued reference to FIG. 143, the channel 4713 of the weighting system 5766 can further comprised raised portions 5721 extending away from the crown. In other embodiments, the channel 5713 can comprise lowered portions (not pictured) extending away from the sole 4730. In other embodiments, the channel 5713 can comprise a combination of raised portions 5721, lowered portions, and regular straight channel portions. In the illustrated embodiment, the channel 4713 comprises two raised portions 5721, wherein the first raised portion 5721A is positioned between the toe end 5718 and the rear 5723, and the second raised portion 5721B is positioned between the heel end 5722 and the rear 5723. The raised portions 5721 facilitate positioning and/or retention of the weights 5782 within the channel 5713. For example, as illustrated in FIG. 143, in some embodiments the raised portions 5721 are positioned between the distinct attachment locations of the features 5770 along the channel 5713 for the weights 5782. The channel 5713 is free of the raised portions 5721 at the locations of the features 5770. The raised portions 5721 prevent or inhibit the weights 5782 from being inserted into the channel 5713 in any regions other than the distinct attachment locations at the features 5770. In some embodiments, one or more of the raised portions 5721 helps to align the weight 5782 into the designated region 5769.

The adjustable weighting system 5766 of golf club head 5710 maintains or prevents a significant reduction in club head moment of inertia, and low and back club head center of gravity positioning, compared to a club head devoid of an adjustable weighting system. The adjustable weighting system 5766 of golf club head 5710 maintains a high club head moment of inertia and a low and back club head CG position due to the low profile of the weighting system and the perimeter positioning of the one or more weights. The club head 5710 having the adjustable weighting system 5766 can have similar or identical parameters and measurements as club head 100 described above.

Figure 144:
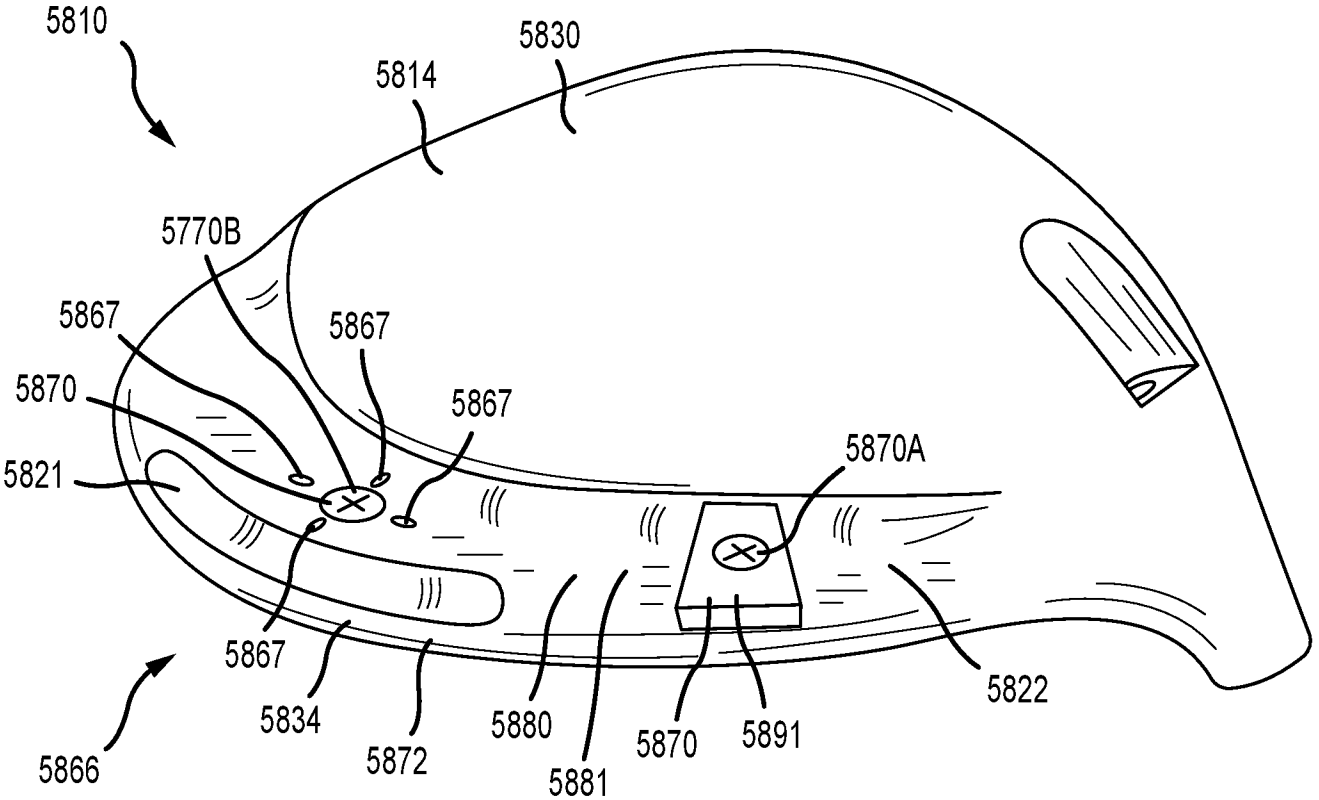
FIG. 144 is a perspective view of a golf club head according to another embodiment.

FIG. 144 illustrates a club head 5810 having a club head body 5814. The club head 5810 includes an adjustable weighting system 5866 that is adjustable by an end user to modify the club head 5810 center of gravity and/or moment of inertia and/or heel/toe bias to achieve desired performance characteristics (e.g., forgiveness, spin, trajectory) under various circumstances. The adjustable weighting system 5866 is a low profile system and thereby does not significantly shift or change the club head 5810 MOI when compared to a club head not including the adjustable weighting system 5866. Further, the low profile adjustable weighting system 5866 ensures that shifts in the club head 5810 CG occur mainly in a heel end 5822 to toe end 5818 direction keeping the overall club head 5810 CG in a low and back location.

As illustrated in FIG. 142, the adjustable weighting system 5866 further comprises a plurality of discrete attachment locations. The plurality of discrete attachment locations can comprise various features 5870. In some embodiments, the features 5870 can be protruding bodies, apertures, recesses, ports capable of receiving a fastener, notches, tabs, cutout regions, ribs, grooves, pegs, hooks, magnets, programmable magnets, or any other suitable attachment means. The features 5870 define a discrete attachment location for securing the weight 5882 to the club head 5810. In contrast to other adjustable weighting systems wherein the weight can be coupled at any, or at an infinite, or at an unlimited number of locations across the recessed portion. The adjustable weighting system 5866 can further comprise a shallow channel or shallow recessed portion 5880 configured to comprise at least one feature 5870. Each feature 5870 defines a discrete attachment location for securing a weight 5882 to the club head 5810. In the illustrated embodiment, the adjustable weighting system 5866 includes a recessed portion 5880 comprising a plurality of features 5870, wherein the features 5870 in the illustrated embodiment are apertures.

The shallow recessed portion 5880 is positioned on a sole of the club head 5830 and extends from near the toe end 5818 proximate a trailing edge 5872, to near the heel end 5822 in an arcuate fashion (forming a U-shape). In other embodiments, the recessed portion can be positioned on any portion of the sole 5830 and form any shape. The recessed portion 5880 comprises a recessed surface 5881, and a wall 5883 separating the recessed surface 5881 with the remaining outer surface 5890 of the sole. In the exemplary embodiment, the club head 5810 can further comprise a channel 5871. The channel 5871 is positioned on the sole 5830, near the rear 5823 along the trialing edge.

In many embodiments, the recessed portion 5880 can be shallow ensuring the adjustable weight system 5866 remains low profile. For example, in some embodiments, the recessed portion 5880 has a maximum depth (measured perpendicularly to the recessed surface 5881 of the recessed portion 5880) of 0.25 inches. In other embodiments, the recessed portion 5880 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 5880 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches.

Referring again to FIGS. 140-141, the recessed portion 5880 can include one or more features 5870 defining a discrete attachment location for securing a weight 5882 to the club head 5810. The features 5870 are apertures, wherein the apertures can comprise an inner threading to receive a fastener 5876. In many embodiment, the adjustable weighting system 5866 comprises three features 5870: a first feature 5870A near the toe end 5818, a second feature 5870C near the heel end 5822, and a third feature 5870B in a general center between the first feature 5870A and the second feature 5870C. In other embodiments, the recessed surface 5881 of the recessed portion 5880 can comprise one, two, three, four, five, six, seven, eight, nine or ten features 5870. The features 5870 can be spaced evenly apart, or in other embodiments, the features 5870 can be spaced at any distance from one another.

The weights 5882 have a generally trapezoidal shape. In other embodiments, the weights 5882 can have a circular, triangular, trapezoidal, polygonal or any other suitable shape configured to fit in the recessed portion 5880. In the illustrated embodiment, the adjustable weighting system 5866 comprises one weight 5882. In other embodiments, the adjustable weighting system 5866 can comprise more or less weights 5882 than the number of features 5870. For example, the adjustable weighting system 5866 can comprise one, two, three, four, five, six, seven, eight, nine to ten weights 5882. In the illustrated embodiment, the weights 5882 comprise apertures extending entirely through the weight 5882 sized and configured to receive the fastener 5876. The fastener 5876 can be threaded through the weight 5882 into the corresponding feature 5870, thus securing the weight 5882 to the recessed portion 5880. In other embodiments, the weight 5882 can be devoid of an aperture. In other embodiments, the weights 5882 can further be secured the features 5870 through a friction fit, a snap-fit mechanism, with a set-screw, or with any other suitable structure. In some embodiments, when the weights 5882 are coupled to the features 5870, the weights 5882 can be flush with the outer surface 5890 of the club head 5810. The flush orientation may improve air flow characteristics during a swing to improve the club head 5810 aerodynamics.

In the illustrated embodiment each of the features 5870A, B, C can receives the fastener 5876 extended through the weight 5882. In other embodiments, one or more of the features 5870A, B, C receives a weight 5882, while the remaining features 5870A, B, C are bare and uncovered, or are covered with another material or structure. In some embodiments, one or more of the features 5870A, B, C receives more than one weight 5882.

In the illustrated embodiment, each of the weights 5882 is illustrated having the same shape and size. In other embodiments, the weights 5882 can vary in shape and size, resulting in different weights 5882 having varying masses. Further, in some embodiments, the weights 5882 are made of different materials such that they vary in mass. For example, one weight 5882 may be made of a high density material, such as tungsten, and the remaining weights 5882 may be made of a less dense material, such as polyurethane or another plastic. In other embodiments, the weights 5882 may have different sizes or volumes such that they vary in mass. For example, one weight 5882 may have a greater volume than the remaining weights 5882. In some embodiments, each of the weights 5882 may vary in volume from one another and thus vary in mass. In some embodiments, the weights 5882 may vary in both volume and material from one another. In some embodiments, one of the structures labeled as 5882 is not a weight, but rather a light-weight (e.g., light-weight plastic) cover that snap-fits or otherwise couples to one of the features 5870A, B, C. In some embodiments, the weights 5882 may vary between 0.1-50 g. For example, in embodiments having a plurality of weights 5882, one or more of the weights 5882 may vary between 0-10 g, one or more of the weights 5882 may vary between 10-20 g, one or more of the weights 5882 may vary between 20-30, one or more of the weights 5882 may vary between 30-40 g, and one or more of the weights 5882 may vary between 40-50 g. In some embodiments, a first weight 5882 may vary between 0-10 g, a second weight 5882 may vary between 10-20 g, a third weight 5882 may vary between 20-30, a fourth weight 82 may vary between 30-40 g, and a fifth weight 5882 may vary between 40-50 g. In other embodiments, a first weight 5882 may vary between 1-5 g, and a second and third weight 5882 may vary between 5-30 g. In other embodiments, a first and second weight 5882 may vary between 1-10 g, and a third and fourth weight 5882, may vary between 5-25 g. In some embodiments, a first weight 5882 has a mass of 8.5 grams, and a second and third weight 5882 each have a mass of 1.5 grams. In other embodiments, a first weight 5882 can have a mass of 12 grams, and a second and third weight 5882 each have a mass of 1.5 grams. In other embodiments, a first weight 5882 has a mass of 8.5 grams, and a second and third weight 5882 each have a mass of 0.75 grams. In other embodiments, a first weight 5882 can have a mass of 10, 11, 12, 13, 14, 15, 16, 17, 18, 19, 20, 21, 22, 23, 24, 25, 26, 27, 28, 29 or 30 grams, and the second, third, and fourth weight 5882 can have a mass of 1, 2, 3, 4, 5, or 6 grams. In other embodiments, any number of weights 5882 may have the same mass or may have a varying mass between 0.1-50 g.

The weights 5882 may be strategically positioned on the features 5870A, B, C to achieve a desired club head 5810 center of gravity position and/or moment of inertia and/or heel/toe bias. For example, in some embodiments, a heavier weight 5882 can be positioned on the feature 5870B, located between the toe or toe end 5818 and the heel or heel end 5822, while lighter weights are positioned on the features 5870A, C near the toe or toe end 5818 and the heel or heel end 5822. The aforementioned weight 5882 placement can result in the center of gravity remaining centered while being shifted towards the back end 5834 of the club head 5810. In some embodiments, a heavier weight 5882 can be positioned on the features 5870C near the heel or heel end 5822, while lighter weights 5882 are positioned on the feature 5870A near the toe or toe end 5818 and on the feature 5870B that is located between the toe or toe end 5818 and the heel or heel end 5822. The aforementioned weight 5882 placement can result in the center of gravity being shifted towards the heel end 5822 of the club head 5810. In some embodiments, a heavier weight 5882 can be positioned on the feature 5870A near the toe or toe end 5818, while lighter weights 5882 are positioned on the feature 5870C near the heel or heel end 5822 and on the feature 5870B that is located between the toe or toe end 5818 and the heel or heel end 5822. The aforementioned weight 5882 placement can result in the center of gravity being shifted towards the toe end 5818 of the club head 5810. In many embodiments, one or more of the features 5870 are of equal size and shape, such that one weight may be interchangeably used with each of the features 5870. In some embodiments, one or more of the features 5870 can have a differing size and shape, such that each features 5870 has its own corresponding weight 5882 or set of weights 5882.

The adjustable weighting system 5866 of golf club head 5810 maintains or prevents a significant reduction in club head moment of inertia, and low and back club head center of gravity positioning, compared to a club head devoid of an adjustable weighting system. The adjustable weighting system 5866 of golf club head 5810 maintains a high club head moment of inertia and a low and back club head CG position due to the low profile of the weighting system and the perimeter positioning of the one or more weights. The club head 5810 having the adjustable weighting system 5866 can have similar or identical parameters and measurements as club head 100 described above.

Figure 145:
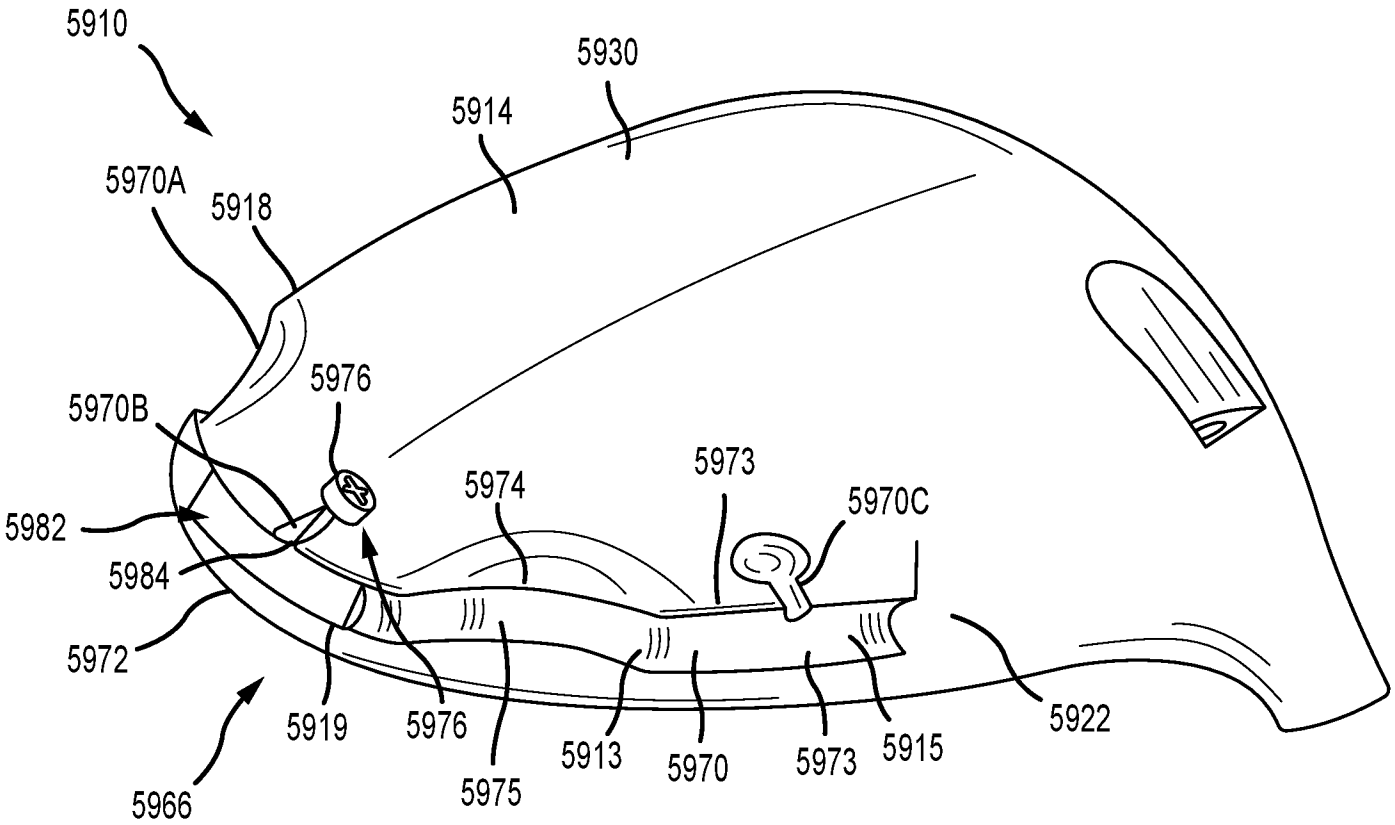
FIG. 145 is a perspective view of a golf club head according to another embodiment.

FIG. 145 illustrates a club head 5910 having a club head body 5914. The club head 5910 includes an adjustable weighting system 5966 that is adjustable by an end user to modify the club head 5910 center of gravity and/or moment of inertia and/or heel/toe bias to achieve desired performance characteristics (e.g., forgiveness, spin, trajectory) under various circumstances. The adjustable weighting system 5966 is a low profile system and thereby does not significantly shift or change the club head 5910 MOI when compared to a club head not including the adjustable weighting system 5966. Further, the low profile adjustable weighting system 5966 ensures that shifts in the club head 5910 CG occur mainly in a heel end 5922 to toe end 5918 direction keeping the overall club head 5910 CG in a low and back location.

As illustrated in FIG. 145, the adjustable weighting system 5966 further comprises a plurality of discrete attachment locations. The plurality of discrete attachment locations can comprise various features 5970. In some embodiments, the features 5970 can be protruding bodies, apertures, recesses, ports capable of receiving a fastener, notches, tabs, cutout regions, ribs, grooves, pegs, hooks, magnets, programmable magnets, or any other suitable attachment means. The features 5970 define a discrete attachment location for securing the weight 5982 to the club head 5910. In contrast to other adjustable weighting systems wherein the weight can be coupled at any, or at an infinite, or at an unlimited number of locations across the recessed portion. The adjustable weighting system 5966 can further comprise a shallow channel or shallow recessed portion 5913. The channel 5913 is defined by three surfaces 5973, 5974, 5975, each of which can be configured to comprise at least one feature 5970. Each feature 5970 defines a discrete attachment location for securing a weight 5982 to the club head 5910. In the illustrated embodiment, the adjustable weighting system 5966 includes a channel 5913 comprising a plurality of features 5970, wherein the features 5970 in the illustrated embodiment are slots.

The channel 5913 extends from near the toe end 5918 in an arcuate manner to near the heel end 5922 following the contour of the trailing edge 5972 of the club head 5910. The channel 5913 is defined by a first surface 5973, a second surface 5974 disposed opposite the first surface 5973, and a third surface 5975 that extends between the first surface 5973 and the second surface 5974. In some embodiments, the first surface 5973 extends parallel to the second surface 5974, and perpendicular to the third surface 5975. The channel 5913 is further defined in part by additional end surfaces 5979 that directly intersect the first surface 5973, the second surface 5974, and the third surface 5975. The additional end surfaces 5979 may provide added support and/or provide an abutment region or edge against which the weights 5983 may rest. In some embodiments, the weights 5982 can be flush with an outer surface 5990 of the club head 5910. The flush orientation may improve air flow characteristics during a swing to improve the club head 5910 aerodynamics.

The channel 5913 includes a depth measured along a direction toward a center of the club head 5910, and/or along a direction that is normal to the third surface 5975. In some embodiments, the channel 5913 can comprise a constant depth from the toe end 5918 to the heel end 5922. In the some embodiment, the channel 5913 can have a varying depth such that it is deeper in some areas than in other areas (e.g., may have a continuously or intermittently changing depth). In other embodiments, the channel depth 5913 can have an increasing, decreasing and/or constant depth along its length from the toe end 5918 to the heel end 5922. Thus, when a weight 5982 is coupled to the club head 5910 in one region of the channel 5913, the weight 5982 may fit flush in the channel 5913 and/or be concealed by the first and/or second surfaces 5973, 5974. When the weight 5982 is coupled to the club head 5910 in a different region of the channel 5913, a portion of the weight 5982 may protrude beyond the first and/or second surfaces 5973, 5974. In some embodiments, the channel 5913 includes a region or regions at the rear or back end 5934 where a portion of the weight 5982 protrudes beyond the first surface 5973 and/or the second surface 5974 when coupled.

In many embodiments, the channel 5913 has a shallow depth ensuring the adjustable weight system 5966 remains low profile. For example, in some embodiments, the channel 5913 has a maximum depth of 0.25 inches. In other embodiments, the channel 5913 can have a maximum depth of 1.5, 1.25, 1.0, 0.9, 0.8, 0.7, 0.6, 0.5, 0.4, 0.3, 0.2, or 0.1 inches. In other embodiments, the depth of the channel 5913 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 5913 includes a width measured as the distance between the first surface 5973 and the second surface 5974. In the illustrated embodiments, the channel 5913 includes a constant width. In other embodiments, the channel 5913 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 145 the channel 5913 can include one or more features 5970 defining a discrete attachment location for securing a weight 5982 to the club head 5910. The features 5970 are slots positioned on the second surface 5974 of the channel 5913. In some embodiments, the features 5970 can be perpendicular to the second surface 5974. In other embodiments as illustrated, the features 5970 can be angled relative to the second surface 5974. In the illustrated embodiment, the features 5970 can comprise a filet for receiving the top portion of the fastener 5976 and therefore the fastener 5982 can sit flush with the outer surface 5971 of the sole 5930. In the illustrated embodiment, the adjustable weighting system 5966 comprises two features 5970: a first feature 5970A near the toe end 5918, and a second feature 5970B in a general center between the first feature 5970A and the heel end 5922. In other embodiments, the club head 5910 can comprise one, two, three, four, five, six, seven, eight, nine or ten features 5970. The features 5970 can be spaced evenly apart, or in other embodiments, the features 5970 can be spaced at any distance from one another.

The weights 5982 have a generally rectangular shape corresponding with the shape of the channel 5913. In other embodiments, the weights 5982 can have a circular, triangular, trapezoidal, polygonal or any other suitable shape configured to fit within the channel 5913. In the illustrated embodiment, the adjustable weighting system 5966 comprises one weight 5982. In other embodiments, the adjustable weighting system 5966 can comprise more or less weights 5982 than the number of features 5970A, B, C. For example, the adjustable weighting system 5966 can comprise one, two, three, four, five, six, seven, eight, nine to ten weights 5982. In the illustrated embodiment, the weights 5982 comprise apertures extending entirely through the weight 5982 sized and configured to receive the fastener 5976. The fastener 5976 can be received by the feature 5970 and into the weight 5982, thus securing the weight 5982 to the channel 5913. In other embodiments, the weight 5982 can comprise a blind aperture not extending entirely through the weight 5982. In other embodiments, the weight 5982 can be devoid of an aperture. In other embodiments, the weights 5982 can further be secured at the features 5970 through a friction fit, a snap-fit mechanism, with a set-screw, or with any other suitable structure.

In the illustrated embodiment each of the features 5970 can receive the fastener 5976, wherein the fastener 5976 extends through the weight 5982. In other embodiments, one or more of the features 5970 receives a weight 5982, while the remaining features 5970 are bare and uncovered, or are covered with another material or structure. In some embodiments, one or more of the features 5970 receives more than one weight 5982. The weights 5982 can be decoupled from the feature by removing the fastener 5976.

In the illustrated embodiment, each of the weights 5982 is illustrated having the same shape and size. In other embodiments, the weights 5982 can vary in shape and size, resulting in different weights 5982 having varying masses. Further, in some embodiments, the weights 5982 are made of different materials such that they vary in mass. For example, one weight 5982 may be made of a high density material, such as tungsten, and the remaining weights 5982 may be made of a less dense material, such as polyurethane or another plastic. In other embodiments, the weights 5982 may have different sizes or volumes such that they vary in mass. For example, one weight 5982 may have a greater volume than the remaining weights 5982. In some embodiments, each of the weights 5982 may vary in volume from one another and thus vary in mass. In some embodiments, the weights 5982 may vary in both volume and material from one another. In some embodiments, one of the structures labeled as 5982 is not a weight, but rather a light-weight (e.g., light-weight plastic) cover that snap-fits or otherwise couples to one of the features 5970A, B, C. In some embodiments, the weights 5982 may vary between 0.1-50 g. For example, in embodiments having a plurality of weights 5982, one or more of the weights 5982 may vary between 0-10 g, one or more of the weights 5982 may vary between 10-20 g, one or more of the weights 5982 may vary between 20-30, one or more of the weights 5982 may vary between 30-40 g, and one or more of the weights 5982 may vary between 40-50 g. In some embodiments, a first weight 5982 may vary between 0-10 g, a second weight 5982 may vary between 10-20 g, a third weight 5982 may vary between 20-30, a fourth weight 82 may vary between 30-40 g, and a fifth weight 5982 may vary between 40-50 g. In other embodiments, a first weight 5982 may vary between 1-5 g, and a second and third weight 5982 may vary between 5-30 g. In other embodiments, a first and second weight 5982 may vary between 1-10 g, and a third and fourth weight 5982, may vary between 5-25 g. In some embodiments, a first weight 5982 has a mass of 8.5 grams, and a second and third weight 5982 each have a mass of 1.5 grams. In other embodiments, a first weight 5982 has a mass of 12 grams, and a second and third weight 5982 each have a mass of 1.5 grams. In other embodiments, a first weight 5982 has a mass of 8.5 grams, and a second and third weight 5982 each have a mass of 0.75 grams. In other embodiments, a first, second, and third weight 5982 can have a mass of 1, 2, 3, 4, 5, or 6 grams, and the fourth weight 5982 can have a mass of 10, 11, 12, 13, 14, 15, 16, 17, 18, 19, 20, 21, 22, 23, 24, 25, 26, 27, 28, 29 or 30 grams. In other embodiments, any number of weights 5982 may have the same mass or may have a varying mass between 0.1-50 g.

The weights 5982 may be strategically positioned and coupled to the features 5970 to achieve a desired club head 5910 center of gravity position and/or moment of inertia and/or heel/toe bias. For example, in some embodiments, a heavier weight 5982 is positioned at the feature 5970B, located between the toe or toe end 5918 and the heel or heel end 5922, while lighter weights are positioned on the features 5970 near the toe or toe end 5918 and the heel or heel end 5922. The fastener 5976 can be coupled to the feature 5970B and weight 5982 to secure the weight 5982 within the channel 5913 at the distinct location. The aforementioned weight 5982 placement can result in the center of gravity remaining centered while being shifted towards the back end 5934 of the club head 5910. In some embodiments, a heavier weight 5982 is positioned on the features 5970 near the heel or heel end 5922, while lighter weights 5982 are positioned on the feature 5970A near the toe or toe end 5918 and on the feature 5970B that is located between the toe or toe end 5918 and the heel or heel end 5922. The aforementioned weight 5982 placement can result in the center of gravity being shifted towards the heel end 5922 of the club head 5910. In some embodiments, a heavier weight 5982 is positioned on the feature 5970A near the toe or toe end 5918, while lighter weights 5982 are positioned on the feature 5970 near the heel or heel end 5922 and on the feature 5970B that is located between the toe or toe end 5918 and the heel or heel end 5922. The aforementioned weight 5982 placement can result in the center of gravity being shifted towards the toe end 5918 of the club head 5910. In many embodiments, one or more of the features 5970 are of equal size and shape, such that one weight may be interchangeably used with each of the features 5970. In some embodiments, one or more of the features 5970 can have a differing size and shape, such that each features has its own corresponding weight 5982 or set of weights 5982. Each of the weights 5982 can be coupled to the feature by tightening the fastener 5976, while the weights 5982 can be decoupled to the feature by loosening and taking out the fastener 5976.

With continued reference to FIG. 145, the channel 4713 of the weighting system 5966 can further comprised raised portions 5921 extending away from the crown. In other embodiments, the channel 5913 can comprise lowered portions (not pictured) extending away from the sole 4730. In other embodiments, the channel 5913 can comprise a combination of raised portions 5921, lowered portions, and regular straight channel portions. In the illustrated embodiment, the channel 4713 comprises two raised portions 5921, wherein the first raised portion 5921A is positioned between the toe end 5918 and the rear 5923, and the second raised portion 5921B is positioned between the heel end 5922 and the rear 5923. The raised portions 5921 facilitate positioning and/or retention of the weights 5982 within the channel 5913. For example, as illustrated in FIG. 145, in some embodiments the raised portions 5921 are positioned between the distinct attachment locations of the features 5970 along the channel 5913 for the weights 5982. The channel 5913 is free of the raised portions 5921 at the locations of the features 5970. The raised portions 5921 prevent or inhibit the weights 5982 from being inserted into the channel 5913 in any regions other than the distinct attachment locations at the features 5970. In some embodiments, one or more of the raised portions 5921 helps to align the weight 5982 into the designated region 5969.

The adjustable weighting system 5966 of golf club head 5910 maintains or prevents a significant reduction in club head moment of inertia, and low and back club head center of gravity positioning, compared to a club head devoid of an adjustable weighting system. The adjustable weighting system 5966 of golf club head 5910 maintains a high club head moment of inertia and a low and back club head CG position due to the low profile of the weighting system and the perimeter positioning of the one or more weights. The club head 5910 having the adjustable weighting system 5966 can have similar or identical parameters and measurements as club head 100 described above.

Figure 146:
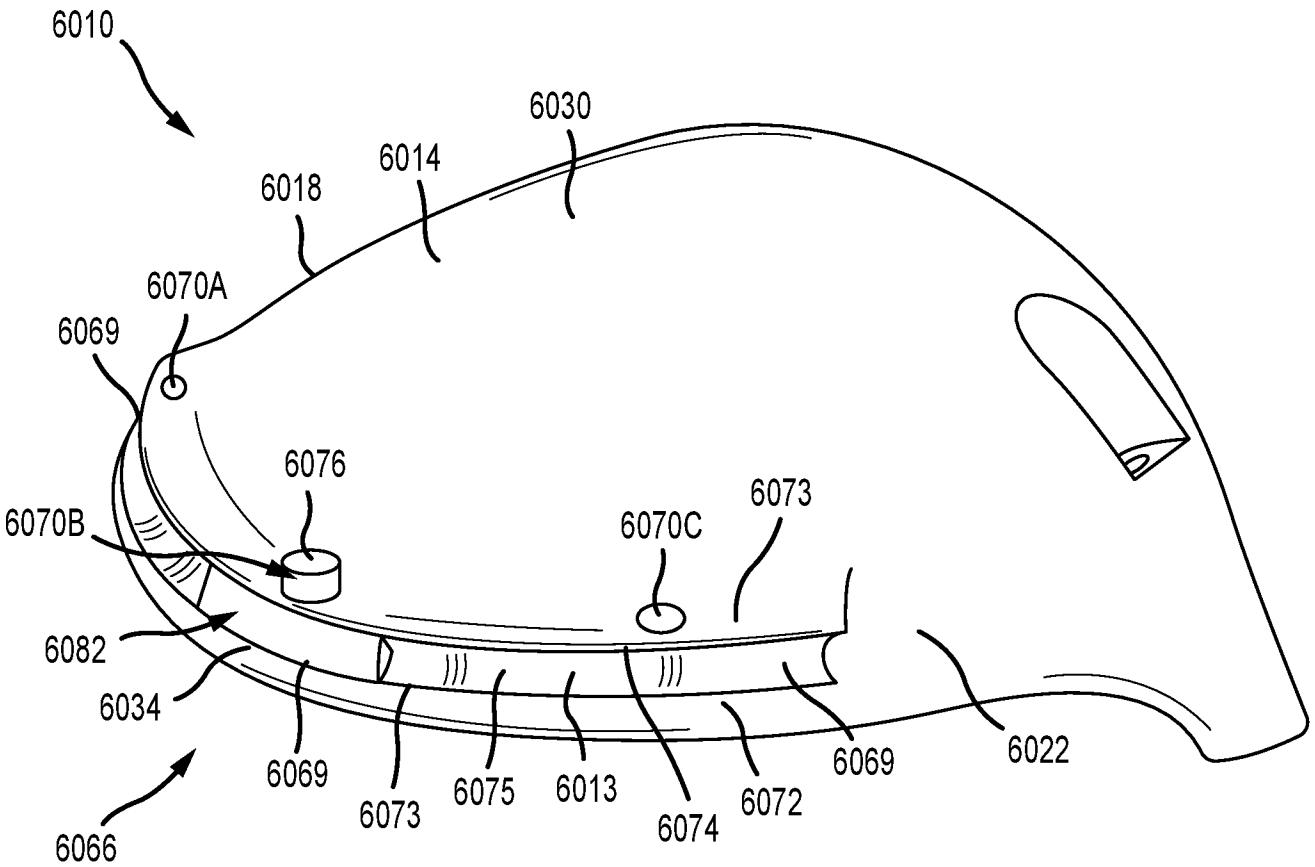
FIG. 146 is a perspective view of a golf club head according to another embodiment.

FIG. 146 illustrates a club head 6010 having a club head body 6014. The club head 6010 includes an adjustable weighting system 6066 that is adjustable by an end user to modify the club head 6010 center of gravity and/or moment of inertia and/or heel/toe bias to achieve desired performance characteristics (e.g., forgiveness, spin, trajectory) under various circumstances. The adjustable weighting system 6066 is a low profile system and thereby does not significantly shift or change the club head 6010 MOI when compared to a club head not including the adjustable weighting system 6066. Further, the low profile adjustable weighting system 6066 ensures that shifts in the club head 6010 CG occur mainly in a heel end 6022 to toe end 6018 direction keeping the overall club head 6010 CG in a low and back location.

As illustrated in FIG. 146, the adjustable weighting system 6066 further comprises a plurality of discrete attachment locations. The plurality of discrete attachment locations can comprise various features 6070. In some embodiments, the features 6070 can be protruding bodies, apertures, recesses, ports capable of receiving a fastener, notches, tabs, cutout regions, ribs, grooves, pegs, hooks, magnets, programmable magnets, or any other suitable attachment means. The features 6070 define a discrete attachment location for securing the weight 6082 to the club head 6010. In contrast to other adjustable weighting systems wherein the weight can be coupled at any, or at an infinite, or at an unlimited number of locations across the recessed portion. The adjustable weighting system 6066 can further comprise a shallow channel or shallow recessed portion 6013. The channel 6013 is defined by three surfaces 6073, 6074, 6075, each of which can be configured to comprise at least one feature 6070. Each feature 6070 defines a discrete attachment location for securing a weight 6082 to the club head 6010. In the illustrated embodiment, the adjustable weighting system 6066 includes a channel 6013 comprising a plurality of features 6070, wherein the features 6070 in the illustrated embodiment are apertures.

The channel 6013 extends from near the toe end 6018 in an arcuate manner to near the heel end 6022 following the contour of the trailing edge 6072 of the club head 6010. The channel 6013 is defined by a first surface 6073, a second surface 6074 disposed opposite the first surface 6073, and a third surface 6075 that extends between the first surface 6073 and the second surface 6074. In some embodiments, the first surface 6073 extends parallel to the second surface 6074, and perpendicular to the third surface 6075. In some embodiments as illustrated, the sole 6030 at the second surface 6074 can comprise a sloped contour wherein the sole 6030 at the second surface 6074 looks like a lip. In other embodiments, the sole 6030 at the second surface 6074 can follow the general trend of the contour of the remaining sole 6030. The channel 6013 is further defined in part by additional end surfaces 6079 that directly intersect the first surface 6073, the second surface 6074, and the third surface 6075. The additional end surfaces 6079 may provide added support and/or provide an abutment region or edge against which the weights 6083 may rest. In some embodiments, the weights 6082 can be flush with an outer surface 6090 of the club head 6010. The flush orientation may improve air flow characteristics during a swing to improve the club head 6010 aerodynamics.

The channel 6013 includes a depth measured along a direction toward a center of the club head 6010, and/or along a direction that is normal to the third surface 6075. In some embodiments, the channel 6013 can comprise a constant depth from the toe end 6018 to the heel end 6022. In the some embodiment, the channel 6013 can have a varying depth such that it is deeper in some areas than in other areas (e.g., may have a continuously or intermittently changing depth). In other embodiments, the channel depth 6013 can have an increasing, decreasing and/or constant depth along its length from the toe end 6018 to the heel end 6022. Thus, when a weight 6082 is coupled to the club head 6010 in one region of the channel 6013, the weight 6082 may fit flush in the channel 6013 and/or be concealed by the first and/or second surfaces 6073, 6074. When the weight 6082 is coupled to the club head 6010 in a different region of the channel 6013, a portion of the weight 6082 may protrude beyond the first and/or second surfaces 6073, 6074. In some embodiments, the channel 6013 includes a region or regions at the rear or back end 6034 where a portion of the weight 6082 protrudes beyond the first surface 6073 and/or the second surface 6074 when coupled.

In many embodiments, the channel 6013 has a shallow depth ensuring the adjustable weight system 6066 remains low profile. For example, in some embodiments, the channel 6013 has a maximum depth of 0.25 inches. In other embodiments, the channel 6013 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6013 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6013 includes a width measured as the distance between the first surface 6073 and the second surface 6074. In the illustrated embodiments, the channel 6013 includes a constant width. In other embodiments, the channel 6013 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 146 the channel 6013 can include one or more features 6070 defining a discrete attachment location for securing a weight 6082 to the club head 6010. The features 6070 are through apertures positioned on the second surface 6074 of the channel 6013. In the illustrated embodiment, the features 6070 extend perpendicular to the second surface 6074 of the channel 6013. In other embodiments, the features can extend at an angle relative to the second surface 6074 of the channel 6013. In the illustrated embodiment, the adjustable weighting system 6066 comprises three features 6070: a first feature 6070A near the toe end 6018, a second feature 6070C near the heel end 5722, and a third feature 6070B in a general center between the first feature 6070A and the second feature 6070C. In other embodiments, the club head 6010 can comprise one, two, three, four, five, six, seven, eight, nine or ten features 6070. The features 6070 can be spaced evenly apart, or in other embodiments, the features 6070 can be spaced at any distance from one another.

The feature 6070 is configured to receive a fastener 6076. The fastener 6076 can comprise threading to be secured into the feature 6070. In other embodiments, the fastener 6076 can be secured into the feature 6070 by press-fit, an adhesive, or by any other coupling means.

The weights 6082 of the adjustable weighting system 6066 have a generally rectangular shape corresponding with the shape of the channel 6013. In other embodiments, the weights 6082 can have a circular, triangular, trapezoidal, polygonal or any other suitable shape configured to fit within the channel 6013. In the illustrated embodiment, the adjustable weighting system 6066 comprises one weight 6082. In other embodiments, the adjustable weighting system 6066 can comprise more or less weights 6082 than the number of features 6070A, B, C. For example, the adjustable weighting system 6066 can comprise one, two, three, four, five, six, seven, eight, nine to ten weights 6082. The weights 6082 can comprise apertures extending entirely through the weight 6082 sized and configured to receive the fastener 6076. The fastener 6076 can be received by the feature 6070 and into the weight 6082, thus securing the weight 6082 to the channel 6013. In other embodiments, the weight 6082 can comprise a blind aperture not extending entirely through the weight 6082, wherein the fastener 6076 presses against the blind aperture, thereby press fitting the weigh 6082 within the channel 6013 at the distinct location of the feature 6070. In other embodiments, the weight 6082 can be devoid of an aperture and the fastener 6076 presses against the weight 6082 to secure the weight 6082. In other embodiments, the weights 6082 can further be secured at the features 6070 through a friction fit, a snap-fit mechanism, with a set-screw, or with any other suitable structure.

In the illustrated embodiment each of the features 6070 can receive the fastener 6076, wherein the fastener 6076 extends through (or abuts the weight 6082, or abuts the blind aperture) the weight 6082. In other embodiments, one or more of the features 6070 receives a weight 6082, while the remaining features 6070 are bare and uncovered, or are covered with another material or structure. In some embodiments, one or more of the features 6070 receives more than one weight 6082. The weights 6082 can be decoupled from the feature by removing the fastener 6076.

In the illustrated embodiment, each of the weights 6082 is illustrated having the same shape and size. In other embodiments, the weights 6082 can vary in shape and size, resulting in different weights 6082 having varying masses. Further, in some embodiments, the weights 6082 are made of different materials such that they vary in mass. For example, one weight 6082 may be made of a high density material, such as tungsten, and the remaining weights 6082 may be made of a less dense material, such as polyurethane or another plastic. In other embodiments, the weights 6082 may have different sizes or volumes such that they vary in mass. For example, one weight 6082 may have a greater volume than the remaining weights 6082. In some embodiments, each of the weights 6082 may vary in volume from one another and thus vary in mass. In some embodiments, the weights 6082 may vary in both volume and material from one another. In some embodiments, one of the structures labeled as 6082 is not a weight, but rather a light-weight (e.g., light-weight plastic) cover that snap-fits or otherwise couples to one of the features 6070A, B, C. In some embodiments, the weights 6082 may vary between 0.1-50 g. For example, in embodiments having a plurality of weights 6082, one or more of the weights 6082 may vary between 0-10 g, one or more of the weights 6082 may vary between 10-20 g, one or more of the weights 6082 may vary between 20-30, one or more of the weights 6082 may vary between 30-40 g, and one or more of the weights 6082 may vary between 40-50 g. In some embodiments, a first weight 6082 may vary between 0-10 g, a second weight 6082 may vary between 10-20 g, a third weight 6082 may vary between 20-30, a fourth weight 82 may vary between 30-40 g, and a fifth weight 6082 may vary between 40-50 g. In other embodiments, a first weight 6082 may vary between 1-5 g, and a second and third weight 6082 may vary between 5-30 g. In other embodiments, a first and second weight 6082 may vary between 1-10 g, and a third and fourth weight 6082, may vary between 5-25 g. In some embodiments, a first weight 6082 has a mass of 8.5 grams, and a second and third weight 6082 each have a mass of 1.5 grams. In other embodiments, a first weight 6082 has a mass of 12 grams, and a second and third weight 6082 each have a mass of 1.5 grams. In other embodiments, a first weight 6082 has a mass of 8.5 grams, and a second and third weight 6082 each have a mass of 0.75 grams. In other embodiments, the first weight 6082 can have a mass of 1, 2, 3, 4, 5, or 6 grams, and the second, and third, and fourth weight 6082 can have a mass of 10, 11, 12, 13, 14, 15, 16, 17, 18, 19, 20, 21, 22, 23, 24, 25, 26, 27, 28, 29 or 30 grams. In other embodiments, any number of weights 6082 may have the same mass or may have a varying mass between 0.1-50 g.

The weights 6082 may be strategically positioned and coupled to the features 6070 to achieve a desired club head 6010 center of gravity position and/or moment of inertia and/or heel/toe bias. For example, in some embodiments, a heavier weight 6082 is positioned at the feature 6070B, located between the toe or toe end 6018 and the heel or heel end 6022, while lighter weights are positioned on the features 6070A, C near the toe or toe end 6018 and the heel or heel end 6022. The fastener 6076 can be coupled to the feature 6070B and weight 6082 to secure the weight 6082 within the channel 6013 at the distinct location. The aforementioned weight 6082 placement can result in the center of gravity remaining centered while being shifted towards the back end 6034 of the club head 6010. In some embodiments, a heavier weight 6082 is positioned on the features 6070C near the heel or heel end 6022, while lighter weights 6082 are positioned on the feature 6070A near the toe or toe end 6018 and on the feature 6070B that is located between the toe or toe end 6018 and the heel or heel end 6022. The aforementioned weight 6082 placement can result in the center of gravity being shifted towards the heel end 6022 of the club head 6010. In some embodiments, a heavier weight 6082 is positioned on the feature 6070A near the toe or toe end 6018, while lighter weights 6082 are positioned on the feature 6070C near the heel or heel end 6022 and on the feature 6070B that is located between the toe or toe end 6018 and the heel or heel end 6022. The aforementioned weight 6082 placement can result in the center of gravity being shifted towards the toe end 6018 of the club head 6010. In many embodiments, one or more of the features 6070A, B, C are of equal size and shape, such that one weight may be interchangeably used with each of the features 6070A, B, C. In some embodiments, one or more of the features 6070A, B, C can have a differing size and shape, such that each features 6070A, B, C has its own corresponding weight 6082 or set of weights 6082.

The adjustable weighting system 6066 of golf club head 6010 maintains or prevents a significant reduction in club head moment of inertia, and low and back club head center of gravity positioning, compared to a club head devoid of an adjustable weighting system. The adjustable weighting system 6066 of golf club head 6010 maintains a high club head moment of inertia and a low and back club head CG position due to the low profile of the weighting system and the perimeter positioning of the one or more weights. The club head 6010 having the adjustable weighting system 6066 can have similar or identical parameters and measurements as club head 100 described above.

Figure 147:
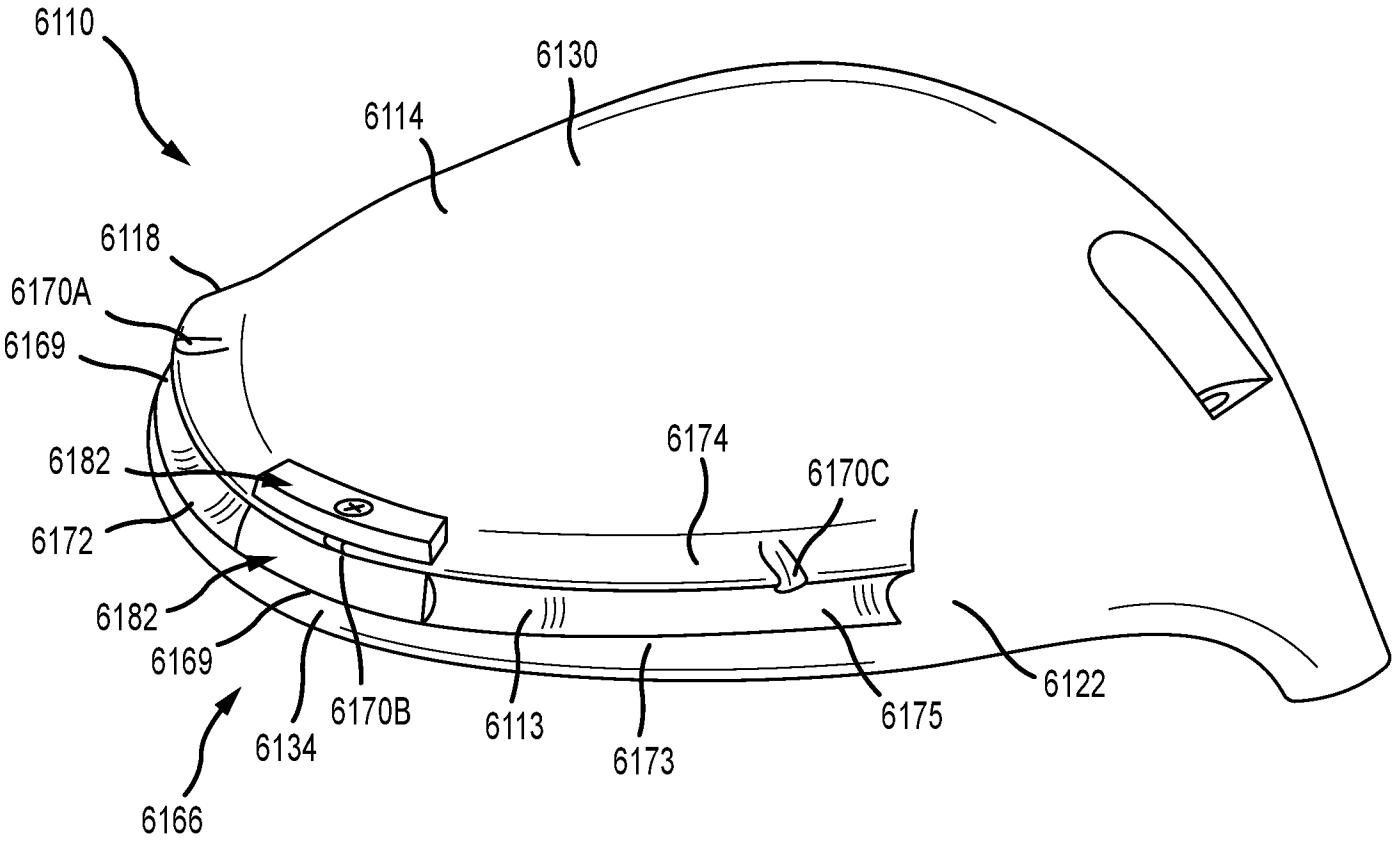
FIG. 147 is a perspective view of a golf club head according to another embodiment.

FIG. 147 illustrates a club head 6110 having a club head body 6114. The club head 6110 includes an adjustable weighting system 6166 that is adjustable by an end user to modify the club head 6110 center of gravity and/or moment of inertia and/or heel/toe bias to achieve desired performance characteristics (e.g., forgiveness, spin, trajectory) under various circumstances. The adjustable weighting system 6166 is a low profile system and thereby does not significantly shift or change the club head 6110 MOI when compared to a club head not including the adjustable weighting system 6166. Further, the low profile adjustable weighting system 6166 ensures that shifts in the club head 6110 CG occur mainly in a heel end 6122 to toe end 6118 direction keeping the overall club head 6110 CG in a low and back location.

As illustrated in FIG. 147, the adjustable weighting system 6166 further comprises a plurality of discrete attachment locations. The plurality of discrete attachment locations can comprise various features 6170. In some embodiments, the features 6170 can be protruding bodies, apertures, recesses, ports capable of receiving a fastener, notches, tabs, cutout regions, ribs, grooves, pegs, hooks, magnets, programmable magnets, or any other suitable attachment means. The features 6170 define a discrete attachment location for securing the weight 6182 to the club head 6110. In contrast to other adjustable weighting systems wherein the weight can be coupled at any, or at an infinite, or at an unlimited number of locations across the recessed portion. The adjustable weighting system 6166 can further comprise a shallow channel or shallow recessed portion 6113. The channel 6113 is defined by three surfaces 6173, 6174, 6175, each of which can be configured to comprise at least one feature 6170. Each feature 6170 defines a discrete attachment location for securing a weight 6182 to the club head 6110. In the illustrated embodiment, the adjustable weighting system 6166 includes a channel 6113 comprising a plurality of features 6170, wherein the features 6170 in the illustrated embodiment are slots.

The channel 6113 extends from near the toe end 6118 in an arcuate manner to near the heel end 6122 following the contour of the trailing edge 6172 of the club head 6110. The channel 6113 is defined by a first surface 6173, a second surface 6174 disposed opposite the first surface 6173, and a third surface 6175 that extends between the first surface 6173 and the second surface 6174. In some embodiments, the first surface 6173 extends parallel to the second surface 6174, and perpendicular to the third surface 6175. In some embodiments as illustrated, the sole 6130 at the second surface 6174 can comprise a sloped contour wherein the sole 6130 at the second surface 6174 looks like a lip. In other embodiments, the sole 6130 at the second surface 6174 can follow the general trend of the contour of the remaining sole 6130. The channel 6113 is further defined in part by additional end surfaces 6179 that directly intersect the first surface 6173, the second surface 6174, and the third surface 6175. The additional end surfaces 6179 may provide added support and/or provide an abutment region or edge against which the weights 6183 may rest. In some embodiments, the weights 6182 can be flush with an outer surface 6190 of the club head 6110. The flush orientation may improve air flow characteristics during a swing to improve the club head 6110 aerodynamics.

The channel 6113 includes a depth measured along a direction toward a center of the club head 6110, and/or along a direction that is normal to the third surface 6175. In some embodiments, the channel 6113 can comprise a constant depth from the toe end 6118 to the heel end 6122. In the some embodiment, the channel 6113 can have a varying depth such that it is deeper in some areas than in other areas (e.g., may have a continuously or intermittently changing depth). In other embodiments, the channel depth 6113 can have an increasing, decreasing and/or constant depth along its length from the toe end 6118 to the heel end 6122. Thus, when a weight 6182 is coupled to the club head 6110 in one region of the channel 6113, the weight 6182 may fit flush in the channel 6113 and/or be concealed by the first and/or second surfaces 6173, 6174. When the weight 6182 is coupled to the club head 6110 in a different region of the channel 6113, a portion of the weight 6182 may protrude beyond the first and/or second surfaces 6173, 6174. In some embodiments, the channel 6113 includes a region or regions at the rear or back end 6134 where a portion of the weight 6182 protrudes beyond the first surface 6173 and/or the second surface 6174 when coupled.

In many embodiments, the channel 6113 has a shallow depth ensuring the adjustable weight system 6166 remains low profile. For example, in some embodiments, the channel 6113 has a maximum depth of 0.25 inches. In other embodiments, the channel 6113 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6113 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6113 includes a width measured as the distance between the first surface 6173 and the second surface 6174. In the illustrated embodiments, the channel 6113 includes a constant width. In other embodiments, the channel 6113 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 147 the channel 6113 can include one or more features 6170 defining a discrete attachment location for securing a weight 6182 to the club head 6110. The features 6170 are slots positioned on the second surface 6174 of the channel 6113. In the illustrated embodiment, the features 6170 extend at an angle relative to the second surface 6174 of the channel 6113. In other embodiments, the features can extend perpendicular to the second surface 6174 of the channel 6113. In the illustrated embodiment, the adjustable weighting system 6166 comprises three features 6170: a first feature 6170A near the toe end 6118, a second feature 6170C near the heel end 5722, and a third feature 6170B in a general center between the first feature 6170 near the toe end 6118 and the second feature 6170C. In other embodiments, the club head 6110 can comprise one, two, three, four, five, six, seven, eight, nine or ten features 6170. The features 6170 can be spaced evenly apart, or in other embodiments, the features 6170 can be spaced at any distance from one another.

The feature 6170 is configured to receive a fastener 6176. The fastener 6176 can comprise threading to be secured into the feature 6170. In other embodiments, the fastener 6176 can be secured into the feature 6170 by press-fit, an adhesive, or by any other coupling means.

In the illustrated embodiments, the weights 6182 comprises a first portion 6183, and a second portion 6184. The first portion 6183 of the weights 6182 can have a generally rectangular shape corresponding with the shape of the channel 6113. The second portions 6184 of the weights 6182 can have a rectangular shape. In other embodiments, both the first and second portion 6183 and 6184 of the weights 6182 can have a circular, triangular, trapezoidal, polygonal or any other suitable shape configured to fit within the channel 6113. The first portion 6183 of the weights 6182 is configured to be placed within the channel 6113, while the second portion 6184 of the weights 6182 is configured to be place on the sole 6130 over the second surface 6174 (i.e., the first and second portion 6183 and 6184 sandwiches the second surface 6174 of the channel 6113). In the illustrated embodiment, the adjustable weighting system 6166 comprises one weight 6182. In other embodiments, the adjustable weighting system 6166 can comprise more or less weights 6182 than the number of features 6170. For example, the adjustable weighting system 6166 can comprise one, two, three, four, five, six, seven, eight, nine to ten weights 6182. The weights 6182 can comprise apertures extending entirely through both the first and second portion 6183 and 6184 configured to receive the fastener 6176. The fastener 6176 can be received by second portion 6184, through the feature 6170, and into the first portion 6183, thus securing the weight 6182 to the channel 6113. In other embodiments, the first portion 6183 of the weight 6182 can comprise a blind aperture not extending entirely through the weight 6182, wherein the fastener 6176 presses against the blind aperture, thereby press fitting the weigh 6182 within the channel 6113 at the distinct location of the feature 6170. In other embodiments, the first portion 6183 of the weight 6182 can be devoid of an aperture and the fastener 6176 presses against the first portion 6183 of the weight 6182 to secure the weight 6182. In other embodiments, the weights 6182 can further be secured at the features 6170 through a friction fit, a snap-fit mechanism, with a set-screw, or with any other suitable structure.

In the illustrated embodiment each of the features 6170 can receive the fastener 6176, wherein the fastener 6176 extends through (or abuts the weight 6182, or abuts the blind aperture) the weight 6182. In other embodiments, one or more of the features 6170 receives a weight 6182, while the remaining features 6170 are bare and uncovered, or are covered with another material or structure. In some embodiments, one or more of the features 6170 receives more than one weight 6182. The weights 6182 can be decoupled from the feature by removing the fastener 6176.

In the illustrated embodiment, each of the weights 6182 is illustrated having the same shape and size. In other embodiments, the weights 6182 can vary in shape and size, resulting in different weights 6182 having varying masses. Further, in some embodiments, the weights 6182 are made of different materials such that they vary in mass. For example, one weight 6182 may be made of a high density material, such as tungsten, and the remaining weights 6182 may be made of a less dense material, such as polyurethane or another plastic. In other embodiments, the weights 6182 may have different sizes or volumes such that they vary in mass. For example, one weight 6182 may have a greater volume than the remaining weights 6182. In some embodiments, each of the weights 6182 may vary in volume from one another and thus vary in mass. In some embodiments, the weights 6182 may vary in both volume and material from one another. In some embodiments, one of the structures labeled as 6182 is not a weight, but rather a light-weight (e.g., light-weight plastic) cover that snap-fits or otherwise couples to one of the features 6170. In some embodiments, the weights 6182 may vary between 0.1-50 g. For example, in embodiments having a plurality of weights 6182, one or more of the weights 6182 may vary between 0-10 g, one or more of the weights 6182 may vary between 10-20 g, one or more of the weights 6182 may vary between 20-30, one or more of the weights 6182 may vary between 30-40 g, and one or more of the weights 6182 may vary between 40-50 g. In some embodiments, a first weight 6182 may vary between 0-10 g, a second weight 6182 may vary between 10-20 g, a third weight 6182 may vary between 20-30, a fourth weight 82 may vary between 30-40 g, and a fifth weight 6182 may vary between 40-50 g. In other embodiments, a first weight 6182 may vary between 1-5 g, and a second and third weight 6182 may vary between 5-30 g. In other embodiments, a first and second weight 6182 may vary between 1-10 g, and a third and fourth weight 6182, may vary between 5-25 g. In some embodiments, a first weight 6182 has a mass of 8.5 grams, and a second and third weight 6182 each have a mass of 1.5 grams. In other embodiments, a first weight 6182 has a mass of 12 grams, and a second and third weight 6182 each have a mass of 1.5 grams. In other embodiments, a first weight 6182 has a mass of 8.5 grams, and a second and third weight 6182 each have a mass of 0.75 grams. In other embodiments, a first weight 6182 can have a mass of 10, 11, 12, 13, 14, 15, 16, 17, 18, 19, 20, 21, 22, 23, 24, 25, 26, 27, 28, 29 or 30 grams and the second, third, and the fourth weight 6182 can have a mass of 1, 2, 3, 4, 5, or 6 grams. In other embodiments, any number of weights 6182 may have the same mass or may have a varying mass between 0.1-50 g.

The weights 6182 may be strategically positioned and coupled to the features 6170 to achieve a desired club head 6110 center of gravity position and/or moment of inertia and/or heel/toe bias. For example, in some embodiments, a heavier weight 6182 is positioned at the feature 6170B, located between the toe or toe end 6118 and the heel or heel end 6122, while lighter weights are positioned on the feature 6170A near the toe or toe end 6118 and the feature 6170C heel or heel end 6122. The fastener 6176 can be coupled to the feature 6170B and weight 6182 to secure the weight 6182 within the channel 6113 at the distinct location. The aforementioned weight 6182 placement can result in the center of gravity remaining centered while being shifted towards the back end 6134 of the club head 6110. In some embodiments, a heavier weight 6182 is positioned on the features 6170C near the heel or heel end 6122, while lighter weights 6182 are positioned on the feature 6170A near the toe or toe end 6118 and on the feature 6170B that is located between the toe or toe end 6118 and the heel or heel end 6122. The aforementioned weight 6182 placement can result in the center of gravity being shifted towards the heel end 6122 of the club head 6110. In some embodiments, a heavier weight 6182 is positioned on the feature 6170A near the toe or toe end 6118, while lighter weights 6182 are positioned on the feature 6170C near the heel or heel end 6122 and on the feature 6170B that is located between the toe or toe end 6118 and the heel or heel end 6122. The aforementioned weight 6182 placement can result in the center of gravity being shifted towards the toe end 6118 of the club head 6110. In many embodiments, one or more of the features 6170 are of equal size and shape, such that one weight may be interchangeably used with each of the features 6170. In some embodiments, one or more of the features 6170 can have a differing size and shape, such that each features 6170 has its own corresponding weight 6182 or set of weights 6182.

The adjustable weighting system 6166 of golf club head 6110 maintains or prevents a significant reduction in club head moment of inertia, and low and back club head center of gravity positioning, compared to a club head devoid of an adjustable weighting system. The adjustable weighting system 6166 of golf club head 6110 maintains a high club head moment of inertia and a low and back club head CG position due to the low profile of the weighting system and the perimeter positioning of the one or more weights. The club head 6110 having the adjustable weighting system 6166 can have similar or identical parameters and measurements as club head 100 described above.

FIGS. 148-152 illustrate a club head 6210 having a club head body 6214. The club head 6210 includes an adjustable weighting system 6266 that is adjustable by an end user to modify the club head 6210 center of gravity and/or moment of inertia and/or heel/toe bias to achieve desired performance characteristics (e.g., forgiveness, spin, trajectory) under various circumstances. The adjustable weighting system 6266 is a low profile system and thereby does not significantly shift or change the club head 6210 MOI when compared to a club head not including the adjustable weighting system 6266. Further, the low profile adjustable weighting system 6266 ensures that shifts in the club head 6210 CG occur mainly in a heel end 6222 to toe end 6218 direction keeping the overall club head 6210 CG in a low and back location.

Referring to FIGS. 148-152, the adjustable weighting system 6266 can comprise a channel or recessed portion 6213. The channel 6213 is defined by three surfaces 6273, 6274, 6275, each of which can be configured to comprise a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6266 includes a channel 6280 comprising a third surface 6275 including three discrete attachment locations. The three discrete attachment locations each comprise a feature 6270A, B, C. The features 6270A, B, C can be any of the features discussed above.

Figure 148:
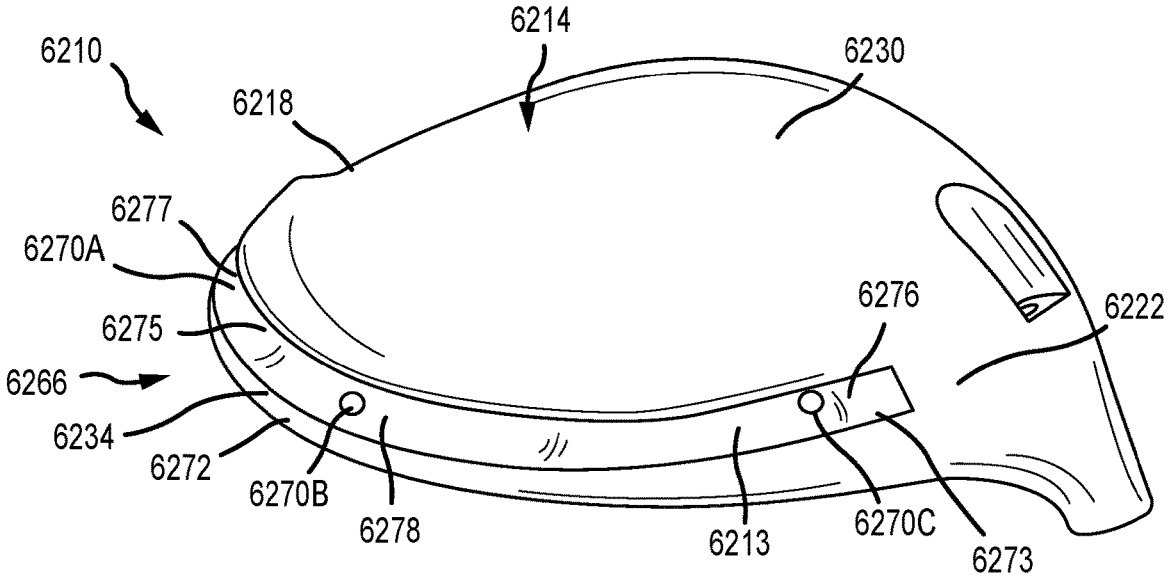
FIGS. 148, 149, and 151 are perspective views of a golf club head according to another embodiment.
Figure 149:
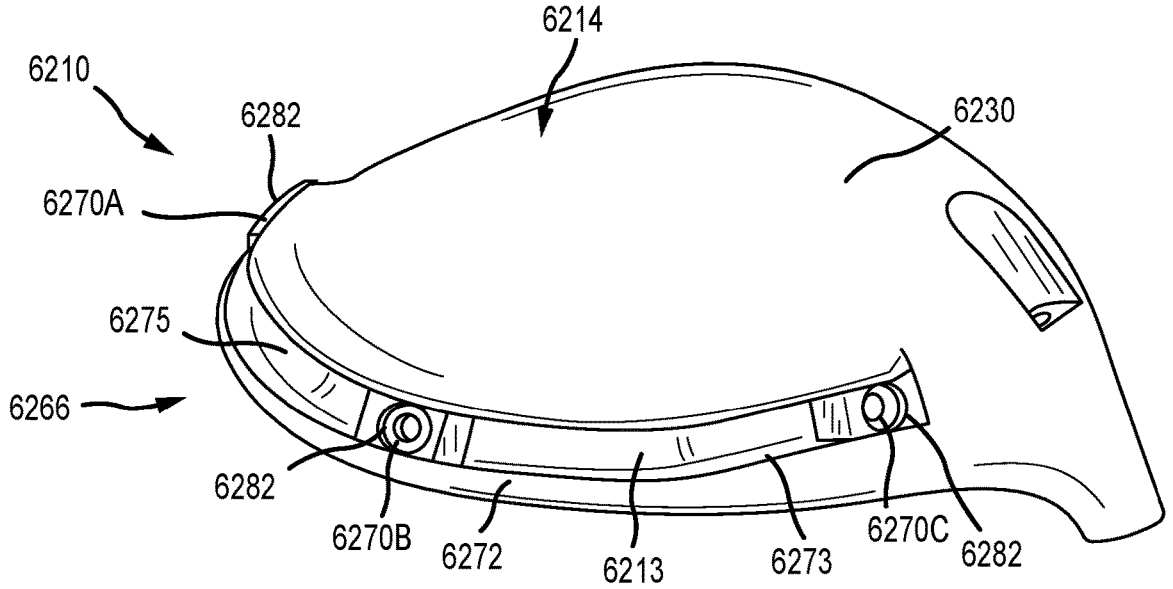
Figure 152:
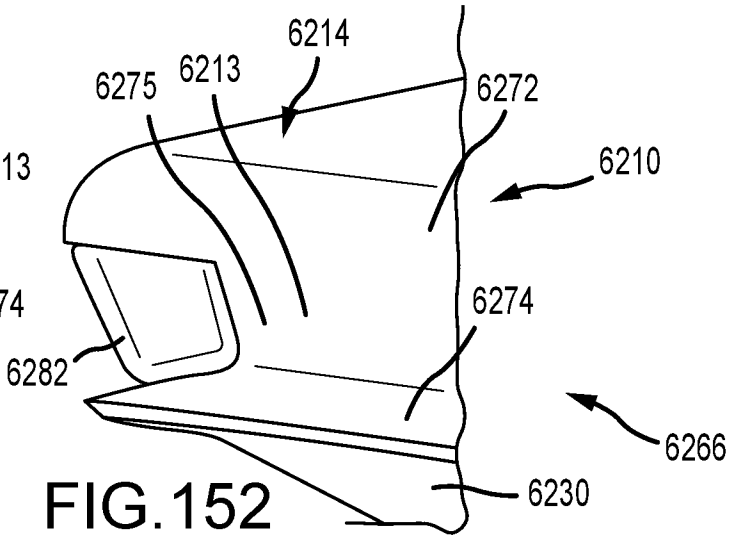
FIGS. 150 and 152 are partial perspective views of the club head of FIGS. 148, 149, and 151.
Figure 150:
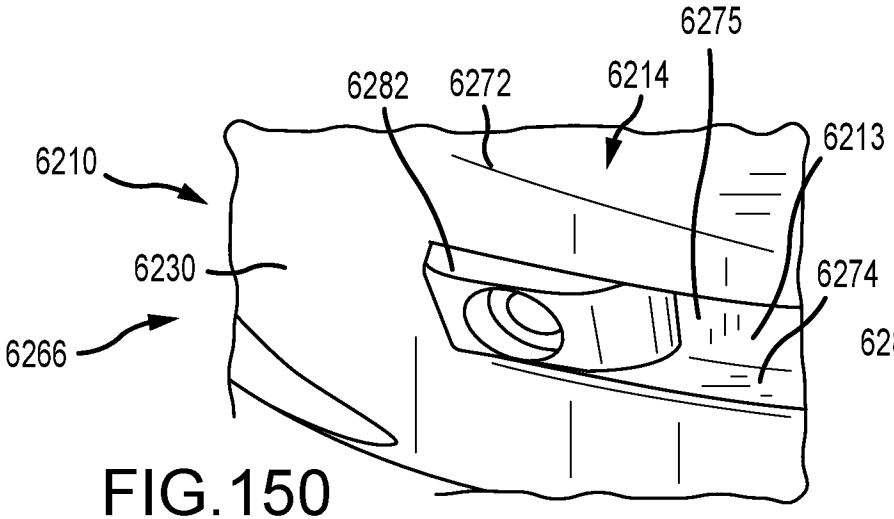
Figure 151:
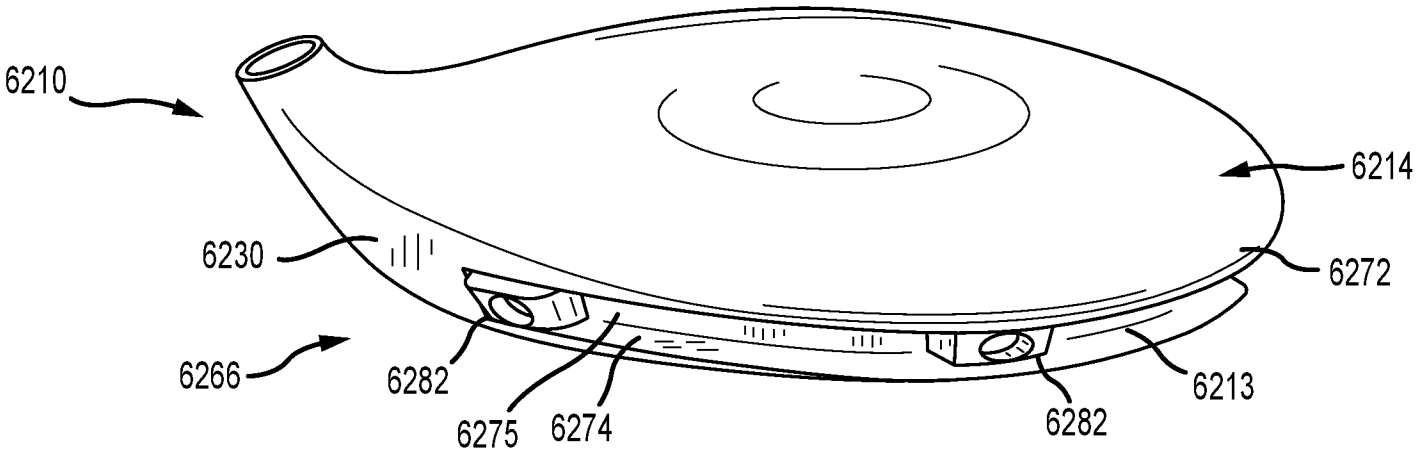

Referring again to FIGS. 148-152, the channel 6213 extends from the near the toe end 6218 in an arcuate manner to near the heel end 6222 following the contour of the trailing edge 6272. The channel 6213 is defined by a first surface 6273 (FIGS. 148 and 149), a second surface 6274 (FIGS. 150-152) disposed opposite the first surface 6273, and a third surface 6275 (FIGS. 148-152) that extends between the first surface 6273 and the second surface 6274. In some embodiments, the first surface 6273 extends parallel to the second surface 6274, and perpendicular to the third surface 6275. The channel 6213 includes a depth measured along a direction toward a center of the club head 6210, and/or along a direction that is normal to the third surface 6275. In the illustrated embodiment, the channel 6213 has a varying depth such that it is deeper in some areas than in other areas (e.g., may have a continuously or intermittently changing depth). In other embodiments, the channel depth 6213 can have an increasing, decreasing and/or constant depth along its length from the toe end 6218 to the heel end 6222. Thus, when a weight 6282 is coupled to the club head 6210 in one region of the channel 6213, the weight 6282 may fit flush in the channel 6213 and/or be concealed by the first and/or second surfaces 6273, 6274 (FIG. 152). When the weight 6282 is coupled to the club head 6210 in a different region of the channel 6213, a portion of the weight 6282 may protrude beyond the first and/or second surfaces 6273, 6274 (FIG. 150). As illustrated in FIG. 148, the channel 6213 includes a first region 6277 at a toe end 6218 of the club head 6210, a second region 6276 at a heel end 6222 of the club head 6210, and a third region 6278 disposed between the heel or heel end 6222 and the toe or toe end 6218, along a rear or back end 6234. The first region 6277 (and similarly the second region 6276) of the channel 6213 has a smaller depth, such that a portion of the weight 6282 protrudes out past the first surface 6273 and the second surface 6274 when the weight 6282 is coupled to the first region 6277 (FIG. 150). In contrast, the third region 6278 has a larger depth, such that the weight 6282 is concealed by the first surface 6273 and the second surface 6274 (e.g., as viewed along the y-axis 58 in FIG. 2) when the weight 6282 is coupled to the third region 6278 (FIG. 152). In other embodiments the channel 6213 includes other numbers and locations of regions than that illustrated. For example, in some embodiments, the channel 6213 includes more than one region where the weight 6282 is concealed when coupled. In some embodiments, the channel 6213 includes a region or regions at the heel or heel end 6222 and/or the toe or toe end 6218 where the weight 6282 is concealed when coupled. In some embodiments, the channel 6213 includes a region or regions at the rear or back end 6234 where a portion of the weight 6282 protrudes beyond the first surface 6273 and/or the second surface 6274 when coupled.

In many embodiments, the channel 6213 has a shallow depth ensuring the adjustable weight system 6266 remains low profile. For example, in some embodiments, the channel 6213 has a maximum depth of 0.25 inches. In other embodiments, the channel 6213 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6213 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6213 includes a width measured as the distance between the first surface 6273 and the second surface 6274. In the illustrated embodiments, the channel 6213 includes a constant width. In other embodiments, the channel 6213 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 148-152, the channel 6213 can include one or more features 6270A, B, C defining a discrete attachment location for securing a weight 6282 to the club head 6210. In contrast to other adjustable weighting systems wherein the weight can be coupled at any, or at an infinite, or at an unlimited number of locations across the channel. In the illustrated embodiment, the adjustable weight system 6266 comprises three features 6270A, B, C. The features 6270A, B, C are represented using a circle, as the features 6270A, B, C can be one of a protruding body, aperture, recess, ports capable of receiving a fastener, notches, tabs, cutout regions, ribs, grooves, pegs, hooks, magnets, programmable magnets or any other suitable attachment means. In other embodiments, the channel 6213 can comprise one, two, three, four, five, six, seven, eight, nine or ten features 6270. In many embodiments, the features 6270A, B, C are positioned on the third surface 6275 of the channel 6213. In other embodiments, the features 6270A, B, C can be positioned on the first, second and or third surface 6273, 6274, 6275 of the channel 6213.

For the purposes of this example, in the illustrated embodiment, the features 6270 A, B, C can be apertures configured to receive a screw. The screw can be comprised of a material having density, which is the same or less than the density of the club head 6210. As illustrated, the features 6270 A, B, C are disposed within the channel 6213 along the third surface 6275 such that one or more weights 6282 may be releasably coupled to the club head 6210 along the channel 6213. More specifically, a first feature 6270A is positioned along the first region 6277 of the channel 6213 near the toe end 6218, a second feature 6270C is positioned along the second region 6276 of the channel 6213 near the heel end 6222, and a third feature 6270C is positioned along a third region 6278 of the channel 6213 between the toe and heel end 6218, 6222.

With continued reference to FIGS. 148-152, the weights 6282 have a generally rectangular shape corresponding with the shape of the channel 6213. In other embodiments, the weights 6282 can have a circular, triangular, trapezoidal, polygonal or any other suitable shape configured to fit within the channel 6213. In the illustrated embodiment, the adjustable weighting system 6266 comprises three weights 6282 corresponding with the number of features 6270A, B, C. In other embodiments, the adjustable weighting system 6266 can comprise more or less weights 6282 than the number of features 6270A, B, C. For example, the adjustable weighting system 6266 can comprise one, two, three, four, five, six, seven, eight, nine or ten weights 6282. In the illustrated embodiment, the weights 6282 comprise apertures extending entirely through the weight 6282 sized and configured to receive a screw. The screw can be threaded through the weight 6282 into the corresponding feature 6270A, B, C, thus securing the weight 6282 to the channel 6213. In some embodiments, the weight 6282 can comprise a filet for receiving the top portion of the screw and therefore the screw can sit flush with the outer portion of the weight 6282. In other embodiments, the weight 6282 can comprise a blind aperture not extending entirely through the weight 6282. In other embodiments, the weight 6282 can be devoid of an aperture. In other embodiments, the weights 6282 can be configured to be couple to the features 6270 A, B, C through a friction fit, a snap-fit mechanism, with a set-screw, or with any other suitable structure.

Referring again to FIGS. 148-152, in the illustrated embodiment each of the features 6270A, B, C receives a weight 6282. In other embodiments, one or more of the features 6270A, B, C receives a weight 6282, while the remaining features 6270A, B, C are bare and uncovered, or are covered with another material or structure. In some embodiments, one or more of the features 6270A, B, C receives more than one weight 6282. In some embodiments, one or more of the features 6270A, B, C does not extend past an outer profile of the club head 10, such that even if the feature 6270A, B, C is left bare and uncovered, the feature 6270A, B, C and or channel 6213 will not interfere with or disrupt a golfer's swing.

In the illustrated embodiment, each of the weights 6282 is illustrated having the same shape and size. In other embodiments, the weights 6282 can vary in shape and size, resulting in different weights 6282 having varying masses. Further, in some embodiments, the weights 6282 are made of different materials such that they vary in mass. For example, one weight 6282 may be made of a high density material, such as tungsten, and the remaining weights 6282 may be made of a less dense material, such as polyurethane or another plastic. In other embodiments, the weights 6282 may have different sizes or volumes such that they vary in mass. For example, one weight 6282 may have a greater volume than the remaining weights 6282. In some embodiments, each of the weights 6282 may vary in volume from one another and thus vary in mass. In some embodiments, the weights 6282 may vary in both volume and material from one another. In some embodiments, one of the structures labeled as 6282 is not a weight, but rather a light-weight (e.g., light-weight plastic) cover that snap-fits or otherwise couples to one of the features 6270A, B, C. In some embodiments, the weights 6282 may vary between 0.1-50 g. For example, in embodiments having a plurality of weights 6282, one or more of the weights 82 may vary between 0-10 g, one or more of the weights 6282 may vary between 10-20 g, one or more of the weights 6282 may vary between 20-30, one or more of the weights 6282 may vary between 30-40 g, and one or more of the weights 6282 may vary between 40-50 g. In some embodiments, a first weight 6282 may vary between 0-10 g, a second weight 6282 may vary between 10-20 g, a third weight 6282 may vary between 20-30, a fourth weight 82 may vary between 30-40 g, and a fifth weight 6282 may vary between 40-50 g. In other embodiments, a first weight 6282 may vary between 1-5 g, and a second and third weight 6282 may vary between 5-30 g. In other embodiments, a first and second weight 6282 may vary between 1-10 g, and a third and fourth weight 6282, may vary between 5-25 g. In some embodiments, a first weight 6282 has a mass of 8.5 grams, and a second and third weight 6282 each have a mass of 1.5 grams. In other embodiments, a first weight 6282 has a mass of 12 grams, and a second and third weight 6282 each have a mass of 1.5 grams. In other embodiments, a first weight 6282 has a mass of 8.5 grams, and a second and third weight 6282 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The weights 6282 may be strategically positioned on the features 6270A, B, C to achieve a desired club head 6210 center of gravity position and/or moment of inertia and/or heel/toe bias. For example, in some embodiments, a heavier weight 6282 is positioned on the feature 6270B, located between the toe or toe end 6218 and the heel or heel end 6222, while lighter weights are positioned on the features 6270A, C near the toe or toe end 6218 and the heel or heel end 6222. The aforementioned weight 6282 placement can result in the center of gravity remaining centered while being shifted towards the back end 6234 of the club head 6210. In some embodiments, a heavier weight 6282 is positioned on the features 6270C near the heel or heel end 6222, while lighter weights 6282 are positioned on the feature 6270A near the toe or toe end 6218 and on the feature 6270B that is located between the toe or toe end 6218 and the heel or heel end 6222. The aforementioned weight 6282 placement can result in the center of gravity being shifted towards the heel end 6222 of the club head 6210. In some embodiments, a heavier weight 6282 is positioned on the feature 6270A near the toe or toe end 6218, while lighter weights 6282 are positioned on the feature 6270C near the heel or heel end 6222 and on the feature 6270B that is located between the toe or toe end 6218 and the heel or heel end 6222. The aforementioned weight 6282 placement can result in the center of gravity being shifted towards the toe end 6218 of the club head 6210. In many embodiments, one or more of the features 6270A, B, C are of equal size and shape, such that one weight may be interchangeably used with each of the features 6270A, B, C. In some embodiments, one or more of the features 6270A, B, C can have a differing size and shape, such that each feature 6270A, B, C has its own corresponding weight 6282 or set of weights 6282.

The adjustable weighting system 6266 of golf club head 6210 maintains or prevents a significant reduction in club head moment of inertia, and low and back club head center of gravity positioning, compared to a club head devoid of an adjustable weighting system. The adjustable weighting system 6266 of golf club head 6210 maintains a high club head moment of inertia and a low and back club head CG position due to the low profile of the weighting system and the perimeter positioning of the one or more weights. The club head 6210 having the adjustable weighting system 6266 can have similar or identical parameters and measurements as club head 100 described above.

FIGS. 153-156 illustrate a club head 6310 having a club head body 6314. The club head 6310 includes an adjustable weighting system 6366 that is adjustable by an end user to modify the club head 6310 center of gravity and/or moment of inertia and/or heel/toe bias to achieve desired performance characteristics (e.g., forgiveness, spin, trajectory) under various circumstances. The adjustable weighting system 6366 is a low profile system and thereby does not significantly shift or change the club head 6310 MOI when compared to a club head not including the adjustable weighting system 6366. Further, the low profile adjustable weighting system 6366 ensures that shifts in the club head 6310 CG occur mainly in a heel end 6322 to toe end 6318 direction keeping the overall club head 6310 CG in a low and back location.

Referring to FIGS. 153-156, the adjustable weighting system 6366 is similar to the adjustable weighting system 6266 and can comprise a channel or recessed portion 6313. The channel 6213 is defined by three surfaces 6373, 6374, 6375, each of which can be configured include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6366 includes a channel 6380 comprising a third surface 6375 including three discrete attachment locations. The three discrete attachment locations each comprise a feature 6370A, B, C. The features 6370A, B, C can be any of the features discussed above.

Referring again to FIGS. 153-156, the channel 6313 is similar to the channel 6213 in that it extends from the near the toe end 6318 in an arcuate manner to near the heel end 6322 following the contour of the trailing edge 6372 of the club head 6310. Further, similar to the channel 6213, the channel 6313 is defined by a first surface 6373 (FIGS. 153 and 154), a second surface 6374 (FIGS. 155-156) disposed opposite the first surface 6373, and a third surface 6375 (FIGS. 153-156) that extends between the first surface 6373 and the second surface 6374. In some embodiments, the first surface 6373 extends parallel to the second surface 6374, and perpendicular to the third surface 6375. In contrast to the channel 6213 of the adjustable weight system 6266, however, the channel 6313 is defined in part by additional end surfaces 6379 that directly intersect the first surface 6373, the second surface 6374, and the third surface 6375. As illustrated in FIGS. 153-156, the club head 6310 includes sloped surfaces 6380 extending from the additional end surfaces 6379 toward a remainder of the sole or bottom 6330 of the club head 6310. The sloped surfaces 6380 and/or additional end surfaces 6379 may provide added support and/or provide an abutment region or edge against which the weights 6383 may rest. In some embodiments the sloped surfaces 6380 also allow the weights 6382 to appear flush with an outer surface 6390 of the club head despite a depth of the channel 6313 decreasing toward a heel or heel end 6322 and toward a toe or toe end 6318 of the club head 6310. The flush orientation may improve air flow characteristics during a swing to improve the club head 6310 aerodynamics.

Figure 153:
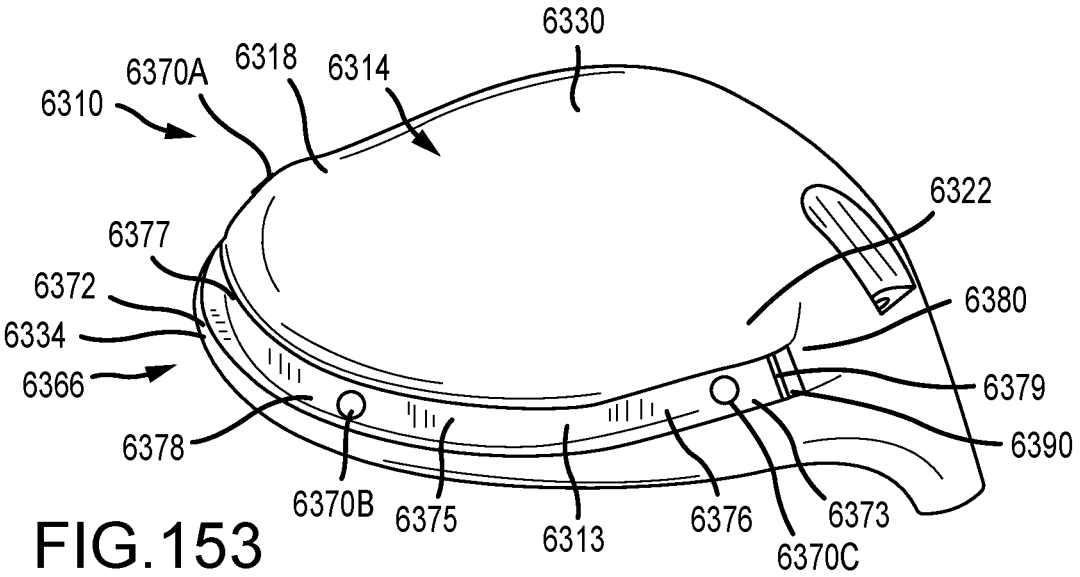
FIGS. 153-156 are perspective views of a golf club head according to another embodiment.
Figure 154:
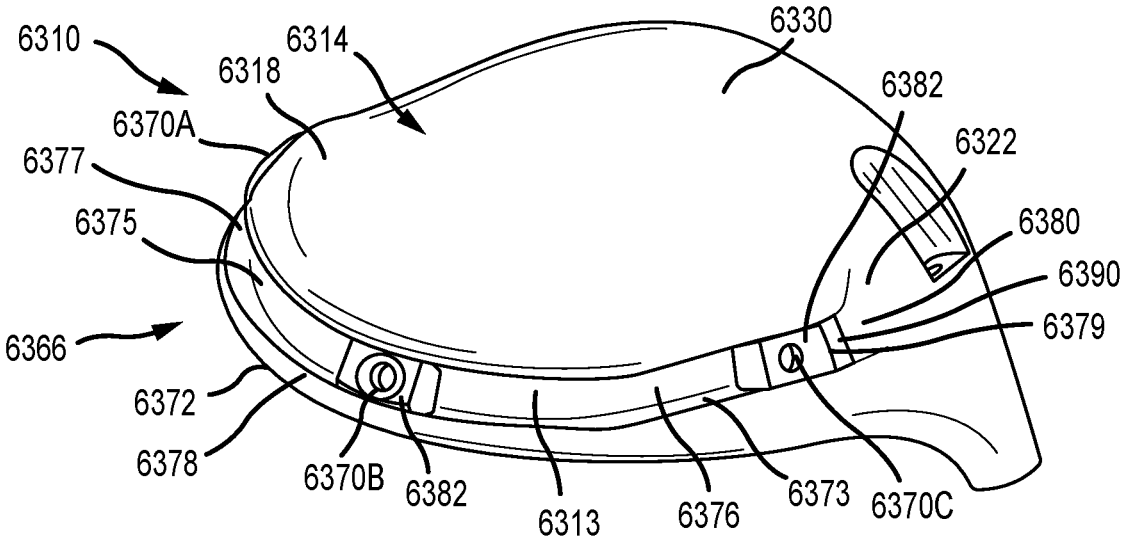
Figure 155:
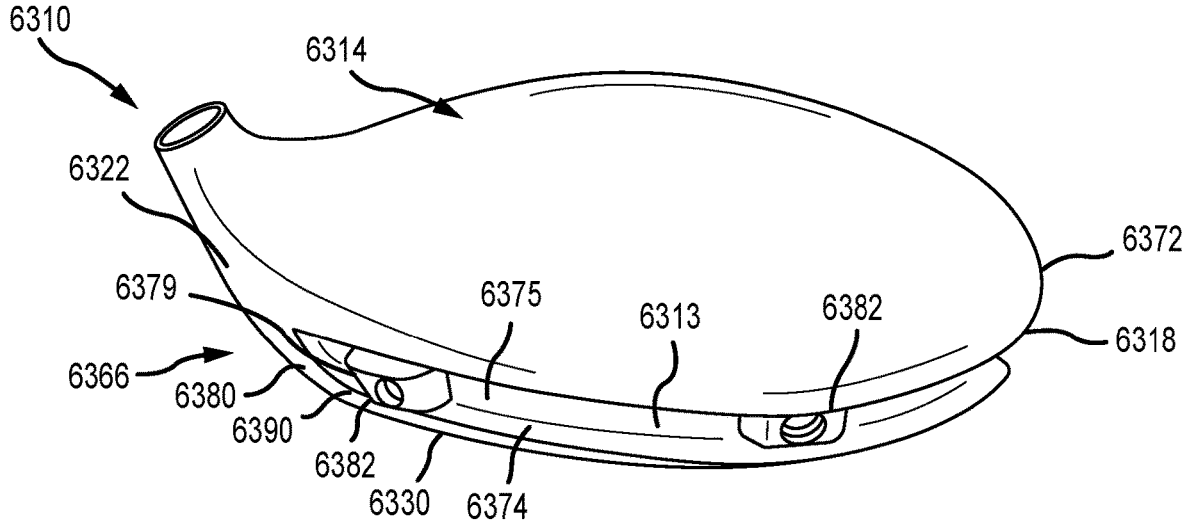
Figure 156:
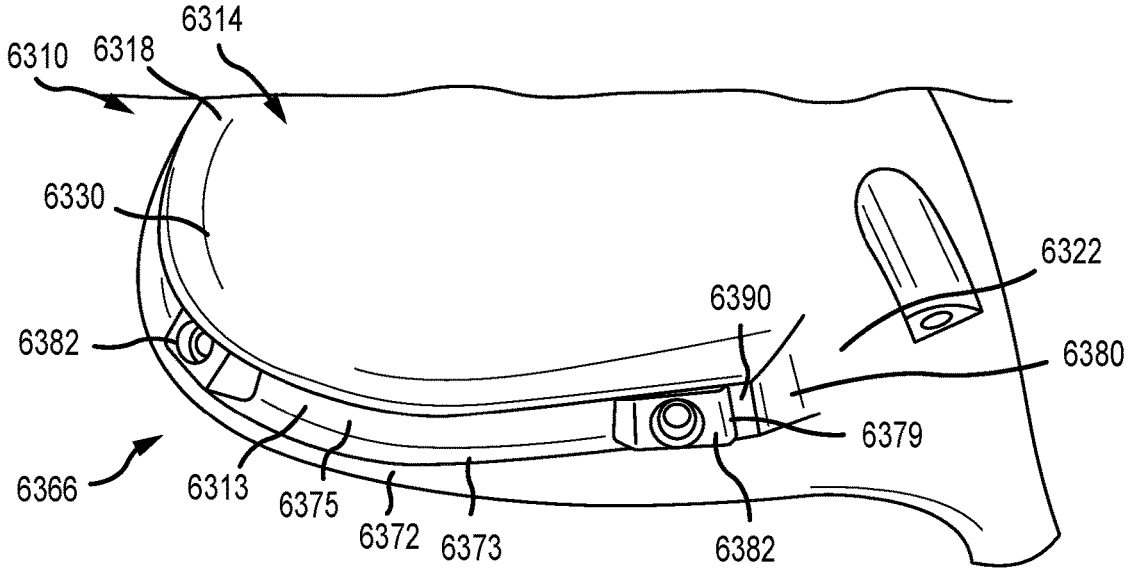

The channel 6313 includes a depth measured along a direction toward a center of the club head 6310, and/or along a direction that is normal to the third surface 6375. In the illustrated embodiment, the channel 6313 has a varying depth such that it is deeper in some areas than in other areas (e.g., may have a continuously or intermittently changing depth). In other embodiments, the channel depth 6313 can have an increasing, decreasing and/or constant depth along its length from the toe end 6318 to the heel end 6322. Thus, when a weight 6382 is coupled to the club head 6310 in one region of the channel 6313, the weight 6382 may fit flush in the channel 6313 and/or be concealed by the first and/or second surfaces 6373, 6374. When the weight 6382 is coupled to the club head 6310 in a different region of the channel 6313, a portion of the weight 6382 may protrude beyond the first and/or second surfaces 6373, 6374. As illustrated in FIG. 153, the channel 6313 includes a first region 6377 at a toe end 6318 of the club head 6310, a second region 6376 at a heel end 6322 of the club head 6310, and a third region 6378 disposed between the heel or heel end 6322 and the toe or toe end 6318, along a rear or back end 6334. The first region 6377 (and similarly the second region 6376) of the channel 6313 has a smaller depth, such that a portion of the weight 6382 protrudes out past the first surface 6373 and the second surface 6374 when the weight 6382 is coupled to the first region 6377. However, due to the sloped surface 6380 the weight 6382 can appear flush to the rest of the sole 6330 or heel end 6322 of the club head 6310. In contrast, the third region 6378 has a larger depth, such that the weight 6382 is concealed by the first surface 6373 and the second surface 6374 (e.g., as viewed along the y-axis 58 in FIG. 2) when the weight 6382 is coupled to the third region 6378. In other embodiments the channel 6313 includes other numbers and locations of regions than that illustrated. For example, in some embodiments, the channel 6313 includes more than one region where the weight 6382 is concealed when coupled. In some embodiments, the channel 6313 includes a region or regions at the heel or heel end 6322 and/or the toe or toe end 6318 where the weight 6382 is concealed when coupled. In some embodiments, the channel 6313 includes a region or regions at the rear or back end 6334 where a portion of the weight 6382 protrudes beyond the first surface 6373 and/or the second surface 6374 when coupled.

In many embodiments, the channel 6313 has a shallow depth ensuring the adjustable weight system 6366 remains low profile. For example, in some embodiments, the channel 6313 has a maximum depth of 0.25 inches. In other embodiments, the channel 6313 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6313 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6313 includes a width measured as the distance between the first surface 6373 and the second surface 6374. In the illustrated embodiments, the channel 6313 includes a constant width. In other embodiments, the channel 6313 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 153-156, the channel 6313 can include one or more features 6370A, B, C defining a discrete attachment location for securing a weight 6382 to the club head 6310. In contrast to other adjustable weighting systems wherein the weight can be coupled at any, or at an infinite, or at an unlimited number of locations across the channel. In the illustrated embodiment, the adjustable weighting system 6366 comprises 3 features 6370A, B, C. The features 6370A, B, C are represented using a circle, as the features 6370A, B, C can be one of a protruding body, aperture, recess, ports capable of receiving a fastener, notches, tabs, cutout regions, ribs, grooves, pegs, hooks, magnets, programmable magnets or any other suitable attachment means. In other embodiments, the channel 6313 can comprise one, two, three, four, five, six, seven, eight, nine or ten features 6370. In many embodiments, the features 6370A, B, C are positioned on the third surface 6375 of the channel 6313. In other embodiments, the features 6370A, B, C can be positioned on the first, second and/or third surface 6373, 6374, 6375 of the channel 6313.

For the purposes of this example, in the illustrated embodiment, the features 6370 A, B, C can be apertures configured to receive a screw. The screw can be comprised of a material having density which is the same or less than the density of the club head 6310. As illustrated, the features 6370 A, B, C are disposed within the channel 6313 along the third surface 6375 such that one or more weights 6382 may be releasable coupled to the club head 6310 along the channel 6313. More specifically, a first feature 6370A is positioned along the first region 6377 of the channel 6313 near the toe end 6318, a second feature 6370C is positioned along the second region 6376 of the channel 6313 near the heel end 6322, and a third feature 6370C is positioned along a third region 6378 of the channel 6313 between the toe and heel end 6318, 6322.

With continued reference to FIGS. 153-156, the weights 6382 are similar to the weights 6282 and have a generally rectangular shape corresponding with the shape of the channel 6313. In other embodiments, the weights 6382 can have a circular, triangular, trapezoidal, polygonal or any other suitable shape configured to fit within the channel 6313. In the illustrated embodiment, the adjustable weighting system 6366 comprises three weights 6382 corresponding with the number of features 6370A, B, C. In other embodiments, the adjustable weighting system 6366 can comprise more or less weights 6382 than the number of features 6370A, B, C. For example, the adjustable weighting system 6366 can comprise one, two, three, four, five, six, seven, eight, nine of ten weights 6382. In the illustrated embodiment, the weights 6382 comprise apertures extending entirely through the weight 6382 sized and configured to receive a screw (not shown). The screw can be threaded through the weight 6382 into the corresponding feature 6370A, B, C, thus securing the weight 6382 to the channel 6313. In some embodiments, the weight 6382 can comprise a filet for receiving the top portion of the screw and therefore the screw can sit flush with the outer portion of the weight 6382. In other embodiments, the weight 6382 can comprise a blind aperture not extending entirely through the weight 6382. In other embodiments, the weight 6382 can be devoid of an aperture. In other embodiments, the weights 6382 can be configured to be couple to the features 6370 A, B, C through a friction fit, a snap-fit mechanism, with a set-screw, or with any other suitable structure.

Referring again to FIGS. 153-156, in the illustrated embodiment each of the features 6370A, B, C receives a weight 6382. In other embodiments, one or more of the features 6370A, B, C receives a weight 6382, while the remaining features 6370A, B, C are bare and uncovered, or are covered with another material or structure. In some embodiments, one or more of the features 6370A, B, C receives more than one weight 6382. In some embodiments, one or more of the features 6370A, B, C does not extend past an outer profile of the club head 10, such that even if the feature 6370A, B, C is left bare and uncovered, the feature 6370A, B, C and or channel 6313 will not interfere with or disrupt a golfer's swing.

In the illustrated embodiment, each of the weights 6382 is illustrated having the same shape and size. In other embodiments, the weights 6382 can vary in shape and size, resulting in different weights 6382 having varying masses. Further, in some embodiments, the weights 6382 are made of different materials such that they vary in mass. For example, one weight 6382 may be made of a high density material, such as tungsten, and the remaining weights 6382 may be made of a less dense material, such as polyurethane or another plastic. In other embodiments, the weights 6382 may have different sizes or volumes such that they vary in mass. For example, one weight 6382 may have a greater volume than the remaining weights 6382. In some embodiments, each of the weights 6382 may vary in volume from one another and thus vary in mass. In some embodiments, the weights 6382 may vary in both volume and material from one another. In some embodiments, one of the structures labeled as 6382 is not a weight, but rather a light-weight (e.g., light-weight plastic) cover that snap-fits or otherwise couples to one of the features 6370A, B, C. In some embodiments, the weights 6382 may vary between 0.1-50 g. For example, in embodiments having a plurality of weights 6382, one or more of the weights 6382 may vary between 0-10 g, one or more of the weights 6382 may vary between 10-20 g, one or more of the weights 6382 may vary between 20-30, one or more of the weights 6382 may vary between 30-40 g, and one or more of the weights 6382 may vary between 40-50 g. In some embodiments, a first weight 6382 may vary between 0-10 g, a second weight 6382 may vary between 10-20 g, a third weight 6382 may vary between 20-30, a fourth weight 82 may vary between 30-40 g, and a fifth weight 6382 may vary between 40-50 g. In other embodiments, a first weight 6382 may vary between 1-5 g, and a second and third weight 6382 may vary between 5-30 g. In other embodiments, a first and second weight 6382 may vary between 1-10 g, and a third and fourth weight 6382, may vary between 5-25 g. In some embodiments, a first weight 6382 has a mass of 8.5 grams, and a second and third weight 6382 each have a mass of 1.5 grams. In other embodiments, a first weight 6382 has a mass of 12 grams, and a second and third weight 6382 each have a mass of 1.5 grams. In other embodiments, a first weight 6382 has a mass of 8.5 grams, and a second and third weight 6382 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g. The weights 6382 may be strategically positioned on the features 6370A, B, C to achieve a desired club head 6310 center of gravity position and/or moment of inertia and/or heel/toe bias. For example, in some embodiments, a heavier weight 6382 is positioned on the feature 6370B, located between the toe or toe end 6318 and the heel or heel end 6322, while lighter weights are positioned on the features 6370A, C near the toe or toe end 6318 and the heel or heel end 6322. The aforementioned weight 6382 placement can result in the center of gravity remaining centered while being shifted towards the back end 6334 of the club head 6310. In some embodiments, a heavier weight 6382 is positioned on the features 6370C near the heel or heel end 6322, while lighter weights 6382 are positioned on the feature 6370A near the toe or toe end 6318 and on the feature 6370B that is located between the toe or toe end 6318 and the heel or heel end 6322. The aforementioned weight 6382 placement can result in the center of gravity being shifted towards the heel end 6322 of the club head 6310. In some embodiments, a heavier weight 6382 is positioned on the feature 6370A near the toe or toe end 6318, while lighter weights 6382 are positioned on the feature 6370C near the heel or heel end 6322 and on the feature 6370B that is located between the toe or toe end 6318 and the heel or heel end 6322. The aforementioned weight 6382 placement can result in the center of gravity being shifted towards the toe end 6318 of the club head 6310 In many embodiments, one or more of the features 6370A, B, C are of equal size and shape, such that one weight may be interchangeably used with each of the features 6370A, B, C. In some embodiments, one or more of the features 6370A, B, C can have a differing size and shape, such that each feature 6370A, B, C has its own corresponding weight 6382 or set of weights 6382.

The adjustable weighting system 6366 of golf club head 6310 maintains or prevents a significant reduction in club head moment of inertia, and low and back club head center of gravity positioning, compared to a club head devoid of an adjustable weighting system. The adjustable weighting system 6366 of golf club head 6310 maintains a high club head moment of inertia and a low and back club head CG position due to the low profile of the weighting system and the perimeter positioning of the one or more weights. The club head 6310 having the adjustable weighting system 6366 can have similar or identical parameters and measurements as club head 100 described above.

Figure 157:
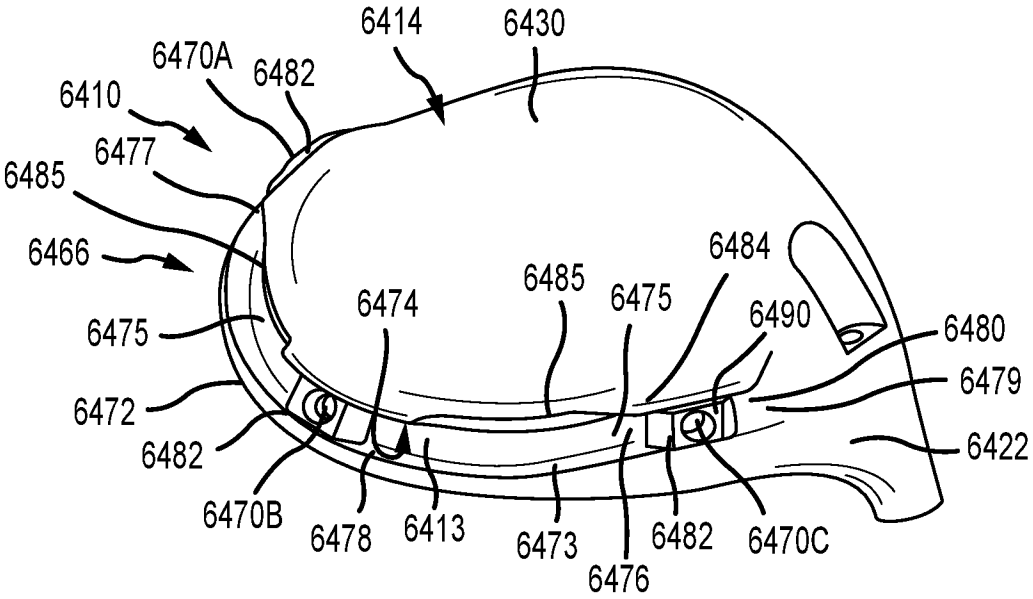
FIGS. 157-159 are perspective views of a golf club head according to another embodiment.
Figure 159:
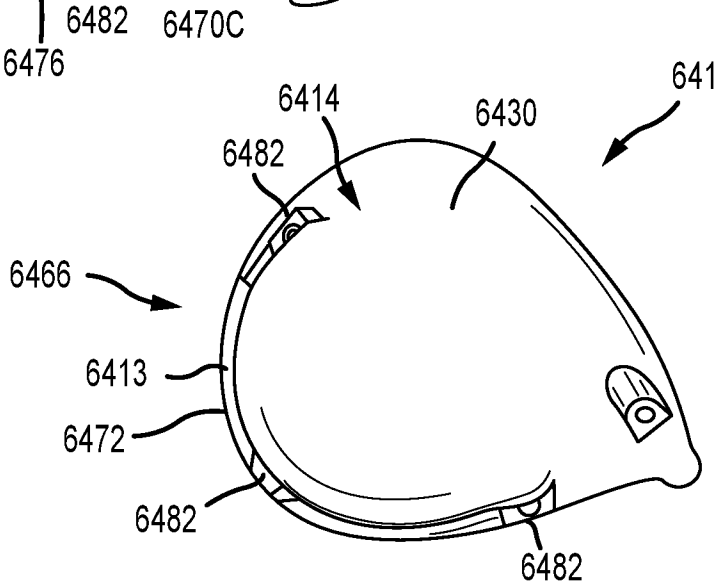
Figure 158:
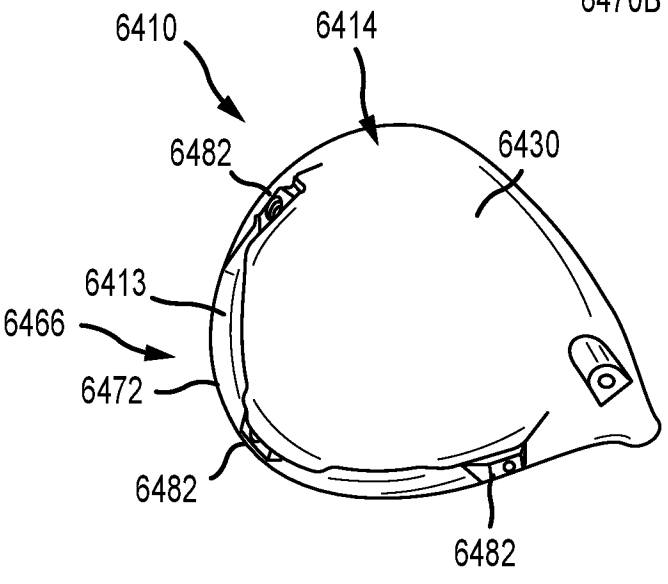

FIGS. 157-159 illustrate a club head 6410 having a club head body 6414. The club head 6410 includes an adjustable weighting system 6466 that is adjustable by an end user to modify the club head 6410 center of gravity and/or moment of inertia and/or heel/toe bias to achieve desired performance characteristics (e.g., forgiveness, spin, trajectory) under various circumstances. The adjustable weighting system 6466 is a low profile system and thereby does not significantly shift or change the club head 6410 MOI when compared to a club head not including the adjustable weighting system 6466. Further, the low profile adjustable weighting system 6466 ensures that shifts in the club head 6410 CG occur mainly in a heel end 6422 to toe end 6418 direction keeping the overall club head 6410 CG in a low and back location.

Referring to FIGS. 157-159, the adjustable weighting system 6466 is similar to the adjustable weighting systems 6266, 6366 and can comprise a channel or recessed portion 6413. The channel 6413 is defined by three surfaces 6473, 6474, 6475, each of which can be configured include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6466 includes a channel 6480 comprising a third surface 6475 including three discrete attachment locations. The three discrete attachment locations each comprise a feature 6470A, B, C. The features 6470A, B, C can be any of the features discussed above.

Referring again to FIGS. 157-159, the channel 6413 is similar to the channel 6313 in that it extends from the near the toe end 6418 in an arcuate manner to near the heel end 6422 following the contour of the trailing edge 6472 of the club head 6410. Further, similar to the channel 6313, the channel 6413 is defined by a first surface 6473 (FIGS. 153 and 154), a second surface 6474 (FIGS. 155-156) disposed opposite the first surface 6473, and a third surface 6475 (FIGS. 153-156) that extends between the first surface 6473 and the second surface 6474. In some embodiments, the first surface 6473 extends parallel to the second surface 6474, and perpendicular to the third surface 6475. In contrast to the channel 6313, the second surface 6474 of the channel 6413 forms a portion of a lip 6484 (FIG. 157). The lip 6484 includes notched portions 6485 that expose the channel 6413. In the illustrated embodiment, the notched portions 6485 of the lip 6484 correspond to areas along the channel 6413 that are between the weights 6482 (e.g., between locations for features 6470A, B, C). The lips 6484 may provide added support and/or provide an abutment region or edge against which the weights 6483 may rest. In some embodiments, the lips 6485 can also allow the weights 6482 to appear flush with an outer surface 6490 of the club head despite a depth of the channel 6413 decreasing at that location. The flush orientation may improve air flow characteristics during a swing to improve the club head 6410 aerodynamics. In other embodiments, any number of lips 6484 and/or notched regions 6485 can exist along the length of the channel 6413, corresponding with the number of features 6470. Further, similar to the channel 6313, the channel 6413 is also defined in part by additional end surfaces 6479 that directly intersect the first surface 6473, the second surface 6474, and the third surface 6475. As illustrated in FIGS. 157-159, the club head 6410 includes sloped surfaces 6480 extending from the additional end surfaces 6479 toward a remainder of the sole or bottom 6430 of the club head 6410. The sloped surfaces 6480 and/or additional end surfaces 6479 may provide added support and/or provide an abutment region or edge against which the weights 6483 may rest. In some embodiments the sloped surfaces 6480 also allow the weights 6482 to appear flush with an outer surface 6490 of the club head despite a depth of the channel 6413 decreasing toward a heel or heel end 6422 and toward a toe or toe end 6418 of the club head 6410. The flush orientation may further improve air flow characteristics during a swing to improve the club head 6410 aerodynamics.

The channel 6413 includes a depth measured along a direction toward a center of the club head 6410, and/or along a direction that is normal to the third surface 6475. The depth can be measured from the first surface 6473 to the third surface 6375. In the illustrated embodiment, the channel 6413 has a varying depth such that it is deeper in some areas than in other areas (e.g., may have a continuously or intermittently changing depth). In other embodiments, the channel depth 6413 can have an increasing, decreasing and/or constant depth along its length from the toe end 6418 to the heel end 6422. Thus, when a weight 6482 is coupled to the club head 6410 in one region of the channel 6413, the weight 6482 may fit flush in the channel 6413 and/or be concealed by the first and/or second surfaces 6473, 6474. When the weight 6482 is coupled to the club head 6410 in a different region of the channel 6413, a portion of the weight 6482 may protrude beyond the first and/or second surfaces 6473, 6474. As illustrated in FIG. 157, the channel 6413 includes a first region 6477 at a toe end 6418 of the club head 6410, a second region 6476 at a heel end 6422 of the club head 6410, and a third region 6478 disposed between the heel or heel end 6422 and the toe or toe end 6418, along a rear or back end 6434. The first region 6477 (and similarly the second region 6476) of the channel 6413 has a smaller depth, such that a portion of the weight 6482 protrudes out past the first surface 6473 when the weight 6482 is coupled to the first region 6477. However, due to the sloped surface 6380 and the lip 6484 the weight 6482 can appear flush to the rest of the sole 6430 or heel end 6422 of the club head 6410. In contrast, the third region 6478 has a larger depth, such that the weight 6482 is concealed by the first surface 6473 and the second surface 6474 (e.g., as viewed along the y-axis 58 in FIG. 2) when the weight 6482 is coupled to the third region 6478. The lip 6484 positioned in the third region 6478 can extend beyond the perimeter surface of the weight 6482 further improving aerodynamics of the golf club head 6410. In other embodiments the channel 6413 includes other numbers and locations of regions than that illustrated. For example, in some embodiments, the channel 6413 includes more than one region where the weight 6482 is concealed when coupled. In some embodiments, the channel 6413 includes a region or regions at the heel or heel end 6422 and/or the toe or toe end 6418 where the weight 6482 is concealed when coupled. In some embodiments, the channel 6413 includes a region or regions at the rear or back end 6434 where a portion of the weight 6482 protrudes beyond the first surface 6473 and/or the second surface 6474 when coupled.

In many embodiments, the channel 6413 has a shallow depth ensuring the adjustable weight system 6466 remains low profile. For example, in some embodiments, the channel 6413 has a maximum depth of 0.25 inches. In other embodiments, the channel 6413 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6413 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6413 includes a width measured as the distance between the first surface 6473 and the second surface 6474. In the illustrated embodiments, the channel 6413 includes a constant width. In other embodiments, the channel 6413 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 157-159, the channel 6413 can include one or more features 6470A, B, C defining a discrete attachment location for securing a weight 6482 to the club head 6410. In contrast to other adjustable weighting systems wherein the weight can be coupled at any, or at an infinite, or at an unlimited number of locations across the channel. In the illustrated embodiment, the adjustable weighting system 6466 comprises 3 features 6470A, B, C. The features 6470A, B, C are represented using a circle, as the features 6470A, B, C can be one of a protruding body, aperture, recess, ports capable of receiving a fastener, notches, tabs, cutout regions, ribs, grooves, pegs, hooks, magnets, programmable magnets or any other suitable attachment means. In other embodiments, the channel 6413 can comprise one, two, three, four, five, six, seven, eight, nine or ten features 6470. In many embodiments, the features 6470A, B, C are positioned on the third surface 6475 of the channel 6413. In other embodiments, the features 6470A, B, C can be positioned on the first, second and/or third surface 6473, 6474, 6475 of the channel 6413.

For the purposes of this example, in the illustrated embodiment, the features 6470 A, B, C can be apertures configured to receive a screw. The screw can be comprised of a material having density which is the same or less than the density of the club head 6410. As illustrated, the features 6470 A, B, C are disposed within the channel 6413 along the third surface 6475 such that one or more weights 6482 may be releasable coupled to the club head 6410 along the channel 6413. More specifically, a first feature 6470A is positioned along the first region 6477 of the channel 6413 near the toe end 6418, a second feature 6470C is positioned along the second region 6476 of the channel 6413 near the heel end 6422, and a third feature 6470C is positioned along a third region 6478 of the channel 6413 between the toe and heel end 6418, 6422.

With continued reference to FIGS. 157-159, the weights 6482 are similar to the weights 6282, 6382 and have a generally rectangular shape corresponding with the shape of the channel 6413. In other embodiments, the weights 6482 can have a circular, triangular, trapezoidal, polygonal or any other suitable shape configured to fit within the channel 6413. In the illustrated embodiment, the adjustable weighting system 6466 comprises three weights 6482 corresponding with the number of features 6470A, B, C. In other embodiments, the adjustable weighting system 6466 can comprise more or less weights 6482 than the number of features 6470A, B, C. For example, the adjustable weighting system 6466 can comprise one, two, three, four, five, six, seven, eight, nine of ten weights 6482. In the illustrated embodiment, the weights 6482 comprise apertures extending entirely through the weight 6482 sized and configured to receive a screw (not shown). The screw can be threaded through the weight 6482 into the corresponding feature 6470A, B, C, thus securing the weight 6482 to the channel 6413. In some embodiments, the weight 6482 can comprise a filet for receiving the top portion of the screw and therefore the screw can sit flush with the outer portion of the weight 6482. In other embodiments, the weight 6482 can comprise a blind aperture not extending entirely through the weight 6482. In other embodiments, the weight 6482 can be devoid of an aperture. In other embodiments, the weights 6482 can be configured to be couple to the features 6470 A, B, C through a friction fit, a snap-fit mechanism, with a set-screw, or with any other suitable structure.

Referring again to FIGS. 157-159, in the illustrated embodiment each of the features 6470A, B, C receives a weight 6482. In other embodiments, one or more of the features 6470A, B, C receives a weight 6482, while the remaining features 6470A, B, C are bare and uncovered, or are covered with another material or structure. In some embodiments, one or more of the features 6470A, B, C receives more than one weight 6482. In some embodiments, one or more of the features 6470A, B, C does not extend past an outer profile of the club head 6410, such that even if the feature 6470A, B, C is left bare and uncovered, the feature 6470A, B, C and or channel 6413 will not interfere with or disrupt a golfer's swing.

In the illustrated embodiment, each of the weights 6482 is illustrated having the same shape and size. In other embodiments, the weights 6482 can vary in shape and size, resulting in different weights 6482 having varying masses. Further, in some embodiments, the weights 6482 are made of different materials such that they vary in mass. For example, one weight 6482 may be made of a high density material, such as tungsten, and the remaining weights 6482 may be made of a less dense material, such as polyurethane or another plastic. In other embodiments, the weights 6482 may have different sizes or volumes such that they vary in mass. For example, one weight 6482 may have a greater volume than the remaining weights 6482. In some embodiments, each of the weights 6482 may vary in volume from one another and thus vary in mass. In some embodiments, the weights 6482 may vary in both volume and material from one another. In some embodiments, one of the structures labeled as 6482 is not a weight, but rather a light-weight (e.g., light-weight plastic) cover that snap-fits or otherwise couples to one of the features 6470A, B, C. In some embodiments, the weights 6482 may vary between 0.1-50 g. For example, in embodiments having a plurality of weights 6482, one or more of the weights 6482 may vary between 0-10 g, one or more of the weights 6482 may vary between 10-20 g, one or more of the weights 6482 may vary between 20-30, one or more of the weights 6482 may vary between 30-40 g, and one or more of the weights 6482 may vary between 40-50 g. In some embodiments, a first weight 6482 may vary between 0-10 g, a second weight 6482 may vary between 10-20 g, a third weight 6482 may vary between 20-30, a fourth weight 82 may vary between 30-40 g, and a fifth weight 6482 may vary between 40-50 g. In other embodiments, a first weight 6482 may vary between 1-5 g, and a second and third weight 6482 may vary between 5-30 g. In other embodiments, a first and second weight 6482 may vary between 1-10 g, and a third and fourth weight 6482, may vary between 5-25 g. In some embodiments, a first weight 6482 has a mass of 8.5 grams, and a second and third weight 6482 each have a mass of 1.5 grams. In other embodiments, a first weight 6482 has a mass of 12 grams, and a second and third weight 6482 each have a mass of 1.5 grams. In other embodiments, a first weight 6482 has a mass of 8.5 grams, and a second and third weight 6482 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

The weights 6482 may be strategically positioned on the features 6470A, B, C to achieve a desired club head 6410 center of gravity position and/or moment of inertia and/or heel/toe bias. For example, in some embodiments, a heavier weight 6482 is positioned on the feature 6470B, located between the toe or toe end 6418 and the heel or heel end 6422, while lighter weights are positioned on the features 6470A, C near the toe or toe end 6418 and the heel or heel end 6422. The aforementioned weight 6482 placement can result in the center of gravity remaining centered while being shifted towards the back end 6434 of the club head 6410. In some embodiments, a heavier weight 6482 is positioned on the features 6470C near the heel or heel end 6422, while lighter weights 6482 are positioned on the feature 6470A near the toe or toe end 6418 and on the feature 6470B that is located between the toe or toe end 6418 and the heel or heel end 6422. The aforementioned weight 6482 placement can result in the center of gravity being shifted towards the heel end 6422 of the club head 6410. In some embodiments, a heavier weight 6482 is positioned on the feature 6470A near the toe or toe end 6418, while lighter weights 6482 are positioned on the feature 6470C near the heel or heel end 6422 and on the feature 6470B that is located between the toe or toe end 6418 and the heel or heel end 6422. The aforementioned weight 6482 placement can result in the center of gravity being shifted towards the toe end 6418 of the club head 6410. In many embodiments, one or more of the features 6470A, B, C are of equal size and shape, such that one weight may be interchangeably used with each of the features 6470A, B, C. In some embodiments, one or more of the features 6470A, B, C can have a differing size and shape, such that each feature 6470A, B, C has its own corresponding weight 6482 or set of weights 6482.

The adjustable weighting system 6466 of golf club head 6410 maintains or prevents a significant reduction in club head moment of inertia, and low and back club head center of gravity positioning, compared to a club head devoid of an adjustable weighting system. The adjustable weighting system 6466 of golf club head 6410 maintains a high club head moment of inertia and a low and back club head CG position due to the low profile of the weighting system and the perimeter positioning of the one or more weights. The club head 6410 having the adjustable weighting system 6466 can have similar or identical parameters and measurements as club head 100 described above.

Figure 160:
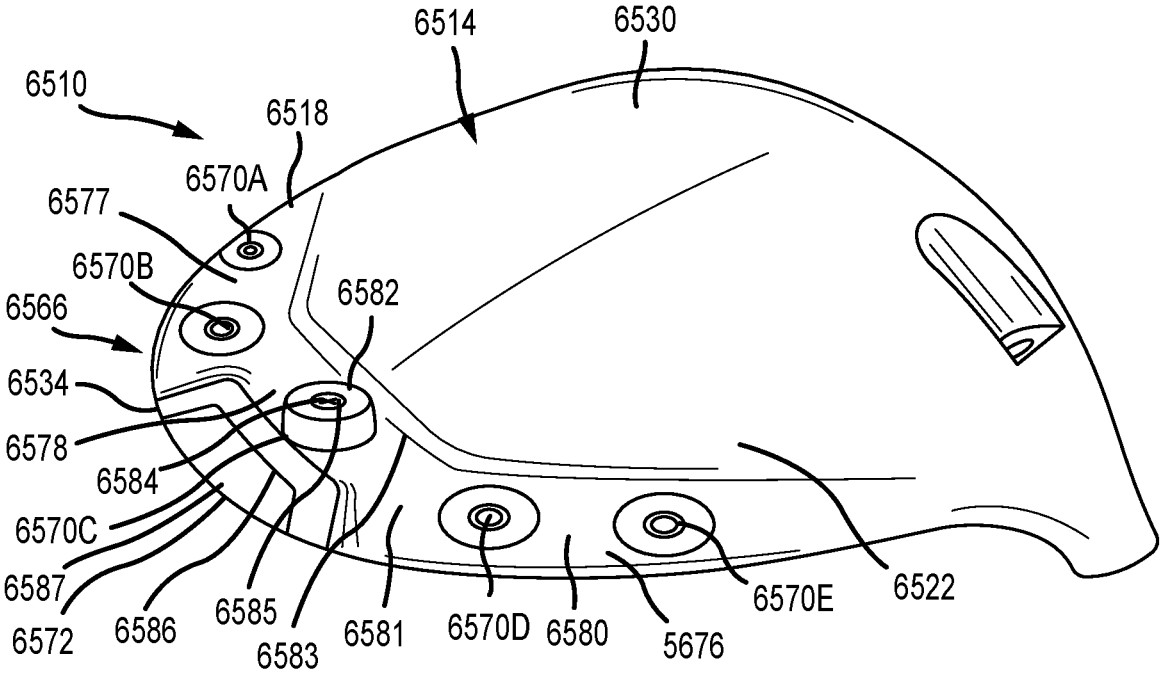
FIGS. 160 and 160A are perspective views of a golf club head according to another embodiment.
Figure 160A:
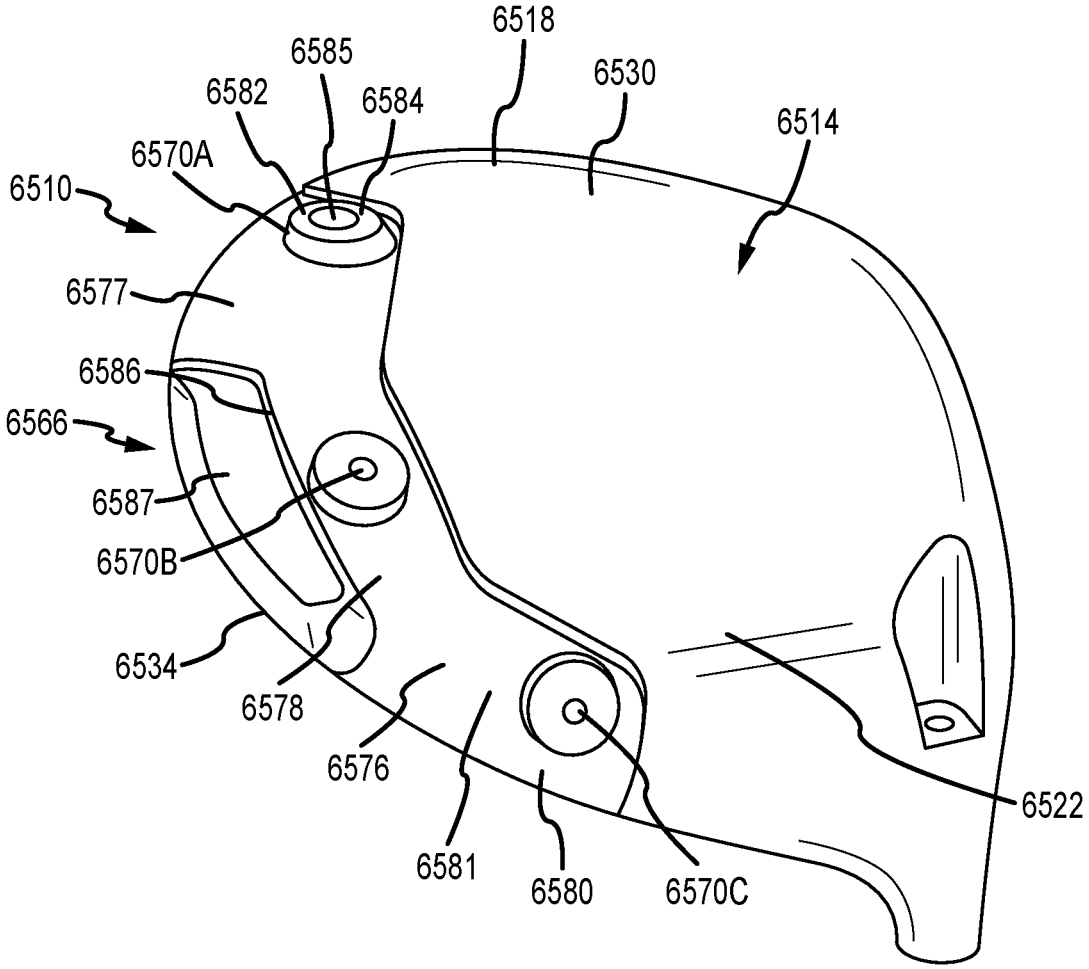

FIGS. 160 and 160A illustrate a club head 6510 (and a variation thereof in FIG. 160A) having a club head body 6514. The club head 6510 includes an adjustable weighting system 6566 that is adjustable by an end user to modify the club head 6510 center of gravity and/or moment of inertia and/or heel/toe bias to achieve desired performance characteristics (e.g., forgiveness, spin, trajectory) under various circumstances. The adjustable weighting system 6566 is a low profile system and thereby does not significantly shift or change the club head 6510 MOI when compared to a club head not including the adjustable weighting system 6566. Further, the low profile adjustable weighting system 6566 ensures that shifts in the club head 6510 CG occur mainly in a heel end 6522 to toe end 6518 direction keeping the overall club head 6510 CG in a low and back location.

Referring to FIGS. 160 and 160A, the adjustable weighting system 6566 can comprise a recessed portion 6580. The recessed portion 6580 comprises a recessed surface 6581 configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6566 includes a recessed surface 6581 comprising three discrete attachment locations. The three discrete attachment locations each comprises feature 6570A, B, C. The features 6570A, B, C can be any of the features discussed above.

Referring again to FIGS. 160 and 160A, the recessed portion 6580 extends from near the toe end 518 in an arcuate manner to the heel end 6522 generally following the contour of the trailing edge 6572. The recessed portion 6580 is defined by a recessed surface 6581 being offset from the sole 6520 of the club head 6510 by a wall 6583. Generally, the recessed surface 6581 extends substantially parallel to the sole 6530 of the club head 6510 while the wall 6583 generally extends substantially perpendicular to the recessed surface 6581. In other embodiments, the wall 6583 can extend at an angle between the recessed surface 6581 and the sole 6530. The recessed portion 6581 includes a depth measured as the distance from the recessed surface 6581 to the sole 6530 in a direction perpendicular to the recessed surface 6581. In the illustrated embodiment, the recessed portion 6580 has a varying depth such that it is deeper in some areas than in other areas (e.g., may have a continuously or intermittently changing depth). For example, in some embodiments, the recessed portion 6580 can have an increasing, decreasing and/or constant depth along its length from the toe end 6518 to the heel end 6522. Thus, when a weight 6582 is coupled to the club head 6510 in one region of the recessed portion 6580, the weight 6582 may be concealed by the wall 6583. When the weight 6582 is coupled to the club head 6510 in a different region of the recessed portion 6580, a portion of the weight 6582 may protrude outward from the wall 6583. As illustrated in FIGS. 160 and 160A, the recessed portion 6580 comprises a first portion 6577 at a toe end 6518 of the club head 6510, a second region 6576 at the heel end 6522 of the club head 6510, and a third region 6578 disposed between the heel end 6522 and the toe end 6522 along or near the back end 6534. Referring to FIG. 160, the first region 6577 (and similarly the second region 6576) of the recessed portion depth which decreases from near the center towards the toe end 6518 (heel end 6522 for the second region 6576), and the third region 6578 has a constant larger depth than the first and second regions 6577, 6576, such that the weight 6582 is concealed by the wall 6583 (e.g., as viewed along the y-axis 58 in FIG. 2) when the weight 6582 is coupled to the third region 6578 (FIG. 160). Turning now to FIG. 160A, in another embodiment, the first region 6577, the second region 6576, and the third region 6578 have a constant depth, such that the weight 6572 is concealed by the wall 6583 when the weight 6582 is couple to any of the first, second or third regions 6577, 6576, 6578. In other embodiments, the channel 6513 includes other numbers and locations of regions than that illustrated. For example, in some embodiments, the channel 6513 includes more than one region where the weight 6582 is concealed when coupled. Further, the adjustable weighting system 6566 includes an additional feature 6570 in the form of a recess or notch 6586 that is sized and shaped to receive a larger weight 6587 (e.g., a tungsten weight). In some embodiments, the larger weight 6587 remains fixed on the club head 6510, and is not repositionable.

In many embodiments, the channel 6513 has a shallow depth ensuring the adjustable weight system 6566 remains low profile. For example, in some embodiments, the recessed portion 6580 has a maximum depth of 0.25 inches. In other embodiments, the recessed portion 6580 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 6580 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 6580 includes a width measured as the distance between the wall 6583 and the trailing edge 6572 or back end 6534. In the illustrated embodiments, the recessed portion 6580 includes a varying width. The first region 6577 has an increasing width from the toe end 6518 towards the center or third region 6578, the second region 6576 comprises an increasing width from the heel end 6522 towards the center and or third portion 6578, and the third region 6578 comprises a constant width which is smaller than the average width of the first and or second regions 6577, 6576. In other embodiments, the recessed portion 6580 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 160 and 160A, the recessed portion 6580 can include one or more features 6570 defining a discrete attachment location for securing a weight 6582 to the club head 6510. In contrast to other adjustable weighting systems wherein the weight can be coupled at any, or at an infinite, or at an unlimited number of locations across the recessed portion. Referring to FIG. 160, in the illustrated embodiment, the recessed portion 6580 includes five features 6570A, B, C, D, E. The features 6570A, B, C, D, E are shown as apertures configured to receive a screw fastener 6585. The screw fastener 6585 can be comprised of a material having density which is the same or less than the density of the club head 6510. In other embodiments, the features 6570A, B, C, D, E can be a protruding body, aperture, recess, ports capable of receiving a fastener, notches, tabs, cutout regions, ribs, grooves, pegs, hooks, magnets, programmable magnets or any other suitable attachment means. In other embodiments, the recessed portion 6580 can comprise one, two, three, four, five, six, seven, eight, nine or ten features 6570. For example, referring to FIG. 160A, the adjustable weighting system 6566 includes three features 6570A, B, C.

As illustrated, the features 6570A, B, C, D, E are disposed within the recessed portion 6580 along the recessed surface 6581 such that one or more weights 6582 may be releasable coupled to the club head 6510 along the recessed portion 6580. More specifically, a first feature 6570A is positioned along the first region 6577 of the recessed portion 6580 near the toe end 6518, a second feature 6570E is positioned along the second region 6576 of the recessed portion near the heel end 6522, a third feature 6570C is positioned along a third region 6578 of the recessed portion 6580 between the toe and heel end 6518, 6522, a fourth feature 6570B is positioned between the first feature 6570A and the third feature 6570C, and a fifth feature 6570D positioned between the third feature 6570C and the second feature 6570E. In some embodiments, the features 6570A, B, C, D, E can be positioned on the wall 6583 of the recessed portion 6580. In other embodiments, the features 6570A, B, C can be positioned on the wall 6583 and the recessed surface 6581 of the recessed portion 6580.

With continued reference to FIGS. 160 and 160A, the weights 6582 have a generally cylindrical shape. In other embodiments, the weights 6582 can have a circular, triangular, trapezoidal, polygonal or any other suitable shape configured to fit within the recessed portion 6580. In the illustrated embodiment, the adjustable weighting system 6566 comprises one weight 6582. In other embodiments, the adjustable weighting system 6566 can comprise three or five weights 6582 corresponding with the number of features 6570A, B, C, D, E. In other embodiments, the adjustable weighting system 6566 can comprise more or less weights 6582 than the number of features 6570A, B, C,D, E. For example, the adjustable weighting system 6566 can comprise one, two, three, four, five, six, seven, eight, nine of ten weights 6582. The weights 6582 comprise apertures extending entirely through the weight 6582 sized and configured to receive a screw fastener 6585. The screw fastener 6585 can be thread through the weight 6582 into the corresponding feature 6570A, B, C, D, E thus securing the weight 6582 to the recessed portion 6580. In some embodiments, the weight 6582 can comprise a filet for receiving the top portion of the screw fastener 6585 and therefore the screw fastener 6585 can sit flush with the outer portion of the weight 6582. In other embodiments, the weights 6582 can be configured to be couple to the features 6570 A, B, C, D, E through a friction fit, a snap-fit mechanism, with a set-screw, or with any other suitable structure.

In embodiments wherein the adjustable weight system 6566 comprises more than one weight 6582, each of the weights 6582 can have the same shape and size. In other embodiments, the weights 6582 can vary in shape and size, resulting in weights 6582 having varying masses. Further, in some embodiments, the weights 6582 are made of different materials such that they vary in mass. For example, one weight 6582 may be made of a high density material, such as tungsten, and the remaining weights 6582 may be made of a less dense material, such as polyurethane or another plastic. In other embodiments, the weights 6582 may have different sizes or volumes such that they vary in mass. For example, one weight 6582 may have a greater volume than the remaining weights 6582. In some embodiments, each of the weights 6582 may vary in volume from one another and thus vary in mass. In some embodiments, the weights 6582 may vary in both volume and material from one another. In some embodiments, one of the structures labeled as 6582 is not a weight, but rather a light-weight (e.g., light-weight plastic) cover that snap-fits or otherwise couples to one of the features 6570A, B, C. In some embodiments, the weights 6582 may vary between 0.1-50 g. For example, in embodiments having a plurality of weights 6582, one or more of the weights 82 may vary between 0-10 g, one or more of the weights 6582 may vary between 10-20 g, one or more of the weights 6582 may vary between 20-30, one or more of the weights 6582 may vary between 30-40 g, and one or more of the weights 6582 may vary between 40-50 g. In some embodiments, a first weight 6582 may vary between 0-10 g, a second weight 6582 may vary between 10-20 g, a third weight 6582 may vary between 20-30, a fourth weight 82 may vary between 30-40 g, and a fifth weight 6582 may vary between 40-50 g. In other embodiments, a first weight 6582 may vary between 1-5 g, and a second and third weight 6582 may vary between 5-30 g. In other embodiments, a first and second weight 6582 may vary between 1-10 g, and a third and fourth weight 6582, may vary between 5-25 g. In some embodiments, a first weight 6582 has a mass of 8.5 grams, and a second and third weight 6582 each have a mass of 1.5 grams. In other embodiments, a first weight 6582 has a mass of 12 grams, and a second and third weight 6582 each have a mass of 1.5 grams. In other embodiments, a first weight 6582 has a mass of 8.5 grams, and a second and third weight 6582 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 160 and 160A, in the illustrated embodiment one of the features 6270A, B, C, D, E receives a weight 6582, while the remaining features 6570A, B, C, D, E are bare and uncovered, or are covered with another material or structure. In other embodiments, each of the features 6570A, B, C, D, E receives a weight 6582. In some embodiments, one or more of the features 6570A, B, C receives more than one weight 6582. In some embodiments, one or more of the features 6570A, B, C, D, E does not extend past an outer profile of the club head 6510, such that even if the feature 6570A, B, C, D, E is left bare and uncovered, the feature 6570A, B, C, D, E and or recessed portion 6580 will not interfere with or disrupt a golfer's swing.

The weights 6582 may be strategically positioned on the features 6570A, B, C, D, E to achieve a desired club head 6510 center of gravity position and/or moment of inertia and/or heel/toe bias. For example, in some embodiments, a heavier weight 6582 is positioned on the feature 6570C, located between the toe or toe end 6518 and the heel or heel end 6522, while lighter weights are positioned on the features 6570A,B, D, E near the toe or toe end 6518 and the heel or heel end 6522. The aforementioned weight 6582 positions results in the center of gravity remaining centered while being shifted towards the back end 6534 of the club head 6510. In some embodiments, a heavier weight 6582 is positioned on the feature 6570E and/or 6570D near the heel or heel end 6522, while lighter weights 6582 are positioned on the feature 6270A, B near the toe or toe end 6518 and on the feature 6570C that is located between the toe or toe end 6318 and the heel or heel end 6322. The aforementioned weight 6582 positions results in the center of gravity being shifted towards the heel end 6522 of the club head 6510. In some embodiments, a heavier weight 6582 is positioned on the feature 6570A and/or 6570B near the toe or toe end 6518, while lighter weights 6582 are positioned on the features 6270D, E near the heel or heel end 6522 and on the feature 6570C that is located between the toe or toe end 6518 and the heel or heel end 6522. The aforementioned weight 6582 positions results in the center of gravity being shifted towards the toe end 6518 of the club head 6510. In many embodiments, one or more of the features 6570A, B, C, D, E are of equal size and shape, such that one weight may be interchangeably used with each of the features 6570A, B, C, D, E. In some embodiments, one or more of the features 6570A, B, C, D, E can have a differing size and shape, such that each features 6570A, B, C, D, E has its own corresponding weight 6582 or set of weights 6582. Further, because the features 6570 A, B, C, D, E are spaced away from the sole towards the strike face, adjusting the weights 6582 can also effect the spin imparted on the ball after impact.

The adjustable weighting system 6566 of golf club head 6510 maintains or prevents a significant reduction in club head moment of inertia, and low and back club head center of gravity positioning, compared to a club head devoid of an adjustable weighting system. The adjustable weighting system 6566 of golf club head 6510 maintains a high club head moment of inertia and a low and back club head CG position due to the low profile of the weighting system and the perimeter positioning of the one or more weights. The club head 6510 having the adjustable weighting system 6566 can have similar or identical parameters and measurements as club head 100 described above.

Figure 161:
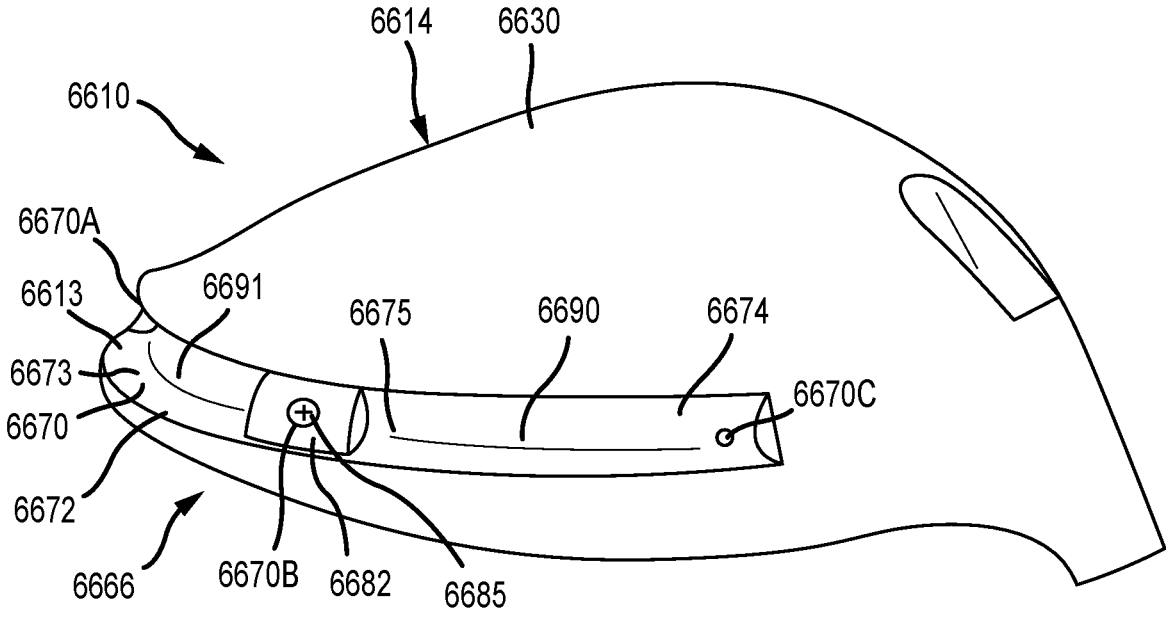
FIG. 161 is a perspective view of a golf club head according to another embodiment.

FIG. 161 illustrates a club head 6610 having a club head body 6614. The club head 6610 includes an adjustable weighting system 6666 that is adjustable by an end user to modify the club head 6610 center of gravity and/or moment of inertia and/or heel/toe bias to achieve desired performance characteristics (e.g., forgiveness, spin, trajectory) under various circumstances. The adjustable weighting system 6666 is a low profile system and thereby does not significantly shift or change the club head 6610 MOI when compared to a club head not including the adjustable weighting system 6666. Further, the low profile adjustable weighting system 6666 ensures that shifts in the club head 6610 CG occur mainly in a heel end 6622 to toe end 6618 direction keeping the overall club head 6610 CG in a low and back location.

Referring to FIG. 161, the adjustable weighting system 6666 can comprise a channel or recessed portion 6613. The channel 6613 is defined by three surfaces 6673, 6674, 6675, each of which can be configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6666 includes a channel 6680 comprising a third surface 6675 including three discrete attachment locations. The three discrete attachment locations each comprise a feature 6670A, B, C. The features 6670A, B, C can be any of the features discussed above.

Referring again to FIG. 161, the channel 6613 extends from the near the toe end 6618 in an arcuate manner to near the heel end 6622 following the contour of the trailing edge 6672. The channel 6613 is defined by a first surface 6673, a second surface 6674 disposed opposite the first surface 6673, and a third surface 6675 that extends between the first surface 6673 and the second surface 6674. In some embodiments, the first surface 6673 extends parallel to the second surface 6674, and perpendicular to the third surface 6675. As illustrated in FIG. 161, the adjustable weighting system 6660 includes a first protruding element 6690 and a second protruding element 6691 that each extend from the third surface 6675. In the illustrated embodiments, the first protruding element 6690 and the second protruding element 6691 are ridges, although other embodiments include different protruding elements. In the illustrated embodiment, the first and second protruding elements 6690, 6691 are blended into the third surface 6675, thus protruding farther out centrally and blending back into the third surface 6675 at opposite ends of each ridge. The first protruding element 6690 and the second protruding element 6691 separate regions (e.g., discrete regions that include the screw apertures 6671) of the channel 6613 that are used to secure the weights 6682. In some embodiments, the protruding elements 6690, 6691 together extend along more than half a length of the channel 6613, such that the discrete regions encompass less than half of the channel 6613. Other embodiments include different ranges and values. In some embodiments, this arrangement of the protruding elements 6690, 6691 additionally provides weighting benefits (e.g., increased peripheral weighting to shift the center of gravity lower and farther back and to increase club head moment of inertia). Providing discrete regions while reducing a cross section of the channel 6613 outside those regions allows for adjustable weighting while also maintaining or minimizing the reduction of moment of inertia associated with introducing weighting structures in the club head 6610

The channel 6613 includes a depth measured along a direction toward a center of the club head 6610, and/or along a direction that is normal to the third surface 6675. In the illustrated embodiment, the channel 6613 has a constant depth. In other embodiments, the channel depth 6613 can have an increasing, decreasing and/or constant depth along its length from the toe end 6618 to the heel end 6622. In other embodiments, the channel cn have different regions having different constant depths. Thus, when a weight 6682 is coupled to the club head 6610 in one region of the channel 6613, the weight 6682 may fit flush in the channel 6613 and/or be concealed by the first and/or second surfaces 6673, 6674. When the weight 6682 is coupled to the club head 6610 in a different region of the channel 6613, a portion of the weight 6682 may protrude beyond the first and/or second surfaces 6673, 6674. In many embodiments, the channel 6613 has a shallow depth ensuring the adjustable weight system 6666 remains low profile. For example, in some embodiments, the channel 6613 has a maximum depth of 0.25 inches. In other embodiments, the channel 6613 can have a maximum depth of 1.5, 1.25, 1.0, 0.9, 0.8, 0.7, 0.6, 0.5, 0.4, 0.3, 0.2, or 0.1 inches. In other embodiments, the depth of the channel 6613 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 6613 includes a width measured as the distance between the first surface 6673 and the second surface 6674. In the illustrated embodiments, the channel 6613 includes a constant width. In other embodiments, the channel 6613 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIG. 161, the channel 6613 can include one or more features 6670 defining a discrete attachment location for securing a weight 6682 to the club head 6610. In contrast to other adjustable weighting systems wherein the weight can be coupled at any, or at an infinite, or at an unlimited number of locations across the recessed portion. In the illustrated embodiment, channel 6613 includes three features 670 A, B, C positioned in the third wall 6675. The features 6670A, B, C are shown as apertures configured to receive screw fasteners 6685. The screw fastener 6685 can be comprised of a material having density which is the same or less than the density of the club head 6510. In other embodiments, the features 6670A, B, C can be a protruding body, aperture, recess, ports capable of receiving a fastener, notches, tabs, cutout regions, ribs, grooves, pegs, hooks, magnets, programmable magnets or any other suitable attachment means. In other embodiments, the channel 6613 can comprise one, two, three, four, five, six, seven, eight, nine or ten features 6670. In some embodiments, the features 6670A, B, C are positioned on the third surface 6675 of the channel 6613. In other embodiments, the features 6670A, B, C can be positioned on the first, second and or third surface 6673, 6674, 6675 of the channel 6613.

As illustrated, the features 6670 A, B, C are disposed within the channel 6613 along the third surface 6675 such that one or more weights 6682 may be releasable coupled to the club head 6610 along the channel 6613. More specifically, a first feature 6670A is positioned between the second protruding element 6691 and the toe end 6618, a second feature 6670C is positioned between the first protruding element 6690 and the heel end 6622, and a third feature 6670C is positioned between the first protruding element 6690 and the second protruding element 6691.

With continued reference to FIG. 161, the weights 6682 have a generally rectangular shape corresponding with the shape of the channel 6613. In other embodiments, the weights 6682 can have a circular, triangular, trapezoidal, polygonal or any other suitable shape configured to fit within the channel 6613. In the illustrated embodiment, the adjustable weighting system 6666 comprises one weight 6682. In other embodiments, the adjustable weight system 6666 can comprise 3 weights 6682 corresponding with the number of features 6670A, B, C. In other embodiments, the adjustable weighting system 6666 can comprise more or less weights 6682 than the number of features 6670A, B, C. For example, the adjustable weighting system 6666 can comprise one, two, three, four, five, six, seven, eight, nine of ten weights 6682. The weights 6682 comprise apertures extending entirely through the weight 6682 sized and configured to receive a screw fastener 6685. The screw fastener 6685 can be thread through the weight 6682 into the corresponding feature 6670A, B, C, thus securing the weight 6682 to the channel 6613. In some embodiments, the weight 6682 can comprise a filet for receiving the top portion of the screw fastener 6685 and therefore the screw fastener 6685 can sit flush with the outer portion of the weight 6682. In other embodiments, the weights 6682 can be configured to be couple to the features 6670 A, B, C through a friction fit, a snap-fit mechanism, with a set-screw, or with any other suitable structure.

In embodiments wherein the adjustable weight system 6666 comprises more than one screw fastener 6685, each of the weights 6682 can have the same shape and size. In other embodiments, the weights 6682 can vary in shape and size, resulting in weights 6682 having varying masses. Further, in some embodiments, the weights 6682 are made of different materials such that they vary in mass. For example, one weight 6682 may be made of a high density material, such as tungsten, and the remaining weights 6682 may be made of a less dense material, such as polyurethane or another plastic. In other embodiments, the weights 6682 may have different sizes or volumes such that they vary in mass. For example, one weight 6682 may have a greater volume than the remaining weights 6682. In some embodiments, each of the weights 6682 may vary in volume from one another and thus vary in mass. In some embodiments, the weights 6682 may vary in both volume and material from one another. In some embodiments, one of the structures labeled as 6682 is not a weight, but rather a light-weight (e.g., light-weight plastic) cover that snap-fits or otherwise couples to one of the features 6670A, B, C. In some embodiments, the weights 6682 may vary between 0.1-50 g. For example, in embodiments having a plurality of weights 6682, one or more of the weights 82 may vary between 0-10 g, one or more of the weights 6682 may vary between 10-20 g, one or more of the weights 6682 may vary between 20-30, one or more of the weights 6682 may vary between 30-40 g, and one or more of the weights 6682 may vary between 40-50 g. In some embodiments, a first weight 6682 may vary between 0-10 g, a second weight 6682 may vary between 10-20 g, a third weight 6682 may vary between 20-30, a fourth weight 82 may vary between 30-40 g, and a fifth weight 6682 may vary between 40-50 g. In other embodiments, a first weight 6682 may vary between 1-5 g, and a second and third weight 6682 may vary between 5-30 g. In other embodiments, a first and second weight 6682 may vary between 1-10 g, and a third and fourth weight 6682, may vary between 5-25 g. In some embodiments, a first weight 6682 has a mass of 8.5 grams, and a second and third weight 6682 each have a mass of 1.5 grams. In other embodiments, a first weight 6682 has a mass of 12 grams, and a second and third weight 6682 each have a mass of 1.5 grams. In other embodiments, a first weight 6682 has a mass of 8.5 grams, and a second and third weight 6682 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIG. 161, in some embodiments each of the features 6670A, B, C receives a weight 6682. In other embodiments, one or more of the features 6670A, B, C receives a weight 6682, while the remaining features 6670A, B, C are bare and uncovered, or are covered with another material or structure. In some embodiments, one or more of the features 6670A, B, C receives more than one weight 6682. In some embodiments, one or more of the features 6670A, B, C does not extend past an outer profile of the club head 10, such that even if the feature 6670A, B, C is left bare and uncovered, the feature 6670A, B, C and or channel 6613 will not interfere with or disrupt a golfer's swing.

The weights 6682 may be strategically positioned on the features 6670A, B, C to achieve a desired club head 6610 center of gravity position and/or moment of inertia and/or heel/toe bias. For example, in some embodiments, a heavier weight 6682 is positioned on the feature 6670B, located between the toe or toe end 6618 and the heel or heel end 6622, while lighter weights are positioned on the features 6670A, C near the toe or toe end 6618 and the heel or heel end 6622. The aforementioned weight placement can result in the center of gravity remaining centered while being shifted towards the back end 6234 of the club head 6210. In some embodiments, a heavier weight 6682 is positioned on the features 6670C near the heel or heel end 6622, while lighter weights 6682 are positioned on the feature 6670A near the toe or toe end 6618 and on the feature 6670B that is located between the toe or toe end 6618 and the heel or heel end 6622. The aforementioned weight placement can result in the center of gravity being shifted towards the heel end 6222 of the club head 6210. In some embodiments, a heavier weight 6682 is positioned on the feature 6670A near the toe or toe end 6618, while lighter weights 6682 are positioned on the feature 6670C near the heel or heel end 6622 and on the feature 6670B that is located between the toe or toe end 6618 and the heel or heel end 6622. The aforementioned weight placement can result in the center of gravity being shifted towards the toe end 6218 of the club head 6210. In many embodiments, one or more of the features 6670A, B, C are of equal size and shape, such that one weight may be interchangeably used with each of the features 6670A, B, C. In some embodiments, one or more of the features 6670A, B, C can have a differing size and shape, such that each feature 6670A, B, C has its own corresponding weight 6682 or set of weights 6682.

The adjustable weighting system 6666 of golf club head 6610 maintains or prevents a significant reduction in club head moment of inertia, and low and back club head center of gravity positioning, compared to a club head devoid of an adjustable weighting system. The adjustable weighting system 6666 of golf club head 6610 maintains a high club head moment of inertia and a low and back club head CG position due to the low profile of the weighting system and the perimeter positioning of the one or more weights. The club head 6610 having the adjustable weighting system 6666 can have similar or identical parameters and measurements as club head 100 described above.

Figure 162:
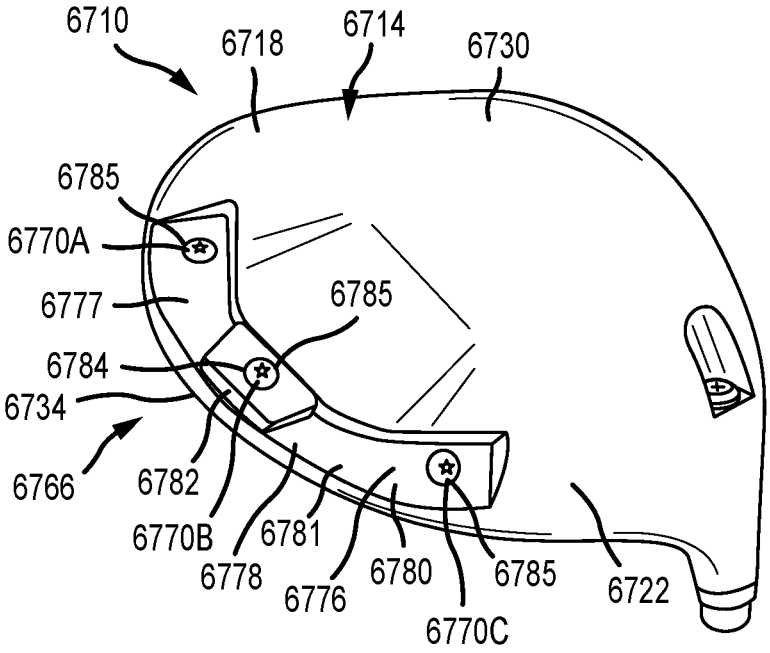
FIGS. 162 and 163 are perspective views of a golf club head according to another embodiment.
Figure 163:
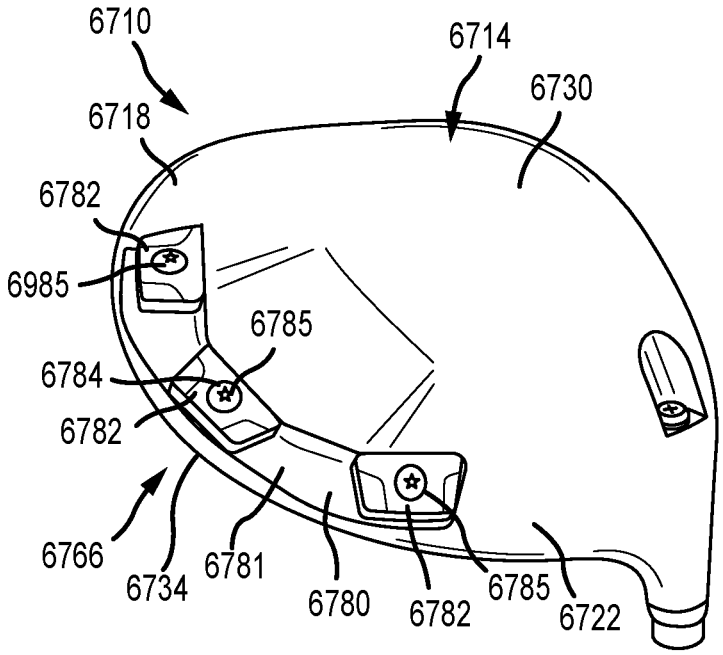

FIGS. 162 and 163 illustrate a club head 6710 (and a variation thereof in FIG. 160A) having a club head body 6714. The club head 6710 includes an adjustable weighting system 6766 that is adjustable by an end user to modify the club head 6710 center of gravity and/or moment of inertia and/or heel/toe bias to achieve desired performance characteristics (e.g., forgiveness, spin, trajectory) under various circumstances. The adjustable weighting system 6766 is a low profile system and thereby does not significantly shift or change the club head 6710 MOI when compared to a club head not including the adjustable weighting system 6766. Further, the low profile adjustable weighting system 6766 ensures that shifts in the club head 6710 CG occur mainly in a heel end 6722 to toe end 6718 direction keeping the overall club head 6710 CG in a low and back location.

Referring to FIGS. 162 and 163, the adjustable weighting system 6766 can comprise a recessed portion 6780. The recessed portion 6780 comprises a recessed surface 6781 configured to include a plurality of discrete attachment locations. The plurality of discrete attachment locations can comprise various features including protruding bodies, apertures or recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6766 includes a recessed surface 6781 comprising three discrete attachment locations. The three distinct attachment locations can each include a feature 6770A, B, C. The features 6770A, B, C can be any of the features discussed above.

Referring again to FIGS. 162 and 163, the recessed portion 6780 extends from near the toe end 518 in an arcuate manner to the heel end 6722 generally following the contour of the trailing edge 6772. The recessed portion 6780 is defined by a recessed surface 6781 being offset from the sole 6720 of the club head 6710 by a wall 6783. Generally, the recessed surface 6781 extends substantially parallel to the sole 6730 of the club head 6710 while the wall 6783 generally extends substantially perpendicular to the recessed surface 6781. In other embodiments, the wall 6783 can extend at an angle between the recessed surface 6781 and the sole 6730. The recessed portion 6781 includes a depth measured as the distance from the recessed surface 6781 to the sole 6730 in a direction perpendicular to the recessed surface 6781. In the illustrated embodiment, the recessed portion 6780 has a constant depth. In other embodiments, the recessed portion 6780 can have an increasing, decreasing and/or constant depth along its length from the toe end 6718 to the heel end 6722. Thus, when a weight 6782 is coupled to the club head 6710 in one region of the recessed portion 6780, the weight 6782 may be concealed by the wall 6783. When the weight 6782 is coupled to the club head 6710 in a different region of the recessed portion 6780, a portion of the weight 6782 may protrude outward from the wall 6783. As illustrated in FIGS. 162 and 163, the recessed portion 6780 comprises a first portion 6777 at a toe end 6718 of the club head 6710, a second region 6776 at the heel end 6722 of the club head 6710, and a third region 6778 disposed between the heel end 6722 and the toe end 6722 along or near the back end 6734.

In many embodiments, the channel 6713 has a shallow depth ensuring the adjustable weight system 6766 remains low profile. For example, in some embodiments, the recessed portion 6780 has a maximum depth of 0.25 inches. In other embodiments, the recessed portion 6780 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 6780 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 6780 includes a width measured as the distance between the wall 6783 and the trailing edge 6772 or back end 6734. In the illustrated embodiments, the recessed portion 6780 includes a varying width. The first region 6777 has an increasing width from the toe end 6718 towards the center or third region 6778, the second region 6776 comprises an increasing width from the heel end 6722 towards the center and or third portion 6778, and the third region 6778 comprises a constant width which is smaller than the average width of the first and or second regions 6777, 6776. In other embodiments, the recessed portion 6780 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 162 and 163, the recessed portion 6780 can include one or more features 6770A, B, C defining a discrete attachment location for securing a weight 6782 to the club head 6710. In contrast to other adjustable weighting systems wherein the weight can be coupled at any, or at an infinite, or at an unlimited number of locations across the recessed portion. Referring to FIG. 160, in the illustrated embodiment, the recessed portion 6780 includes five features 6770A, B, C, D, E. The features 6770A, B, C, D, E are shown as apertures configured to receive a screw fastener 6785. In other embodiments, the features 6770A, B, C, D, E can be a protruding body, aperture, recess, ports capable of receiving a fastener, notches, tabs, cutout regions, ribs, grooves, pegs, hooks, magnets, programmable magnets or any other suitable attachment means. In other embodiments, the recessed portion 6780 can comprise one, two, three, four, five, six, seven, eight, nine or ten features 6770. For example, referring to FIG. 160A, the adjustable weighting system 6766 includes three features 6770A, B, C.

As illustrated, the features 6770A, B, C, D, E are disposed within the recessed portion 6780 along the recessed surface 6781 such that one or more weights 6782 may be releasable coupled to the club head 6710 along the recessed portion 6780. More specifically, a first feature 6770A is positioned along the first region 6777 of the recessed portion 6780 near the toe end 6718, a second feature 6770E is positioned along the second region 6776 of the recessed portion near the heel end 6722, a third feature 6770C is positioned along a third region 6778 of the recessed portion 6780 between the toe and heel end 6718, 6722, a fourth feature 6770B is positioned between the first feature 6770A and the third feature 6770C, and a fifth feature 6770D positioned between the third feature 6770C and the second feature 6770E. In some embodiments, the features 6770A, B, C, D, E can be positioned on the wall 6783 of the recessed portion 6780. In other embodiments, the features 6770A, B, C can be positioned on the wall 6783 and the recessed surface 6781 of the recessed portion 6780.

With continued reference to FIGS. 162 and 163, the weights 6782 have a generally rectangular shape. In other embodiments, the weights 6782 can have a circular, triangular, trapezoidal, polygonal or any other suitable shape configured to fit within the recessed portion 6780. In the illustrated embodiment, the adjustable weighting system 6766 comprises one weight 6782. In other embodiments, the adjustable weighting system 6766 can comprise three or five weights 6782 corresponding with the number of features 6770A, B, C, D, E. In other embodiments, the adjustable weighting system 6766 can comprise more or less weights 6782 than the number of features 6770A, B, C,D, E. For example, the adjustable weighting system 6766 can comprise one, two, three, four, five, six, seven, eight, nine or ten weights 6782. The weights 6782 comprise apertures extending entirely through the weight 6782 sized and configured to receive a screw fastener 6785. The screw fastener 6785 can be thread through the weight 6782 into the corresponding feature 6770A, B, C, D, E thus securing the weight 6782 to the recessed portion 6780. In some embodiments, the weight 6782 can comprise a filet for receiving the top portion of the screw fastener 6785 and therefore the screw fastener 6785 can sit flush with the outer portion of the weight 6782. In other embodiments, the weights 6782 can be configured to be couple to the features 6770 A, B, C, D, E through a friction fit, a snap-fit mechanism, with a set-screw, or with any other suitable structure.

In embodiments wherein the adjustable weight system 6766 comprises more than one weight 6782, each of the weights 6782 can have the same shape and size. In other embodiments, the weights 6782 can vary in shape and size, resulting in weights 6782 having varying masses. Further, in some embodiments, the weights 6782 are made of different materials such that they vary in mass. For example, one weight 6782 may be made of a high density material, such as tungsten, and the remaining weights 6782 may be made of a less dense material, such as polyurethane or another plastic. In other embodiments, the weights 6782 may have different sizes or volumes such that they vary in mass. For example, one weight 6782 may have a greater volume than the remaining weights 6782. In some embodiments, each of the weights 6782 may vary in volume from one another and thus vary in mass. In some embodiments, the weights 6782 may vary in both volume and material from one another. In some embodiments, one of the structures labeled as 6782 is not a weight, but rather a light-weight (e.g., light-weight plastic) cover that snap-fits or otherwise couples to one of the features 6770A, B, C. In some embodiments, the weights 6782 may vary between 0.1-50 g. For example, in embodiments having a plurality of weights 6782, one or more of the weights 82 may vary between 0-10 g, one or more of the weights 6782 may vary between 10-20 g, one or more of the weights 6782 may vary between 20-30, one or more of the weights 6782 may vary between 30-40 g, and one or more of the weights 6782 may vary between 40-50 g. In some embodiments, a first weight 6782 may vary between 0-10 g, a second weight 6782 may vary between 10-20 g, a third weight 6782 may vary between 20-30, a fourth weight 82 may vary between 30-40 g, and a fifth weight 6782 may vary between 40-50 g. In other embodiments, a first weight 6782 may vary between 1-5 g, and a second and third weight 6782 may vary between 5-30 g. In other embodiments, a first and second weight 6782 may vary between 1-10 g, and a third and fourth weight 6782, may vary between 5-25 g. In some embodiments, a first weight 6782 has a mass of 8.5 grams, and a second and third weight 6782 each have a mass of 1.5 grams. In other embodiments, a first weight 6782 has a mass of 12 grams, and a second and third weight 6782 each have a mass of 1.5 grams. In other embodiments, a first weight 6782 has a mass of 8.5 grams, and a second and third weight 6782 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 162 and 163, in the illustrated embodiment one of the features 6270A, B, C, D, E receives a weight 6782, while the remaining features 6770A, B, C, D, E are bare and uncovered, or are covered with another material or structure. In other embodiments, each of the features 6770A, B, C, D, E receives a weight 6782. In some embodiments, one or more of the features 6770A, B, C receives more than one weight 6782. In some embodiments, one or more of the features 6770A, B, C, D, E does not extend past an outer profile of the club head 6710, such that even if the feature 6770A, B, C, D, E is left bare and uncovered, the feature 6770A, B, C, D, E and or recessed portion 6780 will not interfere with or disrupt a golfer's swing.

The weights 6782 may be strategically positioned on the features 6770A, B, C, D, E to achieve a desired club head 6710 center of gravity position and/or moment of inertia and/or heel/toe bias. For example, in some embodiments, a heavier weight 6782 is positioned on the feature 6770C, located between the toe or toe end 6718 and the heel or heel end 6722, while lighter weights are positioned on the features 6770A, B, D, E near the toe or toe end 6718 and the heel or heel end 6722. The aforementioned weight 6782 positions results in the center of gravity remaining centered while being shifted towards the back end 6734 of the club head 6710. In some embodiments, a heavier weight 6782 is positioned on the feature 6770E and/or 6770D near the heel or heel end 6722, while lighter weights 6782 are positioned on the feature 6270A, B near the toe or toe end 6718 and on the feature 6770C that is located between the toe or toe end 6318 and the heel or heel end 6322. The aforementioned weight 6782 positions results in the center of gravity being shifted towards the heel end 6722 of the club head 6710. In some embodiments, a heavier weight 6782 is positioned on the feature 6770A and/or 6770B near the toe or toe end 6718, while lighter weights 6782 are positioned on the features 6270D, E near the heel or heel end 6722 and on the feature 6770C that is located between the toe or toe end 6718 and the heel or heel end 6722. The aforementioned weight 6782 positions results in the center of gravity being shifted towards the toe end 6718 of the club head 6710. In many embodiments, one or more of the features 6770A, B, C, D, E are of equal size and shape, such that one weight may be interchangeably used with each of the features 6770A, B, C, D, E. In some embodiments, one or more of the features 6770A, B, C, D, E can have a differing size and shape, such that each features 6770A, B, C, D, E has its own corresponding weight 6782 or set of weights 6782. Further, because the features 6770 A, B, C, D, E are spaced away from the sole towards the strike face, adjusting the weights 6782 can also affect the spin imparted on the ball after impact.

The adjustable weighting system 6766 of golf club head 6710 maintains or prevents a significant reduction in club head moment of inertia, and low and back club head center of gravity positioning, compared to a club head devoid of an adjustable weighting system. The adjustable weighting system 6766 of golf club head 6710 maintains a high club head moment of inertia and a low and back club head CG position due to the low profile of the weighting system and the perimeter positioning of the one or more weights. The club head 6710 having the adjustable weighting system 6766 can have similar or identical parameters and measurements as club head 100 described above.

Figure 166:
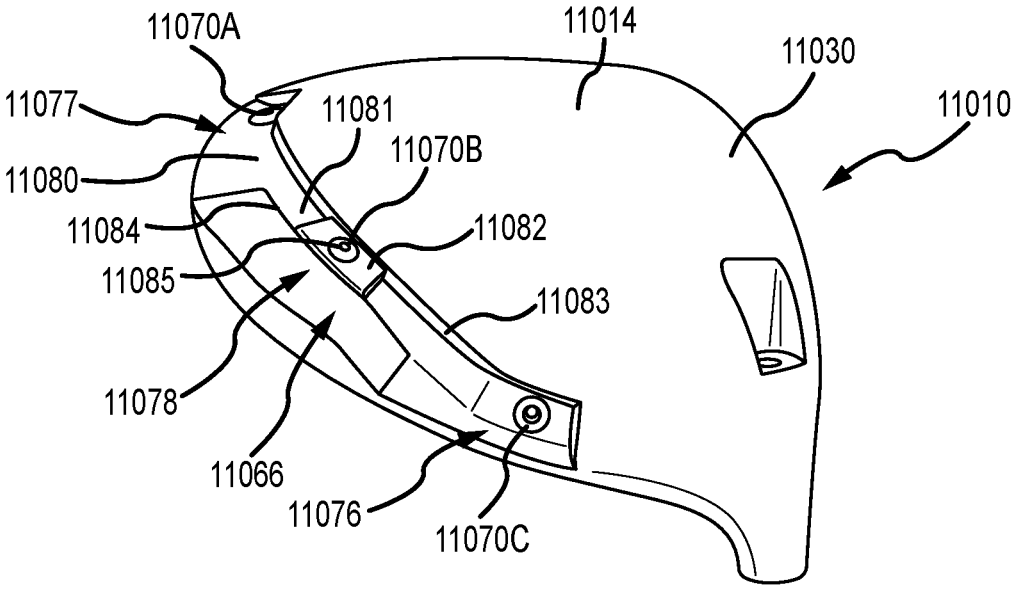
FIG. 166 is a rear perspective view of another golf club head.
Figure 167:
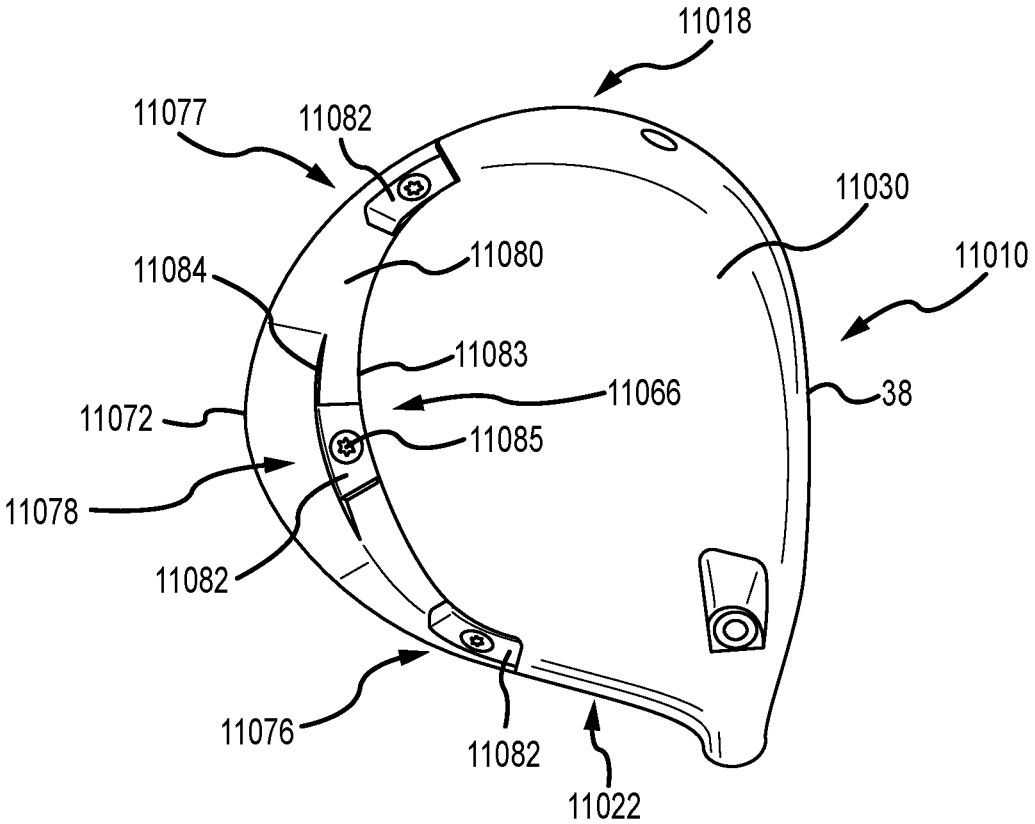
FIG. 167 is a bottom view of the golf club head of FIG. 166.

FIGS. 166 and 167 illustrate a club head 11010 similar to club head 100 described above. The club head 11010 having a club head body 11014 includes an adjustable weighting system 11066 located on a sole 11030 that is adjustable by an end user to modify the club head 11010 center of gravity and/or moment of inertia and/or heel/toe bias to achieve desired performance characteristics (e.g., forgiveness, spin, trajectory) under various circumstances. The club head 11010 can be similar in many respects to club head 100, with similar or identical numbers referencing similar or identical components. The adjustable weighting system 11066 is a low profile system and thereby does not significantly shift or change the MOI of the club head 11010 when compared to a club head devoid of the adjustable weighting system 11066. Further, the low profile adjustable weighting system 11066 ensures that shifts in the club head 11010 CG occur mainly in a heel end 11022 to toe end 11018 direction keeping the overall CG of the club head 11010 in a low and back location. The center of gravity position and MOI of club head 11010 can be similar or identical to the center of gravity position and MOI of club head 100 described above.

Referring to FIGS. 166 and 167, the adjustable weighting system 11066 can comprise a recessed portion 11080. The recessed portion 11080 comprises a recessed surface 11081 configured to include a plurality of discrete attachment locations. The plurality of discrete attachment locations can comprise various features including protruding bodies, apertures, recesses or ports capable of receiving a fastener, notches or tabs or cutout regions, ribs or grooves, pegs, hooks, magnets, programmable magnets, or any other suitable attachment means. In the illustrated embodiment, the adjustable weighting system 11066 includes a recessed surface 11081 comprising three discrete attachment locations 11070A, 11070B, and 11070C. The three discrete attachment locations comprise feature 11070A, 11070B, and 11070C. The features 11070A, 11070B, and 11070C can comprise any of the features discussed above. The attachment locations and corresponding features 11070A, 11070B, and 11070C are configured to receive one or more weights 11082.

Referring again to FIGS. 166 and 167, the recessed portion 11080 defines a groove, channel, and/or recessed track that extends along the sole or bottom 11030 of the club head 11010, adjacent a trailing edge 11072 or a rear perimeter 10136, and extends generally in an arcuate configuration from the toe or toe end 11018 to the heel or heel end 11020. The recessed portion 11080 generally follows the contour of the trailing edge 11072, wherein the recessed portion 11080 can be slightly offset from the trailing edge 11072 or rear perimeter 10136 between the heel end 11022 and the toe end 11018. The recessed portion 11080 comprises a recessed surface 11081 being offset from the sole 11030 of the club head 11010 by a first wall 11083. A portion of the recessed surface 11081 can further be offset from the sole 11030 by a second wall 11084, wherein the second wall 11084 is opposite the first wall 11083, proximate to the trailing edge 11072 or rear perimeter 10136. Generally, the recessed surface 11081 extends substantially parallel to the sole 11030 of the club head 11010, while the first and second walls 11083, and 11084 generally extend substantially perpendicular to the recessed surface 11081 and/or the sole 11030. In other embodiments, the first wall 11083 and the second wall 11084 can extend at a non-perpendicular angle between the recessed surface 11081 and the sole 11030.

Figure 168:
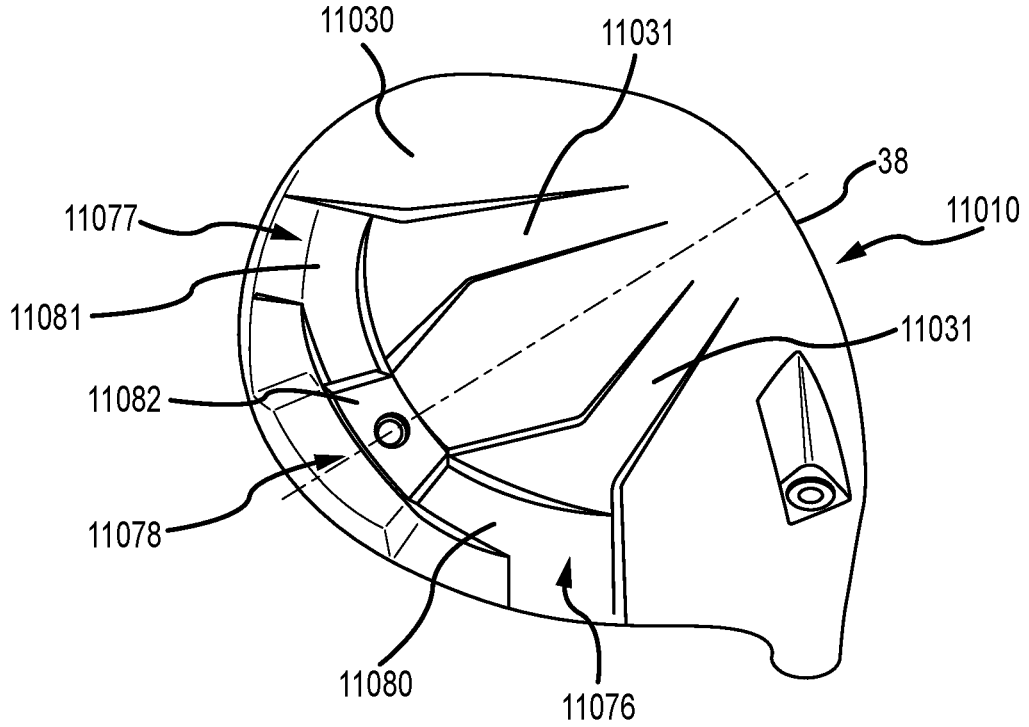
FIG. 168 is a bottom perspective view of an alternative embodiment of FIG. 166.

The recessed portion 11081 includes a depth measured as the distance from the recessed surface 11081 to the sole 11030 in a direction parallel to the recessed surface 11081. In the illustrated embodiment, the recessed portion 11080 has a varying depth such that it is deeper in some areas than in other areas (e.g., may have a continuously or intermittently changing depth). For example, in some embodiments, the recessed portion 11080 can have an increasing, decreasing and/or constant depth along its length from the toe end 11018 to the heel end 11022. Thus, when a weight 11082 is coupled to the club head 11010 in one region of the recessed portion 11080, the weight 11082 may be concealed by the wall 11083 and flush with the sole 11030. When the weight 11082 is coupled to the club head 11010 in a different region of the recessed portion 11080, a portion of the weight 11082 may protrude outward from the wall 11083. As illustrated in FIGS. 166-168, the recessed portion 11080 comprises a first region 11077 at a toe end 11018 of the club head 11010, a second region 11076 at the heel end 11022 of the club head 11010, and a third region 11078 disposed between the heel end 11022 and the toe end 11022 along or near the back end 11034. Referring to FIG. 166, the depth at the first region 11077 (and similarly the depth at the second region 11076) of the recessed portion 11080 is less than the depth at the third region. Accordingly, the depth of the recessed portion 11080 increases from the first and second regions 11077, 11076 toward the third region 11078, such that the third region 11078 has a constant larger depth than the first and second regions 11077, 11076. In this exemplary embodiment, the weight 11082 can be concealed by the first wall 11083 (e.g., as viewed along the y-axis 58 in FIG. 2) when the weight 11082 is coupled to the third region 11078, and the weight 11082 can be at least partially exposed or can at least partially protrude from the contour of the sole 11030 in the first and second regions 11077, 11076. In other embodiments, the first region 11077, the second region 11076, and the third region 11078 can have a constant depth, such that the weight 11072 is concealed by the wall 11083 when the weight 11082 is coupled to any of the first, second and/or third regions 11077, 11076, 11078. In other embodiments, the recessed portion 11080 includes other numbers and locations of regions than that illustrated. For example, in some embodiments, the recessed portion 11080 can include more than one region where the weight 11082 is concealed when coupled. For example, the recessed portion 11080 can comprise 1 region, 2 regions, 3 regions, 4 regions, 5 regions, 6 regions, 7 regions, or 8 regions.

In many embodiments, the recessed portion 11080 has a shallow depth ensuring the adjustable weight system 11066 remains low profile. For example, in some embodiments, the recessed portion 11080 has a maximum depth of 0.25 inches. In other embodiments, the recessed portion 11080 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 11080 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the recessed portion 11080 includes a width measured as the distance between the first wall 11083 and the trailing edge 11072 or second wall 11084. In the illustrated embodiments, the recessed portion 11080 includes a varying width. In some embodiments, the first region 11077 has an increasing width from the toe end 11018 towards the center or third region 11078, the second region 11076 comprises an increasing width from the heel end 11022 towards the center and or third region 11078, and the third region 11078 comprises a constant width which is smaller than the average width of the first and or second regions 11077, 11076. In other embodiments as illustrated in FIGS. 166-168, the width of the recessed portion 11080 can increase from the center or third region 11078 toward the first region 11077, and toward the second region 11076. In other embodiments, the recessed portion 11080 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 166 and 167, the recessed portion 11080 can include one or more features 11070 defining one or more discrete attachment locations for securing a weight 11082 to the club head 11010. The club head 11010 having one or more discrete attachment locations is different than other adjustable weighting systems, wherein the weight can be coupled at any, or at an infinite, or at an unlimited number of locations on the club head. Referring to FIGS. 166 and 167, in the illustrated embodiment, the recessed portion 11080 can include three features or attachment locations 11070A, B, C. The features 11070A, B, C are shown as apertures configured to receive a screw fastener 11085. The screw fastener 11085 can be comprised of a material having a density which is the same or less than the density of the club head 11010. In other embodiments, the features 11070A, B, C, can be a protruding body, aperture, recess, ports capable of receiving a fastener, notches, tabs, cutout regions, ribs, grooves, pegs, hooks, magnets, programmable magnets or any other suitable attachment means. In other embodiments, the recessed portion 11080 can comprise one, two, three, four, five, six, seven, eight, nine or ten features 11070.

As illustrated, the features 11070A, B, C are disposed within the recessed portion 11080 along the recessed surface 11081 such that one or more weights 11082 may be releasably or removably coupled to the club head 11010 along the recessed portion 11080. More specifically, a first feature 11070A is positioned along the first region 11077 of the recessed portion 11080 near the toe end 11018, a second feature 11070C is positioned along the second region 11076 of the recessed portion near the heel end 11022, and a third feature 11070B is positioned along a third region 11078 of the recessed portion 11080 between the toe and heel end 11018, 11022. In some embodiments, one or more of the features 11070A, B, C can be positioned on the first wall 11083, second wall 11084, and/or the recessed surface 11081 of the recessed portion 11080.

With continued reference to FIGS. 166-168, the weights 11082 can have a generally trapezoidal shape. In other embodiments, the weights 11082 can have a circular, ovular, triangular, trapezoidal, polygonal or any other suitable shape configured to fit within the recessed portion 11080. In the illustrated embodiment, the adjustable weighting system 11066 comprises one weight 11082 capable of removably coupling to the features 11070A, B, C. In other embodiments, the adjustable weighting system 11066 can comprise any number of weights 11082 corresponding with the number of features 11070A, B, C. In other embodiments, the adjustable weighting system 11066 can comprise more or less weights 11082 than the number of features 11070A, B, C. For example, the adjustable weighting system 11066 can comprise one, two, three, four, five, six, seven, eight, nine, or ten weights 11082.

In the illustrated embodiment, the weights 11082 comprise apertures extending entirely through the weight 11082 that are sized and configured to receive a threaded fastener or screw fastener 11085. The screw fastener 11085 can be threaded through the weight 11082 into the corresponding feature 11070A, B, C, thus securing the weight 11082 to the recessed portion 11080. In some embodiments, the weight 11082 can comprise a recessed or inset portion for receiving the top portion of the screw fastener 11085, and therefore the screw fastener 11085 can sit flush with an outer portion of the weight 11082. In other embodiments, the weights 11082 can be configured to be couple to the features 11070 A, B, C through a friction fit, a snap-fit mechanism, with a set-screw, or with any other suitable structure.

In embodiments where the adjustable weight system 11066 comprises more than one weight 11082, each of the weights 11082 can have the same shape and size. In other embodiments, the weights 11082 can vary in shape and size, resulting in weights 11082 having varying masses. Further, in some embodiments, the weights 11082 can comprise different materials such that they vary in mass. For example, one weight 11082 can comprise a high density material, such as tungsten, and the remaining weights 11082 can comprise a less dense material, such as polyurethane or another plastic. In other embodiments, the weights 11082 can comprise the same or different material and can have different sizes or volumes such that they vary in mass. For example, one weight 11082 can have a greater volume than the remaining weights 11082. In some embodiments, each of the weights 11082 can vary in volume from one another and thus vary in mass. In some embodiments, the weights 11082 can vary in both volume and material from one another. In some embodiments, one of the structures labeled as 11082 is not a weight, but rather a light-weight (e.g., light-weight plastic) cover that snap-fits or otherwise couples to one of the features 11070A, B, C.

In some embodiments, the weights 11082 can vary between 0.1-50 g. For example, in embodiments having a plurality of weights 11082, one or more of the weights 82 can vary between 0-10 g, one or more of the weights 11082 can vary between 10-20 g, one or more of the weights 11082 can vary between 20-30, one or more of the weights 11082 can vary between 30-40 g, and one or more of the weights 11082 can vary between 40-50 g. In some embodiments, a first weight 11082 can vary between 0-10 g, a second weight 11082 can vary between 10-20 g, and a third weight 11082 can vary between 20-30 g. In other embodiments, a first weight 11082 can vary between 1-5 g, and a second and third weight 11082 can vary between 5-30 g. In other embodiments, a first weight 11082 can vary between 40-50 g, a second weight 11082 can vary between 30-40 g, and a third weight can vary between 20-30 g. In other embodiments, a first and second weight 11082 can vary between 1-10 g, and a third 11082 can vary between 5-25 g. In some embodiments, a first weight 11082 has a mass of 8.5 grams, and a second and third weight 11082 each have a mass of 1.5 grams. In other embodiments, a first weight 11082 has a mass of 12 grams, and a second and third weight 11082 each have a mass of 1.5 grams. In other embodiments, a first weight 11082 has a mass of 8.5 grams, and a second and third weight 11082 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, the first weight can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIG. 166, in the illustrated embodiment, one of the features 11070A, B, C can receive a weight 11082, while the remaining features 11070A, B, C can be bare and uncovered, devoid of a weight, or can be covered with another material or structure. In other embodiments as illustrated in FIG. 167, each of the features 11070A, B, C can receive a weight 11082. In some embodiments, one or more of the features 11070A, B, C can receive a weight 11082. In some embodiments, one or more of the features 11070A, B, C do not extend past an outer profile of the club head 11010, such that even if the feature 11070A, B, C is left bare and uncovered, the features 11070A, B, C, and or recessed portion 11080 will not interfere with, or disrupt a golfer's swing.

The weights 11082 may be strategically positioned on the features 11070A, B, C to achieve a desired club head 11010 center of gravity position and/or moment of inertia and/or heel/toe bias. For example, in some embodiments, a heavier weight 11082 is positioned on the feature 11070B, located between the toe end 11018 and the heel end 11022, while lighter weights are positioned on the features 11070A, and C at the toe end 11018 and the heel end 11022. The aforementioned weight 11082 positions results in the center of gravity remaining centered while being shifted towards the back end 11034 of the club head 11010. In some embodiments, a heavier weight 11082 can be positioned on the feature 11070C at the heel end 11022, while lighter weights 11082 are positioned on the feature 6270A, and B near the toe end 11018 and at the center located between the toe end 6318 and the heel end 6322. The aforementioned weight 11082 positions results in the center of gravity being shifted towards the heel end 11022 of the club head 11010. In some embodiments, a heavier weight 11082 is positioned on the feature 11070A at the toe or toe end 11018, while lighter weights 11082 are positioned on the features 6270C at the heel end 11022 and on the feature 11070B that is located between the toe end 11018 and the heel end 11022. The aforementioned weight 11082 positions results in the center of gravity being shifted towards the toe end 11018 of the club head 11010. In many embodiments, one or more of the features 11070A, B, C can be of equal size and shape, such that one weight may be interchangeably used with each of the features 11070A, B, C. In some embodiments, one or more of the features 11070A, B, C can have a differing size and shape, such that each features 11070A, B, C can have its own corresponding weight 11082 or set of weights 11082. Further, adjustment of the position of the weights 11082 on the features 11070 A, B, C can also effect the spin imparted on the ball after impact.

Referring to FIG. 168, in some embodiments, club head 11010 can further comprise contoured recesses 11031 located on the sole 11030. The contour recesses 11031 can comprise a higher elevation (i.e., less depth) than the recessed portion 11080 having the plurality of discrete attachment locations. The contoured recesses 11031 extend from the recessed portion 11080 toward the strike face 38 of the golf club head 11010.

The adjustable weighting system 11066 of golf club head 11010 maintains or prevents a significant reduction in club head moment of inertia, and low and back club head center of gravity positioning, compared to a club head devoid of an adjustable weighting system. The adjustable weighting system 11066 of golf club head 11010 maintains a high club head moment of inertia and a low and back club head CG position due to the low profile of the weighting system and the perimeter positioning of the one or more weights. The club head 11010 having the adjustable weighting system 11066 can have similar or identical parameters and measurements as club head 100 described above.

Figure 169:
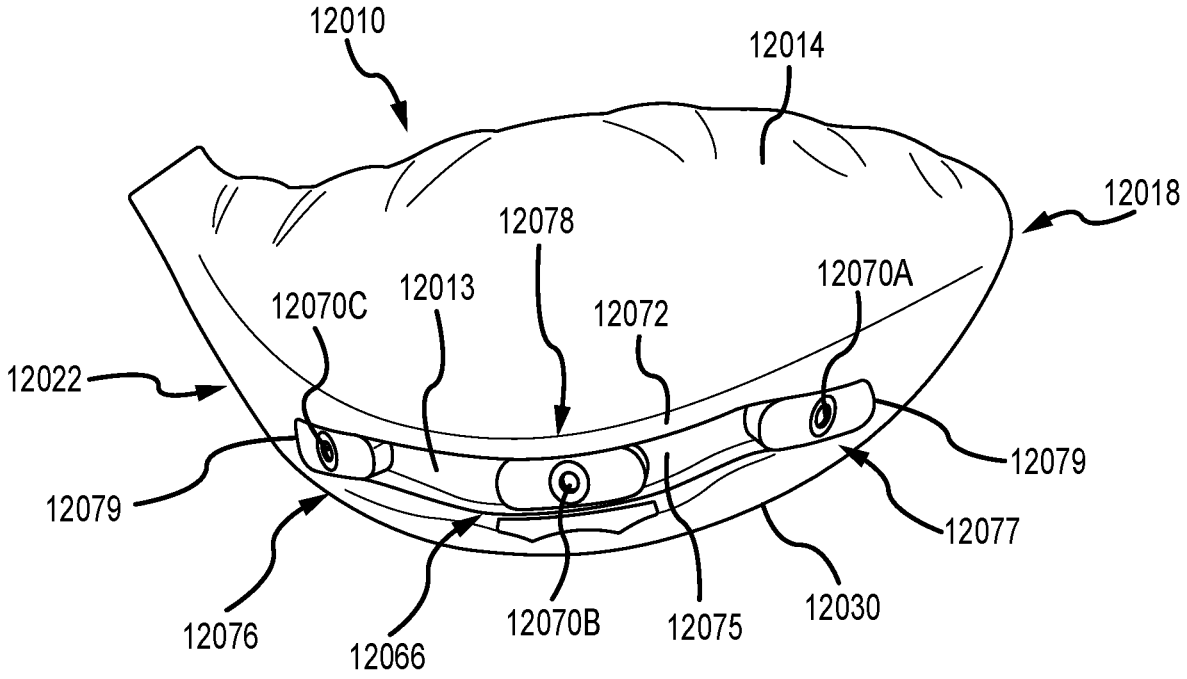
FIG. 169 is a rear view of another golf club head.
Figure 170:
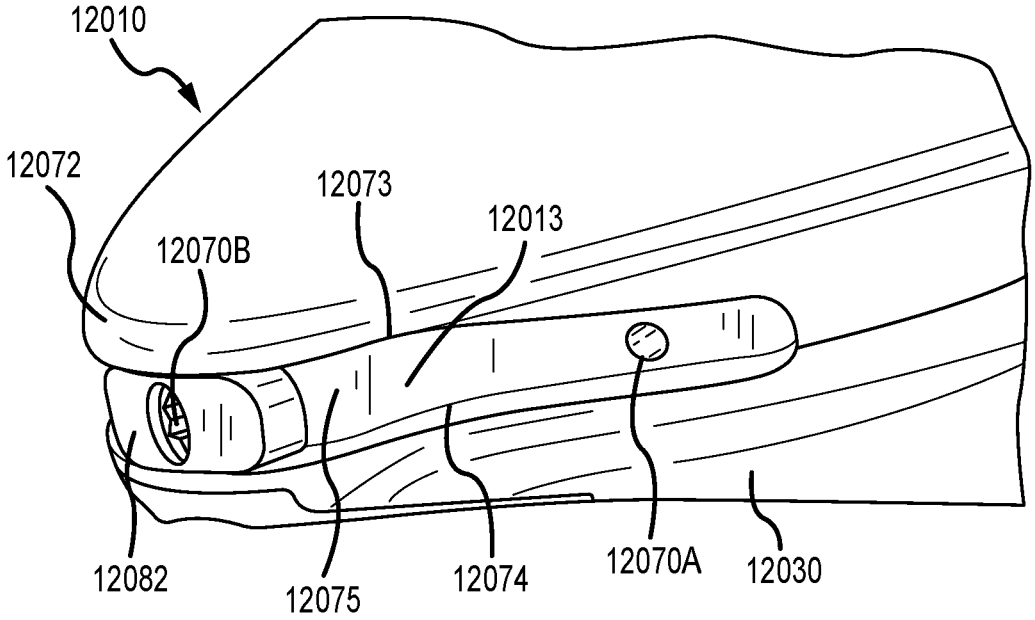
FIG. 170 is a close-up perspective view of the rear of the golf club head of FIG. 169.

FIGS. 169 and 170 illustrate a club head 12010 similar to club head 100 described above. Club head 12010 having a club head body 12014 includes an adjustable weighting system 12066 that is adjustable by an end user to modify the club head 12010 center of gravity and/or moment of inertia and/or heel/toe bias to achieve desired performance characteristics (e.g., forgiveness, spin, trajectory) under various circumstances. The club head 12010 can be similar in many respects to club head 100 and 11010, with similar or identical numbers referencing similar or identical components. The adjustable weighting system 12066 is a low profile system and thereby does not significantly shift or change the MOI of the club head 12010 when compared to a club head devoid of the adjustable weighting system 12066. Further, the low profile adjustable weighting system 12066 ensures that shifts in the club head 12010 CG occur mainly in a heel end 12022 to toe end 12018 direction keeping the overall CG of the club head 12010 in a low and back location. The center of gravity position and MOI of club head 12010 can be similar or identical to the center of gravity position and MOI of club head 100 and 11010 described above.

Referring to FIGS. 169 and 170, the adjustable weighting system 12066 can comprise a channel or recessed portion 12013 positioned on the sole 12030 or in the trailing edge 12072 of the club head 12010. The recessed portion 12013 can comprise a plurality of discrete attachment locations. The plurality of discrete attachment locations can comprise various features including protruding bodies, apertures, recesses or ports capable of receiving a fastener, notches or tabs or cutout regions, ribs or grooves, pegs, hooks, magnets, programmable magnets, or any other suitable attachment means. In the illustrated embodiment, the adjustable weighting system 12066 includes three discrete attachment locations. The three discrete attachment locations comprise features 12070A, 12070B, and 12070C. The features 12070A, 12070B, and 12070C can comprise any of the features discussed above. The attachment locations and corresponding features 12070A, 12070B, and 12070C are configured to receive one or more weights 12082.

In some embodiments, the recessed portion 12080 defines a groove, channel, and/or recessed track that extends within and along the skirt or trailing edge 12072 or rear perimeter 10136, and extends generally in an arcuate configuration from the toe or toe end 12018 to the heel or heel end 12020. The channel 12013 is defined by a first surface 12073 (FIG. 169), a second surface 12074 (FIGS. 169 and 170) disposed opposite the first surface 12073, and a third surface 12075 (FIGS. 169 and 170) that extends perpendicular between the first surface 12073 and the second surface 12074. In many embodiments, the first surface 12073 comprises an upper wall of the channel 12013, the second surface 12074 comprises a lower wall of the channel 12013, and the third surface 12075 comprises a base or bottom wall of the channel 12013. In some embodiments, the first surface 12073 extends parallel to the second surface 12074, and perpendicular to the third surface 12075. Further, in some embodiments, the first and second surfaces 12073, 12074 of the recessed portion 12080 extend in a direction generally perpendicular to the loft plane of the club head 12010, and the third surface 12075 of the recessed portion 12080 extends in a direction generally parallel to the loft plane of the club head 12010. The channel 12013 is further defined in part by additional end surfaces 12079 that directly intersect the first surface 12073, the second surface 12074, and the third surface 12075. The end surfaces 12079 can provide added support and/or provide an abutment region or edge against which the weights 12082 may rest. In some embodiments, the end surfaces 12079 can also allow the weights 12082 to appear flush with an outer surface 12090 of the club head. The flush surfaces may improve air flow characteristics during a swing to improve the club head 12010 aerodynamics.

The channel 12013 includes a depth measured from the third surface 12075 to the sole 12030 in a direction perpendicular to the third surface 12075. In the illustrated embodiment, the channel 12013 can have a varying depth such that it is deeper in some areas than in other areas (e.g., may have a continuously or intermittently changing depth). In other embodiments, the depth of the channel 12013 can have an increasing, decreasing and/or constant depth along its length from the toe end 12018 to the heel end 12022. Thus, when a weight 12082 is coupled to the club head 12010 in one region of the channel 12013, the weight 12082 can fit flush in the channel 12013 and/or be concealed by the first and/or second surfaces 12073, 12074. When the weight 12082 is coupled to the club head 12010 in a different region of the channel 12013, a portion of the weight 12082 can protrude beyond the first and/or second surfaces 12073, 12074. In other embodiments, the weight 12082 can be recessed within the channel 12013, sit flush within the channel 12013, or protrude beyond the channel 12013 in any position.

As illustrated in FIG. 169, the channel 12013 can comprise a first region 12077 at a toe end 12018 of the club head 12010, a second region 12076 at a heel end 12022 of the club head 12010, and a third region 12078 disposed between the heel or heel end 12022 and the toe or toe end 12018, along a rear or back end 12034. In some embodiments, the first region 12077, second region 12076 and third region 12078 can be parallel to the contour of the trailing edge 12072. In other embodiments, any of the first, second, and/or third region 12077, 12076, and/or 12078 can be parallel and/or angled relative to the contour of the trailing edge 12072. In one example as illustrated in FIG. 169, the first region 12077, and the second region 12076 can be angled upward toward the trailing edge 12072, extending toward the third region 12078; while the third region is parallel with the contour of the trailing edge 12072. In this embodiment, the transition between the first region 12077, third region 12078, and second region 12076 can be smooth and devoid of hard edges In some embodiments, the first region 12077 (and similarly the second region 12076) of the channel 12013 can have a shallow depth, such that a portion of the weight 12082 protrudes out past the first surface 12073 and the second surface 12074 when the weight 12082 is coupled to the first region 12077. However, due to the end surfaces 12079, the weight 12082 can appear flush to the rest of the sole 12030, toe end 12018, or heel end 12022 of the club head 12010. In contrast, the third region 12078 can have a larger depth, such that the weight 12082 is concealed by the first surface 12073 and the second surface 12074 (e.g., as viewed along the y-axis 58 in FIG. 2) when the weight 12082 is coupled to the third region 12078. In other embodiments, the depth of the first, second, and third regions 12077, 12076, and 12078 can comprise the same depth. Further, the transition regions between the first and third regions 12077, and 1278, and the second and third regions 12076, and

12078 can be more shallow than the depth of the first, second, and third regions 12077, 12076, and 12078. In other embodiments, the channel 12013 can include other numbers and locations of regions than those illustrated. For example, in some embodiments, the channel 12013 can include more than one region where the weight 12082 is concealed when coupled. In some embodiments, the channel 12013 can include a region or regions at the heel end 12022 and/or the toe end 12018 where the weight 12082 is concealed when coupled. In some embodiments, the channel 12013 includes a region or regions at the rear or back end 12034 where a portion of the weight 12082 protrudes beyond the first surface 12073 and/or the second surface 12074 when coupled.

In many embodiments, the channel 12013 has a shallow depth ensuring the adjustable weight system 12066 remains low profile. For example, in some embodiments, the channel 12013 has a maximum depth of 0.25 inches. In other embodiments, the channel 12013 can have a maximum depth of 1.5, 1.25, 1.0, 0.9, 0.8, 0.7, 0.6, 0.5, 0.4, 0.3, 0.2, or 0.1 inches. In other embodiments, the depth of the channel 12013 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches. Additionally, the channel 12013 includes a width measured as the distance between the first surface 12073 and the second surface 12074. In the illustrated embodiments, the channel 12013 includes a constant width. In other embodiments, the channel 12013 can have an increasing, decreasing and/or constant width. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 2.0, 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 169 and 170, the channel 12013 can include one or more features 12070A, B, C defining one or more discrete attachment locations for securing a weight 12082 to the club head 12010. The club head 12010 having one or more discrete attachment locations is different than other adjustable weighting systems, wherein the weight can be coupled at any location, or at an infinite, or at an unlimited number of locations on the club head. In the illustrated embodiment, the adjustable weighting system 12066 can comprise 3 features 12070A, B, C. In some embodiments, the features 12070A, B, C can be one of a protruding body, aperture, recess, ports capable of receiving a fastener, notches, tabs, cutout regions, ribs, grooves, pegs, hooks, magnets, programmable magnets or any other suitable attachment means. In other embodiments, the channel 12013 can comprise one, two, three, four, five, six, seven, eight, nine or ten features 12070. As illustrated in FIG. 169, the third surface 12075 of the channel 12013 can comprise the three discrete attachment locations feature 12070A, B, C. The features 12070A, B, C can be any of the features discussed above. In other embodiments, the features 12070A, B, C can be positioned on the first, second and/or third surface 12073, 12074, 12075 of the channel 12013.

For the purposes of this example, in the illustrated embodiment, the features 12070 A, B, C can be apertures configured to receive a screw. The screw can be comprised of a material having density, which is the same or less than the density of the club head 12010. As illustrated, the features 12070 A, B, C are disposed within the channel 12013 along the third surface 12075 such that one or more weights 12082 may be releasably or removably coupled to the club head 12010 along the channel 12013. More specifically, a first feature 12070A is positioned along the first region 12077 of the channel 12013 near the toe end 12018, a second feature 12070C is positioned along the second region 12076 of the channel 12013 near the heel end 12022, and a third feature 12070B is positioned along a third region 12078 of the channel 12013 between the toe and heel end 12018, 12022. In some embodiments, one or more of the features 12070A, B, C can be positioned on the first wall 12083, second wall 12084, and/or the recessed surface 12081 of the recessed portion 11080.

With continued reference to FIGS. 169 and 170, the weights 12082 can have a generally elongated oval shape corresponding with the shape of the channel 12013. In other embodiments, the weights 12082 can have a circular, ovular, rectangular, triangular, trapezoidal, polygonal or any other suitable shape configured to fit within the channel 12013. In the illustrated embodiment of FIG. 169, the adjustable weighting system 12066 comprises three weights 12082 capable of removably coupling to the features 12070A, B, C in any configuration. In this embodiment, the number of weights 12082 corresponds with the number of features 12070A, B, C. In the illustrated embodiment of FIG. 170, the adjustable weighting system 12066 comprises one weight 12082 capable of removably coupling to any of the features 12070A, B, C. In other embodiments, the adjustable weighting system 12066 can comprise more or less weights 12082 than the number of features 12070A, B, C. For example, the adjustable weighting system 12066 can comprise one, two, three, four, five, six, seven, eight, nine, or ten weights 12082.

In the illustrated embodiment, the weights 12082 comprise apertures extending entirely through the weight 12082 that are sized and configured to receive a threaded fastener or screw (not shown). The screw can be threaded through the weight 12082 into the corresponding feature 12070A, B, C, thus securing the weight 12082 to the channel 12013. In some embodiments, the weight 12082 can comprise a recessed or inset portion for receiving the top portion of the screw and therefore the screw can sit flush with the outer portion of the weight 12082. In other embodiments, the weight 12082 can comprise a blind aperture not extending entirely through the weight 12082. In other embodiments, the weight 12082 can be devoid of an aperture. In other embodiments, the weights 12082 can be configured to be couple to the features 12070 A, B, C through a friction fit, a snap-fit mechanism, with a set-screw, or with any other suitable structure.

Referring again to FIG. 169, in the illustrated embodiment each of the features 12070A, B, C can receive a weight 12082. In other embodiments, one or more of the features 12070A, B, C can receive a weight 12082, while the remaining features 12070A, B, C are bare and uncovered, devoid of a weight, or are covered with another material or structure. In some embodiments, one or more of the features 12070A, B, C receives a weight 12082. In some embodiments, one or more of the features 12070A, B, C does not extend past an outer profile of the club head 10, such that even if the feature 12070A, B, C is left bare and uncovered, the feature 12070A, B, C and or channel 12013 will not interfere with or disrupt a golfer's swing.

In the illustrated embodiment, each of the weights 12082 is illustrated having the same shape and size. In other embodiments, the weights 12082 can vary in shape and size, resulting in different weights 12082 having varying masses. Further, in some embodiments, the weights 12082 can comprise different materials such that they vary in mass. For example, one weight 12082 can comprise a high density material, such as tungsten, and the remaining weights 12082 can comprise a less dense material, such as polyurethane or another plastic. In other embodiments, the weights 12082 can comprise the same or different material and can have different sizes or volumes such that they vary in mass. For example, one weight 12082 can comprise a greater volume than the remaining weights 12082. In some embodiments, each of the weights 12082 can vary in volume from one another and thus vary in mass. In some embodiments, the weights 12082 can vary in both volume and material from one another. In some embodiments, one of the structures labeled as 12082 is not a weight, but rather a light-weight (e.g., light-weight plastic) cover that snap-fits or otherwise couples to one of the features 12070A, B, C.

In some embodiments, the weights 12082 can vary between 0.1-50 g. For example, in embodiments having a plurality of weights 12082, one or more of the weights 12082 can vary between 0-10 g, one or more of the weights 12082 can vary between 10-20 g, one or more of the weights 12082 can vary between 20-30, one or more of the weights 12082 can vary between 30-40 g, and one or more of the weights 12082 can vary between 40-50 g. In some embodiments, a first weight 12082 can vary between 0-10 g, a second weight 12082 can vary between 10-20 g, a third weight 12082 can vary between 20-30, a fourth weight 82 can vary between 30-40 g, and a fifth weight 12082 can vary between 40-50 g. In other embodiments, a first weight 12082 can vary between 1-5 g, and a second and third weight 12082 can vary between 5-30 g. In other embodiments, a first and second weight 12082 can vary between 1-10 g, and a third and fourth weight 12082, can vary between 5-25 g. In some embodiments, a first weight 12082 has a mass of 8.5 grams, and a second and third weight 12082 each have a mass of 1.5 grams. In other embodiments, a first weight 12082 has a mass of 12 grams, and a second and third weight 12082 each have a mass of 1.5 grams. In other embodiments, a first weight 12082 has a mass of 8.5 grams, and a second and third weight 12082 each have a mass of 0.75 grams. In other embodiments, a first weight can have a mass of 10-20 g, 10-25 g, or 15-25 g, and the remaining weight (e.g. second, third, fourth, fifth weight) can have a mass of 0.25-2.5 g, 0.25-5 g, 0.25-7.5 g, or 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights can have the same mass or may have a varying mass between 0.1-50 g.

The weights 12082 may be strategically positioned on the features 12070A, B, C to achieve a desired club head 12010 center of gravity position and/or moment of inertia and/or heel/toe bias. For example, in some embodiments, a heavier weight 12082 is positioned on the feature 12070B, located between the toe or toe end 12018 and the heel or heel end 12022, while lighter weights, or no weights, are positioned on the features 12070A, C near the toe or toe end 12018 and the heel or heel end 12022. The aforementioned weight 12082 placement can result in the center of gravity remaining centered while being shifted towards the back end 12034 of the club head 12010. In some embodiments, a heavier weight 12082 is positioned on the features 12070C near the heel or heel end 12022, while lighter weights 12082, or no weights, are positioned on the feature 12070A near the toe or toe end 12018 and on the feature 12070B that is located between the toe or toe end 12018 and the heel or heel end 12022. The aforementioned weight 12082 placement can result in the center of gravity being shifted towards the heel end 12022 of the club head 12010. In some embodiments, a heavier weight 12082 is positioned on the feature 12070A near the toe or toe end 12018, while lighter weights 12082, or no weights, are positioned on the feature 12070C near the heel or heel end 12022 and on the feature 12070B that is located between the toe or toe end 12018 and the heel or heel end 12022. The aforementioned weight 12082 placement can result in the center of gravity being shifted towards the toe end 12018 of the club head 12010. In many embodiments, one or more of the features 12070A, B, C are of equal size and shape, such that one weight may be interchangeably used with each of the features 12070A, B, C. In some embodiments, one or more of the features 12070A, B, C can have a differing size and shape, such that each feature 12070A, B, C has its own corresponding weight 12082 or set of weights 12082.

The adjustable weighting system 12066 of golf club head 12010 maintains or prevents a significant reduction in club head moment of inertia, and low and back club head center of gravity positioning, compared to a club head devoid of an adjustable weighting system. The adjustable weighting system 12066 of golf club head 12010 maintains a high club head moment of inertia and a low and back club head CG position due to the low profile of the weighting system and the perimeter positioning of the one or more weights. The club head 12010 having the adjustable weighting system 12066 can have similar or identical parameters and measurements as club head 100 described above.

Figure 175:
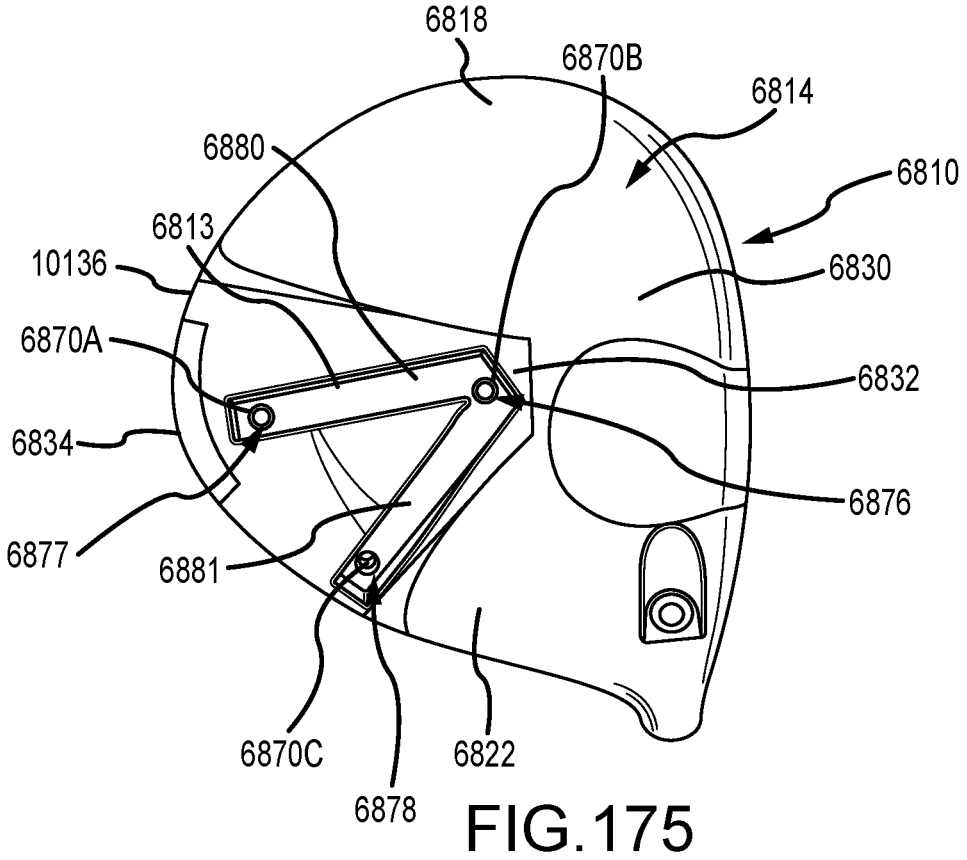
FIG. 175 is a bottom view of another embodiment of a golf club head.
Figure 176:
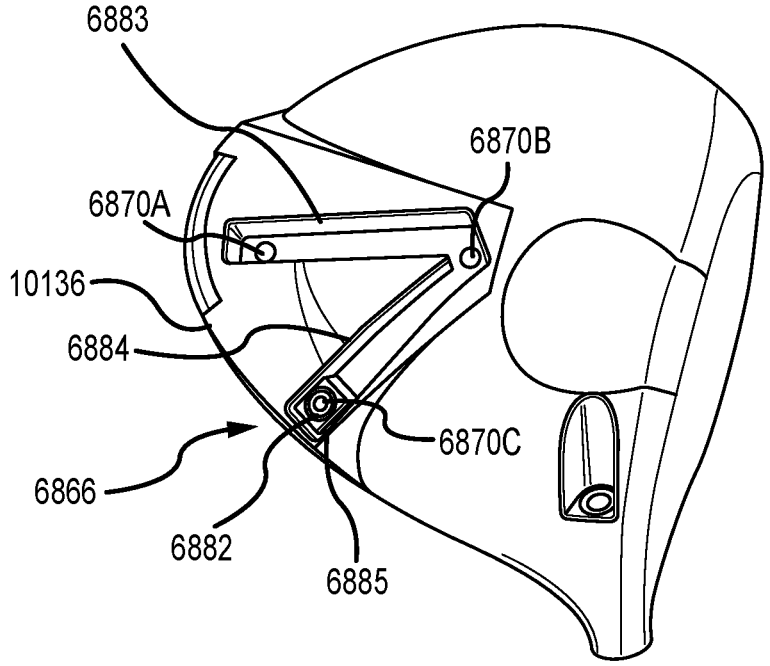
FIG. 176 is a bottom perspective view of the golf club head of FIG. 175.

FIGS. 175 and 176 illustrate a club head 6810 having a club head body 6814. The club head body 6814 includes an adjustable weighting system 6866 that is adjustable by an end user to modify the club head 6810 center of gravity and/or moment of inertia and/or heel/back bias to achieve desired performance characteristics (e.g., forgiveness, spin, trajectory) under various circumstances. The club head 6810 can be similar in many respects to club heads 100, 11010, and 12010 with similar or identical numbers referencing similar or identical components. The adjustable weighting system 6866 is a low profile system and thereby does not significantly shift or change the moment of inertia of the club head 6810 when compared to a club head devoid of the adjustable weighting system 6866. Further, the low profile adjustable weighting system 6866 ensures that shifts in the club head 6810 CG occur mainly down, at the back end 6834, and small shift to the heel end 6822 direction thereby keeping the overall CG of the club head 6810 in a low and back location. The center of gravity position and MOI of club head 6810 can be similar or identical to the center of gravity position and MOI of club head 100 described above.

Referring to FIGS. 175 and 176, the adjustable weighting system 6866 can comprise a recessed portion 6880. The recessed portion 6880 comprises a recessed surface 6881 configured to include a plurality of discrete attachment locations. The plurality of discrete attachment locations can comprise various features including protruding bodies, apertures, recesses or ports capable of receiving a fastener, notches or tabs or cutout regions, ribs or grooves, pegs, hooks, magnets, programmable magnets, or any other suitable attachment means. In the illustrated embodiment, the adjustable weighting system 6866 includes a recessed surface 6881 comprising three discrete attachment locations. The three distinct attachment locations can each include a feature 6870A, B, C. The features 6870A, B, C can be any of the features discussed above. The attachment locations and corresponding features 6870A, B, C are configured to receive one or more weights 6882.

Referring again to FIGS. 175 and 176, the recessed portion 6880 defines a groove, channel, and/or recessed track that extends along the sole or bottom of the club head 6810. The recessed portion 6880 extends from the back end 6834 (a standard position) to a sole center 6832 (a low spin position) to the heel end 6822 (a straight flight position to combat slicing) in a V-shaped configuration. The V-shaped configuration is located closer to the heel end 6822 than the toe end 6818 of the golf club body 6814. The recessed portion 6880 is defined by a recessed surface 6881 being indented or inset into the sole 6830. The recessed portion 6880 further includes an outer wall or first wall 6883 extending the entire length of the recessed portion 6880 and an inner wall or second wall 6884 extending the entire length of the recessed portion 6880. In the illustrated embodiment, the first wall 6883 and the second wall 6884 extend substantially perpendicular to the recessed surface 6881 and/or the sole 6830. In other embodiments, the first wall 6883 and second wall 6884 can extend at an angle between the recessed surface 6881 and/or the sole 6830.

As illustrated in FIGS. 175 and 176, the recessed portion 6880 comprises a first region 6877 near the back end 6834 and rear perimeter 10136 (the standard position) of the club head 6810, a second region 6876 near the sole center 6832 (the low spin position) of the club head 6810, and a third region 6878 near the heel end 6822 and rear perimeter 10136 (the straight flight position to combat slicing). The regions, however, are not isolated and are not generally distinguishable, other than the presence of attachment means. When a weight 6882 is coupled to the club head 6810 in one region of the recessed portion 6880, the weight 6882 may be flush with the sole 6830. When the weight 6882 is coupled to the club head 6810 in a different region of the recessed portion 6880, a portion of the weight 6882 may protrude outward from the sole 6830, a portion of the weight 6882 may sink inward or be recessed from the sole 6830, or a portion of the weight 6882 may be flush with the sole 6830.

The recessed portion 6881 includes a depth measured as the distance from the recessed surface 6881 to the sole 6830 in a direction perpendicular to the recessed surface 6881. In the illustrated embodiment, the recessed portion 6880 has a constant depth. In other embodiments, the recessed portion 6880 can have an increasing, decreasing, varying, and/or constant depth along its length from the back end 6834 to the sole center 6832, and/or from the sole center 6832 to the heel end 6822.

In many embodiments, the recessed portion 6881 has a shallow depth ensuring the adjustable weight system 6866 remains low in profile. The recessed portion 6881 can have an increasing, decreasing, varying, and/or constant the depth between the first region 6877 and the second region 6876, and/or between the second region 6876 and the third region 6878. For example, in some embodiments, the recessed portion 6880 has a maximum depth of 0.50 inches. In other embodiments, the recessed portion 6880 can have a maximum depth of 1.5, 1.25, 1.0, 0.9, 0.8, 0.7, 0.6, 0.5, 0.4, 0.3, 0.2, or 0.1 inches. In other embodiments, the depth of the recessed portion 6880 can vary within the range of 0.05 to 0.25, 0.1 to 0.4, 0.1 to 0.6, 0.1 to 0.8, 0.2 to 0.4, 0.2 to 0.6, 0.2 to 0.8, 0.3 to 0.7, 0.3 to 0.9, 0.4 to 0.8, 0.4 to 1.2, 0.5 to 1.0, 0.5 to 1.5, or 1.0 to 1.5 inches.

Further, the recessed portion 6880 includes a cross sectional shape and a cross sectional area. In some embodiments, the cross sectional shape of the channel 6813 can comprise a cylindrical shape, a circular shape, a rectangular shape, a triangular shape, a polygonal shape, or a trapezoidal shape. The recessed portion 6880 can have a varying and/or constant cross sectional shape between the first region 6877 and the second region 6876, and/or between the second region 6876 and the third region 6878. The recessed portion 6880 can have an increasing, decreasing, varying, and/or constant cross sectional area between the first region 6877 and the second region 6876, and/or between the second region 6876 and the third region 6878.

Additionally, the recessed portion 6880 includes a width measured as the distance between the first wall 6883 and second wall 6884. In some embodiments, the width between the first region 6877 and the second region 6876 is different from the width between the second region 6876 and the third region 6878. In some embodiments, the width between the first region 6877 and the second region 6876 is greater than the width between the second region 6876 and the third region 6878. In other embodiments, the width between the first region 6877 and the second region 6876 is less than the width between the second region 6876 and the third region 6878. In other embodiments, the recessed portion 6880 can have an increasing, decreasing, varying, and/or constant width between the first region 6877 and the second region 6876, and/or between the second region 6876 and the third region 6878. In many embodiments, the width can be less than 2.0 inches. For example, in some embodiments, the width can be less than 2.0, 1.75, 1.5, 1.25, 1.0, 0.9, 0.8, 0.7, 0.6, 0.5, 0.4, 0.3, or 0.2 inches. In other embodiments, the width can vary between 0.1 to 0.5, 0.3 to 0.7, 0.5 to 0.9, 0.7 to 1.1, 0.9 to 1.3, 1.1 to 1.5, 1.3 to 1.7, or 1.5 to 2.0 inches.

Referring again to FIGS. 175 and 176, the recessed portion 6880 can include one or more features 6870A, B, C defining a discrete attachment location for securing a weight 6882 to the club head 6810. The club head 6810 having one or more discrete attachment locations is different than other adjustable weighting systems, wherein the weight can be coupled at any, or at an infinite, or at an unlimited number of locations across the club head. Referring to FIGS. 175 and 176, in the illustrated embodiment, the recessed portion 6880 includes three features 6870A, B, C. The features 6870A, B, C are shown as apertures configured to receive a threaded fastener or screw fastener 6885. A weight of the screw fastener 6885 can be the same as or less than the amount of weight removed to form the features 6870A, B, C. Further, the screw fastener 6885 can comprise a material having a density the same as or less than the density of the material of the club head body. The screw fastener 6885 is configured for attaching a weight 6882 to the features 6870A, B, C. In other embodiments, the features 6870A, B, C can be a protruding body, aperture, recess, ports capable of receiving a fastener, notches, tabs, cutout regions, ribs, grooves, pegs, hooks, magnets, programmable magnets or any other suitable attachment means. In the illustrated embodiment, the adjustable weighting system 6866 includes three features 6870A, B, C. In other embodiments, the recessed portion 6880 can comprise any number of features, including one, two, three, four, five, six, seven, eight, nine or ten features 6870.

As illustrated, the features 6870A, B, C are disposed within the recessed portion 6880 along the recessed surface 6881 such that one or more weights 6882 may be removably or releasably coupled to the club head 6810 along the recessed portion 6880. More specifically, a first feature 6870A is positioned at the first region 6877 of the recessed portion 6880 near the back end 6834, a second feature 6870B is positioned at the second region 6876 of the recessed portion near the sole center 6832, a third feature 6870C is positioned at a third region 6878 of the recessed portion 6880 near the heel end 6822. In other embodiments, one or more of the features 6870A, B, C can be positioned on the first wall 6883, the second wall 6884, and/or the recessed surface 6881 of the recessed portion 6880.

With continued reference to FIGS. 175 and 176, the weights 6882 have a generally rectangular shape. In other embodiments, the weights 6882 can have a circular, ovular, triangular, trapezoidal, polygonal or any other suitable shape configured to fit within the recessed portion 6880. In the illustrated embodiment, the adjustable weighting system 6866 comprises one weight 6882. The weight 6882 may vary between 0.1-50 g. In some embodiments, the weight 6882 may vary between 0.1-0.5 g, 0.5 g-1 g, 1-5 g, 5-10 g, 10-20 g, 20-30 g, 30-40 g, 40-50 g. For example, the weight 6882 can be 0.1, 0.5, 1, 2, 3, 4, 5, 6, 7, 8, 8, 10, 20, 30, 40, or 50 grams. In other embodiments, the adjustable weighting system 6866 can comprise three weights 6882 corresponding with the number of features 6870A, B, C. In other embodiments, the adjustable weighting system 6866 can comprise more or less weights 6882 than the number of features 6870A, B, C. For example, the adjustable weighting system 6866 can comprise one, two, three, four, five, six, seven, eight, nine or ten weights 6882.

In the illustrated embodiment, the weights 6882 comprise apertures extending entirely through the weight 6882 that are sized and configured to receive a threaded fastener or screw fastener 6885. The screw fastener 6885 can be threaded through the weight 6882 into the corresponding feature 6870A, B, C thus securing the weight 6882 to the recessed portion 6880. In some embodiments, the weight 6882 can comprise a recessed or inset portion for receiving the top portion of the screw fastener 6885 and therefore the screw fastener 6885 can sit flush with the outer portion of the weight 6882. In other embodiments, the weights 6882 can be configured to be couple to the features 6870A, B, C through a friction fit, a snap-fit mechanism, with a set-screw, or with any other suitable structure.

In embodiments where the adjustable weight system 6866 comprises more than one weight 6882, each of the weights 6882 can have the same shape and size. In other embodiments, the weights 6882 can vary in shape and size, resulting in weights 6882 having varying masses. Further, in some embodiments, the weights 6882 are made of different materials such that they vary in mass. For example, one weight 6882 may be made of a high density material, such as tungsten, and the remaining weights 6882 may be made of a less dense material, such as polyurethane or another plastic. In other embodiments, the weights 6882 can comprise the same or different materials and can have different sizes or volumes such that they vary in mass. For example, one weight 6882 may have a greater volume than the remaining weights 6882. In some embodiments, each of the weights 6882 may vary in volume from one another and thus vary in mass. In some embodiments, the weights 6882 may vary in both volume and material from one another. In some embodiments, one of the structures labeled as 6882 is not a weight, but rather a light-weight (e.g., light-weight plastic) cover that snap-fits or otherwise couples to one of the features 6870A, B, C.

In some embodiments, the weights 6882 may vary between 0.1-50 g. For example, in embodiments having a plurality of weights 6882, one or more of the weights 6882 may vary between 0-10 g, one or more of the weights 6882 may vary between 10-20 g, one or more of the weights 6882 may vary between 20-30, one or more of the weights 6882 may vary between 30-40 g, and one or more of the weights 6882 may vary between 40-50 g. In some embodiments, a first weight 6882 may vary between 0-10 g, a second weight 6882 may vary between 10-20 g, and a third weight 6882 may vary between 20-30 g. In other embodiments, a first weight 6882 may vary between 1-5 g, and a second and third weight 6882 may vary between 5-30 g. In other embodiments, a first and second weight 6882 may vary between 1-10 g, and a third and fourth weight 6882, may vary between 5-25 g. In some embodiments, a first weight 6882 has a mass of 8.5 grams, and a second and third weight 6882 each have a mass of 1.5 grams. In other embodiments, a first weight 6882 has a mass of 12 grams, and a second and third weight 6882 each have a mass of 1.5 grams. In other embodiments, a first weight 6882 has a mass of 8.5 grams, and a second and third weight 6882 each have a mass of 0.75 grams. In other embodiments, a first weight can have a mass of 10-20 g, 10-25 g, or 15-25 g, and the remaining weight (e.g. second and third weight) can have a mass of 0.25-2.5 g, 0.25-5 g, 0.25-7.5 g, 0.25 to 10 g. In other embodiments, a first weight, can have a mass of 10, 11, 12, 13, 14, 15, 16, 17, 18, 19, 20, 21, 22, 23, 24, 25, 26, 27, 28, 29 or 30 grams and the remaining weights can have a mass of 1, 2, 3, 4, 5, 6, 7, 8, 9, or 10 grams. In other embodiments, any number of weights may have the same mass or may have a varying mass between 0.1-50 g.

With continued reference to FIGS. 175 and 176, in the illustrated embodiment one of the features 6270A, B, C receives a weight 6882, while the remaining features 6870A, B, C are bare and uncovered, devoid of a weight, or are covered with another material or structure. In other embodiments, each of the features 6870A, B, C receives a weight 6882. In some embodiments, one or more of the features 6870A, B, C can receive a weight 6882. In some embodiments, one or more of the features 6870A, B, C does not extend past an outer profile of the club head 6810, such that even if the feature 6870A, B, C is left bare and uncovered, the feature 6870A, B, C and or recessed portion 6880 will not interfere with or disrupt a golfer's swing.

The weights 6882 may be strategically positioned on the features 6870A, B, C to achieve a desired club head 6810 center of gravity position and/or moment of inertia and/or heel/back bias. For example, in some embodiments, a heavier weight 6882 is positioned on the feature 6870A, located near the back end 6834, while lighter weights are positioned on the features 6870B, C near the sole center 6832 and the heel end 6822. The aforementioned weight 6882 positions results in the center of gravity being shifted towards the back end 6834 of the club head 6810.

In some embodiments, a heavier weight 6882 is positioned on the feature 6870C near the heel end 6822, while lighter weights 6882 are positioned on the feature 6270A near the back end 6834 and 6870B located near the sole center 6832. The aforementioned weight 6882 positions results in the center of gravity being shifted towards the heel end 6822 of the club head 6810.

In some embodiments, a heavier weight 6882 is positioned on the feature 6870B located at the sole center 6832, while lighter weights 6882 are positioned on the feature 6870A near the back end 6834 and on the feature 6870C near the heel end 6822. The aforementioned weight 6882 positions results in the center of gravity being centered on the club head 6810.

In many embodiments, one or more of the features 6870A, B, C are of equal size and shape, such that one weight may be interchangeably used with each of the features 6870A, B, C. In some embodiments, one or more of the features 6870A, B, C can have a differing size and shape, such that each features 6870A, B, C has its own corresponding weight 6882 or set of weights 6882. Further, adjustment of the position of the weights 6882 on the features 6870A, B, C can also effect the spin imparted on the ball after impact.

The adjustable weighting system 6866 of golf club head 6810 maintains or prevents a significant reduction in club head moment of inertia, and low and back club head center of gravity positioning, compared to a club head devoid of an adjustable weighting system. The adjustable weighting system 6866 of golf club head 6810 maintains a high club head moment of inertia and a low and back club head CG position due to the low profile of the weighting system and the perimeter positioning of the one or more weights.

Figure 171:
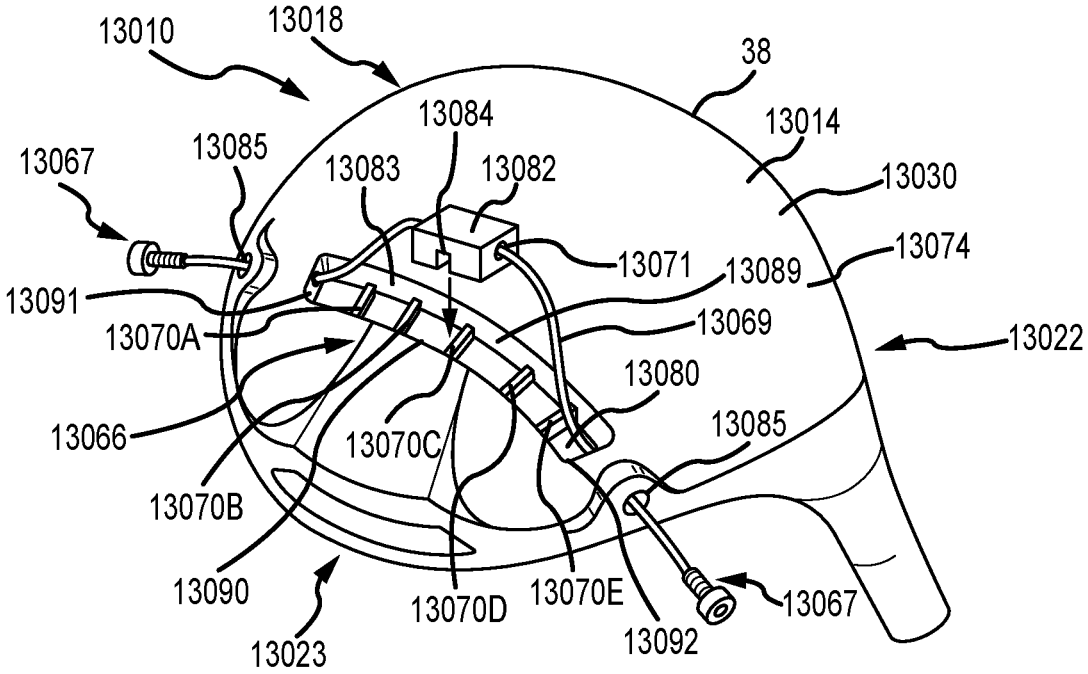
FIG. 171 is bottom perspective of another golf club head.
Figure 172:
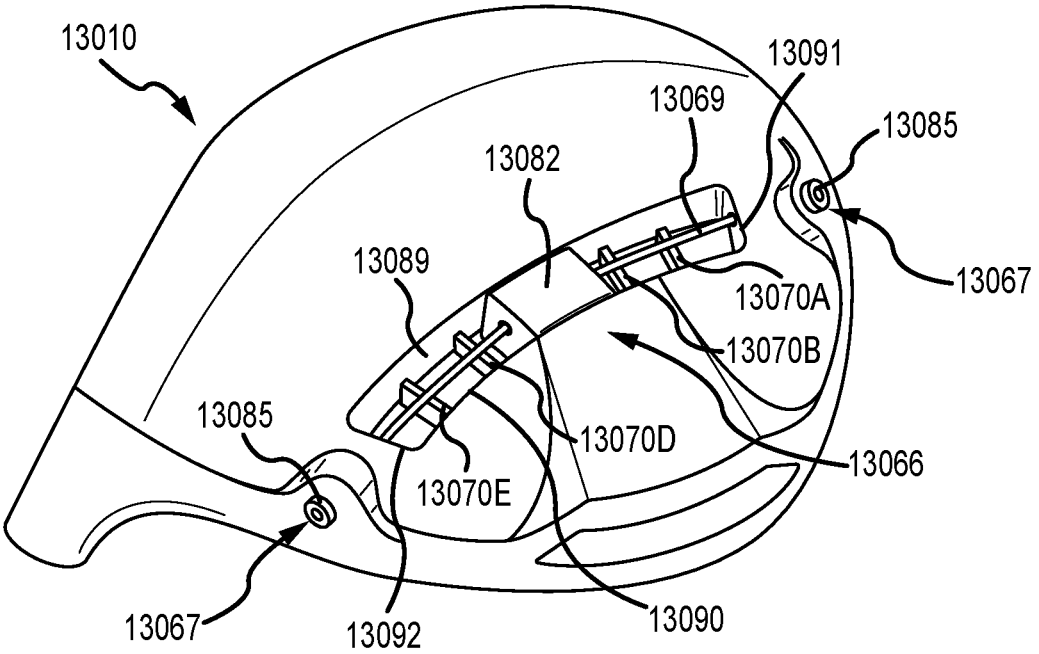
FIG. 172 is another bottom perspective view of the golf club head of FIG. 171.

FIGS. 171 and 172 illustrate a club head 13010 similar to the golf club head 100 described above, with similar or identical numbers referencing similar or identical components. The club head 13010 having a club head body 13014 includes an adjustable weighting system 13066 comprising a cable 13069 and a tensioner 13067 that is adjustable by an end user to modify the club head 13010 center of gravity and/or moment of inertia and/or heel/toe bias to achieve desired performance characteristics (e.g., forgiveness, spin, trajectory) under various circumstances. The adjustable weighting system 13066 is a low profile system and thereby does not significantly shift or change the MOI of the club head 13010 when compared to a club head not including the adjustable weighting system 13066. Further, the low profile adjustable weighting system 13066 ensures that shifts in the club head 13010 CG occur mainly in a heel end 13022 to toe end 13018 direction keeping the overall CG of the club head 13010 in a low and back location. The center of gravity position and MOI of club head 13010 can be similar or identical to the center of gravity position and MOI of club head 100 described above.

The adjustable weighting system 13066 is positioned on a sole 13030 of the club head 13010. As illustrated in FIGS. 171 and 172, the sole 13030 comprises a recessed portion 13080 having a recessed surface 13081. The recessed portion 13080 can be substantially rectangular in shape and can be positioned near a rear 13023, extending from near the toe end 13018 and rear perimeter 10136 to near the heel end 13022 and rear perimeter 10136. In the illustrated embodiment, the recessed portion 13080 extends generally parallel to a strike face 38. In other embodiments, the recessed portion 13080 can be placed anywhere on the sole 13030 and form any shape. The recessed portion 13080 is recessed from the outer surface 13074 of the sole 13030 by a wall 13083. In the illustrated embodiment, the wall 13083 is perpendicular to the recessed surface 13081 or the outer surface 13074 of the sole 13030. In other embodiments, the wall 13083 can be inclined or declined at a non-perpendicular angle to the recessed surface 13081 or the outer surface 13074 of the sole 13030. In the embodiment as illustrated in FIGS. 171 and 172, the wall 13083 can border an entire perimeter of the recessed portion 13080. In other embodiments, the wall 13083 can border a portion of the recessed portion 13080.

In many embodiment, the wall 13083 can include a first wall portion 13089 located toward the strike face 38 of the club head 13010, a second wall portion 13090 located opposite the first wall portion 13089 and toward a rear end 13023 of the club head 13010, a first end wall 13091 located toward the toe end 13018 of the club head 13010, and a second end wall 13092 located opposite the first end wall 13091 and toward the heel end 13022 of the club head 13010. Generally, the recessed surface 13081 extends substantially parallel to the sole 13030 of the club head 13010, while the first and second wall portions 13083, 13084 and the first and second end walls 13091, 13092 generally extend substantially perpendicular to the recessed surface 13081 and/or the sole 13030. In other embodiments, the first and second wall portions 13083, 13084 and/or the first and second end walls 13091, 13092 can extend at a non-perpendicular angle between the recessed surface 13081 and the sole 13030.

Figure 173:
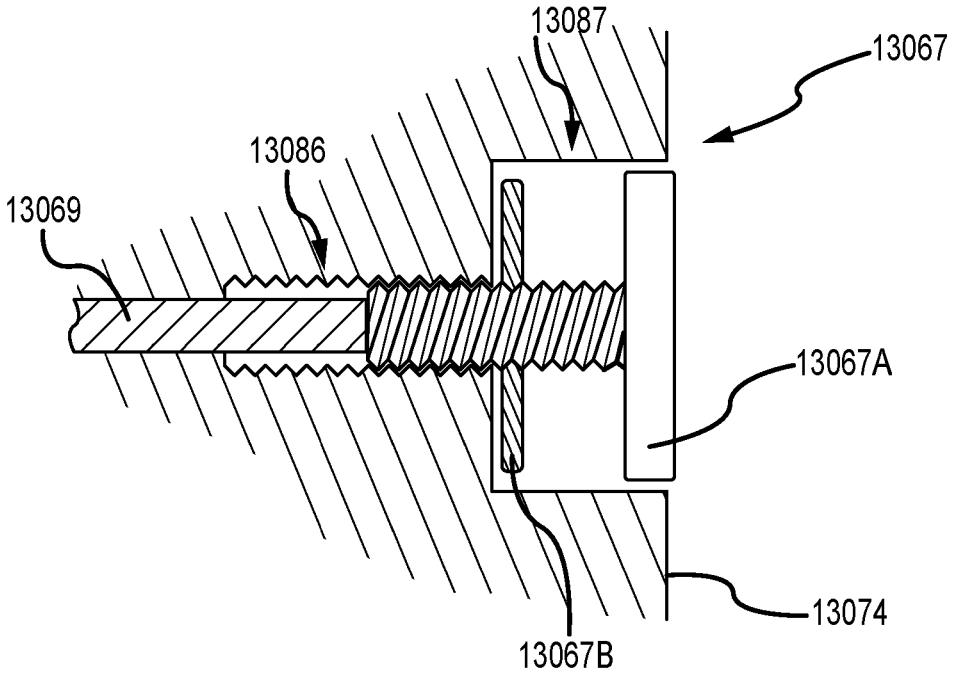
FIG. 173 is a cross-sectional view of an aperture and tensioner of the golf club head of FIG. 171.

In many embodiments as illustrated in FIGS. 171 and 172, the sole 13030 can further comprise one or more apertures 13085 extending from the outer surface 13074 of the sole 13030, into the club head body and into the recessed portion 13080. In some embodiments, the sole 13030 can comprise 1 aperture, 2 apertures, 3 aperture, 4 apertures, or 5 apertures 13085. In the illustrated embodiment of FIGS. 171 and 172, the sole 13030 comprises two apertures 13085. In the illustrated embodiment, the apertures 13085 are located on opposite sides of the recessed portion 13080. The apertures 13085 are positioned on the outer surface 13074 of the sole, and extend into the recessed portion 13080 of the adjustable weighting system. In the illustrated embodiment, the apertures 13085 extend into the first and second end walls 13091, 13092 of the recessed portion 13080. The apertures 13085 are configured to house the tensioner 13067 of the adjustable weighting system 13066. As illustrated in FIG. 173, the apertures 13085 comprise a threaded end 13086 adjacent the recessed portion 13080, and a head or receiving end 13087 adjacent the outer surface 13074 of the sole 13030.

In the illustrated embodiment, the recessed portion 13080 can further comprise a plurality of discrete attachment locations. The plurality of discrete attachment locations can comprise various features 13070 including protruding bodies, apertures, recesses or ports capable of receiving a fastener, notches or tabs or cutout regions, ribs or grooves, pegs, hooks, magnets, programmable magnets, or any other suitable attachment means. The features 13070 define discrete attachment locations for securing one or more weights 13082 to the club head 13010. The club head 13010 having one or more discrete attachment locations is different than other adjustable weighting systems, wherein the weight can be coupled at any, or at an infinite, or at an unlimited number of locations across the club head. In the illustrated embodiment, the features 13070 are straight wall-like protrusions or ribs 13070 extending from the recessed portion 13080, generally perpendicular relative to the strike face 38. In other embodiments, the features 13070 can be protrusions extending from the recessed portion 13080 at any angle, and in any shape (e.g., circular pegs, hourglass-shape pegs, square pegs, etc.)

As illustrated in FIGS. 171 and 172, the recessed portion 13080 comprises five features 13070, a first feature 13070A near the toe end 13018, a second feature 13070E near the heel end 13022, a third feature 13070C between the first feature 13070A and the second feature 13070E, a fourth feature 13070B between the first feature 13070A and the third feature 13070C, and a fifth feature 13070D between the second feature 13070E and the third feature 13070C. In other embodiments, the recessed portion 13080 can comprise any numbers of features 13070. For example, the recessed portion 13080 can comprise one feature 13070, two features 13070, three features 13070, four features 13070, five features 13070, six features 13070, seven features 13070, or eight features 13070. In some embodiments, each of the features 13070 are spaced generally equidistant from one another. In other embodiments, each of the features 13070 can be spaced at any distance apart from one another. In some embodiments, the features 13070 form square-shaped openings (or pockets) in between each feature

13070. In other embodiments, the features 13070 can form any shaped pocket (e.g. polygonal or any shape with at least one curved surface) between each feature 13070.

The weights 13082 are configured to be received by the features 13070 within the recessed portion 13080. The weights 13082 each have a general cross-sectional shape and size (e.g., cylindrical, cubicle, rectangular, trapezoidal, etc.) corresponding to the cross sectional shape of the recessed portion 13080. As illustrated in FIGS. 171 and 172, the weights 13082 can have a rectangular cross-sectional shape. The weights 13083 can further comprise a notch 13084 positioned on a bottom surface of the weight 13083. The notch 13084 on the weights 13083 is configured to mate with the features 13070 in the recessed portion 13080. In many embodiments, the shape of the notch 13084 on the weighs 13082 corresponds to the shape of the features 13070 in the recessed portion 13080.

The weights 13082 can further comprise a through hole 13071 configured to house the cable 13069 of the adjustable weighting system 13066. The through hole 13071 can extend through the weight 13082 in a direction from the heel end 13022 to the toe end 13018 of the club head 13010 when the weight 13082 is positioned within the recessed portion 13080. When assembled the through hole 13071 is parallel to the recessed surface 13081. In other embodiments, the weights 13082 can be devoid of the through hole 13071. In these or other embodiments, the weights 13082 can comprise a groove (not pictured) positioned on a top surface of the weights 13082, configured to receive the cable 13069.

The weights 13082 further comprise a mass. The mass of the weights 13082 can range from 3 grams to 35 grams, 3 grams to 12 grams, 5 grams to 18 grams, 8 grams to 23 grams, 12 grams to 25 grams, 18 grams to 27 grams, 20 grams to 30 grams, 25 grams to 33 grams, or 28 grams to 35 grams. For example, the weights 13082 can be 1 gram, 2 grams, 3 grams, 6 grams, 9 grams, 12 grams, 15 grams, 18 grams, 21 grams, 24 grams, 27 grams, 30 grams, 33 grams, or 35 grams. In embodiments wherein the club head 13010 comprises multiple weights 13082, the weights 13082 can all comprise the same mass, or all have different masses. For example, the club head 13010 comprises three weights 13082 with the first weight 13082 having a mass of 12 grams, and both the second and third weights 13082 having a mass of 5 grams. In another example, the club head 13010 comprises five weights 13082 with the first weight 13082 having a mass of 20 grams, the second weight 13082 having a mass of 15 grams, the third weight 13082 having a mass of 10 grams, the fourth weight 13082 having a mass of 7 grams, and the fifth weight 1082 having a mass of 3 grams.

Figure 174:
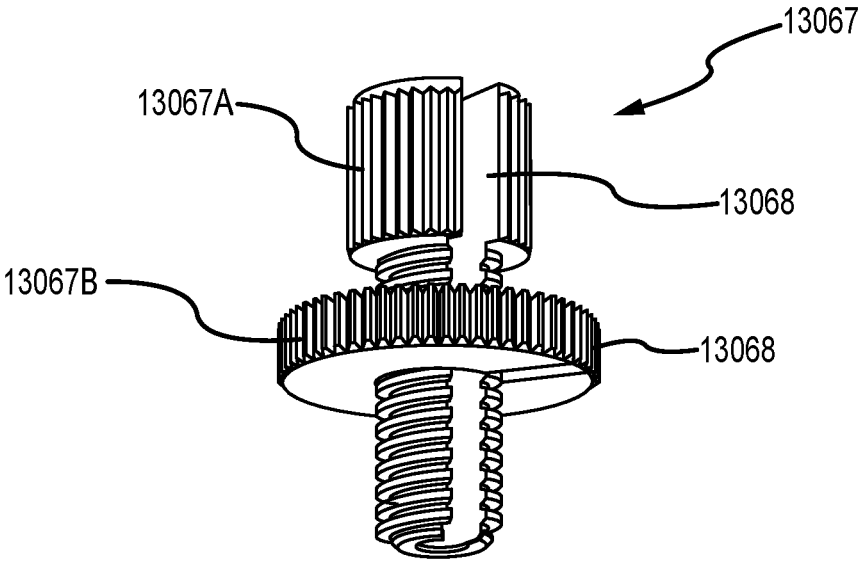
FIG. 174 is a front perspective view of a tensioner of the golf club head of FIG. 171.

The adjustable weighting system 13066 comprising the tensioner 13067 and the cable 13069 is configured to couple the weights 13082 to the club head 13010. The tensioner 13067 of the adjustable weighting system 13066 comprises a fastener 13067A and a washer 13067B. In some embodiments as illustrated in FIG. 174, the tensioner 13067 can be a clutch brake cable adjuster, wherein a notch 13068 is cut into the fastener 13067A (extending the entire length of the fastener 13067A) and the washer 13067B. The notch 13068 of the fastener 13067A and the washer 13067B allow for the cable 13069 to be coupled to the fastener 13067. In other embodiments, the tensioner 13067 can be any type of fastener and washer having a notch configured to receive the cable 13069.

As illustrated in FIGS. 172 and 173, the tensioner 13067 is configured to be received within the aperture 13085 of the sole 13030. The tensioner 13067 can be inserted into the receiving end 13087 of the aperture, wherein a threaded end of the fastener 13067A mates with the threaded end 13086 of the aperture 13085, and the washer 13067B remains in the receiving end 13087 of the aperture. In some embodiments, the adjustable weighting system 13066 can comprise more than one tensioner 13067. For example, the adjustable weighting system 13066 can comprise one tensioner, two tensioners, three tensioners, or four tensioners 13067. In many embodiments, the number of tensioners 13067 corresponds to the number of apertures 13085 configured to receive the tensioners 13067. For example as illustrated in FIGS. 171 and 172, the sole 13030 comprises a first aperture 13085 near the toe end 13018 configured to receive a first tensioner 13067, and a second aperture 13085 near the heel end 13022 configured to receive a second tensioner 13067. In many embodiments, when the tensioner 13067 is housed within the aperture 13085, the tensioner 13067 does not extend past the outer surface 13074 of the sole 13030.

The cable 13069 of the adjustable weighting system 13066 is configured to be received by the tensioner 13067, and positioned within the recessed portion 13080. The cable 13069 can be coupled to the tensioner 13067 via the notch 13068 of the fastener 13067A and washer 13067B, wherein the washer 13067B then rotates to secure the cable 13069 within the fastener 13067A. An end of the cable 13069 comprises a width greater than a width of the notch 13068, which prevents the cable 13069 from dislodging from the fastener 13067A when tension is applied to the cable 13069. In some embodiments, the adjustable weighting system 13066 comprises one tensioner 13067, wherein one end of the cable 13069 is configured to be coupled to the tensioner 13067, and the other end of the cable 13069 is configured to be attached/fixed at an opposite end of the club head 13010 from the tensioner 13067. In other embodiments, the adjustable weighting system comprises two tensioners 13067, wherein one end of the cable 13069 can be configured to couple to a first tensioner 13067, and the other end of the cable 13069 can be configured to couple to the second tensioner 13067. For example, as illustrated in FIGS. 171 and 172, the one end of the cable 13069 can be coupled to the first tensioner 13067 near the heel end 13022, and the other end of the cable 13069 can be coupled to the second tensioner 13067 near the toe end 13018.

The cable 13069 can be a metallic material (e.g., steel wire rope, aluminum wire rope, copper wire rope, tungsten wire rope, nickel wire rope, silver wire rope, or any other metallic wire rope), or a non-metallic material such as a fiber, a polymer, a plastic, or a composite type rope. For example, the cable 13069 can comprise baling twine, parachute cord material, nylon, Kevlar, polymer tweed, steel wire with polymer coating, any metallic wire with polymer coating, high modulus polyethylene fiber, polycarbonate, polyoxymethylene, and/or nylon with polyamide.

The tensioner 13067, when received within the aperture 13085 of sole 13030, can be rotated (i.e., twisted) to adjust the tension in the cable 13069. The notch 13068 of the tensioner 13067 allows the cable 13069 to couple to the tensioner 13067 in such a way that when the tensioner 13067 rotates, the cabled 13069 remains stationary, and does not rotate with the tensioner 13067. The washer 13067B of the tensioner 13067 acts as a stop within the aperture 13085, preventing the fastener 13067A of the tensioner 13067 from moving within the aperture 13085 during a swing and/or impact. When the tensioner 13067 is rotated clockwise, the tensioner 13067 recedes deeper into the aperture 13085, and the cable is loosened. With the cable 13069 loosened, the weight 13082 can be lifted from the feature 13070 within the recessed portion 13080, and moved (or the weight 13082 having the through hole 13071 can slide along the cable 13069) to another feature 13070. Further, when the cable 13069 is loosened, additional weights 13082 comprising grooves (not pictured) can be positioned onto the features 13070 and under the cable 13069 to increase weight. Repositioning the weights 13082 reconfigures the CG of the club head 13010. For example, the weight 13082 can be repositioned from the first feature 13070A near the toe end 13018 to the second feature 13070E near the heel end 13022, wherein the CG shift toward the heel end 13022 helps correct ball trajectory for players who tend to slice the ball and/or generate a draw. In other embodiments, the cable 13069 can be loosened by other means other than by the tensioner 13067.

The tensioner 13067 can be rotated (i.e., twisted) counterclockwise to tighten the tension within the cable 13069, wherein the washer 13067B prevents the fastener 13067A of the tensioner 13067 from moving within the aperture 13085. When the tensioner 13067 is rotated counterclockwise, the tensioner 13067 positioned in the aperture 13085 extends outward toward the outer surface 13074 of the sole 13030, wherein the tensioner 13067 is flush with the outer surface 13074 to indicate the cable 13069 reached maximum tension. As illustrated in FIG. 172, when the cable 13069 is tightened, and the cable 13069 presses on the weights 13082 (i.e., presses on against the through hole 13071, or the groove) creating a force against the features 13070 of the recessed portion 13080 to secure the weights 13082. When the weights 13082 abut against the features 13070, the weights 13082 are flush with the outer surface 13074 of the sole 13030. In other embodiments, when the weights 13082 abut against the features 3270, the weights 13082 can extend past the outer surface 13074 of the sole 3230, however, the weights 13082 do not extend past a lowest point of the club head 13010 when at address. In other embodiments still, when the weights 13082 abut against the features 13070, the weights 13082 can be recessed from and not extending to, or past the outer surface 13074 of the sole 3230. In other embodiments, the cable 13069 can be retracted by means other than by the tensioner 13067.

The club head 13010 having the adjustable weighting system 13066 comprising the tensioner 13067 (or other cable adjustment means) and the cable 13069 described above can optimize the performance of the golf club. The adjustable weighting system 13066 allows for the club head 13010 to adjust the weight of a low center of gravity club head about the x-axis (heel-to-toe end) without having to sacrifice a high moment of inertia (MOI), similar to that of a club head devoid of an adjustable weight system. Shifting the CG about the x-axis allows players to correct a slice or a hook in ball trajectory.

The club head 13010 having the adjustable weight system 13066 with the tensioner 13067 and the cable 13069 further has a utility regarding ease of manufacturing, compared to club heads with more complex structures to house a weight (e.g., deep weight ports, multiple weight ports, rail systems, weight covers/caps). The weight(s) 13082 coupled to the club head body 13014 are secured by the tension of the cable 13069, which creates a force on the weight(s) 13082 onto the feature(s) 13070 of the club head 13010. The tension produced force eliminates the need for the club head 13010 to be manufactured with a weight housing structure having complex internal/external geometries in order to secure the weight(s) 13082. Accordingly, the material and mass associated with the complex weight housing structure can be reduced. The mass saved using the low profile adjustable weighting system can then be positioned elsewhere on the club head to increase strength and/or MOI, and to improve CG positioning. The tension created force of the cable 13069 further eliminates the need for screw-type fasteners, thus the weight(s) 13082 and the club head 13010 do not require manufacturing a threaded aperture and receiving geometry to receive the fastener. The lack of the fastener and threaded aperture reduces the cost of manufacturing and improves the ease of production.

Further, the cable 13069 of the adjustable weighting system 13066 is lightweight, strong, and can be incorporated in a number of different patterns on recessed portion 13080 of the club head 13010. The different patterns allow for the weight(s) 13082 to be place in a number of different locations on the sole 13030 because the weight(s) 13082 are not limited to specific weight housing structures. The number of different weight positions can help fine tune the CG placement to adjust the ball spin and trajectory for individual players. The cable 13069 can further be strategically placed in such a pattern that the cable can reinforce specific locations on the club head 13010. The material and pattern of the cable 13069 can further act as a sound dampener and absorb vibrations experienced by the club head 13010 during impact, thereby reducing unwanted sound, and unwanted stress during a game.

The adjustable weighting system 13066 of golf club head 13010 maintains or prevents a significant reduction in club head moment of inertia, and low and back club head center of gravity positioning, compared to a club head devoid of an adjustable weighting system. The adjustable weighting system 13066 of golf club head 13010 maintains a high club head moment of inertia and a low and back club head CG position due to the low profile of the weighting system and the perimeter positioning of the one or more weights. The club head 13010 having the adjustable weighting system 13066 can have similar or identical parameters and measurements as club head 100 described above.

In some embodiments, one or more of the other adjustable weights described herein (e.g., weights 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082)) are positioned at a minimum distance from a center of gravity (CG) of their associated club head ranging from approximately 1.0 inches to 2.6 inches (e.g. approximately 1.0 inches, approximately 1.2 inches, approximately 1.4 inches, approximately 1.6 inches, approximately 1.8 inches, approximately 2.0 inches, approximately 2.2 inches, approximately 2.4 inches, or approximately 2.6 inches). In some embodiments, one or more of the other adjustable weights described herein (e.g., weights 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082)) are also positioned within a maximum distance of approximately 0.450 inches to approximately 0.550 inches inward from a perimeter of their associated club head when viewed from a top or side view (e.g., the maximum distance from the perimeter can be approximately 0.450 inches, approximately 0.460 inches, approximately 0.470 inches approximately 0.480 inches approximately 0.490 inches approximately 0.500 inches approximately 0.510 inches approximately 0.520 inches approximately 0.530 inches approximately 0.540 inches, or approximately 0.550 inches). Other embodiments include different values and ranges.

In some embodiments, the weight or weights described herein (e.g., 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5882, 5982, 6082, 6182, 6282, 6382, 6482, 6582, 6682, 6782, 6882, 11082, 12082, and/or 13082)) are made at least partially of a high density metal, metal alloy or any other material (e.g., plastic or composite with high density metal beads or powder). In some embodiments, the weights 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082) are made at least partially of steel, tungsten, aluminum, titanium, vanadium, chromium, cobalt, nickel, other metals, metal alloys, or any combination thereof. In some embodiments the cable or cables described herein (e.g., 3269, 3369, 3469, 3569, 3669, 3769, 3869, 3969, 4069, 4169, 4469, 4569, 4669, 4769, 4869, 4969, and/or 13069) are made of metal, although other embodiments include different materials for the weights and the cables described herein.

In some embodiments, one or more of the cable or cables 3269, 3369, 3469, 3569, 3569, 3669, 3769, 3869, 3969, 4069, 4169, 4469, 4569, 4669, 4769, 4869, and/or 4969 described above is a wire, a high modulus polyethylene fiber, a polycarbonate material, a polyoxymethylene material, and/or a nylon material with polyamide.

In many embodiments, the cable 13069 can comprise a thickness between 0.020 inch and 0.125 inch. For example, in some embodiments, the thickness of the cable or cables described herein (e.g., 3269, 3369, 3469, 3569, 3669, 3769, 3869, 3969, 4069, 4169, 4469, 4569, 4669, 4769, 4869, 4969, and/or 13069) can be between 0.021 inch and 0.041 inch, between 0.037 inch and 0.057 inch, between 0.053 inch and 0.073 inch, between 0.068 inch and 0.088 inch, between 0.084 inch and 0.104 inch, between 0.099 inch and 0.119 inch, or between 0.115 inch and 0.135 inch.

In some embodiments, the cable or cables described herein (e.g., 3269, 3369, 3469, 3569, 3669, 3769, 3869, 3969, 4069, 4169, 4469, 4569, 4669, 4769, 4869, 4969, and/or 13069) can withstand a tensile load up to 1500 Newtons (N). For example, in many embodiments, the cable can withstand a tensile load between 200 N and 1500 N. For example, in some embodiments, cable can withstand a tensile load up to 200 N, up to 300 N, up to 400 N, up to 500 N, up to 600 N, up to 700 N, up to 800 N, up to 900 N, up to 1000 N, up to 1100 N, up to 1200 N, up to 1300 N, up to 1400 N, or up to 1500 N. Other embodiments can include different range and values.

In some embodiments, one or more of the tensioners described herein (e.g., 3267, 3367, 3467, 3567, 3667, 3767, 3867, 3967, 4067, 4167, 4467, 4567, 4667, 4767, and/or 13067) is pushed down (i.e., toward the club head) to engage the tensioner. The tensioner is then turned in one direction (e.g., clockwise) to tension the cable or cables. To release tension, the tensioner is pulled up (i.e., away from the club head). In some embodiments, a force of at least 2 lb is required to pull the tensioner back up to loosen the cable or cables, although other embodiments include different values and ranges (e.g., at least 4 lb, 6 lb, 8 lb, 10 lb, 12 lb, 15 lb, 20 lb etc.). In some embodiments, the rotation of the tensioner in a loosening direction (e.g., counterclockwise) may be limited to prevent over-rotation of the tensioner and to prevent tangling or unwanted spooling of the cable or cables. The rotation of the tensioner in the tightening direction (e.g., clockwise) may also be limited. The tensioners described above may also be of a particular size or range of size. For example, in some embodiments, each tensioner may have a diameter of less than 2 inches, less than 1 inch, less than 0.5 inch, etc. Various other ranges and values are also possible. In some embodiments, the cable has a diameter less than 0.5 inches, less than 0.25 inches, less than 0.10 inches, or other values and ranges. In some embodiments, a separate adjustment tool is used to adjust the tensioner (e.g., to rotate or otherwise move the tensioner) and adjust tension in the cables.

In some embodiments, one or more of the club heads described herein may include more than one tensioner. For example, in some embodiments one of the club heads 3210, 3310, 3410, 3510, 3610, 3710, 3810, 3910, 4010, 4110, 4410, 4510, 4610, 4710, and/or 13010 may include two or more tensioners (e.g., along a single recessed portion or separate recessed portions of the club head) that are each coupled to one or more cables. In some embodiments, one tensioner tensions a first set of cables to hold a weight or weights against the club head, and another tensioner tensions a second set of cables to hold a weight or weights against the club head.

While some of the embodiments described herein include a single cable, whereas other embodiments include multiple cables, any of the embodiments described herein may include a single or multiple cables associated with one or more tensioners.

While some of the embodiments described herein include a single channel that guides a cable and/or provides a feature or features for positioning a weight or weights, and other embodiments described above include a distinct network of channels that guide one or more cables and/or provide features for positioning one or more weights, any of the embodiments described herein may include a single channel or network of channels. Additionally, while certain networks of channels are illustrated, any of the club heads described herein may include any arrangement, pattern, or size of channels.

While various grooves (e.g., 3271, 3371, 3571, 3671, 3771, 3871) in the weights are described above and illustrated, other embodiments include different numbers, sizes, and shapes of grooves to accommodate a cable. For example, in some embodiments, one or more of the weights 3282, 3382, 3482, 3582, 3682, 3782, 3882, 3992, 4082, 4182, 4282, 4982, and/or 13082 includes a groove or track that has a C-shaped contour (as opposed to a U-shaped or V-shaped contour), such that the cable or cables may "snap" into the groove and generally be held in place the groove, while still allowing the weight to slide along the cable. In some embodiments, one or more of the channels for the cable or cables has a C-shaped (or other shape) contour or track (as opposed to a U-shaped or V-shaped contour), such that the cable or cables may "snap" into the channel and generally be held in place in the channel, while still allowing the cable to move within the channel. In some embodiments, the channels include tracks or other contours that hold or restrain the cables, for example as the channels curve along the club head body, such that the cables do not come out of the channels during tensioning of the cables.

In some embodiments, one or more of the weights described herein (e.g., 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082)) is attracted to the club head 3210, 3310, 3410, 3510, 3610, 3710, 3810, 3910, 4010, 4110, 4210, 4310, 4410, 4510, 4610, 4710,

4810, 4910, 5010, 5110, 5210, 5310, 5410, 5510, 5610, 5710, 5810, 5910, 6010, 6110, 6210, 6310, 6410, 6510, 6610, 6710, 6810, 11010, 12010, and/or 13010 via a magnetic force, such that the weight or weights are held against the club head at least partially by the magnetic force. For example, in some embodiments one or more of the features 3270, 3370, 3470, 3570, 3670, 3770, 3870, 3970, 4070, 4170, 4270, 4370, 4470, 4570, 4670, 4870, 4970, 5070, 5170, 5270, 5370, 5470, 5570, 5670, 5770, 5870, 5970, 6070, 6170, 6270, 6370, 6470, 6570, 6670, 6770, 6870, 11070, 12070, and/or 13070 is a protruding body or notch that is comprised at least partially of a metallic material, and one or more of the weights 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082 is comprised at least partially of a magnetic material. The weight or weights may be held in place at least partially by the magnetic attractive force between the magnet or magnets and the feature or features, as well as by one or more tensioners and cables as described herein, or by one or more of the other structures described herein (e.g., threaded protruding post, ribs, etc.) In some embodiments, the weight or weights snap into place over a protruding body or into a notch, and are held against the club head at least partially by a frictional force, as well as by the magnetic force. In some embodiments, the weight or weights are held in place solely by the magnetic force. In some embodiments, the weight or weights may be slid along the cable or cables described herein until the weight or weights magnetically snap onto or into a different protruding body or notch. In yet other embodiments, one or more of the weight or weights 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082 is comprised at least partially of the metallic material, and one or more of the features 3270, 3370, 3470, 3570, 3670, 3770, 3870, 3970, 4070, 4170, 4270, 4370, 4470, 4570, 4670, 4870, 4970, 5070, 5170, 5270, 5370, 5470, 5570, 5670, 5770, 5870, 5970, 6070, 6170, 6270, 6370, 6470, 6570, 6670, 6770, 6870, 11070, 12070, and/or 13070 is comprised at least partially of the magnetic material.

In some embodiments, one or more of the weights described herein (e.g., 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, and/or 13082) is pressed against and held to the club head 3210, 3310, 3410, 3510, 3610, 3710, 3810, 3910, 4010, 4110, 4210, 4310, 4410, 4510, 4610, 4710, 4810, 4910, 5010, 5110, 5210, 5310, 5410, 5510, 5610, 5710, 5810, 5910, 6010, 6110, 6210, 6310, 6410, 6510, 6610, 6710, and/or 13010 via tension alone in a cable or cables. Thus, at least in some embodiments, the club head does not include separates notches or protrusions or other features that are sized and shaped to accommodate a single weight. Rather, the club head includes a larger surface (e.g., a recessed surface) and a tensioner and one or more cables that are coupled to (e.g., pressed against) one or more of the weights. The tension of the cable or cables alone via activation of the tensioner is sufficient to hold the weight or weights against the club head in a desired position or location. When the tension is released in the tensioner, the weight or weights may then be moved to a different location along the surface.

In some embodiments, one or more of the weights described herein (e.g., 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082) includes a rail or rails (e.g., a T-shaped rail, etc.) along a portion of the weight. Additionally, one or more channels (e.g., a network of channels) are formed in the club head that are sized and shaped to receive the rails, such that the weight or weights may slide along the channels from one position to another along the club head. In some embodiments, at least one tensioner and cable, and/or at least one magnet, may also be provided to help secure the weight or weights in various positions along the club head (e.g., along the channels).

In some embodiments, one or more of the weights described herein (e.g., 3282, 3382, 3482, 3582, 3682, 3782, 3882, 3992, 4082, 4182, 4282, 4382, 4482, 4582, 4682, 4782, 4882, 4982, 5082, 5182, 5282, 5382, 5482, 5582, 5682, 5782, 5982, 6082, 6182, 6282, 6382, 6482, 6582, 6682, 6782, 6882, 11082, 12082, and/or 13082) includes a port or hole to receive a protrusion from the club head body, or the weight includes a protrusion or screw to be received in a hole or port in the club head body (e.g., in a recessed region of the club head body). Thus, the weights may be moved from one area of the club head to another (e.g., along a cable or cables, along a channel or channels, etc.), and then positioned and held in another area along the club head via the port, hole, protrusion, or screw.

Additionally, while some of the embodiments described above are described in the context of having a recessed region and/or a recessed surface on the sole of the club head body, in some embodiments the club head body may also include a recessed region, including a recessed surface, along a crown or top of the club head. Thus, while generally described above as being primarily disposed on a sole of a club head, in some embodiments the adjustable weighting systems 3266, 3366, 3466, 3566, 3666, 3766, 3866, 3966, 4066, 4166, 4266, 4366, 4466, 4566, 4666, 4766, 4866, 4966, 5066, 5166, 5266, 5366, 5466, 5566, 5666, 5766, 5866, 5966, 6066, 6166, 6866, 11066, 12066, and/or 13066 may instead be primarily disposed on a crown, skirt, heel, toe, or toe of the club head.

Any embodiments discussed above having a protruding body can be similar to the protruding bodies illustrated in FIGS. 59-66 and described above.

While various protrusions are illustrated and described herein as being used to couple a weight to a club head, the specific shapes and sizes of the protrusions are not limiting. Thus, varying geometries of the protrusions (e.g. tapered protrusions, or protrusions of varying sizes and shapes) may be used, including cylindrical, rectangular, square, helical, trapezoidal, pyramid, etc. Protrusions and/or corresponding apertures may be keyed to fit one another. Some of the protrusions may be wings or tabs that extend away from the club head, or may be posts. Various other types of protrusions may also be used.

While various covers (e.g., 5074), sole plates (e.g., 5273), geometric patterns (e.g., 5070), tensioners (e.g., 4967), cables (e.g., 4969), guides (e.g., 4985), clips (e.g., 4890), turnbuckles (e.g., 4783), elongate channels (e.g., 4513), additional channels (e.g., 4493), screw apertures (e.g., 4371), and other features are described above in conjunction with a particular embodiment or embodiments, in yet other embodiments one or more of these features may be combined with a different embodiment, or with one or more of the other features described herein, on a golf club head.

While not illustrated, in some embodiments one or more of the club heads described herein may also include additional apertures that are filled with polymer glue or other material for additional weighting.

In some embodiments, a tool may be used to tighten, loosen, and/or remove one or more of the weights described herein. For example, in some embodiments one or more of the weights may include a specially designed or custom hole, or a specially designed socket, of sufficient size to engage with a portion of a tool (e.g., torque wrench) to facilitate engagement of the torque wrench with the weight. The hole or socket can be any suitable shape, such as star, triangle, square, slot, Phillips®, Torx®, POSIDRIV®, SUPADRIVE®, pentagon, hexagon, or any other suitable polygon or other keyed shape.

Example 1—Single Ledge Adjustable Weighting System for a High Volume Driver

According to one example of the golf club head 6710 illustrated in FIGS. 162 and 163, the club head 6710 comprises a volume of 460 cubic centimeters (cc). The exemplary club head 6710 includes an adjustable weighting system 6766 having a single ledge or recess with three attachment locations including a first attachment location near the toe, a second attachment location near the heel, and third attachment location between the toe and the heel.

The adjustable weighting system 6766 of the exemplary club head 6710 further comprises a first weight having a mass of 18 grams. The first weight has a height 10152 of 0.12 inch, a width 10154 of 0.97 inch, and a depth of 0.48 inch. The first weight comprises an aperture corresponding to a plurality of apertures defining the attachment locations on the club head 6710. The first weight is secured to the attachment location using a fastener positioned through the aperture in the first weight and the aperture in club head. The fastener comprises the same material or a material having a lower density than the density of the body, such that the fastener does not significantly contribute to the club head weighting.

The first weight is positionable at the first attachment location near the toe, the second attachment location near the heel, or the third attachment location between the toe and the heel. The first weight has a surface area of 0.434 inch in contact with the club head body (i.e. the recess) when the weight is coupled to any of the attachment locations. Referring to Table 1 below, the weight center of gravity 10134 of the first weight is positioned at a distance 10142 of 0.379 inch to 0.413 inch from the rear perimeter 10136 of the club head 6710 when the first weight is positioned at the first, second, or third attachment location. Further, the weight center of gravity 10134 of the first weight is positioned at a distance 10138 of 3.496 inches to 4.408 inches from the geometric center 140 of the strike face 38 when the first weight is positioned at the first, second, or third attachment location.

Further referring to Table 1 below, the club head 6710 includes a head CG depth 10130 between 1.711 inches and 1.828 inches, and a head CG height 10132 of 0.057 inch to 0.091 inch above the head depth plane 10120. The exemplary club head 6710 further includes a moment of inertia about the x-axis $I_{xx}$ between 3,465 and 3,787 g·cm$^2$, a moment of inertia about the y-axis $I_{yy}$ between 5,000 and 5,361 g·cm$^2$, and a moment of inertia about the hosel axis $I_{hh}$ between 8,974 and 10,084 g·cm$^2$. The combined moment of inertia of the exemplary club head 6766 about the club head CG (i.e. the sum of the moment of inertia about the x-axis and the moment of inertia about the y-axis) is between 8,290 and 9,148 g·cm$^2$. The combined moment of inertia of the exemplary club head 6766 about the club head CG and the hosel axis (i.e. the sum of the moment of inertia about the x-axis, the moment of inertia about the y-axis, and the moment of inertia about the hosel axis) is between 17,264 and 19,032 g·cm$^2$.

Further referring to Table 1 below, the exemplary club head having the adjustable weighting system 6766 has a depth to mass ratio of the club head CG depth to the mass of the first weight between 0.095 inch and 0.102 inch. Further, the exemplary club head having the adjustable weighting system 6766 has a first inertia to mass ratio of the combined moment of inertia of the club head about the head CG to the mass of the first weight between 461 and 508 cm$^2$. Further still, the exemplary club head having the adjustable weighting system 6766 has a head CG to mass ratio of the maximum shift in head CG to the mass of the first weight of 0.011 inch/gram. Accordingly, the adjustable weighting system 6766 of the exemplary club head 6710 maximizes head CG depth, moment of inertia, and head CG shift by a user, without the use of a large and heavy weight necessitating sizeable weight structures.

TABLE 1

Weighting Properties of Exemplary Golf Club Head 6710

| First weight position | First position (toe) | Second position (heel) | Third position (center) |
|---|---|---|---|
| $W_{CG}$-perimeter 10142 (inch) | 0.413 | 0.390 | 0.379 |
| $W_{CG}$-face center 10138 (inch) | 4.049 | 3.469 | 4.408 |
| $CG_D$ 10130 (inch) | 1.767 | 1.711 | 1.828 |
| $CG_H$ 10132 (inch above head depth plane 10120) | 0.091 | 0.057 | 0.060 |
| $I_{xx}$ (g · cm$^2$) | 3465 | 3290 | 3787 |
| $I_{yy}$ (g · cm$^2$) | 5432 | 5000 | 5361 |
| $I_{hh}$ (g · m$^2$) | 10084 | 8974 | 9884 |
| $I_{xx} + I_{yy}$ (g · cm$^2$) | 8806 | 8290 | 9148 |
| $I_{xx} + I_{yy} + I_{hh}$ (g · cm$^2$) | 18890 | 17264 | 19032 |
| $CG_D$/mass (inch/g) | 0.098 | 0.095 | 0.102 |
| $I_{xx} + I_{yy}$/mass (cm$^2$) | 489 | 461 | 508 |
| Max CG shift/mass (in/g) | 0.011 | 0.011 | 0.011 |

Moving the weight between the first, second, and third attachment locations results in a maximum shift in the club head center of gravity of 0.20 inch. The maximum shift in center of gravity of the exemplary club head 6710 results in a total trajectory change of up to 9.3 yards (i.e. when shifting the first weight from the first to the second attachment location, or from the second to the first attachment location). Accordingly, shifting the weight from the third attachment location to the second attachment location can change the trajectory of a golf ball 4.6 yards to correct for a slice or generate a draw. Further, shifting the weight from the third attachment location to the first attachment location can change the trajectory of a golf ball 4.6 yards to correct for a hook or generate a fade.

Example 2—Single Ledge Adjustable Weighting System for a Mid Volume Driver

According to another example of the golf club head 6710 illustrated in FIGS. 162 and 163, the club head 6710 comprises a volume of 445 cubic centimeters (cc). The exemplary club head 6710 includes an adjustable weighting system 6766 having a single ledge or recess with three attachment locations including a first attachment location near the toe, a second attachment location near the heel, and third attachment location between the toe and the heel.

The adjustable weighting system 6766 of the exemplary club head 6710 further comprises a first weight having a mass of 18 grams. The first weight has a height 10152 of 0.12 inch, a width 10154 of 0.97 inch, and a depth of 0.48. The first weight comprises an aperture corresponding to a plurality of apertures defining the attachment locations on the club head 6710. The first weight is secured to the attachment location using a fastener positioned through the aperture in the first weight and the aperture in club head. The fastener comprises the same material or a material having a lower density than the density of the body, such that the fastener does not significantly contribute to the club head weighting.

The first weight is positionable at the first attachment location near the toe, the second attachment location near the heel, or the third attachment location between the toe and the heel. The first weight has a surface area of 0.434 inch in contact with the club head body (i.e. the recess) when the weight is coupled to any of the attachment locations. Referring to Table 2 below, the weight center of gravity 10134 of the first weight is positioned at a distance 10142 of 0.379 inch to 0.413 inch from the rear perimeter 10136 of the club head 6710 when the first weight is positioned at the first, second, or third attachment location. Further, the weight center of gravity 10134 of the first weight is positioned at a distance 10138 of 3.219 inches to 4.158 inches from the geometric center 140 of the strike face 38 when the first weight is positioned at the first, second, or third attachment location.

Further referring to Table 2 below, the club head 6710 includes a head CG depth 10130 between 1.561 inches and 1.678 inches, and a head CG height 10132 of 0.055 inch to 0.070 inch above the head depth plane 10120. The exemplary club head 6710 further includes a moment of inertia about the x-axis $I_{xx}$ between 2,961 and 3,408 g·cm$^2$, a moment of inertia about the y-axis $I_{yy}$ between 4,700 and 5,040 g·cm$^2$, and a moment of inertia about the hosel axis $I_{hh}$ between 8,006 and 9,116 g·cm$^2$. The combined moment of inertia of the exemplary club head 6766 about the club head CG (i.e. the sum of the moment of inertia about the x-axis and the moment of inertia about the y-axis) is between 7,661 and 8,448 g·cm$^2$. The combined moment of inertia of the exemplary club head 6766 about the club head CG and the hosel axis (i.e. the sum of the moment of inertia about the x-axis, the moment of inertia about the y-axis, and the moment of inertia about the hosel axis) is between 15,668 and 17,364 g·cm$^2$.

Further referring to Table 2 below, the exemplary club head having the adjustable weighting system 6766 has a depth to mass ratio of the club head CG depth to the mass of the first weight between 0.087 inch and 0.093 inch. Further, the exemplary club head having the adjustable weighting system 6766 has a first inertia to mass ratio of the combined moment of inertia of the club head about the head CG to the mass of the first weight between 426 and 469 cm$^2$. Further still, the exemplary club head having the adjustable weighting system 6766 has a head CG to mass ratio of the maximum shift in head CG to the mass of the first weight of 0.011 inch/gram. Accordingly, the adjustable weighting system 6766 of the exemplary club head 6710 maximizes head CG depth, moment of inertia, and head CG shift by a user, without the use of a large and heavy weight necessitating sizeable weight structures.

TABLE 2

Weighting Properties of Exemplary Golf Club Head 6710

| First weight position | First position (toe) | Second position (heel) | Third position (center) |
|---|---|---|---|
| $W_{CG}$-perimeter 10142 (inch) | 0.413 | 0.390 | 0.379 |
| $W_{CG}$-face center 10138 (inch) | 3.799 | 3.219 | 4.158 |
| $CG_D$ 10130 (inch) | 1.617 | 1.561 | 1.678 |
| $CG_H$ 10132 (inch above head depth plane 10120) | 0.070 | 0.055 | 0.058 |
| $I_{xx}$ (g · cm$^2$) | 3118 | 2961 | 3408 |
| $I_{yy}$ (g · cm$^2$) | 5021 | 4700 | 5040 |
| $I_{hh}$ (g · cm$^2$) | 9116 | 8006 | 8916 |
| $I_{xx} + I_{yy}$ (g · cm$^2$) | 8139 | 7661 | 8448 |
| $I_{xx} + I_{yy} + I_{hh}$ (g · cm$^2$) | 17256 | 15668 | 17364 |
| $CG_D$/mass (inch/g) | 0.090 | 0.087 | 0.093 |
| $I_{xx} + I_{yy}$/mass (cm$^2$) | 452 | 426 | 469 |
| Max CG shift/mass (in/g) | 0.011 | 0.011 | 0.011 |

Moving the weight between the first, second, and third attachment locations results in a maximum shift in the club head center of gravity of 0.20 inch. The maximum shift in center of gravity of the exemplary club head 6710 results in a total trajectory change of up to 9.3 yards (i.e. when shifting the first weight from the first to the second attachment location, or from the second to the first attachment location). Accordingly, shifting the weight from the third attachment location to the second attachment location can change the trajectory of a golf ball 4.6 yards to correct for a slice or generate a draw. Further, shifting the weight from the third attachment location to the first attachment location can change the trajectory of a golf ball 4.6 yards to correct for a hook or generate a fade.

Example 3—Perimeter Channel Adjustable Weighting System for a Driver

According to one example of the golf club head 12010 illustrated in FIGS. 169 and 170, the club head 12010 comprises a volume of 457 cubic centimeters (cc). The exemplary club head 12010 includes a recessed portion 12013 comprising a channel positioned in the trailing edge 12072 along the rear perimeter 10136. The recessed portion 12013 comprises a bottom wall or third surface 12075 having three attachment locations or features comprising threaded apertures. The attachment locations include a first attachment location or feature 12070A near the toe end 12018, a second attachment location or feature 12070C near the heel end 12022, and third attachment location or feature 12070B between the toe end 12018 and the heel end 12022.

The adjustable weighting system 12066 of the exemplary club head 12010 further comprises a first weight 12082 having a mass of 18 grams. The first weight 12082 has a height 10152 of 0.33 inch, a width 10154 of 1.18 inch, and a depth of 0.29 inch. The first weight 12082 comprises an aperture corresponding to a plurality of apertures defining the discrete attachment locations on the club head 12010. The first weight 12082 is secured to the discrete attachment location using a fastener positioned through the aperture in the first weight 12082 and the aperture in club head 12010. The fastener comprises the same material or a material having a lower density than the density of the body, such that the fastener does not significantly contribute to the club head weighting.

The first weight 12082 is positionable at the first attachment location near the toe, the second attachment location near the heel, or the third attachment location between the toe and the heel. Referring to Table 1 below, the weight center of gravity 10134 of the first weight is positioned at a distance 10142 of 0.19 inch to 0.22 inch from the rear perimeter 10136 of the club head 6710 when the first weight is positioned at the first, second, or third attachment location. Further, the weight center of gravity 10134 of the first weight is positioned at a distance 10138 of 3.26 inches to 4.41 inches from the geometric center 140 of the strike face 38 when the first weight is positioned at the first, second, or third attachment location.

Further referring to Table 1 below, the club head 6710 includes a head CG depth 10130 between 1.59 inches and 1.71 inches, and a head CG height 10132 of 0.088 inch to 0.108 inch above the head depth plane 10120. The exemplary club head 6710 further includes a moment of inertia about the x-axis $I_{xx}$ between 3,090 and 3,770 g·cm$^2$, a moment of inertia about the y-axis $I_{yy}$ between 4,936 and 5,383 g·cm$^2$, and a moment of inertia about the hosel axis $I_{hh}$ between 8,815 and 10,359 g·cm$^2$. The combined moment of inertia of the exemplary club head 6766 about the club head CG (i.e. the sum of the moment of inertia about the x-axis and the moment of inertia about the y-axis) is between 8,023 and 9,153 g·cm$^2$. The combined moment of inertia of the exemplary club head 6766 about the club head CG and the hosel axis (i.e. the sum of the moment of inertia about the x-axis, the moment of inertia about the y-axis, and the moment of inertia about the hosel axis) is between 16,841 and 19,237 g·cm$^2$.

Further referring to Table 1 below, the exemplary club head having the adjustable weighting system 6766 has a depth to mass ratio of the club head CG depth to the mass of the first weight between 0.099 inch and 0.106 inch. Further, the exemplary club head having the adjustable weighting system 6766 has a first inertia to mass ratio of the combined moment of inertia of the club head about the head CG to the mass of the first weight between 446 and 508 cm$^2$. Further still, the exemplary club head having the adjustable weighting system 6766 has a head CG to mass ratio of the maximum shift in head CG to the mass of the first weight of 0.015 inch/gram. Accordingly, the adjustable weighting system 6766 of the exemplary club head 6710 maximizes head CG depth, moment of inertia, and head CG shift by a user, without the use of a large and heavy weight necessitating sizeable weight structures.

TABLE 1

Weighting Properties of Exemplary Golf Club Head 6710

| First weight position | First position (toe) | Second position (heel) | Third position (center) |
|---|---|---|---|
| $W_{CG}$-perimeter 10142 (inch) | 0.19 | 0.22 | 0.21 |
| $W_{CG}$-face center 10138 (inch) | 4.19 | 3.26 | 4.41 |
| $CG_D$ 10130 (inch) | 1.67 | 1.59 | 1.72 |
| $CG_H$ 10132 (inch above head depth plane 10120) | 0.108 | 0.088 | 0.086 |
| $I_{xx}$ (g · cm$^2$) | 3457 | 3090 | 3770 |
| $I_{yy}$ (g · cm$^2$) | 5369 | 4936 | 5383 |
| $I_{hh}$ (g · cm$^2$) | 10359 | 8815 | 10084 |
| $I_{xx} + I_{yy}$ (g · cm$^2$) | 8826 | 8026 | 9153 |
| $I_{xx} + I_{yy} + I_{hh}$ (g · cm$^2$) | 19185 | 16841 | 19237 |
| $CG_D$/mass (inch/g) | 0.104 | 0.099 | 0.106 |
| $I_{xx} + I_{yy}$/mass (cm$^2$) | 490 | 446 | 508 |
| Max CG shift/mass (in/g) | 0.015 | 0.015 | 0.015 |

Moving the weight between the first, second, and third discrete attachment locations results in a maximum shift in the club head center of gravity of 0.27 inch. The maximum shift in center of gravity of the exemplary club head 6710 results in a total trajectory change of up to 12.4 yards (i.e. when shifting the first weight from the first to the second attachment location, or from the second to the first attachment location). Accordingly, shifting the weight from the third attachment location to the second attachment location can change the trajectory of a golf ball 6.2 yards to correct for a slice or generate a draw. Further, shifting the weight from the third attachment location to the first attachment location can change the trajectory of a golf ball 6.2 yards to correct for a hook or generate a fade.

Clause 1: A golf club head comprising a club head body having a toe end, a heel end located opposite the toe end, a crown, a sole located opposite the crown, a strike face, and a back end located opposite the strike face, and an adjustable weighting system including a plurality of cylindrical protruding bodies extending from an outer surface of the club head along at least a portion of the sole, and a plurality of weights, each weight configured for coupling to one of the plurality of cylindrical protruding bodies.

Clause 2: The golf club head of clause 1, wherein the outer surface includes a plurality of raised portions, and wherein at least some of the plurality of cylindrical protruding bodies extend from the plurality of raised portions.

Clause 3: The golf club head of clause 1, wherein the outer surface includes a plurality of recessed surfaces, wherein at least some of the plurality of cylindrical protruding bodies extend from the plurality of recessed surfaces.

Clause 4: A golf club head comprising a club head body having an outer surface, the outer surface further defining a recessed portion; and an adjustable weighting system including a rib extending from the recessed portion, the rib including a slot, and a weight configured for engagement with the slot.

Clause 5: The golf club head of clause 4, wherein weight includes a post, wherein the post is configured for engagement with the slot.

Clause 6: A golf club head comprising: a club head body having a toe end, a heel end located opposite the toe end, a crown, a sole located opposite the crown, a strike face, and a trailing edge that extends between the toe end and the heel end and defines an intersection between the sole and the crown, wherein an outer surface is defined on the club head body along a portion of the sole adjacent the trailing edge, the outer surface including a recessed portion; and an adjustable weighting system having a plurality of protruding bodies, each protruding body extending from the recessed portion and configured to removably secure a weight.

Clause 7: The golf club head of clause 6, wherein each of the plurality of protruding bodies is cylindrical in shape.

Clause 8: The golf club head of clause 6, wherein one of the plurality of protruding bodies is a different size than another of the plurality of protruding bodies.

Clause 9: The golf club head of clause 6, wherein the recessed portion comprises a first surface and a second surface.

Clause 10: The golf club head of clause 9, wherein the first surface is perpendicular to the second surface.

Clause 11: The golf club head of clause 9, wherein the first surface is parallel to the second surface.

Clause 12: The golf club head of clause 9, wherein at least one of the plurality of protruding bodies is positioned on the first surface, and wherein at least another of the plurality of protruding bodies is positioned on the second surface.

Clause 13: The golf club head of clause 12, wherein three protruding bodies are positioned on the first surface and a single protruding body is positioned on the second surface.

Clause 14: The golf club head of clause 13, wherein the single protruding body is of a different size than each of the three protruding bodies.

Clause 15: The golf club head of clause 6, wherein the recessed portion extends from the toe or toe end to the heel or heel end generally in an arcuate configuration.

Clause 16: The golf club head of clause 6, wherein the recessed portion includes a first portion, a second portion, and a third portion that all intersect with one another at an intersection region, wherein the first portion extends from the intersection region toward the toe end, wherein the second portion extends from the intersection region toward the heel end, and wherein the third portion extends from the intersection region inwardly toward a center of the sole.

Clause 17: The golf club head of clause 16, wherein the recessed portion defines a channel adjacent the trailing edge.

Clause 18: The golf club head of clause 16, further comprising a plurality of differently-sized weights, each configured for coupling to one of the plurality of protruding bodies.

Clause 19: A golf club head comprising: a club head body having an outer surface; and an adjustable weighting system including a plurality of protruding bodies extending outwardly from the outer surface, each protruding body configured to removably secure a weight.

Clause 20: A golf club head comprising: a club head body having an outer surface; an adjustable weighting system including a plurality of protruding bodies extending outwardly from the outer surface; and a cover configured for coupling to the club head body and overlying at least one of the plurality of protruding bodies.

Clause 21: A golf club head comprising: a club head body having an outer surface; and an adjustable weighting system including a plurality of protruding bodies or notches along a portion of the outer surface, a cable, a tensioner operable to increase or decrease tension in the cable, and at least one weight coupled to the cable and securable to or within one of the protruding bodies or notches via tension in the cable.

Clause 22: A golf club head comprising: a club head body having an outer surface; and an adjustable weighting system including a plurality of protruding bodies or notches positioned along a portion of the outer surface, a cable, a tensioner operable to increase or decrease tension in the cable, and at least one weight having a groove along an outer surface thereof to receive the cable such that the cable presses the at least one weight against one of the protruding bodies or notches upon activation of the tensioner to increase tension in the cable.

Clause 23: A golf club head comprising: a club head body having an outer surface; and an adjustable weighting system including a plurality of protruding bodies or notches positioned along a portion of the outer surface, a cable, a tensioner operable to increase or decrease tension in the cable, and at least one weight having an aperture therethrough, wherein the cable extends through the aperture such that the weight may be adjusted along the cable upon activation of the tensioner to decrease tension in the cable and fixed relative to the outer surface upon activation of the tensioner to increase tension in the cable.

Clause 24: A golf club head comprising: a club head body having an outer surface; and an adjustable weighting system including a plurality of protruding bodies or notches positioned along a portion of the outer surface, a cable, a tensioner operable to increase or decrease tension in the cable, and at least one weight fixed at an end of the cable, wherein the tensioner is configured to retract the cable to secure the weight against one of the protruding bodies or within one of the notches.

Clause 25: A golf club head comprising: a club head body having a toe end, a heel end located opposite the toe end, a crown, a sole located opposite the crown, a strike face, and a perimeter positioned at a junction between the crown and the sole extending from near the heel end to near the toe end; and an adjustable weighting system positioned on the sole, the perimeter, or a combination thereof, the adjustable weighting system including: a plurality of discrete attachment locations; and one or more weights, each having a weight center of gravity, wherein each weight is configured to be coupled to one of the plurality of discrete attachment locations, and each weight is configured to be moveable between the plurality of discrete attachment locations to shift a center of gravity of the club head; wherein: the one or more weights are positioned such that the weight center of gravity of each weight is positioned within 0.50 inch of the perimeter of the club head when the weight is coupled to at least one of the discrete attachment locations; the one or more weights are positioned such that the weight center of gravity of each weight protrudes from an external contour of the sole, or is inset from the external contour of the sole by a distance less than 0.125 inch; and a combined moment of inertia of the club head about the club head center of gravity, defined as the sum of a crown-to-sole moment of inertia and a heel-to-toe moment of inertia, is greater than 8,000 $g \cdot cm^2$.

Clause 26: The golf club head of clause 25, wherein the plurality of discrete attachment locations are selected from the group consisting of: a plurality of protruding bodies, a plurality of recesses, a plurality of apertures, a plurality of notches, a plurality of tabs, a plurality of cutout regions, a plurality of ribs, a plurality of grooves, and a plurality of hooks.

Clause 27: The golf club head of clause 25, wherein the one or more weights comprise a first weight between 10 grams and 20 grams, and the first weight is the heaviest of the one or more weights.

Clause 28: The golf club head of clause 27, wherein the one or more weights further comprise a second weight between 0.25 grams and 10 grams.

Clause 29: The golf club head of clause 25, wherein the plurality of attachment locations are positioned on a recessed portion of the club head.

Clause 30: The golf club head of clause 29, wherein the recessed portion is positioned on the sole, is arcuate in shape, and generally follows the contour of the perimeter of the club head.

Clause 31: The golf club head of clause 29, wherein the recessed portion comprises a maximum depth of 0.25 inch.

Clause 32: The golf club head of clause 29, wherein the plurality of discrete attachment locations comprise a plurality of apertures configured to receive a fastener.

Clause 33: The golf club head of clause 25, wherein the plurality of attachment locations are positioned in a channel extending in a direction from near the toe end to near the heel end of the club head.

Clause 34: The golf club head of clause 33, wherein the maximum depth of the channel is 0.25 inch.

Clause 35: The golf club head of clause 33, wherein the depth of the channel varies from near the toe end to near the heel end of the club head.

Clause 36: The golf club head of clause 33, wherein the width of the channel varies from near the toe end to near the heel end of the club head.

Clause 37: A golf club head comprising: a club head body having a toe end, a heel end located opposite the toe end, a crown, a sole located opposite the crown, a strike face, and a perimeter positioned at a junction between the crown and the sole extending from near the heel end to near the toe end; and an adjustable weighting system positioned on the sole, the perimeter, or a combination thereof, the adjustable weighting system including: a plurality of discrete attachment locations; and a cable, a tensioner operable to increase or decrease tension in the cable, and one or more weights coupled to the cable and securable to or within one of the plurality of discrete attachment locations, wherein each weight is configured to be moveable between the plurality of discrete attachment locations to change a center of gravity of the club head, and each of the one or more weights comprise a weight center of gravity, wherein: the one or more weights are positioned such that the weight center of gravity of each weight is positioned within 0.50 inch of the perimeter of the club head, when the weight is coupled to at least one of the discrete attachment locations; the one or more weights are positioned such that the weight center of gravity of each weight protrudes from an external contour of the sole, or is inset from the external contour of the sole by a distance less than 0.125 inch; and a combined moment of inertia of the club head about the club head center of gravity, defined as the sum of a crown-to-sole moment of inertia and a heel-to-toe moment of inertia, is greater than 8,000 $g \cdot cm^2$.

Clause 38: The golf club head of clause 37, wherein the plurality of discrete attachment locations are selected from the group consisting of: a plurality of protruding bodies, a plurality of recesses, a plurality of apertures, a plurality of notches, a plurality of tabs, a plurality of cutout regions, a plurality of ribs, a plurality of grooves, and a plurality of hooks.

Clause 39: The golf club head of clause 37, wherein the one or more weights comprise a first weight between 10 grams and 20 grams, and the first weight is the heaviest of the one or more weights.

Clause 40: The golf club head of clause 39, wherein the one or more weights further comprise a second weight between 0.25 grams and 10 grams.

Clause 41: The golf club head of clause 37, wherein the one or more weights has a groove along an outer surface thereof to receive the cable such that the cable presses the weight against one of the attachment locations upon activation of the tensioner to increase tension in the cable.

Clause 42: The golf club head of clause 37, wherein the one or more weights has an aperture therethrough, wherein the cable extends through the aperture such that the weight may be adjusted along the cable upon activation of the tensioner to decrease tension in the cable.

Clause 43: The golf club head of clause 37, wherein the one or more weights is fixed at an end of the cable, wherein the tensioner is configured to retract the cable to secure the weight against one of the discrete attachment locations.

Clause 44: A golf club head comprising: a club head body having a toe end, a heel end located opposite the toe end, a crown, a sole located opposite the crown, a strike face, and a perimeter positioned at a junction between the crown and the sole extending from near the heel end to near the toe end; and an adjustable weighting system positioned on the sole, the perimeter, or a combination thereof, the adjustable weighting system including: a plurality of discrete attachment locations; and one or more weights, each having a weight center of gravity, wherein each weight is configured to be coupled to one of the plurality of discrete attachment locations, and each weight is configured to be moveable between the plurality of discrete attachment locations to shift a center of gravity of the club head; wherein: the one or more weights are positioned such that the weight center of gravity of each weight is positioned within 0.50 inch of the perimeter of the club head, when the weight is coupled to at least one of the discrete attachment locations; a combined moment of inertia of the club head about the club head center of gravity, defined as the sum of a crown-to-sole moment of inertia and a heel-to-toe moment of inertia, is greater than 8,000 $g \cdot cm^2$.

Clause 45: The golf club head of clause 44, wherein the one or more weights are positioned such that the weight center of gravity of each weight protrudes from an external contour of the sole, or is inset from the external contour of the sole by a distance less than 0.125 inch.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

The invention claimed is:

1. A golf club head comprising:

a club head body having a toe end, a heel end located opposite the toe end, a crown, a sole located opposite the crown, a strike face, and a perimeter positioned at a junction between the crown and the sole extending from near the heel end to near the toe end; and an adjustable weighting system positioned on the sole, the perimeter, or a combination thereof, the adjustable weighting system including:

a plurality of discrete attachment locations; and a cable, a tensioner operable to increase or decrease tension in the cable, and one or more weights coupled to the cable and securable to or within one of the plurality of discrete attachment locations, wherein each weight is configured to be moveable between the plurality of discrete attachment locations to change a center of gravity of the club head, and each of the one or more weights comprise a weight center of gravity;

wherein:

the one or more weights are positioned such that the weight center of gravity of each weight is positioned within 0.50 inch of the perimeter of the club head, when the weight is coupled to at least one of the discrete attachment locations;

the one or more weights are positioned such that the weight center of gravity of each weight protrudes from an external contour of the sole, or is inset from the external contour of the sole by a distance less than 0.125 inch; and a combined moment of inertia of the club head about the club head center of gravity, defined as the sum of a crown-to-sole moment of inertia and a heel-to-toe moment of inertia, is greater than 8,000 $g \cdot cm^2$.

2. The golf club head of claim 1, wherein the plurality of discrete attachment locations are selected from the group consisting of: a plurality of protruding bodies, a plurality of recesses, a plurality of apertures, a plurality of notches, a plurality of tabs, a plurality of cutout regions, a plurality of ribs, a plurality of grooves, and a plurality of hooks.

3. The golf club head of claim 1, wherein the one or more weights comprise a first weight between 10 grams and 20 grams, and the first weight is the heaviest of the one or more weights.

4. The golf club head of claim 3, wherein the one or more weights further comprise a second weight between 0.25 grams and 10 grams.

5. The golf club head of claim 1, wherein the one or more weights has a groove along an outer surface thereof to receive the cable such that the cable presses the weight against one of the attachment locations upon activation of the tensioner to increase tension in the cable.

6. The golf club head of claim 5, wherein the one or more weights are configured to be adjusted by removing the weight from the cable.

7. The golf club head of claim 1, wherein the one or more weights has an aperture therethrough, wherein the cable extends through the aperture such that the weight may be adjusted along the cable upon activation of the tensioner to decrease tension in the cable.

8. The golf club head of claim 7, wherein the one or more weights are configured to be adjusted without being removed from the cable.

9. The golf club head of claim 1, wherein the one or more weights is fixed at an end of the cable, wherein the tensioner is configured to retract the cable to secure the weight against one of the discrete attachment locations.

10. The golf club head of claim 1, wherein the cable is a metallic wire rope selected from the group consisting of steel, aluminum, copper, tungsten, nickel, and silver.

11. The golf club head of claim 1, wherein the adjustable weighting system further comprises a plurality of guide elements configured to receive and guide the cable.

12. The golf club head of claim 11, wherein at least one guide element is configured to re-route the cable back to the tensioner.

13. The golf club head of claim 12, wherein the cable is looped through the plurality of guide elements to form a web network.

14. The golf club head of claim 1, wherein the tensioner is configured to increase or decrease the tension of the cable in a first configuration, and wherein the tensioner is configured to lock the tension of the cable in a second configuration.

15. The golf club head of claim 1, wherein the tensioner is configured to receive a tool to adjust the tension in the cable.

* * * * *